US011009820B2

(12) United States Patent
Kakigahara et al.

(10) Patent No.: US 11,009,820 B2
(45) Date of Patent: May 18, 2021

(54) FIXING DEVICE FIXING DEVELOPING AGENT IMAGE TO SHEET BY ELECTROSTATICALLY SPRAYING CHARGED FIXING SOLUTION

(71) Applicant: Brother Kogyo Kabushiki Kaisha, Nagoya (JP)

(72) Inventors: Yutaka Kakigahara, Nagoya (JP); Kengo Takeda, Tokai (JP); Jun Mihara, Nagoya (JP); Satoshi Murata, Nagoya (JP); Shinya Yamamoto, Nagoya (JP); Tomoaki Hattori, Nagoya (JP); Kumiko Sakaguchi, Nagoya (JP); Takayuki Higuchi, Anpachi-gun (JP); Tatsuya Ezaka, Kariya (JP); Emi Shimizu, Nagoya (JP); Kentaro Murayama, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 16/556,320

(22) Filed: Aug. 30, 2019

(65) Prior Publication Data

US 2019/0391517 A1 Dec. 26, 2019

Related U.S. Application Data

(63) Continuation of application No. 15/940,106, filed on Mar. 29, 2018, now Pat. No. 10,509,351, which is a (Continued)

(30) Foreign Application Priority Data

Sep. 30, 2015 (JP) ..... JP2015-194631
Sep. 30, 2015 (JP) ..... JP2015-194654
(Continued)

(51) Int. Cl.
*G03G 15/00* (2006.01)
*G03G 15/20* (2006.01)

(52) U.S. Cl.
CPC ..... *G03G 15/2096* (2013.01); *G03G 15/50* (2013.01); *G03G 15/20* (2013.01)

(58) Field of Classification Search
CPC ..... G03G 15/2096; G03G 15/50; G03G 15/20
See application file for complete search history.

(56) References Cited

U.S. PATENT DOCUMENTS 6,705,711 B1 3/2004 Richards
7,599,653 B2 10/2009 Asakura et al.
(Continued)

FOREIGN PATENT DOCUMENTS

CN 100507738 C 7/2009
JP H09-156109 A 6/1997
(Continued)

OTHER PUBLICATIONS

Mar. 4, 2020—(CN) Notification of First Office Action—App 201680056865.7, Eng Tran.
(Continued)

*Primary Examiner* — Yaovi M Ameh
(74) *Attorney, Agent, or Firm* — Banner & Witcoff, Ltd.

(57) ABSTRACT

A fixing device is for fixing a developing agent image to a recording sheet by electrostatically spraying a charged fixing solution toward the developing agent image on the sheet. The fixing device includes a container portion, a plurality of nozzles, and a potential difference generating portion. The container portion is configured to store therein the fixing solution. The plurality of nozzles is in communication with the container portion and configured to spray the fixing solution toward the developing agent image. The potential difference generating portion is configured to generate a (Continued)

potential difference between the fixing solution stored in the plurality of nozzles and the recording sheet conveyed at a position separated from the plurality of nozzles.

19 Claims, 112 Drawing Sheets

Related U.S. Application Data continuation-in-part of application No. PCT/JP2016/079034, filed on Sep. 30, 2016.

(30) Foreign Application Priority Data

| | | |
|---|---|---|
| Sep. 30, 2015 | (JP) | JP2015-194754 |
| Dec. 25, 2015 | (JP) | JP2015-253038 |
| Dec. 25, 2015 | (JP) | JP2015-253388 |
| Mar. 15, 2016 | (JP) | JP2016-050499 |
| Mar. 15, 2016 | (JP) | JP2016-050502 |
| Mar. 15, 2016 | (JP) | JP2016-050505 |
| Mar. 15, 2016 | (JP) | JP2016-050783 |
| Mar. 15, 2016 | (JP) | JP2016-050784 |

(56) References Cited

U.S. PATENT DOCUMENTS

| | | | | |
|---|---|---|---|---|
| 7,747,207 | B2 | 6/2010 | Tanaka et al. | |
| 7,904,011 | B2 | 3/2011 | Arizumi et al. | |
| 7,970,318 | B2 | 6/2011 | Iwamatsu et al. | |
| 2003/0049177 | A1* | 3/2003 | Smith | B01L 3/0268 506/29 |
| 2003/0080142 | A1 | 5/2003 | Meheen | |
| 2004/0021017 | A1 | 2/2004 | Sumiyoshi et al. | |
| 2005/0146545 | A1 | 7/2005 | Richards | |
| 2007/0098422 | A1 | 5/2007 | Asakura et al. | |
| 2007/0109384 | A1 | 5/2007 | Takeda et al. | |
| 2007/0196146 | A1 | 8/2007 | Tanaka et al. | |
| 2007/0212136 | A1 | 9/2007 | Asakura et al. | |
| 2007/0264058 | A1* | 11/2007 | Mukai | G03G 15/2096 399/307 |
| 2008/0069612 | A1* | 3/2008 | Nakamura | G03G 15/2064 399/340 |
| 2009/0041501 | A1 | 2/2009 | Iwamatsu et al. | |
| 2009/0067868 | A1 | 3/2009 | Arizumi et al. | |
| 2009/0324309 | A1 | 12/2009 | Nakamura et al. | |
| 2012/0007906 | A1 | 1/2012 | Zhang | |
| 2014/0160207 | A1 | 6/2014 | Byun et al. | |
| 2014/0205337 | A1 | 7/2014 | Notoya | |

FOREIGN PATENT DOCUMENTS

| | | | | | |
|---|---|---|---|---|---|
| JP | 2001-188426 | A | | 7/2001 | |
| JP | 2003-080142 | A | | 3/2003 | |
| JP | 2003-341106 | A | | 12/2003 | |
| JP | 2005-022318 | A | | 1/2005 | |
| JP | 2005-518278 | A | | 6/2005 | |
| JP | 2005-212286 | A | | 8/2005 | |
| JP | 2005-225230 | A | | 8/2005 | |
| JP | 2006-264188 | A | | 10/2006 | |
| JP | 2007-225730 | A | | 9/2007 | |
| JP | 2007-233197 | A | | 9/2007 | |
| JP | 2008-185704 | A | | 8/2008 | |
| JP | 2008-203361 | A | | 9/2008 | |
| JP | 2008-276037 | A | | 11/2008 | |
| JP | 2009-069256 | A | | 4/2009 | |
| JP | 2009-122149 | A | | 6/2009 | |
| JP | 2009-265506 | A | | 11/2009 | |
| JP | 2010-032858 | A | | 2/2010 | |
| JP | 2010-061076 | A | | 3/2010 | |
| JP | 2010061076 | A | * | 3/2010 | G03G 15/20 |
| JP | 2010-091663 | A | | 4/2010 | |
| JP | 2012-020408 | A | | 2/2012 | |
| JP | 2013-082151 | A | | 5/2013 | |
| JP | 2014-094565 | A | | 5/2014 | |
| JP | 2014-193557 | A | | 10/2014 | |
| JP | 2015-083294 | A | | 4/2015 | |
| WO | 2007/058317 | A1 | | 5/2007 | |

OTHER PUBLICATIONS

May 26, 2020—(EP) Extended Search Report—App 20157737.6.
Dec. 24, 2019—(JP) Notice of Reasons for Refusal—App 2015-253388, Eng Tran.
Oct. 15, 2019—(JP) Office Action—App 2015-194631, Eng Tran.
Dec. 13, 2016—International Search Report—Intl App PCT/JP2016/079034.
Apr. 12, 2018—(WO) International Preliminary Report on Patentability—App PCT/JP2016/079034, Eng Tran.
Mar. 28, 2019—(EP) Extended Search Report—App 16851853.8.
May 28, 2019—(JP) Office Action—App 2015-194631, Eng Tran.
Aug. 6, 2019—(JP) Office Action—App 2015-253038, Eng Tran.
Dec. 17, 2020—(CN) Notification of the Second Office Action—App 201680056865.7, Eng Tran.

* cited by examiner

FIXING DEVICE FIXING DEVELOPING AGENT IMAGE TO SHEET BY ELECTROSTATICALLY SPRAYING CHARGED FIXING SOLUTION

CROSS REFERENCE TO RELATED APPLICATION

This application is a continuation of prior U.S. application Ser. No. 15/940,106, filed Mar. 29, 2018, which is a by-pass continuation-in-part application of International Application No. PCT/JP2016/079034 filed Sep. 30, 2016 in the Japan Patent Office acting as Receiving Office and claiming priorities from Japanese Patent Application Nos. 2015-194631 filed Sep. 30, 2015, 2015-194654 filed Sep. 30, 2015, 2015-194754 filed Sep. 30, 2015, 2015-253038 filed Dec. 25, 2015, 2015-253388 filed Dec. 25, 2015, 2016-050499 filed Mar. 15, 2016, 2016-050502 filed Mar. 15, 2016, 2016-050505 filed Mar. 15, 2016, 2016-050783 filed Mar. 15, 2016, and 2016-050784 filed Mar. 15, 2016. The entire contents of the prior applications are incorporated herein by reference.

TECHNICAL FIELD

The present invention relates to a fixing device provided in an image forming apparatus for fixing toner image onto a sheet.

BACKGROUND

An electro-photographic type image forming apparatus known in the art includes a fixing device in which transferred toner image is melted by heating to fix the toner to a sheet. The fixing device includes a heater such as a halogen heater and a ceramic heater for melting the toner. The molten toner is pressed against the sheet and is fixed to the sheet. Such type of fixing device becomes widespread because of high fixing speed and high imaging quality. However, the image forming apparatus provided with such fixing device is unsuitable in terms of electric power saving because large amount of electric power is required for heating the toner.

In order to solve the above-described problem, there exists an image forming apparatus provided with a fixing device in which a fixing solution for dissolving or swelling toner is applied onto a toner on the sheet to fix the toner image to the sheet. According to such fixing device, heating treatment for melting the toner is not required contrary to the thermal fixing type, providing low electricity consumption which leads to power saving. The fixing solution is coated on a surface of a roller, and the fixing solution on the roller is brought into contact with the toner image for coating the fixing solution onto the toner image.

According to a fixing device described in Patent Document 1, physaliform fixing solution is held on a fixing roller, and the physaliform fixing solution is coated on the toner image, so that the fixing solution melts the toner for fixing the toner image.

According to another method for coating fixing solution onto the toner image, the fixing solution is coated on the toner image in contactless manner by using a spraying device (see Patent Document 2). The fixing device includes spraying means for spraying the fixing solution toward the sheet, and second charging means to which electric voltage is applied. The fixing solution is coated on the toner image by electrostatic spraying.

According to the fixing device disclosed in Patent Document 2, a heater is provided for adjusting temperature of the fixing solution to maintain the liquid at a constant temperature. Viscosity of the fixing solution is changed dependent on the temperature. Regarding the fixing solution whose viscosity is lowered in accordance with elevation of temperature, supplying amount of the fixing solution is increased in accordance with the temperature elevation, wastefully consuming the fixing solution. This drawback must be overcome.

Patent Document 3 discloses a fixing device in which the fixing solution is sprayed onto a developing agent image. This fixing device includes a shutter movable in a widthwise direction of a recording sheet. The shutter is positioned to shut off the spray of the fixing solution at a position between the recording sheet and a spraying head. The shutter is so controlled that the widthwise position of the shutter is changed in accordance with a type of the recording sheet. This structure prevents the sprayed liquid from being deposited on an article other than the recording sheet.

PATENT DOCUMENTS

Patent Document 1: Japanese Patent Application Publication No. 2008-185704

Patent Document 2: Japanese Patent Application Publication No. 2009-69256

Patent Document 3: Japanese Patent Application Publication No. 2010-61076

SUMMARY

However, according to the fixing device disclosed in Patent Document 1, toner molten by the fixing solution may be adhered onto the fixing roller during coating the fixing solution on the toner image by the fixing roller which causes artifacting after fixing. As an example, since the fixing roller and the toner image are in contact with each other, a problem of offset may occur, that is, unfixed toner image may be transferred toward the roller.

Further, according to the fixing device disclosed in Patent Document 2, the problem of offset does not occur because of contactless coating of the fixing solution with respect to the toner image by way of the spraying device. However, a tip end of the nozzle of the spraying means may be polluted by the toner image in case of a contact of the sheet with the nozzle due to curling of the sheet. Further, the sheet may be floated up toward the spraying means due to electric field generated between the spraying means and the second charging means. Thus, the tip end of the nozzle may contaminated by the toner image formed on the sheet. In this case, the toner adhered onto the tip end of the nozzle may also be sprayed along with the fixing solution, to affect fixing quality.

Further, in the fixing device disclosed in Patent Document 2, appropriate control to spray the fixing solution to the recording sheet is not contemplated.

Further, in the fixing device disclosed in Patent Document 2, spraying of the fixing solution subject to a predetermined controlling condition without checking a state of the fixing solution may cause shortcoming under unexpected conditions.

Further, in the fixing device disclosed in Patent Document 3, fixing solution is consumed wastefully since the liquid may also be sprayed on the shutter.

Further, the fixing device disclosed in Patent Document 2 is unsuitable for the purpose of power saving, since the fixing device includes the heater.

Further, in the fixing device employing electrostatic spraying system disclosed in Patent Document 2, if the fixing solution is adhered to and remains on an outer surface of the nozzle at a time of termination of spraying the fixing solution from the nozzle, normal spraying operation may not be achievable at a start of next spraying.

In view of the foregoing, a first object of the present invention is to restrain distortion or degradation of toner image after fixing operation using fixing solution.

Further, a second object of the present invention is to restrain adhesion of the fixing solution sprayed by electrostatic spraying onto a conveyance surface.

Further, a third object of the present invention is to restrain contamination to the tip end of the nozzle with the toner on the sheet.

Further, a fourth object of the present invention is to compute an amount of spray with high accuracy in a fixing device in which fixing solution is sprayed by means of electrostatic spraying.

Further, a fifth object of the present invention is to provide a fixing device capable of performing control to properly spray the fixing solution toward the recording sheet.

Further, a sixth object of the present invention is to provide a fixing device capable of grasping a state of the fixing solution.

Further, a seventh object of the present invention is to restrain wasteful consumption of the fixing solution.

Further, an eighth object of the present invention is to perform a proper electrostatic spraying coping with ambient circumstance while restraining electrical power consumption.

Further, a ninth object of the present invention is to restrain adhesion of the fixing solution to an outer peripheral surface of the nozzle through which the fixing solution is sprayed.

Further, a tenth object of the present invention is to remove the fixing solution adhered to the outer peripheral surface of the nozzle through which the fixing solution is sprayed.

In order to attain the first object, according to a first invention, there is provided a fixing device for fixing a developing agent image to a recording sheet by electrostatically spraying a charged fixing solution toward the developing agent image on the sheet. The fixing device includes a container portion, a plurality of nozzles, and a potential difference generating portion. The container portion is configured to store therein the fixing solution. The plurality of nozzles is in communication with the container portion and configured to spray the fixing solution toward the developing agent image. The potential difference generating portion is configured to generate a potential difference between the fixing solution stored in the plurality of nozzles and the recording sheet conveyed at a position separated from the plurality of nozzles.

BRIEF DESCRIPTION OF THE DRAWINGS

The particular features and advantages of the embodiment(s) as well as other objects will become apparent from the following description taken in connection with the accompanying drawings, in which:

FIG. 119 is a flowchart illustrating operation in a controller;

FIGS. 120A through 120C are views illustrating states where fixing solution adhered to an outer peripheral surface of a nozzle is removed; and FIG. 121 is a flowchart illustrating operation in the controller according to a modification to the tenth embodiment.

DETAILED DESCRIPTION

A fixing device of a first embodiment of the present invention will be described in detail with reference to FIGS. 1 to 17. In the following description, an overall configuration of a laser printer will be first described as one example of image forming devices, and then features of the present invention will be described in detail.

Figure 1:
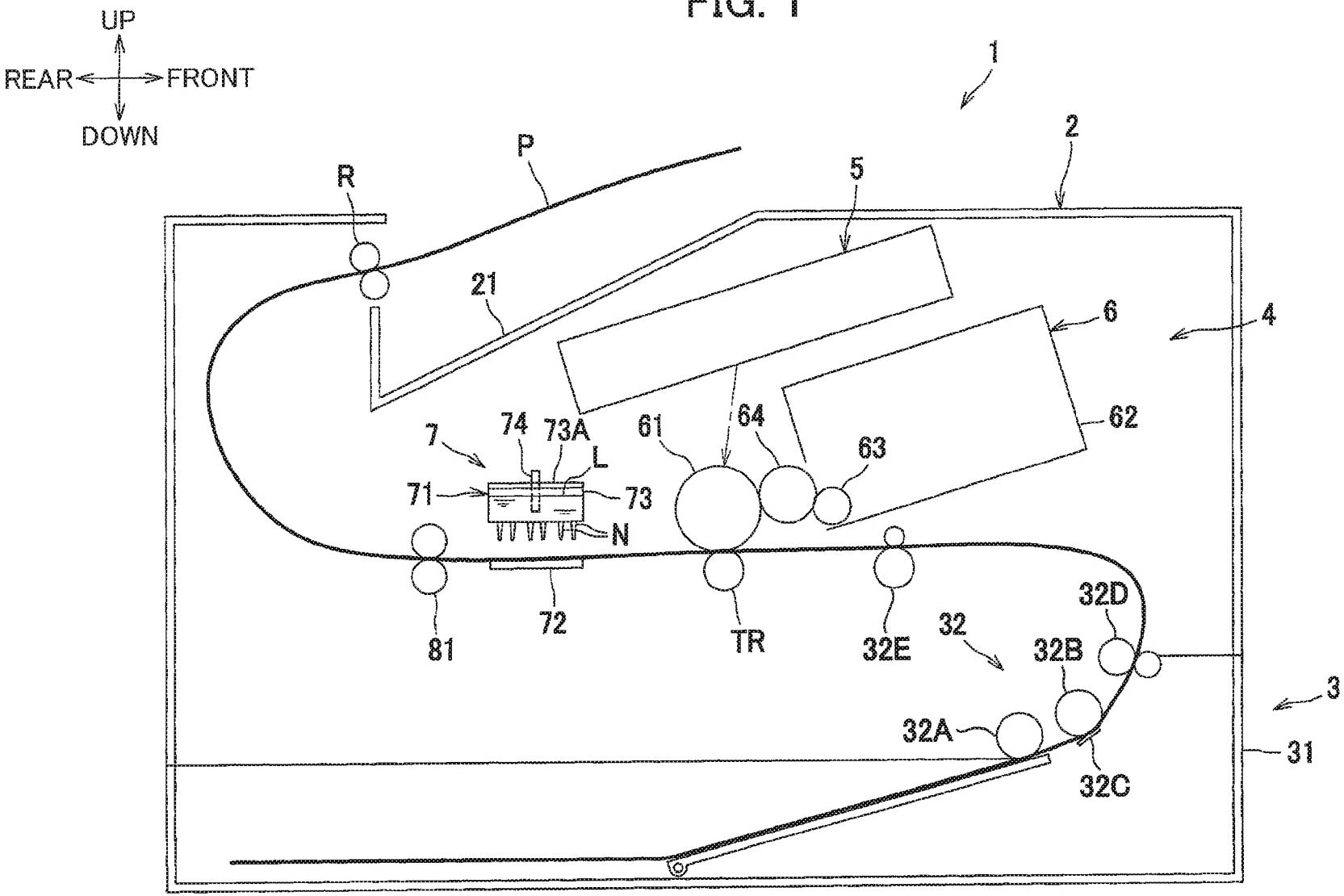
FIG. 1 is a view illustrating a laser printer provided with a fixing device according to a first embodiment of the present invention.

In the following description, directions are defined with respect to a position of a user using the laser printer. That is, the right side of FIG. 1 is defined as a front side, the left side of FIG. 1 is defined as a rear side, the far side of FIG. 1 is defined as a right side, and the near side of FIG. 1 is defined as a left side. The upward and downward directions of FIG. 1 are defined as an upward direction and a downward direction.

As illustrated in FIG. 1, a laser printer 1 includes a casing 2, a feeder portion 3, and an image forming section 4. The feeder portion 3 is used to feed paper P, which is one example of recording sheets and recording objects. The image forming section 4 is used to form an image on the paper P.

The feeder portion 3 includes a paper feed tray 31 which is detachably attached to a lower portion of the casing 2, and a paper feed mechanism 32 which is configured to feed the paper P in the paper feed tray 31 toward the image forming section 4.

The paper feed mechanism 32 includes a pickup roller 32A which is configured to feed the paper P from the paper feed tray 31, a separation roller 32B and a separation pad 32C which is configured to separate the paper P one by one, a paper dust removal roller 32D which is configured to remove paper dust on the paper P, and a registration roller 32E which aligns the leading edge of the paper P. On the downstream side of the registration roller 32E in the conveyance direction of the paper P, a paper sensor SP is disposed to detect the paper P.

The image forming section 4 is housed in the casing 2, and mainly includes a scanner unit 5, a process cartridge 6, a transfer roller TR, and a fixing device 7 which is one example of spraying devices.

The scanner unit 5 is disposed in an upper portion of the casing 2, and includes a laser-emitting portion, a polygon mirror, a lens, and a reflecting mirror, which are not illustrated in FIG. 1. The scanner unit 5 is configured to irradiate the surface of a later-described photosensitive drum 61 with a laser beam with high-speed scanning.

The process cartridge 6 is detachably attached to the casing 2. The process cartridge 6 includes the photosensitive drum 61 on which an electrostatic latent image is to be formed; a charger (not illustrated); a toner container portion 62 containing toner, which is one example of developing agent; and a supply roller 63 and a developer roller 64 which supply the toner in the toner container portion 62 to the photosensitive drum 61.

In the process cartridge 6, the charger (not illustrated) is configured to uniformly charge the surface of the rotating photosensitive drum 61. The scanner unit 5 is configured to emit the laser beam to the surface of the photosensitive drum 61, and thereby expose the surface of the photosensitive drum 61. With this operation, an electrostatic latent image is formed on the surface of the photosensitive drum 61 in accordance with corresponding image data.

The developer roller 64, which is being driven to rotate, is configured to supply the toner to the electrostatic latent image of the photosensitive drum 61 to form a toner image on the surface of the photosensitive drum 61. The toner image on the surface of the photosensitive drum 61 is pulled toward the transfer roller TR and transferred onto the paper P while the paper P is being conveyed between the photosensitive drum 61 and the transfer roller TR.

The fixing device 7 is configured to spray electrically charged fixing solution L toward the toner image on the paper P and fixes the toner image to the paper P under the electrostatic spraying method. A configuration of the fixing device 7 will be described in detail later.

A downstream side conveyance roller 81 is provided on the downstream side of the fixing device 7 in order to convey the paper P, which is discharged from the fixing device 7, to the downstream side. The paper P conveyed by the downstream side conveyance roller 81 is conveyed to a discharge roller R, and then discharged from the discharge roller R onto a paper discharge tray 21.

Next, the configuration of the fixing device 7 will be described in detail.

The fixing device 7 includes a fixing head 71 and a second electrode 72. The fixing head 71 is configured to spray the fixing solution L, which is one example of liquids. The second electrode 72 is disposed below the fixing head 71 so as to face the paper P. In other words, the second electrode 72 is disposed at a position at which the second electrode 72 faces the fixing head 71. Here, the rollers (including the photosensitive drum 61, the transfer roller TR, and the downstream side conveyance roller 81) disposed on the upstream side or the downstream side of the fixing device 7 constitute a conveyance mechanism which is configured to convey the paper P toward a space between later-described nozzles N and the second electrode 72, in a direction extending from a front side toward a rear side of the fixing head 71.

The fixing solution, which is used for satisfactorily performing the electrostatic spraying and the fixing, may be a high-permittivity solvent in which a toner-melting solute is dispersed. The high-permittivity solvent may be water, which is free from danger. That is, in the present embodiment, the toner is melt by the toner-melting solute dispersed in the water, or by an oil in water emulsion. That is, the fixing solution used includes the water as a solvent with an insoluble or hardly-soluble solute being dispersed therein. The solute may be an aliphatic monocarboxylic acid ester, such as ethyl laurate, butyl laurate, isopropyl laurate, ethyl myristate, butyl myristate, isopropyl myristate, ethyl palmitate, butyl palmitate, or isopropyl palmitate, an aliphatic dicarboxylic acid ester, such as diethyl succinate, or dibutyl succinate, an aliphatic tricarboxylic acid ester, such as triethyl o-acetyl citrate, or tributyl o-acetyl citrate, an aliphatic dicarboxylic acid dialkoxyalkyl, such as diethoxyethyl succinate, or dibutoxyethyl succinate, a carbonic acid ester, such as ethylene carbonate, or propylene carbonate. These solutes can soften the toner.

In addition, a surfactant may be added to produce the emulsion having its sufficient quality. The surfactant may be an anionic surfactant, a cationic surfactant, or a nonionic surfactant. The anionic surfactant may be a higher fatty acid salt such as sodium laurate, an alkylaryl sulfonate salt such as sodium dodecylbenzenesulfonate, an alkyl sulfate ester salt such as sodium dodecyl sulfate, a polyoxyethylene alkyl ether sulfate ester salt such as sodium polyethoxyethylene laurylether sulfate, or a polyoxyethylene alkylaryl ether sulfate ester salt such as polyoxyethylene nonylphenyl ether sodium sulfate. The cationic surfactant may be aliphatic amine salt, aliphatic quaternary ammonium salt, benzalkonium chloride, benzethonium chloride, pyridinium salt, or imidazolinium salt. The nonionic surfactant may be a polyoxyethylene alkyl ether such as polyoxyethylene laurylether, a polyoxyethylene alkyl phenyl ether such as polyoxyethylene nonylphenyl ether, a sorbitan higher fatty acid ester such as sorbitan monolaurate, a polyoxyethylene sorbitan higher fatty acid ester such as polyoxyethylene sorbitan monolaurate, a polyoxyethylene higher fatty acid ester such as polyoxyethylene monolaurate, or a sucrose fatty acid ester such as sucrose lauric acid ester.

The fixing head 71 includes a container portion 73 which contains the fixing solution L, a plurality of nozzles N which communicates with the container portion 73 and sprays the fixing solution L toward the toner image, and a first electrode 74 which is configured to apply a voltage to the fixing solution L contained in the container portion 73 and the nozzles N. The first electrode 74 penetrates a top wall 73A of the container portion 73 downward. The lower end portion of the first electrode 74 is positioned in the fixing solution L contained in the container portion 73, and the upper end portion of the first electrode 74 is connected to a controller which has a voltage applying portion (not illustrated).

The second electrode 72 is configured to be contact with the paper P so as to generate a potential difference (electric field) between the fixing solution L contained in the nozzles N and the paper P. The second electrode 72 is disposed below the nozzles N so as to be separated from the tip ends of the nozzles N by a predetermined distance. Here, the predetermined distance is larger than the thickness of the paper P, and determined through an experiment or a simulation so that the electrostatic spraying can be satisfactorily performed. The second electrode 72 may be grounded, or may be applied with a voltage lower than a voltage applied to the first electrode 74. The voltage applied to the second electrode 72 may have a reverse polarity to the polarity of the voltage applied to the first electrode 74. In the case where the second electrode 72 is grounded, the voltage applied to the first electrode 74 is preferably 1 to 10 kV.

When the voltage is applied to the first electrode 74, an electric field is produced in a space in the vicinity of the tip ends of the nozzles N. As a result, at a tip end of each nozzle N, the fixing solution L is pulled by the electric field to form a so-called Taylor cone. Then the fixing solution L is pulled off from the tip of the Taylor cone, and forms a fine droplet.

The droplet-like fixing solution L, sprayed by the nozzles N, is positively charged. In contrast, the paper P has a substantially zero potential. As a result, the droplet-like fixing solution L flies toward the paper P due to Coulomb force, and adheres to the paper P or the toner image.

The first electrode 74 and the second electrode 72, configured in such a manner, constitute a potential difference generating portion which generates a potential difference between the fixing solution L contained in the nozzles N and the paper P which is being conveyed and passing through a position separated from the nozzles N.

Figure 2A:
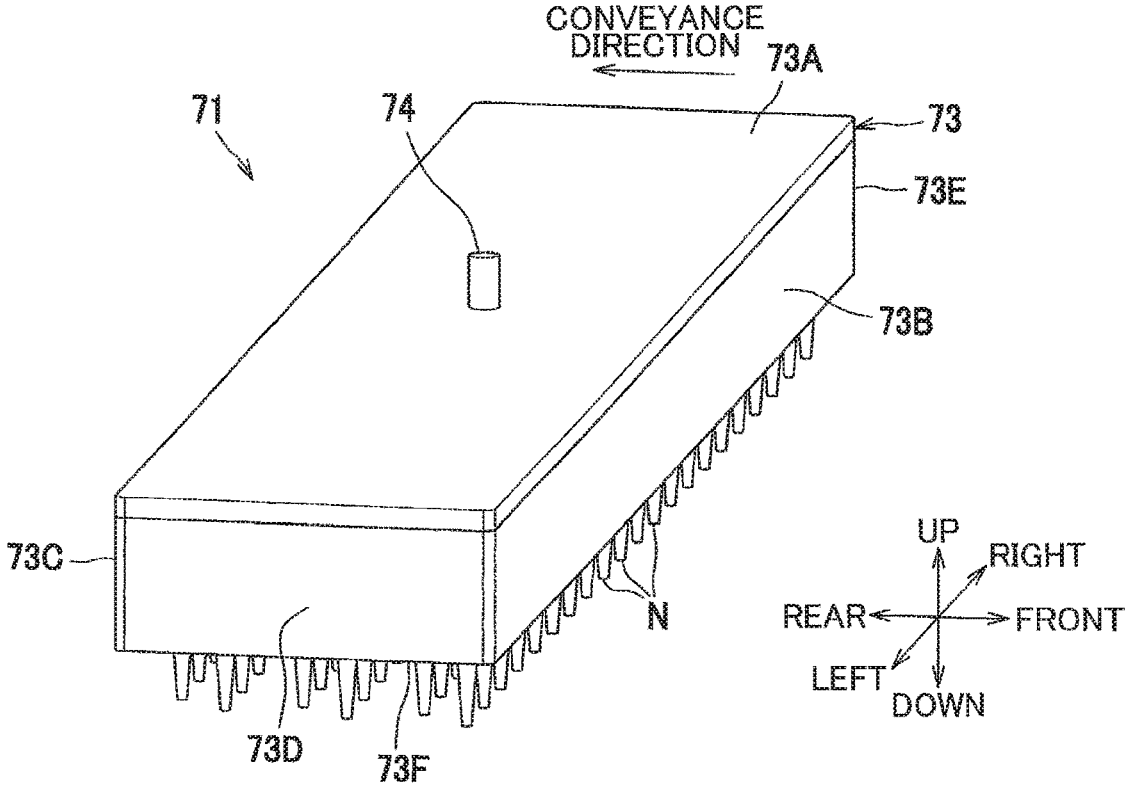
FIG. 2A is a perspective view of a fixing head as viewed from diagonally above.

As illustrated in FIG. 2A, the container portion 73 is a rectangular container which is elongated in a left-right direction, that is, a width direction of the paper P (direction orthogonal to the conveyance direction). The container portion 73 has the top wall 73A, a front wall 73B, a rear wall 73C, a left wall 73D, a right wall 73E, and a bottom wall 73F.

Figure 2B:
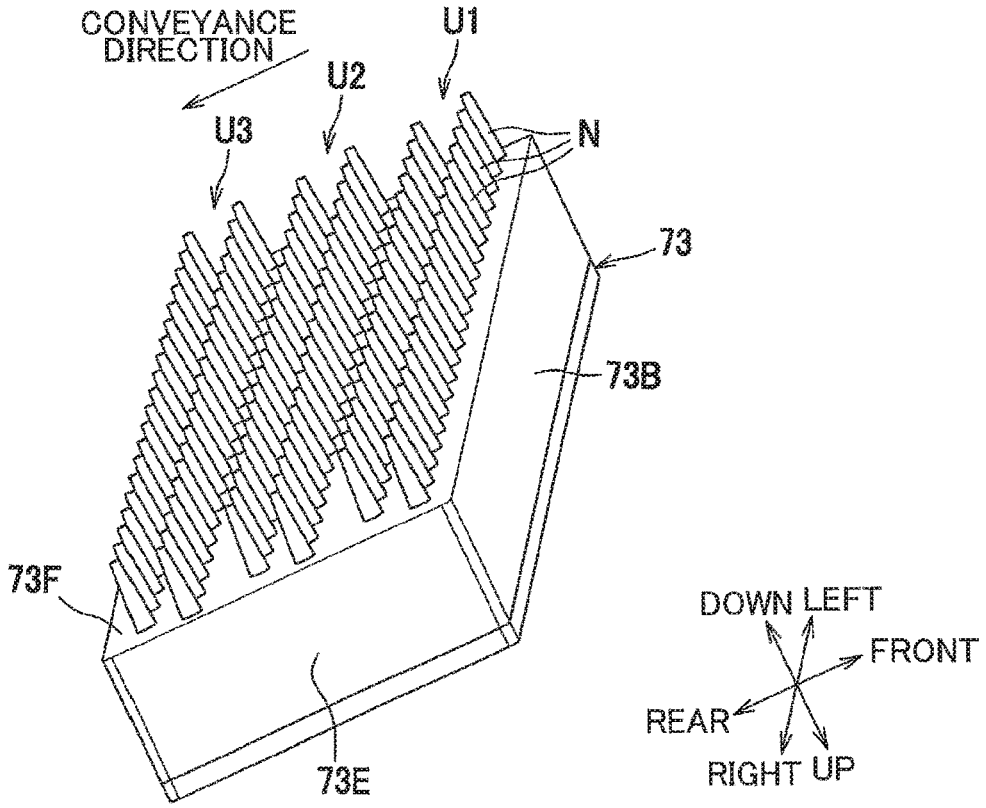
FIG. 2B is a perspective view of the fixing head as viewed from diagonally below.

As illustrated in FIG. 2B, the plurality of nozzles N protrudes downward from the bottom wall 73F of the container portion 73, with their diameters gradually reduced as they extend downward. The plurality of nozzles N is disposed such that a plurality of lines of nozzles N is arranged one after another in the conveyance direction of the paper P, that is, the front-rear direction, and that each line has a plurality of nozzles arranged in the width direction of the paper P, that is, the left-right direction.

Specifically, the plurality of nozzles N constitute three staggered array groups U1, U2, and U3, disposed in the conveyance direction. In the following description, the staggered array group U1 positioned at the front end is referred to also as a first staggered array group U1, the staggered array group U2 positioned on the downstream side of the first staggered array group U1 in the conveyance direction is referred to also as a second staggered array group U2, and the staggered array group U3 positioned at the rear end is referred to also as a third staggered array group U3.

Figure 3A:
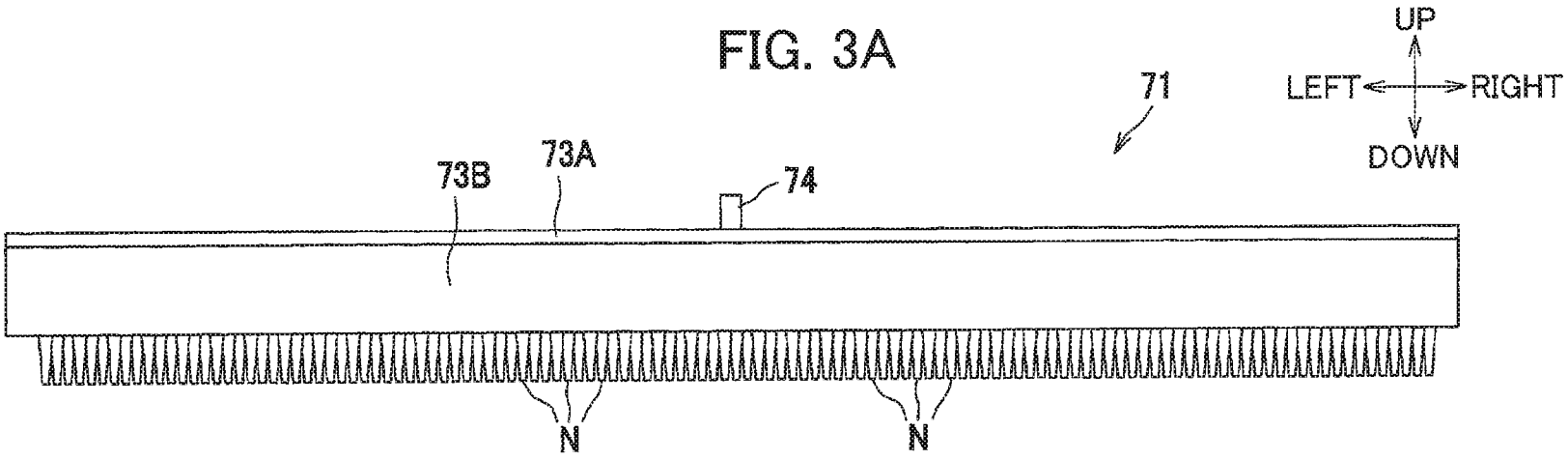
FIG. 3A is a front view of the fixing head.
Figure 3B:
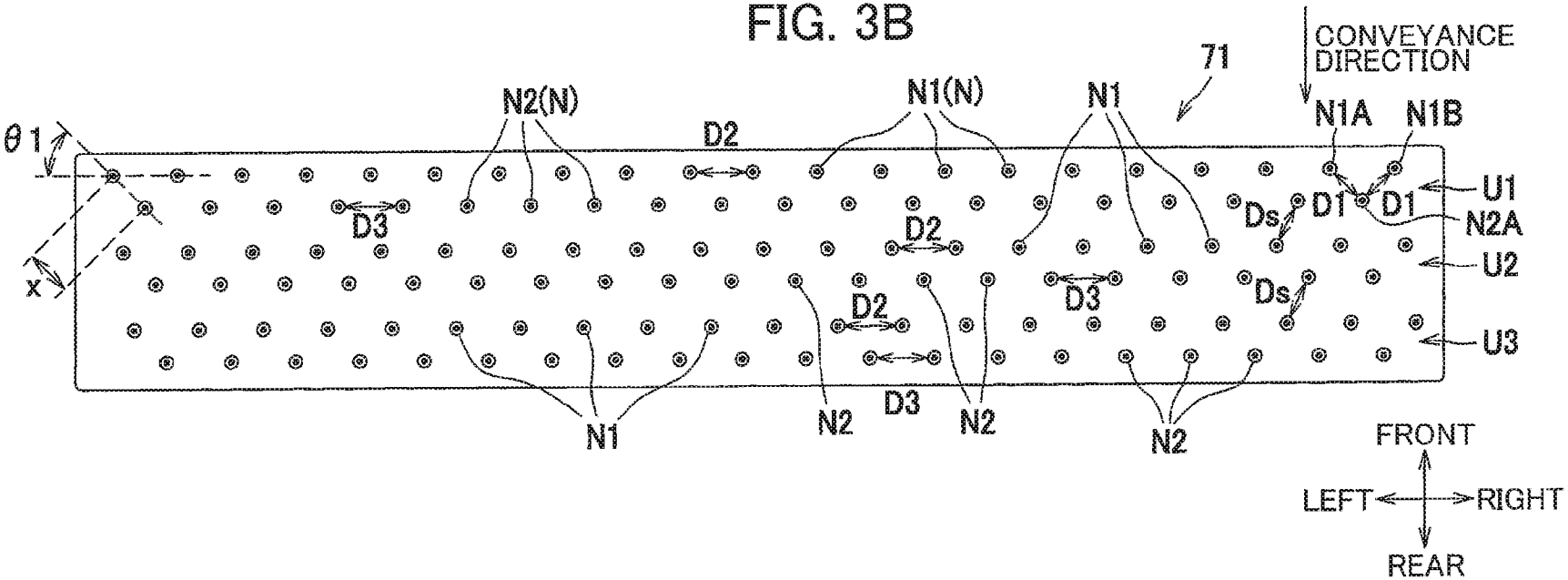
FIG. 3B is a bottom view of the fixing head.

As illustrated in FIGS. 3A and 3B, the first staggered array group U1 includes a first nozzle line and a second nozzle line. The first nozzle line includes a plurality of first nozzles N1 arranged in the width direction at regular second intervals D2. The second nozzle line includes a plurality of second nozzles N2 arranged in the width direction at regular third intervals D3. The first nozzles N1 and the second nozzles N2 are alternately arranged in the width direction with the first nozzles N1 disposed in one side with respect to the conveyance direction and with the second nozzles N2 disposed in the other side with respect to the conveyance direction. In the first embodiment, the second interval D2 is equal to the third interval D3. When viewed in the conveyance direction, each of the second nozzles N2 is interposed between two first nozzles N1 which are adjacent to the second nozzle N2 in the width direction. The plurality of first nozzles N1 of the first nozzle line is arranged on a straight line extending in the left-right direction. The plurality of second nozzles N2 of the second nozzle line is arranged on a straight line extending in the left-right direction. The first nozzle line is disposed on the upstream side of the second nozzle line in the conveyance direction.

Hereinafter, the description will be made in detail. The first nozzle line includes a first nozzle N1A, and another first nozzle N1B which is adjacent to the first nozzle N1A in the width direction. The second nozzle line includes a second nozzle N2A which is adjacent to the first nozzle N1A and the first nozzle N1B in the conveyance direction. When viewed in the conveyance direction, the second nozzle N2A is interposed between the first nozzle N1A and the first nozzle N1B. The distance between the first nozzle N1A and the second nozzle N2A, and the distance between the first nozzle N1B and the second nozzle N2A are set to a first interval D1. In other words, a shape formed by lines connecting two first nozzles N1 adjacent to each other in the width direction and one second nozzle N2 interposed between the two first nozzles N1 in the width direction forms an isosceles triangle.

The second staggered array group U2 and the third staggered array group U3 have the same structure as that of the first staggered array group U1. That is, each of the second staggered array group U2 and the third staggered array group U3 includes a first nozzle line and a second nozzle line. The first nozzle line includes the plurality of first nozzles N1 arranged in the width direction at regular second intervals D2. The second nozzle line includes the plurality of second nozzles N2 arranged in the width direction at regular third intervals D3. The first nozzle line is disposed on the upstream side of the second nozzle line in the conveyance direction. The plurality of first nozzles N1 and the plurality of second nozzles N2 are alternately arranged in the width direction with the plurality of first nozzles N1 disposed in one side with respect to the conveyance direction and the plurality of second nozzles disposed in the other side with respect to the conveyance direction. Also in the second staggered array group U2 and the third staggered array group U3, lines connecting two first nozzles N1 adjacent to each other in the width direction and one second nozzle N2 interposed between the two first nozzles N1 in the width direction forms an isosceles triangle.

The second staggered array group U2 is disposed on the downstream side of the first staggered array group U1 in the conveyance direction, and shifted toward one side (right side) in the width direction by a distance smaller than the half of the second interval D2, with respect to the first staggered array group U1. Specifically, the second staggered array group U2 is shifted rightward with respect to the first staggered array group U1, by a distance which is substantially equal to a diameter of the nozzles N. In addition, a shortest interval Ds is longer than or equal to the first interval D1. Here, the shortest interval Ds is a smallest one of a distance between a first nozzle N1 of the second staggered array group U2 and one adjacent second nozzle N2 of the first staggered array group U1 and a distance between the first nozzle N1 of the second staggered array group U2 and the other adjacent second nozzle N2 of the first staggered array group U1.

The third staggered array group U3 is disposed on the downstream side of the second staggered array group U2 in the conveyance direction, and shifted rightward with respect to the second staggered array group U2, by the distance which is substantially equal to the diameter of the nozzles N. In addition, a shortest interval Ds is longer than or equal to the first interval D1. Here, the shortest interval Ds is a shortest one of a distance between a first nozzle N1 of the third staggered array group U3 and one adjacent second nozzle N2 of the second staggered array group U2 and a distance between the first nozzle N1 of the third staggered array group U3 and the other adjacent second nozzle N2 of the second staggered array group U2.

That is, the first interval D1 is the smallest interval among the intervals between adjacent nozzles of the plurality of nozzles N, which constitute the three staggered array groups U1, U2, and U3. In addition, the first interval D1 is equal to or shorter than a distance at which a fixing solution sprayed from one of two adjacent nozzles N electrically and another fixing solution sprayed from the other of the two adjacent nozzles N electrically repel each other.

Figure 4:
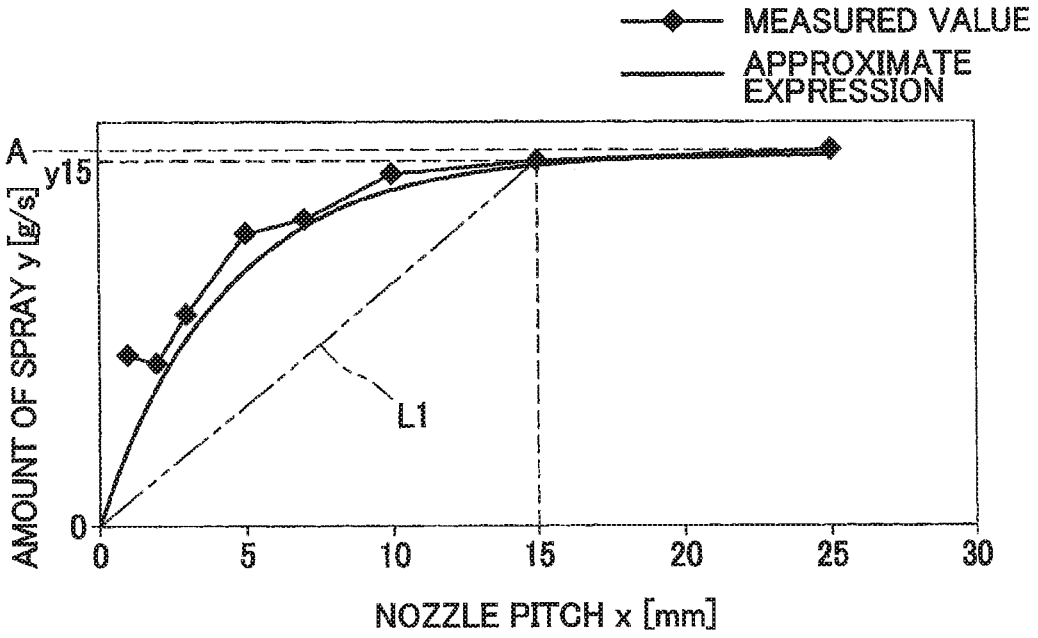
FIG. 4 is a graph showing a relationship between amount of spray per one nozzle and a nozzle pitch.

The first interval D1 can be appropriately set by using an approximate expression determined from an experimental result illustrated in FIG. 4, for example.

The graph of FIG. 4 illustrates the experimental result on the relationship between the amount y [g/s] of spray per nozzle and the nozzle pitch x [mm], and the approximate expression of the experimental result. In this experiment, the amount y decreases as the nozzle pitch x is decreased. The approximate expression based on the actual values measured in this experiment is expressed by the following expression (1).

$$y=(1-1/\exp(x/B))\times A \quad (1)$$

where y is the amount [g/s] of spray of one nozzle among a plurality of nozzles disposed at the nozzle pitch x,
x is the nozzle pitch [mm],
A is the amount [g/s] of spray in a case where only one nozzle is disposed,
B is a value which satisfies the expression of $y15=(1-1/\exp(15/B)\times A$, and
y15 is an actual measured value [g/s] of the amount of spray from one nozzle among a plurality of nozzles disposed at the nozzle pitch of 15 mm.

Here, the nozzle pitch of 15 mm is a nozzle pitch at which y was decreased from A by 2%.

In the graph illustrated in FIG. 4, in the case where the nozzle pitch x is 20 mm or more, the amount y has an almost constant value A. This is because a sufficient amount of nozzle pitch x is secured, and thus the fixing solutions L sprayed from the nozzles N do not electrically interfere with each other.

However, when the nozzle pitch x is decreased to 15 mm, the amount y starts decreasing. This is because the decreased nozzle pitch x causes the fixing solutions L, sprayed from the nozzles N, to electrically interfere with each other, and causes the electric fields, produced between each nozzle N and the second electrode 72, to interfere with each other.

Here, in the region where the nozzle pitch x is smaller than 15 mm, the amount y obtained from the expression (1) gently decreases with its line being convex upward, as the nozzle pitch x is decreased. The decreasing rate of the amount y becomes less than the decreasing rate of the nozzle pitch x. Specifically, in the region of $x\leq 15$, the amount y is larger than an amount of spray obtained on a straight line L1 which passes through a point (15, y15) and the origin. Here, the straight line L1 is expressed by the following expression (1-2).

$$y=(y15/15)\cdot x \quad (1\text{-}2)$$

The experimental data illustrated in FIG. 4 is an example obtained when the fixing solution L was applied with a voltage of 5.5 kV. Also, the similar result was obtained when the fixing solution L was applied with a voltage of 5.0 or 6.0 kV. In addition, the similar result as that of FIG. 4 was also obtained when the fixing solutions L of the above-described emulsions were applied with a voltage.

In a case where the nozzle pitch x is smaller than 2 mm, the amount y becomes too small.

The nozzle pitch x of the above-described expression (1) is a pitch between a first nozzle N1 and a second nozzle N2 arranged at the first interval D1. Thus, the nozzle pitch x satisfies the following expression (2).

$$x=D1+2r \quad (2)$$

where D1 is the first interval, and
r is a radius of the nozzles N.

In the experiment in which the result of FIG. 4 was obtained, the radius r of the nozzles N used was 0.5 mm. Thus, the first interval D1, at which fixing solutions electrically repel each other and the appropriate amount y is obtained, is set to a value in a range, that is, a value larger than or equal to 1 mm and smaller than or equal to 14 mm.

Here, a minimum amount α [g/s] of spray necessary to fix the toner image onto the paper P is calculated by using the following expression (3).

$$\alpha=At/T1 \quad (3)$$

where At is a total amount [g] of spray necessary to perform printing on all of an image forming area of the paper P having a predetermined size, that is, necessary for the fixing to solidly fill all of the image forming area with black, and T1 is a conveyance time interval [s] for a sheet of the paper P.

The conveyance time interval T1 is calculated by using the following expression (4).

$$T1=(60/VE)\cdot[Lf/(Lf+C)] \quad (4)$$

where VE is a conveyance speed [ppm] of the paper P,
Lf is a length [mm] of the paper P in the conveyance direction, and
C is a distance [mm] between successive sheets in continuous printing.

The conveyance speed VE of the paper P depends on specifications of the laser printer 1. The length Lf of the paper P in the conveyance direction is 297 mm in a case where the paper P has a size of A4, for example. The distance C in continuous printing is determined by using the conveyance speed VE and the length Lf of the paper P in the conveyance direction.

The total number St of the nozzles N, which is formed in the fixing head 71, is set to a natural number which satisfies the following expression.

$$St\geq\alpha/[(1-1/\exp(x/B))\times A]$$

Figure 5:
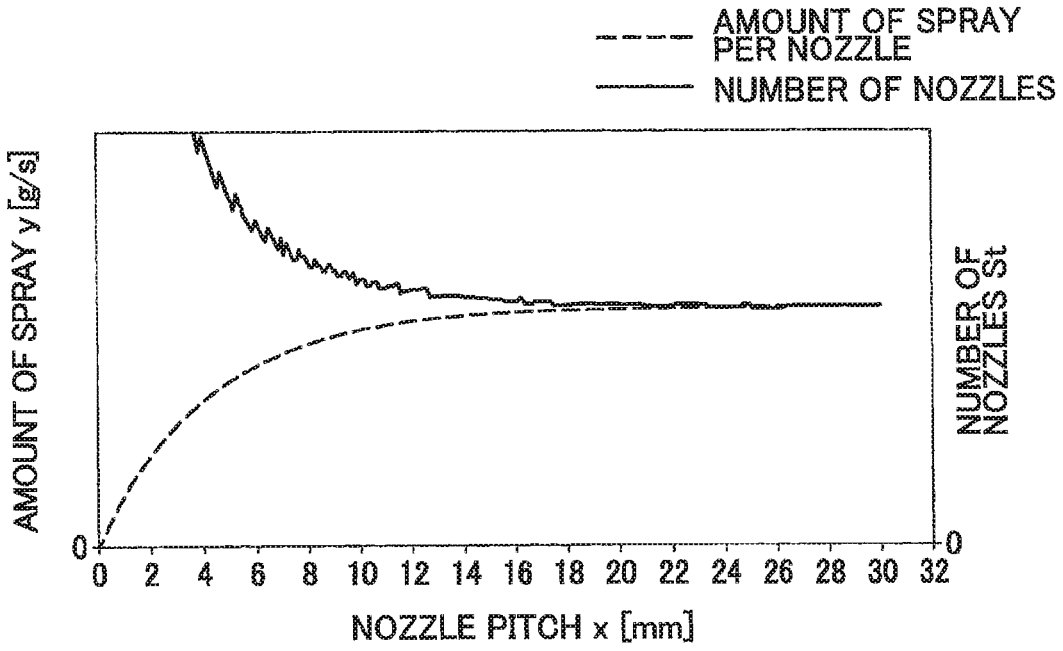
FIG. 5 is a graph showing a relationship among amount of spray per one nozzle, the nozzle pitch, and total number of the nozzles.

Specifically, as illustrated in FIG. 5, the total number St of the nozzles N becomes larger as the nozzle pitch x is decreased.

The number S1 of nozzles N in a single staggered array group (for example, the first staggered array group U1) is calculated by using the following expression (5), in consideration of the relationship between the number S1 and a width Lb (length in the left-right direction) of the paper P.

$$S1=Lb/(x\cdot\cos\theta 1)+1 \quad (5)$$

where θ1 is an angle formed by a line connecting two first nozzles N1 aligned in the width direction and a line connecting a first nozzle N1 and a second nozzle N2 which are adjacent to each other and contained in respective predetermined staggered array groups (see FIG. 3B).

The width Lb of the paper P is 210 mm in a case where the paper P has a size of A4, for example.

The number n of the staggered array groups each having the above-described number S1 (the number n is a minimum number necessary for the fixing) is set to a natural number which satisfies the following expression (6).

$$n\geq\alpha/\rho \quad (6)$$

where α is the minimum amount [g/s] of spray indicated by the expression (3), and ρ is an amount [g/s] of spray per second, sprayed by a single staggered array group, and is calculated by using the following expression (6-1).

$$\rho=y\cdot S1 \quad (6\text{-}1)$$

where y is the above-described amount [g/s] of spray of one nozzle, and

S1 is the above-described number of the nozzles N in a single staggered array group.

When the minimum number n necessary for fixing is determined, the length Lh of the fixing head 71 in the conveyance direction (that is, minimum length necessary for the fixing) is calculated by using the following expression (7).

$$Lh=(2n-1)\cdot x\cdot\sin\theta 1 \quad (7)$$

where x is the above-described nozzle pitch [mm], and θ1 is the angle indicated in the expression (5).

Figure 6:
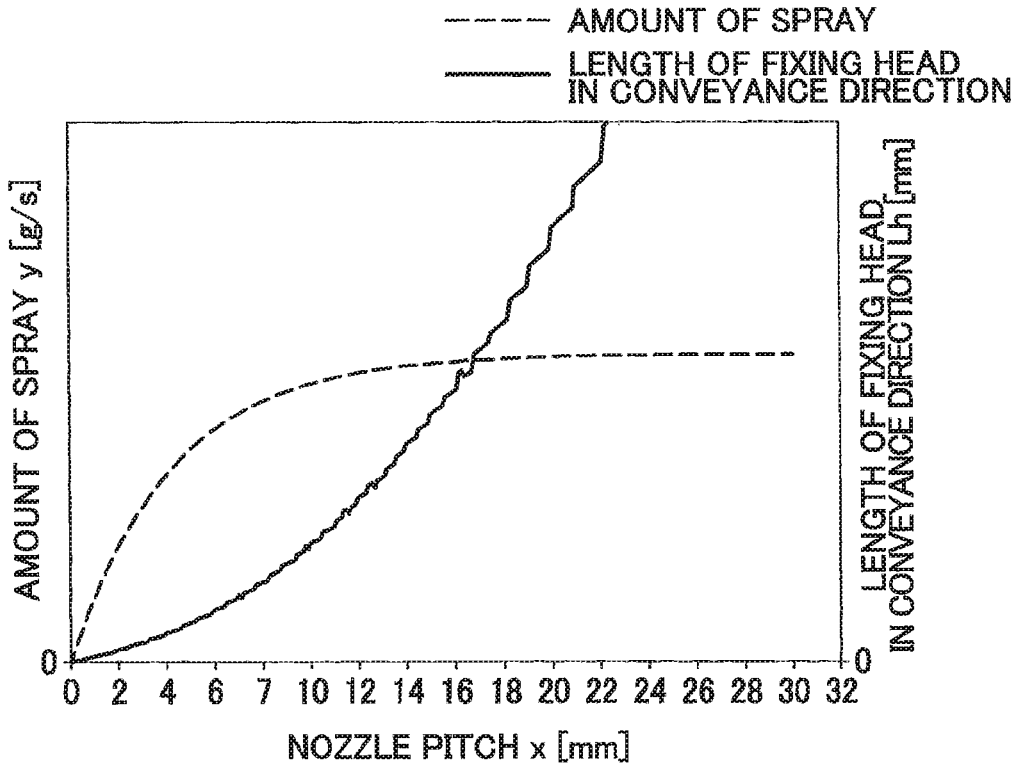
FIG. 6 is a graph showing a relationship among amount of spray per one nozzle, the nozzle pitch, and a length of the fixing head in a conveyance direction.

Specifically, as illustrated in FIG. 6, the length Lh of the fixing head 71 in the conveyance direction can be set to a smaller value as the nozzle pitch x is decreased.

The nozzle pitch x is required to be decreased for downsizing the fixing head 71. However, when the nozzle pitch x is decreased, the amount y is also decreased. Thus, the number of the nozzles is increased for securing a predetermined amount of the fixing solution L sprayed from the fixing head 71. This may lead to upsizing of the fixing head 71. In particular, in a case where the amount y would be decreased so as to satisfy the expression (1-2) in the region of x≤15, the decrease in the amount y relative to the decrease in the nozzle pitch x becomes significantly larger. Thus, the number of the nozzles is required to be significantly increased to secure a predetermined amount of fixing solution L sprayed from the fixing head 71.

In the present embodiment, the nozzles N are arranged at intervals, that is, nozzle pitches are smaller than 15 mm so that an electric field formed by a nozzle is interfere with an electric field formed by another nozzle. In this case, the amount y of spray from a nozzle N decreases so as to satisfy the expression (1). In other words, in the region of x≤15, the amount y decreases so as to satisfy the expression (1), in which the amount y is larger than the amount obtained by the expression (1-2). Since the decrease in the amount y relative to the decrease in the nozzle pitch x can be smaller, the fixing head 71 can be downsized in the conveyance direction of the paper P, while securing a prescribed amount y, even when the number of the nozzles is increased.

In the nozzles N having the spraying characteristic shown in FIG. 4, the graph of FIG. 6 illustrates the relationship between the amount y of spray per nozzle and the nozzle pitch x, and the relationship between the length Lh of the fixing head 71 in the conveyance direction and the nozzle pitch x. The graph of FIG. 5 illustrates the relationship between the amount y of spray per nozzle and the nozzle pitch x, and the relationship between the total number St of the nozzles of the fixing head 71 and the nozzle pitch x.

Here, FIG. 5 illustrates the relationship between the total number St of the nozzles of the fixing head 71 and the nozzle pitch x in a case where the total amount of the fixing solution L sprayed from the fixing head 71 is equal to or larger than the predetermined value At (that is, the amount of the minimum fixing solution necessary for the fixing). Since the amount y per nozzle decreases as the nozzle pitch x is decreased, the number of the nozzles is required to be increased to keep a constant amount of fixing solution L sprayed from the fixing head 71. FIG. 5 indicates that the number of the nozzles increases as the nozzle pitch x is decreased.

FIG. 6 illustrates the relationship between the nozzle pitch x and the length Lh of the fixing head 71 in the conveyance direction in a case where the number of the nozzles is increased, as illustrated in FIG. 5, so that the total amount of fixing solution L sprayed from the fixing head 71 is equal to or larger than the predetermined value At. As illustrated in FIG. 6, the length of the fixing head 71 in the conveyance direction decreases even though the number of the nozzles is increased (that is, even though the nozzle pitch x is decreased).

Next, a method of setting the number of the staggered array groups, disposed in the conveyance direction of the paper P, of the fixing head 71 will be described.

Figure 9:
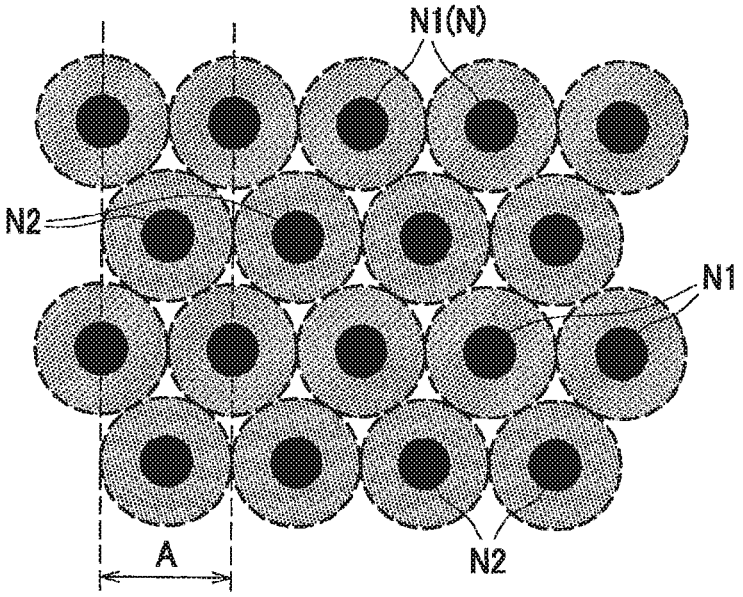
FIG. 9 is a view illustrating a relationship between staggered arrangement group and an application area of droplet.

In a case where the fixing solution L is applied by using an electrostatic spraying method, the droplets sprayed from the nozzles N are fine particles having a droplet diameter of 10 μm or less. For this reason, a single nozzle sprays a small amount of fixing solution. Thus, a plurality of staggered array groups U are preferably disposed in the conveyance direction of the paper P, in order to spray a sufficient amount of fixing solution to a predetermined area of the paper P. For example, assume that an area of the paper to be sprayed by the fixing head 71 is divided into some areas in the left-right direction. As illustrated in FIG. 9, an area A is an area to be sprayed with the fixing solution L by two staggered array groups. In FIG. 9, areas indicated by broken lines are application areas of spraying performed by the nozzles N (that is, sprayed areas on the paper P), and dotted patterns within the broken lines indicate that the spraying has been normally performed. With this arrangement, a sufficient amount of fixing solution L can be sprayed to the paper P.

However, if an excessive amount of fixing solution L is sprayed to the paper P, the toner softened by the fixing solution L may take time to solidify. If the paper P is conveyed with the toner having not sufficiently solidified, the toner of the paper P may adhere to the downstream side conveyance roller 81 or any sensor disposed on the downstream side of the fixing device 7, possibly causing poor printing. For this reason, the number of the staggered array groups in the conveyance direction needs to be appropriately set.

Thus, the above-described amount ρ [g/s] of spray of a single staggered array group is set so as to satisfy the following expression (8).

$$\rho \leq \beta - \alpha \quad (8)$$

where α is a minimum amount [g/s] of spray indicated by the expression (3), and β is a maximum amount [g/s] of spray, at or below which the toner image on the paper P dries before the toner image touches the member (the downstream side conveyance roller 81 illustrated in FIG. 1) disposed on the downstream side of the plurality of staggered array groups U1 to U3.

The amount β can be appropriately set in accordance with the type of a softening agent used for the fixing solution L.

Thus, the amount ρ of spray sprayed from a single staggered array group is required to satisfy both the expression (8) and the above-described expression (6-1). When the amount ρ does not satisfy the expression (8), the amount ρ can be reduced by decreasing the amount y per nozzle, by changing the potential difference between the fixing solution L in the nozzles N and the paper P, or by changing a liquid pressure at tip ends of the nozzles N. Specifically, the amount ρ can be reduced, for example, by decreasing the voltage applied to the first electrode 74, increasing the distance between the nozzles N and the second electrode 72, or decreasing the liquid pressure at tip ends of the nozzles N.

In addition, the number k of the staggered array groups actually disposed on the fixing head 71 is set so as to satisfy the following expression (9).

$$n+1 \leq k \leq m \quad (9)$$

where n is the above-described number of the minimum staggered array groups necessary for the fixing, and m is the largest natural number which satisfies the expression of $m \leq \beta/\rho$.

Figure 10:
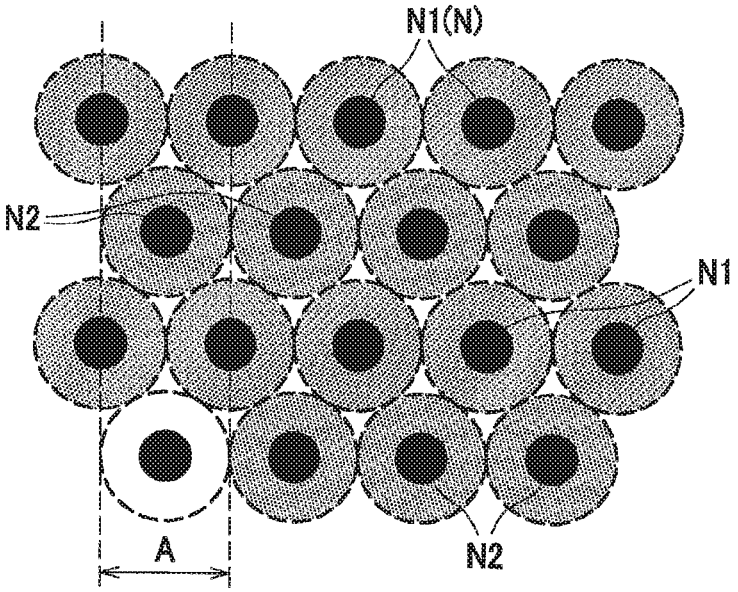
FIG. 10 is a view illustrating a relationship between staggered arrangement groups and an application area of droplet in a case where a part of the nozzle is clogged.

Here, the nozzle N may be clogged when the toner adheres to the tip end of a nozzle N of the fixing head 71. In such a case, as illustrated in FIG. 10, an insufficient amount of fixing solution L will be sprayed to the area A of the paper P. In FIG. 10, the clogged nozzle N is represented by a non-dotted application area of the spraying, indicated by a broken line. Thus, when the amount of the fixing solution L is insufficient, the paper is discharged with the toner image having not been fixed, causing poor printing.

Figure 11:
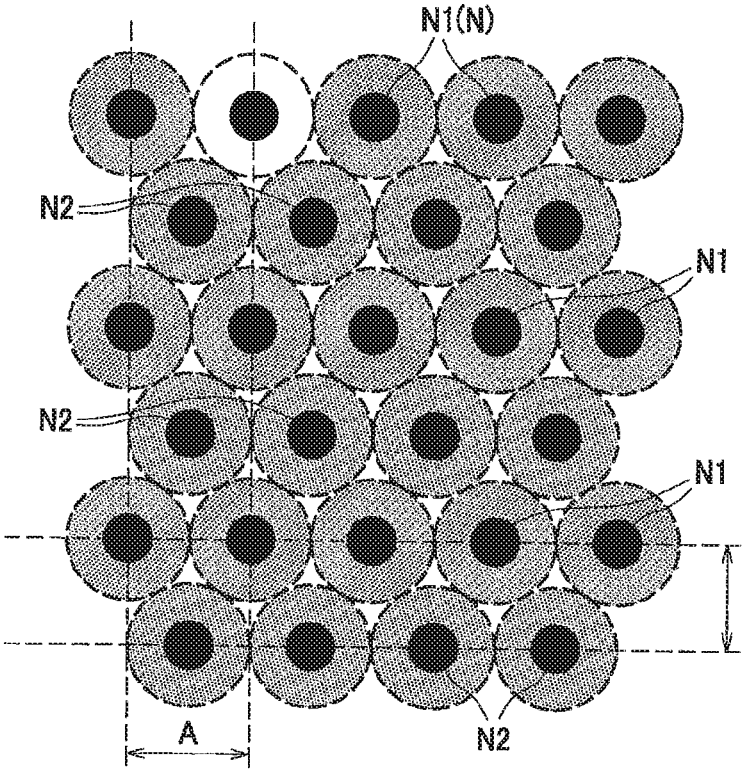
FIG. 11 is a view illustrating a state where number of staggered arrangement groups is increased to cope with nozzle clogging.

As expressed by the expression (9), the number of the staggered array groups which is larger by one than the number of the minimum staggered array groups necessary for the fixing is set as a condition for securing reliability of the fixing head 71. With this setting, even when a nozzle N is clogged in the area A as illustrated in FIG. 11, arranging more staggered array groups can prevent poor fixing. In addition, in an area in which the nozzles N are not clogged, the number of the staggered array groups is equal to or smaller than m, thereby reducing poor printing caused by, for example, adherence of an image with fixing solution L to the downstream side conveyance roller 81.

Figure 7:
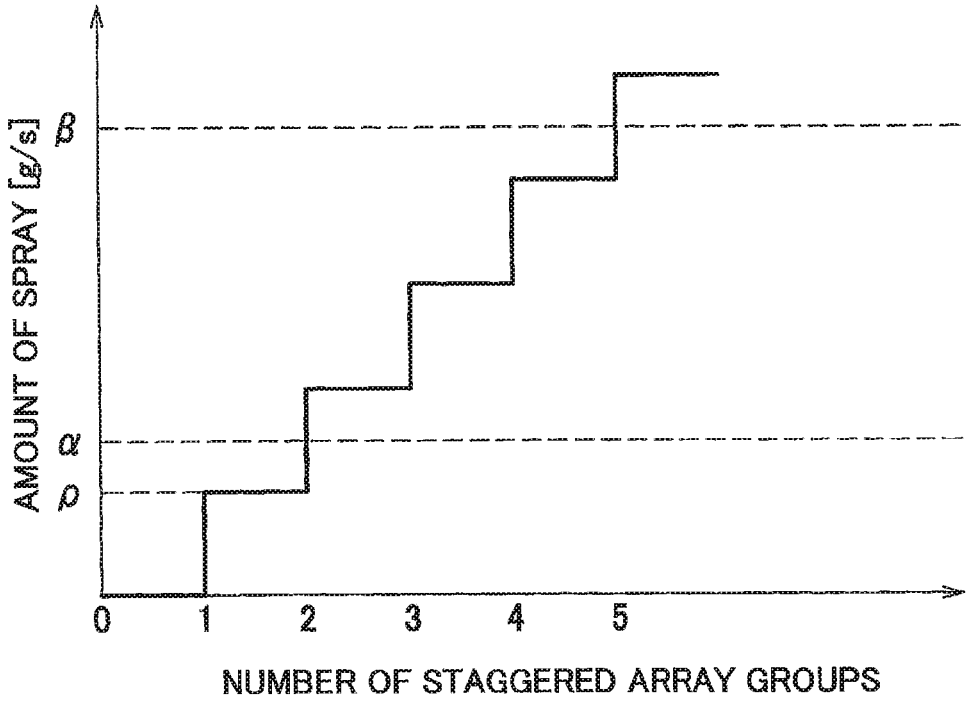
FIG. 7 is a graph showing a relationship among amount $\rho$ of spray per one staggered arrangement group, minimum amount $\alpha$ of spray, maximum amount $\beta$ of spray, and number of staggered arrangement groups.

Specifically, as illustrated in FIG. 7, in a case where at least two staggered array groups are necessary to secure the amount of spray from whole the fixing head 71 which is equal to or larger than the minimum amount α, and where five or more staggered array groups produce the amount of spray of whole the fixing head 71 which is equal to or larger than the maximum amount β, the number k of the staggered array groups can be set to 3 or 4. In the first embodiment, the description will be made for the case of k=3.

Figure 8:
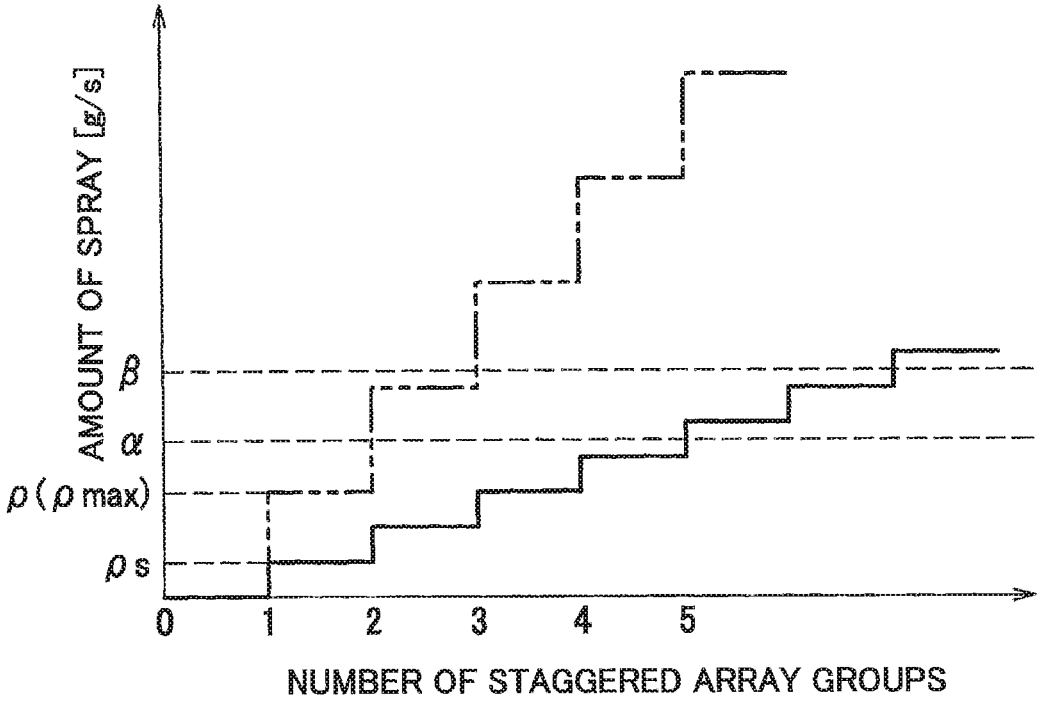
FIG. 8 is a view illustrating a method for adjusting amount $\rho$ of spray under a condition of $\rho max > \beta - \alpha$.

As illustrated in FIG. 8, in a case where the above-described amount ρ of spray from a single staggered array group is a maximum amount ρmax of spray corresponding to a maximum capacity of the single staggered array group, and where $\rho max > \beta - \alpha$, more than n staggered array groups to deal with the nozzle clogging cannot be disposed. This is because, if the number of the staggered array groups is increased in the state of $\rho max > \beta - \alpha$, the amount of the fixing solution sprayed to the paper will exceed β.

Here, one example of cases where the expression of $\rho max > \beta - \alpha$ is satisfied will be described. It is understood through an experiment that the period of time until when the toner hardens from when the fixing solution L is sprayed to the toner on the paper P is proportional to the amount of the fixing solution L sprayed to the paper P.

In addition, it is understood through an experiment that the amount of the fixing solution L sprayed to a predetermined area of the paper P by a predetermined number of nozzles depends on the conveyance speed of the paper P. That is, when the conveyance speed of the paper P is slow, the amount of the fixing solution L sprayed to the paper P is increased. This is because, when the conveyance speed of the paper P is slow, the time in which the paper P faces the fixing head 71 becomes longer.

Figure 12:
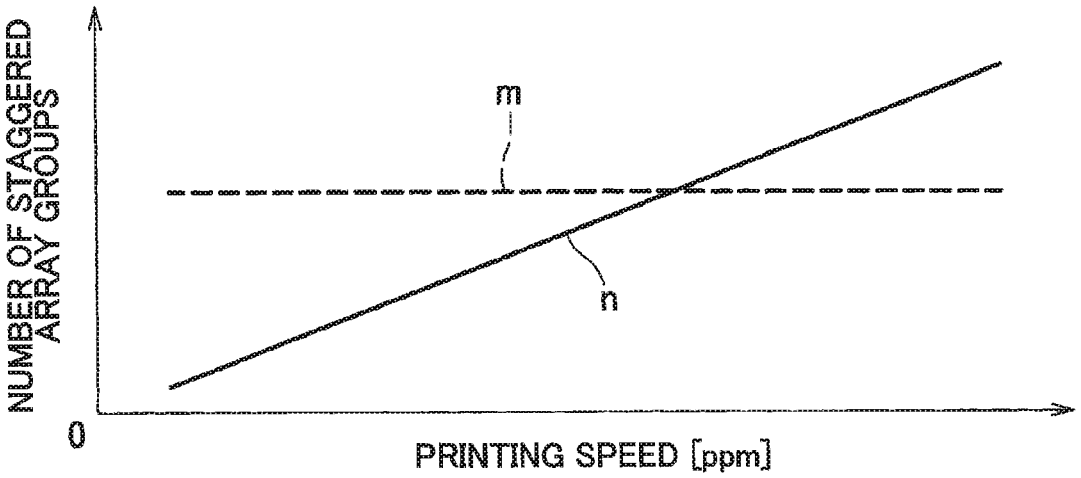
FIG. 12 is a graph showing a relationship between minimum number of staggered arrangement groups capable of performing fixing and printing speed.

In contrast, when the conveyance speed of the paper P is fast, the amount of the fixing solution L sprayed to the paper P is decreased. This is because, when the conveyance speed of the paper P is fast, the time in which the paper P faces the fixing head 71 becomes shorter. Thus, as the conveyance speed of the paper P is increased, it is required that more nozzles of the fixing head 71 are arranged in the conveyance direction of the paper P so as to spray an amount of the fixing solution larger than or equal to α to the paper P. FIG. 12 illustrates the relationship between the conveyance speed of the paper P and the number of the staggered array groups.

FIG. 12 is a graph illustrating the relationship between the conveyance speed of the paper P (i.e. printing speed) measured through an experiment and the number n of the minimum staggered array groups necessary for the fixing. As illustrated in FIG. 12, the number n of the minimum staggered array groups necessary for the fixing increases as the conveyance speed of the paper P is increased.

FIG. 12 also illustrates the relationship between the conveyance speed of the paper P and the number m of the maximum staggered array groups, at or below which the toner image having been sprayed with the fixing solution L does not adhere to a surface of the downstream side conveyance roller 81. As illustrated in FIG. 12, the number m of the maximum staggered array groups is constant even though the conveyance speed of the paper P is increased. This is because the hardening time of the toner image sprayed with the fixing solution L is proportional to the amount of the sprayed fixing solution L. Specifically, as the conveyance speed of the paper P is increased, the time period that the toner image takes to reach the downstream side conveyance roller 81 decreases, while the amount of spray from a single nozzle toward a predetermined area of the paper P (that is, the amount of the fixing solution which is actually applied to the paper P) also decreases.

Here, as illustrated in FIG. 12, when the conveyance speed of the paper P is increased, the number n of the minimum staggered array groups becomes larger than the number m of the maximum staggered array groups. This indicates that, if the paper P is conveyed at a conveyance speed of the paper P faster than a conveyance speed at which the maximum number m is equal to the minimum number n, the number of the staggered array groups is required to be increased so as to apply a sufficient amount of fixing solution to the toner image for the fixing. As a result, an excessive amount of the fixing solution is applied to the paper P, and the softened toner touches the downstream side conveyance roller 81, causing poor printing.

Figure 13:
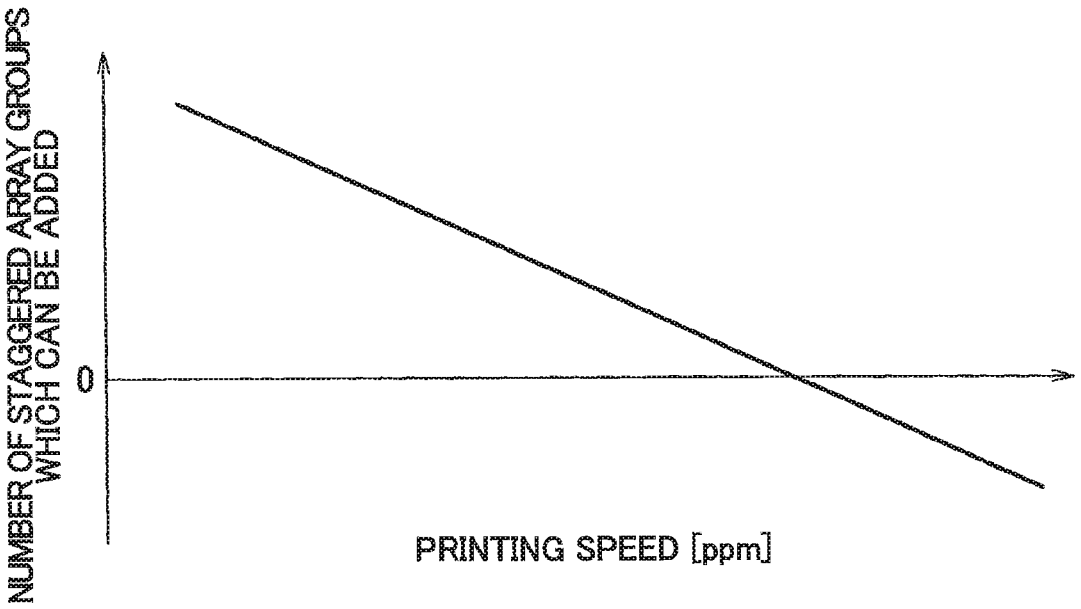
FIG. 13 is a graph showing a relationship between addable number of staggered arrangement groups and printing speed.

The graph of FIG. 13 indicates the difference between the maximum number m and the minimum number n of the staggered array groups, illustrated in FIG. 12, where the condition on the amount ρ is $\rho=\beta-\alpha$. That is, FIG. 13 indicated the number of staggered array groups which can be added to the fixing head 71. As can be seen from FIG. 13, as the conveyance speed of the paper P is increased, the number of staggered array groups which can be added to the fixing head 71 decreases. In addition, if a staggered array group was tried to be added to the fixing head 71 in a region of FIG. 13 where the number of staggered array groups which can be added to the fixing head 71 is less than one, the number of staggered array groups would exceed an upper limit. That is, the staggered array group could not be added to the fixing head 71 in this case.

However, if the amount ρ is set to a value smaller than the maximum amount ρmax in the first embodiment, that is, if the amount ρ is set to a small value ρs that satisfies the expression (8), the reliable fixing head 71 can be provided even when the conveyance speed of the paper P is increased.

Next, effects of the fixing head 71 will be described.

As illustrated in FIG. 1, when the paper P is conveyed above the second electrode 72, the fixing solution L is sprayed from the nozzles N of the fixing head 71 which is disposed separated from the paper P. Specifically, as illustrated in FIG. 3B, the fixing solution L is first sprayed toward the paper P from the nozzles N of the first staggered array group U1. In this time, since the plurality of nozzles N are staggered, the fixing solution L is sprayed uniformly over the substantially entire width of the paper P.

Thereafter the portion of the paper P having been sprayed by the first staggered array group U1 is conveyed below the second staggered array group U2, and is sprayed with the fixing solution L by the nozzles N of the second staggered array group U2. Accordingly, the portion of the paper P is sprayed with the fixing solution L by the first staggered array group U1 and the second staggered array group U2 by an amount equal to or larger than the minimum amount α. As a result, the toner image on the portion can be sufficiently melted by the fixing solution L.

Further, the portion of the paper P having been sprayed by the two staggered array groups U1 and U2 is conveyed below the third staggered array group U3, and is sprayed with the fixing solution L by the nozzles N of the third staggered array group U3. Although an additional amount of fixing solution L is sprayed to the paper P by the third staggered array group U3, the amount of the fixing solution L sprayed to the portion is equal to or smaller than the maximum amount β. As a result, the fixing solution L on the portion dries sufficiently after the portion passes through the fixing head 71 and reaches the downstream side conveyance roller 81 disposed on the downstream side of the fixing head 71. Accordingly, the melted tonner by the fixing solution L can be prevented from adhering to the downstream side conveyance roller 81, and thus degradation of an image quality can be reduced.

In addition, if at least one of the nozzles N of the first staggered array group U1 is clogged and the clogged nozzle cannot satisfactorily spraying the fixing solution L, a portion of the paper P corresponding to the defective nozzle of the first staggered array group U1 is not supplied with the fixing solution L. Even in such a case the portion of the paper is sprayed with the fixing solution L by the remaining two staggered array groups U2 and U3 by an amount equal to or larger than the minimum amount α. Thus, the poor fixing caused by the defect of the first staggered array group U1 can be prevented.

Moreover, the first embodiment can produce the following effects in addition to the above-described effects.

The toner melted by the fixing solution L can be prevented from adhering to the nozzles N because the fixing solution L is sprayed from the nozzles N separated from the conveyed paper P. Accordingly, artifacting of the fixed toner image can be restrained.

Because the plurality of nozzles N disposed in the conveyance direction sprays the fixing solution L to the toner image on the conveyed paper P, the amount of spray per nozzle N can be reduced.

The plurality of nozzles N can be disposed at a high density, and the size of the fixing head 71, that is, the length Lh in the conveyance direction can be reduced. This is because a first nozzle N1 and a second nozzle N2, which are adjacent to each other, are disposed at the first interval D1. Here, the interval D1 is shorter than a distance at which the fixing solution L sprayed from the first nozzle N1 and the fixing solution L sprayed from the second nozzle N2 electrically repel each other.

The toner image can be satisfactorily fixed to the paper P because the total number St of the nozzles N is a natural number which satisfies the expression of $St \geq \alpha/[(1-1/\exp(x/B))\times A]$.

Because the first interval D1 is set to 1 mm or more, the first nozzle N1 and the second nozzle N2 are not too close to each other, thereby preventing poor electrostatic spraying.

Each of the staggered array groups U2 and U3 on the downstream side in the conveyance direction is shifted in the width direction with respect to a corresponding staggered array group disposed on the upstream side in the conveyance direction by a distance smaller than the half of the second distance D2. Thus, each pitch of the fixing solutions L sprayed from the nozzles N to the paper P in the width direction of the sprayed area can be reduced, thereby performing preferable fixing.

Even in a case where poor spraying occurs in one of the plurality of staggered array groups, an additional staggered array group added to a minimum number n of staggered array groups can spray the fixing solutions L, thereby performing sufficient fixing.

The number k of the staggered array groups is set so as to satisfy $k \leq m$ and $m \leq \beta/\rho$. As a result, the number of the staggered array groups can be prevented from being excessively increased, and thus the toner image melted by the fixing solution L can be prevented from adhering to the downstream side conveyance roller 81 before the toner image dries.

The present invention can be used in various embodiments as described below as examples without limited to the first embodiment. In the following description, any member having substantially the same structure as that of the first embodiment will be given the same reference numeral, and the description thereof will be omitted.

Figure 14:
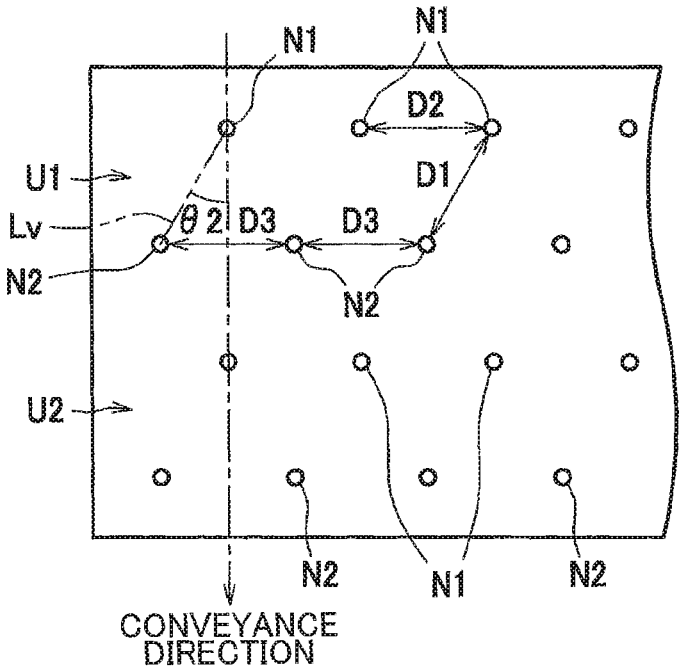
FIG. 14 is a view illustrating a configuration where an angle between a conveyance direction and an imaginary line connecting between a first nozzle and a second nozzle is 30 degrees.
Figure 15:
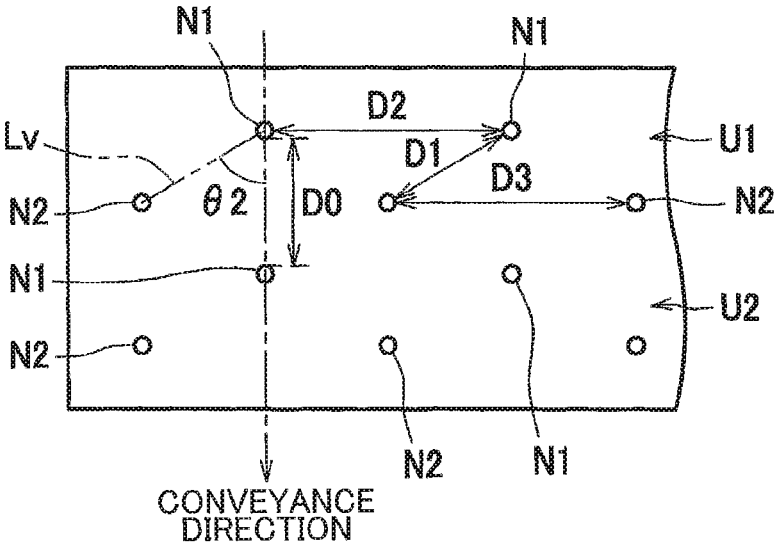
FIG. 15 is a view illustrating a configuration where an angle between the conveyance direction and the imaginary line connecting between the first nozzle and the second nozzle is 60 degrees.

In the first embodiment, the plurality of staggered array groups U1 to U3 is arranged slightly shifted from each other in the width direction. However, the present invention is not limited to this. As illustrated in FIGS. 14 and 15, the plurality of staggered array groups U1 and U2 may be disposed at the same position in the width direction. In addition, as illustrated in FIGS. 14 and 15, the second interval D2 and the third interval D3 may have an identical value, and an angle θ2 of an imaginary line Lv relative to the conveyance direction may be in a range from 30 to 60 degrees. Here, the imaginary line Lv connects a first nozzle N1 and a second nozzle N2 which are adjacent to each other.

With this arrangement, the distance between two second nozzles N2 adjacent to each other in the width direction (that is, the third interval D3), or the distance D0 between two first nozzles N1 adjacent to each other in the conveyance direction is prevented from being smaller than the first interval D1. Thus, this arrangement can prevent poor electrostatic spraying caused by two nozzles N separated by a too small distance.

Preferably, the nozzles N are arranged, as illustrated in FIG. 14, such that lines connecting two first nozzles N1 adjacent to each other in the width direction, and one second nozzle N2 interposed between the two first nozzles N1 in the width direction form an equilateral triangle. With this arrangement, the nozzles N can be disposed at the highest density.

Figure 16:
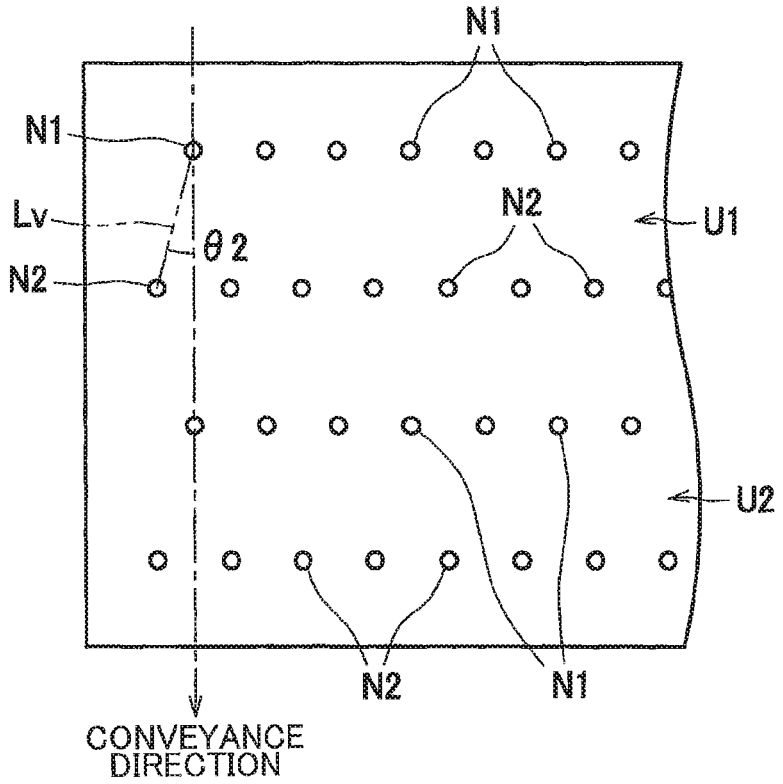
FIG. 16 is a view illustrating a configuration where an angle between the conveyance direction and the imaginary line connecting between the first nozzle and the second nozzle is less than 30 degrees.

As illustrated in FIG. 16, the angle θ2 formed by the imaginary line Lv relative to the conveyance direction may be smaller than 30 degrees. Here, the imaginary line Lv connects a first nozzle N1 and a second nozzle N2, which are adjacent to each other. Although not illustrated, the angle θ2 may be larger than 60 degrees.

Figure 17:
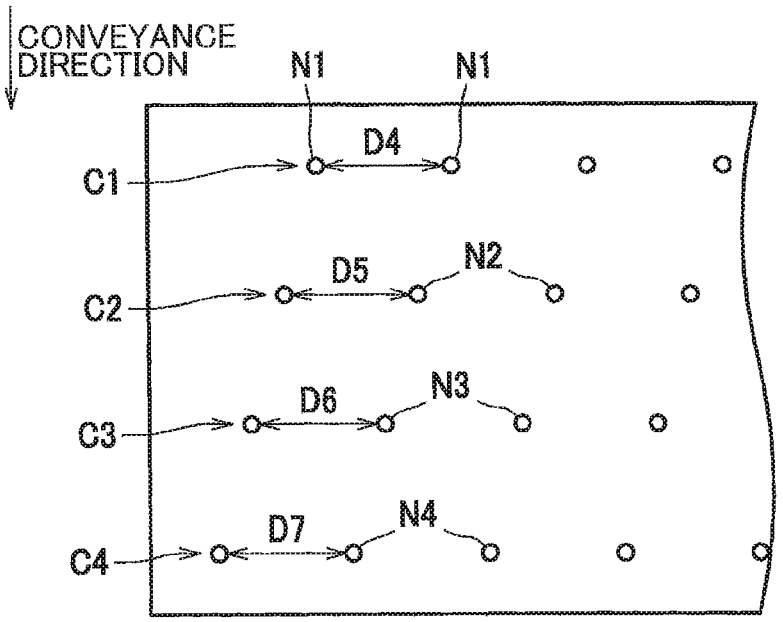
FIG. 17 is a view illustrating a configuration where a plurality of nozzle arrays arrayed in the conveyance direction is slightly displaced in a widthwise direction.

As illustrated in FIG. 17, a plurality of nozzle lines C1 to C4 may be sequentially disposed downstream in the conveyance direction while the plurality of nozzle lines C1 to C4 is slightly shifted from each other in the width direction. Here, each of the plurality of nozzle lines C1 to C4 has a plurality of nozzles N disposed at regular intervals in the width direction. Specifically, the first nozzle line C1 includes a plurality of first nozzles N1 disposed in the width direction at regular fourth intervals D4. The second nozzle line C2 is disposed on the downstream side of the first nozzle line C1 in the conveyance direction, and includes a plurality of second nozzles N2 disposed in the width direction at regular fifth intervals D5.

The third nozzle line C3 is disposed on the downstream side of the second nozzle line C2 in the conveyance direction, and includes a plurality of third nozzles N3 disposed in the width direction at regular sixth intervals D6. The fourth nozzle line C4 is disposed on the downstream side of the third nozzle line C3 in the conveyance direction, and includes a plurality of fourth nozzles N4 disposed in the width direction at regular seventh intervals D7. The intervals D4 to D7 have an identical value.

The second nozzle line C2 is shifted toward one side of the width direction with respect to the first nozzle line C1 by a distance smaller than the half of the fourth interval D4. The third nozzle line C3 is shifted toward one side of the width direction with respect to the second nozzle line C2 by a distance smaller than the half of the fifth interval D5. The fourth nozzle line C4 is shifted toward one side of the width direction with respect to the third nozzle line C3 by a distance smaller than the half of the sixth interval D6. In this example, the shifted distances with respect to the second to the fourth nozzle lines C2 to C4 are a distance obtained by dividing the interval D4 by 3.

Accordingly, a pitch of the fixing solutions L, which is sprayed from the nozzles N1-N4 to the paper P, can be reduced in the width direction of the sprayed area, thereby performing preferable fixing.

Figure 18:
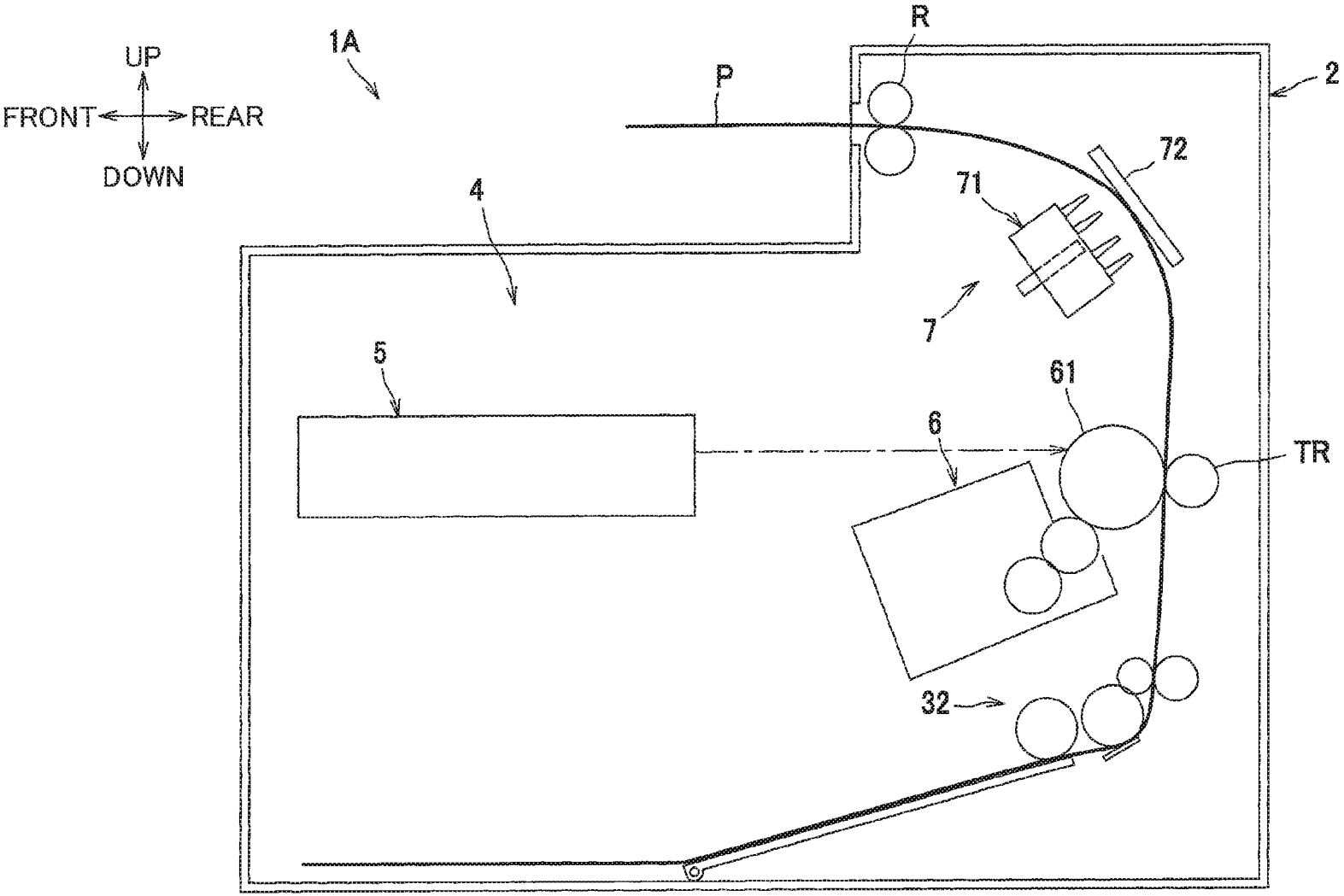
FIG. 18 is a view illustrating an image forming apparatus according to a modified embodiment.

In the first embodiment, the present invention is applied to the laser printer 1 in which the photosensitive drum 61 and the fixing device 7 are disposed adjacent to each other in the front-rear direction, and the paper P is conveyed along a substantially S-shaped path in the casing 2. However, the present invention is not limited to this. For example, the present invention may be applied to a laser printer 1A as illustrated in FIG. 18, in which the fixing device 7 and the photosensitive drum 61 are disposed at biased positions to one end side of the casing 2 in a direction orthogonal to the upward or downward direction, and in which the paper P is conveyed along a substantially C-shaped path in the casing 2.

In the first embodiment, the second electrode 72 is disposed so as to face the tip ends of the nozzles N of the fixing heads 71. However, the present invention is not limited to this. The second electrode 72 may be disposed so as not to overlap with the nozzles N when viewed from a direction toward which the nozzles N protrude. Even in such a case, when the paper which is in contact with the second electrode faces the tip ends of the nozzles, a potential difference is produced between the fixing solution in the nozzles and the paper, allowing the electrostatic spraying.

In the first embodiment, the present invention is applied to the laser printer 1. However, the present invention is not limited to this, and may be applied to other image forming devices, such as copying machines and multifunction peripherals.

In the first embodiment, the paper P, such as thick paper, postcard, or thin paper, is described as one example of recording sheet. However, the present invention is not limited to this, and the recording sheet may be a transparency film for example.

In the first embodiment, the photosensitive drum 61 is described as a photosensitive member, as an example. However, the present invention is not limited to this, and the photosensitive member may be a belt-like photosensitive member.

In the first embodiment, the first electrode 74 is disposed in the interior of the container portion 73. However, the present invention is not limited to this. For example, the nozzles and the container portion may be made of a conductive member such as a metal, and the nozzles or the container portion may be applied with a voltage. In this case, the nozzles or the container portion, which is applied with a voltage, functions as the first electrode. In another case, the container portion may be made of a non-conductive member such as a resin, the nozzles may be made of a conductive member such as a metal, and the nozzles may be applied with a voltage. In this case, the nozzles function as the first electrode.

In addition, the second electrode 72 may not necessarily face the nozzles N, and may be shifted toward the upstream side or the downstream side in the conveyance direction, in which the paper is conveyed.

The first object can be achieved by the first embodiment and any modification thereof described with reference to FIGS. 1 to 18. The above-described first embodiment is one example of the first invention, and the first invention is not limited to this.

A laser printer 101 of a second embodiment of the present invention will be explained with reference to FIGS. 19-26.

The fixing device, which performs the fixing by using the electrostatic spraying method and spraying the fixing solution from the nozzles separated from the recording sheet, may not be able to perform the satisfactorily fixing during the time from when the spraying of the fixing solution is started until when the spraying becomes stable. For this reason, the spraying is required to be started before the recording sheet reaches the fixing device. However, if the spraying is started before the recording sheet reaches the fixing device, the fixing solution may adhere to a conveyance surface, along which the recording sheet is conveyed in the fixing device. In this case, the fixing solution having adhered to the conveyance surface may cause resistance against the conveyance of the recording sheet. The second embodiment deals with such a problem.

In the second embodiment, like parts and components are designated with the same reference numerals as the first embodiment to avoid duplicating description. A laser printer 101 includes a fixing device 107.

Figure 19:
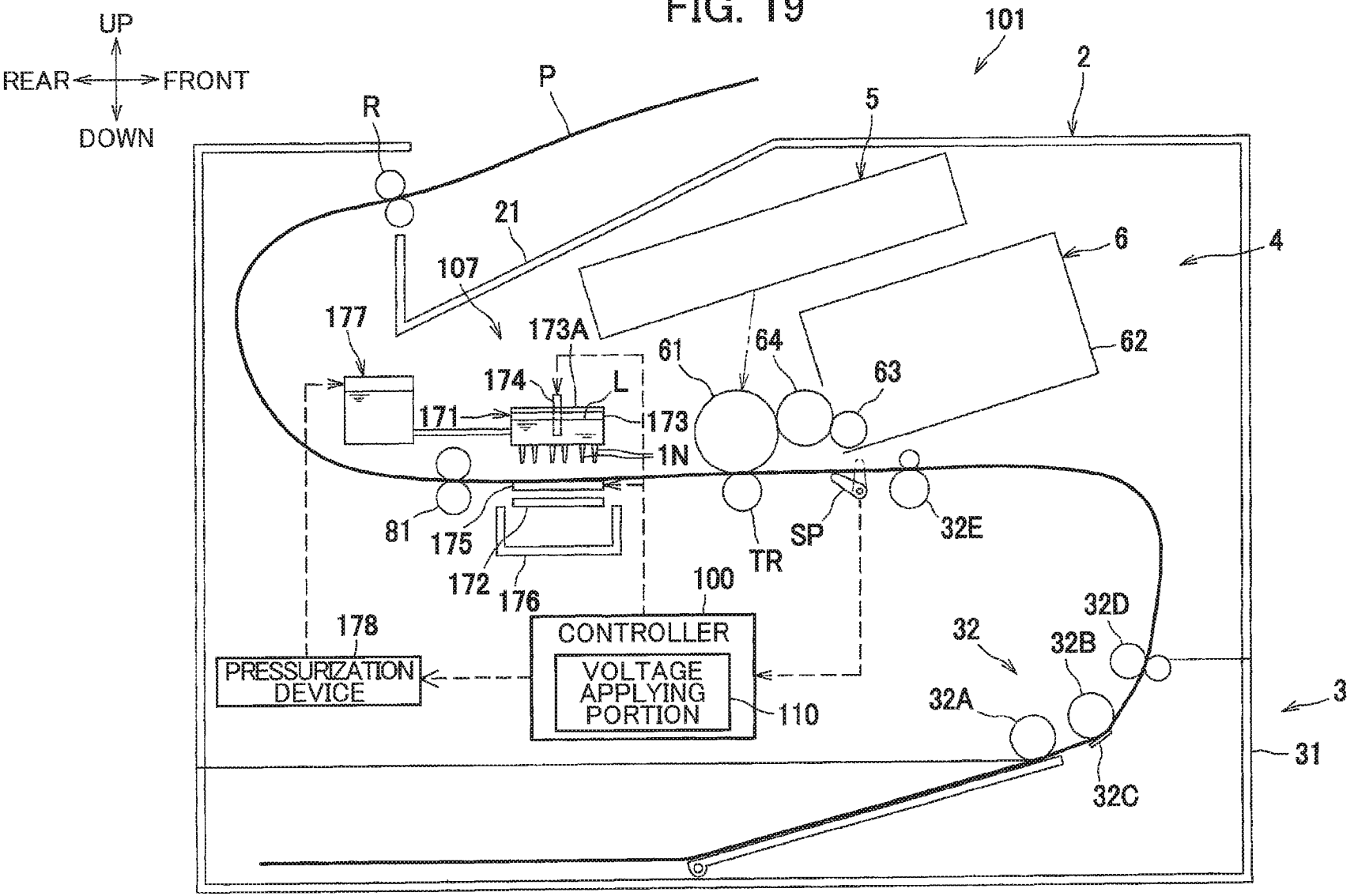
FIG. 19 is a view illustrating a laser printer provided with a fixing device according to a second embodiment of the present invention.

In the following description, directions are defined with respect to a position of a user using the laser printer. That is, the right side of FIG. 19 is defined as a front side, the left side of FIG. 19 is defined as a rear side, the far side of FIG. 19 is defined as a right side, and the near side of FIG. 19 is defined as a left side. The upward and downward directions of FIG. 19 are defined as an upward direction and a downward direction.

The fixing device 107 includes a spraying device which uses the electrostatic spraying method and sprays the fixing solution L, which is one example of electrically charged liquids, toward a toner image formed on the paper P. The toner image is fixed onto the paper P through the electrostatic spraying performed by the spraying device. A configuration of the fixing device 107 will be described in detail later.

A downstream side conveyance roller 81 is provided on the downstream side of the fixing device 107 so as to convey the paper P discharged from the fixing device 107 to the downstream side.

Next, the configuration of the fixing device 107 will be described in detail.

The fixing device 107 includes a fixing head 171 configured to spray the fixing solution L, a conveyance member 175 configured to support the paper P at a position below the fixing head 171, a second electrode 172 disposed below the conveyance member 175, and a storage portion 176 disposed below the second electrode 172. The fixing device 107 also includes a supply tank 177 configured to supply the fixing solution L to the fixing head 171, a pressurization device 178 configured to pressurize air contained in the supply tank 177, and a controller 100 configured to control the fixing head 171 and the pressurization device 178.

The fixing head 171 includes a container portion 173 which contains the fixing solution L, a plurality of nozzles 1N which communicates with the container portion 173 and configured to spray the fixing solution L toward the toner image, and a first electrode 174 configured to apply a voltage to the fixing solution L contained in the container portion 173 and the nozzles 1N. The first electrode 174 penetrates a top wall 173A of the container portion 173 downward. The lower end portion of the first electrode 174 is positioned in the fixing solution L contained in the container portion 173, and the upper end portion of the first electrode 174 is connected to the controller 100 which has a voltage applying portion 110.

Figure 20A:
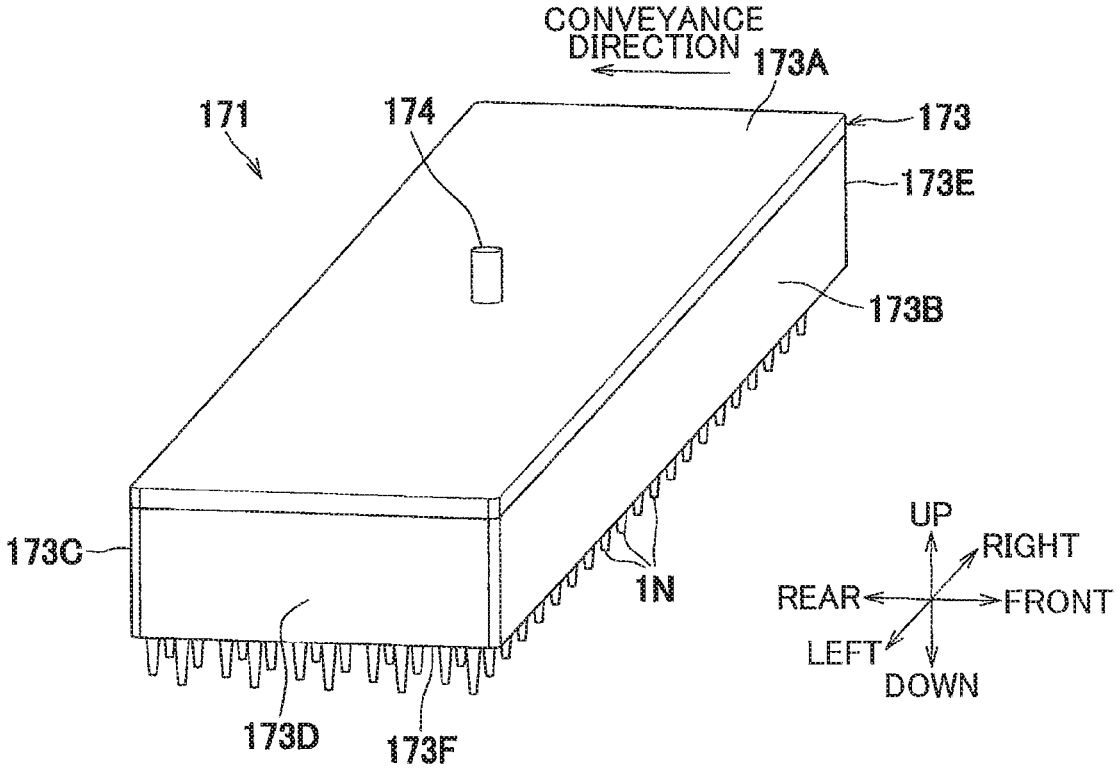
FIG. 20A is a perspective view of a fixing head as viewed from diagonally above.

As illustrated in FIG. 20A, the container portion 173 is a rectangular container which is elongated in a left-right direction, that is, a width direction of the paper P. The container portion 173 has the top wall 173A, a front wall 173B, a rear wall 173C, a left wall 173D, a right wall 173E, and a bottom wall 173F.

Figure 20B:
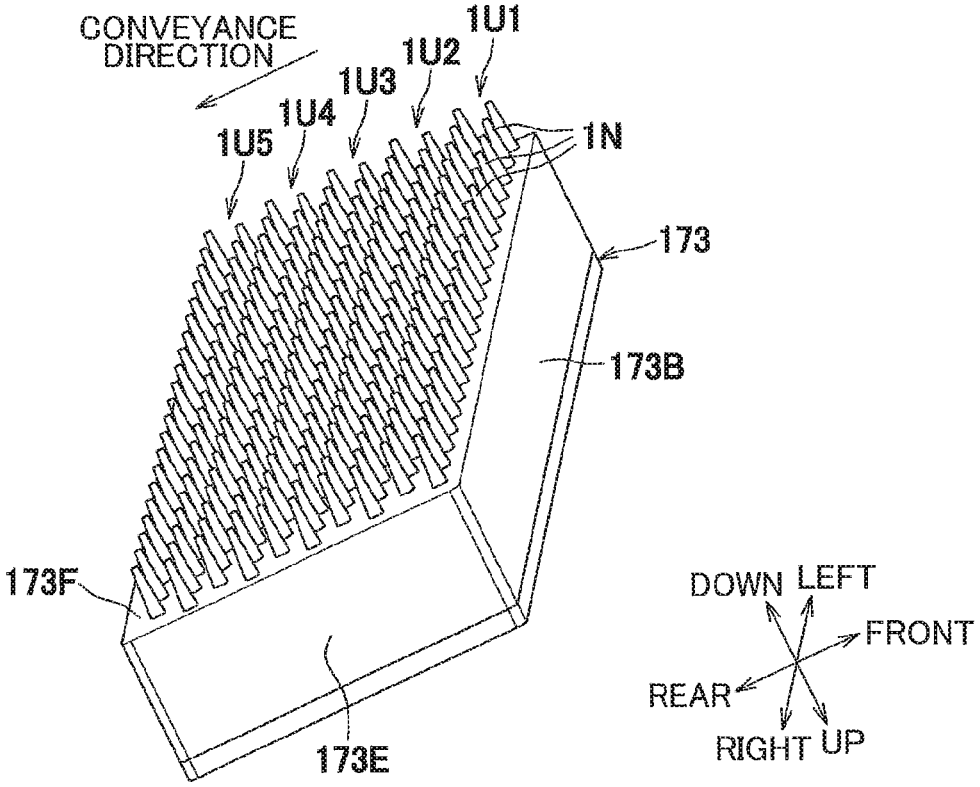
FIG. 20B is a perspective view of the fixing head as viewed from diagonally below.

As illustrated in FIG. 20B, the plurality of nozzles 1N protrudes downward from the bottom wall 173F of the container portion 173 with their diameters gradually reduced as they extend downward. The plurality of nozzles 1N is disposed such that a plurality of lines of nozzles 1N is arranged one after another in the conveyance direction of the paper P, that is, the front-rear direction, and that each line has a plurality of nozzles arranged in the width direction of the paper P, that is, the left-right direction.

Specifically, the plurality of nozzles 1N constitute five staggered array groups 1U1, 1U2, 1U3, 1U4, and 1U5, disposed in the conveyance direction. In the following description, the staggered array group 1U1, 1U2, 1U3, 1U4, and 1U5 arranged from the front end to the rear end in this order will be referred to as the first staggered array group 1U1, the second staggered array group 1U2, the third staggered array group 1U3, the fourth staggered array group 1U3, and the fifth staggered array group 1U5.

Figures 21A, 21B:
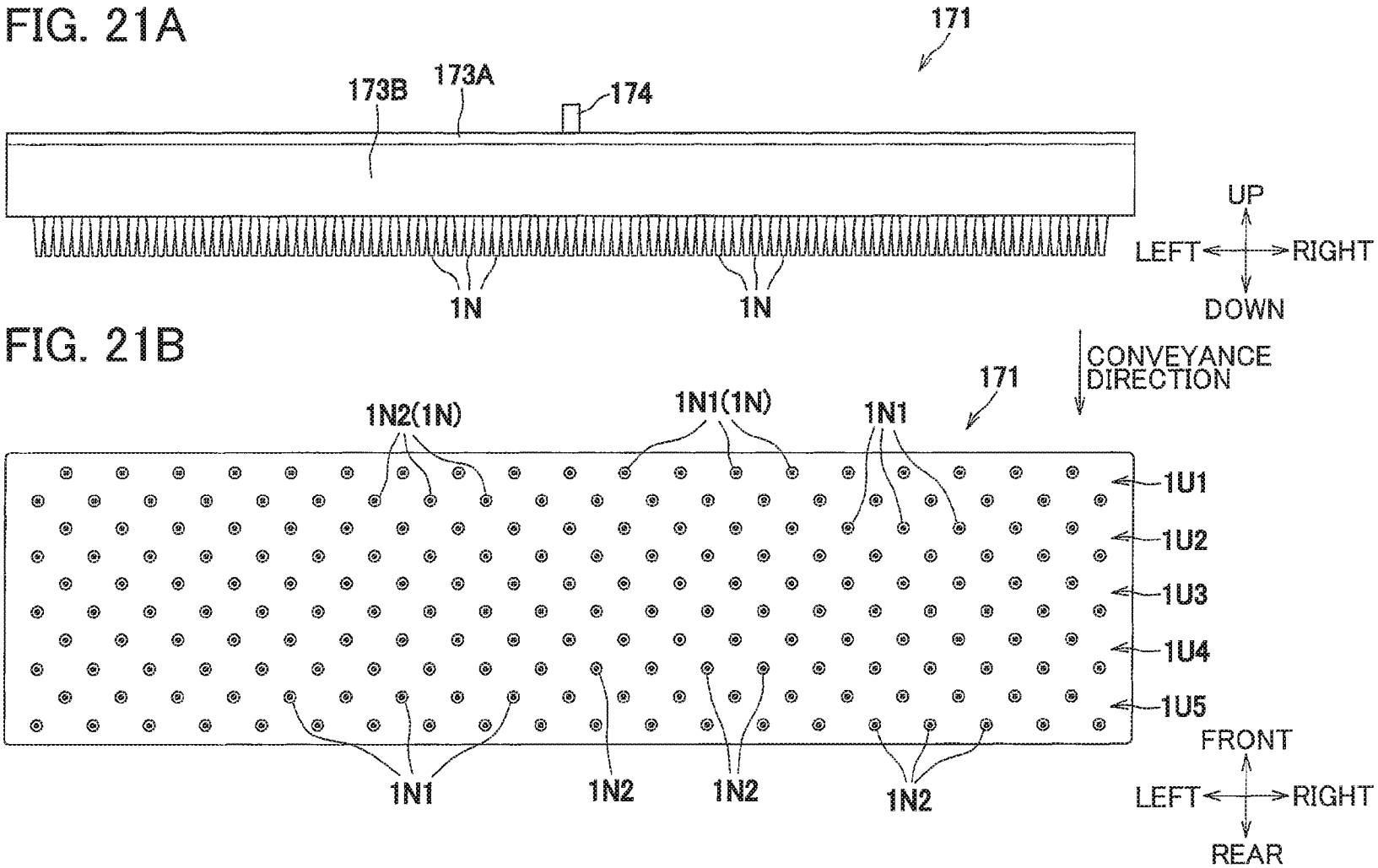
FIG. 21A is a front view of the fixing head.
FIG. 21B is a bottom view of the fixing head.

As illustrated in FIGS. 21A and 21B, the first staggered array group 1U1 includes a plurality of first nozzles 1N1 arranged in the width direction at regular intervals and a plurality of second nozzles 1N2 arranged in the width direction at regular intervals. The first nozzles 1N1 and the second nozzles 1N2 are alternately arranged in the width direction with the first nozzles 1N1 disposed in one side with respect to the conveyance direction and with the second nozzles 1N2 disposed in the other side with respect to the conveyance direction. Each of the first nozzles 1N1 is disposed between two adjacent second nozzles 1N2 in the width direction. The second staggered array group 1U2, the third staggered array group 1U3, the fourth staggered array group 1U4, and the fifth staggered array group 1U5 have the same structure as that of the first staggered array group 1U1.

The pitch of the nozzles 1N can be set to a value in a range from 2 to 15 mm.

As illustrated in FIG. 19, the conveyance member 175, which is one example of an opposing member, is disposed between the fixing head 171 and the second electrode 172, and separated from the tip ends of the nozzles 1N by a predetermined first distance. Here, the first distance is larger than the thickness of the paper P, and is set through an experiment or a simulation so that the paper P on the conveyance member 175 can be satisfactorily sprayed with the fixing solution L.

In addition, the conveyance member 175 contains conductive resin or metal, and is connected to the controller 100, which includes a voltage applying portion 110.

Figures 22A, 22B:
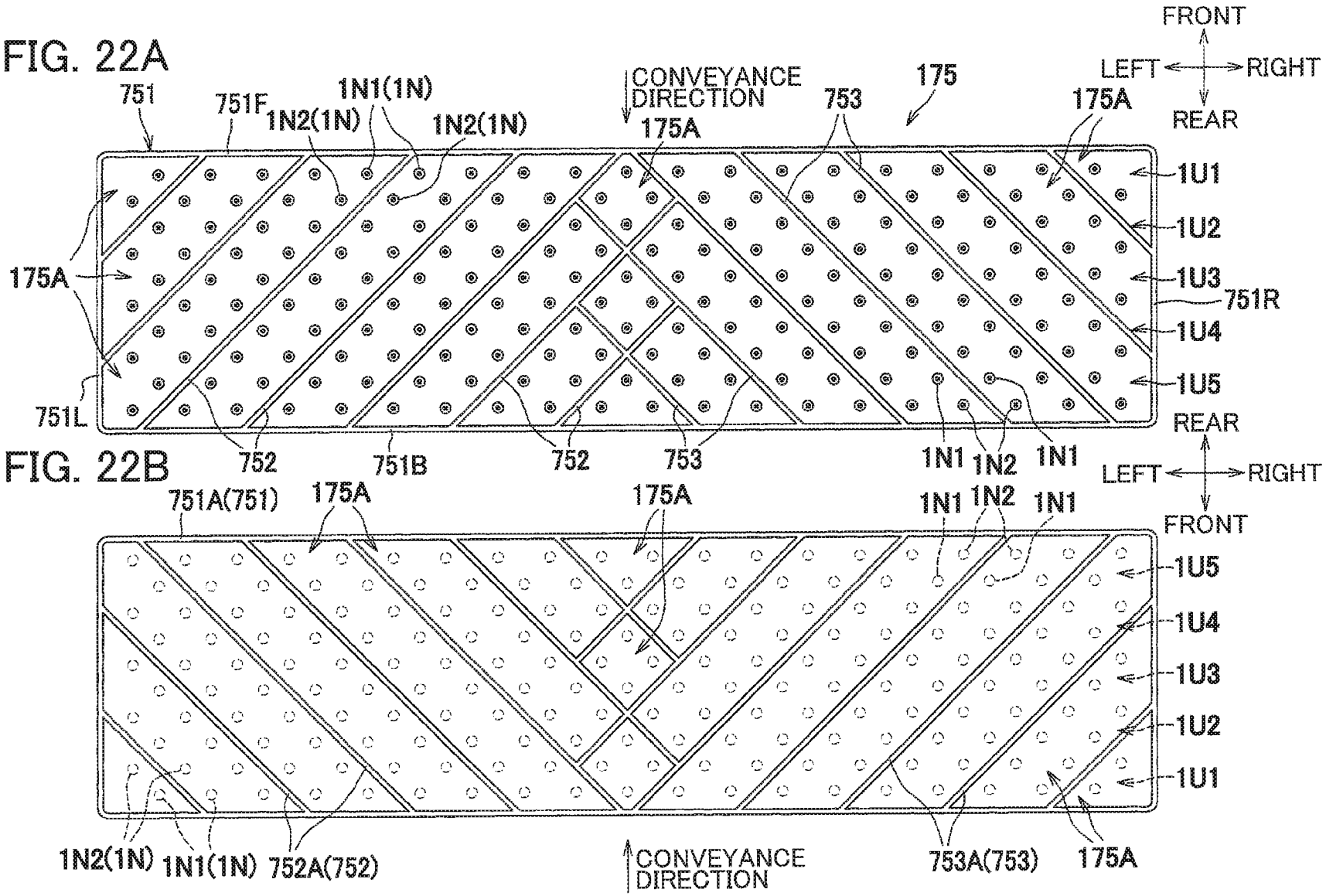
FIG. 22A is a bottom view of a conveyance member and a nozzle.
FIG. 22B is a plan view of the conveyance member.

As illustrated in FIG. 22A, the conveyance member 175 includes a frame 751, a plurality of first conveyance ribs 752, and a plurality of second conveyance ribs 753, which are integrally formed. The frame 751 has a rectangular shape, and is elongated in the left-right direction. The first conveyance ribs 752 and the second conveyance ribs 753 are examples of a joining portion. The plurality of first conveyance ribs 752 extends diagonally rearward left in a substantially left-half space defined by the frame 751. The plurality of second conveyance ribs 753 extends diagonally rearward right in a substantially right-half space defined by the frame 751. Here, FIG. 22A is a bottom view in which the conveyance member 175 and the nozzles 1N are viewed from below, and FIG. 22B is a top view in which the conveyance member 175 is viewed from above.

The frame 751 includes a first portion 751F extending in the longitudinal direction of the container portion 173, a second portion 751B separated from the first portion 751F in the conveyance direction of the paper P and extending in the longitudinal direction, a third portion 751L joining the left end portion of the first portion 751F and the left end portion of the second portion 751B, and a fourth portion 751R joining the right end portion of the first portion 751F and the right end portion of the second portion 751B. The first portion 751F, the second portion 751B, the third portion 751L, and the fourth portion 751R are integrally formed.

The plurality of first conveyance ribs 752 is slanted so as to extend outward in the left direction as the first conveyance ribs 752 extend toward the downstream side in the conveyance direction. The plurality of second conveyance ribs 753 is also slanted so as to extend outward in the right direction as the second conveyance ribs 753 extend toward the downstream side in the conveyance direction. The first conveyance ribs 752 and the second conveyance ribs 753 are bilaterally symmetrical with respect to a conveyance center of the paper P (that is, a central portion of the paper P, which is being conveyed, in the left-right direction). Specifically, the first conveyance ribs 752 and the second conveyance ribs 753 are formed as below.

Among the plurality of first conveyance ribs 752, five first conveyance ribs 752 disposed on the left side extend diagonally rearward left from the first portion 751F of the frame 751, and are joined with the third portion 751L or the second portion 751B of the frame 751. In addition, among the plurality of first conveyance ribs 752, two first conveyance ribs 752 disposed on the right side extend diagonally rearward left from the corresponding second conveyance ribs 753, and are joined with the second portion 751B of the frame 751.

Among the plurality of second conveyance ribs 753, five second conveyance ribs 753 disposed on the right side extend diagonally rearward right from the first portion 751F of the frame 751, and are joined with the fourth portion 751R or the second portion 751B of the frame 751. In addition, among the plurality of second conveyance ribs 753, two second conveyance ribs 753 disposed on the left side extend diagonally rearward right from the corresponding first conveyance ribs 752, and are joined with the second portion 751B of the frame 751.

The two first conveyance ribs 752 disposed on the right side and the two second conveyance ribs 753 disposed on the left side are joined, crossing each other at a middle position in the longitudinal direction.

As illustrated in FIG. 22B, the top surfaces of the first conveyance ribs 752 facing the container portion 173 are first conveyance surfaces 752A, which are used to convey the paper P. Also, the top surfaces of the second conveyance ribs 753 are second conveyance surfaces 753A, which are used to convey the paper P. In addition, the top surface of the frame 751 is a third conveyance surface 751A, which is used to convey the paper P. The conveyance surfaces 752A, 753A, and 751A are examples of an opposing surface.

A front edge portion of the third conveyance surface 751A, that is, an upstream edge portion of the third conveyance surface 751A in the conveyance direction, is disposed upstream of the most upstream nozzles 1N in the conveyance direction (that is, the first nozzles 1N1 of the first staggered array group 1U1). A rear edge portion of the third conveyance surface 751A, that is, an downstream edge portion of the third conveyance surface 751A in the conveyance direction, is disposed downstream of the most downstream nozzles 1N in the conveyance direction (that is, the second nozzles 1N2 of the fifth staggered array group 1U5).

A left edge portion of the third conveyance surface 751A is disposed left side of the leftmost nozzles 1N. A right edge portion of the third conveyance surface 751A is disposed right side of the rightmost nozzles 1N.

The plurality of first conveyance surfaces 752A is disposed at gaps. In addition, the plurality of second conveyance surfaces 753A is also disposed at gaps. The conveyance surfaces 751A, 752A, and 753A are flush with each other. The conveyance surfaces 751A, 752A, and 753A constitute a single conveyance surface, and are joined with each other at respective crossing points. The third conveyance surface 751A, and the first conveyance surfaces 752A or the second conveyance surfaces 753A are disposed at gaps except portions at which the third conveyance surface 751A is joined to the first conveyance surfaces 752A or the second conveyance surfaces 753A.

The conveyance surfaces 751A, 752A, and 753A are disposed shifted from the nozzles 1N when viewed in a direction orthogonal to the conveyance surfaces 751A, 752A, and 753A, that is, when viewed from below. In addition, the first conveyance surfaces 752A are slanted with respect to the front-rear direction so that each first conveyance surface 752A extends between two adjacent first nozzles 1N1 and between two adjacent second nozzles 1N2 when viewed from below. The second conveyance surfaces 753A are slanted with respect to the front-rear direction so that each second conveyance surface 753A extends between two adjacent first nozzles 1N1 and between two adjacent second nozzles 1N2 when viewed from below.

In other words, the conveyance member 175 includes a plurality of opening parts 175A penetrating the conveyance member 175 from the side of the conveyance surfaces 751A, 752A, and 753A toward the side of the second electrode 172, that is, from the upper side toward the lower side. In addition, each opening part 175A is disposed at a position corresponding to the nozzles 1N. That is, each opening part 175A is disposed at a position so that each opening part 175A overlaps with the corresponding nozzles 1N when viewed from below.

Specifically, each of the opening parts 175A is larger than an outer peripheral shape of the corresponding nozzle 1N. In other words, the outer periphery of each opening part 175A encloses the plurality of corresponding nozzles 1N when viewed from below.

As illustrated in FIG. 19, the second electrode 172 is used to produce a potential difference between the fixing solution L in the nozzles 1N and the paper P, and is separated from the tip ends of the nozzles 1N by a second distance larger than the above-described first distance. Here, the second distance is set through an experiment or a simulation so that the electrostatic spraying can be satisfactorily performed.

The second electrode 172 is grounded. However, the second electrode 172 may not necessarily be grounded, and may be applied with a voltage lower than voltages applied to the first electrode 174 and the conveyance member 175.

Figure 23:
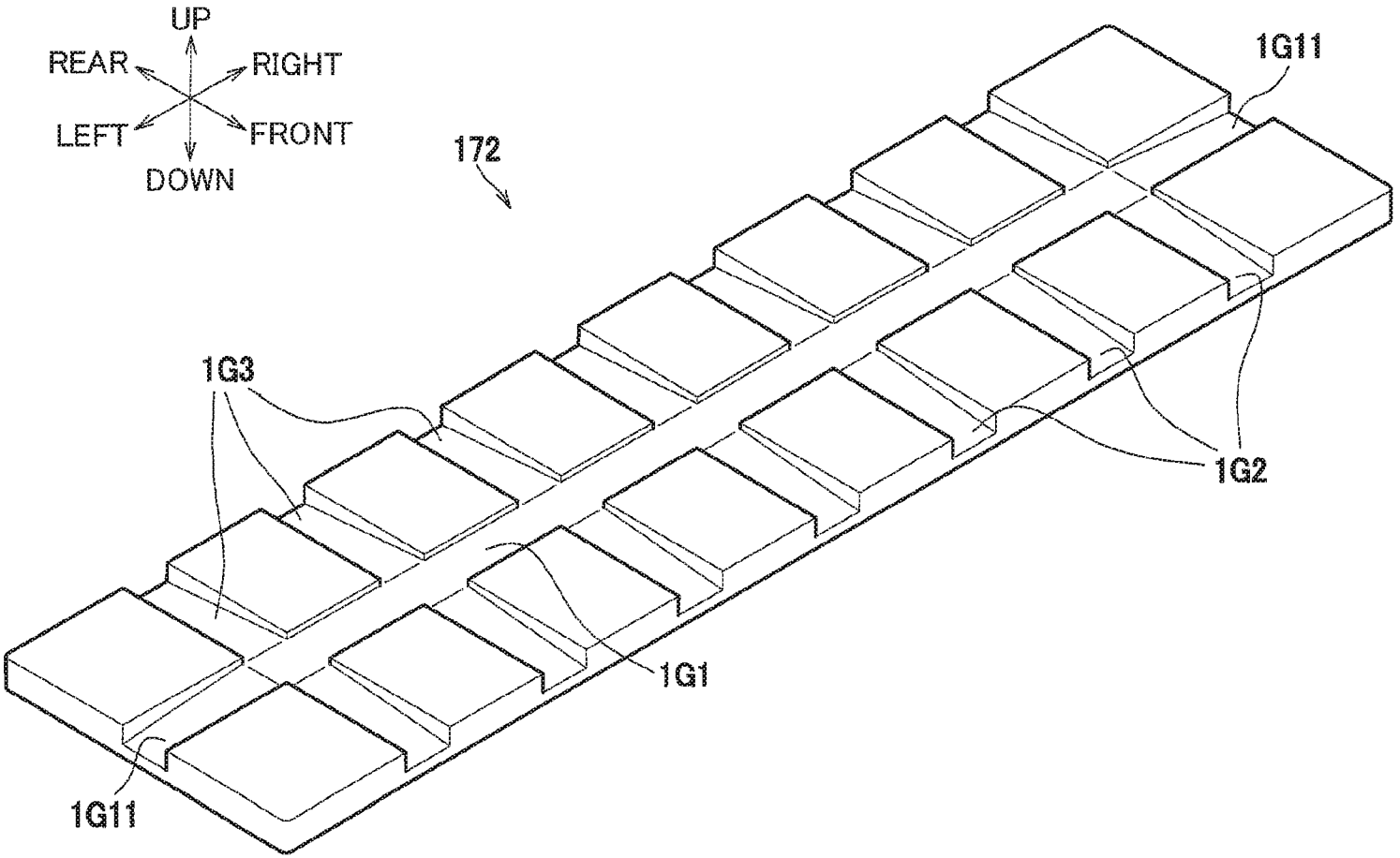
FIG. 23 is a perspective view of a second electrode.

As illustrated in FIG. 23, the second electrode 172 is a plate-like member which is elongated in the left-right direction and contains conductive resin or metal. The second electrode 172 includes a first guide groove 1G1, second guide grooves 1G2, and third guide grooves 1G3, which guide the fixing solution L toward the storage portion 176 (see FIG. 19) disposed below the second electrode 172. The first guide groove 1G1 is formed in the top surface of the second electrode 172, so as to penetrating a side of the first groove 1G1 from the left end to the right end. Both end portions 1G11 of the first guide groove 1G1 are sloped downwardly outward with respect to the right or left direction.

Each of the plurality of second guide grooves 1G2 is continuously provided from the first guide groove 1G1. The second guide grooves 1G2 are sloped downwardly frontward from portions of the first guide groove 1G1 which are separated from both ends of the first guide groove 1G1 in the left-right direction. The front end portions of the second guide grooves 1G2 are opened toward the front direction. Each of the plurality of third guide grooves 1G3 is continuously provided from the first guide groove 1G1. The third guide grooves 1G3 are sloped downwardly rearward from portions of the first guide groove 1G1 which are separated from both ends of the first guide groove 1G1 in the left-right direction. The rear end portions of the third guide grooves 1G3 are opened toward the rear direction. Specifically, the plurality of third guide grooves 1G3 is disposed at the same positions as those of the plurality of second guide grooves 1G2 in the left-right direction.

As illustrated in FIG. 19, the storage portion 176 is a box-shaped member whose top portion is opened, and is made larger than the second electrode 172 in the front-rear direction and in the left-right direction. The second electrode 172 is disposed such that portions of the second electrode 172 other than the above-described guide grooves 1G1 to 1G3 are fixed to the casing 2 or an edge of the opening of the storage portion 176 via a supporting member (not illustrated). With this configuration, the fixing solution L having been sprayed toward the second electrode 172 flows toward the outer periphery of the second electrode 172 through the guide grooves 1G1-1G3, and flows into the storage portion 176 through a space between the outer periphery of the second electrode 172 and the edge of the opening of the storage portion 176. Accordingly, the fixing solution L is stored in the storage portion 176.

The supply tank 177 is filled with the fixing solution L, and is detachably attached to the casing 2. The supply tank 177 and the container portion 173 of the fixing head 172 are connected with each other via a pipe so that an interior space of the supply tank 177 communicates with an interior space of the container portion 173. Thus, the fixing solution L in the supply tank 177 is supplied to the container portion 173.

The pressurization device 178 pressurizes the air of the supply tank 177, and thereby pressurizes the fixing solution L in the supply tank 177 and the container portion 173.

The controller 100 includes a CPU, a RAM, a ROM, and an input and output circuit. The controller 100 has a function which controls voltages applied to the first electrode 174 and the conveyance member 175 on the basis of image data inputted from the outside or a signal from the paper sensor SP. The controller 100 includes the voltage applying portion 110 which applies voltages to the first electrode 174 and the conveyance member 175.

The controller 100 controls the voltage applying portion 110, and thereby produces a first potential difference between the first electrode 174 and the conveyance surfaces 751A, 752A, and 753A of the conveyance member 175, and a second potential difference between the first electrode 174 and the second electrode 172. The second potential difference is larger than the first potential difference. For example, in a case where the fixing solution L is positively charged, the first electrode 174 may be applied with a first voltage of +10 kV, and the conveyance member 175 may be applied with a second voltage of +5 kV. In this case, since the second electrode 172 is grounded, the first potential difference is +5 kV, and the second potential difference is +10 kV.

The controller 100 has a function for controlling the voltage applying portion 110 to start applying voltages to the first electrode 174 and the conveyance member 175 after the controller 100 starts the print control and before the first sheet of the paper P reaches the third conveyance surface 751A. The controller 100 also has a function for lowering, when the controller 100 determines that the first sheet of the paper P is reaching the third conveyance surface 751A, the voltage applied to the third conveyance surface 751A than the voltage applied before the controller 100 makes the determination. Specifically, in the second embodiment, after receiving a print command, the controller 100 immediately starts applying the second voltage to the conveyance member 175. Subsequently, when receiving from the paper sensor SP a signal indicating that the leading edge of the paper P has passed the paper sensor SP, the controller 100 changes the voltage applied to the conveyance member 175 from the second voltage to the third voltage lower than the second voltage. For example, in a case where the second voltage is set to +5 kV as described above, the third voltage may be set to a voltage lower than +5 kV and higher than 0 kV.

In addition, the controller 100 has a function to execute a purge control when water of the fixing solution L in the tip ends of the nozzles 1N evaporates and the viscosity of the fixing solution L is increased (for example, when the fixing operation has not been performed for a predetermined period of time or more). In the purge control, the controller 100 controls the pressurization device 178 to pressurize the fixing solution L in the fixing head 171 so that the fixing solution L, with which the tip ends of the nozzles 1N are clogged, is discharged from the nozzles 1N to the outside.

Next, an operation of the controller 100 will be described in detail. The controller repeatedly executes a process shown in FIG. 24.

Figure 24:
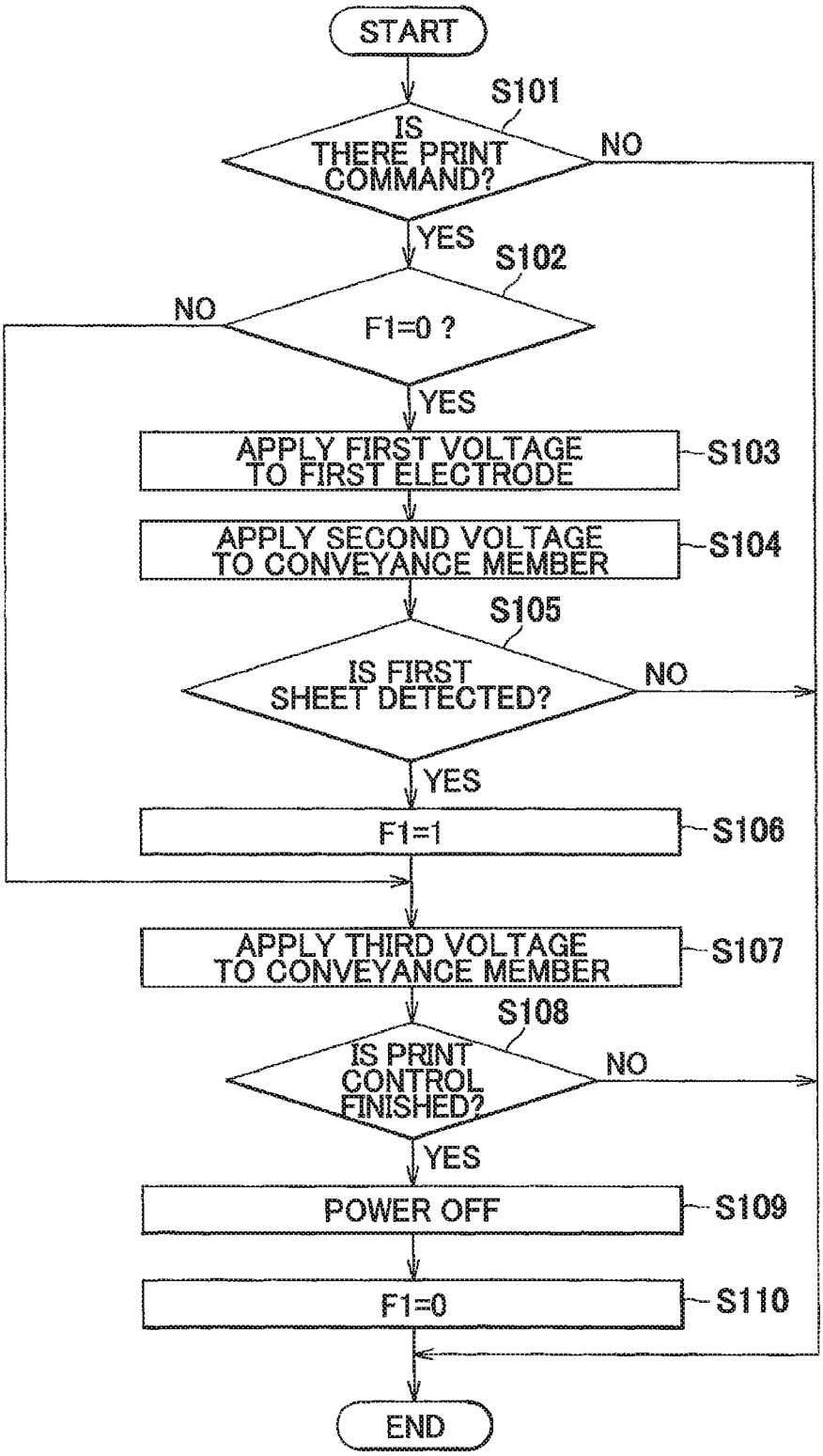
FIG. 24 is a flowchart illustrating operation of a controller.

As illustrated in FIG. 24, the controller 100 first determines whether the controller 100 has received a print command (S101). If the controller 100 determines in Step S101 that the controller 100 has not received a print command (S101: No), then the controller 100 ends this control. Once the print command is received, the controller 100 makes YES determination in S101 while all the predetermined number of sheets specified by the print command are not printed. When all the predetermined number of sheets are printed, and a next print command is not received, the controller 100 makes NO determination in S101. If the controller 100 determines in Step 101 that the controller 100 has received a print command (S101: Yes), then the controller 100 determines whether a flag F1 is 0 (S102).

If the controller 100 determines in Step S102 that the flag F1 is 0 (S102: Yes), then the controller 100 applies the first voltage to the first electrode 174 (S103), and applies the second voltage to the conveyance member 175 (S104). If in the previously executed process shown in FIG. 24, the first voltage is already applied to the first electrode 174, and if the second voltage is already applied to the conveyance member 175, in S103 the controller 103 maintains the first voltage applied to the first electrode 174, and in S104 maintains the second voltage applied to the conveyance member 175. After Step S104, the controller 100 determines whether the controller 100 has received a signal from the paper sensor SP, and thereby determines whether the first sheet of the paper P is detected by the paper sensor SP after the reception of the print command (S105). In other words, in Step S105 the controller 100 determines whether the first sheet of the paper P, detected after the reception of the print command, is reaching the fixing device 107.

In the second embodiment, the controller 100 determines that the first sheet of the paper P is reaching the fixing device 107 when receiving the first signal from the paper sensor SP. However, the present invention is not limited to this. For example, the controller 100 may determine whether the first sheet of the paper P is reaching the fixing device 107, by determining whether a predetermined period of time has elapsed after the reception of the first signal from the paper sensor SP.

If in Step S105 the controller 100 determines that the first sheet of the paper P is not detected (S105: No), then the controller 100 ends this control. If the controller 100 determines in Step S105 that the first sheet of the paper P is detected (S105: Yes), then the controller 100 sets the flag F1 to 1 (Step S106), and proceeds to Step S107. If in Step S102 the controller 100 determines that the flag F1 is 1 (S102: No), then controller 100 skips the steps S103 to S106, and proceeds to Step S107.

In Step S107, the controller 100 applies the third voltage smaller than the second voltage to the conveyance member 175. If in the previously executed process shown in FIG. 24, the third voltage is applied to the conveyance member 175, in S107 the controller 103 maintains the third voltage applied to the conveyance member 175. After Step S107, the controller 100 determines whether the print control has been performed for the predetermined number of sheets specified by the print command (S108).

If in Step S108 the controller 100 determines that the print control is not finished (S108: No), then the controller 100 ends this control. If the controller 100 determines in Step S108 that the print control is finished (S108: Yes), then the controller 100 turns off the voltages applied to the first electrode 174 and the conveyance member 175 (S109), then sets the flag F1 to 0 (S110), and then ends this control.

Figure 25:
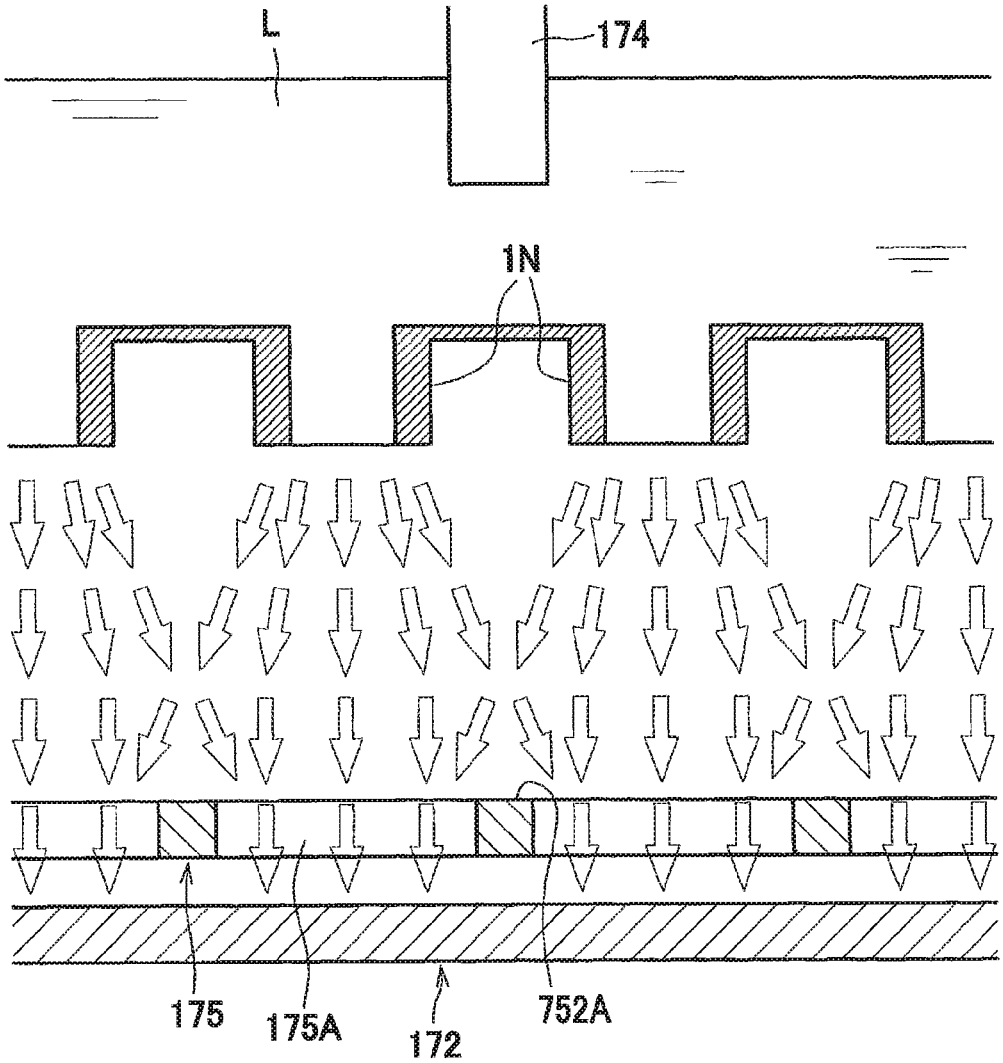
FIG. 25 is a schematic view illustrating function and effect of the fixing device.

Next, effects by the fixing device 107 will be described in detail with reference to FIG. 25. Here, in FIG. 25 components including the nozzles 1N are simplified for convenience.

When the controller 100 applies the first voltage to the first electrode 174, and the second voltage to the conveyance member 175, the second potential difference between the first electrode 174 and the second electrode 172 becomes larger than the first potential difference between the first electrode 174 and the conveyance member 175. With this application, as illustrated in FIG. 25, the fixing solution L having been sprayed from the nozzles 1N moves toward the second electrode 172, while avoiding the conveyance surface (such as the first conveyance surface 752A) which is being applied with the second voltage. As a result, if the spraying from the nozzles 1N is started before the paper P reaches the fixing device 107, the fixing solution L does not adhere to the conveyance surface. Thus, the fixing solution L can be prevented from adhering to the conveyance surface, thereby avoiding a situation in which the adhered fixing solution L to the conveyance surface would obstruct the conveyance of the paper P.

In addition, even when the voltage applied to the conveyance member 175 is changed from the second voltage to the third voltage lower than the second voltage, the relationship between the first potential difference and the second potential difference is unchanged. Thus, even when the paper P is on one portion of the conveyance surface, the fixing solution L can be prevented from adhering to the other portion of the conveyance surface.

When the purge control is performed for discharging a high-viscous fixing solution L with which the tip ends of the nozzles 1N are clogged, the high-viscous fixing solution L is discharged straight toward a position which is directly below the nozzles 1N. Even in such a case, since the conveyance surface is shifted from the nozzles 1N when viewed in the vertical direction, that is, since each of the opening parts 175A is disposed at a position corresponding to the nozzles 1N, the fixing solution L, which is discharged straight toward the position directly below the nozzles 1N, can be prevented from adhering to the conveyance surface.

In addition, since each of the opening parts 175A is larger than the outer peripheral shape of the corresponding nozzle 1N, the fixing solution L can be more effectively prevented from adhering to the conveyance surface in the purge control.

The second embodiment can also produce the following effects in addition to the above-described effects.

The plurality of first conveyance ribs 752 is slanted so as to extend outward in the left direction as the first conveyance ribs 752 extends toward the downstream side in the conveyance direction, and the plurality of second conveyance ribs 753 is slanted so as to extend outward in the right direction as the second conveyance ribs 753 extends toward the downstream side in the conveyance direction. Thus, when the paper P is conveyed on the conveyance ribs 752 and 753, force acts outwardly in the left-right direction on the conveyance ribs 752 and 753. As a result, the right edge portion and the left edge portion of the paper P are stretched outward in the respective left and right directions, and thus the paper P can be prevented from being wrinkled in the fixing operation.

Because the second electrode 172 includes the guide grooves 1G1 to 1G3 guiding the fixing solution L toward the storage portion 176, the fixing solution L, which has moved from the nozzles 1N to the second electrode 172 through the opening parts 175A of the conveyance member 175, can be guided toward the storage portion 176 by the guide grooves 1G1 to 1G3. As a result, the fixing solution L can be prevented from remaining on the second electrode 172.

The high second voltage is applied to the conveyance member 175 before the paper P reaches the third conveyance surface 751A, and thus the fixing solution L can be effectively prevented from adhering to the conveyance surface, such as the third conveyance surface 751A. In addition, when the paper sensor SP detects the paper P, that is, when the controller 100 determines that the paper P is reaching the third conveyance surface 751A, the controller 100 applies the low third voltage to the conveyance member 175. As a result, the electric potential of the paper P which is in contact with the conveyance surface, such as the third conveyance surface 751A, can be lowered, and thus the fixing solution L can be effectively sprayed to the paper P.

The present invention can be used in various embodiments as examples as described below without limited to the second embodiment. In the following description, a member having substantially the structures the same as those of the second embodiment will be given the same reference numerals, and the description thereof will be omitted.

Figure 26A:
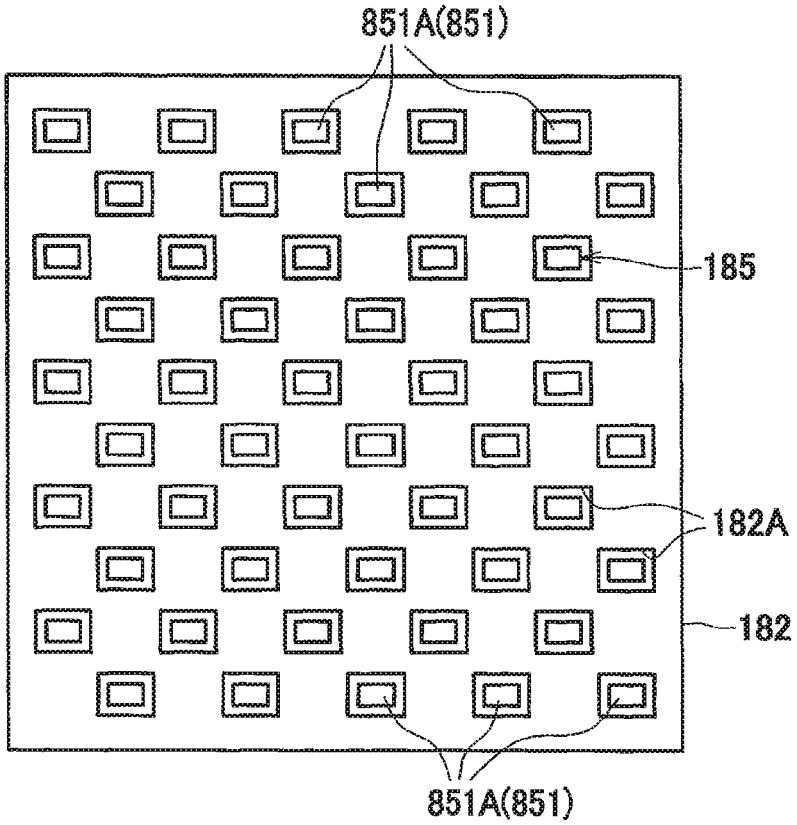
FIG. 26A is a plan view illustrating a modification of the conveyance member and the second electrode.
Figure 26B:
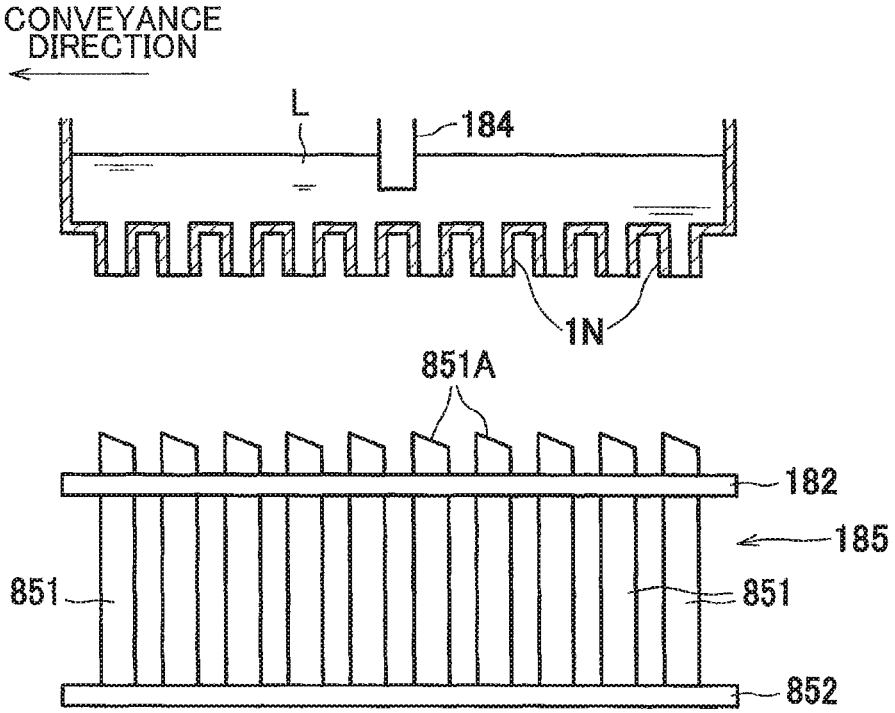
FIG. 26B is a side view of the modification.

In the second embodiment, the whole of the conveyance member 175 is disposed between the first electrode 174 and the second electrode 172. However, the present invention is not limited to this. For example, as illustrated in FIGS. 26A and 26B, a plurality of conveyance surfaces 851A of a conveyance member 185 only have to be disposed between a first electrode 184 and a second electrode 182, and thus the other portions of the conveyance member 185 may be disposed below the second electrode 182. The plurality of conveyance surfaces 851A is one example of a plurality of conveyance surfaces. In this embodiment, each of the conveyance surfaces 851A serves as one conveyance surface.

Specifically, as shown in FIGS. 26A and 26B, the conveyance member 185 includes a plate-like base portion 852 disposed below the second electrode 182, and a plurality of protrusions 851 extending upward from the base portion 852. The base portion 852 and the protrusions 851 are integrally formed. A top surface of each of the protrusions 851 is one of the conveyance surfaces 851A, along which the paper P is conveyed. The conveyance surfaces 851A are positioned at an identical position in the vertical direction.

Each of conveyance surface 851A is sloped upward toward downstream side in the conveyance direction. The second electrode 182 has a plurality of through holes 182A. Each of the plurality of protrusions 851 is inserted through the corresponding through hole 182A from the lower side to the upper side.

Even in this embodiment, the same effects as those of the second embodiment can be obtained by setting a potential difference between the first electrode 184 and the conveyance surfaces 851A to the first potential difference, and setting a potential difference between the first electrode 184 and the second electrode 182 to the second potential difference, which is larger than the first potential difference. In this embodiment, because each of the conveyance surfaces 851A is sloped upward toward downstream side in the conveyance direction, the leading edge of the paper P can be prevented from moving down into a space between adjacent protrusions 851.

In the second embodiment, the outer periphery of each of the opening parts 175A encloses the corresponding nozzles 1N. However, the present invention is not limited to this. For example, the outer periphery of each of the opening parts 175A may enclose a corresponding single nozzle. That is, the plate-like conveyance member may be provided with a plurality of holes in one-to-one correspondence with the plurality of nozzles. In this case, each of the conveyance surfaces encircled in the corresponding hole constitutes one conveyance surface.

In the second embodiment, the second electrode 182 is provided with the guide grooves 1G1-1G3. However, the present invention is not limited to this. For example, the second electrode 182 may have a netlike shape to guide the fixing solution L to the storage portion, or may have a plate like shape sloped with respect to a horizontal plane to guide the fixing solution L to the storage portion.

In the second embodiment, the fixing solution L is positively charged. However, the present invention is not limited to this. For example, the fixing solution L may be negatively charged. In this case, electrodes such as the first electrode may be applied with a negative voltage.

In the second embodiment, the present invention is applied to the laser printer 101. However, the present invention is not limited to this, and may be applied to other image forming devices, such as copying machines and multifunction peripherals.

In the second embodiment, the paper P, such as thick paper, postcard, or thin paper, is described as one example of recording sheet. However, the present invention is not limited to this, and the recording sheet may be a transparency film for example.

In the second embodiment, the first electrode 174 is disposed in the interior of the container portion 173. However, the present invention is not limited to this. For example, the container portion may be made of a conductive member, and the container portion may be applied with a voltage. In this case, the container portion functions as the first electrode. In another case, only the nozzles may be made of conductive member, and the nozzles may be applied with a voltage. In this case, the nozzles function as the first electrode.

In the second embodiment, the first conveyance ribs 752 having a plate-like shape and the second conveyance ribs 753 having a plate-like shape are described as an example. However, the present invention is not limited to this. For example, the joining portion may be a long and narrow member like a wire.

The second object can be achieved by the second embodiment described with reference to FIGS. 19 to 26. The above-described second embodiment is one example of the second invention, and the second invention is not limited to this.

A laser printer 201 according to a third embodiment of the present invention will be described with reference to FIGS. 27 to 45. In the third embodiment, like parts and components are designated with the same reference numerals as the first embodiment to avoid duplicating description. The laser printer 201 includes a fixing device 207.

Figure 27:
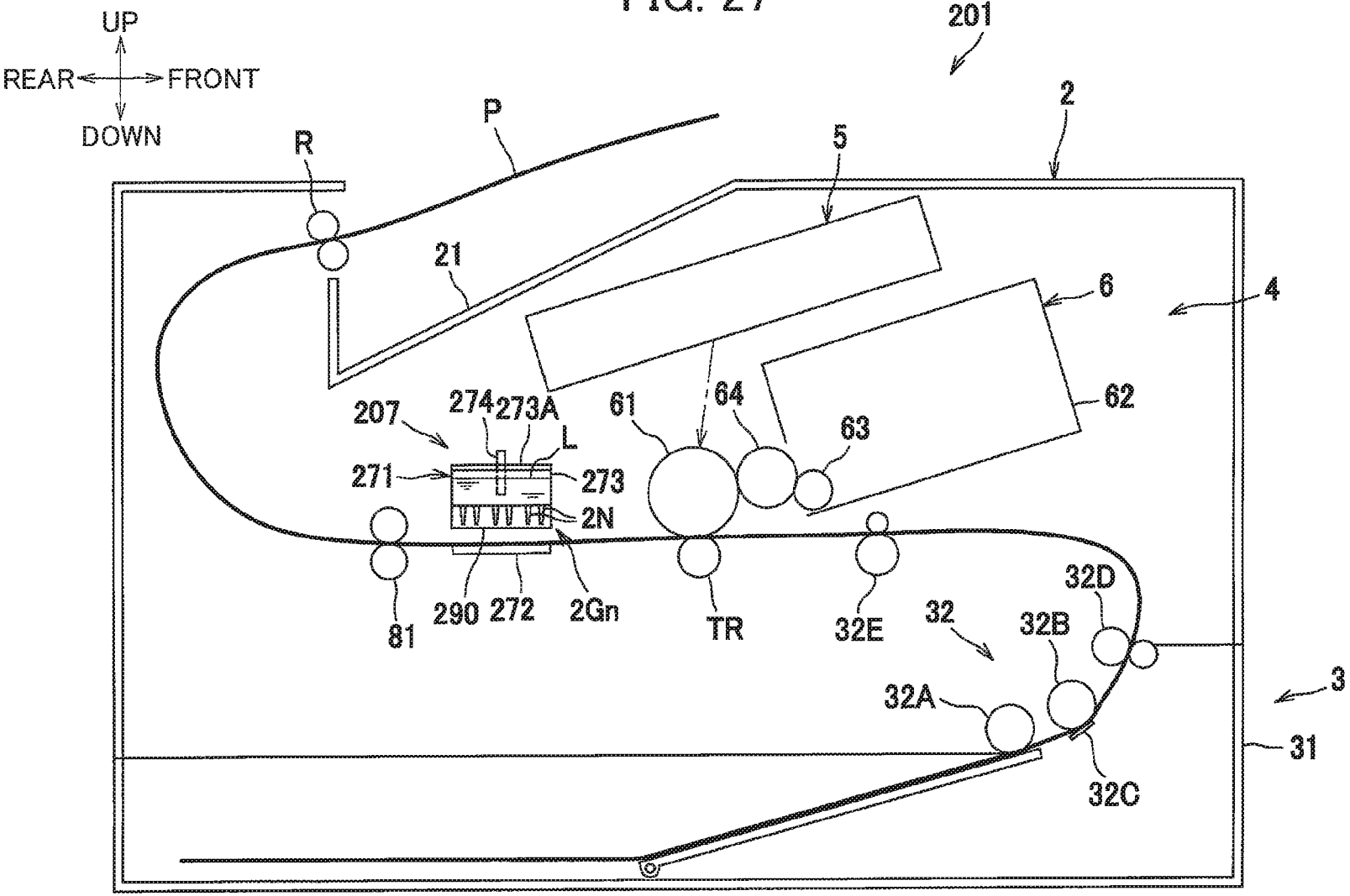
FIG. 27 is a view illustrating a laser printer provided with a fixing device according to a third embodiment of the present invention.

In the following description, directions are defined with respect to a position shown in FIG. 27. That is, the right side of FIG. 27 is defined as a front side, the left side of FIG. 27 is defined as a rear side, the far side of FIG. 27 is defined as a right side, and the near side of FIG. 27 is defined as a left side. The upward and downward directions of FIG. 27 are defined as upward and downward directions.

As illustrated in FIG. 27, the fixing device 207 is configured to spray electrically charged fixing solution L toward a toner image on paper P and fixes the toner image to the paper P under the electrostatic spraying method. A configuration of the fixing device 207 will be described in detail later.

A downstream side conveyance roller 81 is provided on the downstream side of the fixing device 207 in order to convey the paper P discharged from the fixing device 207 to the downstream side. The paper P conveyed by the downstream side conveyance roller 81 is conveyed to a discharge roller R, and then discharged from the discharge roller R onto a paper discharge tray 21.

Next, the configuration of the fixing device 207 will be described in detail.

The fixing device 207 includes a fixing head 271 used to spray the fixing solution L, and a second electrode 272. The second electrode 272 is disposed at a position below the fixing head 271 so as to face the fixing head 271, and supports the paper P, which is conveyed toward a space below the fixing head 271, at the position below the fixing head 271. Here, the rollers (such as a photosensitive drum 61, a transfer roller TR, the downstream side conveyance roller 81, and the like) disposed on the upstream side or the downstream side of the fixing head 271 constitute a conveyance mechanism which conveys the paper P to a space between later-described nozzles 2N and the second electrode 272 in a direction extending from a front side toward a rear side of the fixing head 271.

The fixing head 271 includes: a container portion 273 which contains the fixing solution L; a nozzle group 2Gn including a plurality of nozzles 2N which communicates with the container portion 273 and sprays the fixing solution L toward the toner image; and a first electrode 274 which applies a voltage to the fixing solution L contained in the container portion 273 and nozzles 2N. The nozzle group 2Gn includes all the nozzles 2N of the fixing head 271. In other words, the nozzle group 2Gn has a plurality of lateral nozzle arrays arrayed with each other in a conveyance direction, and each lateral nozzle array includes a plurality of nozzles 2N arrayed in a left-right direction. In the embodiment illustrated in FIG. 29, the nozzle group 2Gn has six lateral nozzle arrays. Each of the nozzles 2N has an inner diameter in a range from 0.1 to 1.0 mm.

The first electrode 274 penetrates a top wall 273A of the container portion 273 downward. The lower end portion of the first electrode 274 is positioned in the fixing solution L contained in the container portion 73, and the upper end portion of the first electrode 274 is connected to a controller which has a voltage applying portion (not illustrated).

The second electrode 272 is configured to be contact with the paper P so as to generate a potential difference (electric field) between the fixing solution L contained in the nozzles 2N and the paper P. The second electrode 272 is disposed below the nozzles 2N so as to face a tip end of each nozzle 2N at a predetermined distance. Here, the predetermined distance is greater than the thickness of the paper P, and determined through an experiment or a simulation so that the electrostatic spraying can be satisfactorily performed. The second electrode 272 may be grounded, or may be applied with a voltage lower than a voltage applied to the first electrode 274. The voltage applied to the second electrode 272 may have a polarity opposite to the polarity of the voltage applied to the first electrode 274. In a case where the second electrode 272 is grounded, the voltage applied to the first electrode 274 is preferably 1 to 10 kV.

When the voltage is applied to the first electrode 274, an electric field is generated in a space in the vicinity of the tip end of each nozzle 2N. Specifically, the fixing solution L in the container portion 273 is applied with a pressure by a pressurization device (not illustrated). Accordingly, the fixing solution L is supplied toward the tip end of each nozzle 2N. As a result, the electric field is generated between the fixing solution L at the tip end of each nozzle 2N and the second electrode 272. Then, at the tip end of each nozzle 2N, the fixing solution L is attracted by the electric field to form a so-called Taylor cone. Since the electric field is concentrated on the tip of the Taylor cone, the fixing solution L is torn off from the tip of the Taylor cone to form a fine droplet.

The droplet-like fixing solution L sprayed by the nozzles 2N is positively charged. In contrast, the paper P has a substantially zero potential. As a result, the droplet-like fixing solution L flies toward the paper P due to Coulomb force, and adheres to the paper P or the toner image.

The first electrode 274 and second electrode 272 configured in such a manner constitute a potential difference generating portion which generates a potential difference between the fixing solution L contained in the nozzles 2N and the paper P which is being conveyed at a position distant from the nozzles 2N.

Figure 28A:
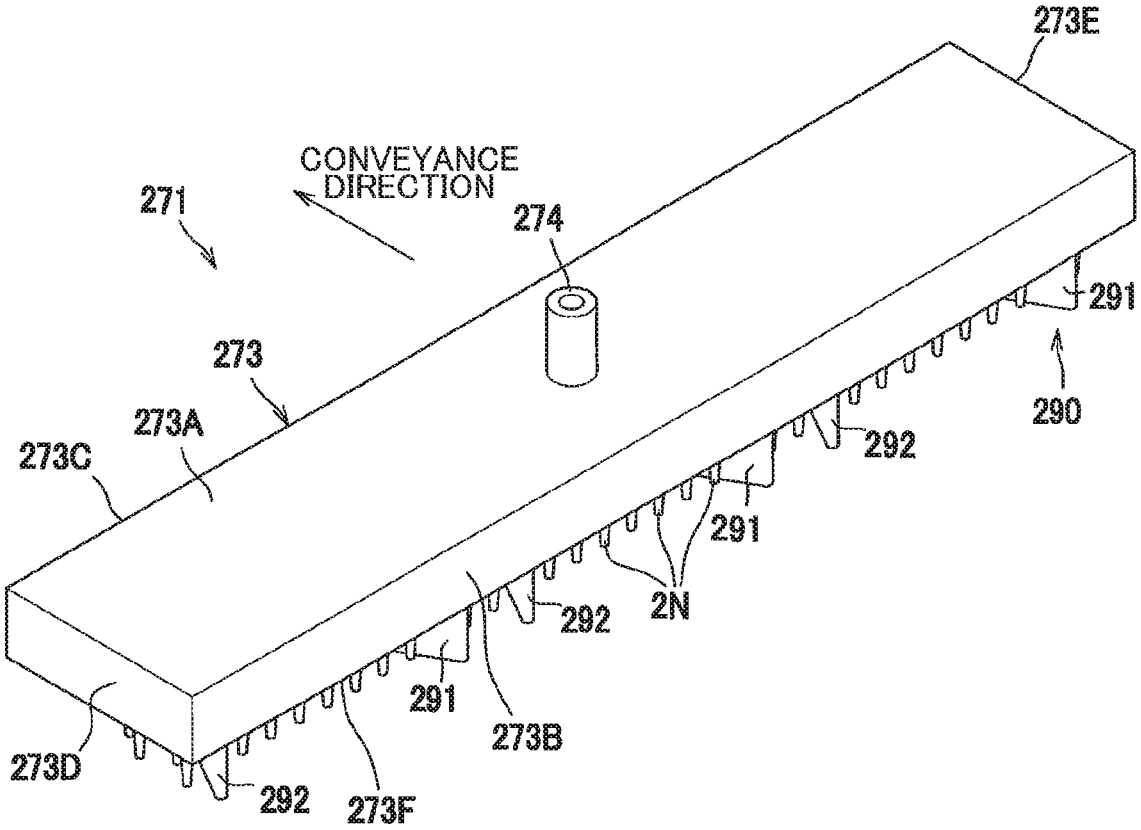
FIG. 28A is a perspective view of a fixing head as viewed from diagonally above.

As illustrated in FIG. 28A, the container portion 273 is a rectangular container which is elongated in the left-right direction, that is, in a width direction of the paper P (a perpendicular direction perpendicular to the conveyance direction). The container portion 273 has the top wall 273A, a front wall 273B, a rear wall 273C, a left wall 273D, a right wall 273E, and a bottom wall 273F.

Figure 28B:
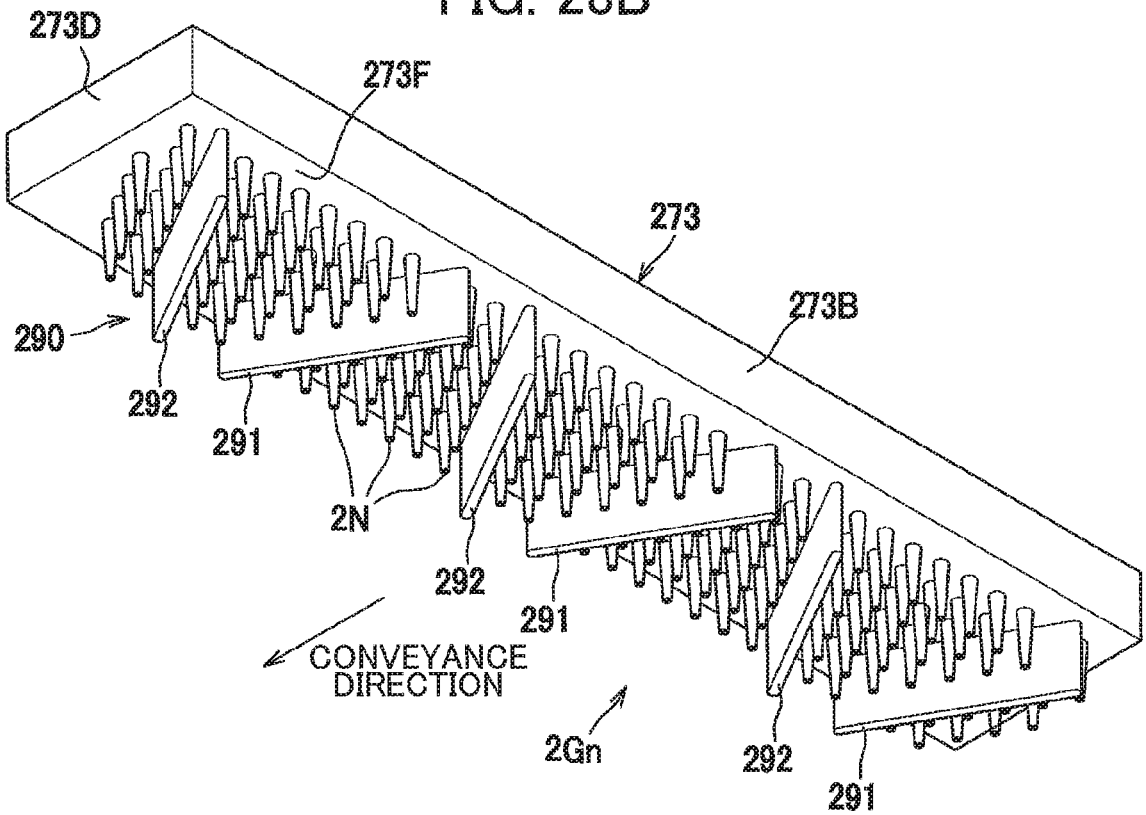
FIG. 28B is a perspective view of the fixing head as viewed from diagonally below.

As illustrated in FIG. 28B, each of the plurality of nozzles 2N is a substantially cylindrical nozzle that communicates with the inside of the container portion 273, and protrudes downward (as an example of a first direction) from the bottom wall 273F of the container portion 73, with its diameter gradually reduced as it extends downward. The plurality of nozzles 2N is disposed such that a plurality of arrays of nozzles 2N is arrayed with each other in the width direction of the paper P, that is, in the left-right direction, and that each array includes a plurality of nozzles 2N arrayed in the conveyance direction of the paper P, that is, in the front-rear direction.

The bottom wall 273F of the container portion 273 is provided with ribs 290 which guide the paper P in a space between the ribs 290 and the second electrode 272. The container portion 273, nozzle group 2Gn, and ribs 290 are integrally formed with a resin.

The ribs 290 include three first ribs 291, and three second ribs 292. The first ribs 291 and the second ribs 292 extend downward from the bottom wall 273F of the container portion 273, and bottom surfaces of the ribs 291 and 292 are positioned lower than the tip end of each nozzle 2N (see FIG. 27). In other words, the ribs 291 and 292 protrude toward the second electrode 272 more than the tip ends of the plurality of nozzles 2N, and are separated from the second electrode 272. That is, the distance between each of the ribs 291 and 292 and the second electrode 272 is smaller than the distance between the tip end of each nozzle 2N and the second electrode 272.

Figure 29:
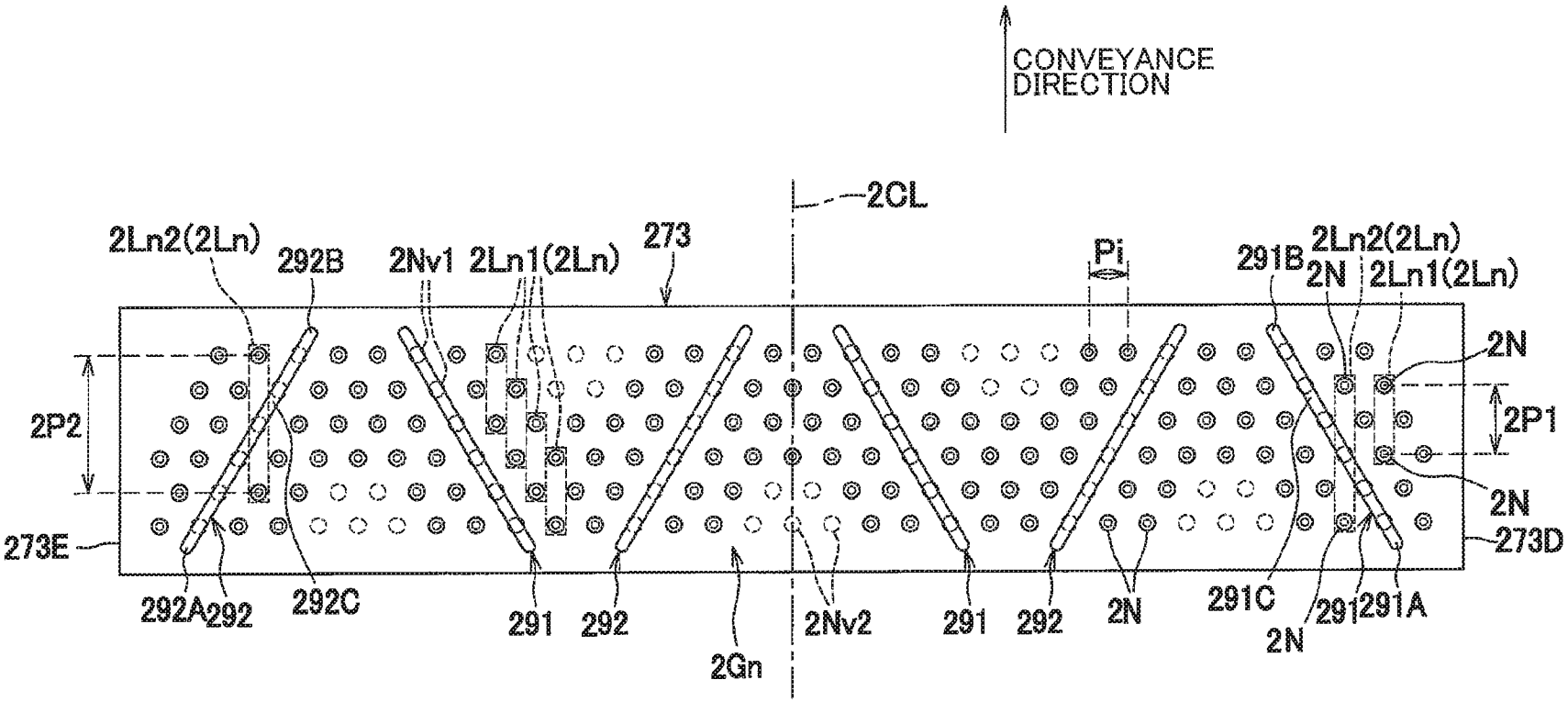
FIG. 29 is a bottom view of the fixing head.

As illustrated in FIG. 29, each of the first ribs 291 and second ribs 292 is inclined with respect to the conveyance direction of the paper P, and is arranged so as to traverse the nozzle group 2Gn from the upstream side to the downstream side in the conveyance direction. Specifically, each first rib 291 has a first portion 291A disposed on the upstream side of the nozzle group 2Gn, a second portion 291B disposed on the downstream side of the nozzle group 2Gn, and a third portion 291C continuously extending from the first portion 291A to the second portion 291B and connected to the first portion 291A and the second portion 291B. In other words, the first portion 291A is disposed on the upstream side of the most upstream lateral nozzle array among the plurality of lateral nozzle arrays, and the second portion 291B is disposed on the downstream side of the most downstream lateral nozzle array among the plurality of lateral nozzle arrays. Similarly, each second rib 292 also has a first portion 292A disposed on the upstream side of the nozzle group 2Gn, a second portion 292B disposed on the downstream side of the nozzle group 2Gn, and a third portion 292C continuously extending from the first portion 292A to the second portion 292B and connected to the first portion 292A and the second portion 292B. In other words, the first portion 292A is disposed on the upstream side of the most upstream lateral nozzle array among the plurality of lateral nozzle arrays, and the second portion 292B is disposed on the downstream side of the most downstream lateral nozzle array among the plurality of lateral nozzle arrays.

In each first rib 291, the second portion 291B is disposed on one side (on the right side) with respect to the first portion 291A in the left-right direction. That is, the distance between the left wall 273D and the second portion 291B in the left-right direction is greater than the distance between the left wall 273D and the first portion 291A in the left-right direction.

In contrast, in each second rib 292, the second portion 292B is disposed on another side (on the left side) opposite to the one side with respect to the first portion 292A in the left-right direction. That is, the distance between the left wall 273D and the second portion 291B in the left-right direction is smaller than the distance between the left wall 273D and the first portion 292A in the left-right direction. In addition, the three first ribs 291 and the three second ribs 292 are alternately arrayed in the left-right direction.

Specifically, on the one side (left side in FIG. 29) of the nozzle group 2Gn (lateral nozzle array) in the left-right direction with respect to the center line 2CL, a second rib 292, a first rib 291, and a second rib 292 are alternately arrayed in this order from the center line 2CL; on the other side, a first rib 291, a second rib 292, and a first rib 291 are alternately arrayed in this order from the center line 2CL. In addition, the ribs 292, 291, and 292 disposed on the one side with respect to the center line 2CL and the ribs 291, 292, and 291 disposed on the other side with respect to the center line 2CL are axisymmetric with respect to the center line 2CL which serves as a symmetry axis.

The nozzle group 2Gn includes a plurality of nozzle arrays 2Ln arrayed with each other in the left-right direction, and each nozzle array 2Ln includes two nozzles 2N arrayed in the conveyance direction. With such configuration, the nozzle group 2Gn is configured so that substantially the same amount of spray per unit area is achieved at each position on the paper P in the left-right direction.

The plurality of nozzle arrays 2Ln includes first nozzle arrays 2Ln1 and second nozzle arrays 2Ln2. Each first nozzle array 2Ln1 includes two nozzles 2N aligned at a predetermined first pitch 2P1, and each second nozzle array 2Ln2 includes two nozzles 2N aligned at a predetermined second pitch 2P2 which is larger than the first pitch 2P1. Here, the second pitch 2P2 is twice the first pitch 2P1.

The first nozzle arrays 2Ln1 are disposed along the first rib 291 on the left or right side in FIG. 29 of the first rib 291, or disposed along the second rib 292 on the left or right side in FIG. 29 of the second rib 292. Each of the second nozzle arrays 2Ln2 is disposed such that a corresponding first rib 291 or second rib 292 is interposed between two nozzles 2N included in the second nozzle array 2Ln2.

The plurality of nozzles 2N is disposed such that a shape formed by connecting centers of three nozzles 2N closest to each other becomes a substantially regular triangle. In other words, a shape formed by connecting centers of two nozzles 2N adjacent to each other with the shortest distance in the left-right direction and a center of one nozzle 2N closest to these two nozzles 2N becomes a substantially regular triangle.

In addition, the shortest distance between two nozzles 2N adjacent to each other in the left-right direction, the shortest distance between the nozzles 2N and the first ribs 291, and the shortest distance between the nozzles 2N and the second ribs 292 have a substantially identical value to each other. Here, the shortest distance between the first ribs 291 and the nozzles 2N, and the shortest distance between the second ribs 292 and the nozzles 2N may be greater than the shortest distance between two adjacent nozzles 2N. In this case, the fixing solution L sprayed from the nozzles 2N is less adversely influenced by an electric field generated by the electrically charged ribs 291 and 292. As a result, the fixing solution L can be satisfactorily sprayed. The pitch of two nozzles 2N adjacent to each other in the left-right direction, that is, the pitch of two nozzles 2N arrayed in the shortest distance may be set to a value within a range from 2 mm to less than 10 mm, for example.

The above-described nozzle group 2Gn, first ribs 291, and second ribs 292 can be appropriately arranged by the following design method.

First, the plurality of lateral nozzle arrays is arrayed with each other in the conveyance direction. Each of the lateral nozzle arrays includes a plurality of nozzles 2N (including nozzles 2Nv1 and 2Nv2, those are indicated by broken lines) arrayed in the left-right direction at a predetermined third pitch Pi. Here, the plurality of lateral nozzle arrays is each shifted in the left-right direction by half the third pitch Pi so that a shape formed by connecting centers of three nozzles closest to each other becomes a substantially regular triangle.

Then the plurality of nozzles 2Nv1 arrayed in a diagonal direction with respect to the conveyance direction are removed, and the first ribs 291 and the second ribs 292 are disposed on portions from which the nozzles 2Nv1 have been removed. Thereafter, excess nozzles 2Nv are removed so that the number of nozzles 2N arrayed in the conveyance direction becomes two.

That is, the plurality of nozzles 2N is arranged in principle at vertexes of a plurality of regular triangles which are disposed so as to fill the bottom wall 273F, but is not disposed in portions where the first ribs 291 or the second ribs 292 are to be disposed, and in portions where nozzles 2N are not required to be disposed so as to keep a number of nozzles 2N aligned in the conveyance direction constant depending on the arrangement of the first ribs 291 and the second ribs 292. In the following description, the arrangement in which the nozzles 2N are disposed in principle at vertexes of regular triangles is referred to also as a close-packed arrangement.

Next, advantageous effects by the ribs 290 will be described.

As illustrated in FIG. 27, the paper P onto which a toner image is transferred when the paper P passes through between the photosensitive drum 61 and the transfer roller TR is conveyed toward a space between the ribs 290 and the second electrode 272 by a guide member (not illustrated). If the paper P is moved toward the nozzles 2N due to the state of curling of the paper P or the like while the paper P is being conveyed in the space between the ribs 290 and the second electrode 272, the movement of the paper P toward the nozzles 2N is restricted by the ribs 290 positioned below the tip end of each nozzle 2N. This can restrain contamination of the tip end of each nozzle 2N with the toner on the paper P.

The present embodiment can produce the following effects in addition to the effects described above.

The ribs 290 are formed on the container portion 273 so as to extend from the container portion 273 toward the second electrode 272. Thus, the ribs 290 can be arranged with respect to each nozzle 2N with high accuracy in comparison with the configuration in which the ribs are provided, for example, at another member independent of the container portion.

The first ribs 291 and the second ribs 292 extend from the upstream side toward the downstream side of the nozzle group 2Gn. Thus, the ribs 290 can prevent the paper P from moving toward the nozzles 2N throughout the time in which the paper P passes through the space between the nozzle group 2Gn and the second electrode 272.

The first ribs 291 and the second ribs 292 are inclined with respect to the conveyance direction. Thus, the plurality of nozzles 2N can be arranged with well-balanced distribution.

The ribs 292, 291, and 292 disposed on one side with respect to the center line 2CL and the ribs 291, 292, and 291 disposed on the other side with respect to the center line 2CL are axisymmetric with respect to the center line 2CL which serves as a symmetry axis. Thus, diagonal movement with respect to the conveyance direction of the paper P guided by the ribs 290 can be restrained.

Each of the plurality of nozzle arrays 2Ln arrayed with each other in the left-right direction includes the same number (two) of nozzles 2N. Thus, a toner image on the paper P can be substantially uniformly sprayed with the fixing solution L.

The container portion 273, the nozzle group 2Gn, and the ribs 290 are integrally formed with a resin. Thus, the container portion 273, the nozzle group 2Gn, and the ribs 290 can be easily manufactured.

The present invention can be used in various embodiments as described below as examples without limited to the third embodiment. In the following description, any member having substantially the same structure as that of the third embodiment will be given the same reference numeral, and the description thereof will be omitted. Further, in the drawings used for the following description, a part of the container portion 273 is enlarged as appropriate.

Figure 30:
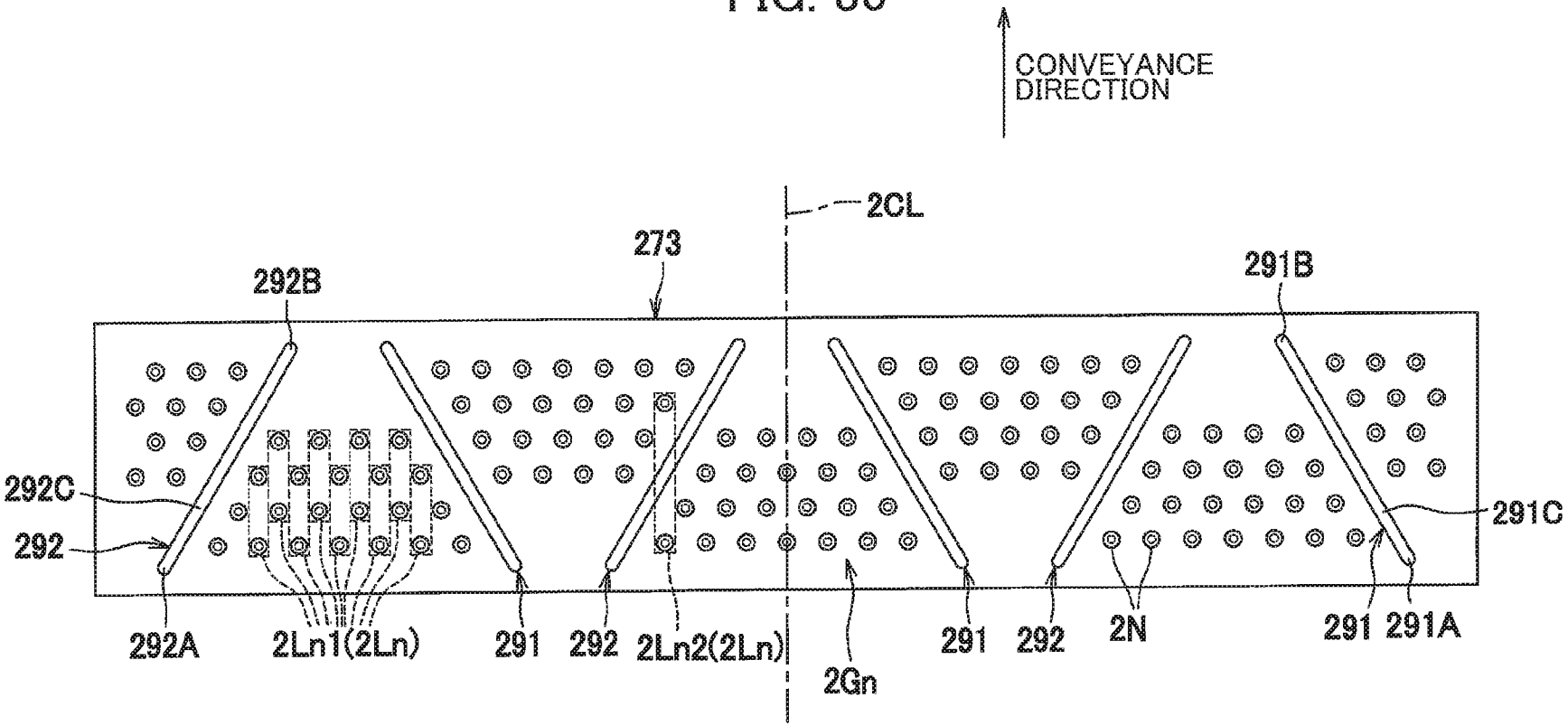
FIG. 30 is a bottom view of a fixing head as a first modification to the third embodiment.

In the third embodiment described above, the plurality of first nozzle arrays 2Ln1 is disposed along a first rib 291 or a second rib 292. The present invention, however, is not limited to this. For example, as illustrated in FIG. 30, the plurality of first nozzle arrays 2Ln1 may be disposed on the wider side of substantially triangular space which is formed between a first rib 291 and a second rib 292. In the modification of FIG. 30, the nozzle group 2Gn includes six lateral nozzle arrays arrayed with each other in the conveyance direction, and each of the six lateral nozzle arrays includes a plurality of nozzles 2N arrayed in the light-left direction. Also in this modification, the first portions 291A and 292A are disposed on the upstream side of the most upstream lateral nozzle array among the plurality of lateral nozzle arrays of the nozzle group 2Gn, and the second portions 291B and 292B are disposed on the downstream side of the most downstream lateral nozzle array among the plurality of lateral nozzle arrays of the nozzle group 2Gn.

Figure 31:
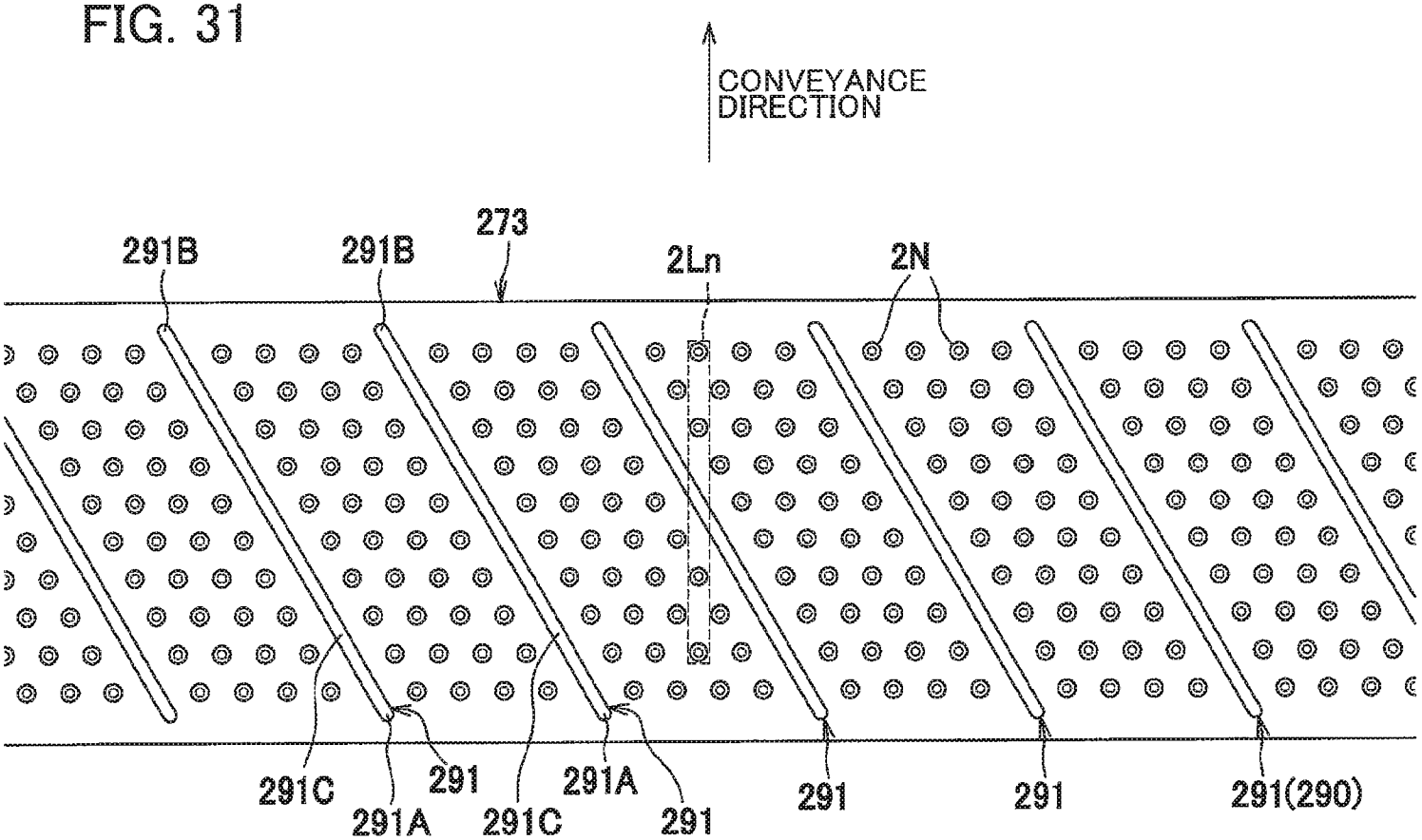
FIG. 31 is a bottom view of a fixing head as a second modification to the third embodiment.

In the third embodiment described above, the ribs 290 are constituted by the two types of the first ribs 291 and the second ribs 292 having different inclination directions. The present invention, however, is not limited to this. As illustrated in FIG. 31, the ribs 290 may be constituted by a plurality of first ribs 291 alone. Specifically, in the modification of FIG. 31, the plurality of first ribs 291 are spaced away from each other in the left-right direction, and among two first ribs 291 adjacent to each other in the left-right direction, the first portion 291A of one first rib 291 and the second portion 291B of the other first rib 291 are overlapped with each other when viewed in the conveyance direction. In this modification, the nozzles 2N are disposed in the close-packed arrangement, and each of a plurality of nozzle arrays 2Ln arrayed with each other in the left-right direction includes four nozzles 2N arrayed in the conveyance direction. In other words, in the modification of FIG. 31, a nozzle group 2Gn includes ten lateral nozzle arrays arrayed with each other in the conveyance direction, and each of the lateral nozzle arrays includes a plurality of nozzles 2N arrayed in the left-right direction. Also in this modification, the first portions 291A are disposed on the upstream side of the most upstream lateral nozzle array among the plurality of lateral nozzle arrays of the nozzle group 2Gn, and the second portions 291B are disposed on the downstream side of the most downstream lateral nozzle array among the plurality of lateral nozzle arrays of the nozzle group 2Gn.

Figure 32:
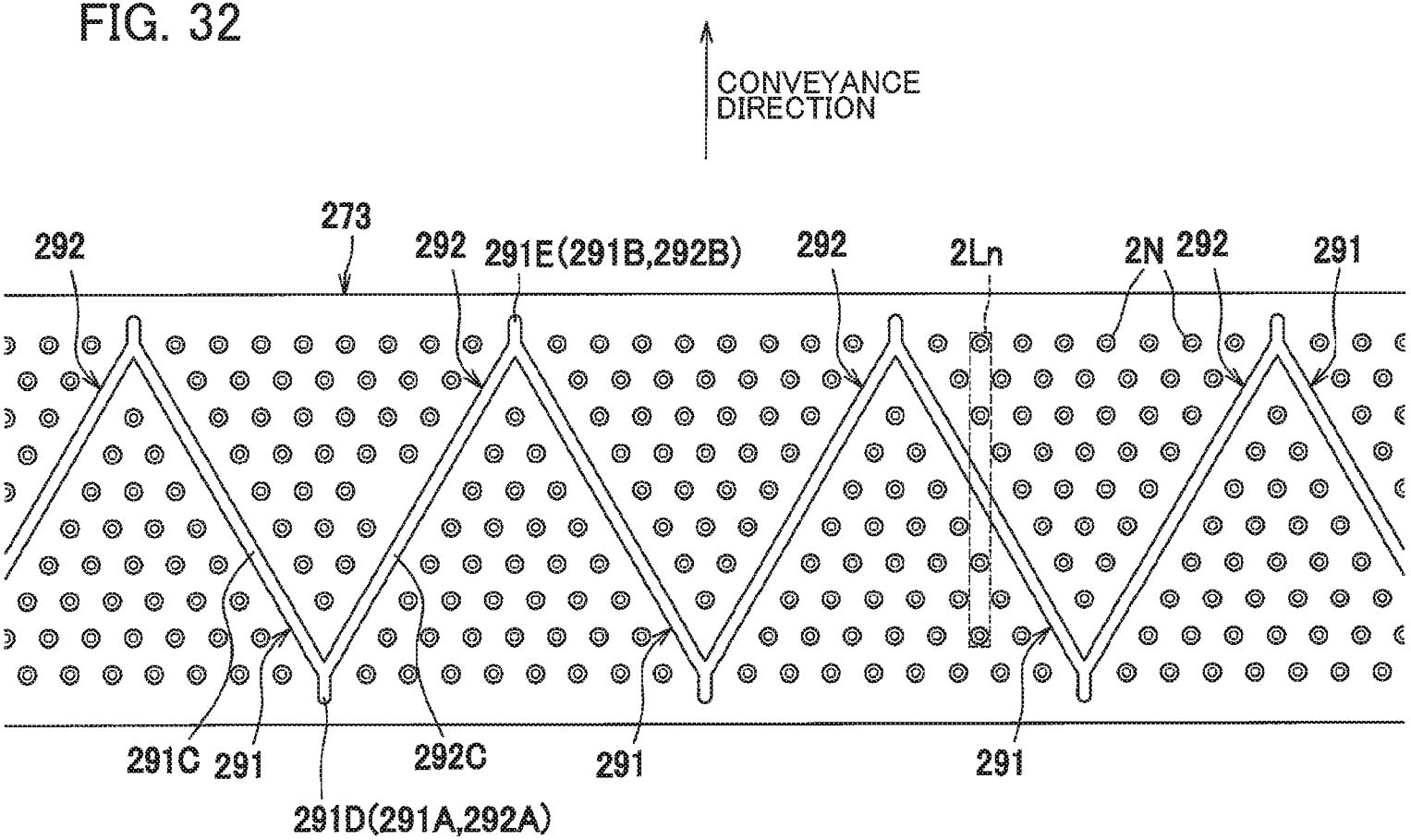
FIG. 32 is a bottom view of a fixing head as a third modification to the third embodiment.

As illustrated in FIG. 32, a first portion 291A of a first rib 291 and a first portion 292A of a second rib 292 may be connected to form a fourth portion 291D, and a second portion of the first rib 291 and a second portion 292B of another second rib 292 may be connected to form a fifth portion 291E. Specifically, the fourth portion 291D is formed so as to extend along the conveyance direction from substantially the same position as that of the most upstream nozzles 2N in the conveyance direction to a position on the upstream side of the most upstream nozzles 2N in the conveyance direction. In addition, the fifth portion 291E is formed so as to extend along the conveyance direction from substantially the same position as that of the most downstream nozzles 2N in the conveyance direction to a position on the downstream side of the most downstream nozzles 2N in the conveyance direction. Also in this modification, the nozzles 2N are disposed in the close-packed arrangement, and each of a plurality of nozzle arrays 2Ln arrayed with each other in the left-right direction includes four nozzles 2N arrayed in the conveyance direction. In other words, in the modification of FIG. 32, a nozzle group 2Gn includes ten lateral nozzle arrays arrayed with each other in the conveyance direction, and each of the lateral nozzle arrays includes a plurality of nozzles 2N arrayed in the left-right direction. Also in this modification, the first portions 291A and 292A are disposed on the upstream side of the most upstream lateral nozzle array among the plurality of lateral nozzle arrays of the nozzle group 2Gn, and the second portions 291B and 292B are disposed on the downstream side of the most downstream lateral nozzle array among the plurality of lateral nozzle arrays of the nozzle group 2Gn.

With this connecting manner of the first ribs 291 and the second ribs 292, the ribs 291 and 292 can have enhanced strength.

Figure 33:
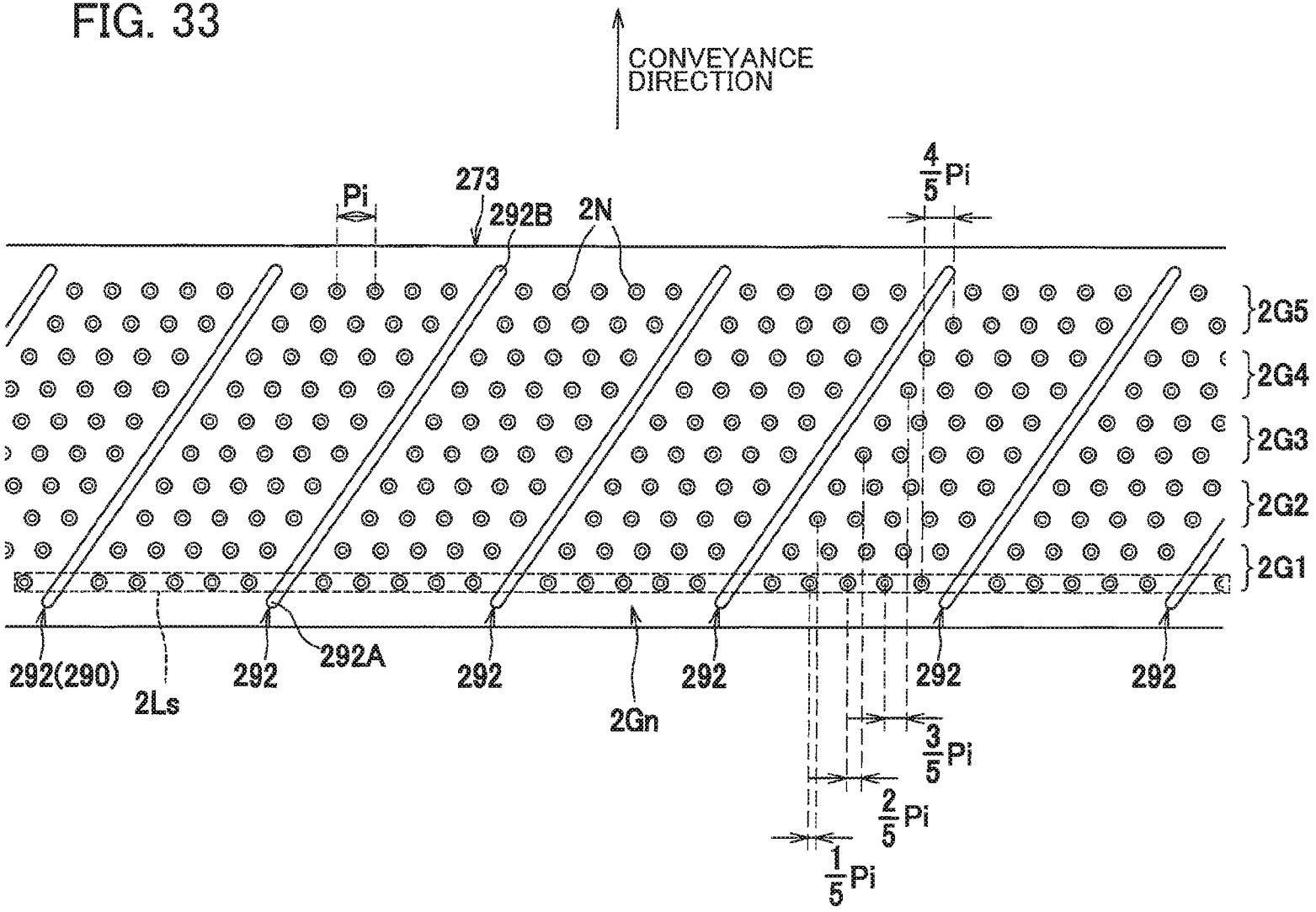
FIG. 33 is a bottom view of a fixing head as a fourth modification to the third embodiment.

In the third embodiment described above, the nozzles 2N are disposed in the close-packed arrangement. The present invention, however, is not limited to this. For example, the nozzles 2N may be disposed as illustrated in FIG. 33. In the modification of FIG. 33, the ribs 290 are constituted by a plurality of second ribs 292 alone. Also in this modification, the first portions 292A are disposed on the upstream side of the most upstream lateral nozzle array among the plurality of lateral nozzle arrays of the nozzle group 2Gn, and the second portions 292B are disposed on the downstream side of the most downstream lateral nozzle array among the plurality of lateral nozzle arrays of the nozzle group 2Gn.

The nozzle group 2Gn includes a plurality of lateral nozzle arrays 2Ls, that is, ten lateral nozzle arrays 2Ls arrayed with each other in the conveyance direction, and each of the ten lateral nozzle arrays 2Ls includes a plurality of nozzles 2N arrayed in the left-right direction. In the following description, the first and second lateral nozzle arrays 2Ls disposed in this order from the upstream side in the conveyance direction are collectively referred to as a first nozzle group 2G1, and the third and fourth lateral nozzle arrays 2Ls disposed in this order from the upstream side in the conveyance direction are collectively referred to as a second nozzle group 2G2. Similarly, the fifth and sixth lateral nozzle arrays 2Ls are collectively referred to as a third nozzle group 2G3, the seventh and eighth lateral nozzle arrays 2Ls are collectively referred to as a fourth nozzle group 2G4, and the ninth and tenth lateral nozzle arrays 2Ls are collectively referred to as a fifth nozzle group 2G5.

Each of the nozzle groups 2G1 to 2G5 is disposed in the close-packed arrangement. In addition, the second nozzle group 2G2 is shifted with respect to the first nozzle group 2G1 by one-fifth of the above-described third pitch Pi toward the other side in the left-right direction; the third nozzle group 2G3 is shifted with respect to the first nozzle group 2G1 by two-fifths of the third pitch Pi toward the other side in the left-right direction; the fourth nozzle group 2G4 is shifted with respect to the first nozzle group 2G1 by three-fifths of the third pitch Pi toward the other side in the left-right direction; and the fifth nozzle group 2G5 is shifted with respect to the first nozzle group 2G1 by four-fifths of the third pitch Pi toward the other side in the left-right direction.

Thus, since the nozzle groups 2G1 to 2G5 are each shifted by one-fifth of the third pitch Pi in the left-right direction, a spray area (circular area) of the fixing solution L sprayed onto the paper P from nozzles 2N can be slightly overlapped with each other by one-fifth of the third pitch Pi in the left-right direction. As a result, substantially the same amount of spray per unit area can be achieved at each position on the paper P in the left-right direction. Such a configuration of the nozzle groups 2G1 to 2G5 may be also applied to the ribs 290 disposed as illustrated in FIG. 29 or FIG. 32.

Figure 34:
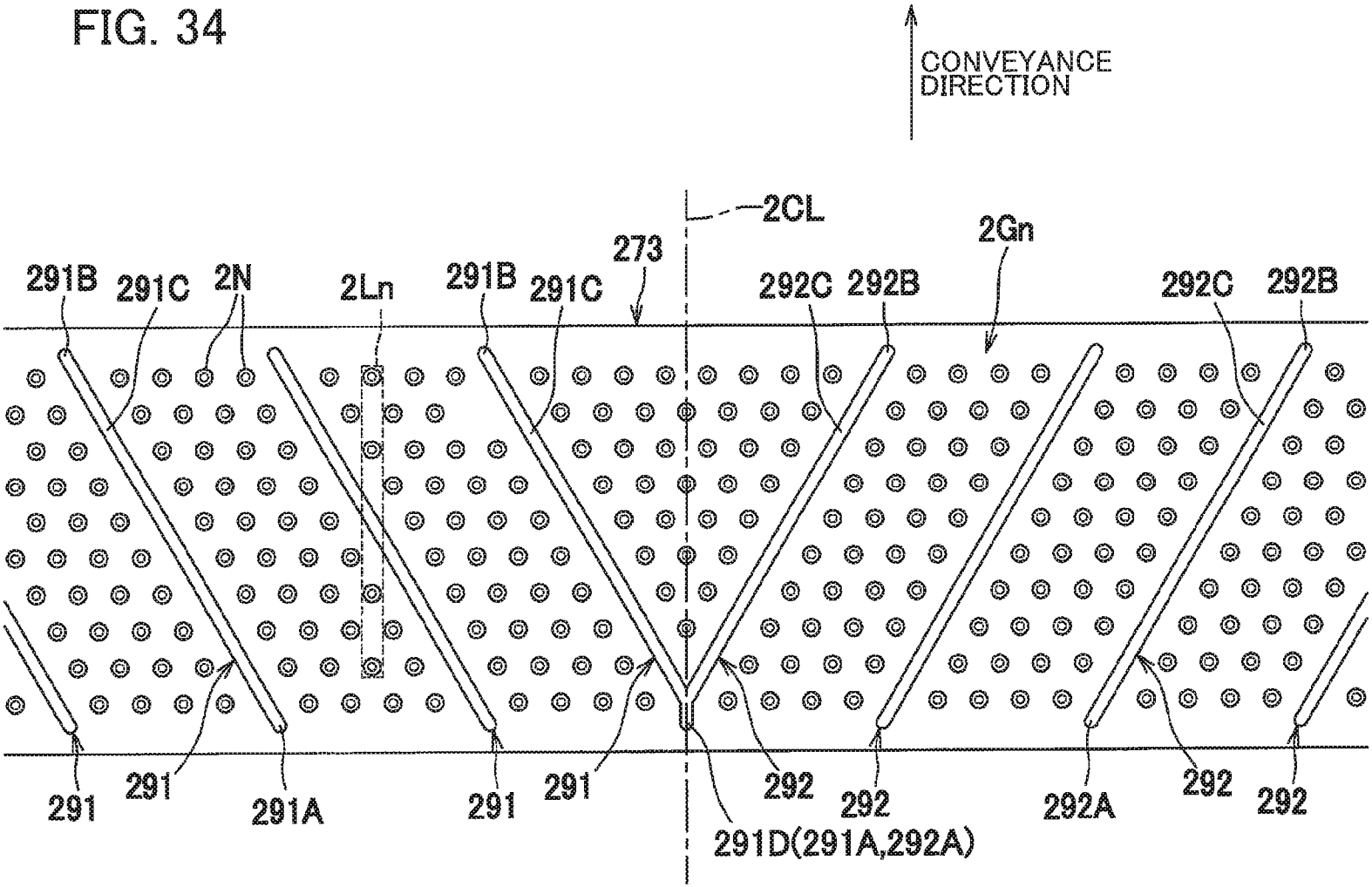
FIG. 34 is a bottom view of a fixing head as a fifth modification to the third embodiment.

Further, the ribs 290 may be formed as illustrated in FIG. 34. In this modification, the ribs 290 include three first ribs 291 and three second ribs 292 as in the embodiment illustrated in FIG. 29, but the arrangement of the first ribs 291 and the second ribs 292 are different from that of FIG. 29. In the modification of FIG. 34, the nozzle group 2Gn includes ten lateral nozzle arrays arrayed with each other in the conveyance direction, and each of the ten lateral nozzle arrays includes a plurality of nozzles 2N arrayed in the left-right direction. Also in this modification, the first portions 291A and 292A are disposed on the upstream side of the most upstream lateral nozzle array among the plurality of lateral nozzle arrays of the nozzle group 2Gn, and the second portions 291B and 292B are disposed on the downstream side of the most downstream lateral nozzle array among the plurality of nozzle arrays of the nozzle group 2Gn.

Specifically, each first rib 291 has a first portion 291A and a second portion 291B disposed on the one side (right side) with respect to the first portion 291A in the left-right direction, and is disposed on the one side with respect to the center line 2CL of the nozzle group 2Gn in the left-right direction. In contrast, each second rib 292 has a first portion 292A and a second portion 292B disposed on the other side (left side) with respect to the first portion 292A in the left-right direction and is disposed on the other side with respect to the center line 2CL of the nozzle group 2Gn in the left-right direction. That is, the first ribs 291 and the second ribs 292 are axisymmetric with respect to the center line 2CL which serves as a symmetry axis.

In addition, a first portion 291A of a first rib 291 which is most adjacent to the center line 2CL of the nozzle group 2Gn among the plurality of first ribs 291 and a first portion 292A of a second rib 292 which is most adjacent to the center line 2CL of the nozzle group 2Gn are connected to form a fourth portion 291D. The fourth portion 291D is formed as in the modification of FIG. 32. Also in this modification, the nozzles 2N are disposed in the close-packed arrangement, and each of the plurality of nozzle arrays 2Ln includes four nozzles 2N arrayed in the conveyance direction.

According to this modification, the first ribs 291 and the second ribs 292 having different inclination directions from those of the first ribs 291 are arranged with well-balanced distribution with respect to the center line 2CL of the nozzle group 2Gn. Thus, diagonal movement with respect to the conveyance direction of the paper P guided by the ribs 291 and 292 can be restrained. In addition, the first ribs 291 and the second ribs 292 are disposed so as to be separated more from the center line 2CL of the nozzle group 2Gn, that is, so as to be gradually distant from the center line 2CL of the nozzle group 2Gn, as going toward the downstream side in the conveyance direction. Thus, the first ribs 291 and the second ribs 292 can smooth out creases of the paper P.

Figure 35:
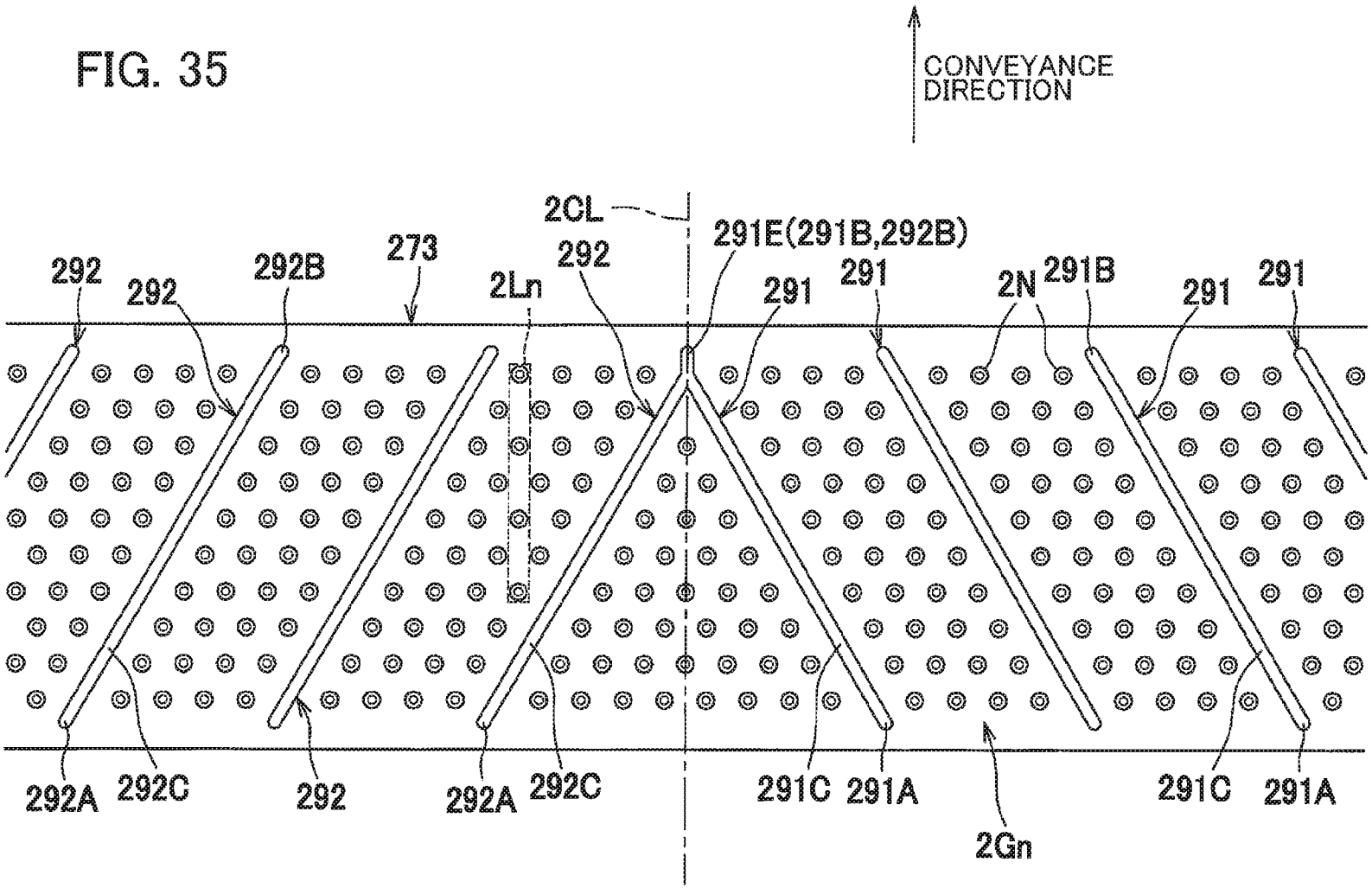
FIG. 35 is a bottom view of a fixing head as a sixth modification to the third embodiment.

Further, the ribs 290 may be formed as illustrated in FIG. 35. In this modification, the upstream side and the downstream side in the conveyance direction of the arrangement illustrated in FIG. 34 are reversed. In the modification of FIG. 35, the nozzle group 2Gn includes ten lateral nozzle arrays arrayed with each other in the conveyance direction, and each of the ten lateral nozzle arrays includes a plurality of nozzles 2N arrayed in the left-right direction. Also in this modification, the first portions 291A and 292A are disposed on the upstream side of the most upstream lateral nozzle array among the plurality of lateral nozzle arrays of the nozzle group 2Gn, and the second portions 291B and 292B are disposed on the downstream side of the most downstream lateral nozzle array among the plurality of lateral nozzle arrays of the nozzle group 2Gn.

Specifically, each first rib 291 has a first portion 291A and a second portion 291B disposed on the one side (left side in FIG. 35) with respect to the first portion 291A in the left-right direction and is disposed on the other side (right side in FIG. 35) with respect to the center line 2CL of the nozzle group 2Gn in the left-right direction. In contrast, each second rib 292 has a first portion 292A and a second portion 292B disposed on the other side with respect to the first portion 292A in the left-right direction and is disposed on the one side with respect to the center line 2CL of the nozzle group 2Gn in the left-right direction. That is, the first ribs 291 and the second ribs 292 are axisymmetric with respect to the center line 2CL which serves as a symmetry axis.

In addition, a second portion 291B of a first rib 291 which is most adjacent to the center line 2CL of the nozzle group 2Gn among the plurality of first ribs 291 and a second portion 292B of a second rib 292 which is most adjacent to the center line 2CL of the nozzle group 2Gn among the plurality of second ribs 292 are connected to form a fifth portion 291E. The fifth portion 291E is formed as in the modification of FIG. 32. Also in this modification, the nozzles 2N are disposed in the close-packed arrangement, and each of the plurality of nozzle arrays 2Ln includes four nozzles 2N arrayed in the conveyance direction.

According to this configuration, the first ribs 291 and the second ribs 292 having different inclination directions from those of the first ribs 291 are arranged with well-balanced distribution with respect to the center line 2CL of the nozzle group 2Gn. Thus, diagonal movement with respect to the conveyance direction of the paper P guided by the ribs 291 and 292 can be restrained. In addition, the first ribs 291 and the second ribs 292 are disposed so as to gradually narrow toward the center line 2CL of the nozzle group 2Gn, that is, so as to gradually reduce the distance between each of the first ribs 291 and second ribs 292 and the center line 2CL of the nozzle group 2Gn, as going toward the downstream side in the conveyance direction. Thus, for example, in a case where the paper P is curled such that a center portion of the paper P protrudes toward the nozzle group 2Gn in a plane perpendicular to the conveyance direction, the ribs 291 and 292 whose distance therebetween is gradually reduced can urge the protruding center portion of the paper P toward the second electrode 272 to remedy the curling of the paper P.

Figure 36:
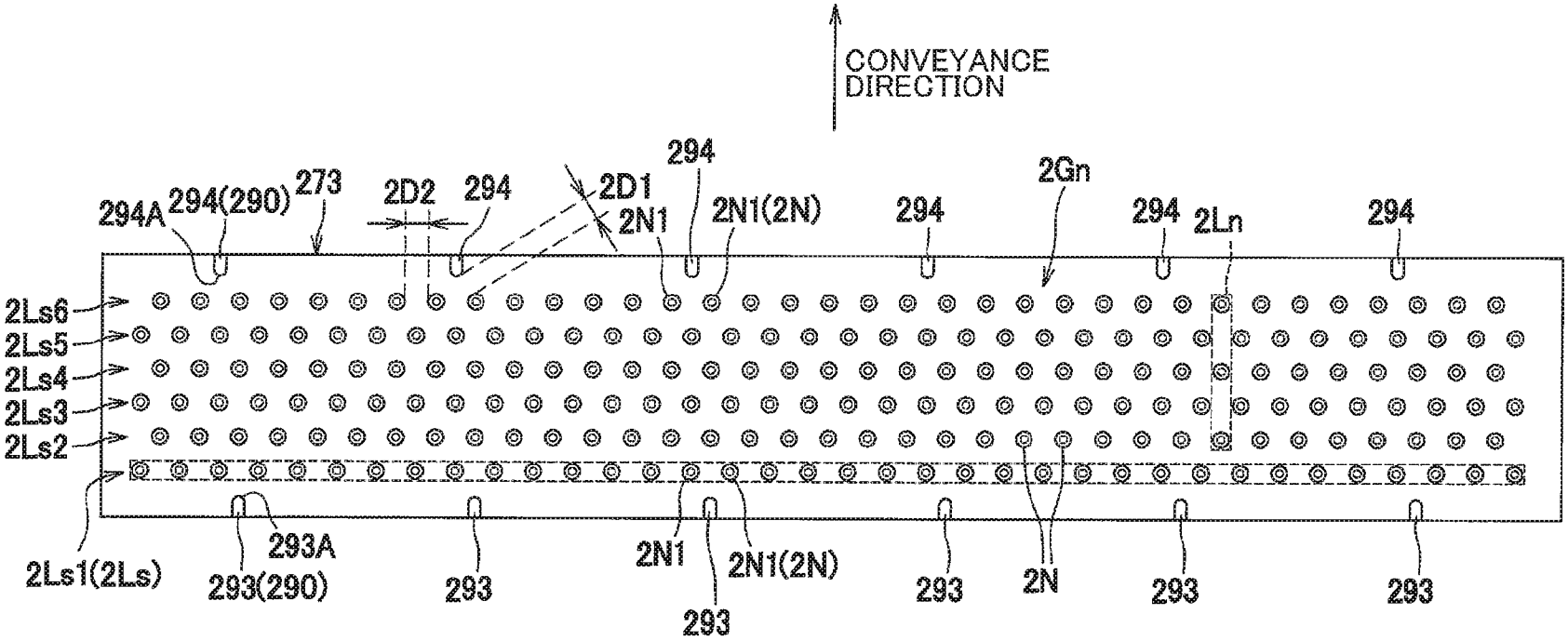
FIG. 36 is a bottom view of a fixing head as a seventh modification to the third embodiment.

Further, the ribs 290 may be formed as illustrated in FIG. 36. In this modification, the plurality of nozzles 2N is all disposed in the close-packed arrangement, and each of the plurality of nozzle arrays 2Ln includes three nozzles 2N arrayed in the conveyance direction. In other words, the nozzle group 2Gn of this modification includes a plurality of lateral nozzle arrays 2Ls arrayed with each other in the conveyance direction, and each of the plurality of lateral nozzle arrays 2Ls includes a plurality of nozzles 2N arrayed in the left-right direction. In the following description, the plurality of lateral nozzle arrays 2Ls is referred to also as a first lateral nozzle array 2Ls1, a second lateral nozzle array 2Ls2, a third lateral nozzle array 2Ls3, a fourth lateral nozzle array 2Ls4, a fifth lateral nozzle array 2Ls5, and a sixth lateral nozzle array 2Ls6 from the upstream side in the conveyance direction.

The ribs 290 include six third ribs 293 disposed on the upstream side of the nozzle group 2Gn in the conveyance direction, and six fourth ribs 294 disposed on the downstream side of the nozzle group 2Gn in the conveyance direction. The ribs 293 and 294 extend from the container portion 273 toward the second electrode 282, and the bottom surface of each of the ribs 293 and 294 is positioned closer to the second electrode 272 than the tip end of each nozzle 2N to the second electrode 272. In the following description, nozzles 2N of the lateral nozzle arrays 2Ls adjacent to the ribs 293 and 294 in the conveyance direction are referred to also as first nozzles 2N1, for convenience. That is, for example, in the modification of FIG. 36, nozzles 2N of the first lateral nozzle array 2Ls1 and nozzles 2N of the sixth lateral nozzle array 2Ls6 are referred to also as the first nozzles 2N1.

Figure 37A:
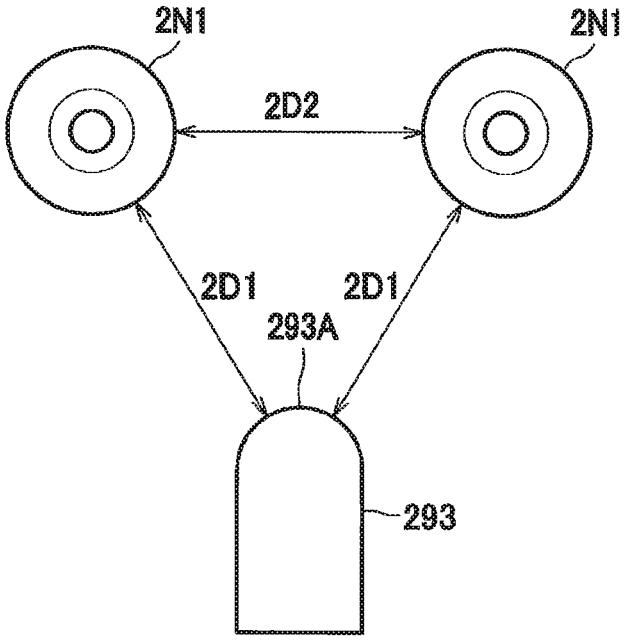
FIG. 37A is an enlarged view illustrating a relationship between a third rib and first nozzles those illustrated in FIG. 36.

As illustrated in FIG. 37A, each third rib 293 is formed with a predetermined length in the conveyance direction, and is disposed at a position shifted to the upstream side in the conveyance direction with respect to two first nozzles adjacent to each other in the left-right direction. A first end portion 293A which is an end portion of each third rib 293 on the first nozzles 2N1 side is positioned between centers of two first nozzles 2N1 in the left-right direction. Further, the first end portion 293A has a curved surface which faces the first nozzles 2N1 and has cross section whose shape includes an arc. The shortest distance 2D1 between the first end portion 293A and the first nozzles 2N1 is equal to the shortest distance 2D2 between two first nozzles 2N1.

Figure 37B:
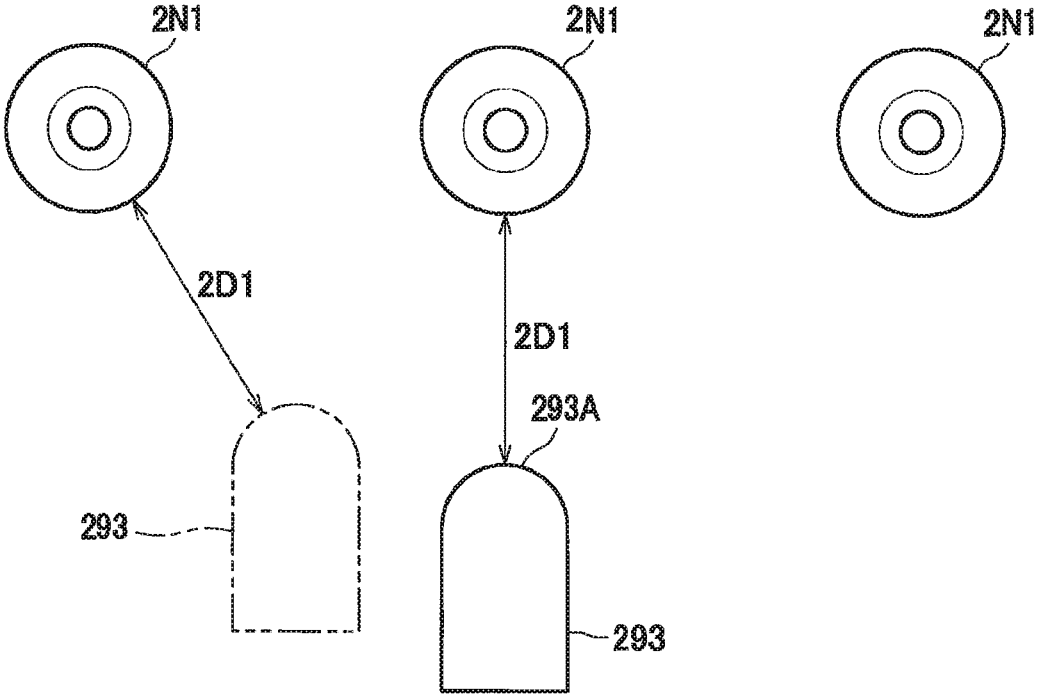
FIG. 37B is an enlarged view illustrating a relationship between a third rib and first nozzles in a comparative example corresponding to FIG. 37A.

In this way, arranging each first end portion 293A so as to face a position between two first nozzles 2N1 in the conveyance direction allows each third rib 293 to be disposed closer to the first nozzles 2N1 in the conveyance direction in comparison with a configuration in which, as illustrated in FIG. 37B, each first end portion 293A is arranged apart from a corresponding first nozzle 2N1 by a distance 2D1 in the conveyance direction.

As illustrated in FIG. 36, the fourth ribs 294 have substantially the same configuration as those of the third ribs 293. Specifically, the fourth ribs 294 have a configuration in which the direction of the third ribs 293 is reversed in the conveyance direction. More specifically, a first end portion 294A which is an end portion of each fourth rib 294 on the first nozzles 2N1 side is positioned between centers of two first nozzles 2N1 in the left-right direction. Further, the first end portion 294A has a curved surface which faces the first nozzles 2N1 and has cross section whose shape includes an arc. The shortest distance 2D1 between the first end portion 294A and the first nozzles 2N1 is equal to the shortest distance 2D2 between the two first nozzles 2N1.

According to this modification, as compared with a configuration in which each of the first end portions 293A and 294B is arranged to be aligned with a corresponding first nozzle 2N1 in the conveyance direction, for example, the ribs 293 and 294 can be disposed closer to the nozzle group 2Gn. Thus, the length of container portion 273 in the conveyance direction can be shortened. In addition, the shortest distance 2D1 between the first end portion 293A and the first nozzles 2N1 and the shortest distance 2D1 between the first end portion 294A and the first nozzles 2N1 are equal to the shortest distance 2D2 between two first nozzles 2N1. Thus, the first end portions 293A and 294A and the first nozzles 2N1 can be arranged closest to each other.

In the modification of FIG. 36, the third ribs 293 are disposed adjacent to the first lateral nozzle array 2Ls1 on the upstream side thereof and the fourth ribs 294 are disposed adjacent to the sixth lateral nozzle array 2Ls6 on the downstream side thereof. The present invention, however, is not limited to this. For example, as illustrated in FIGS. 38A to 40B, the third ribs 293 and the fourth ribs 294 may be disposed adjacent to lateral nozzle arrays 2Ls other than the first lateral nozzle array 2Ls1 and the sixth lateral nozzle array 2Ls6 in the conveyance direction.

Figure 38A:
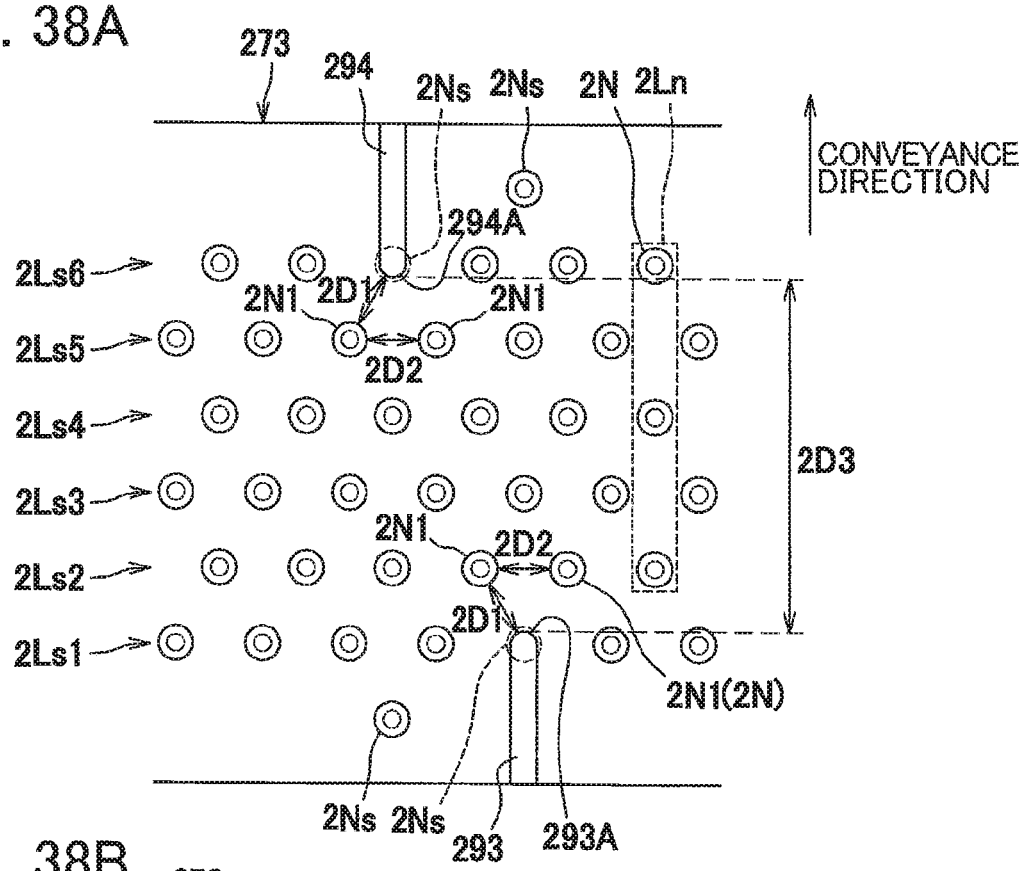
FIG. 38A is a bottom view of a fixing head as an eighth modification to the third embodiment.

In the modification illustrated in FIG. 38A, each third rib 293 is formed so as to extend from a position on the upstream side of the first lateral nozzle array 2Ls1 to a position adjacent to the second lateral nozzle array 2Ls2, and the first end portion 293A of the third rib 293 is disposed between centers of two first nozzles 2N1 of the second lateral nozzle array 2Ls2. Specifically, the first end portion 293A of the third rib 293 is disposed such that the shortest distance 2D1 between the first end portion 293A and the two first nozzles 2N1 of the second lateral nozzle array 2Ls2 becomes equal to the shortest distance 2D2 between the two first nozzles 2N1.

Each fourth rib 294 is formed so as to extend from a position on the downstream side of the sixth lateral nozzle array 2Ls6 to a position adjacent to the fifth lateral nozzle array 2Ls5, and the first portion 294A of the fourth rib 294 is disposed between centers of two first nozzles 2N1 of the fifth lateral nozzle array 2Ls5. Specifically, the first end portion 294A of the fourth rib 294 is disposed such that the shortest distance 2D1 between the first end portion 294A and the two first nozzles 2N1 of the fifth lateral nozzle array 2Ls5 becomes equal to the shortest distance 2D2 between the two first nozzles 2N1.

In this modification, since each third rib 293 is disposed so as to traverse the first lateral nozzle array 2Ls1, a nozzle 2Ns of the first lateral nozzle array 2Ls1, which is to be disposed in a portion in which the third rib 293 is disposed, is rearranged at a position on the downstream side of the sixth lateral nozzle array 2Ls6. Similarly, since each fourth rib 294 is disposed so as to traverse the sixth lateral nozzle array 2Ls6, a nozzle 2Ns of the sixth lateral nozzle array 2Ls6, which is to be disposed in a portion in which the fourth rib 294 is disposed, is rearranged at a position on the upstream side of the first lateral nozzle array 2Ls1. With such rearrangement, each of the plurality of nozzle arrays 2Ln arrayed with each other in the left-right direction includes three nozzles 2N arrayed in the conveyance direction.

Figure 38B:
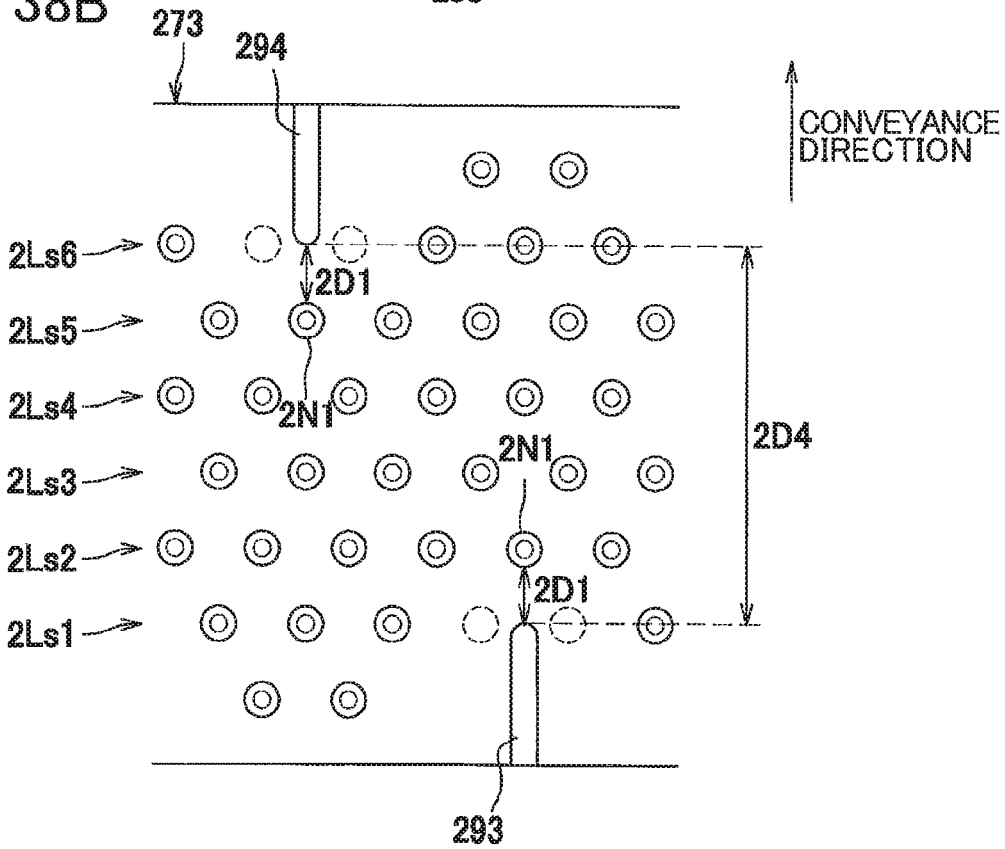
FIG. 38B is a bottom view of a fixing head as a comparative example corresponding to FIG. 38A.

In contrast, in a case where each of the third ribs 293 and the fourth ribs 294 is arranged apart from the corresponding first nozzle 2N1 by the distance 2D1 in the conveyance direction as illustrated in FIG. 38B, the third ribs 293 and the fourth ribs 294 are arranged apart more from the respective corresponding first nozzles 2N1 in the conveyance direction in comparison with those of the modification of FIG. 38A. As a result, the modification of FIG. 38A can reduce the distance between the third ribs 293 and the fourth ribs 294 in the conveyance direction (2D3<2D4), as compared with that of FIG. 38B. Thus, the paper P can be smoothly conveyed from the third ribs 293 to the fourth ribs 294.

Figure 39A:
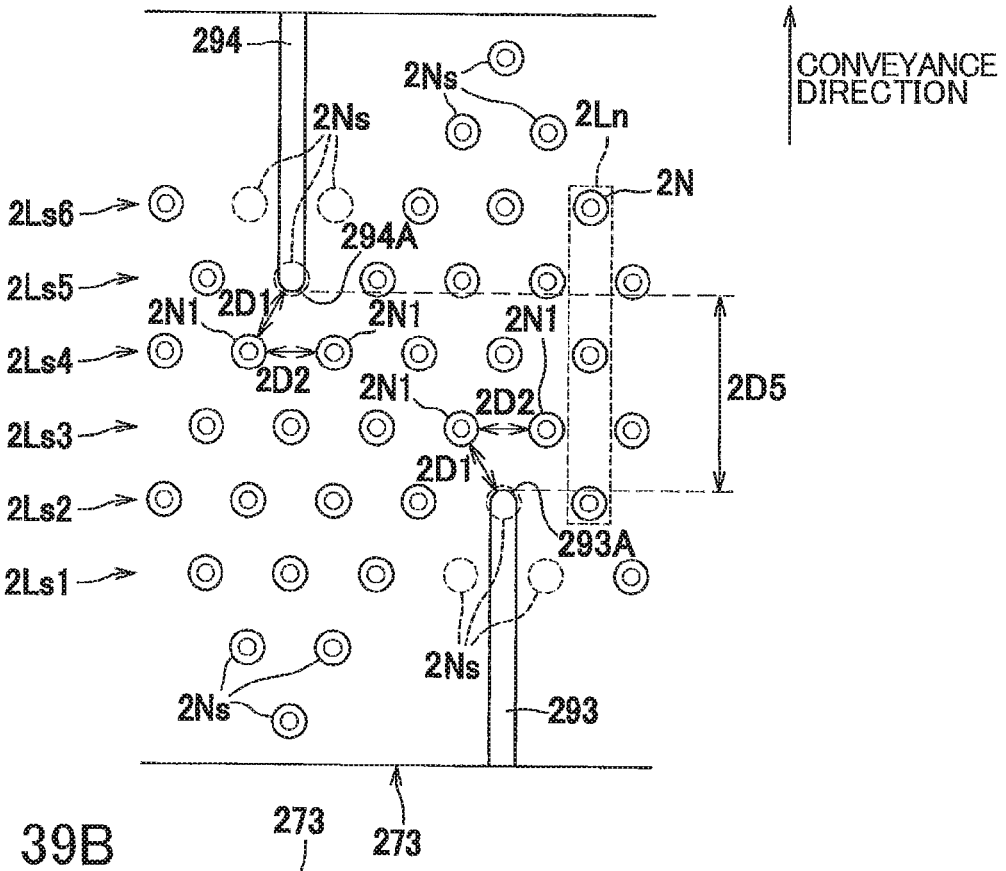
FIG. 39A is a bottom view of a fixing head as a ninth modification to the third embodiment.

In the modification illustrated in FIG. 39A, each third rib 293 is formed so as to extend from a position on the upstream side of the first lateral nozzle array 2Ls1 to a position adjacent to the third lateral nozzle array 2Ls3, and the first end portion 293A of the third rib 293 is disposed between centers of two first nozzles 2N1 of the third lateral nozzle array 2Ls3. Specifically, the first end portion 293A of the third rib 293 is disposed such that the shortest distance 2D1 between the first end portion 293A and the two first nozzles 2N1 of third lateral nozzle array 2Ls3 becomes equal to the shortest distance 2D2 between the two first nozzles 2N1.

Each fourth rib 294 is formed so as to extend from a position on the downstream side of the sixth lateral nozzle array 2Ls6 to a position adjacent to the fourth lateral nozzle array 2Ls4, and the first portion 294A of the fourth rib 294 is disposed between centers of two first nozzles 2N1 of the fourth lateral nozzle array 2Ls4 in the left-right direction. Specifically, the first end portion 294A of the fourth rib 294 is disposed such that the shortest distance 2D1 between the first end portion 294A and the two first nozzles 2N1 of the fourth lateral nozzle array 2Ls4 becomes equal to the shortest distance 2D2 between the two first nozzles 2N1.

In this modification, since each third rib 293 is disposed so as to traverse the first lateral nozzle array 2Ls1 and the second lateral nozzle array 2Ls2, three nozzles 2Ns of the first and second lateral nozzle arrays 2Ls1 and 2Ls2, each of those is to be disposed in a portion in which the third rib 293 is disposed, are rearranged at positions on the downstream side of the sixth lateral nozzle array 2Ls6. Here, before the three nozzles 2Ns are rearranged, two of the three nozzles 2Ns, those constitute the first lateral nozzle array 2Ls1, are not overlapped with a corresponding third rib 293. However, the two nozzles 2Ns are rearranged because the shortest distance between the two nozzles 2Ns and the corresponding third rib 293 is smaller than 2D1.

Similarly, since each fourth rib 294 is disposed so as to traverse the sixth lateral nozzle array 2Ls6 and the fifth lateral nozzle array 2Ls5, three nozzles 2Ns of the sixth and fifth lateral nozzle arrays 2Ls6 and 2Ls5, each of those is to be disposed in a portion in which the fourth rib 294 is disposed, are rearranged at positions on the upstream side of the first lateral nozzle array 2Ls1. With such rearrangement, each of the plurality of nozzle arrays 2Ln includes three nozzles 2N arrayed in the conveyance direction.

Figure 39B:
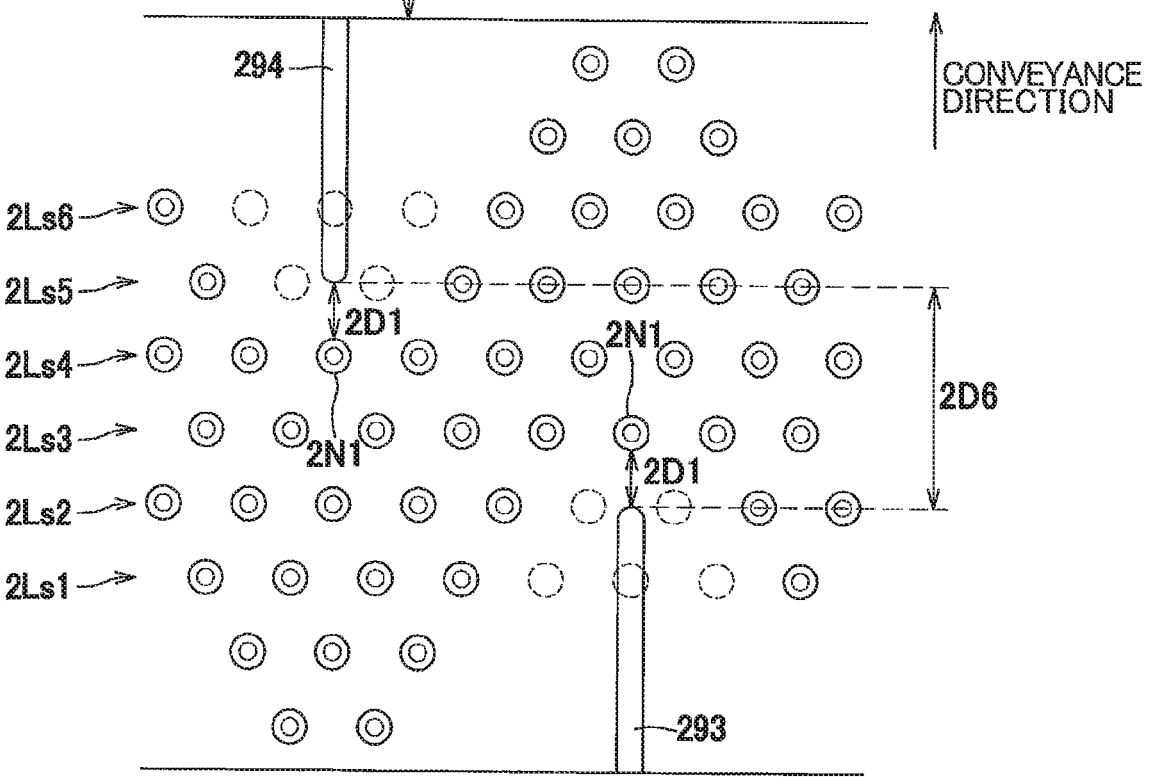
FIG. 39B is a bottom view of a fixing head as a comparative example corresponding to FIG. 39A.

This modification can also reduce the distance between the third ribs 293 and the fourth ribs 294 in the conveyance direction in comparison with the configuration in which each of the third ribs 293 and the fourth ribs 294 is arranged apart from the corresponding first nozzle 2N1 by the distance 2D1 in the conveyance direction (2D5<2D6), as illustrated in FIG. 39B.

Figure 40A:
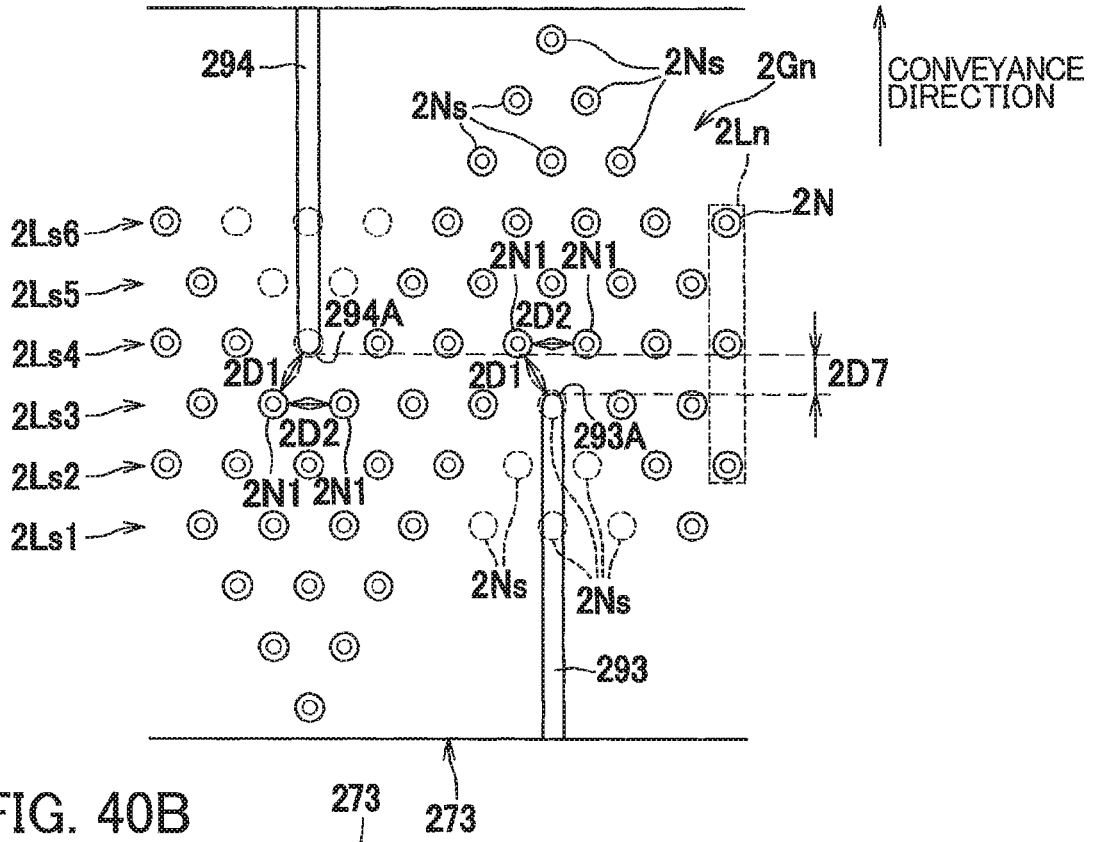
FIG. 40A is a bottom view of a fixing head as a tenth modification to the third embodiment.

In the modification illustrated in FIG. 40A, each third rib 293 is formed so as to extend from a position on the upstream side of the first lateral nozzle array 2Ls1 to a position adjacent to the fourth lateral nozzle array 2Ls4, and the first end portion 293A of the third rib 293 is disposed between centers of two first nozzles 2N1 of the fourth lateral nozzle array 2Ls4 in the left-right direction. Specifically, the first end portion 293A of the third rib 293 is disposed such that the shortest distance 2D1 between the first end portion 293A and the two first nozzles 2N1 of the fourth lateral nozzle array 2Ls4 becomes equal to the shortest distance 2D2 between the two first nozzles 2N1.

Each fourth rib 294 is formed so as to extend from a position on the downstream side of the sixth lateral nozzle array 2Ls6 to a position adjacent to the third lateral nozzle array 2Ls3, and the first end portion 294A of the fourth rib 294 is disposed between centers of two first nozzles 2N1 of the third lateral nozzle array 2Ls3 in the left-right direction. Specifically, the first end portion 294A of the fourth rib 294 is disposed such that the shortest distance 2D1 between the first end portion 294A and the two first nozzles 2N1 of the third lateral nozzle array 2Ls3 becomes equal to the shortest distance 2D2 between the two first nozzles 2N1.

In this modification, since each third rib 293 is disposed so as to traverse the first lateral nozzle array 2Ls1 to the third lateral nozzle array 2Ls3, a plurality of nozzles 2Ns of the first to third lateral nozzle array 2Ls1 to 2Ls3, each of those is to be disposed in a portion in which the third rib 293 is disposed, is rearranged at positions on the downstream side of the sixth lateral nozzle array 2Ls6. Here, two nozzles 2Ns of the first lateral nozzle array 2Ls are also rearranged even though the shortest distance between the two nozzles 2Ns and the corresponding third rib 293 is equal to or larger than 2D1. However, such rearrangement is merely performed in consideration of the whole shape of the nozzle group 2Gn. Thus, the two nozzles 2Ns may not be rearranged.

Similarly, since each fourth rib 294 is disposed so as to traverse the sixth lateral nozzle array 2Ls6 to the fourth lateral nozzle array 2Ls4, a plurality of nozzles 2Ns is rearranged at positions on the upstream side of the first lateral nozzle array 2Ls1. With such rearrangement, each of the plurality of nozzle arrays 2Ln includes three nozzles 2N arrayed in the conveyance direction.

Figure 40B:
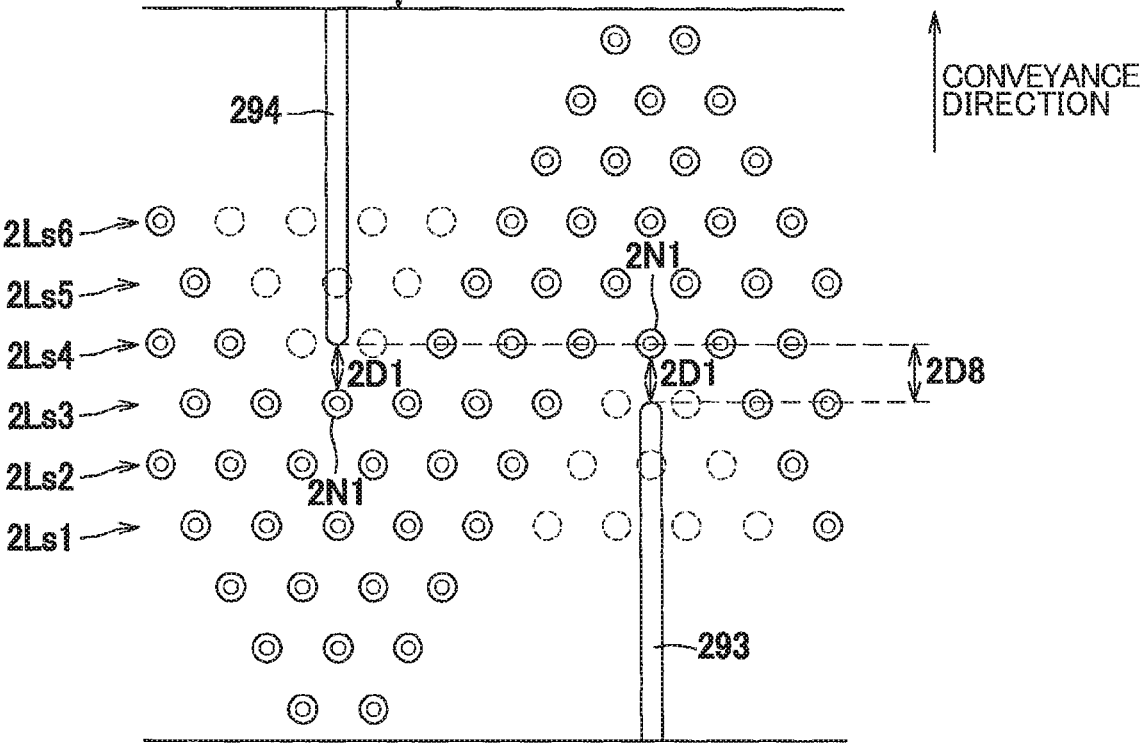
FIG. 40B is a bottom view of a fixing head as a comparative example corresponding to FIG. 40A.

This modification can also reduce the distance between the third ribs 293 and the fourth ribs 294 in the conveyance direction in comparison with the configuration in which each of the third ribs 293 and the fourth ribs 294 is arranged apart from the corresponding first nozzle 2N1 by the distance 2D1 in the conveyance direction (2D7<2D8), as illustrated in FIG. 40B.

Figure 41:
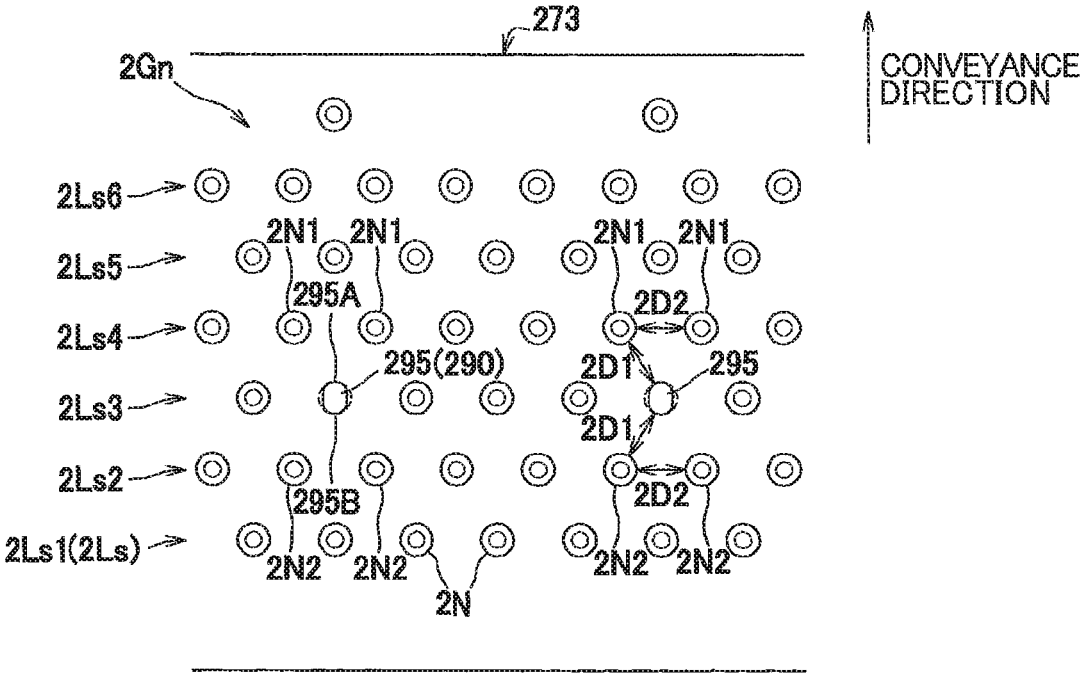
FIG. 41 is a bottom view of a fixing head as an eleventh modification to the third embodiment.

In the modification illustrated in FIG. 41, the ribs 290 include a plurality of fifth ribs 295 disposed in the nozzle group 2Gn. Each fifth rib 295 extends from the container portion 273 toward the second electrode 272, and the bottom surface of each fifth rib 285 is positioned closer to the second electrode 272 than the tip end of each nozzle 2N. Each fifth rib 295 is arranged between the second lateral nozzle array 2Ls2 and the fourth lateral nozzle array 2Ls4 in the conveyance direction, and is formed with a predetermined length (greater than a diameter of each nozzle 2N) in the conveyance direction. In the following description, nozzles 2N of the lateral nozzle array 2Ls adjacent to the fifth ribs 295 on the downstream side thereof are referred to also as first nozzles 2N1, and nozzles 2N of the lateral nozzle array 2Ls adjacent to the fifth ribs 295 on the upstream side thereof are referred to also as second nozzles 2N2, for convenience.

A first end portion 295A which is an end portion of each fifth rib 295 on the first nozzles 2N1 side is positioned between centers of two first nozzles 2N1 in the left-right direction. The first end portion 295A has a curved surface which faces the first nozzles 2N1 and has cross section whose shape includes an arc. The shortest distance 2D1 between the first end portion 295A and the two first nozzles 2N1 is equal to the shortest distance 2D2 between the two first nozzles 2N1.

A second end portion 295B which is an end portion of each fifth rib 295 on the second nozzles 2N2 side is positioned between centers of two second nozzles 2N2 in the left-right direction. The second end portion 295B has a curved surface which faces the second nozzles 2N2 and has cross section whose shape includes an arc. The shortest distance 2D1 between the second end portion 295B and the two second nozzles 2N2 is equal to the shortest distance 2D2 between the two second nozzles 2N2.

By arranging the first end portions 295A and the second end portions 295B in this manner, the distance between the second lateral nozzle array 2Ls2 and the fourth lateral nozzle array 2Ls4 can be suppressed from increasing, as compared with, for example, a configuration in which at least one of the first end portions 295A and the second end portions 295B is arranged apart from the corresponding first nozzle 2N1 or second nozzle 2N2 by the distance 2D1 in the conveyance direction. Thus, the length of the nozzle group 2Gn in the conveyance direction can be shortened.

Also in this modification, the rearrangement of nozzles 2N as described, for example, in the modification of FIG. 38A is performed.

Figure 42:
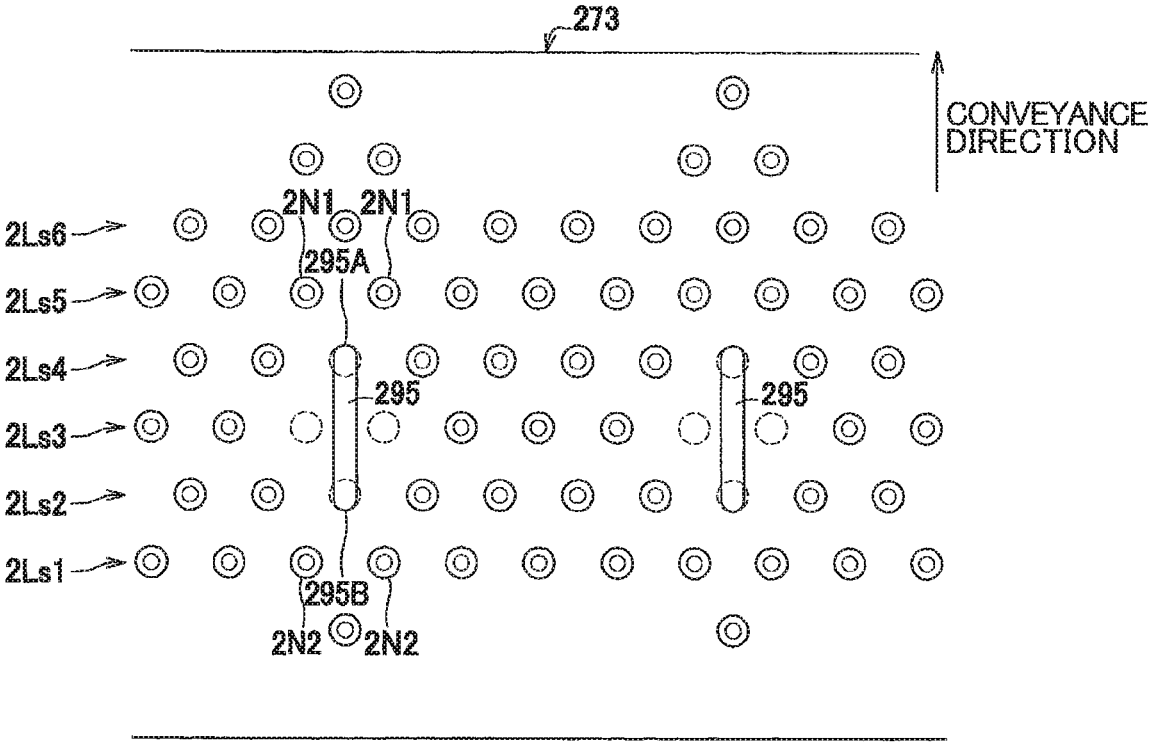
FIG. 42 is a bottom view of a fixing head as a twelfth modification to the third embodiment.

In the modification illustrated in FIG. 42, each fifth rib 295 is formed with a larger length in the conveyance direction than that of the modification of FIG. 41. Specifically, in this modification, the first end portion 295A of each fifth rib 295 is disposed between centers of two first nozzles 2N1 of the fifth lateral nozzle array 2Ls5, and the second end portion 295B of each fifth rib 295 is disposed between centers of two second nozzles 2N2 of the first lateral nozzle array 2Ls1.

According to this modification, the same effects as those of the modification of FIG. 41 can be obtained, and in addition, the paper P can be more stably guided since the length of each fifth rib 295 in the conveyance direction is longer than that of the modification of FIG. 41. Also in this modification, the rearrangement of nozzles 2N as described, for example, in the modification of FIG. 38A is performed.

Figure 43A:
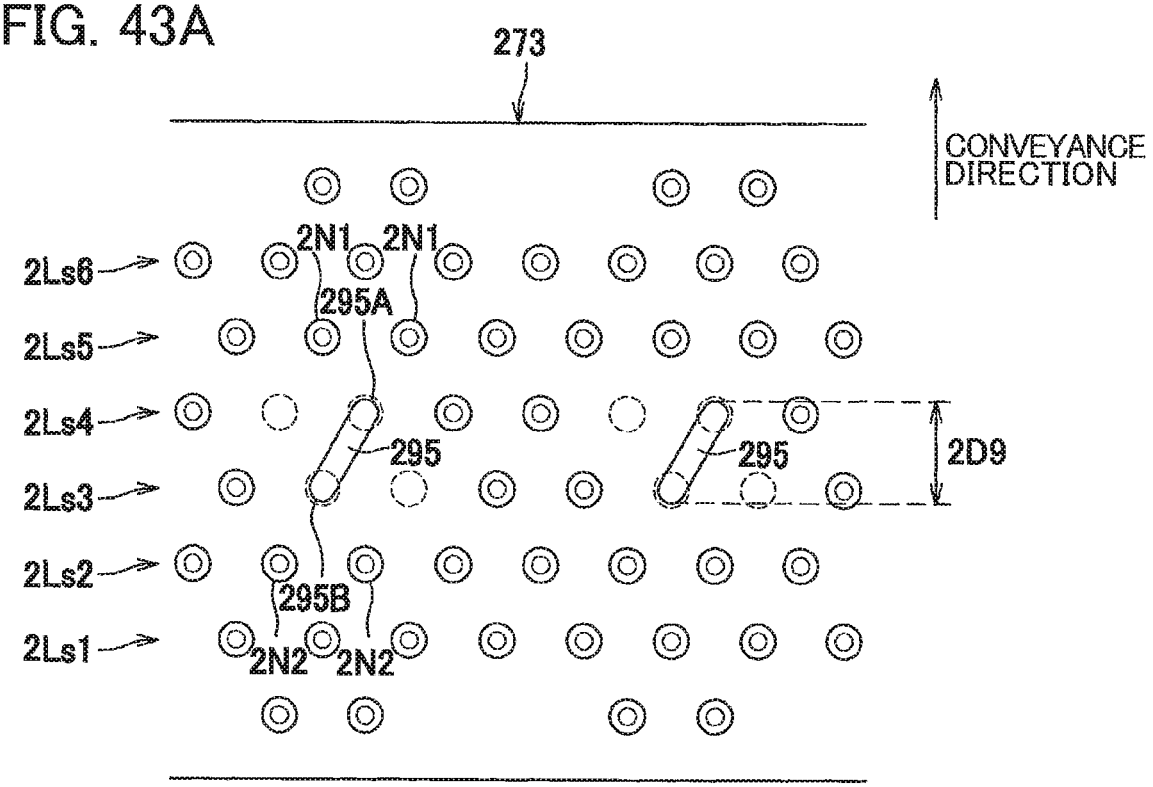
FIG. 43A is a bottom view of a fixing head as a thirteenth modification to the third embodiment.

In the modification illustrated in FIG. 43A, each fifth rib 295 is disposed between the fifth lateral nozzle array 2Ls5 and the second lateral nozzle array 2Ls2 so as to be inclined with respect to the conveyance direction. Specifically, in the modification, the first end portion 295A of each fifth rib 295 is disposed between centers of two first nozzles 2N1 of the fifth lateral nozzle array 2Ls5 in the left-right direction, and the second end portion 295B of each fifth rib 295 is disposed between centers of two second nozzles 2N2 of the second lateral nozzle array 2Ls2 in the left-right direction. Also in this modification, the rearrangement of nozzles 2N as described, for example, in the modification of FIG. 38A is performed.

Figure 43B:
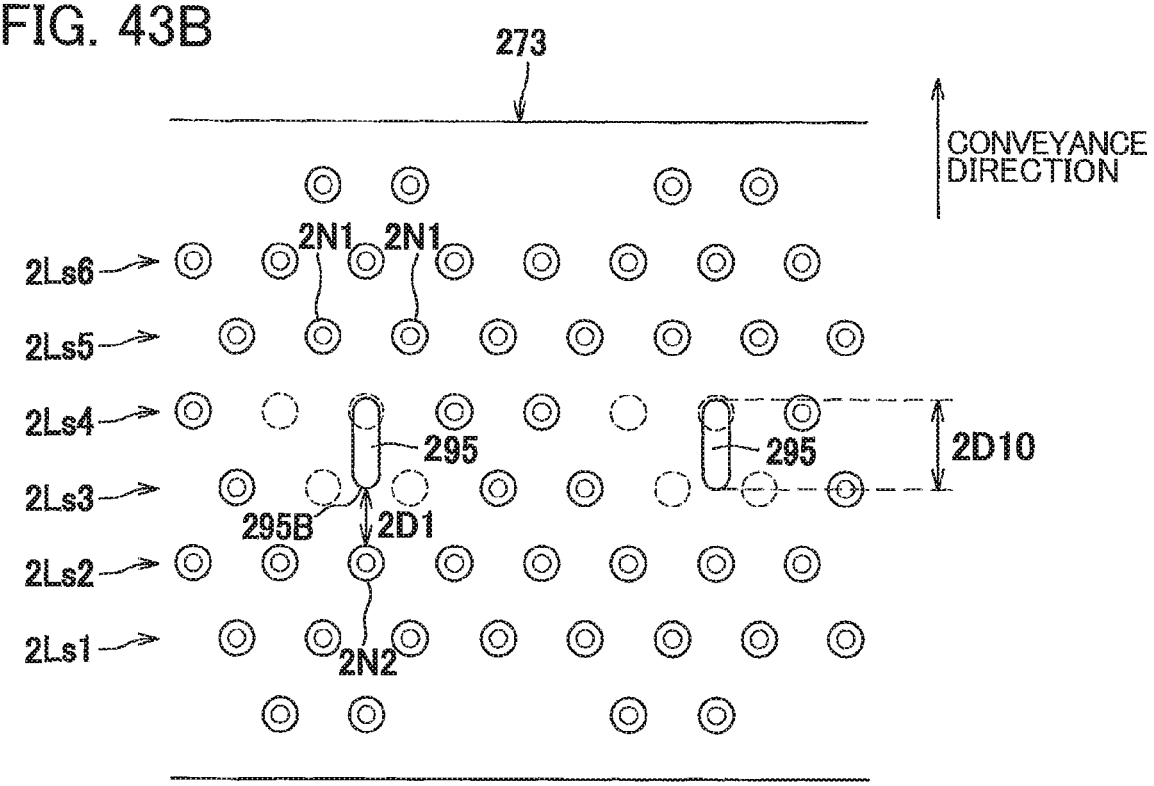
FIG. 43B is a bottom view of a fixing head as a comparative example corresponding to FIG. 43A.

In contrast, as illustrated in FIG. 43B, in a case where the fifth ribs 295 are disposed between the fifth lateral nozzle array 2Ls5 and the second lateral nozzle array 2Ls2 so as to extend in the conveyance direction, each fifth rib 295 is required to be arranged so that the second end portion 295BB thereof is separated from the corresponding second nozzle 2N2 by the distance 2D1 in the conveyance direction, for example. As a result, the length of each fifth rib 295 in the conveyance direction is reduced. Thus, the modification of FIG. 43A can increase the length of each fifth rib 295 in the conveyance direction in comparison with a comparative example of FIG. 43B (2D9>2D10).

Figure 44A:
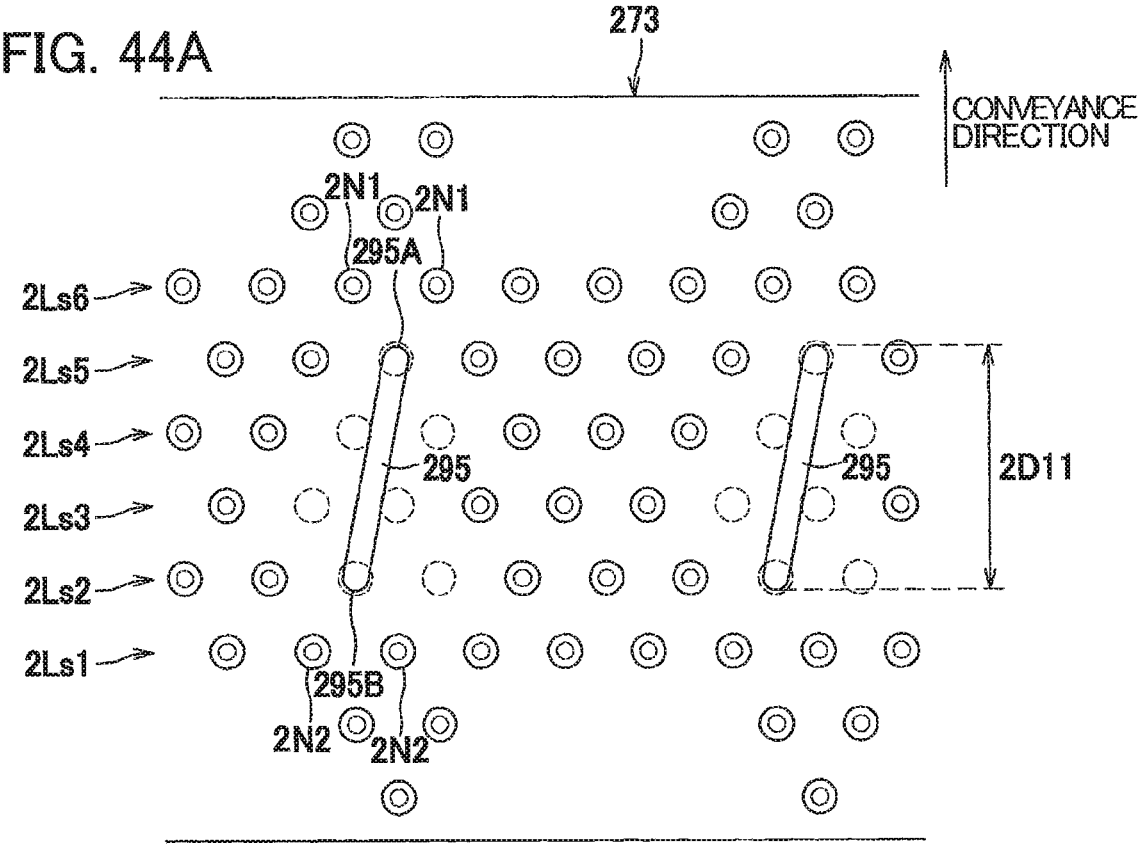
FIG. 44A is a bottom view of a fixing head as a fourteenth modification to the third embodiment.

In the modification illustrated in FIG. 44A, each fifth rib 295 is formed with a larger length in the conveyance direction than that of the modification of FIG. 43A. Specifically, in the modification, the first end portion 295A of each fifth rib 295 is disposed between centers of two first nozzles 2N1 of the sixth lateral nozzle array 2Ls6 in the left-right direction, and the second end portion 295B of each fifth rib 295 is disposed between centers of two second nozzles 2N2 of the first lateral nozzle array 2Ls1 in the left-right direction. Also in this modification, the rearrangement of nozzles 2N as described, for example, in the modification of FIG. 38A is performed.

Figure 44B:
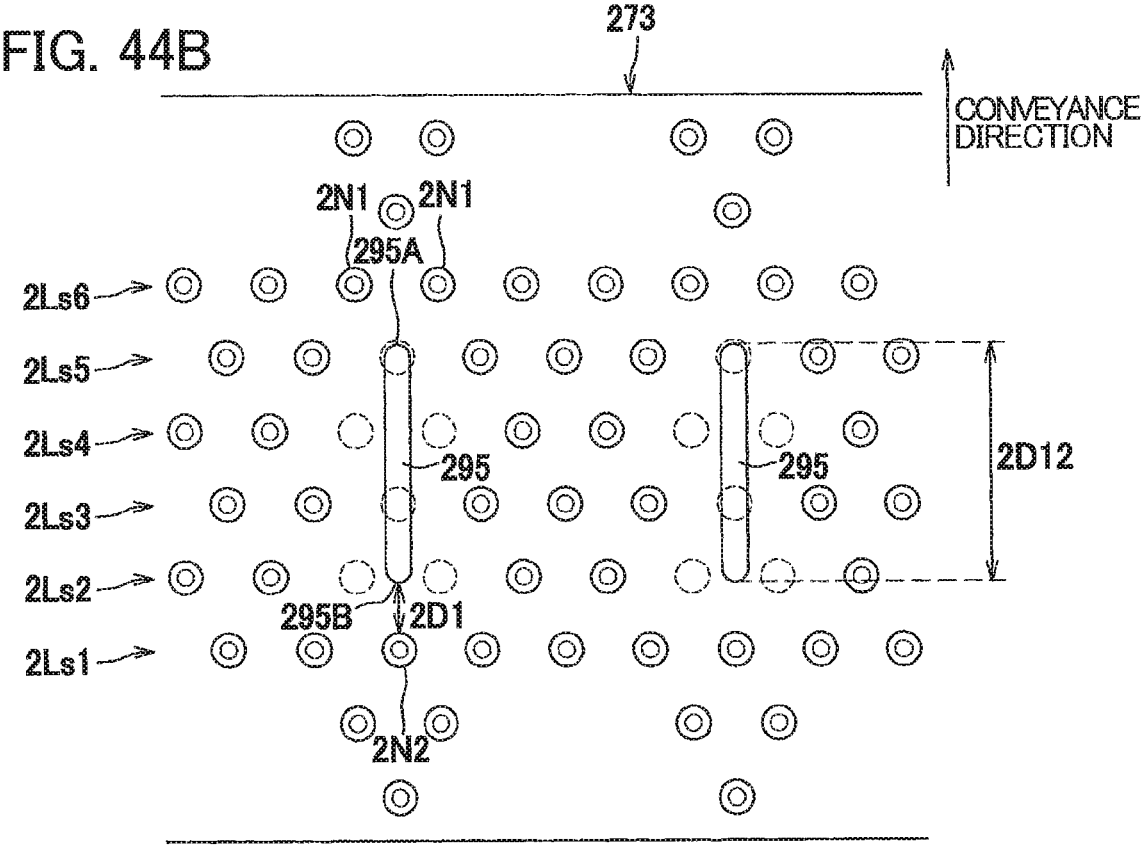
FIG. 44B is a bottom view of a fixing head as a comparative example corresponding to FIG. 44A.

In contrast, as illustrated in FIG. 44B, in a case where the fifth ribs 295 are disposed between the first lateral nozzle array 2Ls1 and the sixth lateral nozzle array 2Ls6 so as to extend in the conveyance direction, each fifth rib 295 is required to be arranged so that the second end portion 295B thereof is separated from the corresponding second nozzle 2N2 by the distance 2D1 in the conveyance direction, for example. As a result, the length of each fifth rib 295 in the conveyance direction is reduced. Thus, the modification of FIG. 44A can increase the length of each fifth rib 295 in the conveyance direction in comparison with a comparative example of FIG. 44B (2D11>2D12).

Figure 45:
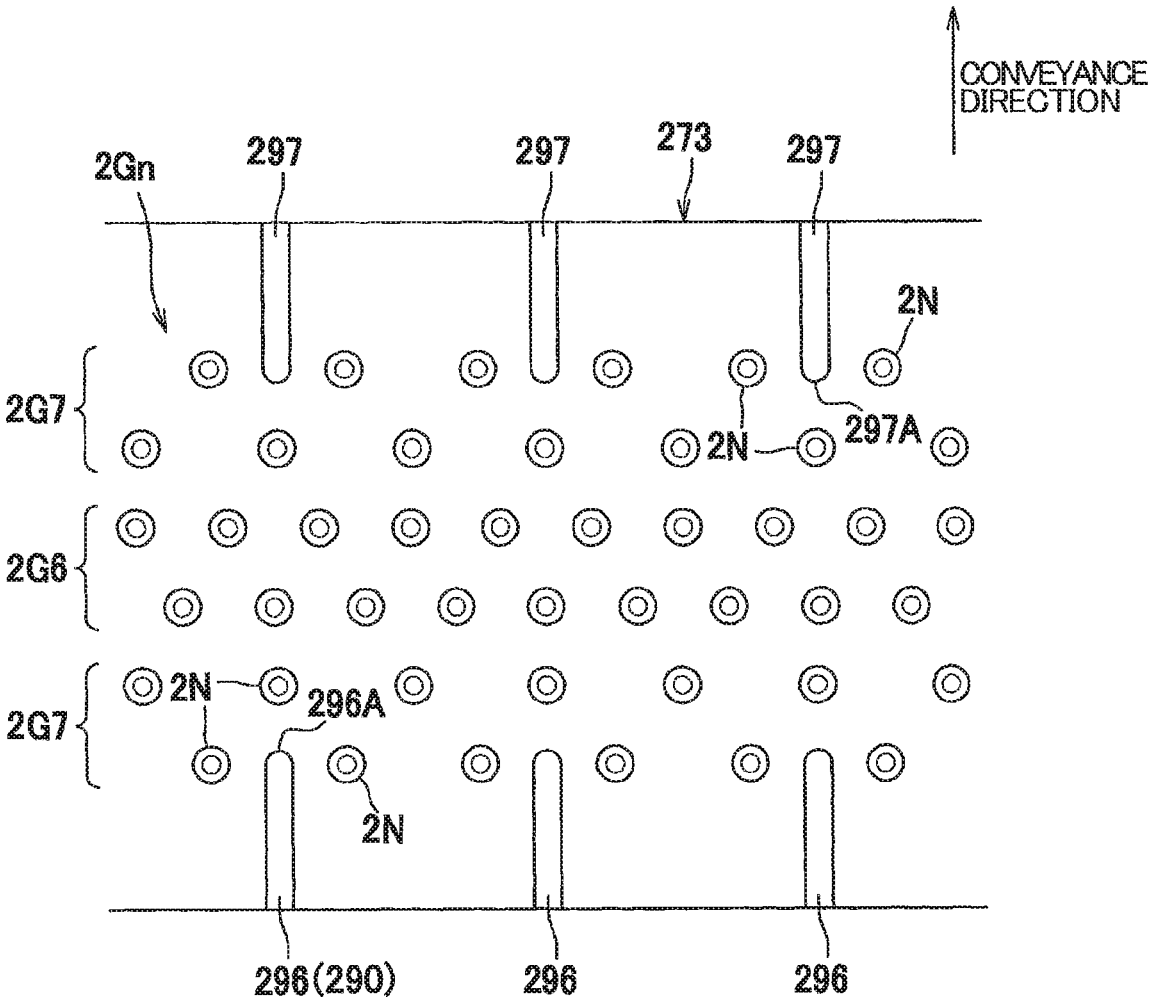
FIG. 45 is a bottom view of a fixing head as a fifteenth modification to the third embodiment.

In the modification illustrated in FIG. 45, the nozzle groups 2Gn includes a sixth nozzle group 2G6 in which a plurality of nozzles 2N is arranged at a predetermined pitch in the close-packed arrangement, and two seventh nozzle groups 2G7 in which a plurality of nozzles 2N is arranged at a pitch larger than the predetermined pitch in the close-packed arrangement. The sixth nozzle group 2G6 is disposed between the two seventh nozzle groups 2G7 in the conveyance direction. The amount of spray of each seventh nozzle group 2G7 is greater than the amount of spray of the sixth nozzle group 2G6.

In this modification, the ribs 290 include a plurality of sixth ribs 296 and a plurality of seventh ribs 297. Each sixth rib 296 is formed so as to extend from a position on the upstream side of the seventh nozzle group 2G7 disposed on the upstream side to a position between two nozzles 2N disposed on the most upstream side in the conveyance direction. Each sixth rib 296 has an end portion 296A on the downstream side thereof and the end portion 296A faces a corresponding nozzle 2N included in the second array from the upstream side in the conveyance direction.

Each seventh rib 297 is formed so as to extend from a position on the downstream side of the seventh nozzle group 2G7 disposed on the downstream side to a position between two nozzles 2N disposed on the most downstream side in the conveyance direction. Each seventh rib 297 has an end portion 287A on the upstream side thereof and the end portion 287A faces a corresponding nozzle 2N included in the second array from the downstream side in the conveyance direction.

This modification also allows the ribs 296 and 297 to suppress the paper P from touching the nozzles 2N. In addition, since the amount of spray of each seventh nozzle group 2G7 is greater than the amount of spray of the sixth nozzle group 2G6, spray areas (circular areas) of the fixing solution L sprayed onto the paper P from the nozzles 2N arranged at a larger pitch can also be overlapped with each other in the left-right direction, and substantially the same amount of spray per unit area can be achieved at each position on the paper P in the left-right direction.

In the third embodiment described above, the second electrode 272 has been described as an example of a supporting member used to support the paper P. The present invention, however, is not limited to this. For example, another supporting member may be disposed between the second electrode and the nozzles, and support the paper at a position below the paper. In this case, the supporting member is preferably provided with a paper conveyance guide which is formed along the rib 290.

In the third embodiment described above, the second electrode 272 is disposed so as to face the tip end of each nozzle 2N of the fixing head 271. The present invention, however, is not limited to this. The second electrode may be disposed so as not to overlap with the nozzles when viewed in a direction toward which the nozzles protrude. Even in such a case, when the paper which is in contact with the second electrode faces the tip ends of nozzles, a potential difference is produced between the fixing solution in the nozzles and the paper, allowing the electrostatic spraying.

In the third embodiment described above, the present invention is applied to the laser printer 201. The present invention, however, is not limited to this, and may be applied to other image forming devices, such as color printers, copying machines, and multifunction peripherals.

In the third embodiment described above, the paper P, such as thick paper, postcard, or thin paper, is described as one example of a recording sheet. The present invention, however, is not limited to this, and the recording sheet may be a transparency film for example.

In the third embodiment described above, the photosensitive drum 61 is described as a photosensitive member, as an example. The present invention, however, is not limited to this. The photosensitive member may be a belt-like photosensitive member.

In the third embodiment described above, the first electrode 274 is disposed in the interior of the container portion 273. The present invention, however, is not limited to this. For example, the nozzles and the container portion may be made of a conductive member such as a metal, and the nozzles or the container portion may be applied with a voltage. In this case, the nozzles or the container portion, which is applied with a voltage, functions as the first electrode. In another case, the container portion may be made of a non-conductive member such as a resin, the nozzles may be made of a conductive member such as a metal, and the nozzles may be applied with a voltage. In this case, the nozzles function as the first electrode.

The first ribs 291 and the second ribs 292 are not necessarily completely continuous in the conveyance direction, and may be interrupted in the middle of the conveyance direction.

The first ribs 291 and the second ribs 292 may be members separated from the container portion 273. Only the first ribs 291 and the second ribs 292 may be formed as a separate unit, and separated from the container portion.

The third object can be achieved by the third embodiment described with reference to FIGS. 27 to 45. The above-described third embodiment is one example of the third invention, and the third invention is not limited to this.

Next, a laser printer 301 according to a fourth embodiment of the present invention will be described in detail while referring to FIGS. 46-52. In the fourth embodiment, parts and components similar to those of the first embodiment are designated with the same reference numerals to avoid duplicating description. The laser printer 301 includes a fixing device 307.

The present inventor has conceived the device that sprays the fixing solution from the nozzles disposed away from the recording sheet, by using the electrostatic spraying method, to thereby perform the fixing. Also, the present inventor has understood that, in order to putting this device into practical use, it is important to accurately calculate the amount of spray of the fixing solution sprayed from the nozzles. The fourth embodiment has been conceived on the basis of such understanding.

In the following description, directions are defined with respect to a position of a user using the laser printer. That is, the right side of FIG. 46 is defined as a "front side," the left side of FIG. 46 is defined as a "rear side," the far side of FIG. 46 is defined as a "right side," and the near side of FIG. 46 is defined as a "left side." The up-down direction of FIG. 46 is defined as an "up-down direction."

Figure 46:
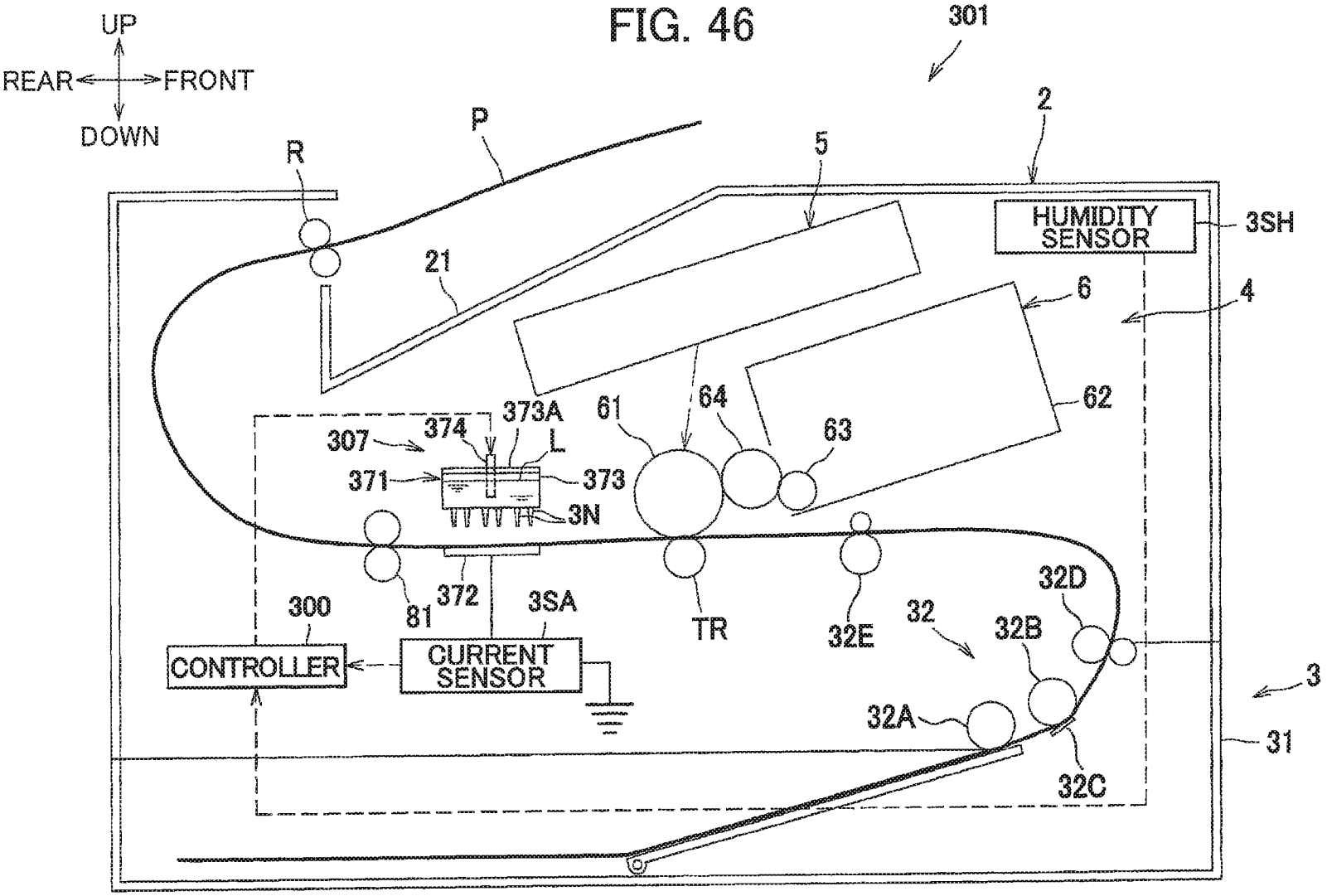
FIG. 46 is a view illustrating a laser printer provided with a fixing device according to a fourth embodiment of the present invention.

As illustrated in FIG. 46, the fixing device 307 is configured to spray electrically charged fixing solution L toward the toner image on the paper P, using the electrostatic spraying method, to thereby fix the toner image to the paper P. Note that a configuration of the fixing device 307 will be described later in detail.

The downstream side conveyance roller 81 is provided downstream relative to the fixing device 307 in the conveyance direction of the paper P. The downstream side conveyance roller 81 is configured to convey the paper P, which has been discharged from the fixing device 307, to the downstream side in the conveyance direction. The paper P that has been conveyed by the downstream side conveyance roller 81 is conveyed to the discharge roller R, and then is discharged from the discharge roller R onto the paper discharge tray 21.

Next, the configuration of the fixing device 307 will be described in detail.

The fixing device 307 includes a fixing head 371 and a second electrode 372. The fixing head 371 is used to spray the fixing solution L. The second electrode 372 is positioned below the fixing head 371 and is configured to support the paper P.

The fixing head 371 includes a container portion 373, a plurality of nozzles 3N, and a first electrode 374. The container portion 373 accommodates therein the fixing solution L. Each of the plurality of nozzles 3N is communicated with the interior of the container portion 373 and sprays the fixing solution L toward the toner image. The first electrode 374 is configured to apply a voltage to the fixing solution L accommodated in the container portion 373 and in the nozzles 3N. The first electrode 374 is provided so as to penetrate a top wall 373A of the container portion 373 downward. The first electrode 374 has a lower end portion positioned in the fixing solution L accommodated in the container portion 373, and an upper end portion connected to a controller 300 including a voltage applying portion (not illustrated). It is preferable that the voltage applied to the first electrode 374 is within a range from 1 kV to 10 kV.

The second electrode 372 is configured to contact the paper P and generate a potential difference between the paper P and the fixing solution L accommodated in the nozzles 3N. The second electrode 372 is disposed below the nozzles 3N so as to be separated from the tip ends of the nozzles 3N by a predetermined distance. Here, the predetermined distance is larger than the thickness of the paper P, and is determined through experiments, simulations, or other methods so as to be a distance that enables the electrostatic spraying to be satisfactorily performed.

The second electrode 372 is grounded via a current sensor 3SA. However, the second electrode 372 need not necessarily be grounded, and may be applied with a voltage lower than the voltage applied to the first electrode 374.

When the voltage is applied to the first electrode 374, an electric field is produced at a space in the vicinity of the tip ends of the nozzles 3N. As a result, at each of the tip ends of the nozzles 3N, the fixing solution L is pulled by the electric field to form a so-called Taylor cone. Then, the fixing solution L forming a tip end of the Taylor cone is pulled off, and therefore a fine droplet is generated.

The droplets of the fixing solution L that have been sprayed from the nozzles 3N are positively charged. In contrast, the paper P has a substantially zero potential. Thus, the droplets of the fixing solution L flies toward the paper P due to Coulomb force, and adheres onto the paper P or the toner image formed thereon.

The current sensor 3SA is a sensor configured to detect current which flows through the second electrode 372. The current sensor 3SA detects the current flowing through the second electrode 372 when the fixing solution L is sprayed from the nozzles 3N to the paper P, and outputs the detected value to the controller 300. Here, when the fixing solution L is not sprayed from the nozzles 3N, the current does not flow in the second electrode 372 in spite of the fact that the voltage has been applied to the first electrode 374. The current flows through the second electrode 372 by the fixing solution L being sprayed from the nozzles 3N, i.e., by movement of the electrically charged fixing solution L from the nozzles 3N to the paper P.

The first electrode 374 and the second electrode 372 configured as described above constitute a potential difference generating portion which generates a potential difference between the fixing solution L contained in the nozzles 3N and the paper P conveyed at a position separated from the nozzles 3N.

The casing 2 is provided with a humidity sensor 3SH which detects humidity. The humidity sensor 3SH outputs the detected humidity value to the controller 300.

Figure 47A:
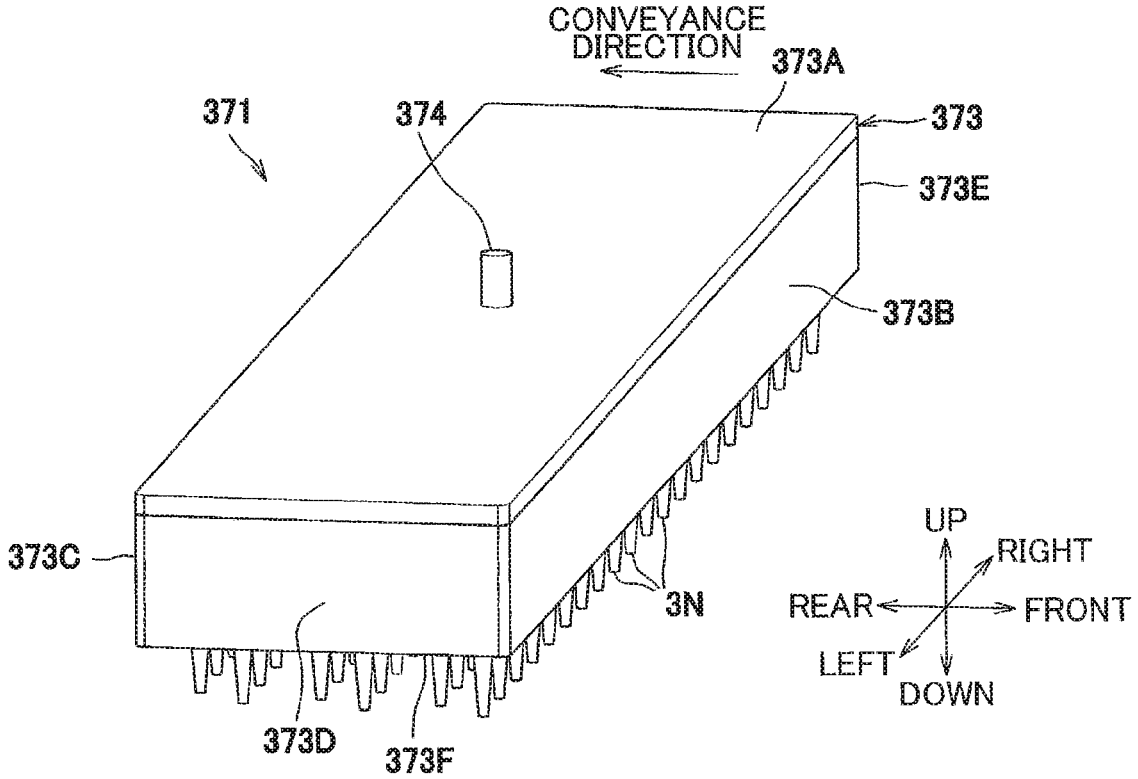
FIG. 47A is a perspective view of a fixing head as viewed from diagonally above.

As illustrated in FIG. 47A, the container portion 373 is a rectangular container which is elongated in the left-right direction, i.e., in the width direction of the paper P. The container portion 373 has the top wall 373A, a front wall 373B, a rear wall 373C, a left wall 373D, a right wall 373E, and a bottom wall 373F.

Figure 47B:
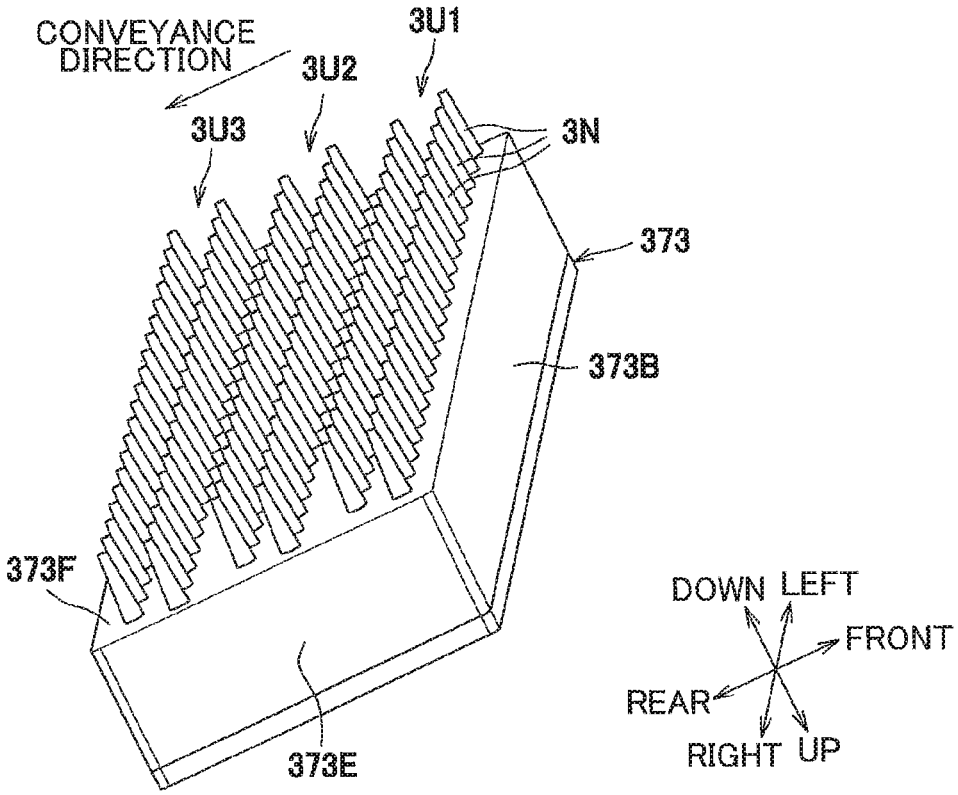
FIG. 47B is a perspective view of the fixing head as viewed from diagonally below.

As illustrated in FIG. 47B, each of the plurality of nozzles 3N protrudes downward from the bottom wall 373F of the container portion 373, with its diameter gradually reduced as it extend downward. The plurality of nozzles 3N is disposed such that a plurality of lines of nozzles 3N is arranged one after another in the conveyance direction of the paper P, that is, the front-rear direction, and that each line has a plurality of nozzles arranged in the width direction of the paper P, that is, the left-right direction.

Specifically, the plurality of nozzles 3N constitutes three staggered array groups 3U1, 3U2, and 3U3, which are disposed in the conveyance direction. In the following description, the staggered array group 3U1 positioned at the front end is referred to also as a first staggered array group 3U1, the staggered array group 3U2 positioned downstream relative to the first staggered array group 3U1 in the conveyance direction is referred to also as a second staggered array group 3U2, and the staggered array group 3U3 positioned at the rear end is referred to also as a third staggered array group 3U3.

Figures 48A, 48B:
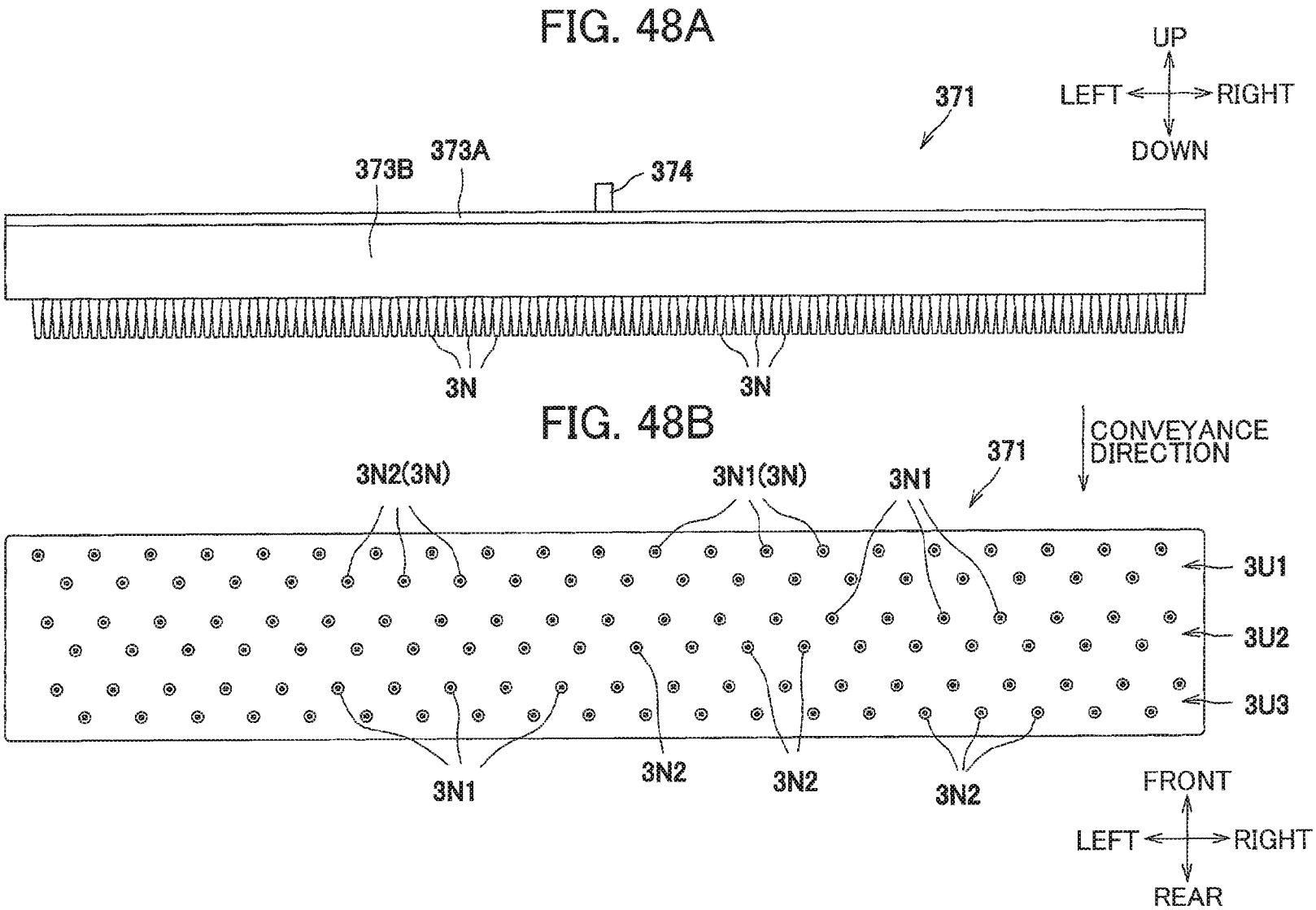
FIG. 48A is a front view of the fixing head.
FIG. 48B is a bottom view of the fixing head.

As illustrated in FIGS. 48A and 48B, the first staggered array group 3U1 includes a plurality of first nozzles 3N1 arranged in the width direction at regular intervals, and a plurality of second nozzles 3N2 arranged in the width direction at regular intervals. The first nozzles 3N1 and the second nozzles 3N2 are alternately arranged in the width direction with the first nozzles 3N1 disposed in one side of the conveyance direction and with the second nozzles 3N2 disposed in the other side of the conveyance direction. Each of the plurality of second nozzles 3N2 is positioned between two neighboring first nozzles 3N1 in the width direction. The second staggered array group 3U2 and the third staggered array group 3U3 have the same structures as that of the first staggered array group 3U1. In the present embodiment, the nozzle pitch (i.e., the shortest nozzle pitch) may be set within a range of 1 mm or more and 14 mm or less.

As illustrated in FIG. 46, the controller 300 includes a CPU, a RAM, a ROM, and an input and output circuit. The controller 300 has a function to control the voltage applied to the first electrode 374 on the basis of image data inputted from the outside and signals sent from the current sensor 3SA and the humidity sensor 3SH. Specifically, the controller 300 has a function to estimate a ratio Rx of charge to mass on the basis of a humidity value detected by the humidity sensor 3SH.

Here, the ratio Rx of charge to mass is an index indicating the amount of electric charge that is transported by the sprayed fixing solution, with a weight as reference. The ratio Rx of charge to mass can be obtained as a coulomb amount per unit weight. Specifically, the ratio Rx of charge to mass is a ratio I/ρ which indicates the relationship between: the target amount ρ of spray of the fixing solution which has been actually sprayed under a predetermined temperature-and-humidity condition; and a current I, which has flowed through the second electrode 372 by the above actual spraying. The ratio Rx of charge to mass is set as appropriate in accordance with humidity, through experiments or simulations. In addition, a map indicating the relationship between the ratio Rx of charge to mass and the humidity is stored in a storage (not illustrated). The controller 300 refers, as appropriate, to the map stored in the storage, and sets the ratio Rx of charge to mass corresponding to the humidity at that time.

In addition, the controller 300 has a function to execute a third process in which the controller 300 sets a target amount ρ of spray. The target amount ρ of spray is a target value on the amount of the fixing solution that is sprayed from the nozzles 3N per unit time on the basis of image data. Specifically, upon receiving image data (print command), the controller 300 sets an initial target amount $\rho_0$ of spray in accordance with a density of a portion of the image data, which portion is subject to spraying. More specifically, the controller 300 sets the initial target amount $\rho_0$ of spray to a larger value as the density of the portion of the image data is higher. Here, a map or a function indicating the relationship between the density and the initial target amount $\rho_0$ of spray may be stored in the storage (not illustrated).

In addition, the controller 300 has a function to correct, in the third process, the initial target amount $\rho_0$ of spray in accordance with data which is contained in the image data and which indicates a type of the paper P. Specifically, when the controller 300 determines that the paper P is plain paper, the controller 300 sets a provisional target amount $\rho_1$ of spray to the initial target amount $\rho_0$ of spray without changing the initial target amount $\rho_0$. When the controller 300 determines that the paper P is thin paper thinner than the plain paper, the controller 300 sets the provisional target amount $\rho_1$ of spray to a value smaller than that when determining that the paper P is the plain paper. When the controller 300 determines that the paper P is thick paper thicker than the plain paper, the controller 300 sets the provisional target amount $\rho_1$ of spray to a value larger than that when determining that the paper P is the plain paper.

In addition, the controller 300 has a function to correct, in the third process, the provisional target amount $\rho_1$ of spray on the basis of data which is contained in the image data and which indicates image quality. Specifically, the controller 300 determines whether the image quality is high quality. When the controller 300 determines that the image quality is not high quality, that is, the image quality is normal quality, the controller 300 sets the target amount ρ of spray to the provisional target amount $\rho_1$ of spray without changing the provisional target amount $\rho_1$. When the controller 300 determines that the image quality is high quality, the controller 300 sets the target amount ρ of spray to a value larger than that when determining the image quality is normal quality. Examples of the high quality mode include a gloss mode of giving a gloss effect to the toner image.

In addition, in the third process, the controller 300 sets a target current value IT corresponding to the target amount ρ of spray. In the present embodiment, the target current value IT is set by multiplying the set target amount ρ of spray by the above-described ratio Rx of charge to mass.

The setting of the target current value IT is not limited to the above method. For example, the target current value IT may be directly set from the image quality or the type of the paper P, by using a map indicating in advance the relationship between the image quality or the type of the paper P and the target current value IT. Even in the method of directly setting the target current value IT from the image quality or the type of the paper P, since the target current value IT corresponds to the target amount ρ of spray, it can be said that the controller 300 indirectly sets the target amount ρ of spray in the third process.

The controller 300 controls the voltage so that the current detected by the current sensor 3SA can have the set target current value IT. In the following description, the value of the current detected by the current sensor 3SA is referred to also as a measured current value $I_n$.

Further, the controller 300 has a function to execute a second process in which the controller 300 determines whether the spraying of the fixing solution L from the nozzles 3N has become stable. Specifically, the controller 300 determines whether the spraying has become stable, by determining whether the difference between the measured current value $I_n$ and the target current value IT has become equal to or smaller than a prescribed value δ.

In addition, the controller 300 has a function to execute a first process in which the controller 300 estimates a consumption amount Lu of the fixing solution L per unit time. The controller 300 executes the first process when determining in the second process that the spraying has become stable. Here, the consumption amount Lu is the amount of spray of the fixing solution L sprayed from the nozzles 3N per unit time. Specifically, in the first process, the controller 300 estimates the consumption amount Lu to be a value obtained by dividing the measured current value $I_n$ by the ratio Rx of charge to mass.

Further, when the controller 300 determines in the second process that the spraying has not become stable yet, the controller 300 sets the consumption amount Lu of the fixing solution L to 0. That is, the consumption amount Lu of the fixing solution L during a period of time from when the spraying of the fixing solution L is started to when the spraying becomes stable is set to 0 by the controller 300.

In addition, the controller 300 has a function to execute a fourth process in which the controller 300 calculates a residual amount $L_n$ of the fixing solution L by subtracting the consumption amount Lu from a previous value $L_{n-1}$ of the residual amount $L_n$ of the fixing solution L.

Next, an operation of the controller 300 will be described in detail.

Figure 49:
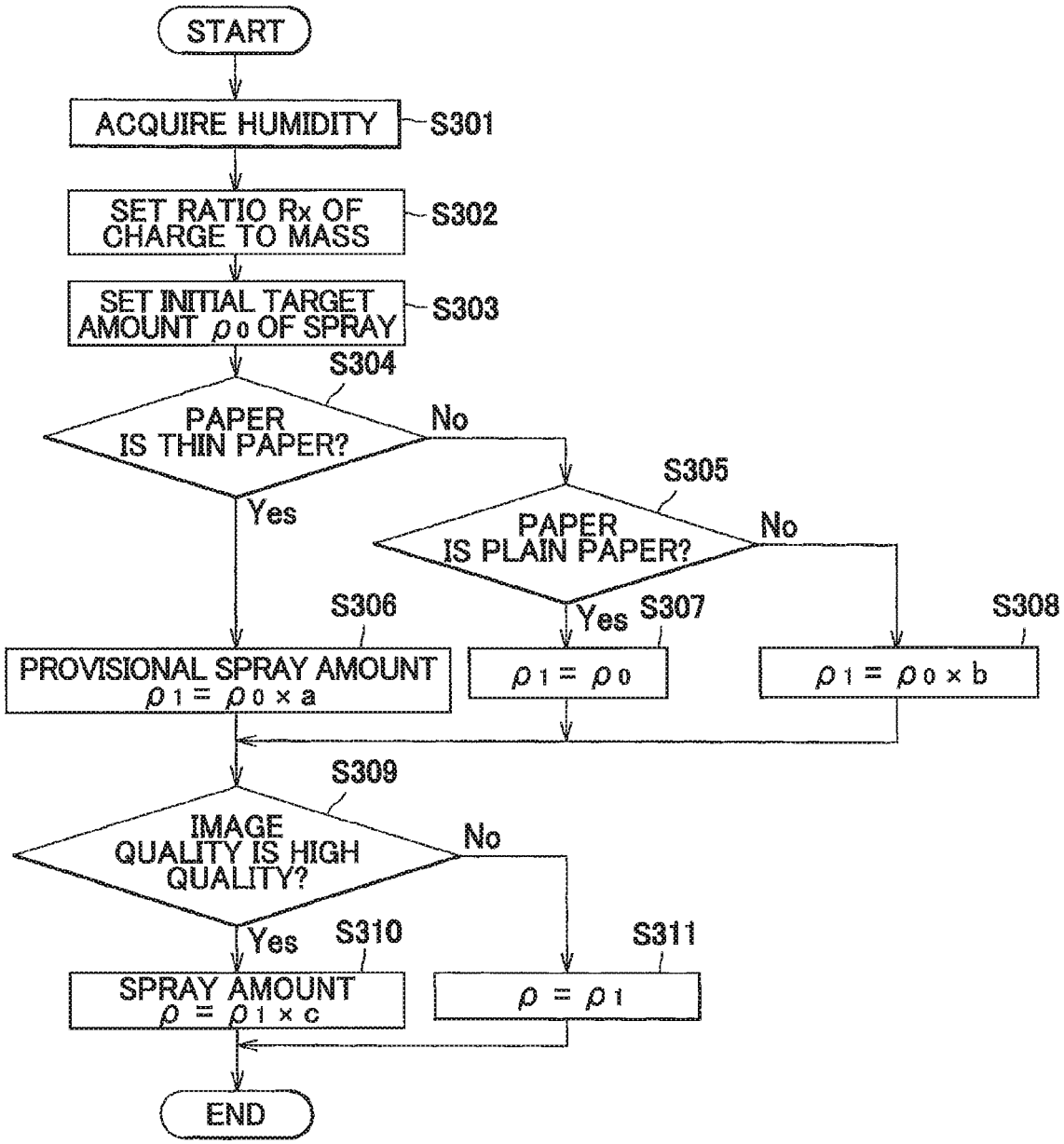
FIG. 49 is a flowchart illustrating a setting process to set spraying amount.

As illustrated in FIG. 49, upon receiving a print command (START), the controller 300 acquires a humidity value from the humidity sensor 3SH (S301), and sets the ratio Rx of charge to mass on the basis of the humidity value (S302). After Step S302, the controller 300 sets the initial target amount $\rho_0$ of spray on the basis of the image data (S303).

After Step S303, the controller 300 determines whether the paper P is thin paper, in accordance with the print command (S304). When the controller 300 determines in Step S304 that the paper P is not thin paper (NO), the controller 300 determines whether the paper P is plain paper (S305).

When the controller 300 determines in Step S305 that the paper P is plain paper (YES), the controller 300 sets the provisional target amount $\rho_1$ of spray to the initial target amount $\rho_0$ of spray without changing the initial target amount $\rho_0$ (S307). When the controller 300 determines in Step S305 that the paper P is not plain paper, that is, the paper is thick paper (No), the controller 300 sets the provisional target amount $\rho_1$ of spray to a value obtained by multiplying the initial target amount $\rho_0$ of spray by a correction coefficient b that is equal to or larger than 1 (for example, 1.1) (S308). When the controller 300 determines in Step S304 that the paper P is thin paper (Yes), the controller 300 sets the provisional target amount $\rho_1$ of spray to a value obtained by multiplying the initial target amount $\rho_0$ of spray by a correction coefficient a that is smaller than 1 (for example, 0.9) (S306).

After Step S306, S307, or S308, the controller 300 determines whether the image quality is high quality on the basis of the image data (S309). When the controller 300 determines in Step S309 that the image quality is not high quality, that is, the image quality is normal quality (No), the controller 300 sets the target amount ρ of spray to the provisional target amount $\rho_1$ of spray without changing the provisional target amount $\rho_1$ (S311), and ends this control. On the other hand, when the controller 300 determines in Step S309 that the image quality is high quality (Yes), the controller 300 sets the target amount ρ of spray to a value obtained by multiplying the provisional target amount $\rho_1$ of spray by a correction coefficient c that is equal to or larger than 1 (for example, 1.1) (S310), and ends this control.

Figure 50:
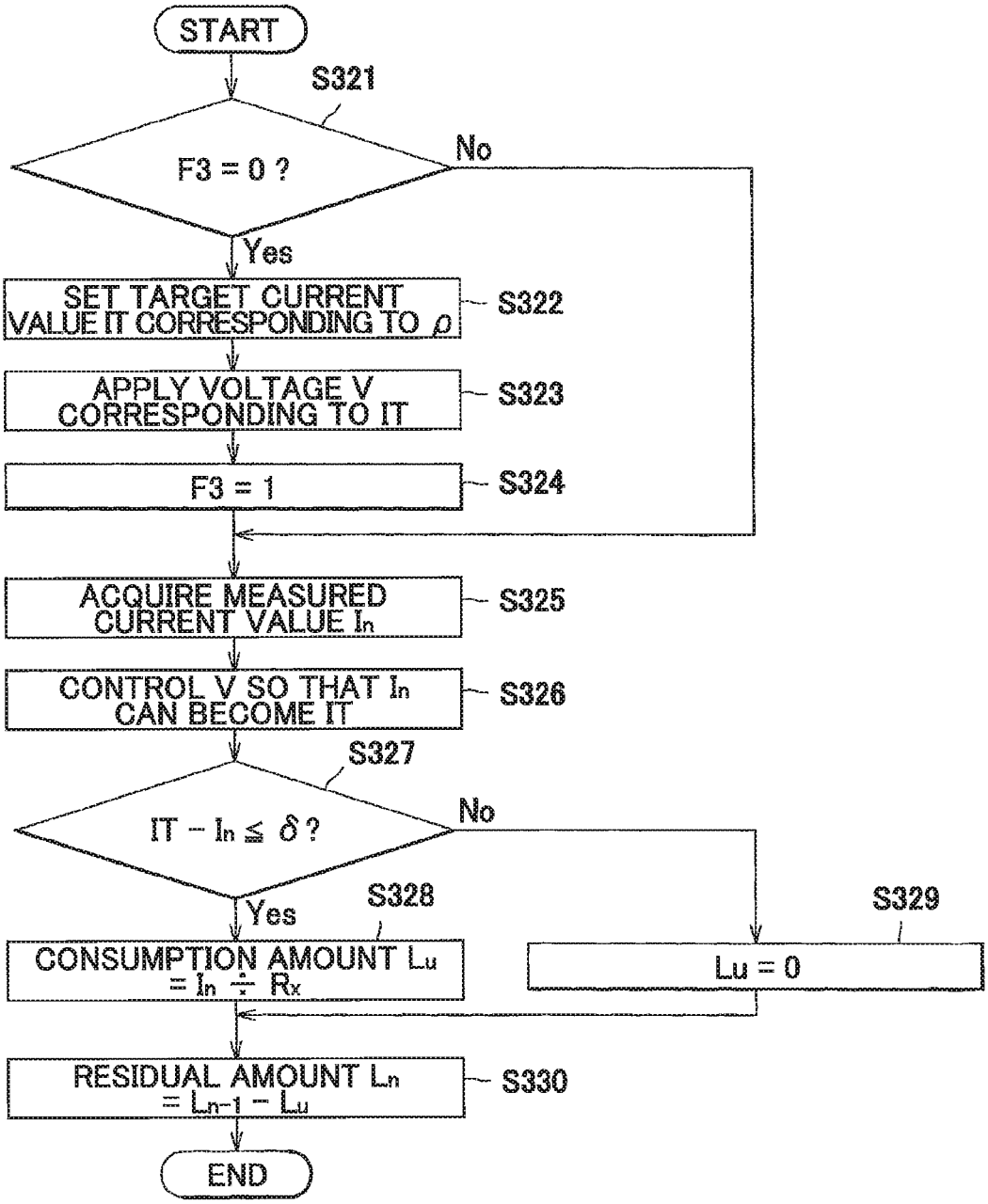
FIG. 50 is a flowchart illustrating a residual amount calculating process to calculate residual amount of fixing solution.

After completing the process of FIG. 49, the controller 300 executes the process of FIG. 50. The process of FIG. 50 is repeatedly executed. One cycle of the repeatedly executed process of FIG. 50 is referred to as a control cycle.

After setting the target amount ρ of spray as illustrated in the flowchart of FIG. 49 (START), the controller 300 determines whether a flag F3 is 0 (S321), as illustrated in FIG. 50. Here, the flag F3 is set to 0 every time the print control is finished.

When the controller 300 determines in Step S321 that the flag F3 is 0 (Yes), the controller 300 sets the target current value IT corresponding to the set target amount ρ of spray (S322), and then applies a voltage V corresponding to the set target current value IT to the first electrode 374 (S323). After Step S323, the controller 300 sets the flag F3 to 1 (S324), and proceeds to Step S325.

In Step S321, when the controller 300 determines that the flag F3 is not 0 (No), the controller 300 skips steps S322 to S324, and proceeds to Step S325. In Step S325, the controller 300 acquires a measured current value $I_n$ from the current sensor 3SA.

After Step S325, the controller 300 controls the voltage V so that the measured current value $I_n$ can become equal to the target current value IT (S326). After Step S326, the controller 300 determines whether the spraying has become stable, by determining whether a value obtained by subtracting the measured current value $I_n$ from the target current value IT has become equal to or smaller than a prescribed value δ (S327).

When the controller 300 determines in Step S327 that the relational expression $IT-I_n>\delta$ is satisfied (No), the controller 300 sets the consumption amount Lu of the fixing solution L to 0 (S329). When the controller 300 determines in Step S327 that the relational expression $IT-I_n\leq\delta$ is satisfied (Yes), the controller 300 sets the consumption amount Lu of the fixing solution L to a value obtained by dividing the measured current value $I_n$ by the ratio Rx of charge to mass (S328).

Here, the conveyance of the paper P is started after the spraying is determined to have become stable. That is, the fixing head 371 starts the spraying before the paper P reaches the fixing head 371.

After Step S328 or S329, the controller 300 sets the residual amount $L_n$ of the fixing solution L to a value obtained by subtracting the consumption amount Lu from the previous value $L_{n-1}$ of the residual amount of the fixing solution L (S330). Note that, for example, each time the storage tank used to supply the fixing solution L to the fixing head 371 is replaced with a new storage tank, the residual amount $L_n$ of the fixing solution L is set to the amount of the fixing solution stored in the new storage tank.

According to the above-described fourth embodiment, the following effects can be obtained.

The consumption amount Lu of the fixing solution L is calculated after the spraying of the fixing solution L from the nozzles 3N becomes stable. Thus, the residual amount $L_n$ of the fixing solution L can be calculated with high accuracy.

Here, the amount of the fixing solution L sprayed from the nozzles 3N during the period of time in which the spraying is unstable is so small that it can be ignored. Accordingly, during this unstable period of time, the consumption amount Lu is set to 0 and the calculation of the consumption amount Lu is omitted. With this configuration, the consumption amount Lu can be easily calculated.

In the state where the spraying is stable, the target amount ρ of spray is proportional to the measured current value L. Accordingly, by controlling the measured current value $I_n$ so that the measured current value $I_n$ can become equal to the target current value IT corresponding to the target amount ρ of spray, an appropriate amount of fixing solution L can be sprayed.

Whether the spraying has become stable is determined by determining whether the difference between the measured current value $I_n$ and the target current value IT has become equal to or smaller than the prescribed value δ. Thus, the stable state of the spraying can be appropriately determined on the basis of the current that actually flows in the second electrode 372.

The consumption amount Lu can be highly accurately calculated, since the consumption amount Lu of the fixing solution L is calculated on the basis of the current that actually flows in the second electrode 372.

The consumption amount Lu can be highly accurately calculated since the consumption amount Lu of the fixing solution L is calculated in consideration of the ratio Rx of charge to mass which changes depending upon humidity.

Since the target amount ρ of spray is set in accordance with the type of the paper P, the fixing can be performed with an appropriate amount of spray for each of different types of the paper P.

The present invention is not limited to the above-described fourth embodiment, and can be used in various embodiments as described below as examples. In the following description, structures and processes which are substantially the same as those in the fourth embodiment are designated with the same reference numerals, and the description thereof will be omitted.

Figure 51:
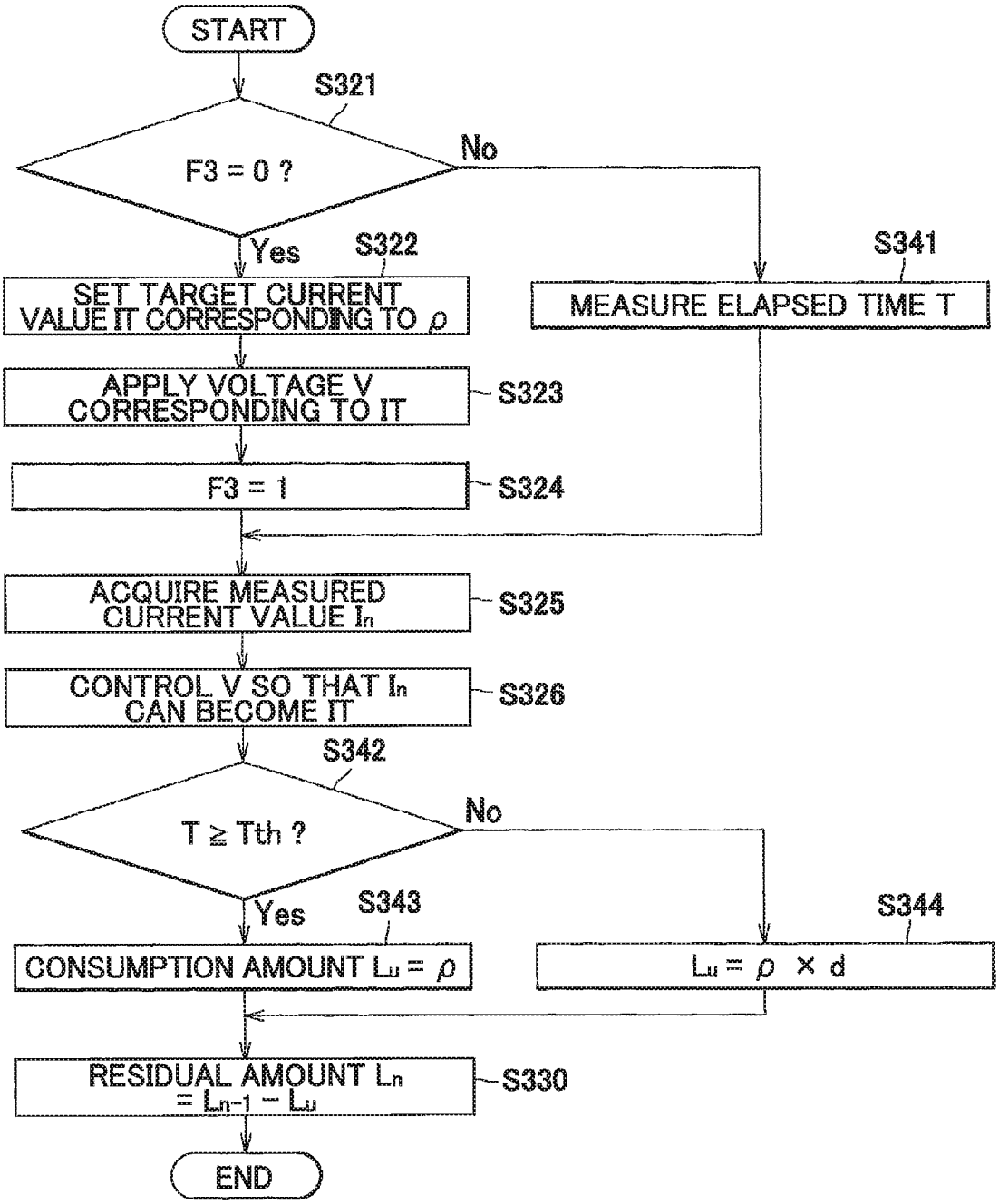
FIG. 51 is a flowchart illustrating a residual amount calculating process according to a first modification to the fourth embodiment.

In the above-described fourth embodiment, whether the spraying has become stable is determined on the basis of the measured current value $I_n$. The present invention, however, is not limited to this. For example, whether the spraying has become stable may be determined by determining whether the elapsed time period from the start of the application of the voltage to the first electrode 374 has reached a prescribed time period. Specifically, as illustrated in FIG. 51, a new step S341 of counting up an elapsed time period T may be provided between Step S321: No and Step S325 in the flowchart of FIG. 50, and Step S327 of FIG. 50 may be replaced with a new step S342 of determining whether the elapsed time period T is equal to or longer than a prescribed time period Tth. Note that, the prescribed time period Tth may be set as appropriate through experiments, simulations, or the like.

In the above modification, the application of the voltage V is started in Step S323; then the flag F3 is set to 1 in Step S324; then, in the next control cycle, Step S321 is determined as "No"; and then the counting up of the elapsed time period T is started in Step S341. After then, when the controller 300 determines in Step S342 that the relational expression T<Tth is satisfied (No), the controller 300 determines that the spraying has not become stable yet. On the other hand, when the controller 300 determines in Step S342 that relational expression T≥Tth is satisfied (Yes), the controller 300 determines that the spraying has become stable.

Here, the start of the counting up of the elapsed time period T is delayed from the start of the application of the voltage V by one control cycle. However, because the elapsed time period T calculated in this manner increases with the actual elapsed time period from the start of the application of the voltage V, the elapsed time period T can be treated as the time period which is substantially the same as the actual elapsed time period. In a case where the counting up of the elapsed time period T has already been started in the control cycles performed before this time, the counting up of the elapsed time period T is continued in S341.

In this manner, also in the case where the stable state of the spraying is determined by using the elapsed time period T from the start of the application of the voltage V, whether the spraying has become stable can be easily determined because the current flowing through the potential difference generating portion need not be monitored.

Further, the modification depicted in FIG. 51 is different from the above-described fourth embodiment in the method of calculating the consumption amount Lu of the fixing solution L. Specifically, in the modification of FIG. 51, new steps S343 and S344 are provided in place of the steps S328 and S329 of FIG. 50, respectively.

In Step S343, that is, in the first process, the controller 300 sets the consumption amount Lu to the target amount ρ of spray set in the third process (in the flowchart of FIG. 49) without changing the set target amount ρ. In other words, in Step S343, i.e., in the first process, the controller 300 estimates the consumption amount Lu to be the target amount ρ of spray set in the third process. In Step S344, the controller 300 sets the consumption amount Lu to a value obtained by multiplying the target amount ρ of spray set in the third process by a correction coefficient d which is smaller than 1. That is, the controller 300 sets the consumption amount Lu of the fixing solution L in the time period from when the spraying of the fixing solution L is started until when the spraying becomes stable, to a value smaller than the target amount ρ of spray.

Since, in the above modification, the target amount ρ of spray is used, as it is, as the consumption amount Lu when the spraying is stable (S342: Yes), the consumption amount Lu in the stable state can be easily calculated. In addition, since the consumption amount Lu in the time period during which the spraying is unstable is calculated by using a method different from that used in the stable time period, the consumption amount Lu in the unstable time period can be calculated with high accuracy.

Figure 52:
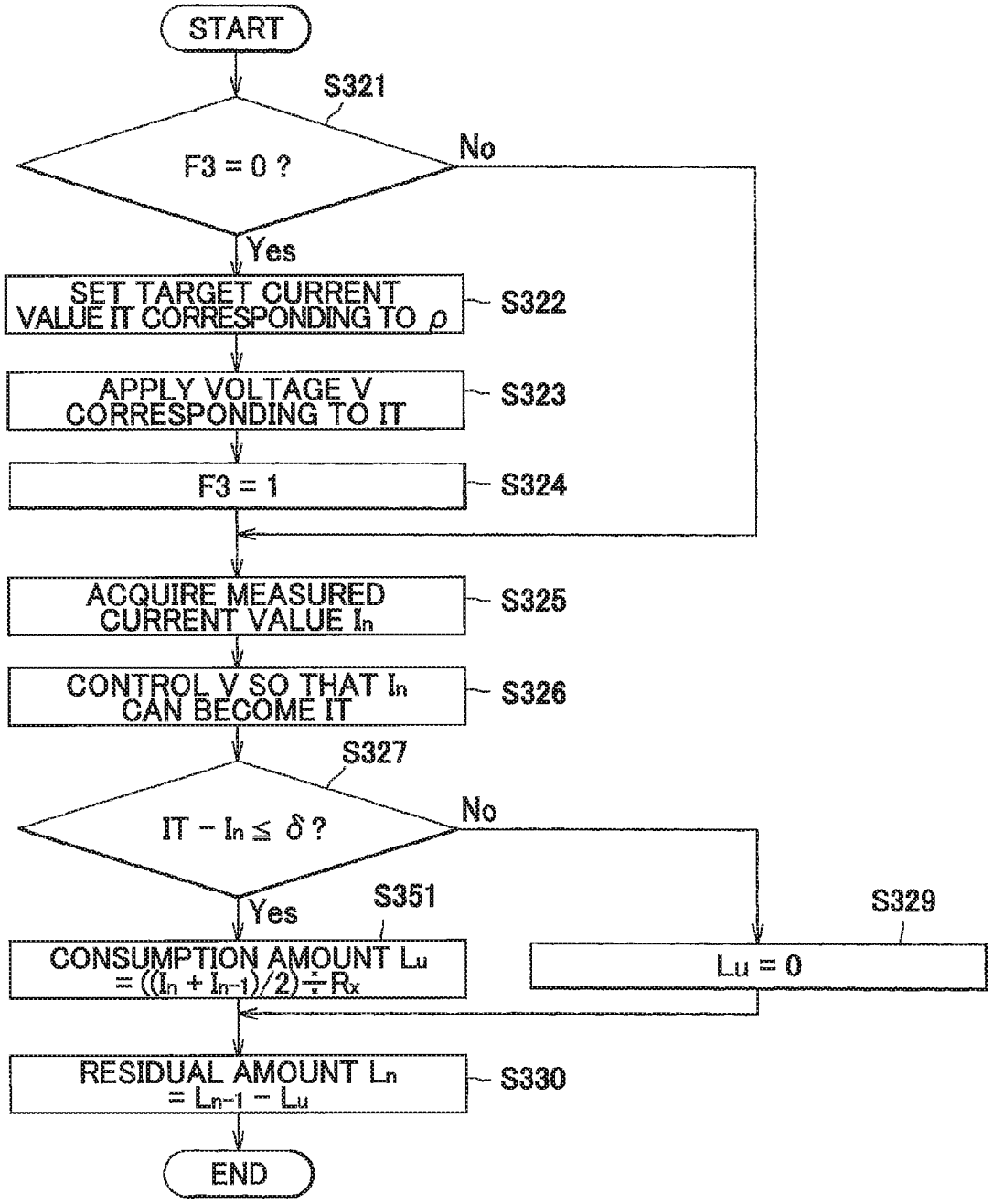
FIG. 52 is a flowchart illustrating a residual amount calculating process according to a second modification to the fourth embodiment.

In the above-described fourth embodiment, the consumption amount Lu is obtained by dividing the measured current value $I_n$ by the ratio Rx of charge to mass. The present invention, however, is not limited to this. A value obtained by dividing an average of a present value $I_n$ and a previous value of the measured current values by the ratio Rx of charge to mass may be used as the consumption amount Lu. Specifically, as illustrated in FIG. 52, Step S328 of FIG. 50 may be replaced with a new step S351 of setting the consumption amount Lu to the value obtained by dividing an average of a present value $I_n$ and a previous value of the measured current values by the ratio Rx of charge to mass.

In the above modification, since the consumption amount Lu is calculated in consideration of the ratio Rx of charge to mass which changes with humidity, the consumption amount Lu can be calculated with high accuracy.

In the above-described fourth embodiment, the ratio Rx of charge to mass is set on the basis of humidity. The present invention, however, is not limited to this. For example, the ratio Rx of charge to mass may be set on the basis of temperature which is detected by a temperature sensor, or may be set on the basis of both the temperature and the humidity. In these cases, a map indicating the relationship between the ratio Rx of charge to mass and the temperature, or a map indicating the relationship between the ratio Rx of charge to mass and both of the temperature and the humidity may be stored in the storage (not illustrated).

In the above-described fourth embodiment, the second electrode 372 is disposed so as to face the tip ends of the nozzles 3N of the fixing head 371. The present invention, however, is not limited to this. The second electrode 372 may be disposed so as not to face the tip ends of the nozzles 3N. That is, the second electrode 372 may be disposed so as to be shifted from the nozzles 3N in the conveyance direction. Even in this case, when the paper which is in contact with the second electrode faces the tip ends of the nozzles, a potential difference is generated between the fixing solution in the nozzles and the paper, thereby enabling the electrostatic spraying to be performed.

In the fourth embodiment, the present invention is applied to the laser printer 301. However, the present invention is not limited to this, and may be applied to other image forming devices, such as copiers and multifunction peripherals.

In the fourth embodiment, the paper P, such as thick paper, postcard, or thin paper, has been described as one example of recording sheet. However, the present invention is not limited to this, and the recording sheet may be, for example, a transparency film.

In the above-described fourth embodiment, since the control cycle is very short in time, the consumption amount Lu is calculated without consideration of this short time. The present invention, however, is not limited to this. The consumption amount may be calculated by multiplying a parameter (such as $I_n$) which is used to calculate the consumption amount, by the short time.

In the above-described embodiment and the modifications thereof, one process may be replaced, as appropriate, with another process having the same purpose as that of the one process. For example, the process of Step S329 may be executed instead of Step S344 of FIG. 51, and the process of Step S342 may be executed instead of Step S327 of FIG. 50. In Step S327, the current value is specified by measuring the current using the current sensor 3SA. The present invention, however, is not limited to this method. There may be stored a table indicating the relationship among the temperature, the humidity, and the current which flows during the spraying, and the current value $I_n$ may be specified by using the table.

The fourth object can be achieved by the fourth embodiment described with reference to FIGS. 46 to 52. The above-described fourth embodiment is one example of the embodiment of the fourth invention, and the fourth invention is not limited to this.

A laser printer 401 of a fifth embodiment of the present invention will be explained with reference to FIGS. 53-62. In the fifth embodiment, like parts and components are designated with the same reference numerals as the first embodiment to avoid duplicating description. A laser printer 401 includes a fixing device 407.

Figure 53:
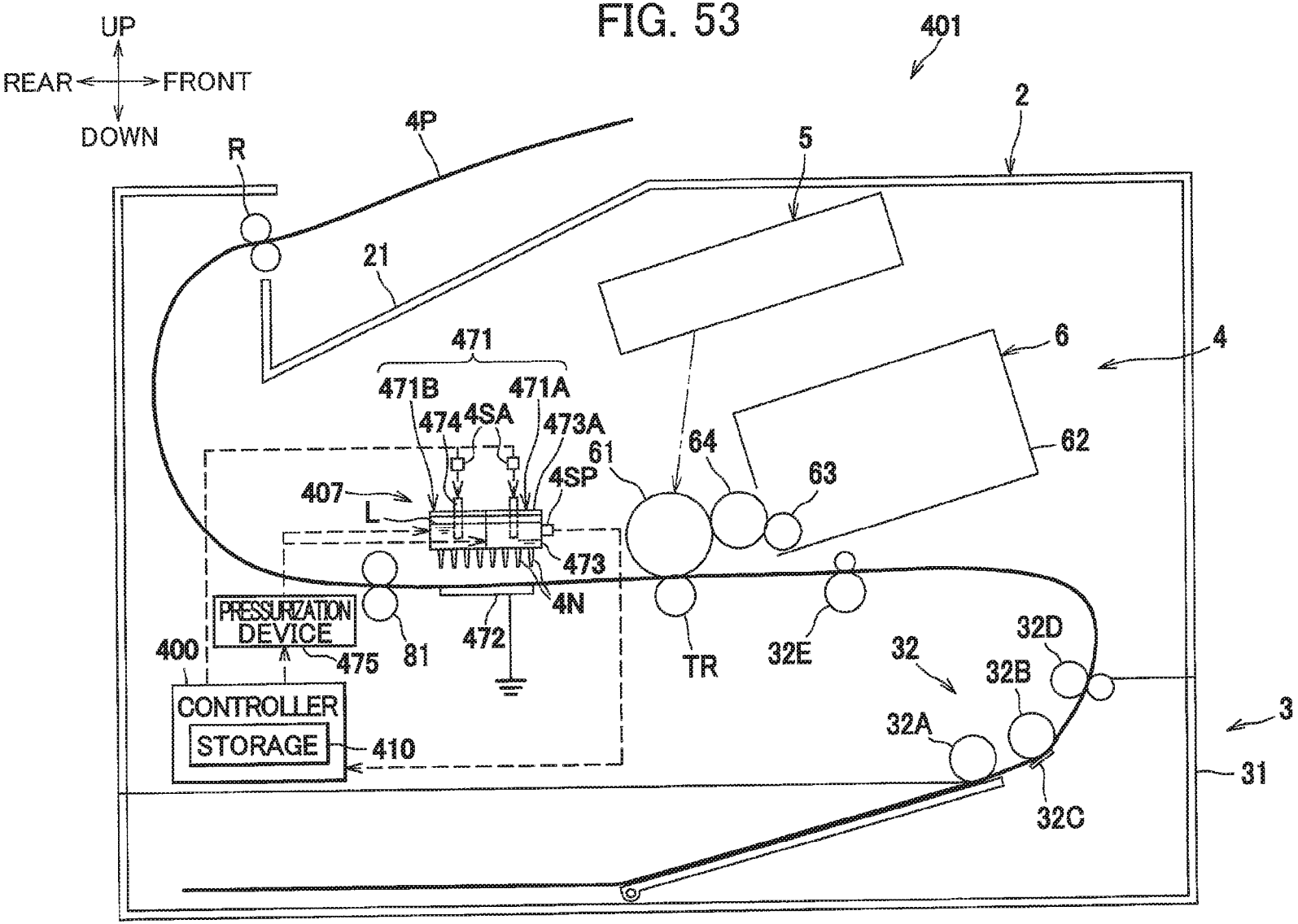
FIG. 53 is a view illustrating a laser printer according to a fifth embodiment of the present invention.

In the following description, directions are defined with respect to a position of a user using the laser printer. That is, the right side of FIG. 53 is defined as a front side, the left side of FIG. 53 is defined as a rear side, the far side of FIG. 53 is defined as a right side, and the near side of FIG. 53 is defined as a left side. The upward and downward directions of FIG. 53 are defined as an upward direction and a downward direction.

As illustrated in FIG. 53, the laser printer 401 has a casing 2, a feeder portion 3 configured to feed a paper 4P as an example of a recording sheet, an image forming section 4 configured to form an image onto the paper 4P, and a controller 400.

The feeder portion 3 has a paper feed tray 31 detachably attached to the lower portion of the casing 2 and a paper feed mechanism 32 that is configured to feed the paper 4P in the paper feed tray 31 toward the image forming section 4. The paper feed mechanism 32 has a feed roller 32A, a separation roller 32B, a separation pad 32C, a paper dust removal roller 32D, and a registration roller 32E. The registration roller 32E is configured to align the leading edge of the papers 4P and is appropriately stopped or rotated under the control of the controller 400.

The fixing device 407 is configured to supply a charged fixing solution L onto a toner image on the paper 4P by electrostatic spraying method to fix the toner image onto the paper 4P. The configuration of the fixing device 407 will be described later in detail.

A pair of downstream side conveyance rollers 81 is provided downstream of the fixing device 407. The pair of conveyance rollers 81 is configured to nip and convey the paper 4P discharged from the fixing device 407 to the downstream side. The paper 4P conveyed by the downstream side conveyance rollers 81 is then conveyed to a discharge roller R to be discharged onto a paper discharge tray 21.

Next, the configuration of the fixing device 407 will be described in detail.

The fixing device 407 has a fixing head 471 configured to spray the fixing solution L toward the toner image on the paper 4P and a second electrode 472 that is configured to support the paper 4P below the fixing head 471.

Figure 54A:
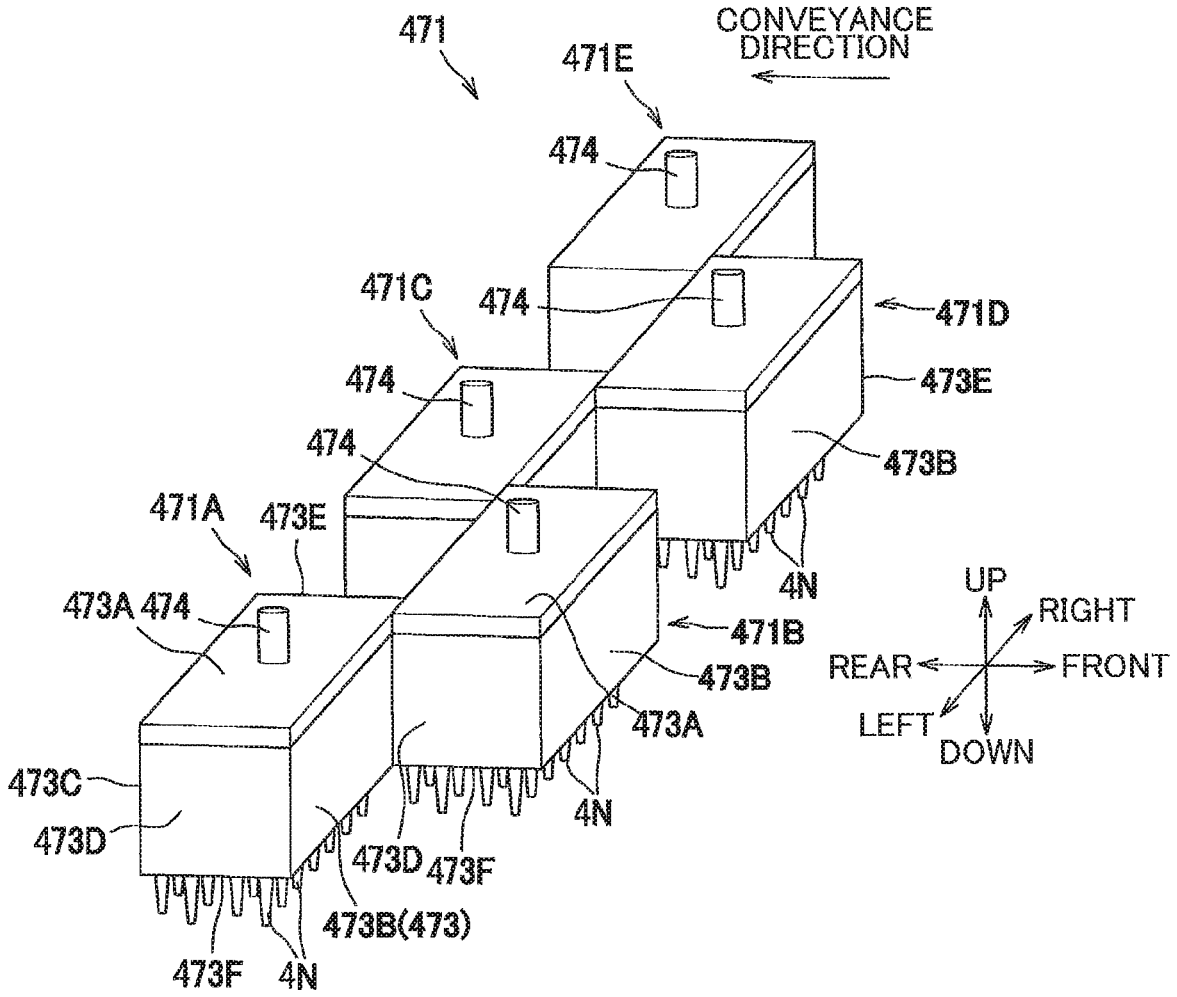
FIG. 54A is a perspective view of a fixing head as viewed from diagonally above.
Figure 54B:
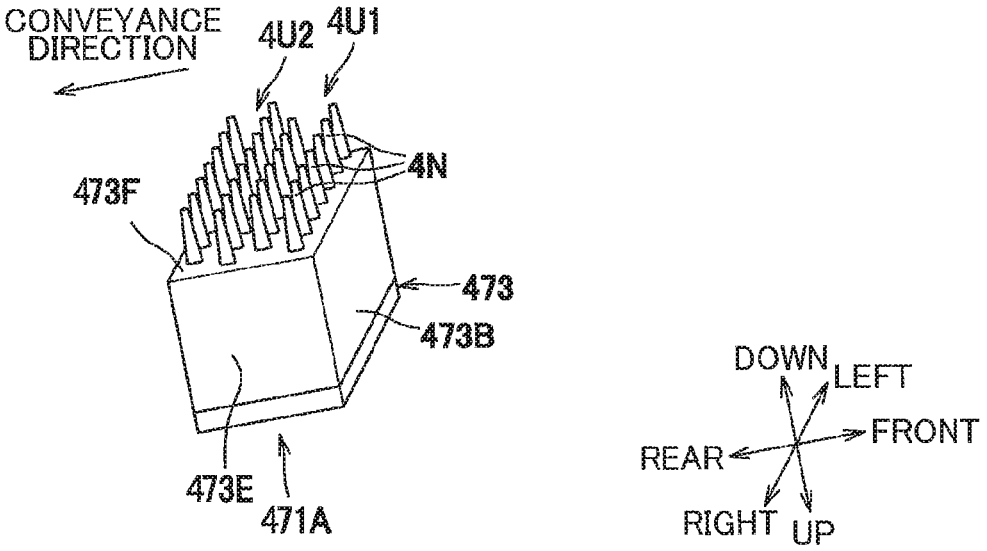
FIG. 54B is a perspective view of the fixing head as viewed from diagonally below.

As illustrated in FIG. 54A, the fixing head 471 has a first fixing head 471A, a second fixing head 471B, a third fixing head 471C, a fourth fixing head 471D, and a fifth fixing head 471E which are arranged in a staggered manner in the width direction of the paper 4P. The first fixing head 471A, the third fixing head 471C, and the fifth fixing head 471E are disposed at substantially the same position in the front-rear direction, i.e., in the conveyance direction of the paper 4P and disposed spaced apart from each other in the left-right direction, i.e., in the width direction of the paper 4P. The second fixing head 471B is disposed upstream of the first fixing head 471A and the third fixing head 471C in the conveyance direction such that the center of the second fixing head 471B in the width direction is located between the first fixing head 471A and the third fixing head 471C in the width direction. The fourth fixing head 471D is disposed upstream of the third fixing head 471C and the fifth fixing head 471E in the conveyance direction such that the center of the fourth fixing head 471E in the width direction is located between the third fixing head 471C and the fifth fixing head 471E in the width direction.

The first fixing head 471A has a container portion 473 that stores therein the fixing solution L, a plurality of nozzles 4N that communicates with the container portion 473 and is configured to spray the fixing solution L toward the toner image, and a first electrode 474 that is configured to apply a voltage to the fixing solution L in the container portion 473 and the nozzles 4N. The other fixing heads 471B to 471E have substantially the same configuration as the first fixing head 471A, so components of the other fixing heads 471B to 471E are designated with the same reference numerals as those of the first fixing head 471A, and description thereof is omitted.

The container portion 473 is an insulating container having a rectangular shape elongated in the width direction and has a top wall 473A, a front wall 473B, a rear wall 473C, a left wall 473D, a right wall 473E, and a bottom wall 473F. As illustrated in FIG. MB, the plurality of nozzles 4N in each of the fixing heads 471A-471E protrudes downward from the bottom wall 473F with their diameters gradually reduced as they extend downward. The plurality of nozzles 4N is arranged in both of the width and conveyance directions.

Figure 55:
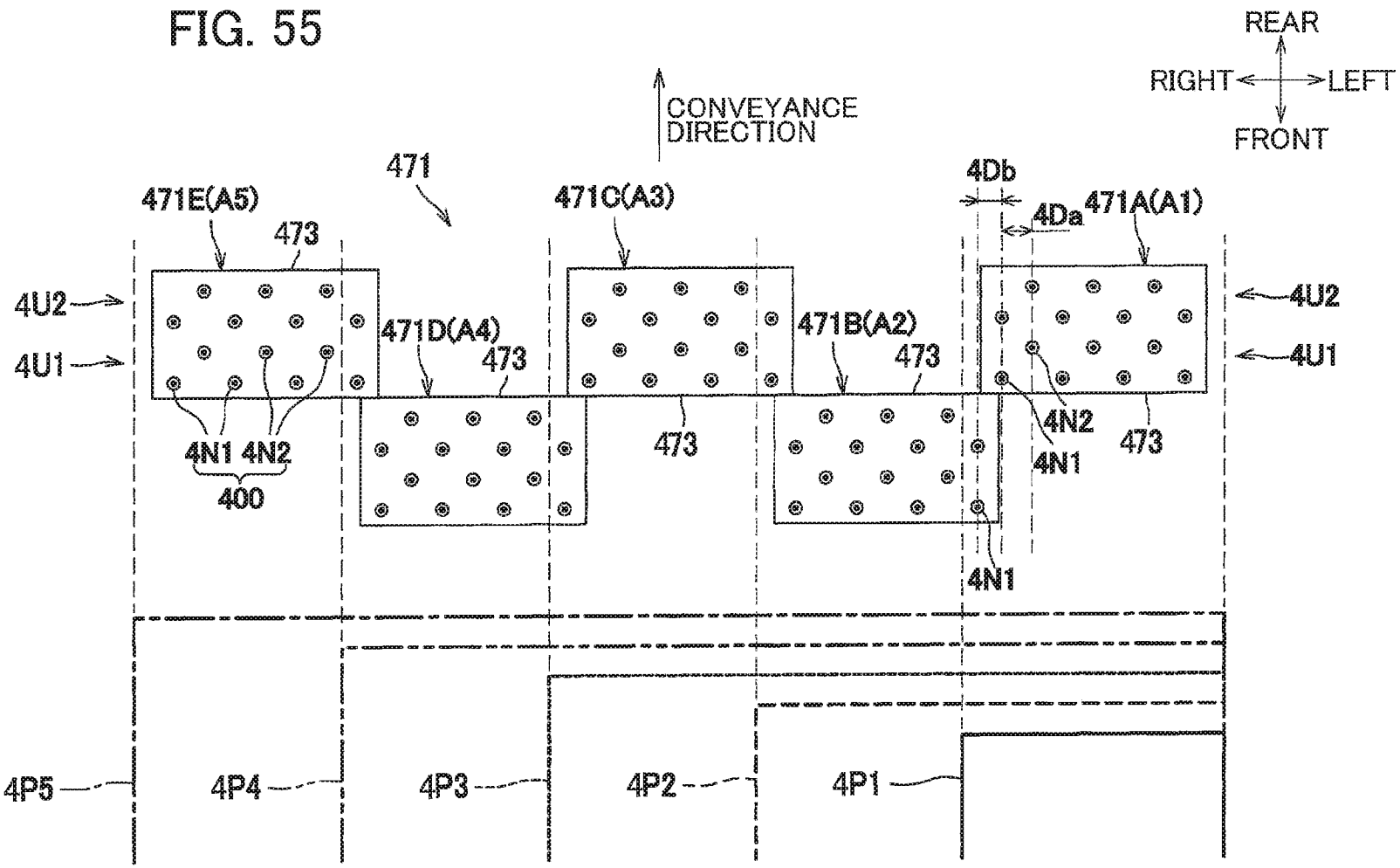
FIG. 55 is a bottom view of the fixing head.

Specifically, the plurality of nozzles 4N constitutes a first staggered array group 4U1 and a second staggered array group 4U2. The first staggered array group 4U1 and the second staggered array group 4U2 are arranged in the conveyance direction. As illustrated in FIG. 55, the first staggered array group 4U1 includes a plurality of first nozzles 4N1 arranged at regular intervals in the width direction and a plurality of second nozzles 4N2 arranged at regular intervals in the width direction. The first nozzles 4N1 and the second nozzles 4N2 are alternately arranged in the width direction with the first nozzles 4N1 disposed in one side with respect to the conveyance direction and with the second nozzles 4N2 disposed in the other side with respect to the conveyance direction.

Each second nozzle 4N2 is disposed between two first nozzles 4N1 in the width direction. A shape formed by connecting two first nozzles 4N1 adjacent to each other in the width direction and the second nozzle 4N2 disposed between the two first nozzles 4N1 is an equilateral triangle or an isosceles triangle. Similarly, a shape formed by connecting two second nozzles 4N2 adjacent to each other in the width direction and the first nozzle 4N1 disposed between the two second nozzles 4N2 is an equilateral triangle or an isosceles triangle.

The second staggered array group 4U2 has the same structure as that of the first staggered array group 4U1. In the present embodiment, a nozzle pitch (the shortest distance between the outer peripheries of the adjacent nozzles) may be set in a range equal to or larger than 1 mm and equal to or smaller than 14 mm.

Two fixing heads (e.g., first and second fixing heads 471A and 471B) adjacent to each other in the width direction are disposed such that the container portions 473 thereof overlap each other when viewed in the conveying direction. Specifically, the minimum pitch (e.g., pitch between the first nozzle 4N1 and the second nozzle 4N2) of the plurality of nozzles 4N in the width direction in a prescribed fixing head (e.g., the first fixing head 471A) is 4Da. On the other hand, a distance 4Db is smaller than the minimum pitch 4Da. Here, the distance 4Db is a distance from one nozzle 4N of a prescribed fixing head (e.g., the rightmost first nozzle 4N1 of the first fixing head 471A) to another nozzle 4N of another fixing head (e.g., the leftmost first nozzle 4N1 of the second fixing head 471B). Specifically, the width direction is a direction from one end side to the other end side, the one nozzle 4N is an end nozzle disposed at the one end side in the width direction among nozzles 4N in the prescribed fixing head. The another fixing head is disposed adjacent to the prescribed fixing head at the one end side of the prescribed fixing head in the width direction. The another nozzle 4N is an end nozzle disposed at the other end side in the width direction among nozzles 4N in the another fixing head.

Fixing regions A1-A5 are set for respective fixing heads 471A-471E. Each of the fixing regions A1-A5 is a region to which the nozzles of the corresponding one of the fixing heads 471A-471E spray the fixing solution L toward the paper P4. The fixing heads 471A-471E are disposed such that the fixing regions A1-A5 overlap one another when viewed in the conveyance direction. In the present embodiment, for descriptive convenience, it is assumed that the fixing regions A1-A5 of the respective fixing heads 471A-471E have the same in shape, size, and position as those of the lower surfaces of corresponding container portions 473.

More specifically, the first fixing region A1 overlaps the second fixing region A2 when viewed in the conveyance direction. Here, the fixing solution L is sprayed from the first fixing head 471A to the first fixing region A1 and the fixing solution L is sprayed from the second fixing head 471B to the second fixing region A2. Further, the fifth fixing region A5 overlaps the fourth fixing region A4 when viewed in the conveyance direction. Here, the fixing solution L is sprayed from the fifth fixing head 471E to the fifth fixing region A5 and the fixing solution L is sprayed from the fourth fixing head 471D to the fourth fixing region A4.

Further, the third fixing region A3 overlaps the second fixing region A2 and the fourth fixing region A4 when viewed in the conveyance direction. Here, the fixing solution L is sprayed from the third fixing head 471C to the third fixing region A3. The arrangement of the fixing heads 471A-471E described above can suppress occurrence of a region between any two of the fixing heads 471A-471E to which the fixing solution L is not sprayed.

The first fixing head 471A is a head for spraying the fixing solution L to a first paper 4P1 having the narrowest width among a plurality of types of the papers 4P on which the laser printer 401 can print images. The first fixing head 471A has a width smaller than the width of the first paper 4P1. The first fixing head 471A is disposed within a range between the left and right ends of the first paper 4P1 in the left-right direction. More specifically, the first fixing region A1 of the first fixing head 471A is formed so as to have a width equal to or larger than the width of an image formation region of the first paper 4P1 on which an image is to be formed. That is, the entire width of the image formation region falls within the width of the first fixing region A1.

In the present embodiment, as illustrated in FIG. 55, the papers 4P1 to 4P5 having different paper widths are conveyed with the left ends thereof set as a reference. Specifically, a guide member (not illustrated) is provided in the casing 2 and is configured to contact and guide the left end of each of the papers 4P1 to 4P5.

The second fixing head 471B is adjacent to the right side (one side in the width direction) of the first fixing head 471A and is disposed left side (the other side in the width direction) of the right end of the second paper 4P2 having a width larger than the width of the first paper 4P1. Specifically, the right end of the second fixing region A2 of the second fixing head 471B is disposed at the same position as or right side of the right end of the image formation region of the second paper 4P2. The left end of the image formation region of the second paper 4P2 substantially coincides with the left end of the image formation region of the first paper 4P1. With this arrangement, the combination of the first fixing head 471A and the second fixing head 471B can spray the fixing solution L to the image formation region of the second paper 4P2.

The third fixing head 471C is adjacent to the right side of the second fixing head 471B and is disposed left side of the right end of the third paper 4P3 having a width larger than the width of the second paper 4P2. Specifically, the right end of the third fixing region A3 of the third fixing head 471C is disposed at the same position as or right side of the right end of the image formation region of the third paper 4P3. The left end of the image formation region of the third paper 4P3 substantially coincides with the left end of the image formation region of the first paper 4P1. With this arrangement, the combination of the first fixing head 471A, the second fixing head 471B, and the third fixing head 471C can spray the fixing solution L to the image formation region of the third paper 4P3.

The fourth fixing head 471D is adjacent to the right side of the third fixing head 471C and is disposed left side of the right end of the fourth paper 4P4 having a width larger than the width of the third paper 4P3. Specifically, the right end of the fourth fixing region A4 of the fourth fixing head 471D is disposed at the same position as or right side of the right end of the image formation region of the fourth paper 4P4. The left end of the image formation region of the fourth paper 4P4 substantially coincides with the left end of the image formation region of the first paper 4P1. With this arrangement, the combination of the first to fourth fixing heads 471A to 471D can spray the fixing solution L to the image formation region of the fourth paper 4P4.

The fifth fixing head 471E is adjacent to the right side of the fourth fixing head 471D and is disposed left side of the right end of the fifth paper 4P5 having a width larger than the width of the fourth paper 4P4. Specifically, the right end of the fifth fixing region A5 of the fifth fixing head 471E is disposed at the same position as or right side of the right end of the image formation region of the fifth paper 4P5. The left end of the image formation region of the fifth paper 4P5 substantially coincides with the left end of the image formation region of the first paper 4P1. With this arrangement, the combination of the first to fifth fixing heads 471A-471E can spray the fixing solution L to the image formation region of the fifth paper 4P5.

Referring back to FIG. 53, the first electrode 474 is an electrode that applies a voltage to the fixing solution L in the container portion 473 to generate an electric field at the tip of each nozzle 4N. The first electrode 474 is provided so as to penetrate the top wall 473A of the container portion 473 from the top to the bottom of the top wall 473A. The lower end portion of the first electrode 474 is disposed in the fixing solution L in the container portion 473 and in contact with the fixing solution L, and the upper end portion thereof is connected to the controller 400 having a voltage applying portion (not illustrated). The voltage to be applied to the first electrode 474 is preferably in a range from 1 kV to 10 kV.

A pressurization device 475, which is an example of a pressure applying means, is connected to the fixing heads 471A-471E. The pressurization device 475 is a device that applies a pressure to the fixing solution L in the fixing heads 471A-471E. The pressurization device 475 has a pump that feeds the fixing solution L into the fixing heads 471A-471E so as to pressurize the fixing solution L and a reducing valve that releases the fixing solution L from the fixing heads 471A-471E so as to depressurize the fixing solution L. Further, each of the fixing heads 471A-471E has a pressure sensor 4SP (in FIG. 53, only one pressure sensor 4SP is illustrated as a representative example) that detects the pressure of the fixing solution L therein.

The second electrode 472 is an electrode that is configured to contact the paper 4P to form a potential difference between the fixing solution L in the nozzle 4N and the paper 4P and is disposed below the fixing heads 471A-471E so as to be separated from the tips of the nozzles 4N of the fixing heads 471A-471E by a prescribed distance. The prescribed distance is determined by experiments or simulations. Specifically, the prescribed distance is set to a value larger than the thickness of the paper 4P so that electrostatic spraying can be performed suitably.

An electric field is formed in a space around the tip of each nozzle 4N when a voltage is applied to the first electrode 474. Since the fixing solution L is supplied toward the tip of each nozzle 4N by the pressurization device 475, the second electrode 472 forms an electric field between the second electrode 472 and the fixing solution L in the tip of each nozzles 4N. Then, at the tip of each nozzle 4N, the fixing solution L is attracted by the electric field to form so-called Taylor cone. The fixing solution L is torn off from the tip of the Taylor cone, whereby a fine droplet is generated.

A current sensor 4SA is a sensor that detects a current flowing in the first electrode 474 to indirectly detect a current flowing in the fixing solution L and is provided corresponding to each first electrode 474. The current sensor 4SA detects a current flowing in the first electrode 474 when the fixing solution L is sprayed from the corresponding nozzles 4N to the paper 4P and outputs a detected value thereof to the controller 400. When the fixing solution L is not sprayed from the nozzle 4N, no current flows in the first electrode 474 even if a voltage is applied to the first electrode 474. A current flows in the first electrode 474 when the fixing solution L is sprayed from each nozzle 4N, in other words, when the charged fixing solution L is moved from each nozzle 4N to the paper 4P.

The first and second electrodes 474 and 472 having the above-configuration constitute a potential difference generating portion for generating a potential difference between the fixing solution L in the nozzles 4N and the paper 4P conveyed at a position separated from the nozzles 4N.

The controller 400 has a storage 410 including a RAM, a ROM, and the like, a CPU, and an input/output circuit and has a function to control the pressurization device 475 or to control a voltage to be applied to the first electrode 474 on the basis of image data inputted from an outside and signals from the sensors 4SP and 4SA.

Specifically, the controller 400 is configured to maintain a pressure applied to the fixing solution L in each of the fixing heads 471A-471E constant during print control on the basis of information from the pressure sensor 4SP. For example, in a state where no voltage is applied to the first electrode 474, the pressure to be applied to the fixing solution L can be set to a prescribed value so that the interface of the fixing solution L at the tip of the nozzle 4N with air is recessed to the fixing solution L side. When the pressure is low, the interface of the fixing solution L at the tip of the nozzle 4N has a substantially semi-spherical shape recessed to the fixing solution L side. As the pressure is gradually increased from this state, the semi-spherical interface is moved outward to gradually become close to a flat. When the pressure is further increased, the interface is moved further outward to be a substantially semi-spherical shape protruding outward. When the interface becomes close to a flat surface, the surface area thereof becomes minimum. The larger the surface area of the interface, the more easily the fixing solution L at the tip of the nozzle 4N is dried, and the higher the possibility that the tip of the nozzle 4N is clogged. Thus, the surface area of the interface is preferably small.

The controller 400 is configured to individually control voltages to be applied to the fixing solution L in the fixing heads 471A-471E. Specifically, in a standby state, the controller 400 sets a voltage V to be applied to the first electrode 474 of each of the fixing heads 471A-471E to a first voltage V41 at which the fixing solution L is not sprayed from the nozzle 4N. During print control, the controller 400 sets the voltage V to a second voltage V42 higher than the first voltage V41 for each of the fixing heads 471A-471E at a prescribed timing before the leading end of the paper 4P reaches a corresponding one of the fixing regions A1-A5. In other words, the controller 400 sets the voltage V to a second voltage V42 higher than the first voltage V41 for each of the fixing heads 471A-471E when the leading end of the paper 4P reaches a first position separated upstream from a corresponding one of the fixing regions A1-A5 by a prescribed first distance 4D1 (see FIGS. 61B and 61C), that is, when the distance from the leading end of the paper 4P to the corresponding one of the fixing regions A1-A5 is the first distance 4D1.

The first voltage V41 can be set to a voltage value larger than 0. When the pressure is set to the above-mentioned prescribed value, the first voltage V41 can be set to a voltage value at which the surface area of the interface between air and the fixing solution L at the tip of the nozzle 4N formed by voltage application is a value (e.g., minimum value) smaller than the maximum value. Further, the second voltage V42 can be set to a voltage value so that spraying can be performed but an amount of spray cannot reach a desired value.

Specifically, in a standby state, the controller 400 calculates a relational expression between a current flowing in the second electrode 472 and a voltage applied to the first electrode 474 and determines the second voltage V42 based on the relational expression. More specifically, as illustrated in FIG. 56, in a standby state, the controller 400 first controls the voltage V applied to each first electrode 474 such that the value of the current detected by the current sensor 4SA becomes a first current value Ia4 and then stores a first measured voltage Va4 at which the detected current value becomes the first current value Ia4 together with the first current value Ia4.

Then, the controller 400 controls the voltage applied to each first electrode 474 such that the detected current value becomes a second current value Ib4 different from the first current value Ia4 and then stores a second measured voltage Vb4 at which the detected current value becomes the second current value Ib4 together with the second current value Ib4.

Figure 56:
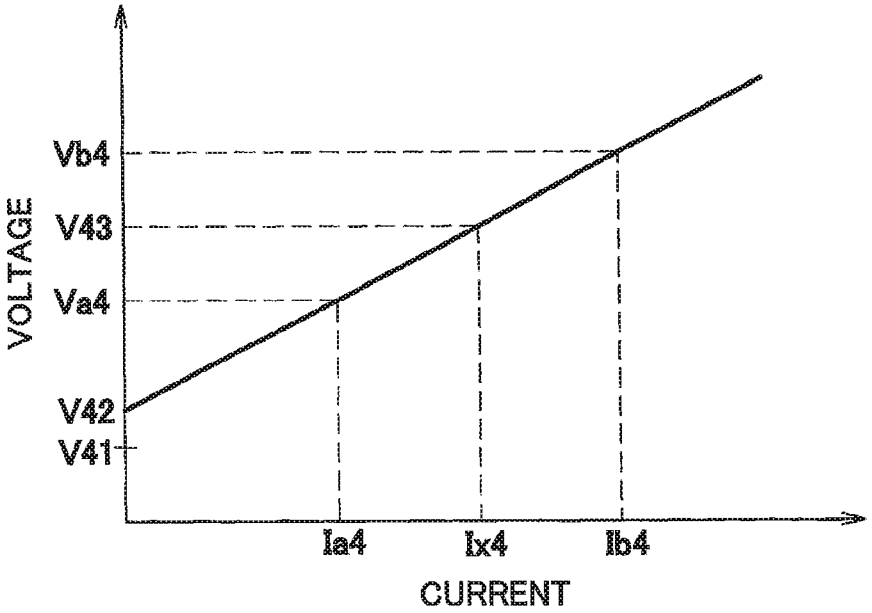
FIG. 56 is a view illustrating the relationship between electrical current flowing in a second electrode and an electrical voltage applied to a first electrode.

Thereafter, the controller 400 calculates a relational expression representing the relationship between the current and the voltage as illustrated in FIG. 56 on the basis of the measured voltages Va4, Vb4 and current values Ia4 and Ib4. Then, the controller 400 calculates a voltage (intercept) at which the current is 0. The calculated intercept voltage is set as the second voltage V42, and a value smaller than the second voltage V42 is set as the first voltage V41.

The controller 400 calculates the above relational expression when a prescribed condition is satisfied in a standby state. The prescribed condition may be any condition indicating that there may be a change in environment such as temperature. For example, the prescribed condition may be a condition that a prescribed specified time period elapses from the end of the previous print control, a condition that a difference between a temperature detected by a temperature sensor (not illustrated) and a temperature detected at a time when the relational expression was previously calculated is equal to or larger than a prescribed value, a condition that a fixing-solution cartridge (not illustrated) that supplies the fixing solution L to the fixing head 471 is exchanged, and the like.

The prescribed timing when the voltage V is switched from the first voltage V41 to the second voltage V42 is set to a timing after the leading end of the paper 4P passes between the photosensitive drum 61 and the transfer roller TR. The prescribed timing refers to the time when a prescribed first time period (time period corresponding to the paper 4P) elapses from the time set as a prescribed starting point. The time set as a starting point may be the time when paper feeding by the feed roller 232A is started, the time when once stopped conveyance of the paper 4P is resumed by the registration roller 232E, or the time when passage of the leading end of the paper 4P is detected by a paper sensor (not illustrated) disposed upstream of the fixing device 207 and downstream of the registration roller 232E.

Further, the prescribed timing depends on the conveyance speed of the paper 4P and a distance from an initial position (e.g., position of the paper sensor) set as the prescribed starting point to the above-mentioned first position. So, when the conveyance speed is changed for example, the prescribed timing may be appropriately changed depending on the conveyance speed. Specifically, the above-mentioned first time period may be calculated by (distance/conveyance speed). Hereinafter, a plurality of prescribed timings when the voltage V is switched from the first voltage V41 to the second voltage V42 is referred to as "plurality of first times t401".

Further, the controller 400 is configured to set the voltage V to a third voltage V43 before a toner image on the paper 4P (hereinafter, referred to simply as "image") reaches each of the fixing regions A1-A5. Here, the third voltage V43 is higher than the second voltage V42 and enables to fixe toner. In other words, for each of the fixing heads 471A-471E, the controller 400 sets the voltage V to the third voltage V43 higher than the second voltage V42 when the image reaches a second position separated upstream from a corresponding one of the fixing regions A1-A5 by a prescribed second distance 4D2 (smaller than the first distance 4D1: see FIGS. 61D and 61E), that is, when the distance from the image to the corresponding one of the fixing regions A1-A5 becomes the second distance 4D2.

The third voltage V43 is set to a voltage value large enough to spray the amount of fixing solution L required for fixing the image. Thus, the controller 400 first sets a target supply amount of the fixing solution L according to image density for example, and then sets a target current value Ix4 according to the set target supply amount as illustrated in FIG. 56. Then, the controller 400 sets the third voltage V43 on the basis of the target current value Ix4 and the relational expression of FIG. 56.

The timing before each image reaches each of the fixing regions A1-A5 is the time when a prescribed second time period (time period corresponding to each image and each of the fixing regions A1-A5) elapses from the time set as the prescribed starting point as described above. Hereinafter, a plurality of timings when the voltage V is switched from the second voltage V42 to the third voltage V43 is referred to as "plurality of second times t402".

Further, in a case where a plurality of images (images in the width of each of the fixing regions A1-A5) corresponding to each of the fixing regions A1-A5 is separated from one another in the conveyance direction on a prescribed paper 4P and where the distance between two images included in the plurality of images is larger than a third distance 4D3 (see FIG. 60) which is short to some extent, the controller 400 switches the voltage V from the third voltage V43 to the second voltage V42 after the downstream one of the two images is moved past the fixing region. That is, as illustrated in, e.g., FIG. 60, when determining that the distance between two images 4G2 and 4G3 corresponding to the first fixing region A1 is larger than the third distance 4D3, the controller 400 switches the voltage V from the third voltage V43 to the second voltage V42 after the downstream-side second image 4G2 is moved past the first fixing region A1. In other words, when the time period from a time when the second image 4G2 is moved past the first fixing region A1 to a time when the subsequent image 4G3 reaches the first fixing region A1 is equal to or larger than a first threshold value, the controller 400 switches the voltage V from the third voltage V43 to the second voltage V42.

The first threshold value can be experimentally calculated and is set to the time period from a time when the control of switching the voltage applied to the first electrode 474 from the third voltage V43 to the second voltage V42 is started to a time when the voltage is stabilized at the second voltage V42. The distance 4D3 can be calculated from the conveyance speed of the paper and the first threshold value.

Further, in a case where the images corresponding to each of the fixing regions A1-A5 are separated from one another in the conveyance direction on a prescribed paper 4P and where the distance between two images included in the plurality of images is equal to or smaller than the third distance 4D3 (see FIG. 60) which is short to some extent, the controller 400 recognizes the two images as one image. That is, as illustrated in, e.g., FIG. 60, when determining that the distance between two images 4G1 and 4G2 corresponding to the first fixing region A1 is equal to or smaller than the third distance 4D3, the controller 400 recognizes the two images 4G1 and 4G2 as one image and thus does not lower the voltage V but maintains the third voltage V43 while a region between the two images 4G1 and 4G2 is passing through the first fixing region A1. In other words, when the time period from a time when the image 4G1 is moved past the first fixing region A1 to a time when the subsequent second image 4G2 reaches the first fixing region A1 is smaller than a first threshold value, the controller 400 maintains the voltage V at the third voltage V43.

Further, when a most upstream image (e.g., 4G3) in the conveyance direction on a prescribed paper 4P is moved past the fixing region (e.g., A41), the controller 400 changes the voltage V from the third voltage V43 to the first voltage V41 or the second voltage V42. Specifically, in a case where the distance from the trailing end of the most upstream image 4G3 on a prescribed paper 4P to the leading end of the subsequent paper 4P is larger than a fourth distance 4D4, the controller 400 switches the voltage V from the third voltage V43 to the first voltage V41 after the most upstream image 4G3 is moved past the first fixing region A1. In other words, in a case where the time period from a time when the most upstream image 4G3 on a prescribed paper 4P is moved past the first fixing region A1 to a time when the leading end of the subsequent paper 4P reaches the first fixing region A1 is larger than a second threshold value, the controller 400 switches the voltage V from the third voltage V43 to the first voltage V41 after the most upstream image 4G3 is moved past the first fixing region A1.

The second threshold value can be experimentally calculated and is set to the time period from a time when the control of switching the voltage applied to the first electrode 474 from the third voltage V43 to the first voltage V41 is started to a time when the voltage is stabilized at the first voltage V41. The distance 4D4 can be calculated from the conveyance speed of the paper and the second threshold value.

Further, also in a case where the subsequent paper 4P does not exist for a most upstream image corresponding to a prescribed fixing region or where an image corresponding to the prescribed fixing region does not exist on the subsequent paper 4P, the controller 400 switches the voltage V from the third voltage V43 to the first voltage V41 after the most upstream image is moved past the fixing region. Specifically, in a case where an image corresponding to the first fixing region A1 does not exist on the subsequent paper 4P conveyed successively after a prescribed paper 4P on which the most upstream image 4G3 corresponding to the first fixing region A1 is formed, the controller 400 switches the voltage V from the third voltage V43 to the first voltage V41 after the image 4G3 is moved past the first fixing region A1.

In a case where a distance from each most upstream image to the leading end of the subsequent paper 4P is larger than the fourth distance 4D4, a case where the subsequent paper 4P does not exist, or a case where no image exists on the subsequent paper 4P for each most upstream image, the timing when the each most upstream image is moved past each of the fixing regions A1-A5 is a time when a prescribed fourth time period (time period corresponding to each image and each of the fixing regions A1-A5) elapses from the time set as the prescribed starting point. Hereinafter, a plurality of timings when the voltage V is switched from the third voltage V43 to the first voltage V41 is referred to as "plurality of fourth times t404".

Further, in a case where the distance from the trailing end of a most upstream fourth image 4G4 on a prescribed paper 4P to the leading end of the subsequent paper 4P is equal to or smaller than the fourth distance 4D4 for example, the controller 404 switches the voltage V from the third voltage V43 to second voltage V42 after the most upstream fourth image 4G4 is moved past the fifth fixing region A5. In other words, in a case where the time period from a time when the most upstream image 4G4 on a prescribed paper 4P is moved past the fifth fixing region A5 to a time when the leading end of the subsequent paper 4P reaches the fifth fixing region A5 is equal to or smaller than the second threshold value, the controller 400 switches the voltage V from the third voltage V43 to the second voltage V42 after the most upstream image 4G4 is moved past the fifth fixing region A5.

In a case where a distance from each most upstream image to the leading end of the subsequent paper 4P is equal to or lower than the fourth distance 4D4, the timing when each most upstream image is moved past a corresponding one of the fixing regions A1-A5 is the time when a prescribed third time period (time period corresponding to each image and each of the fixing regions A1-A5) elapses from the time set as the prescribed starting point. Hereinafter, a plurality of timings when the voltage V is switched from the third voltage V43 to the second voltage V42 is referred to as "plurality of third times t403".

Figure 60:
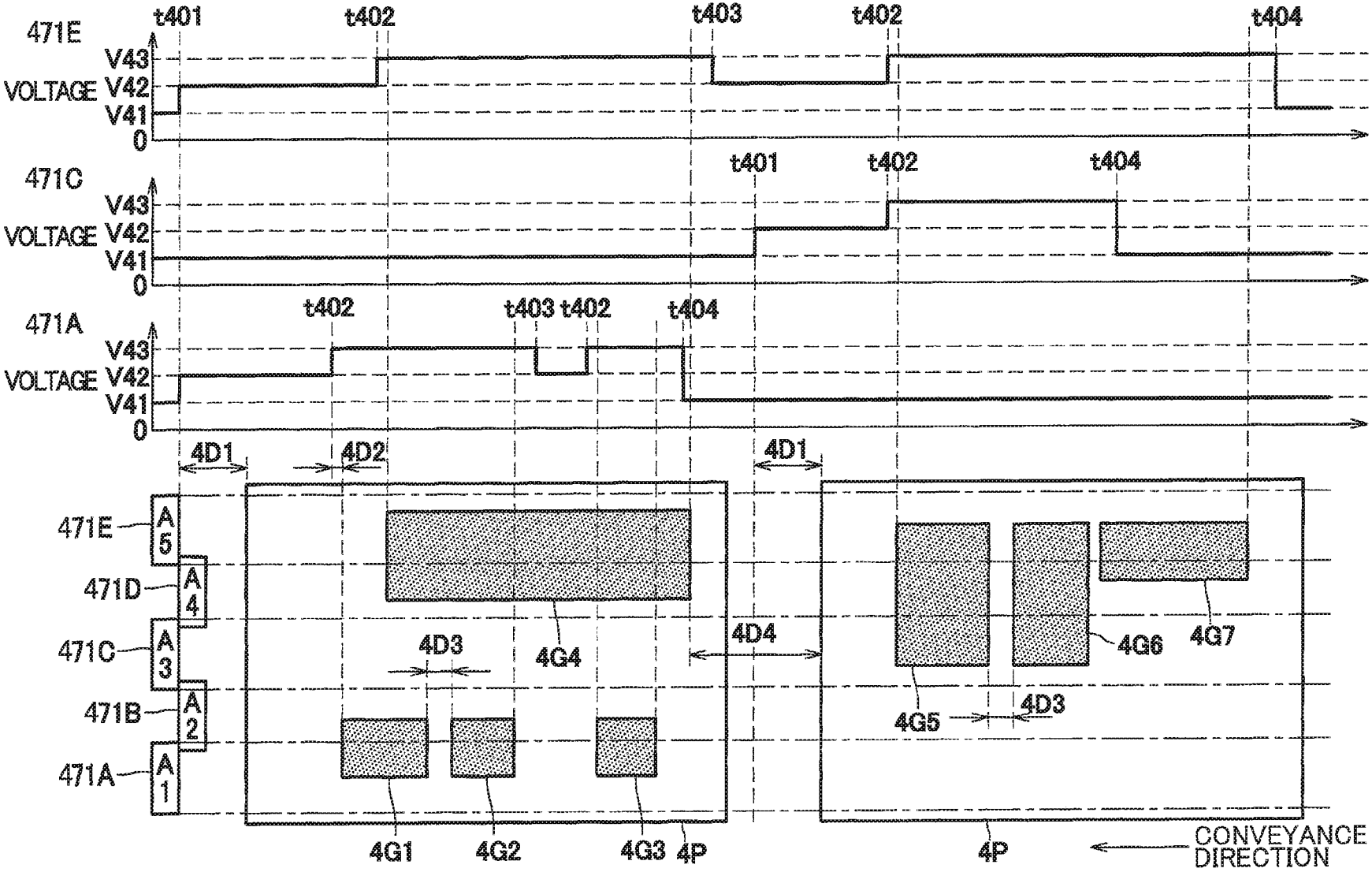
FIG. 60 is a timing chart showing timings at which voltage applied to each of a first fixing head, a third fixing head, and a fifth fixing head is altered, where the timings are shown in association with a position of a leading end of sheets or a position of each image.

Further, in a case where it is determined that no image exists in a prescribed region corresponding to a prescribed fixing region (e.g., A3) in the image formation region of a prescribed paper 4P, the controller 400 maintains the voltage V applied to the fixing solution L in a prescribed fixing head (e.g., 471C) corresponding to the prescribed region at the first voltage V41 after the first time t401 and during the time period while the prescribed paper 4P is passing through a fixing region corresponding to the prescribed fixing head. That is, since no image exists within the width of the third fixing region A3 in the image formation region of the paper 4P illustrated on the left side in FIG. 60, the controller 400 does not set the first time t401 (i.e., timing when the voltage V is switched from the first voltage V41 to the second voltage V42) for the third fixing head 471C. Thus, during the time period while the left side paper 4P of FIG. 60 is passing through the third fixing region A3, the voltage V applied to the third fixing head 471C is maintained at the first voltage V41.

The above-mentioned distances 4D1-4D4, times t401-t4404, and voltages V41-V43 are appropriately set by experiments or simulations.

Figure 57:
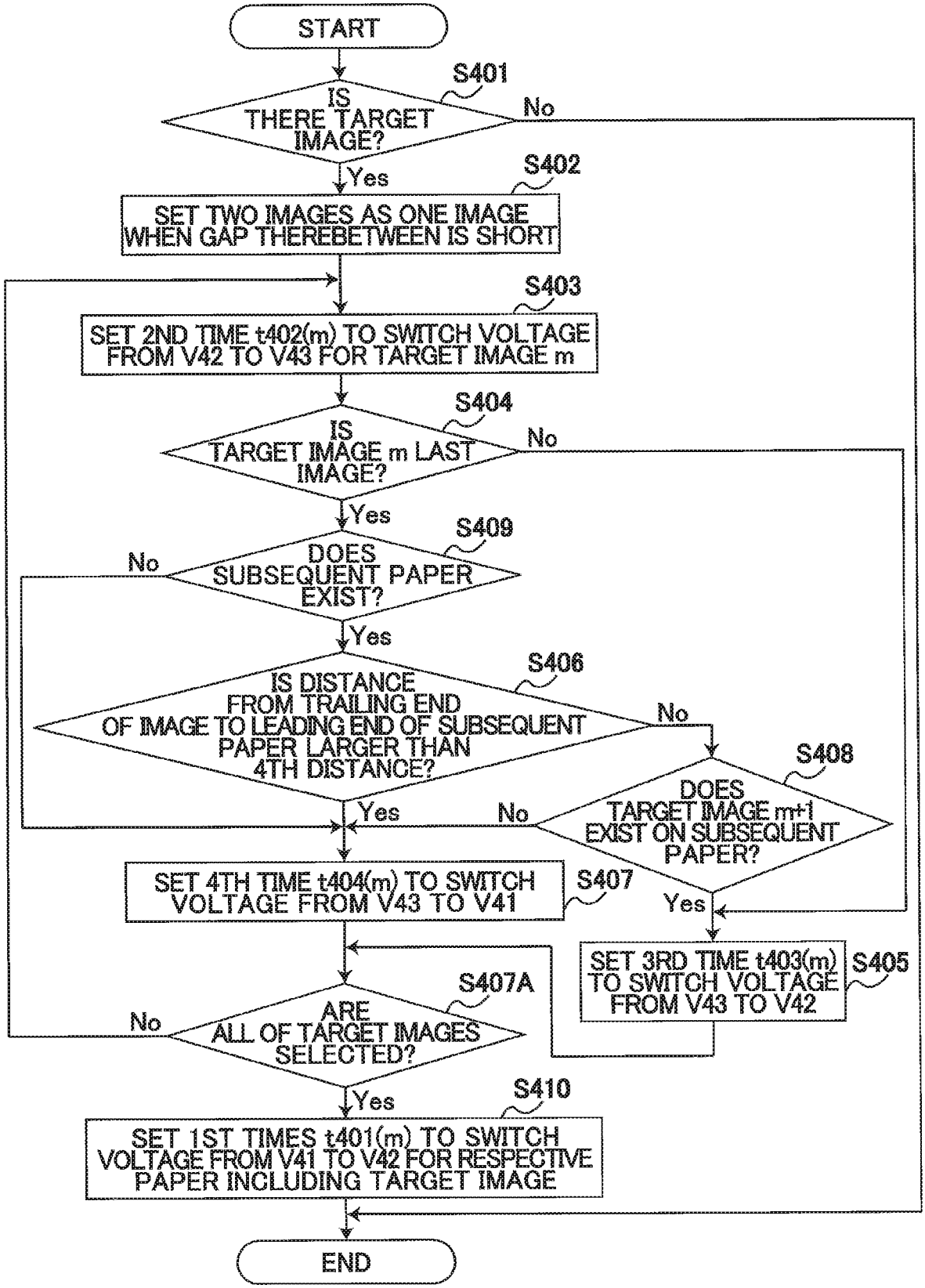
FIG. 57 is a flowchart illustrating a process for setting each time in a preparation state.
Figure 58:
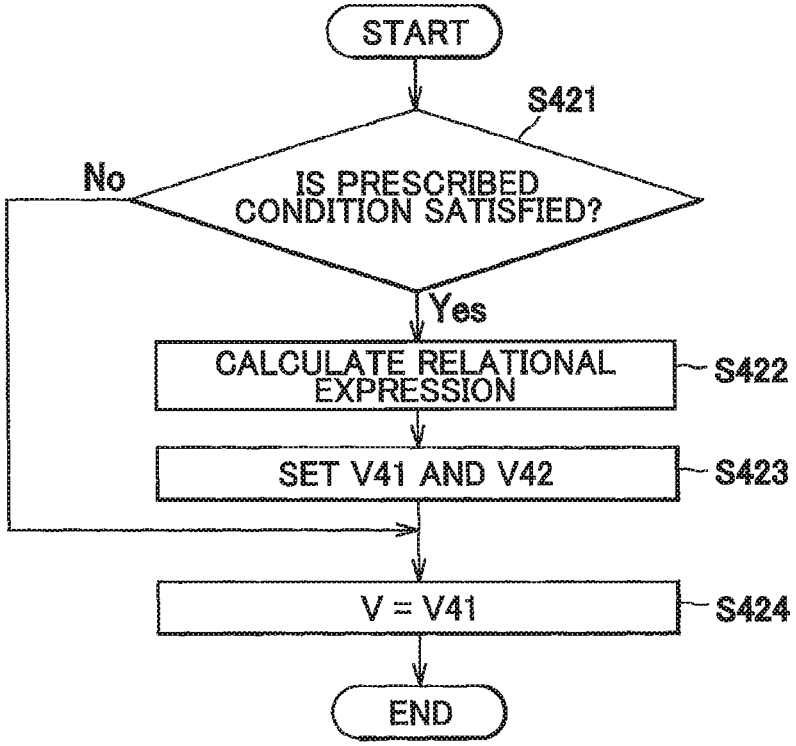
FIG. 58 is a flowchart illustrating voltage control in a standby state.
Figure 59:
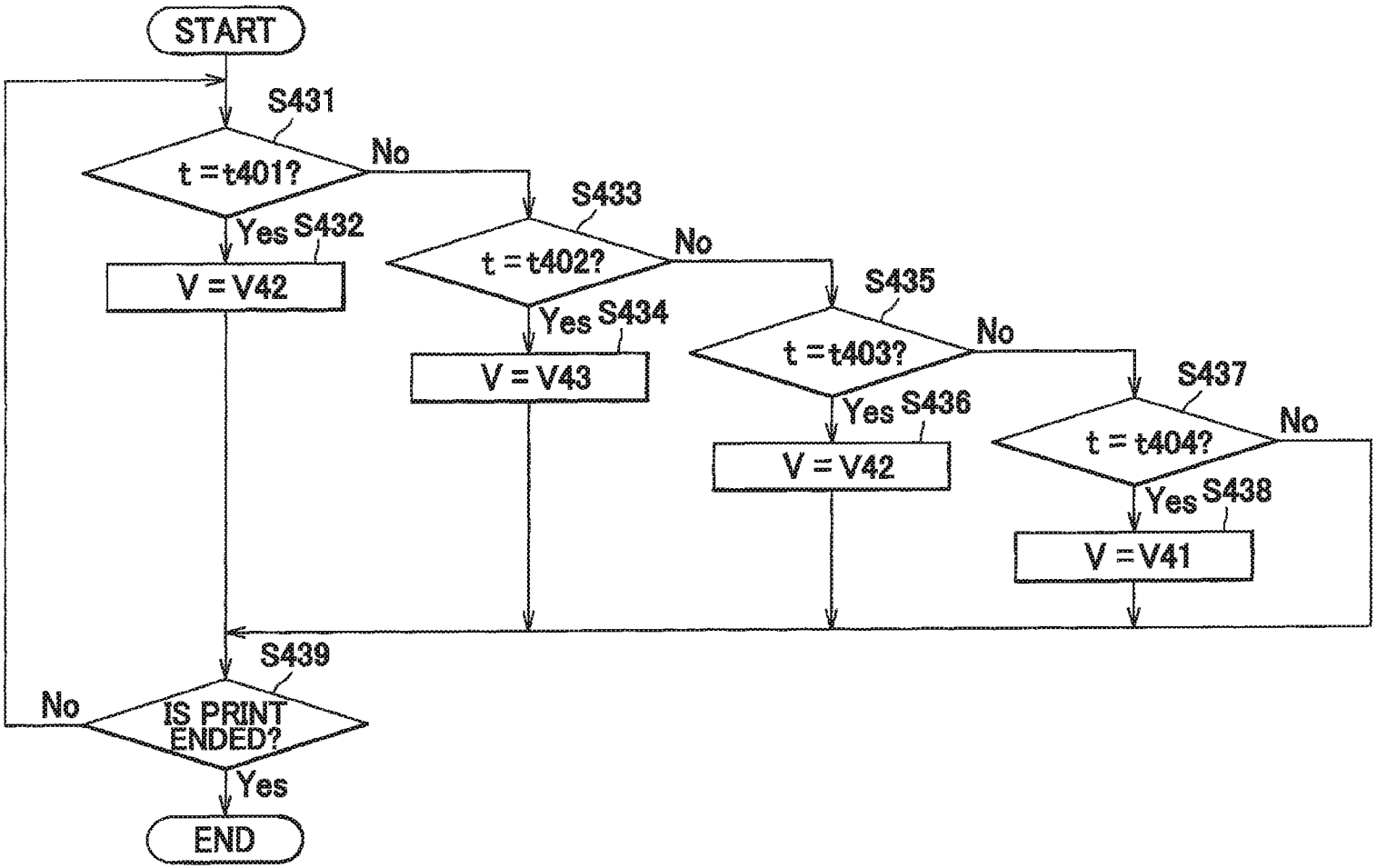
FIG. 59 is a flowchart illustrating voltage control in print control.

The following describes in detail the operation of the controller 400. The controller 400 executes the flowcharts illustrated in FIGS. 57 to 59 for each of the fixing heads 471A-471E. Hereinafter, control for the first fixing head 471A will be described as a representative example. The flowchart shown in FIG. 57 illustrates the process for setting the times t401 to t404 in a preparation state immediately before the execution of fixing control. The flowchart shown in FIG. 58 illustrates voltage control in a standby state. The flowchart shown in FIG. 59 illustrates voltage control during print control. The flowchart shown in FIG. 58 is repeatedly executed in a standby state, and the flowchart shown in FIG. 59 is executed repeatedly during print control.

The fixing control is a control executed during the time period from a time when spraying of the fixing solution L is started for an image on the first paper 4P in a print instruction to a time when spraying for the last paper 4P is ended. The preparation state is a state between the time when a print instruction is received and the time when spraying for an image on the first paper 4P is started. The standby state is a state where the laser printer 401 is powered ON and where no print instruction is received.

As illustrated in FIG. 57, the controller 400 receives a print instruction in the standby state (START) and then determines based on print data whether any image (hereinafter, referred to also as "target image") corresponding to the first fixing head 471A exists (S401). When determining in step S401 that no target image exists (No), the controller 400 ends this routine.

When determining in step S401 that a target image exists (Yes), the controller 400 sets two target images as one target image in a case where a gap between the two target images is equal to or smaller than the third distance 4D3, that is, the gap between the two target images is small (S402). In S402, the controller selects one target image m from among the 1st to k-th target images. Hereinafter, the number of the target images set in step S402 is assumed to be k, and the selected target image m among the 1st to k-th target images in S402 is simply referred to as "target image m".

After executing step S402, the controller 400 sets a second time t402, that is, the timing when the voltage V is switched from the second voltage V42 to the third voltage V43 for the target image m (S403). After executing step S403, the controller 400 determines whether the target image m is the last image, i.e., the most upstream image on the paper 4P (S404).

When determining in step S404 that the target image m is not the most upstream image (No), the controller 400 sets a third time t403, that is, the timing when the voltage V is switched from the third voltage V43 to the second voltage V42 for the target image m which is not the most upstream image (S405). That is, as a result of execution of steps S404: No S405, the voltage V is lowered from the third voltage V43 to the second voltage V42 after the target image m other than the most upstream image on the same paper 4P is moved past the first fixing region A1.

When determining in step S404 that the target image m is the most upstream image (Yes), the controller 400 determines whether the subsequent paper 4P exists for the most upstream target image m (S409). When determining in step S409 that the subsequent paper 4P does not exist for the most upstream target image m (No), the controller 400 shifts to step S407 and sets the fourth time t404 which is the timing when the voltage V is switched from the third voltage V43 to the first voltage V41 for the most upstream target image m, i.e., the last target image k. That is, as a result of execution of steps S409: No→S407, the voltage V is set back to the first voltage V41 set in the standby state when the target image m is the last target image k, that is, when spraying to the last target image k is finished.

When determining in step S409 that the subsequent paper 4P exists for the target image m (Yes), the controller 400 determines whether the distance from the trailing end of the most upstream target image m to the leading end of the subsequent paper 4P is larger than the fourth distance 4D4 (S406). When determining in step S406 that the distance is larger than the fourth distance 4D4 (Yes), the controller 400 sets a fourth time t404, that is, the timing when the voltage V is switched from the third voltage V43 to the first voltage V41 for the most upstream target image m (S407). That is, as a result of execution of steps S406: Yes→S407, the voltage V is lowered from the third voltage V43 to the first voltage V41 when the time period from a time when the most upstream target image m is moved past the first fixing region A1 to a time when the leading end of the subsequent paper 4P reaches the first position is comparatively long, whereby power consumption can be suppressed.

When determining in step S406 that the distance is equal to or smaller than the fourth distance 4D4 (No), the controller 400 determines whether a target image m+1 exists on the subsequent paper 4P for the corresponding most upstream target image m (S408). When determining in step S408 that the target image m+1 does not exist on the subsequent paper 4P (No), the controller 400 shifts to step S407 and sets the fourth time t404 for the most upstream target image m. That is, as a result of execution of steps S408: No→S407, the voltage V is maintained at the first voltage V41 during the time period from a time when the most upstream target image m is moved past the first fixing region A1 to at least until the subsequent paper 4P is moved past the first fixing region A1 in a case where the target image m+1 does not exist on the subsequent paper 4P, that is, a case where there is no need to spray the fixing solution L onto the subsequent paper 4P with the first fixing head 471A, whereby power consumption can be suppressed.

When determining in step S408 that the target image m+1 exists on the subsequent paper 4P (Yes), the controller 400 shifts to step S405 and sets the third time t403 for the target image m. That is, as a result of execution of steps S406: No→S408: Yes→S405, the voltage V is changed from the third voltage V43 to the second voltage V42 in a case where the distance from the trailing end of the most upstream target image m to the leading end of the subsequent paper 4P is small, that is, equal to or smaller than the fourth distance 4D4, thereby eliminating the need to switch the voltage V from the first voltage V41 to the second voltage V42 between successive papers (between a prescribed paper on which the target image m is formed and the subsequent paper).

When the voltage V is switched from the first voltage V41 to the second voltage V42, a phenomenon that the fixing solution L drops from the nozzle 4N as droplet may occur. Further, when the conveyance speed is increased in a case where the distance from the trailing end of the most upstream target image m to the leading end of the subsequent paper 4P is small, that is, equal to or smaller than the fourth distance 4D4, the time period from a time when the most upstream target image m is moved past the first fixing region A1 to a time when the leading end of the subsequent paper 4P reaches the first fixing region A1 may be significantly short. In this case, if the voltage V is set to the first voltage V41 after the target image m is moved past the first fixing region A1 and then switched from the first voltage V41 to the second voltage V42 between the successive papers, the fixing solution L dropping from the nozzle 4N may adhere to the subsequent paper 4P. On the other hand, when the voltage V is maintained at the second voltage V42 between successive papers in a case where the distance is small, that is, equal to or smaller than the fourth distance 4D4, dripping that may occur upon switching between the first voltage V41 and second voltage V42 can be prevented, thereby preventing the droplet-like fixing solution L from adhering to the paper 4P. After executing step S407 or S405, the controller 400 determines whether all of the 1st to k-th target images are selected as the target image m (S407A). If all of the 1st to k-th target images are selected as the target image m (YES), the controller 400 shifts to S410. If there is at least one image that has not been selected as the target image m among the 1st to k-th target images, in S407A the controller 400 selects one image that has not been selected as the target image as the target image m, and returns to step S403. In this case, steps starting from S403 are performed for the newly selected target image m.

After executing step S407A, the controller 400 sets a plurality of first times t401, that is, the timings when the voltage V is switched from the first voltage V41 to the second voltage V42 for respective papers 4P including the target image m (S410) and then ends this routine.

As illustrated in FIG. 58, when the laser printer 401 is powered ON (START), the controller 400 determines whether the prescribed condition is satisfied to thereby determine whether there is a possibility that any environmental change occurs (S421). When determining in S421 that the prescribed condition is satisfied, that is, there is a possibility that environmental change occurs (Yes), the controller 400 controls voltage V so as to make the current values become Ia4 and Ib4 to calculate the relational expression (S422), as illustrated in FIG. 56.

After executing step S422, the controller 400 sets the first voltage V41 and the second voltage V42 based on the relational expression. After executing step S423, or when determining "No" in step S421, the controller 400 sets the voltage V to the first voltage V41 (S424) and ends this routine. As a result, in the standby state, the voltage V is basically set to the first voltage V41.

As illustrated in FIG. 59, after receiving a print instruction (START), the controller 400 determines whether a time t based on a time set as the prescribed starting point as a reference, i.e., a time t counted up from the time set as the prescribed starting point is the first time t401 (S431). When determining in step S431 that t=t401 (Yes), the controller 400 sets the voltage V to the second voltage V42 (S432). Specifically, in step S432, the controller 400 increases the voltage from the first voltage V41 to the second voltage V42.

When determining in step S431 that t≠t401 (No), the controller 400 determines whether the time t is the second time t402 (S433). When determining in step S433 that t=t402 (Yes), the controller 400 sets the voltage V to the third voltage V43 (S434). Specifically, in step S434, the controller 400 increases the voltage V from the second voltage V42 to the third voltage V43.

When determining in step S433 that t≠t402 (No), the controller 400 determines whether the time t is the third time t403 (S435). When determining in step S435 that t=t403 (Yes), the controller 400 sets the voltage V to the second voltage V42 (S436). Specifically, in step S436, the controller 400 reduces the voltage V from the third voltage V43 to the second voltage V42.

When determining in step S435 that t≠t403 (No), the controller 400 determines whether the time t is the fourth time t404 (S437). When determining in step S437 that t=t404 (Yes), the controller 400 sets the voltage V to the first voltage V41 (S438). Specifically, in step S438, the controller 400 reduces the voltage V from the third voltage V43 to the first voltage V41.

When determining in step S437 that t≠t404 (No), or after executing step S432, step S434, step S436, or step S438, the controller 400 determines whether the print control is ended (S439). When determining in step S439 that the print control is not ended (No), the controller 400 returns to step S431. When determining in step S439 that the print control is ended (Yes), the controller 400 ends this routine.

The following describes an example of the control with reference to FIGS. 60 to 62.

FIG. 60 is a timing chart in which the time axis is made to correspond to the position of the paper and the image formed on the paper. In FIG. 60, control for the first fixing head 471A, the third fixing head 471C, and the fifth fixing head 471E is illustrated as a representative example. The control for the second fixing head 471B is substantially the same as that for the first fixing head 471A since the target images corresponding to the second fixing head 471B have the same sizes as and located at the same positions as the target images 4G1 to 4G3 corresponding to the first fixing head 471A. Similarly, the control for the fourth fixing head 471D is substantially the same as that for the fifth fixing head 471E since the target images corresponding to the fourth fixing head 471D have the same sizes as and located at the same positions as the target images 4G4 to 4G7 corresponding to the fifth fixing head 471E. Hereinafter, for descriptive convenience, the target images 4G1 to 4G7 are referred to also as a first image 4G1, a second image 4G2, a third image 4G3, a fourth image 4G4, a fifth image 4G5, a sixth image 4G6, and a seventh image 4G7, respectively.

First, with reference to FIG. 60, control for the first fixing head 471A will be described.

As illustrated in FIG. 60, at the first time t401 when the distance from the leading end of the first paper 4P in the print control to the first fixing region A1 is the first distance 4D1, the controller 400 increases the voltage V, which was set to the first voltage V41 in the standby state, to the second voltage V42. Then, at the second time t402 when the distance from the leading end of the first image 4G1 of the first paper 4P to the first fixing region A1 is the second distance 4D2, the controller 400 increases the voltage from the second voltage V42 to the third voltage V43.

The gap between the two images 4G1 and 4G2 is equal to or smaller than the third distance 4D3, so that the controller 400 maintains the voltage V at the third voltage V43 during the time period from a time when the leading end of the first image 4G1 reaches the first fixing region A1 to a time when the second image 4G2 is moved past the first fixing region A1. At the third time t403 when the second image 4G2 is moved past the first fixing region A1, the controller 400 reduces the voltage V from the third voltage V43 to the second voltage V42. Specifically, the second image 4G2 is not the most upstream image, so that the controller 400 reduces the voltage V from the third voltage V43 to the second voltage V42 after the trailing end of the second image 4G2 is moved past the first fixing region A1.

After that, similarly, at the second time t402 set for the most upstream third image 4G3, the controller 400 increases the voltage V from the second voltage V42 to the third voltage V43. At the fourth time t404 when the most upstream third image 4G3 is moved past the first fixing region A1, the controller 400 reduces the voltage V from the third voltage V43 to the first voltage V41. Specifically, since there is no image corresponding to the first fixing region A1 on a paper 4P following the first paper 4P on which the most upstream third image 4G3 is formed, the controller 400 reduces the voltage V from the third voltage V43 to the first voltage V41.

Next, control for the third fixing head 471C will be described.

Since there is no image corresponding to the third fixing head 471C on the first paper 4P, the controller 400 does not set the first time t401 for the first paper 4P. As a result, the controller 400 maintains the voltage V at the first voltage V41 set in the standby state even when the distance from the leading end of the first paper 4P to the third fixing region A3 is the first distance 4D1.

Since there exist the images 4G5 and 4G6 corresponding to the third fixing head 471C on the subsequent paper 4P, the controller 400 sets the first time t401 for the subsequent paper 4P. As a result, at the first time t401, the distance from the leading end of the subsequent paper 4P to the third fixing region A3 becomes the first distance 4D1, and then the controller 400 increases the voltage V from the first voltage V41 to the second voltage V42.

Thereafter, as in the control for the first fixing head 471A, the controller 400 increases the voltage V from the second voltage V42 to the third voltage V43 at the second time t402 and reduces the voltage V from the third voltage V43 to the first voltage V41 at the fourth time t404. Because the gap between the two images 4G5 and 4G6 is also equal to or smaller than the third distance 4D3, the controller 400 maintains the voltage V at the third voltage V43 while the gap between the images 4G5 and 4G6 is passing through the corresponding fixing region.

Finally, control for the fifth fixing head 471E will be described.

At the first time t401, the distance from the leading end of the first paper 4P to the fifth fixing region A5 is the first distance 4D1, and then the controller 400 increases the voltage V from the first voltage V41 set in the standby state to the second voltage V42. At the second time t402, the distance from the leading end of the fourth image 4G4 on the first paper 4P to the fifth fixing region A5 is the second distance 4D2, the controller 400 increases the voltage V from the second voltage V42 to the third voltage V43.

Because only the fourth image 4G4 on the first paper 4P corresponds to the fifth fixing region A5, the fourth image 4G4 is the most upstream image. The distance from the trailing end of the fourth image 4G4 to the leading end of the subsequent paper 4P is equal to or smaller than the fourth distance 4D4. Thus, at the third time t403 the fourth image 4G4 is moved past the fifth fixing region A5, and then the controller 400 reduces the voltage V from the third voltage V43, not to the first voltage V41, but to the second voltage V42.

As a result, the voltage V is maintained at the second voltage V42 during the time period from a time when the fourth image 4G4 on the first paper 4P is moved past the fifth fixing region A5 to a time when the fifth image 4G5 on the subsequent paper 4P reaches a position just before the fifth fixing region A5. Thereafter, as in the control for the first fixing head 471A, the controller 400 increases the voltage V from the second voltage V42 to the third voltage V43 at the second time t402 and reduces the voltage V from the third voltage V43 to first voltage V41 at the fourth time t404. The gap between the two images 4G5 and 4G6 is equal to or smaller than the third distance 4D3. The gap between the two images 4G6 and 4G7 is also equal to or smaller than the third distance 4D3. Thus, the controller 400 maintains the voltage V at the third voltage V43 while the gap between the images 4G5 and 4G6 and the gap between the images 4G6 and 4G7 are passing through the corresponding fixing region.

The following describes how the voltage V applied to the fixing heads 471A-471E is switched with reference to FIGS. 61A to 62F.

Figure 61A:
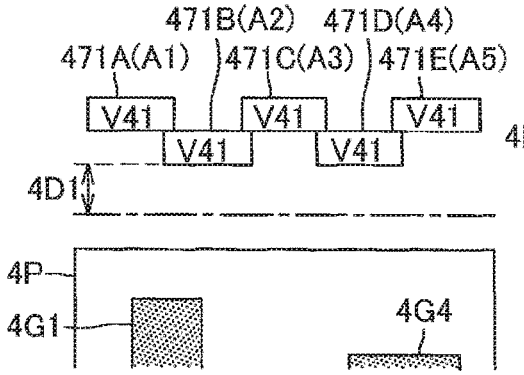
FIGS. 61A through 61H are views illustrating timings of altering voltage applied to each fixing head, and showing each state starting from a state where a leading sheet has not been reaches each fixing head to a state where a second image of the leading sheet is moved past the second fixing head.
Figure 61B:
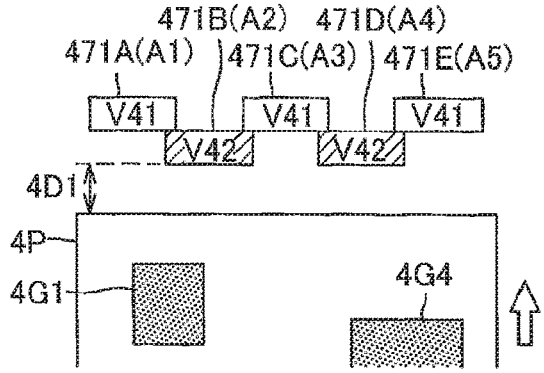

As illustrated in FIGS. 61A and 61B, when the leading end of the first paper 4P reaches a position separated upstream from the second fixing region A2 and fourth fixing region A4 by the first distance 4D1, voltages V applied to the respective second fixing head 471B and fourth fixing head 471D are switched from the first voltage V41 to the second voltage V42.

Figure 61C:
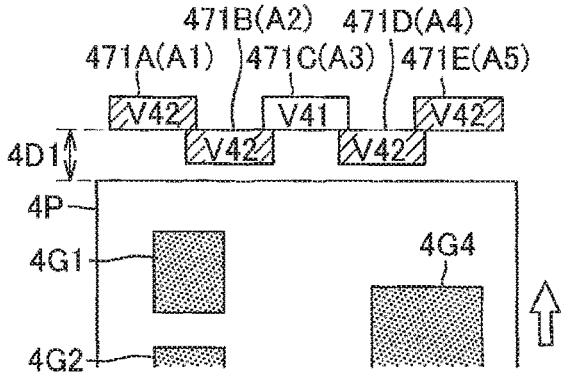

As illustrated in FIG. 61C, when the leading end of the first paper 4P reaches a position separated upstream from the first fixing region A1, the third fixing region A3, and the fifth fixing region A5 by the first distance 4D1, the voltages V applied to the respective first fixing head 471A and the fifth fixing head 471E are switched from the first voltage V41 to the second voltage V42. Since there exists no image corresponding to the third fixing head 471C, the voltage applied to the third fixing head 471C is maintained at the first voltage V41.

Figure 61D:
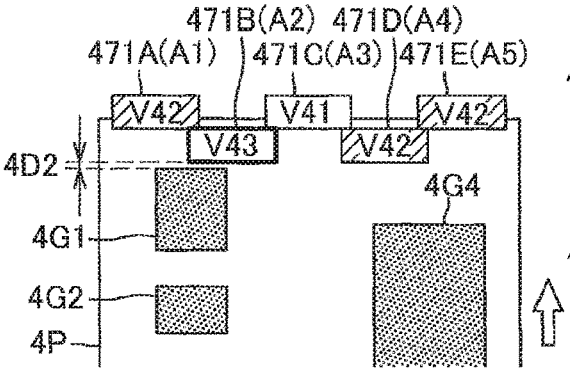
Figure 61E:
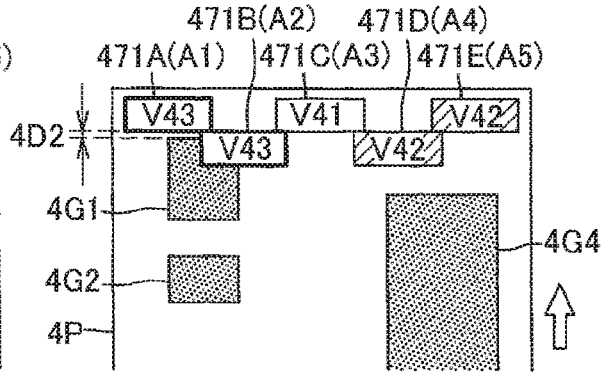

As illustrated in FIG. 61D, when the first image 4G1 corresponding to the second fixing head 471B reaches a position separated upstream from the second fixing region A2 by the second distance 4D2, the voltage V applied to the second fixing head 471B is switched from the second voltage V42 to the third voltage V43. As illustrated in FIG. 61E, when the first image 4G1 corresponding to the first fixing head 471A reaches a position separated upstream from the first fixing region A1 by the second distance 4D2, the voltage V applied to the first fixing head 471A is switched from the second voltage V42 to third voltage V43.

Figure 61F:
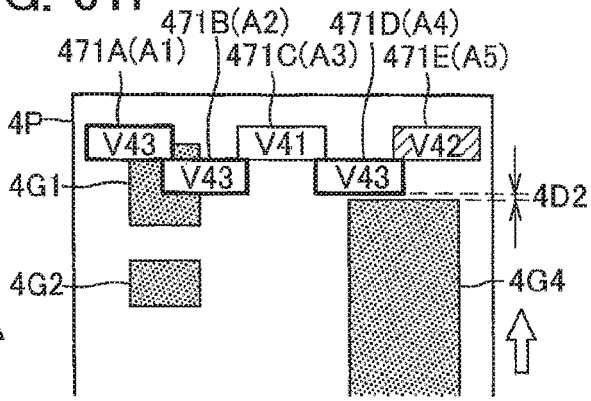
Figure 61G:
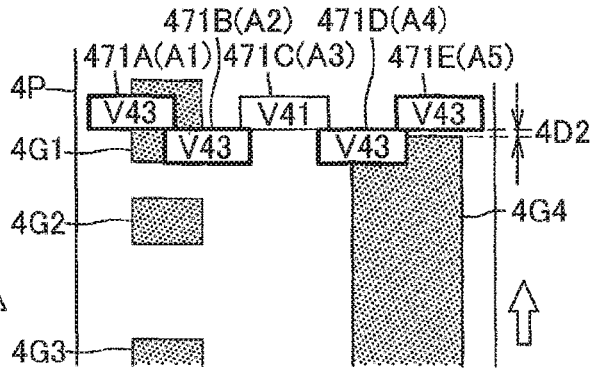

As illustrated in FIG. 61F, when the fourth image 4G4 corresponding to the fourth fixing head 471D reaches a position separated upstream from the fourth fixing region A4 by the second distance 4D2, the voltage V applied to the fourth fixing head 471D is switched from the second voltage V42 to the third voltage V43. As illustrated in FIG. 61G, when the fourth image 4G4 corresponding to the fifth fixing head 471E reaches a position separated upstream from the fifth fixing region A5 by the second distance 4D2, the voltage V applied to the fifth fixing head 471E is switched from the second voltage V42 to the third voltage V43.

Figure 61H:
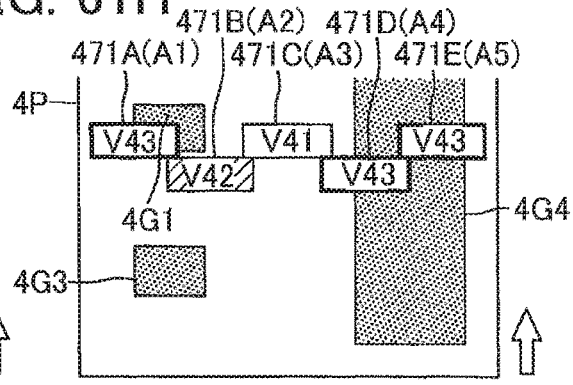
Figure 62A:
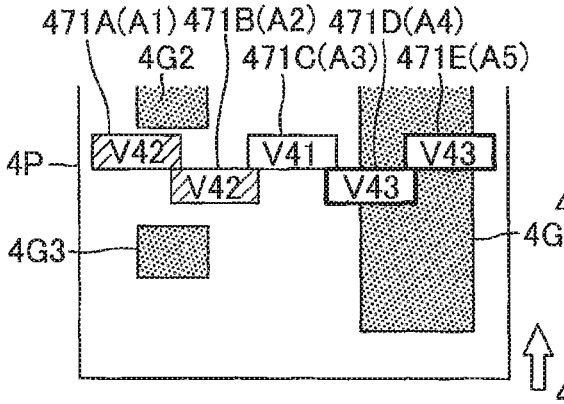
FIGS. 62A through 62F are views illustrating timings of altering voltage applied to each fixing head, and showing each state starting from a state where the second image is moved past the first head to a state where a fourth image is moved past a fifth fixing head.

As illustrated in FIG. 61H, when the second image 4G2 is moved past the second fixing region A2, the voltage applied to the second fixing head 471B is switched from the third voltage V43 to the second voltage V42. As illustrated in FIG. 62A, when the second image 4G2 is moved past the first fixing region A1, the voltage V applied to the first fixing head 471A is switched from the third voltage V43 to the second voltage V42.

Figure 62D:
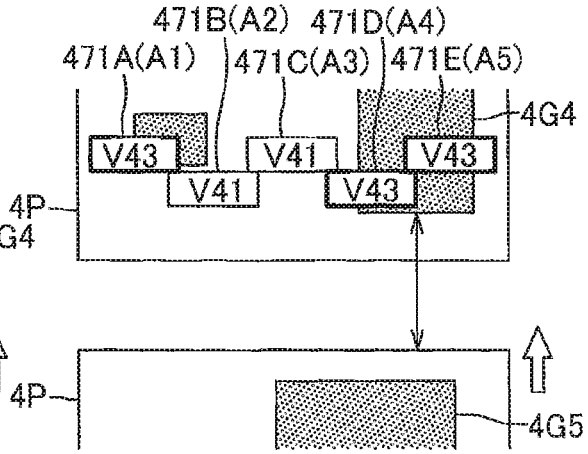
Figure 62B:
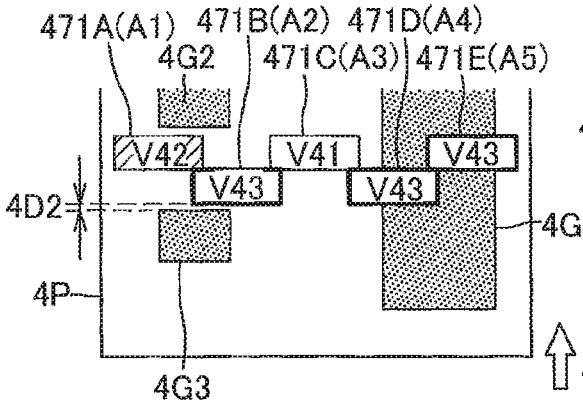
Figure 62E:
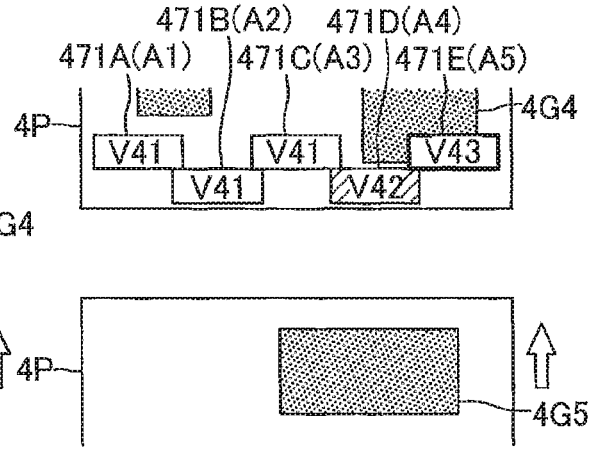
Figure 62C:
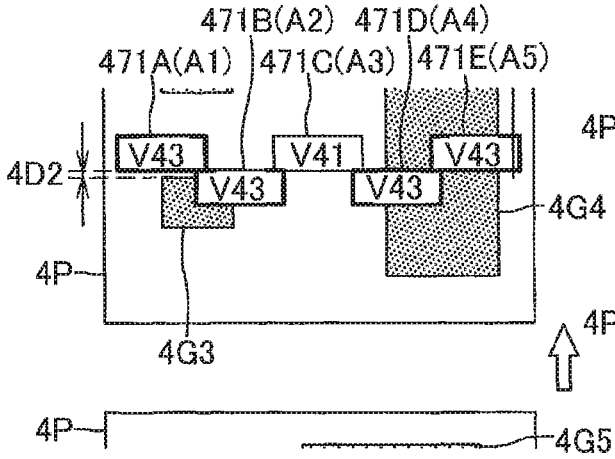

Thereafter, as illustrated in FIGS. 62B and 62C, at the timing when the distance between the third image 4G3 corresponding to both the fixing heads 471A and 471B and each of the fixing regions A1 and A2 becomes second distance 4D2, each voltage V applied to a corresponding one of the fixing heads 471A and 471B is switched from the second voltage V42 to the third voltage V43. As illustrated in FIG. 62D, when the third image 4G3 is moved past the second fixing region A2, the voltage V applied to the second fixing head 471B is switched from the third voltage V43 to the first voltage V41. That is, because there is no image corresponding to the second fixing region A2 on the subsequent paper 4P, the voltage V applied to the second fixing head 471B is switched from the third voltage V43 to the first voltage V41. Similarly, as illustrated in FIG. 62E, when the third image 4G3 is moved past the first fixing region A1, the voltage V applied to the first fixing head 471A is switched from the third voltage V43 to the first voltage V41.

Figure 62F:
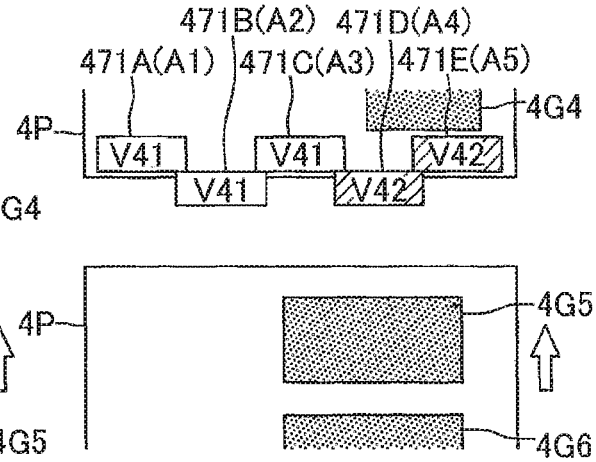

As illustrated in FIG. 62E, when the fourth image 4G4 corresponding to the fourth fixing head 471D is moved past the fourth fixing region A4, the voltage applied to the fourth fixing head 471D is switched from the third voltage V43 to the second voltage V42. Since the distance from the fourth image 4G4 to the leading end of the subsequent paper 4P is equal to or smaller than the fourth distance 4D4, the voltage applied to the fourth fixing head 471D is switched from the third voltage V43 to the second voltage V42. Similarly, as illustrated in FIG. 62F, when the fourth image 4G4 is moved past the fifth fixing region A5, the voltage applied to the fifth fixing head 471E is switched from the third voltage V43 to the second voltage V42.

The control for the fixing heads 471A-471E when the fifth paper 4P5 having the largest width is used has been described with reference to FIGS. 60 to 62. The control is performed in the same manner when the papers 4P1 to 4P4 having different widths are used. In this case, the voltage applied to a fixing head positioned outside the image formation region of the paper in the width direction (e.g., the fifth fixing head 471E when the fourth paper 4P4 is used) is maintained at the first voltage V41 during the print control.

Specifically, when the print control is performed using the fourth paper 4P4 for example, there is no target image corresponding to the fifth fixing head 471E positioned outside the image formation region of the fourth paper 4P4 in the conveyance direction. Thus, in the process illustrated in FIG. 57, "No" is determined in step S401 for the fifth fixing head 471E. Accordingly, the times t401-t404 for changing the voltage V are not set for the fifth fixing head 471E, with the result that the voltage applied to the fifth fixing head 471E is maintained at the first voltage V41 during the print control.

According to the above fifth embodiment, the following effects can be obtained.

Because the voltage is increased from the first voltage V41 to the second voltage V42 before the leading end of the paper 4P reaches the fixing regions A1-A5, the droplet-like fixing solution L can be prevented from dropping from the nozzle 4N when switching the voltage from the first voltage V41 to the second voltage V42, and can prevent the fixing solution L from adhering to the paper 4P.

The voltage is once set to the second voltage V42 lower than the third voltage V43 before application of the third voltage V43, power consumption can be reduced as compared to a case where the voltage is changed to the third voltage V43 at one time from the first voltage V41 before the leading end of the paper 4P reaches the fixing regions A1-A5.

Because the voltage is reduced from the third voltage V43 to the second voltage V42 while the large gap between the images 4G2 and 4G3 is passing through the corresponding fixing region, power consumption can be reduced as compared to a case where the voltage is maintained at the third voltage V43 while the large gap is passing through the corresponding fixing region.

Because the voltage is maintained at the third voltage V43 while the small gap between the images 4G1 and 4G2 is passing through the corresponding fixing region, a state of spraying the fixing solution L for fixing the second image 4G2 following the first image 4G1 can be stabilized.

Because the voltage is reduced to the first voltage V41 after the most upstream third image 4G3 is moved past the first fixing region A1, unnecessary power consumption can be prevented between the first paper 4P and the subsequent paper 4P.

Because the voltage is reduced, not to the first voltage V41, but to the second voltage V42 after the most upstream fourth image 4G4 is moved past the fifth fixing region A5, dripping from the fifth fixing head 471E can be restricted between successive papers.

Because the second voltage V42 is determined on the basis of the relational expression calculated in the standby state, the second voltage V42 can be set to a proper value for the environment.

Because the plurality of fixing heads 471A-471E arranged in the width direction is individually controlled, in a case where there is no image corresponding to the third fixing head 471C on the paper 4P for example, the third fixing head 471C can be put in a non-activated state, thereby preventing unnecessary spraying from the third fixing head 471C.

The fixing heads 471A-471E are controlled depending on the width of the paper 4P to be used. In a case where the print control is performed for the first paper 4P1 having the smallest width for example, the fixing heads 471B to 471E do not correspond to the image formation region of the first paper 4P1. In this case, the fixing heads 471B to 471E can be put in a non-activated state, thereby preventing unnecessary spraying of the fixing solution L from the fixing heads 471B to 471E.

The width of the first fixing head 471A is made smaller than the width of the first paper 4P1, and the widths of the respective fixing heads 471B to 471E are made small such that the fixing heads 471B to 471E fall within the widths of their corresponding papers 4P2 to 4P5, respectively. Accordingly, the fixing heads 471A-471E can be reduced in size, which in turn can reduce the size of the fixing device 407.

The present invention is not limited to the above-described fifth embodiment, but may be variously modified as exemplified below.

In the above fifth embodiment, the voltage V is changed to the second voltage V42 (voltage value at which formation of Taylor cone starts) when the distance between two images is larger than the third distance 4D3. However, the present invention is not limited to this, and the voltage V may be changed to any value that is smaller than the third voltage V43 and larger than the first voltage V41.

In the above fifth embodiment, when the distance from the trailing end of the most upstream fourth image 4G4 to the leading end of the subsequent paper 4P is equal to or smaller than the fourth distance 4D4, the voltage V is set to the second voltage V42 after the most upstream fourth image 4G4 is moved past the fifth fixing region A5. However, the present invention is not limited to this, and the voltage V may be set to any value that is larger than the first voltage V41.

In the above fifth embodiment, in the print control, the voltage V is once increased to the second voltage V42 from the first voltage V1 set in the standby state and then increased to the third voltage V43 for fixing. However, the present invention is not limited to this, and the voltage V may be increased to the third voltage V43 at one time from the first voltage V41 before the leading end of the paper 4P reaches the fixing region, for example.

In the fifth embodiment, the first electrode 474 is disposed in the interior of the container portion 473. However, the present invention is not limited to this. For example, the nozzles and the container portions may be made of a conductive member such as a metal, and the nozzles or the container portion may be applied with a voltage. In this case, each nozzle or each container portion, which is applied with a voltage, functions as the first electrode. In this case, the plurality of conductive container portions may be provided so as to be separated from each other in order to block movement of electric charges between the container portions. Alternatively, insulating members may be provided between the plurality of conductive container portions in order to block movement of electric charges between the container portions. In another case, the container portion may be made of a non-conductive member such as a resin, the nozzles may be made of a conductive member such as a metal, and the nozzles may be applied with a voltage. In this case, each nozzle functions as the first electrode.

In the above fifth embodiment, the present invention is applied to the laser printer 401. However, the present invention is not limited to this, and may be applied to other types of image forming devices, such as a copying machine or a multifunction peripheral.

In the above fifth embodiment, the paper 4P such as a thick paper, a post card, or a thin paper is exemplified as a recording sheet. However, the present invention is not limited to this, and the recording sheet may be an OHP sheet for example.

In the above fifth embodiment, the photosensitive drum 61 is exemplified as a photosensitive member. However, the present invention is not limited to this, and the photosensitive member may be a belt-like photosensitive member.

In the above embodiments, the transfer roller TR is exemplified as a transfer member. However, the present invention is not limited to this, and the transfer member may be any member such as a conductive brush or a conductive plate spring that is applied with a transfer bias.

In the above fifth embodiments, the pressurization device 475 having the pump and the reducing valve is exemplified as a pressure applying means. However, the present invention is not limited to this, and, for example, the pressure applying means may be a cylinder that pressurizes or depressurizes air in each head.

In the above fifth embodiment, the fixing head 471 includes the five fixing heads 471A-471E. However, the present invention is not limited to this, and the fixing head 471 may include only one fixing head, or two to four, or six or more fixing heads.

In the above fifth embodiment, determination in steps S402 and S406 is made based on the distance. However, the present invention is not limited to this, and the determination in steps S402 and S406 is made based on the time.

In the above fifth embodiment, a voltage is applied in the standby state. However, the present invention is not limited to this, and a voltage may not be applied in the standby state.

In the above fifth embodiment, each of the fixing regions A1-A5 is the same in shape, size, and position as a lower surface of the corresponding container portion 473 for descriptive convenience. However, the present invention is not limited to this, and the fixing region may be smaller or larger in size than the lower surface of the container portion. That is, the fixing region may be defined based on the front-rear width and left-right width of the fixing solution to be sprayed onto the paper.

The fifth object can be achieved by the fifth embodiment and any modification thereof described with reference to FIGS. 53 to 62. The above-described fifth embodiment is one example of the fifth invention, and the fifth invention is not limited to this.

Figure 63:
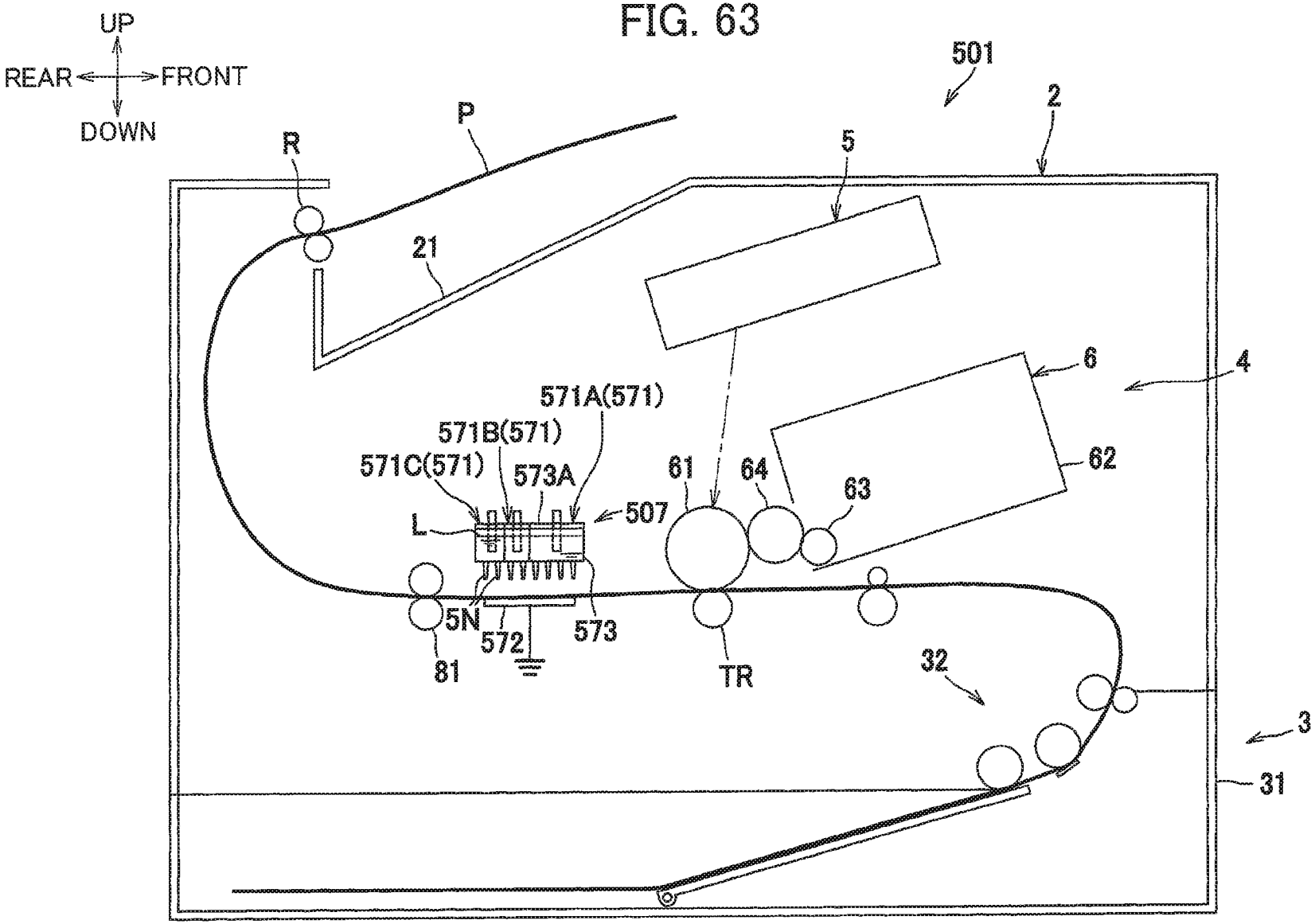
FIG. 63 is a view illustrating a laser printer provided with a fixing device according to a sixth embodiment of the present invention.

A laser printer 501 of a sixth embodiment of the present invention will be explained with reference to FIGS. 63-79. In the sixth embodiment, like parts and components are designated with the same reference numerals as the first embodiment to avoid duplicating description. A laser printer 501 includes a fixing device 507. In the following description, directions are defined as shown in FIG. 63. That is, the right side of FIG. 63 is defined as a front side, the left side of FIG. 63 is defined as a rear side, the far side of FIG. 63 is defined as a right side, and the near side of FIG. 63 is defined as a left side. The upward and downward directions of FIG. 63 are defined as an upward direction and a downward direction.

As illustrated in FIG. 63, the laser printer 501 has a casing 2, a feeder portion 3 configured to feed a paper 4P as an example of a recording sheet, an image forming section 4 configured to form an image onto the paper 4P, and a controller 400.

The fixing device 507 is configured to supply a charged fixing solution L onto a toner image on the paper P by electrostatic spraying method to fix the toner image onto the paper P. The configuration of the fixing device 507 will be described later in detail.

Figure 64:
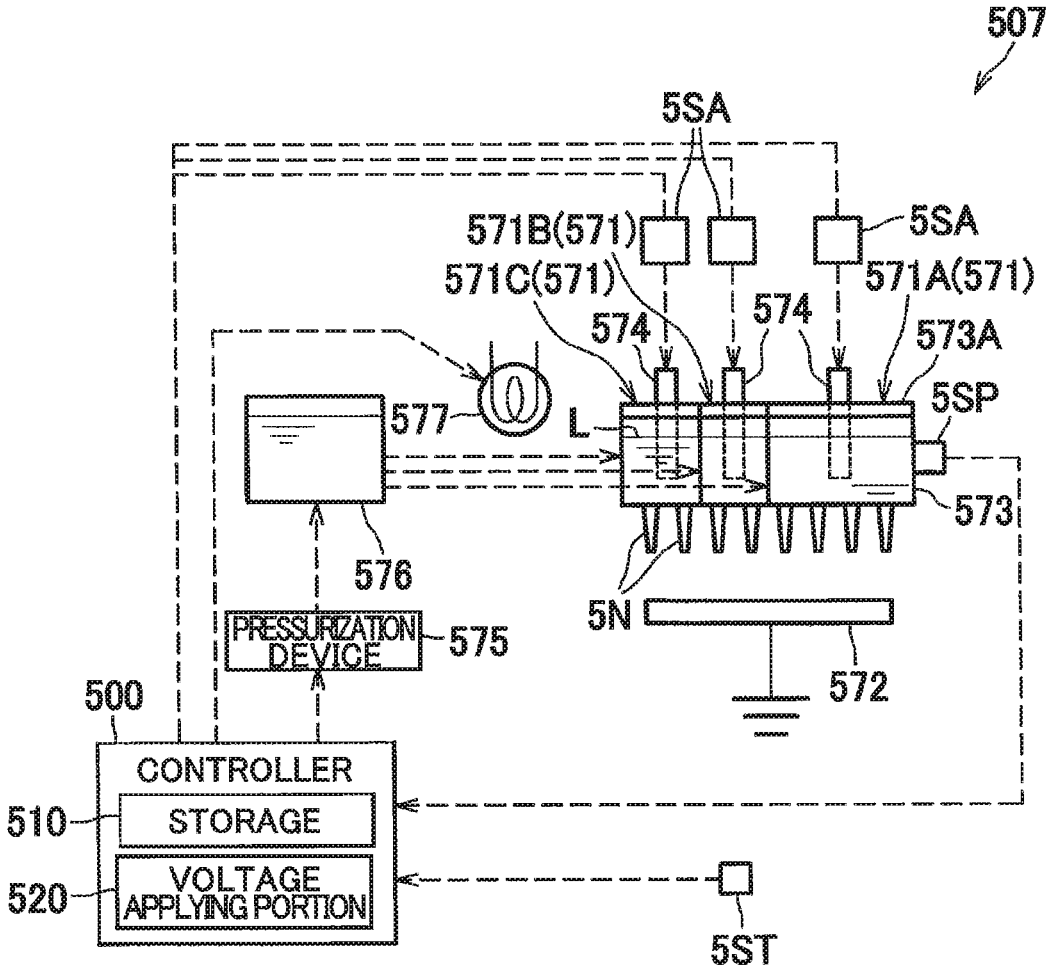
FIG. 64 is a view illustrating in detail the fixing device.

As illustrated in FIG. 64, the fixing device 507 has a fixing head 571 configured to spray the fixing solution L, a second electrode 572 located below the fixing head 571 to support the paper P, a fixing-solution cartridge 576, a pressurization device 575 as an example of a pressure applying means, a heater 577, and a controller 500.

The fixing head 571 has a first fixing head 571A, a second fixing head 571B, and a third fixing head 571C. The first to third fixing heads 571A to 571C are arranged in this order from the upstream side to the downstream side in the conveyance direction of the paper P.

The first fixing head 571A has a container portion 573 that stores therein the fixing solution L, a plurality of nozzles 5N that communicates with the container portion 573 and is configured to spray the fixing solution L toward the toner image, and a first electrode 574 configured to apply a voltage to the fixing solution L in the container portion 573 and the nozzles 5N. The second and third fixing heads 571B and 571C have substantially the same configurations as the first fixing head 571A, so components of the fixing heads 571B and 571C are designated with the same reference numerals as those of the first fixing head 571A, and description thereof will be omitted appropriately.

The first electrode 574 is provided so as to penetrate the top wall 573A of the container portion 573 from the top to the bottom of the top wall 573A. The lower end portion of the first electrode 574 is disposed in the fixing solution L in the container portion 573, and the upper end portion thereof is connected to a voltage applying portion 520 controlled by the controller 500. The voltage to be applied to the first electrode 574 is preferably in a range from 1 kV to 10 kV. A current sensor SSA is provided between the first electrode 574 of each of the fixing heads 571A to 571C and the voltage applying portion 520 so as to correspond to the first electrode 574. A current flowing in the first electrode 574 is detected by the current sensor SSA. However, the current may be detected by the voltage applying portion 520.

The fixing-solution cartridge 576 is connected to each of the fixing heads 571A to 571C. The fixing-solution cartridge 576 is a cartridge filled with the fixing solution L and is detachably attached to the casing 2. The casing 2 has an attachment/detachment sensor (not illustrated) for detecting attachment/detachment of the fixing-solution cartridge 576, and information concerning the attachment/detachment detected by the attachment/detachment sensor is output to the controller 500. For example, as the attachment/detachment sensor, an optical sensor or an RFID (Radio Frequency Identifier) can be exemplified.

A pipe is provided between the fixing-solution cartridge 576 and each of the fixing heads 571A to 571C so as to connect the fixing-solution cartridge 576 and each of the fixing heads 571A to 571C. Accordingly, the fixing solution L in the fixing-solution cartridge 576 is supplied to each of the fixing heads 571A to 571C.

The fixing-solution cartridge 576 is connected with the pressurization device 575. The pressurization device 575 pressurizes air in the fixing-solution cartridge 576 to pressurize the inside of the fixing-solution cartridge 576 and the fixing solution L in each of the fixing heads 571A to 571C. Further, each of the fixing heads 571A to 571C has a pressure sensor 5SP (in FIG. 64, only one pressure sensor 5SP is illustrated as a representative example) that is configured to detect the pressure inside of the corresponding fixing head 571. In the sixth embodiment, the pressure inside each of the fixing heads 571A to 571C is adjusted by the pressurization device 575. However, the pressure inside the fixing head 571 may be adjusted by the water head difference of the fixing solution L inside the head 571.

The second electrode 572 is an electrode that is configured to contact the paper P to form a potential difference between the fixing solution L in the nozzle 5N and the paper P and is disposed below the fixing heads 571A-571E so as to be separated from the tips of the nozzles 5N of the fixing heads 571A-571E by a prescribed distance. The prescribed distance is determined by experiments or simulations. Specifically, the prescribed distance is set to a value larger than the thickness of the paper P so that electrostatic spraying can be performed suitably.

The second electrode 572 is grounded. The second electrode 572 need not necessarily be grounded, but a voltage lower than the current applied to the first electrode 574 may be applied to the second electrode 572. The second electrode 572 forms an electric field between itself and the tips of the nozzles 5N.

When a voltage is applied to the first electrode 574, an electric field is formed in a space around the tip of each nozzle 5N. Specifically, the fixing solution L in the container portion 573 is applied with a pressure by the pressurization device 575. Accordingly, the fixing solution L is supplied toward the tip of each nozzle 5N, and an electric field is formed between the fixing solution L at the tip of each nozzle 5N and the second electrode 572. Then, at the tip of each nozzle 5N, the fixing solution L is attracted by the electric field to form so-called Taylor cone. The electric field is concentrated on the tip of the Taylor cone, with the result that the fixing solution L is torn off from the tip of the Taylor cone, whereby a fine droplet is generated.

The droplet-like fixing solution L, sprayed by the nozzles 5N, is positively charged. In contrast, the paper P has a substantially zero potential. As a result, the droplet-like fixing solution L flies toward the paper P due to Coulomb force, and adheres to the paper P or the toner image.

The current sensor SSA is a sensor configured to detect a current flowing in the first electrode 574 to indirectly detect a current flowing in the fixing solution L. The current sensor 5SA detects a current flowing in the first electrode 574 in a case where the fixing solution L is sprayed from the nozzle 5N to paper P, and outputs a detected value thereof to the controller 500. When the fixing solution L is not sprayed from the nozzle 5N, no current flows in the first electrode 574 even if a voltage is applied to the first electrode 574. That is, a current flows in the first electrode 574 when the fixing solution L is sprayed from the nozzle 5N, in other words, when the charged fixing solution L is moved from the nozzle 5N to the paper P.

The first electrode 574 and the second electrode 572, configured in such a manner, constitute a potential difference generating portion which generates a potential difference between the fixing solution L contained in the nozzles 5N and the paper P which is being conveyed and passing through a position separated from the nozzles 5N.

The heater 577 is a device configured to heat the fixing solution L inside the fixing head 571 and the fixing-solution cartridge 576, and is disposed between the fixing head 571 and the fixing-solution cartridge 576. The heater 577 is controlled by the controller 500.

A temperature sensor 5ST is provided in the casing 2. The temperature sensor 5ST is configured to detect temperature and output the detected temperature to the controller 500. In the sixth embodiment, a temperature around the fixing device 507 is detected by the temperature sensor 5ST. However, the present invention is not limited to this, and the temperature of the fixing solution L may be detected by a temperature sensor.

Figure 65A:
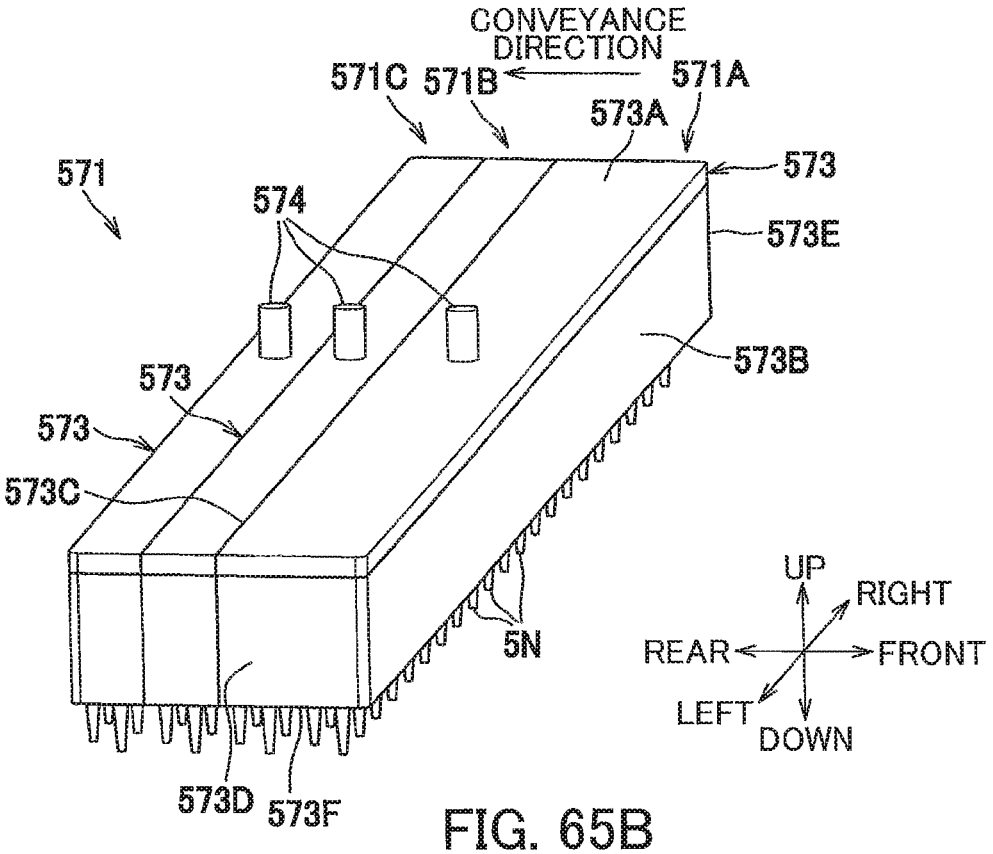
FIG. 65A is a perspective view of a fixing head as viewed from diagonally above.

As illustrated in FIG. 65A, the container portion 573 of the first fixing head 571A is a container having a rectangular shape elongated in the left-right direction, i.e., in the width direction of the paper P. The container portion 573 has a top wall 573A, a front wall 573B, a rear wall 573C, a left wall 573D, a right wall 573E, and a bottom wall 573F. The container portion 573 of the second fixing head 571B has the same size as that of the container portion 573 of the first fixing head 571A in the left-right direction and has a smaller size than that of the container portion 573 of the first fixing head 571A in the conveyance direction. The container portion 573 of the third fixing head 571C has the same size as that of the container portion 573 of the second fixing head 571B.

Figure 65B:
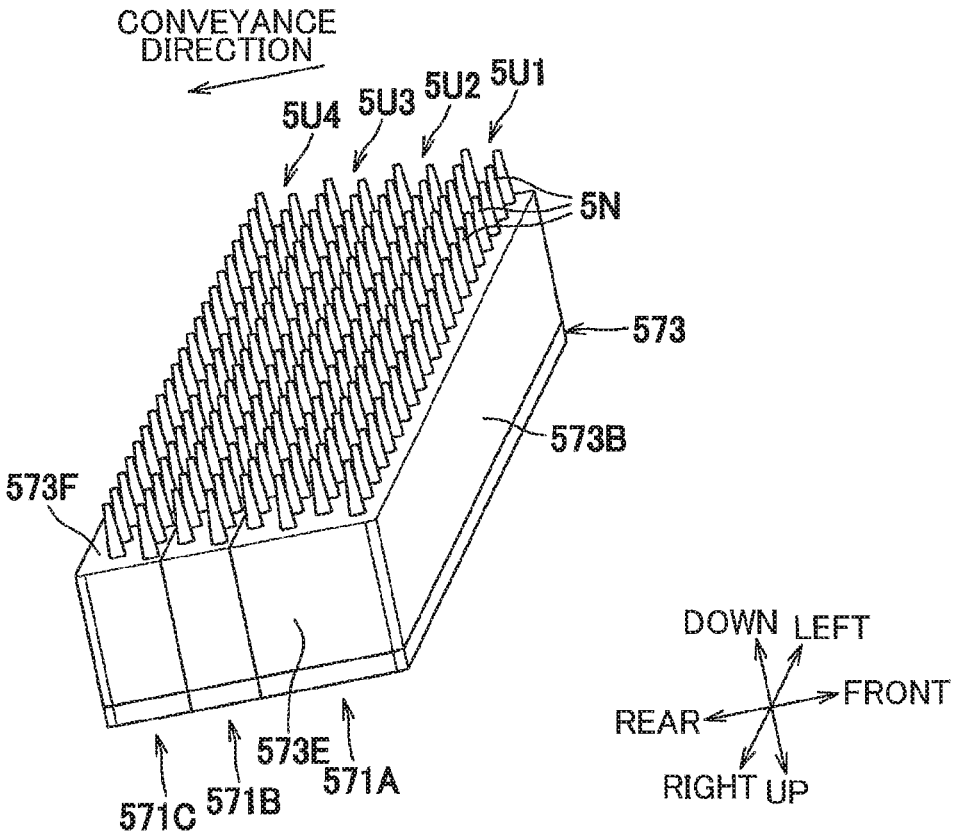
FIG. 65B is a perspective view of the fixing head as viewed from diagonally below.

As illustrated in FIG. 65B, the plurality of nozzles 5N in each of the fixing heads 571A to 571C protrudes downward from the bottom wall 573F of the container portion 573. Each nozzle 5N is reduced in diameter as it goes downward. The plurality of nozzles 5N is arranged in both the width direction of the paper P (left-right direction) and the conveyance direction of the paper P (front-rear direction). The inner diameter of each nozzle 5N is preferably in a range from 0.1 mm to 1.0 mm.

Specifically, the plurality of nozzles 5N in the first fixing head 571A constitutes first and second staggered array groups 5U1 and 5U2 arranged in the conveyance direction. The plurality of nozzles 5N in the second fixing head 571B constitutes a third staggered array group 5U3, and the plurality of nozzles 5N in the third fixing head 571C constitutes a fourth staggered array group 5U4.

Figures 66A, 66B:
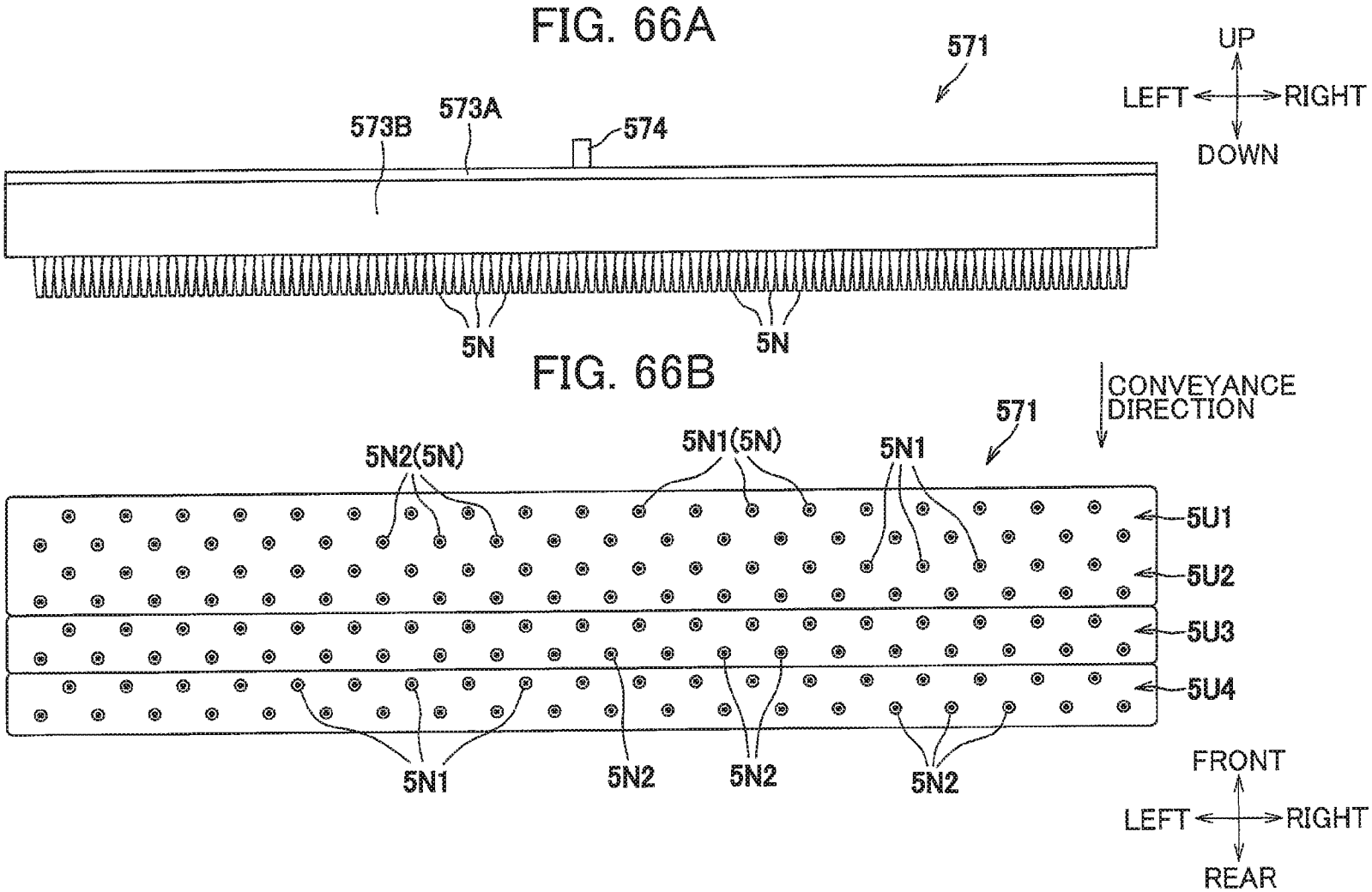
FIG. 66A is a front view of the fixing head.
FIG. 66B is a bottom view of the fixing head.

As illustrated in FIGS. 66A and 66B, the first staggered array group 5U1 includes a plurality of first nozzles 5N1 arranged at regular intervals in the width direction, and a plurality of second nozzles 5N2 arranged at regular intervals in the width direction. The first nozzles 5N1 and the second nozzles 5N2 are alternately arranged in the width direction with the first nozzles 5N1 disposed in one side with respect to the conveyance direction and with the second nozzles 5N2 disposed in the other side with respect to the conveyance direction. The second nozzle 5N2 is disposed between two first nozzles 5N1 in the width direction. A shape formed by connecting two first nozzles 5N1 adjacent to each other in the width direction and the second nozzle 5N2 disposed between the two first nozzles 5N1 is a equilateral triangle or an isosceles triangle. Similarly, a shape formed by connecting two second nozzles 5N2 adjacent to each other in the width direction and the first nozzle 5N1 disposed between the two second nozzles 5N2 is a equilateral triangle or an isosceles triangle.

Each of the second staggered array group 5U2, the third staggered array group 5U3, and the fourth staggered array group 5U4 has the same structure as that of the first staggered array group 5U1. In the sixth embodiment, a nozzle pitch (the shortest distance between the outer peripheries of the adjacent nozzles) may be set in a range equal to or larger than 1 mm and equal to or smaller than 14 m.

As illustrated in FIG. 64, the controller 500 has a storage 510 including a RAM, a ROM, and the like, the voltage applying portion 520, a CPU, and an input/output circuit and has a function to control a voltage applied to the first electrode 574, and to control the pressurization device 575 and the heater 577, on the basis of externally input image data, and signals from the pressure sensors SSP, the current sensors SSA, and the temperature sensor SST.

Specifically, the controller 500 executes a state grasping control to grasp a state (e.g., viscosity) of the fixing solution L when print control is not performed, and executes the spray control to spray the fixing solution L in accordance with the state of the fixing solution L grasped in the state grasping control. More specifically, the controller 500 is configured to perform the state grasping control and the spray control for each of the plurality of fixing heads 571A to 571C individually. The spray control refers to a control executed in the print control during the time period from a time when spraying of the fixing solution L from the nozzles 5N is started to a time when the spraying is ended. More specifically, the spray control is started when the first paper P based on a print instruction reaches a prescribed position upstream of the fixing head 571 and is ended after the last paper P is moved past the fixing head 571.

In the state grasping control, the controller 500 applies a first pressure PR1 to the fixing solution L using the pressurization device 575. Each of the first pressure PR1 and a second pressure PR2 (described later) is a pressure low enough not to discharge the fixing solution L from the nozzles 5N, and is appropriately set by experiments or simulations.

Figure 67:
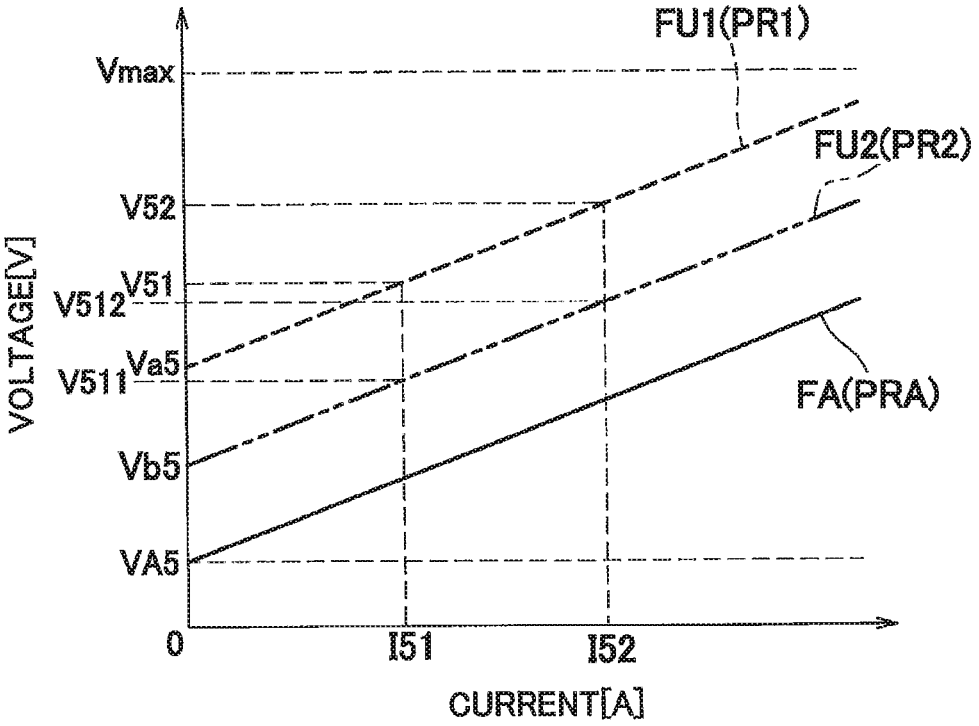
FIG. 67 is a graph showing a first function, a second function, and a target function.

Thereafter, as illustrated in FIG. 67, the controller 500 starts applying the voltage to the first electrode 574 and gradually increases the voltage. Then, the controller 500 stores in the storage 510 a first voltage V51 at which the current detected by the current sensor 5SA becomes a first current value I51, and stores in the storage 510 a second voltage V52 at which the current becomes a second current value I52 larger than the first current value I51. Each of the first and second current values I51 and I52 is set to a value within a range of the current value used in the spray control on the basis of experiments or simulations.

Then, the controller 500 calculates a first function FU1 representing the relationship between the voltage and the current based on the voltage V51, V52 and the current values I51, I52. The first function FU1 is a linear function. Specifically, the controller 500 calculates a slope c and an intercept β of the first function FU1 based on the following expressions (1) and (2), and then obtains the first function FU1 (V=α·I+β).

$$V51=\alpha\cdot I51+\beta \quad (1)$$

$$V52=\alpha\cdot I52+\beta \quad (2)$$

$$\alpha=(V52-V51)/(I52-I51)$$

$$\beta=(V51\cdot I52-V52\cdot I51)/(I52-I51)$$

Subsequently, the controller 500 stops application of the voltage to the first electrode 574, and sets the pressure applied to the fixing solution L by the pressurization device 575 to a pressure PR2 higher than the first pressure PRE Thereafter, the controller 500 resumes application of the voltage to the first electrode 574 and gradually increases the voltage. Then, the controller 500 stores in the storage 510 a first voltage V511 at which the current detected by the current sensor SSA becomes the first current value I51, and stores in the storage 510 a second voltage V512 at which the current becomes the second current value I52 larger than the first current value I51. The controller 500 calculates a second function FU2 representing the relationship between the voltage and the current based on the voltages V511, V512 and the current values I51, I52. The second function FU2 is a linear function. The second function FU2 can be calculated in the same manner as for the first function FU1, so description of the calculation method for the second function FU2 will be omitted.

Thereafter, the controller 500 calculates, using the first function FU1, a fourth voltage Va5 at which the current value becomes 0. Further, the controller 500 calculates, using the second function FU2, a fifth voltage Vb5 at which the current value becomes 0. The fourth voltage Va5 and the fifth voltage Vb5 correspond to the interceptions β of the first and second functions FU1 and FU2, respectively. Hereinafter, for descriptive convenience, the fourth and fifth voltages Va5 and Vb5 are referred to also as "intercept voltage Va5" and "intercept voltage Vb5", respectively.

Figure 68:
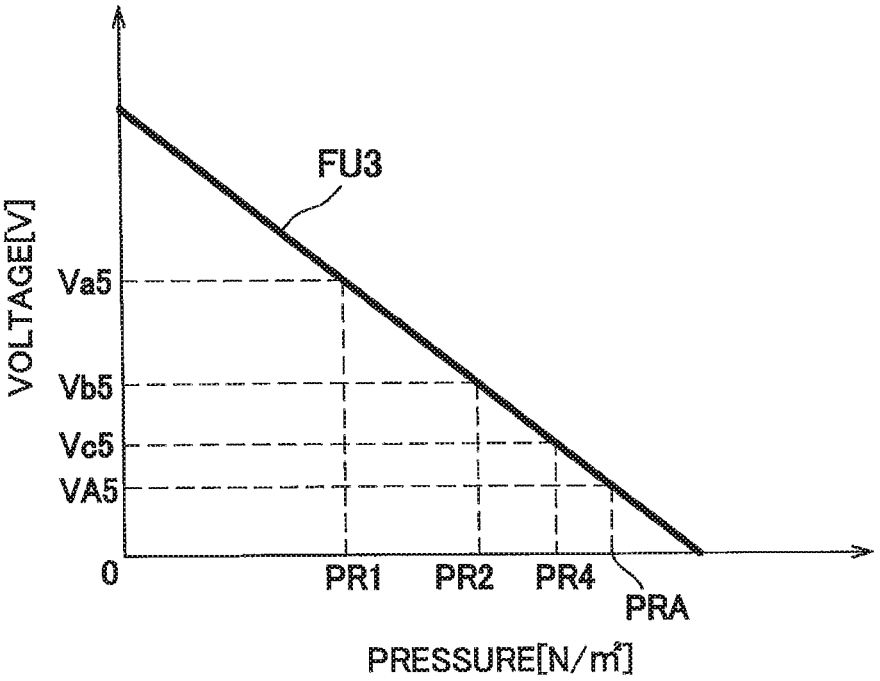
FIG. 68 is a graph showing a third function.
Figure 69:
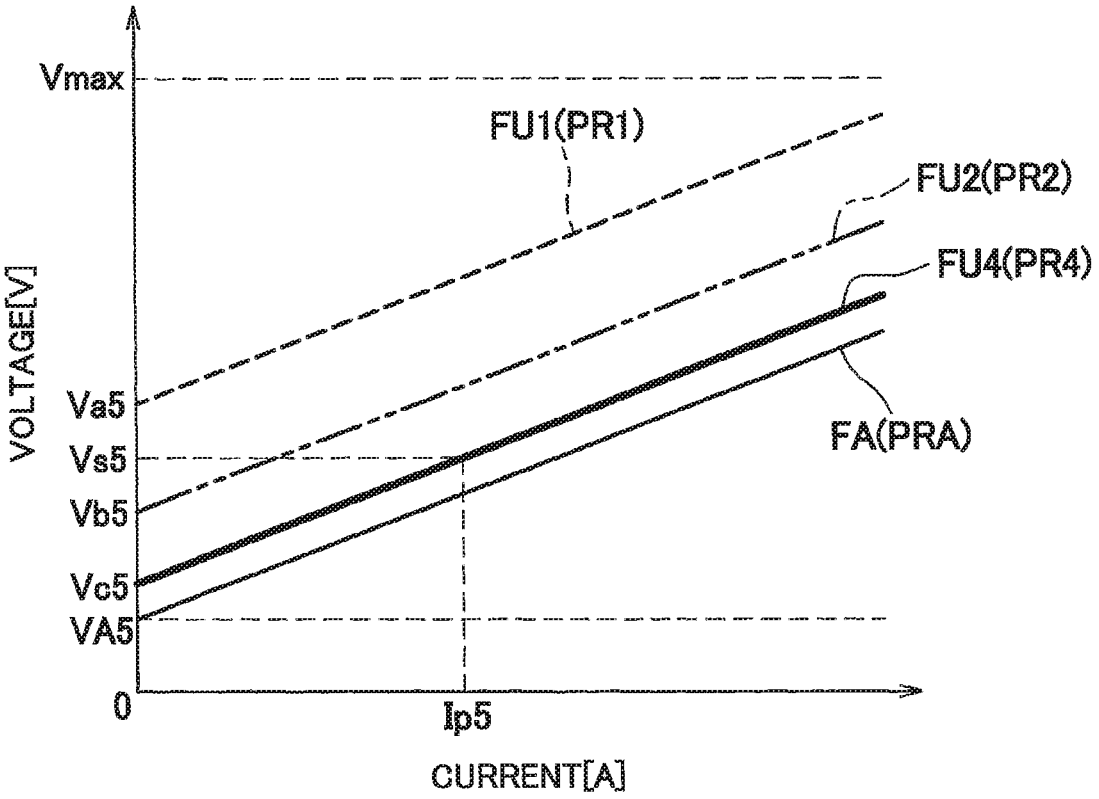
FIG. 69 is a graph showing the first function, the second function, the target function, and a fourth function.

Then, the controller 500 calculates a third function FU3 representing the relationship between the pressure and the voltage as illustrated in FIG. 68 on the basis of the intercept voltage Va5 of the first function FU1, the first pressure PR1 corresponding to the first function FU1, the intercept voltage Vb5 of the second function FU2, and the second pressure PR2 corresponding to the second function FU2. The third function FU3 is a linear function. The third function FU3 can be calculated in the same manner as for the first function FU1, so the description of the calculation method for the third function FU3 will be omitted.

By calculating the functions FU1 to FU3 in the manner as described above, the controller 500 grasps the current state of the fixing solution L. The inventor of the present application has confirmed by experiments and the like that the higher the viscosity of the fixing solution L is, the larger the slopes a and intercepts β of the first and second functions FU1 and FU2 become, and that changes in the functions FU1 and FU2 in accordance with the viscosity changes the third function FU3. Further, it is known that in general the viscosity of the fixing solution L is increased as the temperature is lowered. That is, the slopes a of the functions FU1 and FU2 are increased as the temperature is lowered.

The controller 500 is configured to execute the above state grasping control when a prescribed condition is satisfied. Details of the prescribed condition will be descried later.

After grasping the state of the fixing solution L through the state grasping control, the controller 500 calculates a fourth function FU4, a fourth pressure PR4, and a seventh voltage V57. The fourth function FU4 is a function for determining a voltage applied in the spray control. The fourth pressure PR4 is a pressure to be applied to the fixing solution L in the spray control, a standby state, and a preparation state. The seventh voltage V57 is a voltage to be applied to the fixing solution L in the standby state and the preparation state. The standby state refers to a state until a prescribed standby time period elapses from activation of the laser printer 501 or from end of the print control, or to a state (print waiting state) from a time when the prescribed standby time starts and to a time when a print job is received during the prescribed standby time period. Further, the preparation state refers to a state from a time when the print control is started to a time when the spray control is started. When the standby time period elapses from the end of the print control, the controller 500 shifts from the standby state to a sleep state. In the sleep state, the controller 500 sets the voltage and pressure to 0.

In order to calculate the fourth function FU4, the fourth pressure PR4, and the seventh voltage V57, the controller 500 first calculates a target function FA in which a target voltage VA5 is the intercept voltage, as illustrated in FIG. 67. The target function FA is calculated as a linear function having the same slope a as that of the first function FU1 and having an intercept corresponding to the target voltage VA5. The target voltage VA5 is an intercept voltage of a function in which the pressure is set to a target pressure PRA (described later), and is set to a voltage value equal to or larger than 0 by experiments or simulations.

The inventor of the present application has confirmed that a function (e.g., the first function FU1) representing the relationship between the current and the voltage shifts in parallel to the negative side such that the intercept voltage thereof is decreased as the pressure applied to the fixing solution L is increased. Further, the inventor has confirmed that the fixing solution L is dripped from the nozzles 5N when the intercept voltage of the function, which shifts in parallel to the negative side, becomes smaller than a prescribed value (target voltage VA5 in the example of FIG. 67), and the fixing solution is applied with a pressure corresponding to this shifted function to the fixing solution L in a state where no voltage is applied.

Further, the controller 500 calculates a target pressure PRA corresponding to the target voltage VA5 based on the third function FU3 illustrated in FIG. 68. The target pressure PRA refers to a pressure value at which the interface of the fixing solution L at the tip of the nozzle 5N with air becomes substantially a flat when no voltage is applied to the first electrode 574, but the pressure of the pressure value is applied to the fixing solution. When the pressure is low, the interface of the fixing solution L has a substantially semi-spherical shape recessed to the fixing solution L side. As the pressure is gradually increased, the semi-spherical interface is moved outward to gradually become close to a flat. When the pressure is further increased, the interface is moved further outward to be a substantially semi-spherical shape protruding outward. When the interface becomes a flat surface, the surface area thereof becomes minimum. By thus making the surface area of the interface minimum, the fixing solution L at the tip of the nozzle 5N can be prevented from drying.

Then, the controller 500 determines whether the target pressure PRA corresponds to the resolution of the pressurization device 575. When determining that the target pressure PRA does not correspond to the resolution, the controller 500 sets the fourth pressure PR4 which is lower than the target pressure PRA and corresponds to the resolution. For example, when the resolution of the pressurization device 575, i.e., the minimum unit of a pressure change is x (N/mm2), a pressure to be applied to the fixing solution L is changed as follows: x→2x→3x, . . . . On the other hand, when, for example, the target pressure PRA is 2x+y (y is smaller than x), the pressurization device 575 cannot apply the target pressure PRA of 2x+y which is a value between 2x and 3x to the fixing solution L. In this case, the controller 500 sets a pressure of 2x which is smaller than 2x+y as the fourth pressure PR4 corresponding to the resolution.

After setting the fourth pressure PR4, the controller 500 calculates an intercept voltage Vc5 corresponding to the fourth pressure PR4 based on the third function FU3 illustrated in FIG. 68. Thereafter, the controller 500 calculates the fourth function FU4 illustrated in FIG. 69 based on the intercept voltage Vc5 and the slope α which is obtained when the first function FU1 is obtained, and stores the calculated fourth function FU4 in the storage 510. The intercept voltage Vc5 of the fourth function FU4 corresponds to a sixth voltage V6 at which a current value becomes 0 in the fourth function FU4 and is set to a value larger than the target voltage VA5.

Further, the controller 500 subtracts the target voltage VA5 from the intercept voltage Vc5 of the fourth function FU4 to obtain the seventh voltage V57 to be applied to the fixing solution L in the standby state and the preparation state. The intercept voltage Vc5 is a voltage value to start the spraying of the fixing solution L from the nozzles 5N at the fourth pressure PR4. So, when the seventh voltage V57 to be applied to the fixing solution L in the standby state and the preparation state is set to a value larger than the intercept voltage Vc5, dripping may occur in the standby state and the preparation state. On the other hand, in the sixth embodiment, the seventh voltage V57 is set to a value equal to or larger than 0 and equal to or smaller than the intercept voltage Vc5. That is, the seventh voltage V57 is set to a value Vc5-VA5. Accordingly, dripping in the standby state and the preparation state can be prevented.

Further, as illustrated in FIG. 68, the voltage difference (Vc5-VA5) corresponds to the pressure difference (PRA-PR4). So, when the seventh voltage V57 is applied to the fixing solution L in the standby state and the preparation state, the interface of the fixing solution L at the tip of the nozzle 5N becomes a flat since the value of the pressure applied to the fixing solution L becomes the value PRA obtained by adding a pressure corresponding to the pressure difference (PRA-PR4) to the fourth pressure PR4. This can prevent the fixing solution L at the tip of the nozzle 5N from drying.

Before executing the spray control, the controller 500 calculates a plurality of voltages Vs5 for spraying to be used in the spray control, on the basis of the fourth function FU4 and a plurality of target current values Ip5. Further, before executing the spray control, the controller 500 determines whether each voltage Vs5 is equal to or larger than an upper limit Vmax. Here, each target current value Ip5 is set on the basis of a target amount ρ of spray set in accordance with image density. A setting method for the target current values Ip5 will be described in detail later.

When determining that the voltage Vs5 is equal to or larger than the upper limit Vmax, the controller 500 sets this voltage Vs5 to a value smaller than the upper limit Vmax and lowers the conveyance speed of the paper P. The lower the conveyance speed of the paper P is, the larger the amount of spray of the fixing solution L per unit area is. The amount of spray and the current are in a proportional relationship, and the current and the voltage are also in a proportional relationship. Thus, by multiplying the voltage Vs5 by a coefficient corresponding to an amount of change in the conveyance speed, for example, a new voltage Vs5 for spraying, which corresponds to a lower conveyance speed, can be calculated. Then, in the spray control, the controller 500 appropriately switches and applies the set voltages Vs5 for spraying to the first electrode 574 at prescribed timings, whereby a desired amount of the fixing solution L can be sprayed to the paper P.

The following describes the operation of the controller 500 in detail. The controller 500 regularly repeats the flowchart illustrated in FIG. 70 when the print control is not executed.

Figure 70:
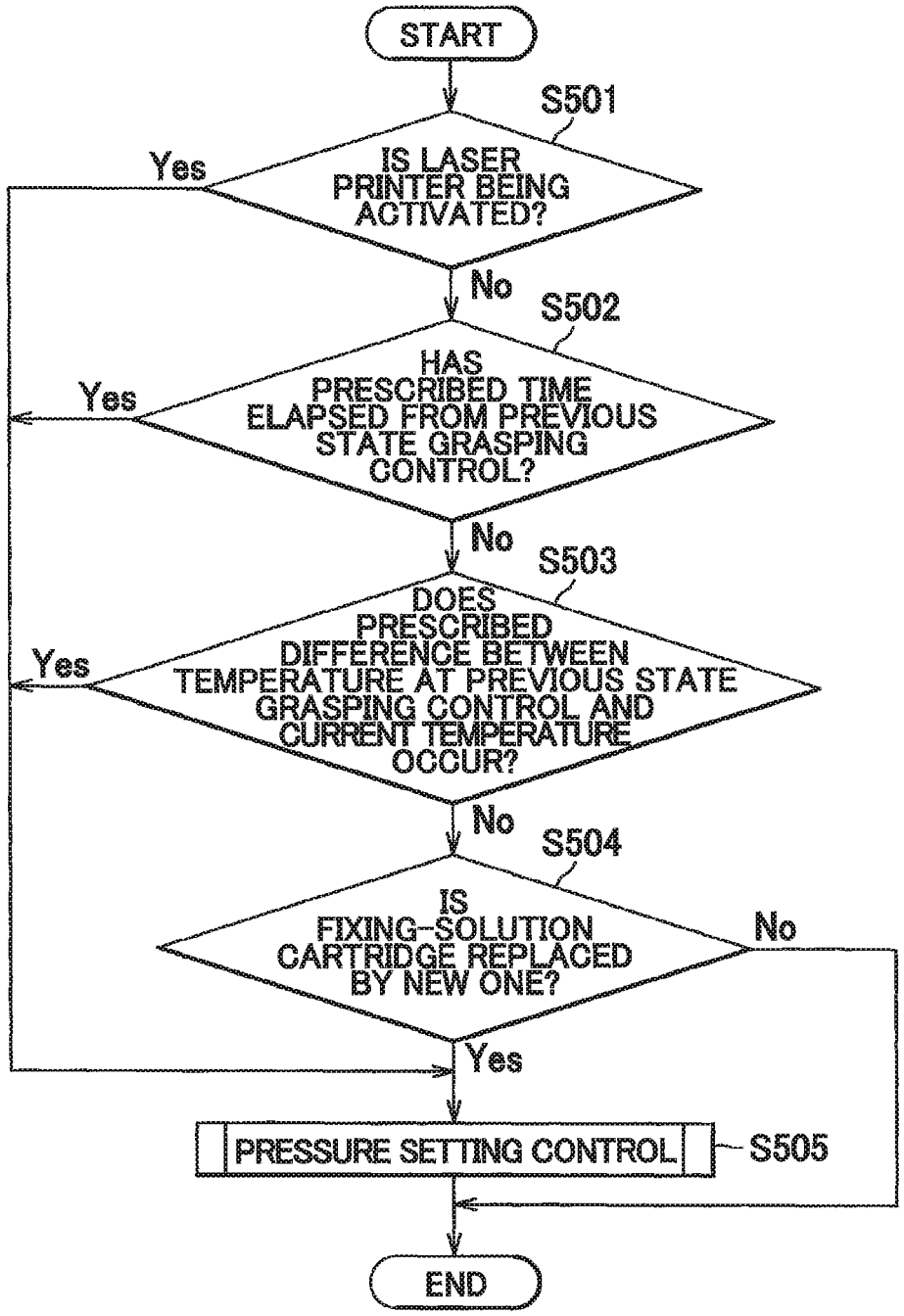
FIG. 70 is a flowchart illustrating a regular operation performed by a controller while print control is not executed.

As illustrated in FIG. 70, the controller 500 determines whether the laser printer 501 is being activated (S501). When determining in step S501 that the laser printer 501 is being activated (Yes), the controller 500 executes pressure setting control (S505). In the pressure setting control, the controller 500 first executes the above described state grasping control, and then sets a pressure to be applied to the fixing solution L in the standby state, the preparation state, or the spray control. Details of the pressure setting control will be described later.

When determining in step S501 that the laser printer 501 is not being activated (No), the controller 500 determines whether a prescribed time period has elapsed from the end of the previous state grasping control (S502). When determining in S502 that the prescribed time period elapses (Yes), the controller 500 shifts to the pressure setting control (S505). On the other hand, when determining in S502 that the prescribed time period has not elapsed (No), the controller 500 shifts to step S503.

In step S503, the controller 500 compares a temperature at the previous state grasping control with a current temperature to determine whether the difference between the temperature at the previous state grasping control and the current temperature is equal to or larger than a prescribed value. The temperature at the previous state grasping control is detected by the temperature sensor 5ST during the previous state grasping control and is stored in the storage 510 by the controller 500. That is, the controller 500 stores the temperature in the storage 510 every time the controller 500 executes the state grasping control.

When determining in step S503 that the difference is equal to or larger than a prescribed value, the controller 500 shifts to the pressure setting control (S505). On the other hand, when determining that the difference is smaller than a prescribed value (No), the controller 500 shifts to step S504. In step S504, the controller 500 determines whether the fixing-solution cartridge 576 is replaced by a new one.

When determining in step S504 that the fixing-solution cartridge 576 is replaced by a new one (Yes), the controller 500 shifts to the pressure setting control (S505). On the other hand, when determining that the fixing-solution cartridge 576 has not replaced by a new one (No), the controller 500 ends this operation.

Figure 71:
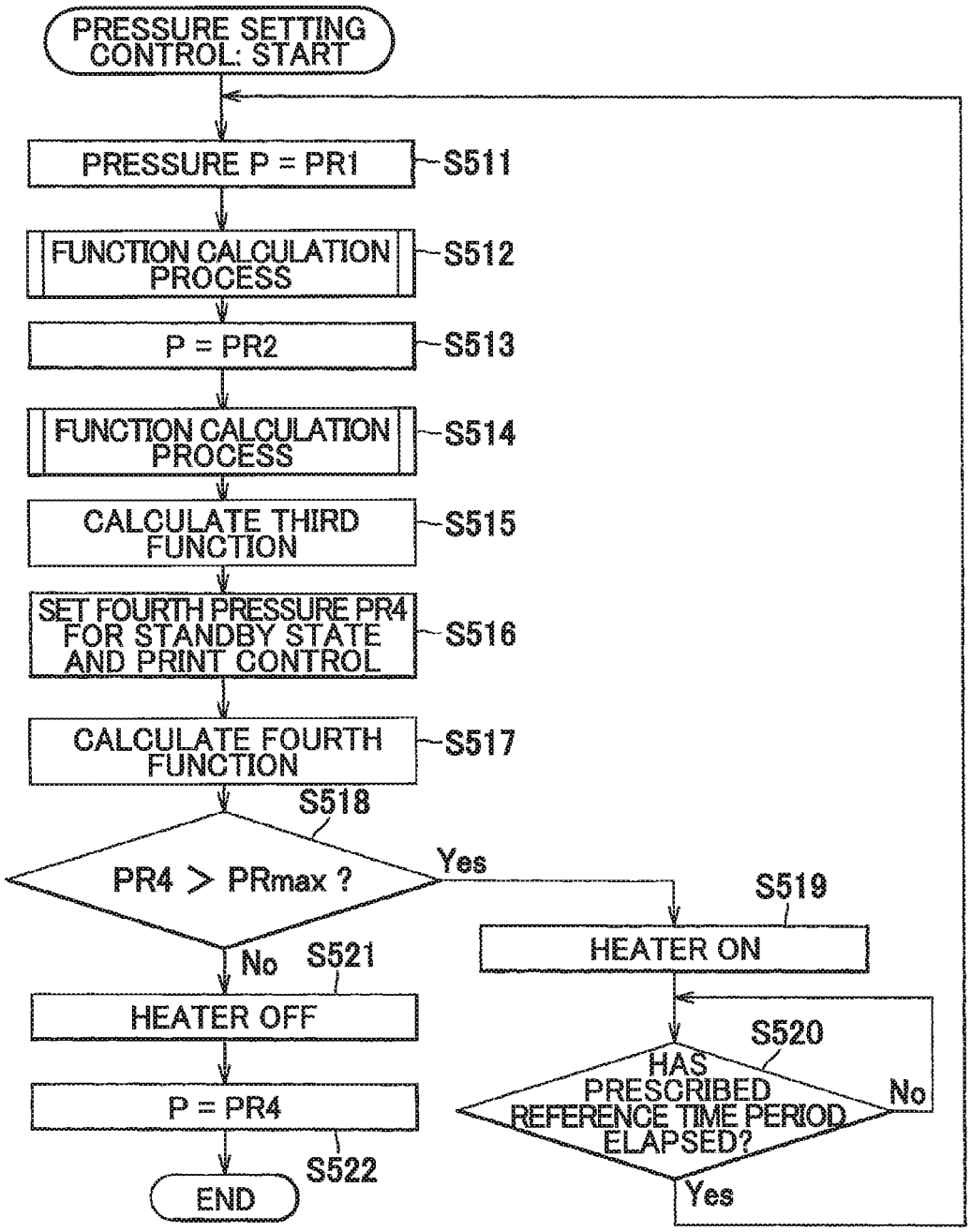
FIG. 71 is a flowchart illustrating a pressure setting control.

As illustrated in FIG. 71, in the pressure setting control, the controller 500 first sets the pressure PR applied to the fixing solution L to the first pressure PR1 (S511). After executing step S511, the controller 500 executes a function calculation process for calculating the function FU1 (S512).

Figure 72:
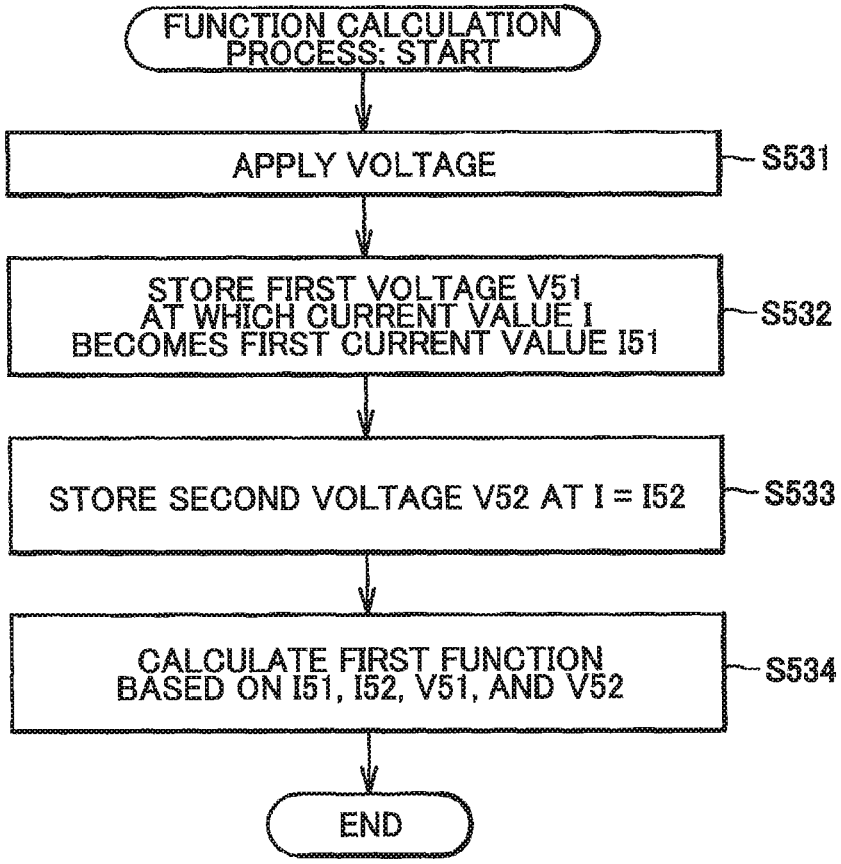
FIG. 72 is a flowchart illustrating a function calculation process.

As illustrated in FIG. 72, in the function calculation process, the controller 500 first starts applying a voltage to the first electrode 574 and then gradually increases the voltage (S531). After executing step S531, the controller 500 stores the first voltage V51 at which the current value I detected by the current sensor SSA becomes the first current value I51 in the storage 510 (S532).

After executing step S532, the controller 500 stores the second voltage V52 at which the current value I detected by the current sensor SSA becomes the second current value I52 in the storage 510 (S533). After executing step S533, the controller 500 calculates the first function FU1 based on the current values I51, I52 and the voltages V51, V52 (S534) and ends this control.

Returning back to FIG. 71, after executing step S512, the controller 500 changes the pressure PR to the second pressure PR2 (S513). After executing step S513, the controller 500 executes the function calculation process similarly to that described above (S514). Specifically, the controller 500 changes the pressure PR in step S513 and then executes steps S531 to S534 illustrated in FIG. 72 to thereby calculate the first voltage V511 (S532) and the second voltage V512 (S533) different from the above first voltage V51 and second voltage V52, respectively, and calculate the second function FU2 different from the first function FU1 in step S534.

After executing step S514, the controller 500 calculates the third function FU3 based on the functions FU1, FU2 and the pressures PR1, PR2 (S515). After executing step S515, the controller 500 sets the fourth pressure PR4 to be applied to the fixing solution L in the standby state and the print control on the basis of the third function FU3, the target voltage VA5, and the resolution of the pressurization device 575 (S516). The print control includes preparation control and the spray control.

After executing step S516, the controller 500 calculates the fourth function FU4 based on the fourth pressure PR4 and the third function FU3 (S517). After executing step S517, the controller 500 determines whether the fourth pressure PR4 is larger than a maximum pressure PRmax which is the maximum pressure that the pressurization device 575 can apply (S518).

When in S518 determining that PR4>PRmax (Yes), the controller 500 turns ON the heater 577 (S519) to heat the fixing solution L. The lower the temperature of the fixing solution L is, the higher the viscosity thereof becomes. So, the lower the temperature is, the higher a pressure needs to be for the spray control. The fourth pressure PR4 is set in consideration of the state (viscosity) of the fixing solution L, so that PR4>PRmax indicates that the viscosity of the fixing solution L is high, that is, the temperature is low. Thus, when the temperature of the fixing solution L is low, the heater 577 is turned ON to heat the fixing solution L in step S519, whereby the viscosity of the fixing solution L can be lowered.

After executing step S519, the controller 500 determines whether a prescribed reference time period has elapsed from the turning ON of the heater 577 (S520). The controller 500 repeats step S520 until the reference time period elapses. When determining in step S520 that the reference time period has elapsed (Yes), the controller 500 returns to step S511. As a result, the fourth pressure PR4 is set again in a state where the viscosity of the fixing solution L is reduced, so that the fourth pressure PR4 is set to a value smaller than the previous one.

When determining in step S518 that PR4 PRmax (No), the controller 500 turns OFF the heater 577 when the heater is turned ON in step S519 (S521). When directly shifting to step S521 without passing through step S519, the controller 500 maintains the heater 577 in an OFF state in step S521.

After executing step S521, the controller 500 sets the pressure PR to the fourth pressure PR4 (S522) and ends this control.

Figure 73:
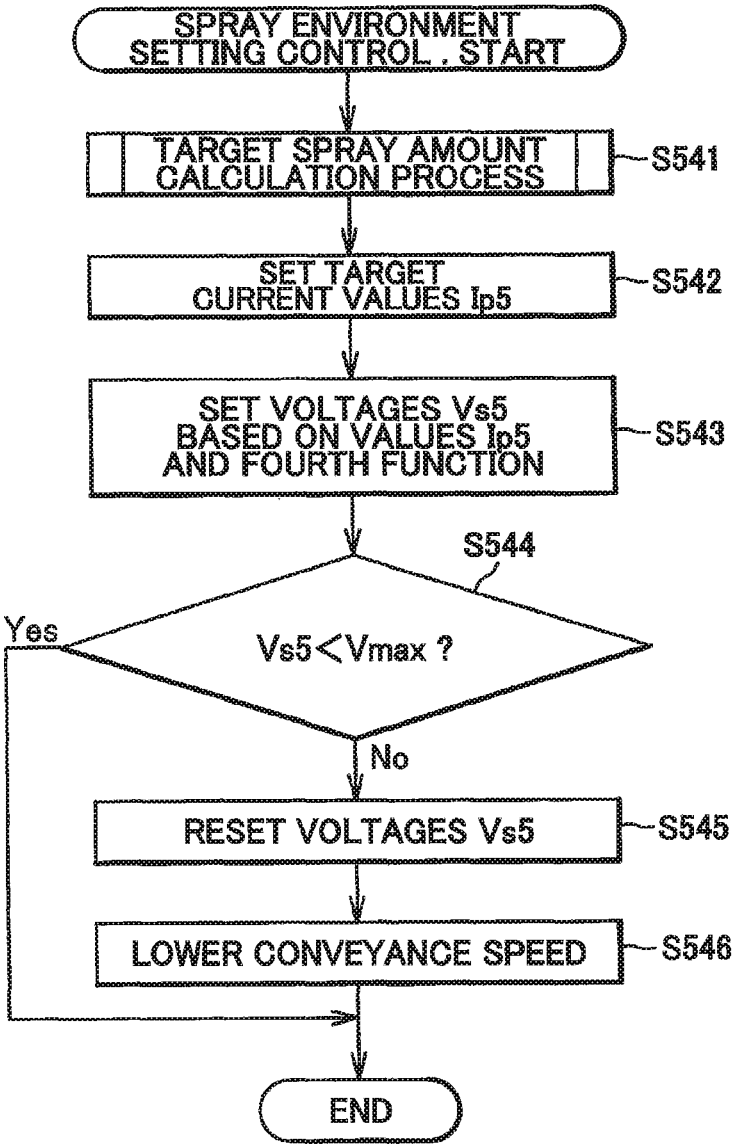
FIG. 73 is a flowchart illustrating a spray environment setting control.

As illustrated in FIG. 73, the controller 500 executes spray environment setting control for setting environment for the spray control before the execution of the spray control. The spray environment setting control is executed during the time period from a time when the controller 500 receives a print instruction and before feeding of the paper P is started. For example, the spray environment setting control is started when the controller 500 receives a print instruction and is ended before the start of the feeding of the paper P.

Figure 74:
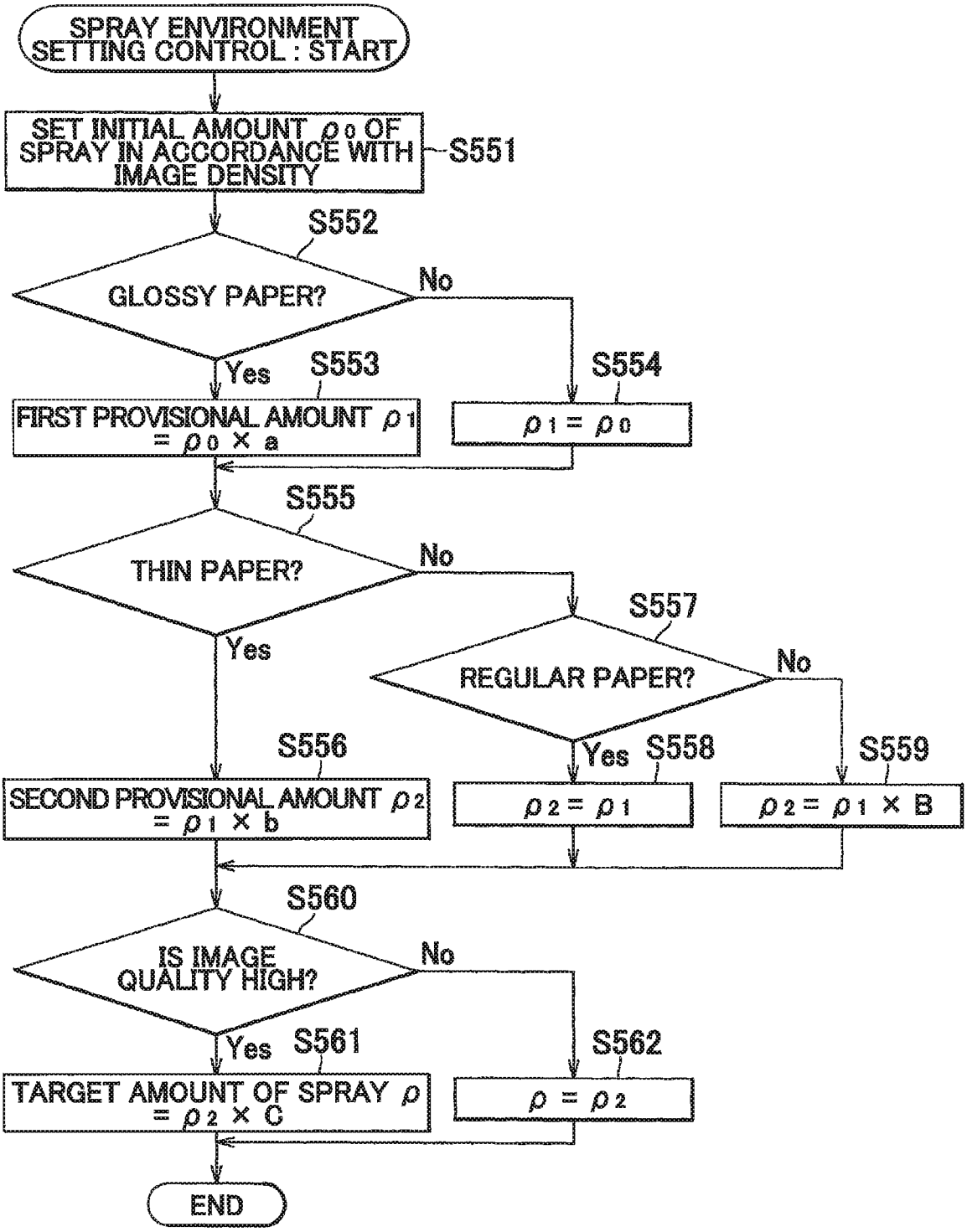
FIG. 74 is a flowchart illustrating a target spray amount calculation process.

In the spray environment setting control, the controller 500 first executes a target spray amount calculation process for calculating a target amount ρ of spray (S541). As illustrated in FIG. 74, in the target spray amount calculation process, the controller 500 first sets an initial amount $\rho_0$ of spray in accordance with image density based on image data included in the print instruction (S551). Specifically, in step S551, the controller 500 sets the amount $\rho_0$ to a larger value as image density becomes higher. The amount $\rho_0$ may be set for each paper P. Here, the amount $\rho_0$ may be set in accordance with the image density of the entire image formation region of the corresponding paper P. Alternatively, the amount $\rho_0$ may be set for each of a plurality of divided regions of the image formation region of each single paper P so as to be in accordance with the image density of each divided region.

After executing step S551, the controller 500 determines, on the basis of the print instruction, whether the paper P is a glossy paper (S552). When determining in step S552 that the paper P is a glossy paper (Yes), the controller 500 multiplies the amount $\rho_0$ by a coefficient "a" smaller than 1 to calculate a first provisional amount $\rho_1$ of spray (S553). That is, in step S553, the first provisional amount $\rho_1$ is set to a value smaller than the amount $\rho_0$. When determining in step S552 that the paper P is not a glossy one (No), the controller 500 sets the first provisional amount $\rho_1$ to the value of the amount $\rho_0$ (S554).

After executing step S553 or S554, the controller 500 determines, on the basis of the print instruction, whether the paper P is a thin paper (SSSS). When determining in step S555 that the paper P is a thin paper (Yes), the controller 500 multiplies the amount $\rho_1$ by a coefficient "b" smaller than 1 to calculate a second provisional amount $\rho_2$ of spray (S556). That is, in step S556, the second provisional amount $\rho_2$ is set to a value smaller than the amount $\rho_1$.

When determining in step S555 that the paper P is not a thin paper (No), the controller 500 determines, on the basis of the print instruction, whether the paper P is a regular paper (plain paper) (S557). When determining in step S557 that the paper P is a regular paper (Yes), the controller 500 sets the second provisional amount $\rho_2$ to the value of the first provisional amount $\rho_1$ (S558).

When determining in step S557 that the paper P is not a regular one (No), that is, when the paper P is a thick paper, the controller 500 multiplies the first provisional amount $\rho_1$ by a coefficient "B" larger than 1 to calculate the second provisional amount $\rho_2$ (S559). That is, in step S559, the second provisional amount $\rho_2$ is set to a value larger than the first provisional amount $\rho_1$.

After executing step S556, S558, or S559, the controller 500 determines, on the basis of the print instruction, whether image quality is high (S560). When determining in step S560 that image quality is high (Yes), the controller 500 multiplies the amount $\rho_2$ by a coefficient C larger than 1 to calculate the target amount ρ (S561). That is, in step S561, the target amount ρ is set to a value larger than the second provisional amount $\rho_2$.

When determining in step S560 that image quality is not high (No), the controller 500 sets the target amount ρ to the value of the amount $\rho_2$ (S562). After executing step S561 or S562, the controller 500 ends this control.

Returning back to FIG. 73, after executing step S541, the controller 500 sets a plurality of target current values Ip5 based on the plurality of target amounts p (S542). After executing step S542, the controller 500 sets a plurality of voltages Vs5 for spraying based on the plurality of target current values Ip5 and the fourth function FU4 (S543).

After executing step S543, the controller 500 determines whether all the plurality of voltage Vs5 for spraying are smaller than the upper limit Vmax (S544). When determining in step S544 that all the voltage Vs5 for spraying are smaller than the upper limit Vmax (Yes), the controller 500 ends this control.

When determining in step S544 that at least one voltage Vs5 for spraying is equal to or larger than the upper limit Vmax (No), the controller 500 performs correction to multiply all the voltages Vs5 for spraying by a prescribed coefficient such that the voltage Vs5 equal to or larger than the upper limit Vmax becomes smaller than the upper limit Vmax to thereby reset the voltages Vs5 (S545). After executing step S545, the controller 500 sets the conveyance speed to a value lower than the initial value thereof (S546) and ends this control.

Figure 75:
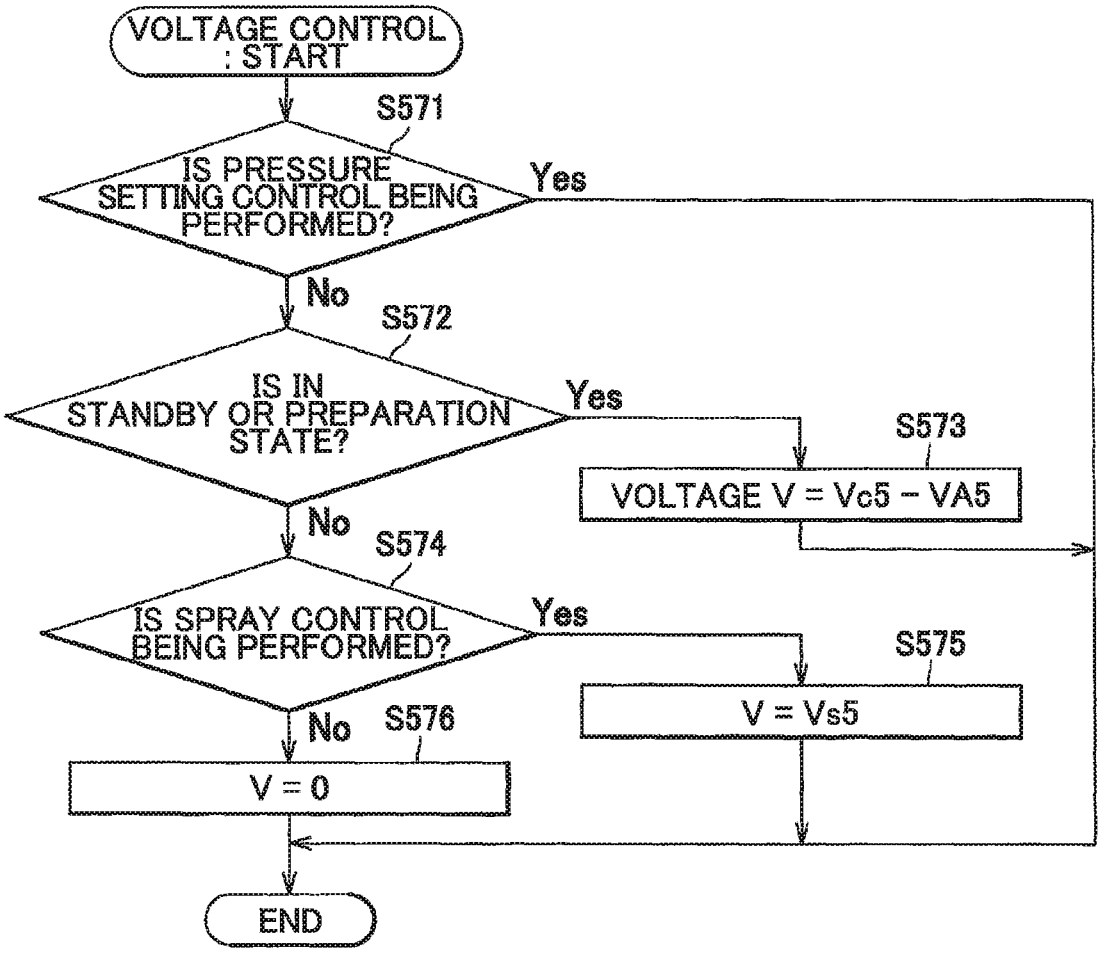
FIG. 75 is a flowchart illustrating a voltage control.

As illustrated in FIG. 75, when the laser printer 501 is activated (START), the controller 500 starts voltage control. In the voltage control, the controller 500 first determines whether the pressure setting control is being performed (S571). When determining in step S571 that the pressure setting control is being performed (Yes), the controller 500 ends this control.

When determining in step S571 that the pressure setting control is not being performed (No), the controller 500 determines whether the present state is in the standby state or preparation state (S572). When determining in step S572 that the present state is in the standby state or the preparation state (Yes), the controller 500 sets the voltage V applied to the first electrode 574 to Vc5-VA5, i.e., the seventh voltage V57 (S573) and ends this control.

When determining in step S572 that the present state is neither in the standby state nor the preparation state (No), the controller 500 determines whether the spray control is being performed (S574). When determining in S574 that the spray control is being performed (Yes), the controller 500 sets the voltage V to the voltage Vs5 for spraying (S575) and ends this control.

When determining in step S574 that the spray control is not being performed (No), the controller 500 sets the voltage V to 0 (S576) and ends this control.

According to the sixth embodiment, the following effects can be obtained.

By grasping the first voltage V51 corresponding to the first current value I51 in a state where the print control is not performed, the state (viscosity) of the fixing solution L can be grasped. That is, the state of the fixing solution L can be grasped before the execution of the print control, whereby spray control appropriate for the state of the fixing solution L can be executed during the print control.

The first and second current values I51 and I52 used in the state grasping control are made to fall within the range of a current value used in the spray control, so that the first and second voltages V51 and V52 stored in the storage 510 in the state grasping control can be used in the spray control, whereby the spray control can be performed satisfactorily.

The first function FU1 is calculated on the basis of the first and second voltages V51 and V52, and the voltage Vs5 for spraying is identified on the basis of the first function FU1 and the target current value Ip5. Accordingly, even when the target current value Ip5 differs from the first and second current values I51 and I52, the voltage Vs5 for the target current value Ip5 can be identified.

The pressure in the standby state or the preparation state is determined on the basis of the third function FU3. Accordingly, the fixing solution L can be prevented from being sprayed in the standby state or preparation state.

The intercept voltage Vc5 of the fourth function FU4 is set to a value larger than the target voltage VA5, so that the fixing solution L can be prevented from dripping when the voltage V is not being applied.

By applying the seventh voltage V57 corresponding to the difference between the intercept voltage Vc5 and the target voltage VA5 to the first electrode 574 in the standby state or the preparation state, the interface of the fixing solution L at the tip of the nozzle with air can be set in a substantially flat state from a state recessed to the fixing solution L side. Thus, the surface area of the interface can be reduced to thereby prevent the fixing solution L at the tip of the nozzle from drying.

Both the state grasping control and the spray control are executed for each of the plurality of fixing heads 571A to 571C individually. Accordingly, the spray control appropriate for the state of the fixing solution L can be executed for each of the fixing heads 571A to 571C.

The state grasping control is executed every time a prescribed time period elapses, that is, every time an environmental change may occur, so that the state of the fixing solution L can be grasped accurately.

The state grasping control is executed every time a temperature difference occurs, so that the state of the fixing solution L can be grasped accurately.

The state grasping control is executed every time the fixing-solution cartridge 576 is replaced by a new one, so that the state of the fixing solution L supplied from the new fixing-solution cartridge 576 to the fixing head 571 can be grasped accurately.

By setting the voltage Vs5 for spraying to a value smaller than the upper limit Vmax, separation of the fixing solution L, which may occur due to application of a voltage equal to or larger than the upper limit Vmax to the fixing solution L, can be prevented. Further, when the voltage Vs5 is equal to or larger than the upper limit Vmax, the voltage Vs5 is reset to a value smaller than the upper limit Vmax, resulting in a reduction in the amount of spray. In this case, however, by lowering the conveyance speed of the paper P, the amount of spray per unit area can be increased to a required level. Thus, the spray control can be continued with a lower conveyance speed.

The present invention can be used in various embodiments as described below as examples without limited to the sixth embodiment. In the following description, any member having substantially the same structure as that of the sixth embodiment will be given the same reference numeral, and the description thereof will be omitted.

Figure 76:
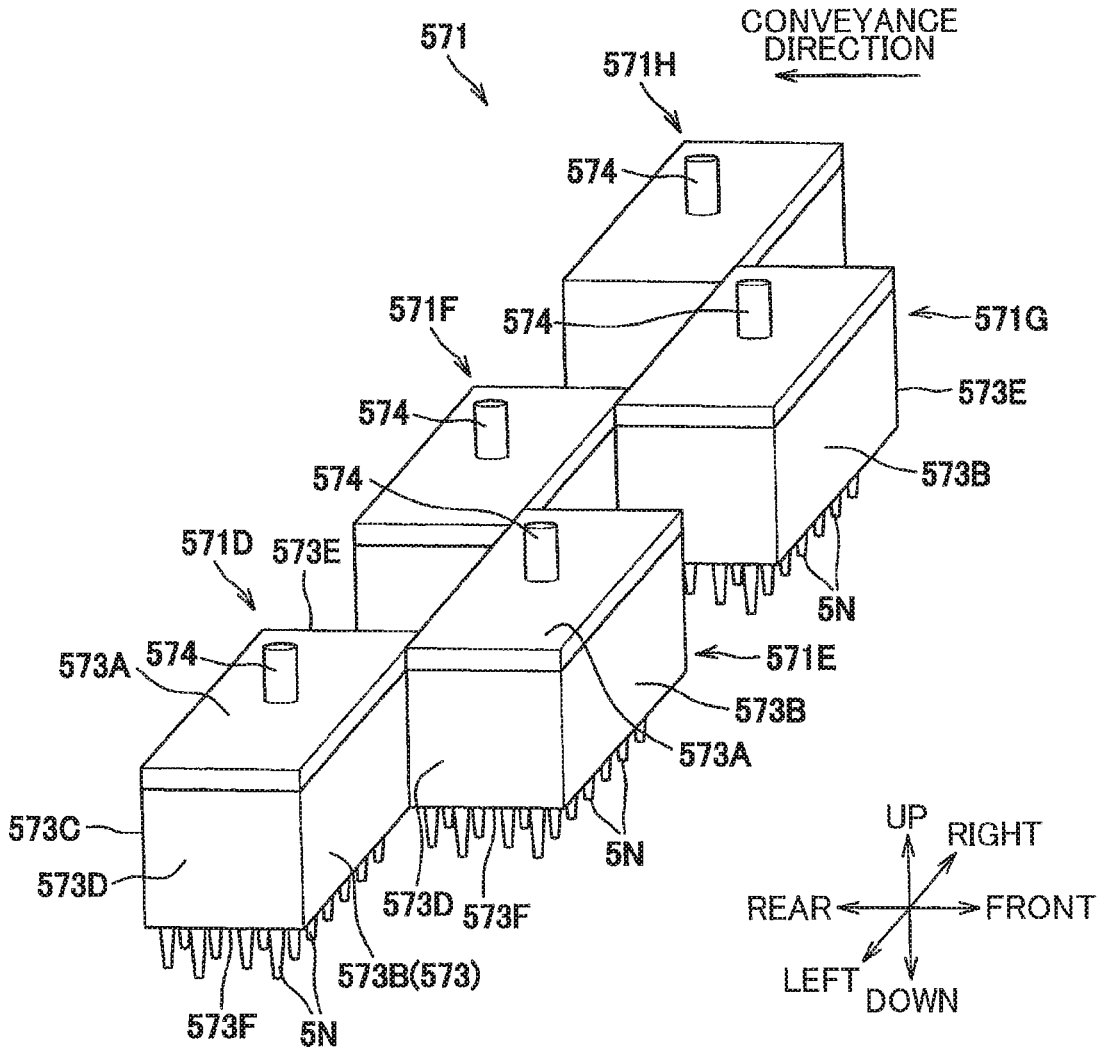
FIG. 76 is a perspective view illustrating fixing heads arrayed in left-right direction.

In the above sixth embodiment, the fixing heads 571A to 571C are arranged in the conveyance direction. However, the present invention is not limited to this, and as illustrated in FIG. 76, a plurality of fixing heads 571D to 571H may be arranged in the left-right direction for example. Each of the fixing heads 571D to 571H is substantially the same in configuration as the first fixing head 571A according to the sixth embodiment except for its size. So, the same reference numerals as those given to the components (nozzle 5N, etc.) constituting the fixing head 571D to 571H are given to those constituting each of the other fixing heads 471B to 471E, and description thereof will be omitted. Alternatively, the number of fixing heads may be reduced to one.

Figure 77:
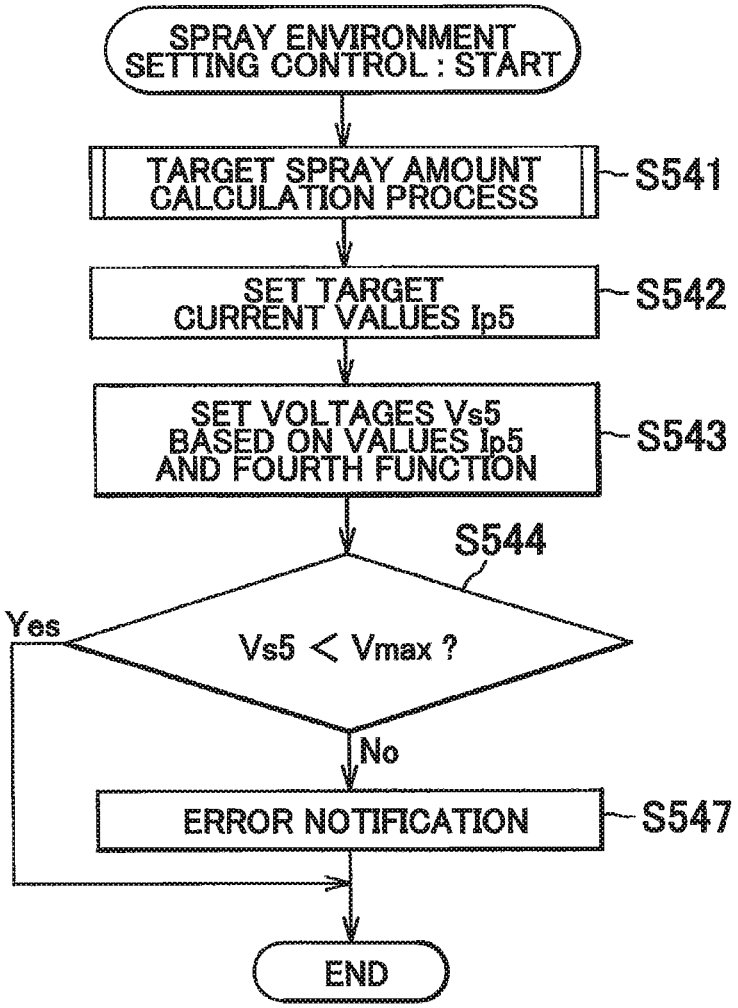
FIG. 77 is a flowchart illustrating a spray environment setting control according to a modification.

In the above sixth embodiment, when the voltage Vs5 for spraying is equal to or larger than the upper limit Vmax, the voltage Vs5 is reset to a value smaller than the upper limit Vmax, and the conveyance speed is lowered. However, the present invention is not limited to this. Specifically, as illustrated in FIG. 77, when the voltage Vs5 for spraying is equal to or larger than the upper limit Vmax (No in S544), the spray control may be stopped with error notification (S547). In this case, separation of the fixing solution L, which may occur due to the application of a voltage equal to or larger than the upper limit Vmax to the fixing solution L, can be prevented.

In the above sixth embodiment, in the state grasping control, the state of the fixing solution L is grasped by calculating the functions FU1 to FU3. However, the present invention is not limited to this, and the state of the fixing solution L may be grasped not from the functions but from the first voltage. Specifically, the higher the viscosity of the fixing solution, the higher the first voltage required for a current having the first current value becomes. By utilizing this, the state of the fixing solution can be grasped. Then, by utilizing the relationship between the first current value and the first voltage, the voltage to be used in the spray control can be determined. That is, the spray control can be executed on the basis of the first voltage.

In the above sixth embodiment, the pressure is adjusted in accordance with the state of the fixing solution L. However, the present invention is not limited to this, and the constant pressure may be applied to the fixing solution L irrespective of the state of the fixing solution L. When the pressure is set to a constant value, e.g., the first pressure PR1, only the first function FU1 may be calculated. That is, the voltage Vs5 for spraying may be determined on the basis of the first function FU1 and the target current value 5Ip.

In this case, the voltage to be applied to the first electrode 574 in the standby state or the preparation state is desirably set to the third voltage. Here, the third voltage is equal to or larger than 0, and equal to or smaller than a value at which the current value becomes 0 in the first function FU1. This can prevent the fixing solution L from being sprayed in the standby state or the preparation state.

In the above sixth embodiment, the pressurization device 575 that pressurizes air inside the fixing-solution cartridge 576 is exemplified as a pressure applying means. However, the present invention is not limited to this, and, for example, a pressurization device having a pump and a reducing valve may be used. Here, the pump feeds the fixing solution L from the fixing-solution cartridge 576 into the fixing heads 571A to 571C for pressurization of air in the fixing heads 571A to 571C. The reducing valve releases the fixing solution L from the fixing heads 571A to 571C for depressurization.

In the sixth embodiment, the present invention is applied to the laser printer 501. However, the present invention is not limited to this, and may be applied to other image forming devices, such as copying machines and multifunction peripherals.

In the sixth embodiment, the paper P, such as thick paper, postcard, or thin paper, is described as one example of recording sheet. However, the present invention is not limited to this, and the recording sheet may be a transparency film for example.

In the sixth embodiment, the first electrode 574 is disposed in the interior of the container portion 573. However, the present invention is not limited to this. For example, the nozzles and the container portions may be made of a conductive member such as a metal, and the nozzles or the container portion may be applied with a voltage. In this case, each nozzle or each container portion, which is applied with a voltage, functions as the first electrode. In another case, the container portion may be made of a non-conductive member such as a resin, the nozzles may be made of a conductive member such as a metal, and the nozzles may be applied with a voltage. In this case, each nozzle functions as the first electrode.

The second electrode 572 may not necessarily face the nozzles 5N, and may be shifted toward the upstream side or the downstream side in the conveyance direction, in which the paper is conveyed.

Figure 78:
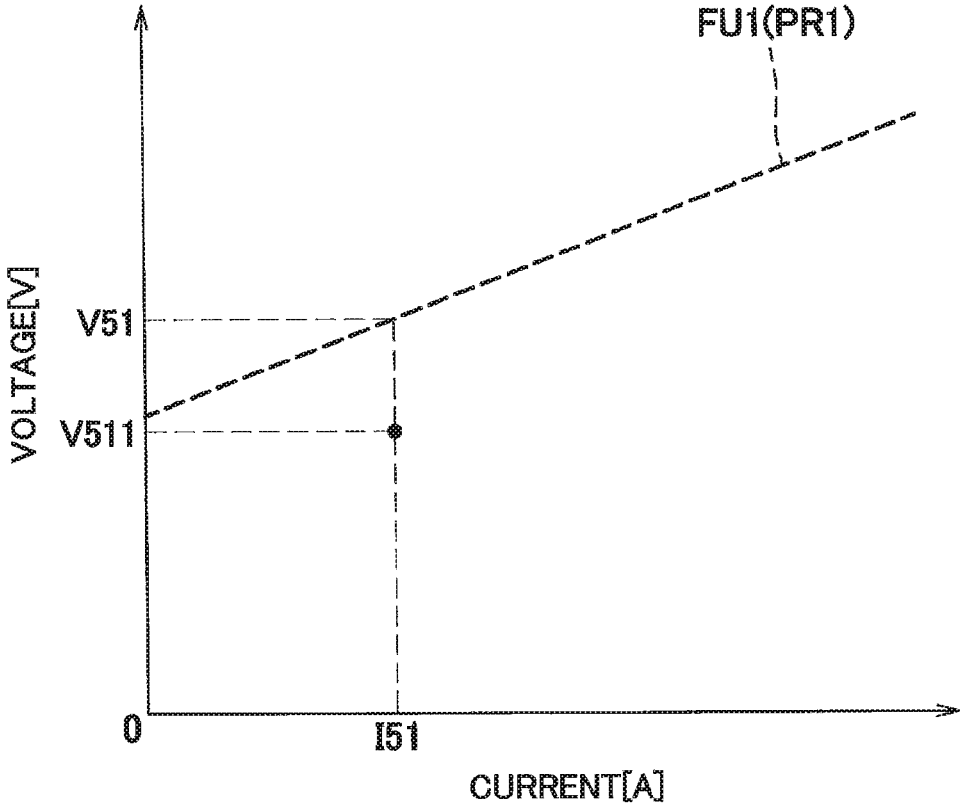
FIG. 78 is a graph for description of obtaining a first function according to a modification to the sixth embodiment.
Figure 79:
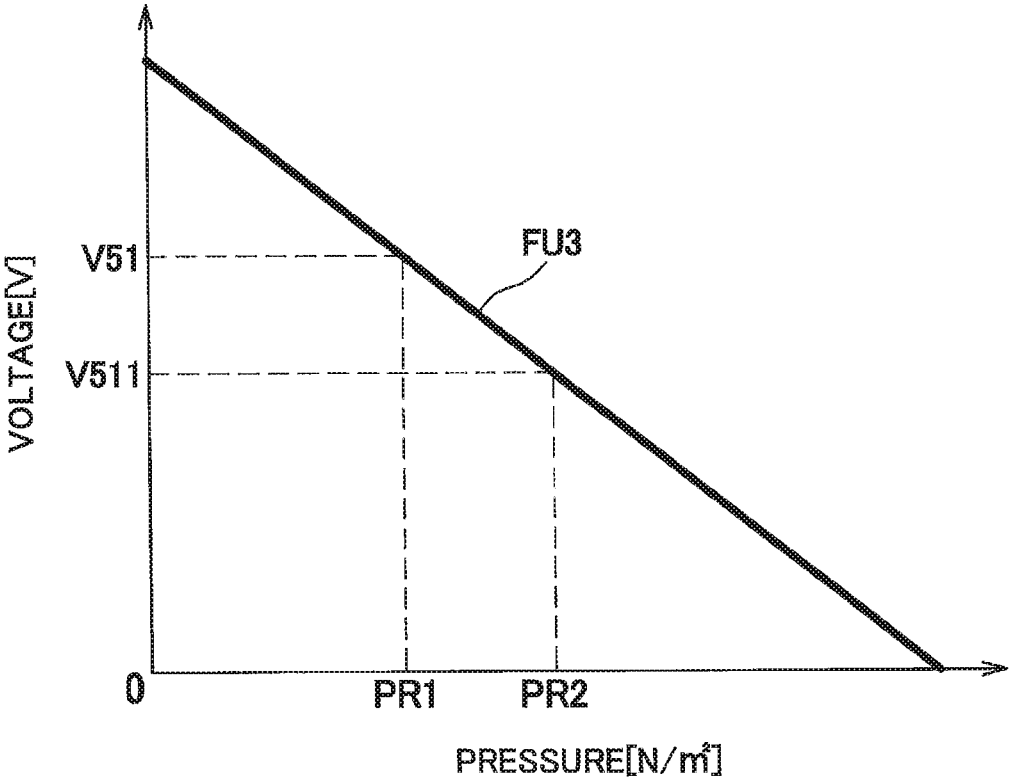
FIG. 79 is a graph for description of obtaining a third function according to a modification to the sixth embodiment.

In the above sixth embodiment, the third function FU3 representing the relationship between the pressure and the voltage is calculated on the basis of the intercept voltage Va5 of the first function FU1, the first pressure PR1 corresponding to the first function FU1, the intercept voltage Vb5 of the second function FU2, and the second pressure PR2 corresponding to the second function FU2. However, the present invention is not limited to this. For example, as illustrated in FIG. 78, the fourth function FU4 can be calculated by calculating the pressure and the voltage when the current value is I51. The third function FU3 illustrated in FIG. 79 may be calculated on the basis of the first pressure PR1, the first voltage V51, the second pressure PR2, and the first voltage V511. Here, the first voltage V51 is acquired when the pressure applied to the fixing solution L is the first pressure PR1. The second pressure PR2 is different from the first pressure PR1. The first voltage V511 is acquired when the pressure applied to the fixing solution L is the second pressure PR2. A calculation method for the third function FU3 is the same as that used in the sixth embodiment. A method for obtaining the fourth pressure 4 is also the same as that used in the sixth embodiment.

In the above sixth embodiment, in the state grasping control, the first voltage V51 acquired when a current flowing in a potential difference forming portion becomes a prescribed first current value I51 is stored in the storage 510. However, the present invention is not limited to this. For example, the first current value acquired when a voltage becomes a prescribed first voltage may be stored in the storage. In this case, the spray control may be executed based on the first current value stored in the storage.

The sixth object can be achieved by the sixth embodiment and any modification thereof described with reference to FIGS. 63 to 79. The above-described sixth embodiment is one example of the sixth invention, and the sixth invention is not limited to this.

A laser printer 601 of a seventh embodiment of the present invention will be explained with reference to FIGS. 80-96. In the seventh embodiment, like parts and components are designated with the same reference numerals as the first embodiment to avoid duplicating description. The laser printer 601 includes a fixing device 607.

Figure 80:
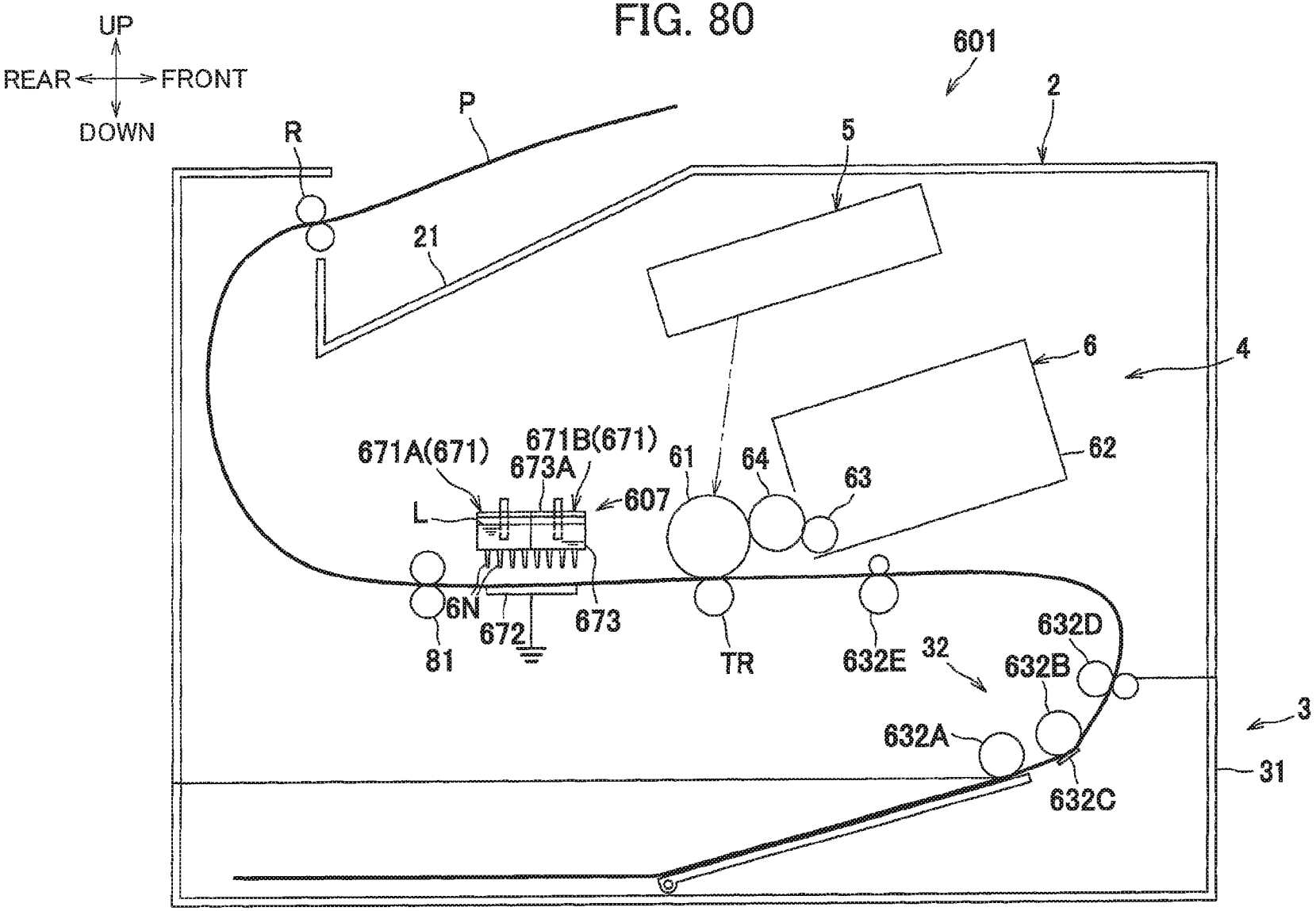
FIG. 80 is a view illustrating a laser printer provided with a fixing device according to a seventh embodiment of the present invention.

In the following description, directions are defined with respect to a position of a user using the laser printer. That is, the right side of FIG. 80 is defined as a front side, the left side of FIG. 80 is defined as a rear side, the far side of FIG. 80 is defined as a right side, and the near side of FIG. 80 is defined as a left side. The upward and downward directions of FIG. 80 are defined as an upward direction and a downward direction.

As illustrated in FIG. 80, the laser printer 601 has a casing 2, a feeder portion 3 configured to feed a paper 6P as an example of a recording sheet, and an image forming section 4 configured to form an image onto the paper 6P.

The feeder portion 3 has a paper feed tray 31 detachably attached to the lower portion of the casing 2 and a paper feed mechanism 32 that is configured to feed the paper 6P in the paper feed tray 31 toward the image forming section 4. The paper feed mechanism 32 has a feed roller 632A, a separation roller 632B, a separation pad 632C, a paper dust removal roller 632D, and a registration roller 632E. The registration roller 632E is configured to align the leading edge of the papers 6P and is appropriately stopped or rotated under control of a controller 600 described below.

The fixing device 607 is configured to supply a charged fixing solution L onto a toner image on the paper 6P by electrostatic spraying method to fix the toner image onto the paper 6P. The configuration of the fixing device 607 will be described later in detail.

A pair of downstream side conveyance rollers 81 is provided downstream of the fixing device 607. The pair of conveyance rollers 81 is configured to nip and convey the paper 6P discharged from the fixing device 607 to the downstream side. The paper 6P conveyed by the downstream side conveyance rollers 81 is then conveyed to a discharge roller R to be discharged onto a paper discharge tray 21.

Next, the configuration of the fixing device 607 will be described in detail.

Figure 81:
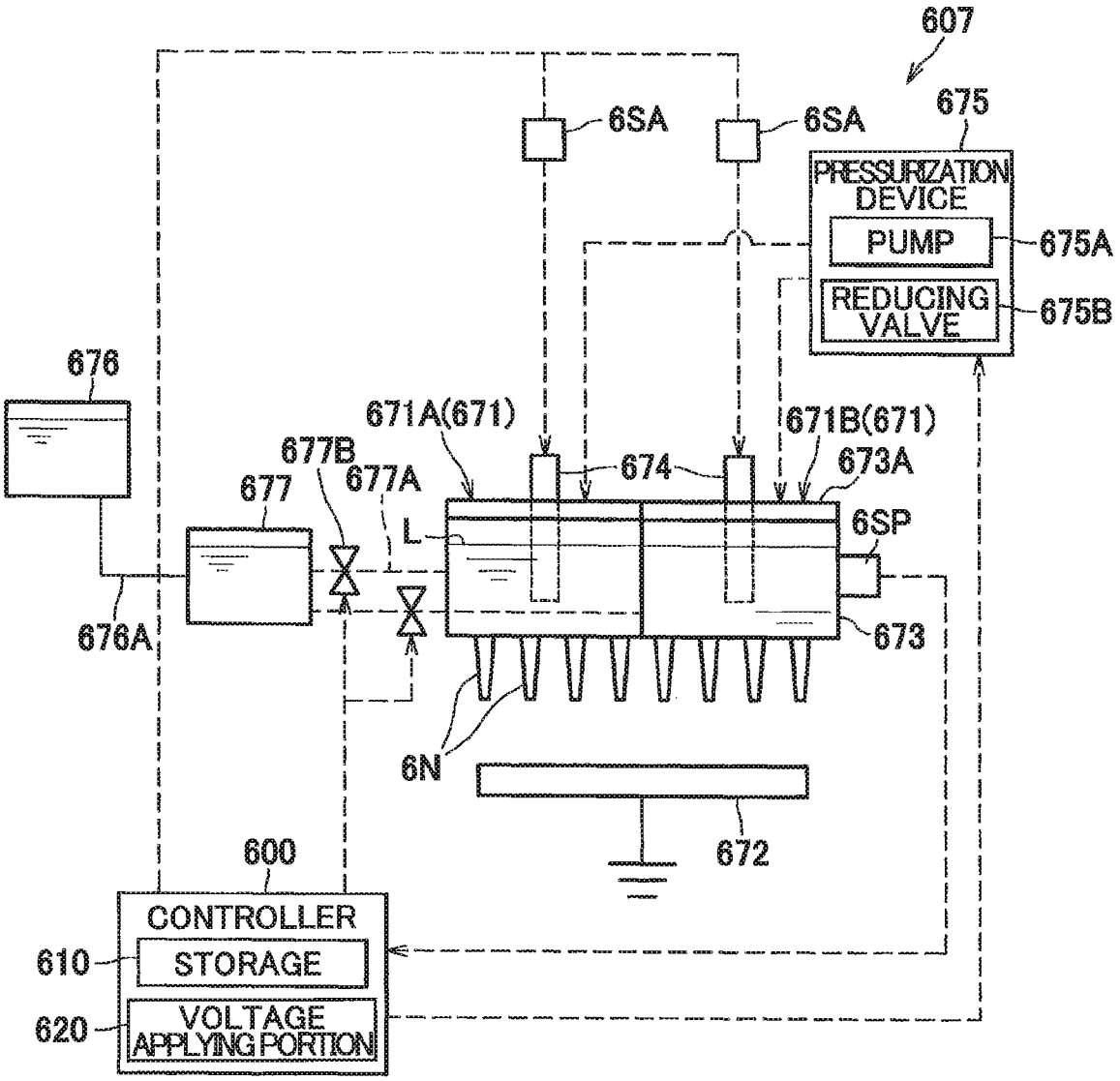
FIG. 81 is a view illustrating in detail the fixing device.

As illustrated in FIG. 81, the fixing device 607 has a fixing head 671 configured to spray the fixing solution L toward the toner image on the paper 6P, a second electrode 672 that is configured to support the paper 6P below the fixing head 671, a pressurization device 675, a fixing-solution cartridge 676, a tank 677, and the controller 600.

Figure 82A:
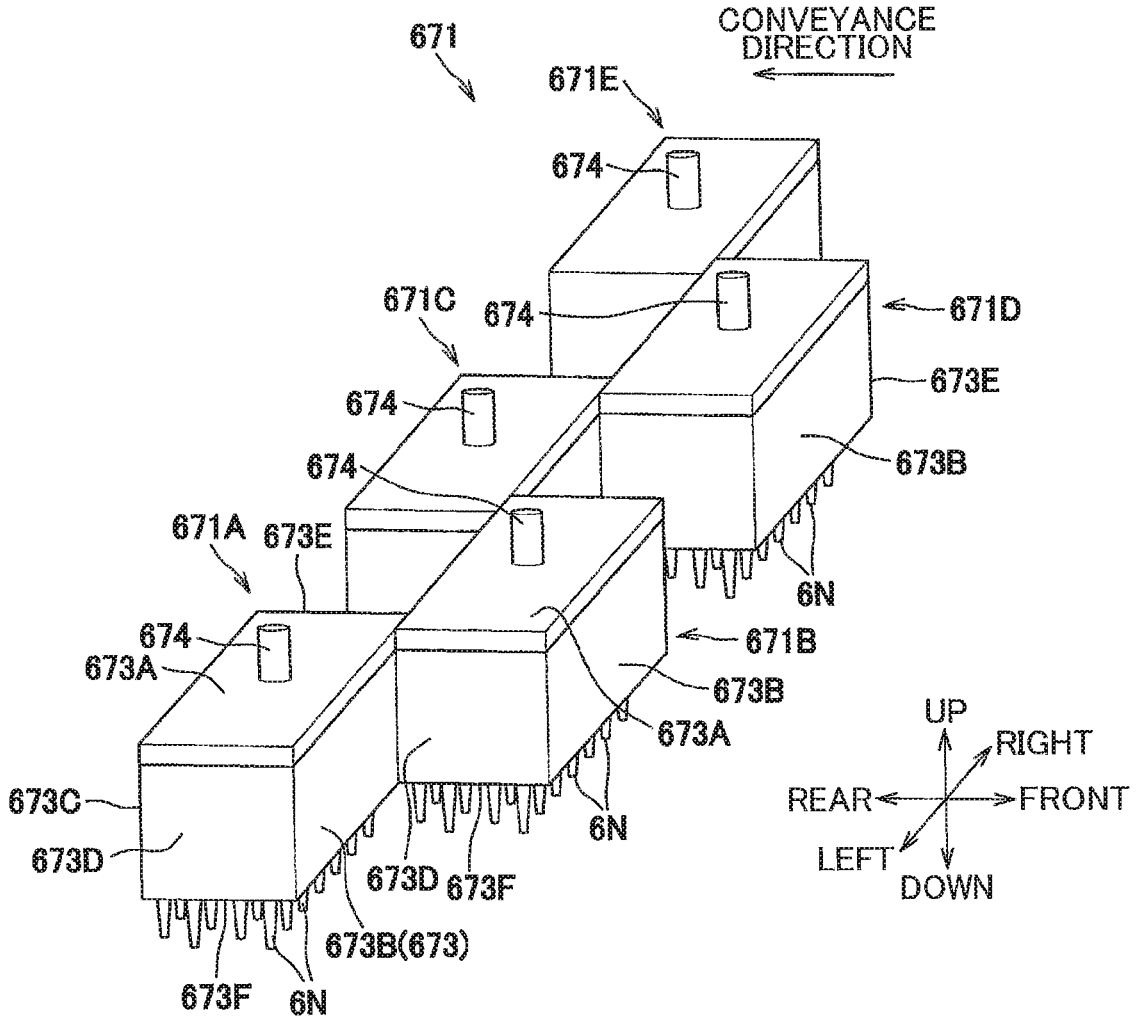
FIG. 82A is a perspective view of a fixing head as viewed from diagonally above.

As illustrated in FIG. 82A, the fixing head 671 has a first fixing head 671A, a second fixing head 671B, a third fixing head 671C, a fourth fixing head 671D, and a fifth fixing head 671E which are arranged in a staggered manner in the width direction of the paper 6P. The first fixing head 671A, the third fixing head 671C, and the fifth fixing head 671E are disposed at substantially the same position in the front-rear direction, i.e., in the conveyance direction of the paper 6P and disposed spaced apart from each other in the left-right direction, i.e., in the width direction of the paper 6P. The second fixing head 671B is disposed upstream of the first fixing head 671A and the third fixing head 671C in the conveyance direction such that the center of the second fixing head 671B in the width direction is located between the first fixing head 671A and the third fixing head 671C in the width direction. The fourth fixing head 671D is disposed upstream of the third fixing head 671C and the fifth fixing head 671E in the conveyance direction such that the center of the fourth fixing head 671E in the width direction is located between the third fixing head 671C and the fifth fixing head 671E in the width direction.

The first fixing head 671A has a container portion 673 that stores therein the fixing solution L, a plurality of nozzles 6N that communicates with the container portion 673 and is configured to spray the fixing solution L toward the toner image, and a first electrode 674 that is configured to apply a voltage to the fixing solution L in the container portion 673 and the nozzles 6N. The other fixing heads 671B to 671E have substantially the same configuration as the first fixing head 671A, so components of the other fixing heads 671B to 6471E are designated with the same reference numerals as those of the first fixing head 671A, and description thereof is omitted. That is, the fixing heads 671A-671E (container portions 673) are separately provided from one another and have the same shapes. Each container portion 673 includes the number of nozzles 6N arranged in the same manner. The numbers of nozzles 6N and arrangement of the nozzles 6N are the same among the fixing heads 671A-671E.

Figure 82B:
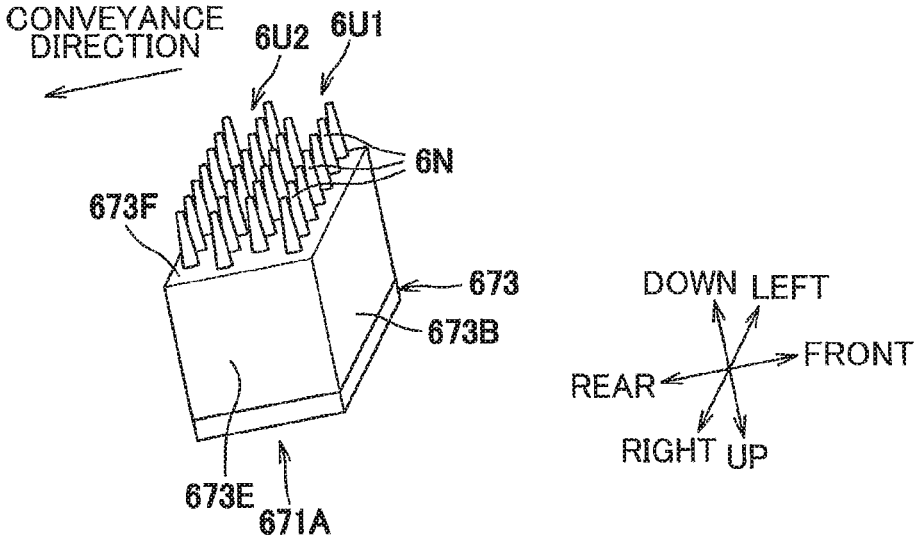
FIG. 82B is a perspective view of the fixing head as viewed from diagonally below.

The container portion 673 is an insulating container having a rectangular shape elongated in the width direction and has a top wall 673A, a front wall 673B, a rear wall 673C, a left wall 673D, a right wall 673E, and a bottom wall 673F. As illustrated in FIG. 82B, the plurality of nozzles 6N in each of the fixing heads 671A-671E protrudes downward from the bottom wall 673F with their diameters gradually reduced as they extend downward. The plurality of nozzles 6N is arranged in both of the width and conveyance directions.

Figure 83:
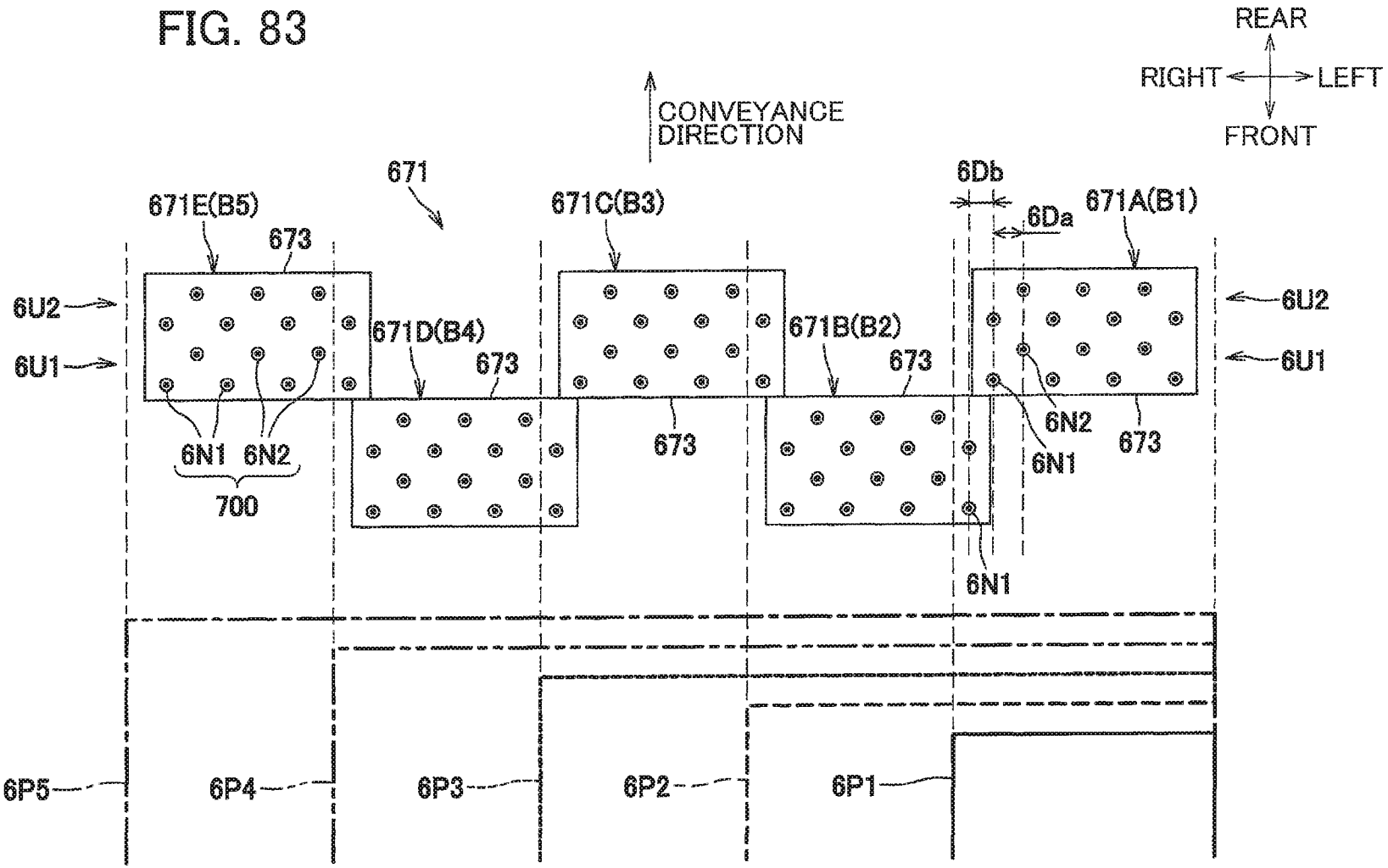
FIG. 83 is a bottom view of the fixing head.

Specifically, the plurality of nozzles 6N constitutes a first staggered array group 6U1 and a second staggered array group 6U2. The first staggered array group 6U1 and the second staggered array group 6U2 are arranged in the conveyance direction. As illustrated in FIG. 83, the first staggered array group 6U1 includes a plurality of first nozzles 6N1 arranged at regular intervals in the width direction and a plurality of second nozzles 6N2 arranged at regular intervals in the width direction. In the first staggered array group 6U1, the first nozzles 6N1 and the second nozzles 6N2 are alternately arranged in the width direction with the first nozzles 6N1 disposed in one side with respect to the conveyance direction and with the second nozzles 6N2 disposed in the other side with respect to the conveyance direction.

Each second nozzle 6N2 is disposed between two first nozzles 6N1 in the width direction. A shape formed by connecting two first nozzles 6N1 adjacent to each other in the width direction and the second nozzle 6N2 disposed between the two first nozzles 6N1 is an equilateral triangle or an isosceles triangle. Similarly, a shape formed by connecting two second nozzles 6N2 adjacent to each other in the width direction and the first nozzle 6N1 disposed between the two second nozzles 6N2 is an equilateral triangle or an isosceles triangle.

The second staggered array group 6U2 has the same structure as that of the first staggered array group 6U1. In the seventh embodiment, a nozzle pitch (the shortest distance between the outer peripheries of the adjacent nozzles) may be set in a range equal to or larger than 1 mm and equal to or smaller than 14 mm.

Two fixing heads (e.g., first and second fixing heads 671A and 671B) adjacent to each other in the width direction are disposed such that the container portions 673 thereof overlap each other when viewed in the conveying direction. Specifically, the minimum pitch (e.g., pitch between the first nozzle 6N1 and the second nozzle 6N2) of the plurality of nozzles 6N in the width direction in a prescribed fixing head (e.g., the first fixing head 671A) is 6Da. On the other hand, a distance 6Db is smaller than the minimum pitch 6Da. Here, the distance 6Db is a distance from one nozzle 6N of a prescribed fixing head (e.g., the rightmost first nozzle 6N1 of the first fixing head 671A) to another nozzle 6N of another fixing head (e.g., the leftmost first nozzle 6N1 of the second fixing head 671B). Specifically, the one nozzle 6N is an end nozzle disposed at one end side in the width direction among nozzles 6N in the prescribed fixing head. The another fixing head is disposed adjacent to the prescribed fixing head at the one end side of the prescribed fixing head in the width direction. The another nozzle 6N is an end nozzle disposed at an end side opposite to the one end side in the width direction among nozzles 6N in the another fixing head.

Fixing regions B1-B5 are set for respective fixing heads 671A-671E. Each of the fixing regions B1-B5 is a region to which the nozzles of the corresponding one of the fixing heads 671A-671E spray the fixing solution L toward the paper P4. The fixing heads 671A-671E are disposed such that the fixing regions B1-B5 overlap one another when viewed in the conveyance direction. In the seventh embodiment, for descriptive convenience, it is assumed that the fixing regions B1-B5 of the respective fixing heads 671A-671E have the same in shape, size, and position as those of the lower surfaces of corresponding container portions 673.

More specifically, the first fixing region B1 overlaps the second fixing region B2 when viewed in the conveyance direction. Here, the fixing solution L is sprayed from the first fixing head 671A to the first fixing region B1 and the fixing solution L is sprayed from the second fixing head 671B to the second fixing region B2. Further, the fifth fixing region B5 overlaps the fourth fixing region B4 when viewed in the conveyance direction. Here, the fixing solution L is sprayed from the fifth fixing head 671E to the fifth fixing region B5 and the fixing solution L is sprayed from the fourth fixing head 671D to the fourth fixing region B4.

Further, the third fixing region B3 overlaps the second fixing region B2 and the fourth fixing region B4 when viewed in the conveyance direction. Here, the fixing solution L is sprayed from the third fixing head 671C to the third fixing region B3. The arrangement of the fixing heads 671A-671E described above can suppress occurrence of a region between any two of the fixing heads 671A-671E to which the fixing solution L is not sprayed.

The first fixing head 671A is a head for spraying the fixing solution L to a first paper 6P1 having the narrowest width among a plurality of types of the papers 6P on which the laser printer 601 can print images. The first fixing head 671A has a width smaller than the width of the first paper 6P1. The first fixing head 671A is disposed within a range between the left and right ends of the first paper 6P1 in the left-right direction. More specifically, the first fixing region B1 of the first fixing head 671A is formed so as to have a width equal to or larger than the width of an image formation region of the first paper 6P1 on which an image is to be formed. That is, the entire width of the image formation region falls within the width of the first fixing region B1. The container portion 673 of the first fixing head 671A corresponds to a first container portion disposed in correspondence with the width of the first paper 6P1.

In the seventh embodiment, as illustrated in FIG. 83, the papers 6P1 to 6P5 having different paper widths are conveyed with the left ends thereof set as a reference. Specifically, a guide member (not illustrated) is provided in the casing 2 and is configured to contact and guide the left end of each of the papers 6P1 to 6P5.

The second fixing head 671B is adjacent to the right side (one side in the width direction) of the first fixing head 671A and is disposed left side (the other side in the width direction) of the right end of the second paper 6P2 having a width larger than the width of the first paper 6P1. Specifically, the right end of the second fixing region B2 of the second fixing head 671B is disposed at the same position as or right side of the right end of the image formation region of the second paper 6P2. The left end of the image formation region of the second paper 6P2 substantially coincides with the left end of the image formation region of the first paper 6P1. With this arrangement, the combination of the first fixing head 671A and the second fixing head 671B can spray the fixing solution L to the image formation region of the second paper 6P2. The container portion 673 of the first fixing head 671B corresponds to a second container portion disposed in correspondence with the width of the second paper 6P2 that is wider than the width of the first paper 6P1.

The third fixing head 671C is adjacent to the right side of the second fixing head 671B and is disposed left side of the right end of the third paper 6P3 having a width larger than the width of the second paper 6P2. Specifically, the right end of the third fixing region B3 of the third fixing head 671C is disposed at the same position as or right side of the right end of the image formation region of the third paper 6P3. The left end of the image formation region of the third paper 6P3 substantially coincides with the left end of the image formation region of the first paper 6P1. With this arrangement, the combination of the first fixing head 671A, the second fixing head 671B, and the third fixing head 671C can spray the fixing solution L to the image formation region of the third paper 6P3. The container portion 673 of the first fixing head 671C corresponds to a third container portion disposed in correspondence with the width of the third paper 6P3 that is wider than the width of the second paper 6P1.

The fourth fixing head 671D is adjacent to the right side of the third fixing head 671C and is disposed left side of the right end of the fourth paper 6P4 having a width larger than the width of the third paper 6P3. Specifically, the right end of the fourth fixing region B4 of the fourth fixing head 671D is disposed at the same position as or right side of the right end of the image formation region of the fourth paper 6P4. The left end of the image formation region of the fourth paper 6P4 substantially coincides with the left end of the image formation region of the first paper 6P1. With this arrangement, the combination of the first to fourth fixing heads 671A to 671D can spray the fixing solution L to the image formation region of the fourth paper 6P4.

The fifth fixing head 671E is adjacent to the right side of the fourth fixing head 671D and is disposed left side of the right end of the fifth paper 6P5 having a width larger than the width of the fourth paper 6P4. Specifically, the right end of the fifth fixing region B5 of the fifth fixing head 671E is disposed at the same position as or right side of the right end of the image formation region of the fifth paper 6P5. The left end of the image formation region of the fifth paper 6P5 substantially coincides with the left end of the image formation region of the first paper 6P1. With this arrangement, the combination of the first to fifth fixing heads 671A-671E can spray the fixing solution L to the image formation region of the fifth paper 6P5.

Referring back to FIG. 81, the first electrode 674 is an electrode that applies a voltage to the fixing solution L in the container portion 673 to generate an electric field at the tip of each nozzle 6N. The first electrode 674 is provided so as to penetrate the top wall 673A of the container portion 673 from the top to the bottom of the top wall 673A. The lower end portion of the first electrode 674 is disposed in the fixing solution L in the container portion 673 and in contact with the fixing solution L, and the upper end portion thereof is connected to the controller 600 having the voltage applying portion 620. The voltage to be applied to the first electrode 674 is preferably in a range from 1 kV to 10 kV.

A pressurization device 675, which is an example of a pressure applying means, is connected to the fixing heads 671A-671E. The pressurization device 675 is a device that applies a pressure to the fixing solution L in the fixing heads 671A-671E. The pressurization device 675 has a pump 675A that pressurizes air in the fixing heads 671A-671E and a reducing valve 675B that releases the air from the fixing heads 671A-671E so as to depressurize thereof. Further, each of the fixing heads 671A-671E has a pressure sensor 6SP (in FIG. 81, only one pressure sensor 6SP is illustrated as a representative example) that detects the pressure of the fixing solution L therein.

The second electrode 672 is an electrode that is configured to contact the paper 6P to form a potential difference between the fixing solution L in the nozzle 6N and the paper 6P and is disposed below the fixing heads 671A-671E so as to be separated from the tips of the nozzles 6N of the fixing heads 671A-671E by a prescribed distance. The prescribed distance is determined by experiments or simulations. Specifically, the prescribed distance is set to a value larger than the thickness of the paper 6P so that electrostatic spraying can be performed suitably.

The second electrode 672 is grounded. The second electrode 672 may not be grounded, and the second electrode 672 may be applied with a voltage lower than a voltage applied to the first electrode 674. The second electrode 672 forms an electric field between itself and the tips of the nozzles 6N.

An electric field is formed in a space around the tip of each nozzle 6N when a voltage is applied to the first electrode 674. Since the fixing solution L is supplied toward the tip of each nozzle 6N by the pressurization device 675, the second electrode 672 forms an electric field between the second electrode 672 and the fixing solution L in the tip of each nozzle 6N. Then, at the tip of each nozzle 6N, the fixing solution L is attracted by the electric field to form so-called Taylor cone. The fixing solution L is torn off from the tip of the Taylor cone, whereby a fine droplet is generated.

The droplet-like fixing solution L sprayed from the nozzle 6N is positively charged. On the other hand, the paper 6P is substantially in a zero potential state. Thus, the droplet-like fixing solution L flies toward the paper P by Coulomb force to adhere onto the paper P or toner image.

A current sensor 6SA is a sensor that detects a current flowing in the first electrode 674 to indirectly detect a current flowing in the fixing solution L and is provided corresponding to each first electrode 674. The current sensor 6SA detects a current flowing in the first electrode 674 when the fixing solution L is sprayed from the corresponding nozzles 6N to the paper 6P and outputs a detected value thereof to the controller 600. When the fixing solution L is not sprayed from the nozzle 6N, no current flows in the first electrode 674 even if a voltage is applied to the first electrode 674. A current flows in the first electrode 674 when the fixing solution L is sprayed from each nozzle 6N, in other words, when the charged fixing solution L is moved from each nozzle 6N to the paper 6P.

The first and second electrodes 674 and 672 having the above-configuration constitute a potential difference generating portion for generating a potential difference between the fixing solution L in the nozzles 6N and the paper 6P conveyed at a position separated from the nozzles 6N.

The fixing-solution cartridge 676 is a cartridge filled with the fixing solution L and is detachably attached to the casing 2. The fixing-solution cartridge 676 is connected to the tank 677 through a pipe 676A. The pipe 676A may be provided with a hydraulic pump for supplying the fixing solution L from the fixing-solution cartridge 676 to the tank 677 and a switching valve for switching between supply and stop of the fixing solution L.

The tank 677 is provided in the casing 2 and is connected to the container portions 673 of the respective fixing heads 671A to 671E through a plurality of pipes 677A. Each pipe 677A is provided with: a hydraulic pump for supplying the fixing solution L from the tank 677 to corresponding one of the fixing heads 671A to 671E; and a valve 677B for switching between supply and stop of the fixing solution L. The valve 677B is formed of an insulating member.

The controller 600 has a storage 610 including a RAM, a ROM, and the like, a voltage applying portion 620 configured to apply voltage to the first electrode 674, a CPU, and an input/output circuit. The controller 600 has a function to control the pressurization device 675, to control a voltage to be applied to the first electrode 674, or to control the valve 677B on the basis of image data inputted from an outside and signals from the sensors 6SP and 6SA.

Specifically, the controller 600 is configured to maintain a pressure applied to the fixing solution L in each of the fixing heads 671A-671E constant during print control on the basis of information from the pressure sensor 6SP. For example, in a state where no voltage is applied to the first electrode 674, the pressure applied to the fixing solution L can be set to a prescribed value so that the interface of the fixing solution L at the tip of the nozzle 6N with air is recessed to the fixing solution L side. When the pressure is low, the interface of the fixing solution L at the tip of the nozzle 6N has a substantially semi-spherical shape recessed to the fixing solution L side. As the pressure is gradually increased from this state, the semi-spherical interface is moved outward to gradually become close to a flat. When the pressure is further increased, the interface is moved further outward to be a substantially semi-spherical shape protruding outward. When the interface becomes close to a flat surface, the surface area thereof becomes minimum. The larger the surface area of the interface, the more easily the fixing solution L at the tip of the nozzle 6N is dried, and the higher the possibility that the tip of the nozzle 6N is clogged. Thus, the surface area of the interface is preferably small.

The controller 600 is configured to individually control voltages to be applied to the fixing solution L in the fixing heads 671A-671E. Specifically, in a standby state, the controller 600 sets a voltage V to be applied to the first electrode 674 of each of the fixing heads 671A-671E to a first voltage V61 at which the fixing solution L is not sprayed from the nozzle 6N. During print control, the controller 600 sets the voltage V to a second voltage V62 higher than the first voltage V61 for each of the fixing heads 671A-671E at a prescribed timing before the leading end of the paper 6P reaches a corresponding one of the fixing regions B1-B5. In other words, the controller 600 sets the voltage V to a second voltage V62 higher than the first voltage V61 for each of the fixing heads 671A-671E when the leading end of the paper 6P reaches a first position separated upstream from a corresponding one of the fixing regions B1-B5 by a prescribed first distance 6D1 (see FIGS. 89B and 89C), that is, when the distance from the leading end of the paper 6P to the corresponding one of the fixing regions B1-B5 is the first distance 6D1.

The first voltage V61 can be set to a voltage value larger than 0. When the pressure is set to the above-mentioned prescribed value, the first voltage V61 can be set to a voltage value at which the surface area of the interface between air and the fixing solution L at the tip of the nozzle 6N formed by voltage application is a value (e.g., minimum value) smaller than the maximum value. Further, the second voltage V62 can be set to a voltage value so that spraying can be performed but an amount of spray cannot reach a desired value.

That is, the first voltage V61 is a voltage applied to the first electrode 674 in a case where the fixing solution L is not sprayed. The second voltage V62 is a voltage applied to the first electrode 674 as a preparatory step for spraying the fixing solution L in a case where the fixing solution L is sprayed. When applying the first voltage V61 to the first electrode 674 corresponding to a prescribed fixing head (e.g., the first fixing head 671A), the controller 600 closes the valve 677B corresponding to a prescribed fixing head. That is, when not performing spray of the fixing solution L from a prescribed fixing head, the controller 600 closes the valve 677B corresponding to the prescribed fixing head.

When applying a voltage equal to or higher than the second voltage V62 to the first electrode 674 corresponding to a prescribed fixing head, the controller 600 appropriately opens/closes the valve 677B corresponding to the prescribed fixing head according to the amount of the fixing solution L in the prescribed fixing head.

Specifically, in a standby state, the controller 600 calculates a relational expression between a current flowing in the second electrode 672 and a voltage applied to the first electrode 674 and determines the second voltage V62 based on the relational expression. More specifically, as illustrated in FIG. 84, in a standby state, the controller 600 first controls the voltage V applied to each first electrode 674 such that the value of the current detected by the current sensor 6SA becomes a first current value Ia6 and then stores a first measured voltage Va6 at which the detected current value becomes the first current value Ia6 together with the first current value Ia6.

Then, the controller 600 controls the voltage applied to each first electrode 674 such that the detected current value becomes a second current value Ib6 different from the first current value Ia6 and then stores a second measured voltage Vb6 at which the detected current value becomes the second current value Ib6 together with the second current value Ib6.

Figure 84:
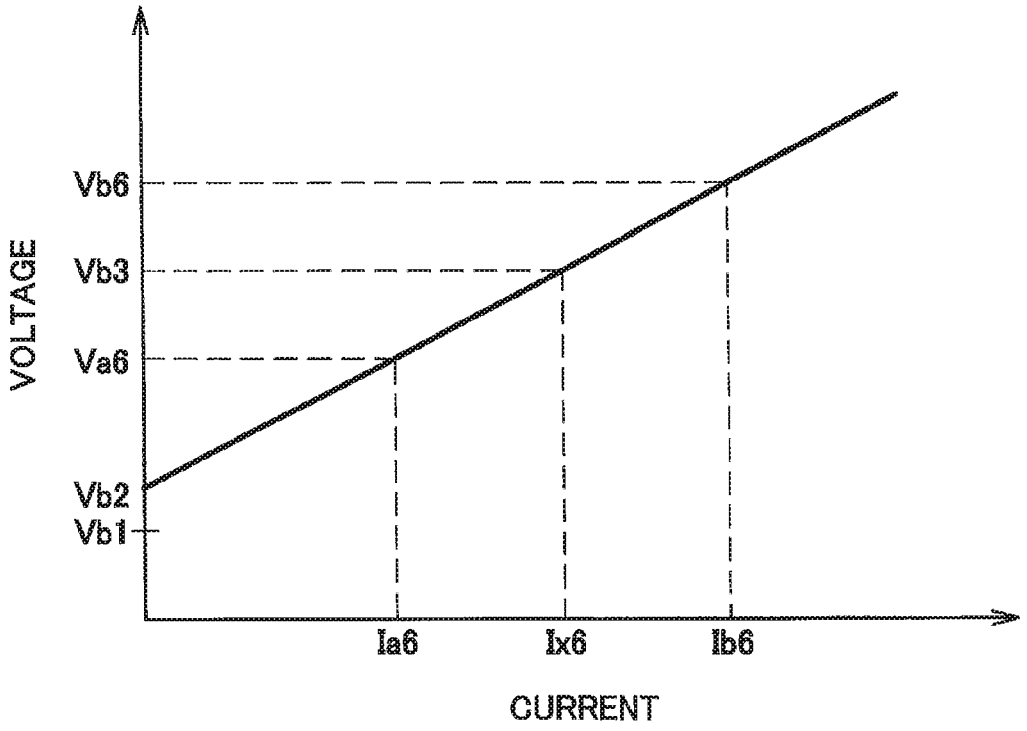
FIG. 84 is a view illustrating the relationship between electrical current flowing in a first electrode and an electrical voltage applied to a first electrode.

Thereafter, the controller 600 calculates a relational expression representing the relationship between the current and the voltage as illustrated in FIG. 84 on the basis of the measured voltages Va6, Vb6 and current values Ia6 and Ib6. Then, the controller 600 calculates a voltage (intercept) at which the current is 0. The calculated intercept voltage is set as the second voltage V62, and a value smaller than the second voltage V62 is set as the first voltage V61.

The controller 600 calculates the above relational expression when a prescribed condition is satisfied in a standby state. The prescribed condition may be any condition indicating that there may be a change in environment such as temperature. For example, the prescribed condition may be a condition that a prescribed specified time period elapses from the end of the previous print control, a condition that a difference between a temperature detected by a temperature sensor (not illustrated) and a temperature detected at a time when the relational expression was previously calculated is equal to or larger than a prescribed value, a condition that a fixing-solution cartridge 676 is exchanged, and the like.

The prescribed timing when the voltage V is switched from the first voltage V61 to the second voltage V62 is set to a timing after the leading end of the paper 6P passes between the photosensitive drum 61 and the transfer roller TR. The prescribed timing refers to the time when a prescribed first time period (time period corresponding to the paper 6P) elapses from the time set as a prescribed starting point. The time set as a starting point may be the time when paper feeding by the feed roller 632A is started, the time when once stopped conveyance of the paper 6P is resumed by the registration roller 232E, or the time when passage of the leading end of the paper 6P is detected by a paper sensor (not illustrated) disposed upstream of the fixing device 207 and downstream of the registration roller 232E.

Further, the prescribed timing depends on the conveyance speed of the paper 6P and a distance from an initial position (e.g., position of the paper sensor) set as the prescribed starting point to the above-mentioned first position. So, when the conveyance speed is changed for example, the prescribed timing may be appropriately changed depending on the conveyance speed. Specifically, the above-mentioned first time period may be calculated by (distance/conveyance speed). Hereinafter, a plurality of prescribed timings when the voltage V is switched from the first voltage V61 to the second voltage V62 is referred to as "plurality of first times t601".

Further, the controller 600 is configured to set the voltage V to a third voltage V63 before a toner image on the paper 6P (hereinafter, referred to simply as "image") reaches each of the fixing regions B1-B5. Here, the third voltage V63 is higher than the second voltage V62 and enables to fixe toner. In other words, for each of the fixing heads 671A-671E, the controller 600 sets the voltage V to the third voltage V63 higher than the second voltage V62 when the image reaches a second position separated upstream from a corresponding one of the fixing regions B1-B5 by a prescribed second distance 6D2 (smaller than the first distance 6D1: see FIGS. 89D and 89E), that is, when the distance from the image to the corresponding one of the fixing regions B1-B5 becomes the second distance 6D2.

The third voltage V63 is set to a voltage value large enough to spray the amount of fixing solution L required for fixing the image. Thus, the controller 600 first sets a target supply amount of the fixing solution L according to image density for example, and then sets a target current value Ix6 according to the set target supply amount as illustrated in FIG. 84. Then, the controller 600 sets the third voltage V63 on the basis of the target current value Ix6 and the relational expression of FIG. 84.

The timing before each image reaches each of the fixing regions B1-B5 is the time when a prescribed second time period (time period corresponding to each image and each of the fixing regions B1-B5) elapses from the time set as the prescribed starting point as described above. Hereinafter, a plurality of timings when the voltage V is switched from the second voltage V62 to the third voltage V63 is referred to as "plurality of second times t602".

Further, in a case where a plurality of images (images in the width of each of the fixing regions B1-B5) corresponding to each of the fixing regions B1-B5 is separated from one another in the conveyance direction on a prescribed paper 6P and where the distance between two images included in the plurality of images is larger than a third distance 6D3 (see FIG. 88) which is short to some extent, the controller 600 switches the voltage V from the third voltage V63 to the second voltage V62 after the downstream one of the two images is moved past the fixing region. That is, as illustrated in, e.g., FIG. 88, when determining that the distance between two images 6G2 and 6G3 corresponding to the first fixing region B1 is larger than the third distance 6D3, the controller 600 switches the voltage V from the third voltage V63 to the second voltage V62 after the downstream-side second image 6G2 is moved past the first fixing region B1. In other words, when the time period from a time when the second image 6G2 is moved past the first fixing region B1 to a time when the subsequent image 6G3 reaches the first fixing region B1 is equal to or larger than a first threshold value, the controller 600 switches the voltage V from the third voltage V63 to the second voltage V62.

The first threshold value can be experimentally calculated and is set to the time period from a time when the control of switching the voltage applied to the first electrode 674 from the third voltage V63 to the second voltage V62 is started to a time when the voltage is stabilized at the second voltage V62. The distance 6D3 can be calculated from the conveyance speed of the paper and the first threshold value.

Further, in a case where the images corresponding to each of the fixing regions B1-B5 are separated from one another in the conveyance direction on a prescribed paper 6P and where the distance between two images included in the plurality of images is equal to or smaller than the third distance 6D3 (see FIG. 88) which is short to some extent, the controller 600 recognizes the two images as one image. That is, as illustrated in, e.g., FIG. 88, when determining that the distance between two images 6G1 and 6G2 corresponding to the first fixing region B1 is equal to or smaller than the third distance 6D3, the controller 600 recognizes the two images 6G1 and 6G2 as one image and thus does not lower the voltage V but maintains the third voltage V63 while a region between the two images 6G1 and 6G2 is passing through the first fixing region B1. In other words, when the time period from a time when the image 6G1 is moved past the first fixing region B1 to a time when the subsequent second image 6G2 reaches the first fixing region B1 is smaller than a first threshold value, the controller 600 maintains the voltage V at the third voltage V63.

Further, when a most upstream image (e.g., 6G3) in the conveyance direction on a prescribed paper 6P is moved past the fixing region (e.g., B1), the controller 600 changes the voltage V from the third voltage V63 to the first voltage V61 or the second voltage V62. Specifically, in a case where the distance from the trailing end of the most upstream image 6G3 on a prescribed paper 6P to the leading end of the subsequent paper 6P is larger than a fourth distance 6D4, the controller 600 switches the voltage V from the third voltage V63 to the first voltage V61 after the most upstream image 6G3 is moved past the first fixing region B1. In other words, in a case where the time period from a time when the most upstream image 6G3 on a prescribed paper 6P is moved past the first fixing region B1 to a time when the leading end of the subsequent paper 6P reaches the first fixing region B1 is larger than a second threshold value, the controller 600 switches the voltage V from the third voltage V63 to the first voltage V61 after the most upstream image 6G3 is moved past the first fixing region B1.

The second threshold value can be experimentally calculated and is set to the time period from a time when the control of switching the voltage applied to the first electrode 674 from the third voltage V63 to the first voltage V61 is started to a time when the voltage is stabilized at the first voltage V61. The distance 6D4 can be calculated from the conveyance speed of the paper and the second threshold value.

Further, also in a case where the subsequent paper 6P does not exist for a most upstream image corresponding to a prescribed fixing region or where an image corresponding to the prescribed fixing region does not exist on the subsequent paper 6P, the controller 600 switches the voltage V from the third voltage V63 to the first voltage V61 after the most upstream image is moved past the fixing region. Specifically, in a case where an image corresponding to the first fixing region B1 does not exist on the subsequent paper 6P conveyed successively after a prescribed paper 6P on which the most upstream image 6G3 corresponding to the first fixing region B1 is formed, the controller 600 switches the voltage V from the third voltage V63 to the first voltage V61 after the image 6G3 is moved past the first fixing region B1.

In a case where a distance from each most upstream image to the leading end of the subsequent paper 6P is larger than the fourth distance 6D4, a case where the subsequent paper 6P does not exist, or a case where no image exists on the subsequent paper 6P for each most upstream image, the timing when the each most upstream image is moved past each of the fixing regions B1-B5 is a time when a prescribed fourth time period (time period corresponding to each image and each of the fixing regions B1-B5) elapses from the time set as the prescribed starting point. Hereinafter, a plurality of timings when the voltage V is switched from the third voltage V63 to the first voltage V61 is referred to as "plurality of fourth times t604".

Further, in a case where the distance from the trailing end of a most upstream fourth image 6G4 on a prescribed paper 6P to the leading end of the subsequent paper 6P is equal to or smaller than the fourth distance 6D4 for example, the controller 404 switches the voltage V from the third voltage V63 to second voltage V62 after the most upstream fourth image 6G4 is moved past the fifth fixing region B5. In other words, in a case where the time period from a time when the most upstream image 6G4 on a prescribed paper 6P is moved past the fifth fixing region B5 to a time when the leading end of the subsequent paper 6P reaches the fifth fixing region B5 is equal to or smaller than the second threshold value, the controller 600 switches the voltage V from the third voltage V63 to the second voltage V62 after the most upstream image 6G4 is moved past the fifth fixing region B5.

In a case where a distance from each most upstream image to the leading end of the subsequent paper 6P is equal to or lower than the fourth distance 6D4, the timing when each most upstream image is moved past a corresponding one of the fixing regions B1-B5 is the time when a prescribed third time period (time period corresponding to each image and each of the fixing regions B1-B5) elapses from the time set as the prescribed starting point. Hereinafter, a plurality of timings when the voltage V is switched from the third voltage V63 to the second voltage V62 is referred to as "plurality of third times t603".

Figure 88:
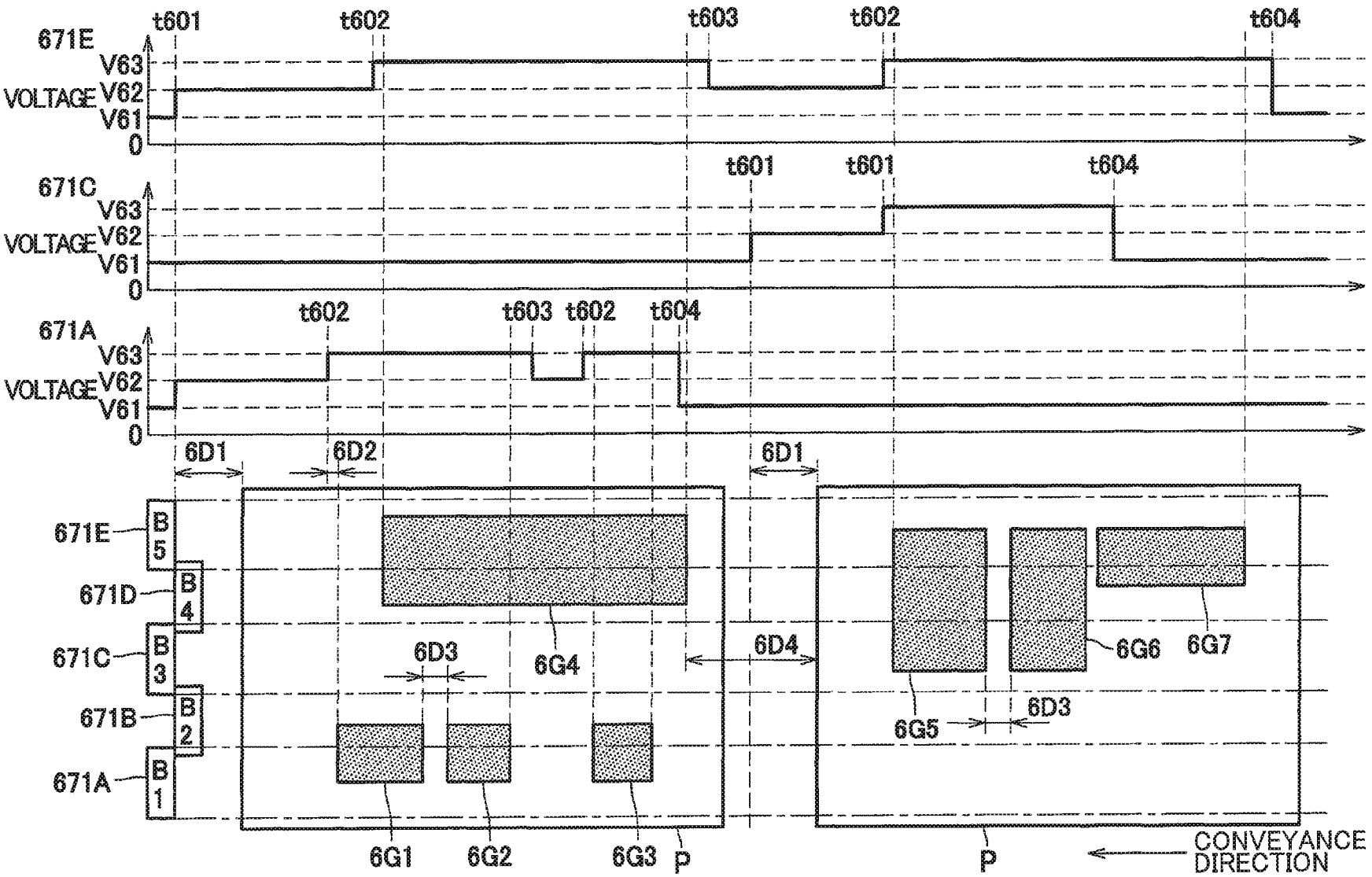
FIG. 88 is a timing chart showing timings at which voltage applied to a first fixing head, a third fixing head, and a fifth fixing head is altered, where the timings are in association with a position of a leading end of sheets or a position of each image.

Further, in a case where it is determined that no image exists in a prescribed region corresponding to a prescribed fixing region (e.g., B3) in the image formation region of a prescribed paper 6P, the controller 600 maintains the voltage V applied to the fixing solution L in a prescribed fixing head (e.g., 671C) corresponding to the prescribed region at the first voltage V61 after the first time t601 and during the time period while the prescribed paper 6P is passing through a fixing region corresponding to the prescribed fixing head. That is, since no image exists within the width of the third fixing region B3 in the image formation region of the paper 6P illustrated on the left side in FIG. 88, the controller 600 does not set the first time t601 (i.e., timing when the voltage V is switched from the first voltage V61 to the second voltage V62) for the third fixing head 671C. Thus, during the time period while the left side paper 6P of FIG. 88 is passing through the third fixing region B3, the voltage V applied to the third fixing head 671C is maintained at the first voltage V61.

The above-mentioned distances 6D1-6D4, times t601-t604, and voltages V61-V63 are appropriately set by experiments or simulations.

Figure 85:
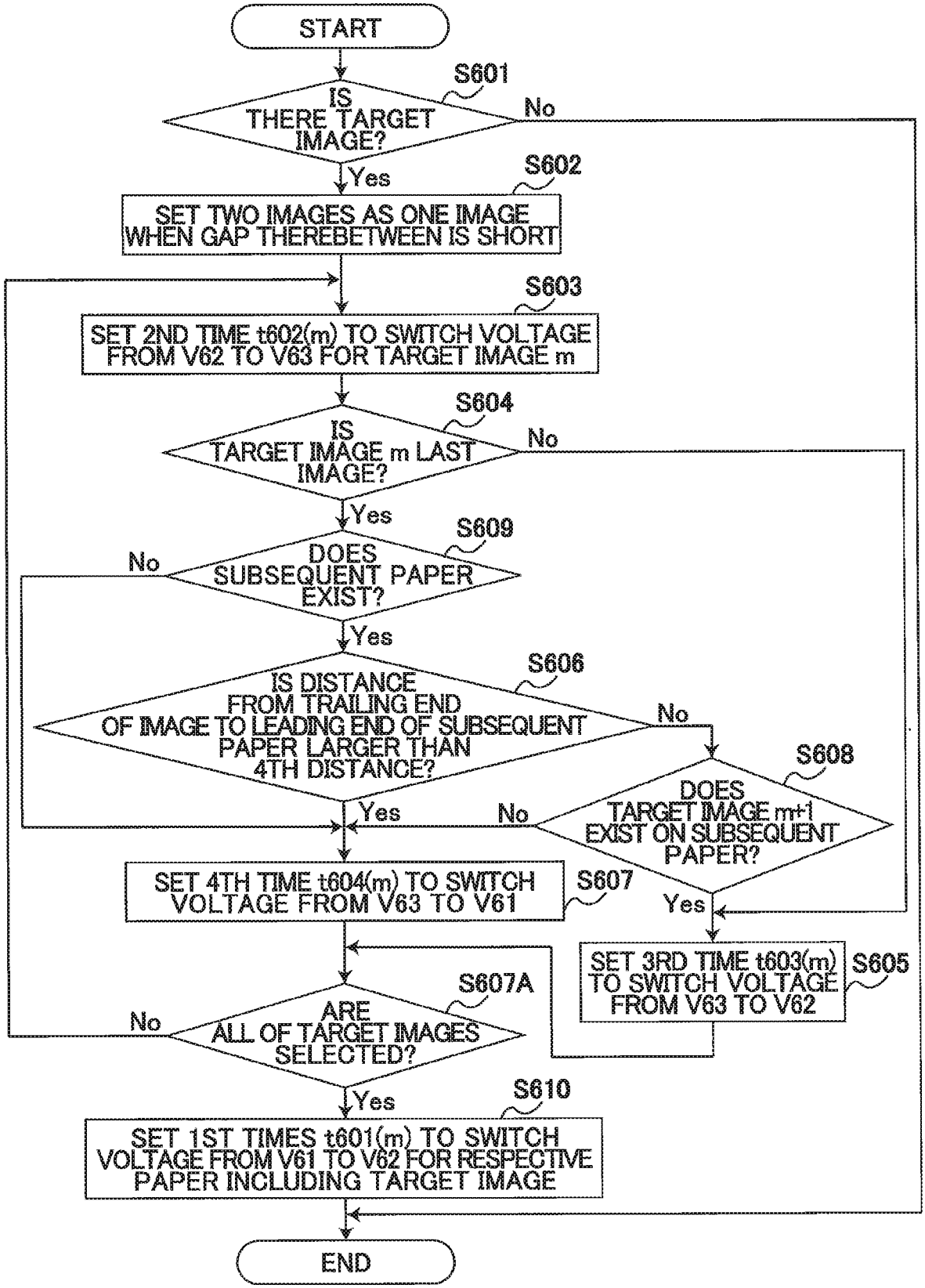
FIG. 85 is a flowchart illustrating a process for setting each time in a preparation state.
Figure 86:
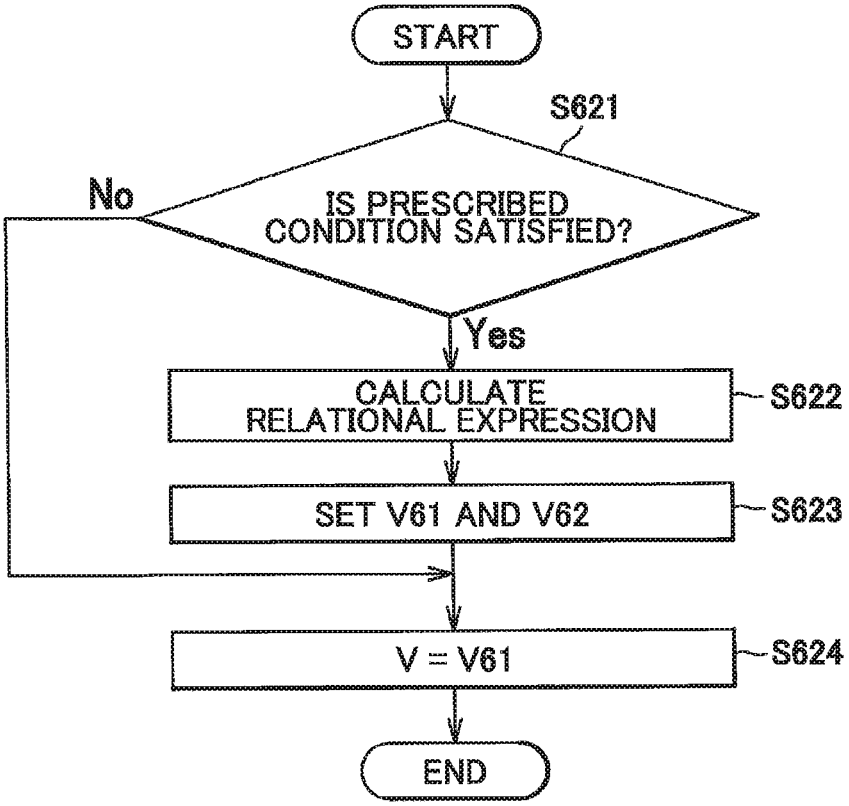
FIG. 86 is a flowchart illustrating voltage control in a standby state.
Figure 87:
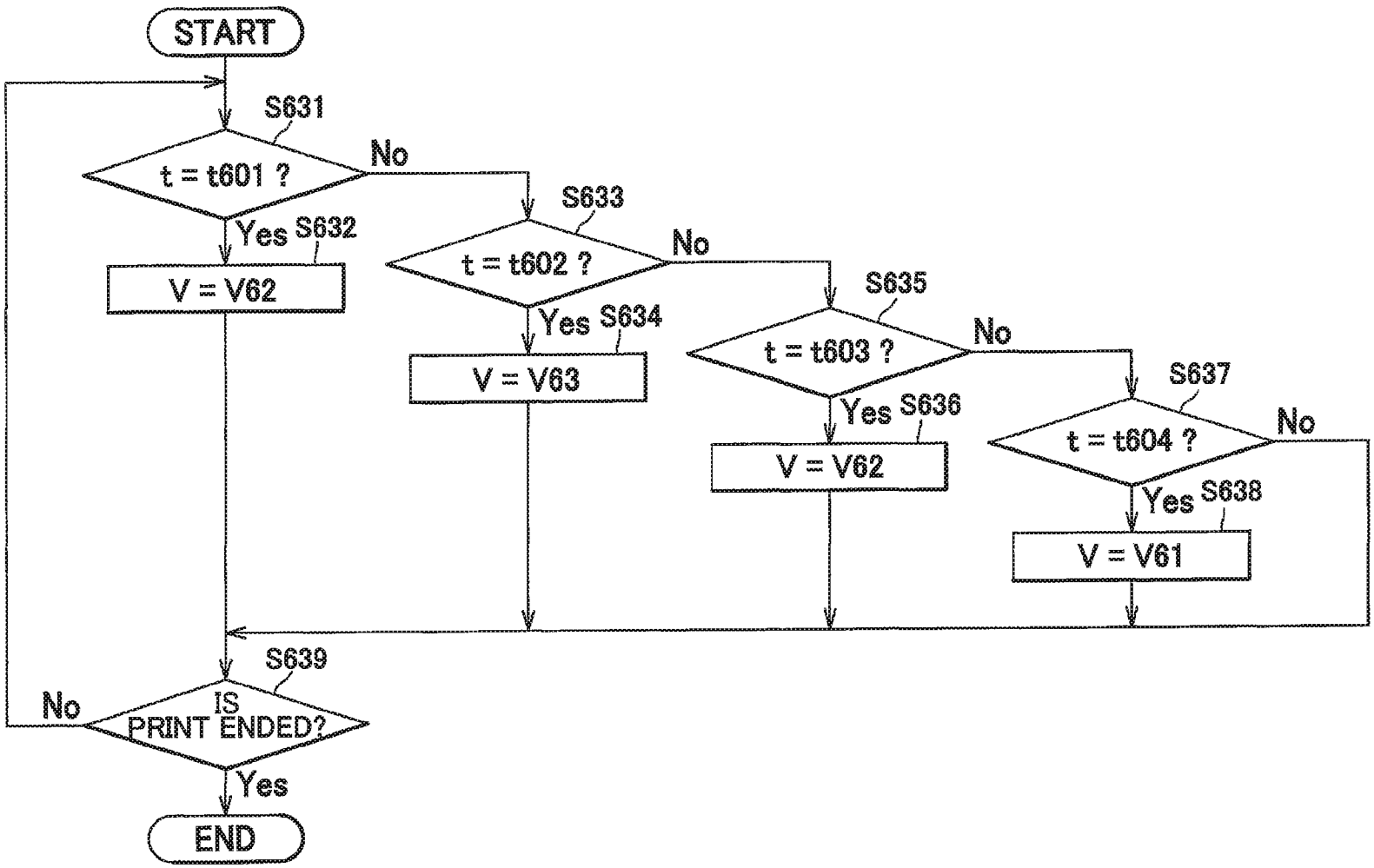
FIG. 87 is a flowchart illustrating voltage control in print control.

The following describes in detail the operation of the controller 600. The controller 600 executes the flowcharts illustrated in FIGS. 85 to 87 for each of the fixing heads 671A-671E. Hereinafter, control for the first fixing head 671A will be described as a representative example. The flowchart shown in FIG. 85 illustrates the process for setting the times t601 to t604 in a preparation state immediately before the execution of fixing control. The flowchart shown in FIG. 86 illustrates voltage control in a standby state. The flowchart shown in FIG. 87 illustrates voltage control during print control. The flowchart shown in FIG. 86 is repeatedly executed in a standby state, and the flowchart shown in FIG. 87 is executed repeatedly during print control.

The fixing control is a control executed during the time period from a time when spraying of the fixing solution L is started for an image on the first paper 6P in a print instruction to a time when spraying for the last paper 6P is ended. The preparation state is a state between the time when a print instruction is received and the time when spraying for an image on the first paper 6P is started. The standby state is a state where the laser printer 601 is powered ON and where no print instruction is received.

As illustrated in FIG. 85, the controller 600 receives a print instruction in the standby state (START) and then determines based on print data whether any image (hereinafter, referred to also as "target image") corresponding to the first fixing head 671A exists (S601). When determining in step S601 that no target image exists (No), the controller 600 ends this routine.

When determining in step S601 that a target image exists (Yes), the controller 600 sets two target images as one target image in a case where a gap between the two target images is equal to or smaller than the third distance 6D3, that is, the gap between the two target images is small (S602). In S602, the controller selects one target image m from among the 1st to k-th target images. Hereinafter, the number of the target images set in step S602 is assumed to be k, and the selected target image m among the 1st to k-th target images in S602 is simply referred to as "target image m".

After executing step S602, the controller 600 sets a second time t602, that is, the timing when the voltage V is switched from the second voltage V62 to the third voltage V63 for the target image m (S603). After executing step S603, the controller 600 determines whether the target image m is the last image, i.e., the most upstream image on the paper 6P (S604).

When determining in step S604 that the target image m is not the most upstream image (No), the controller 600 sets a third time t603, that is, the timing when the voltage V is switched from the third voltage V63 to the second voltage V62 for the target image m which is not the most upstream image (S605). That is, as a result of execution of steps S604: No→S605, the voltage V is lowered from the third voltage V63 to the second voltage V62 after the target image m other than the most upstream image on the same paper 6P is moved past the first fixing region B1.

When determining in step S604 that the target image m is the most upstream image (Yes), the controller 600 determines whether the subsequent paper 6P exists for the most upstream target image m (S609). When determining in step S609 that the subsequent paper 6P does not exist for the most upstream target image m (No), the controller 600 shifts to step S607 and sets the fourth time t604 which is the timing when the voltage V is switched from the third voltage V63 to the first voltage V61 for the most upstream target image m, i.e., the last target image k. That is, as a result of execution of steps S609: No→S607, the voltage V is set back to the first voltage V61 set in the standby state when the target image m is the last target image k, that is, when spraying to the last target image k is finished.

When determining in step S609 that the subsequent paper 6P exists for the target image m (Yes), the controller 600 determines whether the distance from the trailing end of the most upstream target image m to the leading end of the subsequent paper 6P is larger than the fourth distance 6D4 (S606). When determining in step S606 that the distance is larger than the fourth distance 6D4 (Yes), the controller 600 sets a fourth time t604, that is, the timing when the voltage V is switched from the third voltage V63 to the first voltage V61 for the most upstream target image m (S607). That is, as a result of execution of steps S606: Yes→S607, the voltage V is lowered from the third voltage V63 to the first voltage V61 when the time period from a time when the most upstream target image m is moved past the first fixing region B1 to a time when the leading end of the subsequent paper 6P reaches the first position is comparatively long, whereby power consumption can be suppressed.

When determining in step S606 that the distance is equal to or smaller than the fourth distance 6D4 (No), the controller 600 determines whether a target image m+1 exists on the subsequent paper 6P for the corresponding most upstream target image m (S608). When determining in step S608 that the target image m+1 does not exist on the subsequent paper 6P (No), the controller 600 shifts to step S607 and sets the fourth time t604 for the most upstream target image m. That is, as a result of execution of steps S608: No→S607, the voltage V is maintained at the first voltage V61 during the time period from a time when the most upstream target image m is moved past the first fixing region B1 to at least until the subsequent paper 6P is moved past the first fixing region B1 in a case where the target image m+1 does not exist on the subsequent paper 6P, that is, a case where there is no need to spray the fixing solution L onto the subsequent paper 6P with the first fixing head 671A, whereby power consumption can be suppressed.

When determining in step S608 that the target image m+1 exists on the subsequent paper 6P (Yes), the controller 600 shifts to step S605 and sets the third time t603 for the target image m. That is, as a result of execution of steps S606: No→S608: Yes→S605, the voltage V is changed from the third voltage V63 to the second voltage V62 in a case where the distance from the trailing end of the most upstream target image m to the leading end of the subsequent paper 6P is small, that is, equal to or smaller than the fourth distance 6D4, thereby eliminating the need to switch the voltage V from the first voltage V61 to the second voltage V62 between successive papers (between a prescribed paper on which the target image m is formed and the subsequent paper).

When the voltage V is switched from the first voltage V61 to the second voltage V62, a phenomenon that the fixing solution L drops from the nozzle 6N as droplet may occur. Further, when the conveyance speed is increased in a case where the distance from the trailing end of the most upstream target image m to the leading end of the subsequent paper 6P is small, that is, equal to or smaller than the fourth distance 6D4, the time period from a time when the most upstream target image m is moved past the first fixing region B1 to a time when the leading end of the subsequent paper 6P reaches the first fixing region B1 may be significantly short. In this case, if the voltage V is set to the first voltage V61 after the target image m is moved past the first fixing region B1 and then switched from the first voltage V61 to the second voltage V62 between the successive papers, the fixing solution L dropping from the nozzle 6N may adhere to the subsequent paper 6P. On the other hand, when the voltage V is maintained at the second voltage V62 between successive papers in a case where the distance is small, that is, equal to or smaller than the fourth distance 6D4, dripping that may occur upon switching between the first voltage V61 and second voltage V62 can be prevented, thereby preventing the droplet-like fixing solution L from adhering to the paper 6P. After executing step S607 or S605, the controller 600 determines whether all of the 1st to k-th target images are selected as the target image m (S607A). If all of the 1st to k-th target images are selected as the target image m (YES), the controller 600 shifts to S610. If there is at least one image that has not been selected as the target image m among the 1st to k-th target images, in S607A the controller 600 selects one image that has not been selected as the target image as the target image m, and returns to step S603. In this case, steps starting from S603 are performed for the newly selected target image m.

After executing step S607A, the controller 600 sets a plurality of first times t601, that is, the timings when the voltage V is switched from the first voltage V61 to the second voltage V62 for respective papers 6P including the target image m (S610) and then ends this routine.

As illustrated in FIG. 86, when the laser printer 601 is powered ON (START), the controller 600 determines whether the prescribed condition is satisfied to thereby determine whether there is a possibility that any environmental change occurs (S621). When determining in S621 that the prescribed condition is satisfied, that is, there is a possibility that environmental change occurs (Yes), the controller 600 controls voltage V so as to make the current values become Ia6 and Ib6 to calculate the relational expression (S622), as illustrated in FIG. 84.

After executing step S622, the controller 600 sets the first voltage V61 and the second voltage V62 based on the relational expression. After executing step S623, or when determining "No" in step S621, the controller 600 sets the voltage V to the first voltage V61 (S624) and ends this routine. As a result, in the standby state, the voltage V is basically set to the first voltage V61.

As illustrated in FIG. 87, after receiving a print instruction (START), the controller 600 determines whether a time t based on a time set as the prescribed starting point as a reference, i.e., a time t counted up from the time set as the prescribed starting point is the first time t601 (S631). When determining in step S631 that t=t601 (Yes), the controller 600 sets the voltage V to the second voltage V62 (S632). Specifically, in step S632, the controller 600 increases the voltage from the first voltage V61 to the second voltage V62.

When determining in step S631 that t≠t601 (No), the controller 600 determines whether the time t is the second time t602 (S633). When determining in step S633 that t=t602 (Yes), the controller 600 sets the voltage V to the third voltage V63 (S634). Specifically, in step S634, the controller 600 increases the voltage V from the second voltage V62 to the third voltage V63.

When determining in step S633 that t≠t602 (No), the controller 600 determines whether the time t is the third time t603 (S635). When determining in step S635 that t=t603 (Yes), the controller 600 sets the voltage V to the second voltage V62 (S636). Specifically, in step S636, the controller 600 reduces the voltage V from the third voltage V63 to the second voltage V62.

When determining in step S635 that t≠t603 (No), the controller 600 determines whether the time t is the fourth time t604 (S637). When determining in step S637 that t=t604 (Yes), the controller 600 sets the voltage V to the first voltage V61 (S638). Specifically, in step S638, the controller 600 reduces the voltage V from the third voltage V63 to the first voltage V61.

When determining in step S637 that t≠t604 (No), or after executing step S632, step S634, step S636, or step S638, the controller 600 determines whether the print control is ended (S639). When determining in step S639 that the print control is not ended (No), the controller 600 returns to step S631. When determining in step S639 that the print control is ended (Yes), the controller 600 ends this routine.

The following describes an example of the control with reference to FIGS. 88 to 90.

FIG. 88 is a timing chart in which the time axis is made to correspond to the position of the paper and the image formed on the paper. In FIG. 88, control for the first fixing head 671A, the third fixing head 671C, and the fifth fixing head 671E is illustrated as a representative example. The control for the second fixing head 671B is substantially the same as that for the first fixing head 671A since the target images corresponding to the second fixing head 671B have the same sizes as and located at the same positions as the target images 6G1 to 6G3 corresponding to the first fixing head 671A. Similarly, the control for the fourth fixing head 671D is substantially the same as that for the fifth fixing head 671E since the target images corresponding to the fourth fixing head 671D have the same sizes as and located at the same positions as the target images 6G4 to 6G7 corresponding to the fifth fixing head 671E. Hereinafter, for descriptive convenience, the target images 6G1 to 6G7 are referred to also as a first image 6G1, a second image 6G2, a third image 6G3, a fourth image 6G4, a fifth image 6G5, a sixth image 6G6, and a seventh image 6G7, respectively.

First, with reference to FIG. 88, control for the first fixing head 671A will be described.

As illustrated in FIG. 88, at the first time t601 when the distance from the leading end of the first paper 6P in the print control to the first fixing region B1 is the first distance 6D1, the controller 600 increases the voltage V, which was set to the first voltage V61 in the standby state, to the second voltage V62. Then, at the second time t602 when the distance from the leading end of the first image 6G1 of the first paper 6P to the first fixing region B1 is the second distance 6D2, the controller 600 increases the voltage from the second voltage V62 to the third voltage V63.

The gap between the two images 6G1 and 6G2 is equal to or smaller than the third distance 6D3, so that the controller 600 maintains the voltage V at the third voltage V63 during the time period from a time when the leading end of the first image 6G1 reaches the first fixing region B1 to a time when the second image 6G2 is moved past the first fixing region B1. At the third time t603 when the second image 6G2 is moved past the first fixing region B1, the controller 600 reduces the voltage V from the third voltage V63 to the second voltage V62. Specifically, the second image 6G2 is not the most upstream image, so that the controller 600 reduces the voltage V from the third voltage V63 to the second voltage V62 after the trailing end of the second image 6G2 is moved past the first fixing region B1.

After that, similarly, at the second time t602 set for the most upstream third image 6G3, the controller 600 increases the voltage V from the second voltage V62 to the third voltage V63. At the fourth time t604 when the most upstream third image 6G3 is moved past the first fixing region B1, the controller 600 reduces the voltage V from the third voltage V63 to the first voltage V61. Specifically, since there is no image corresponding to the first fixing region B1 on a paper 6P following the first paper 6P on which the most upstream third image 6G3 is formed, the controller 600 reduces the voltage V from the third voltage V63 to the first voltage V61.

Next, control for the third fixing head 671C will be described.

Since there is no image corresponding to the third fixing head 671C on the first paper 6P, the controller 600 does not set the first time t601 for the first paper 6P. As a result, the controller 600 maintains the voltage V at the first voltage V61 set in the standby state even when the distance from the leading end of the first paper 6P to the third fixing region B3 is the first distance 6D1.

Since there exist the images 6G5 and 6G6 corresponding to the third fixing head 671C on the subsequent paper 6P, the controller 600 sets the first time t601 for the subsequent paper 6P. As a result, at the first time t601, the distance from the leading end of the subsequent paper 6P to the third fixing region B3 becomes the first distance 6D1, and then the controller 600 increases the voltage V from the first voltage V61 to the second voltage V62.

Thereafter, as in the control for the first fixing head 671A, the controller 600 increases the voltage V from the second voltage V62 to the third voltage V63 at the second time t602 and reduces the voltage V from the third voltage V63 to the first voltage V61 at the fourth time t604. Because the gap between the two images 6G5 and 6G6 is also equal to or smaller than the third distance 6D3, the controller 600 maintains the voltage V at the third voltage V63 while the gap between the images 6G5 and 6G6 is passing through the corresponding fixing region.

Finally, control for the fifth fixing head 671E will be described.

At the first time t601, the distance from the leading end of the first paper 6P to the fifth fixing region B5 is the first distance 6D1, and then the controller 600 increases the voltage V from the first voltage V61 set in the standby state to the second voltage V62. At the second time t602, the distance from the leading end of the fourth image 6G4 on the first paper 6P to the fifth fixing region B5 is the second distance 6D2, the controller 600 increases the voltage V from the second voltage V62 to the third voltage V63.

Because only the fourth image 6G4 on the first paper 6P corresponds to the fifth fixing region B5, the fourth image 6G4 is the most upstream image. The distance from the trailing end of the fourth image 6G4 to the leading end of the subsequent paper 6P is equal to or smaller than the fourth distance 6D4. Thus, at the third time t603 the fourth image 6G4 is moved past the fifth fixing region B5, and then the controller 600 reduces the voltage V from the third voltage V63, not to the first voltage V61, but to the second voltage V62.

As a result, the voltage V is maintained at the second voltage V62 during the time period from a time when the fourth image 6G4 on the first paper 6P is moved past the fifth fixing region B5 to a time when the fifth image 6G5 on the subsequent paper 6P reaches a position just before the fifth fixing region B5. Thereafter, as in the control for the first fixing head 671A, the controller 600 increases the voltage V from the second voltage V62 to the third voltage V63 at the second time t602 and reduces the voltage V from the third voltage V63 to first voltage V61 at the fourth time t604. The gap between the two images 6G5 and 6G6 is equal to or smaller than the third distance 6D3. The gap between the two images 6G6 and 6G7 is also equal to or smaller than the third distance 6D3. Thus, the controller 600 maintains the voltage V at the third voltage V63 while the gap between the images 6G5 and 6G6 and the gap between the images 6G6 and 6G7 are passing through the corresponding fixing region.

The following describes how the voltage V applied to the fixing heads 671A-671E is switched with reference to FIGS. 89A to 90F.

Figure 89A:
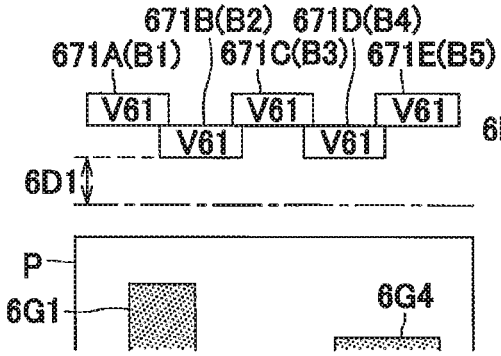
FIGS. 89A through 89H are views illustrating timings of altering voltage applied to each fixing head, and showing each state starting from a state where a leading sheet has not been arrived at each fixing head to a state where a second image of the leading sheet is moved past the second fixing head.
Figure 89B:
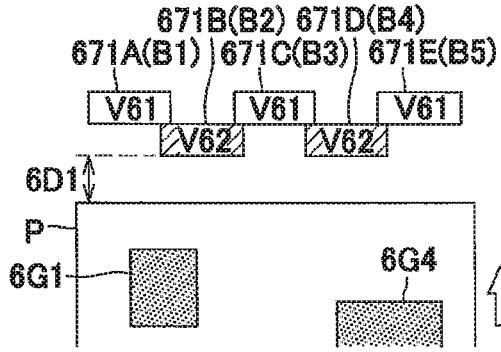

As illustrated in FIGS. 89A and 89B, when the leading end of the first paper 6P reaches a position separated upstream from the second fixing region B2 and fourth fixing region B4 by the first distance 6D1, voltages V applied to the respective second fixing head 671B and fourth fixing head 671D are switched from the first voltage V61 to the second voltage V62.

Figure 89C:
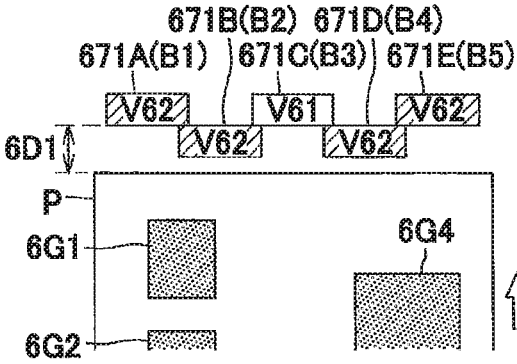

As illustrated in FIG. 89C, when the leading end of the first paper 6P reaches a position separated upstream from the first fixing region B1, the third fixing region B3, and the fifth fixing region B5 by the first distance 6D1, the voltages V applied to the respective first fixing head 671A and the fifth fixing head 671E are switched from the first voltage V61 to the second voltage V62. Since there exists no image corresponding to the third fixing head 671C, the voltage applied to the third fixing head 671C is maintained at the first voltage V61.

Figure 89D:
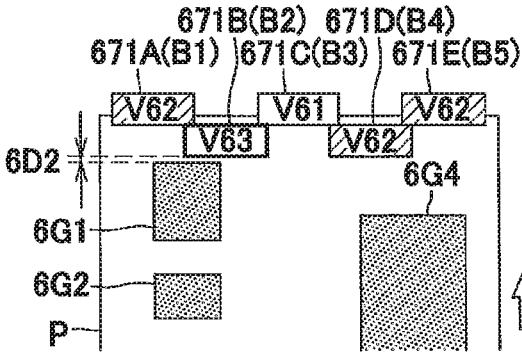
Figure 89E:
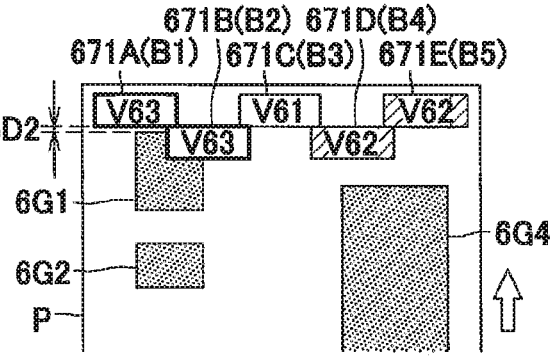

As illustrated in FIG. 89D, when the first image 6G1 corresponding to the second fixing head 671B reaches a position separated upstream from the second fixing region B2 by the second distance 6D2, the voltage V applied to the second fixing head 671B is switched from the second voltage V62 to the third voltage V63. As illustrated in FIG. 89E, when the first image 6G1 corresponding to the first fixing head 671A reaches a position separated upstream from the first fixing region B1 by the second distance 6D2, the voltage V applied to the first fixing head 671A is switched from the second voltage V62 to third voltage V63.

Figure 89F:
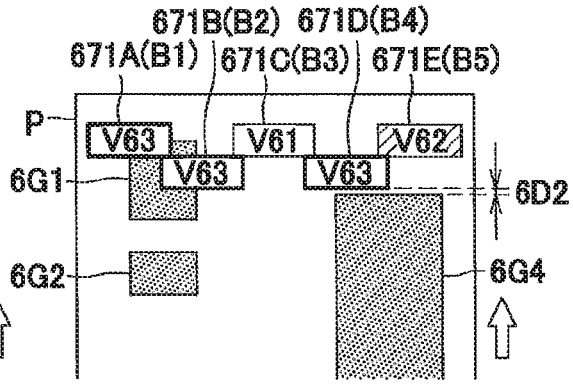
Figure 89G:
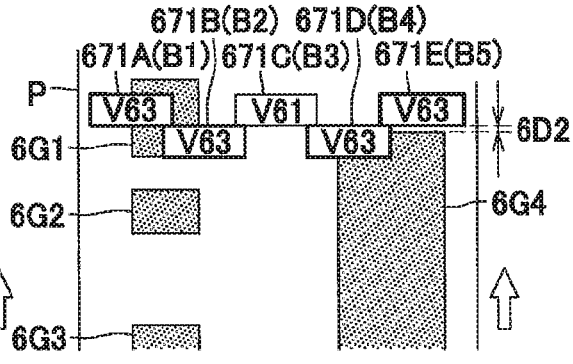

As illustrated in FIG. 89F, when the fourth image 6G4 corresponding to the fourth fixing head 671D reaches a position separated upstream from the fourth fixing region B4 by the second distance 6D2, the voltage V applied to the fourth fixing head 671D is switched from the second voltage V62 to the third voltage V63. As illustrated in FIG. 89G, when the fourth image 6G4 corresponding to the fifth fixing head 671E reaches a position separated upstream from the fifth fixing region B5 by the second distance 6D2, the voltage V applied to the fifth fixing head 671E is switched from the second voltage V62 to the third voltage V63.

Figure 89H:
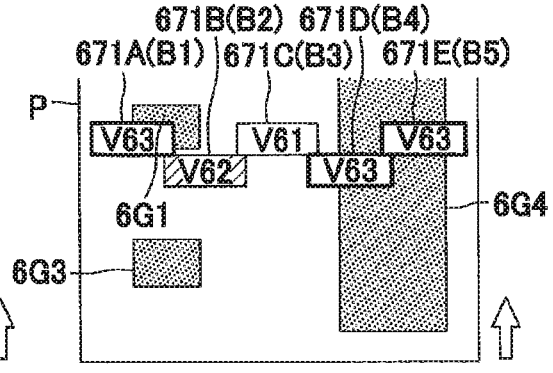
Figure 90A:
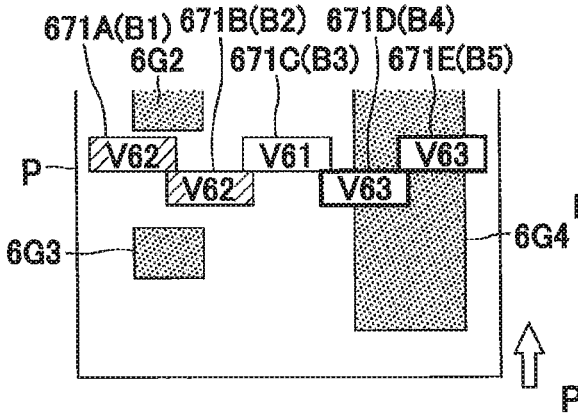
FIGS. 90A through 90F are views illustrating timings of altering voltage applied to each fixing head, and showing each state starting from a state where the second image is moved past the first head to a state where a fourth image is moved past a fifth fixing head.

As illustrated in FIG. 89H, when the second image 6G2 is moved past the second fixing region B2, the voltage applied to the second fixing head 671B is switched from the third voltage V63 to the second voltage V62. As illustrated in FIG. 90A, when the second image 6G2 is moved past the first fixing region B1, the voltage V applied to the first fixing head 671A is switched from the third voltage V63 to the second voltage V62.

Figure 90D:
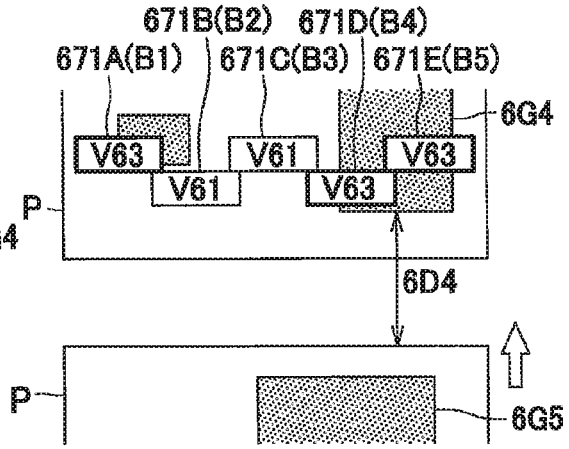
Figure 90B:
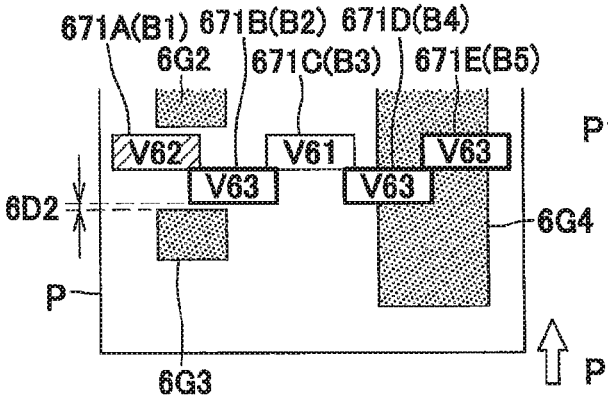
Figure 90E:
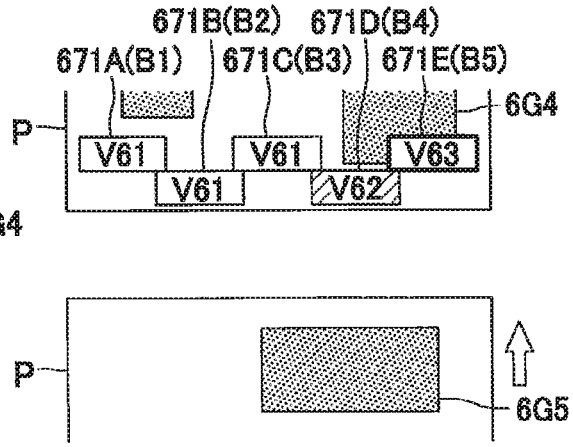
Figure 90C:
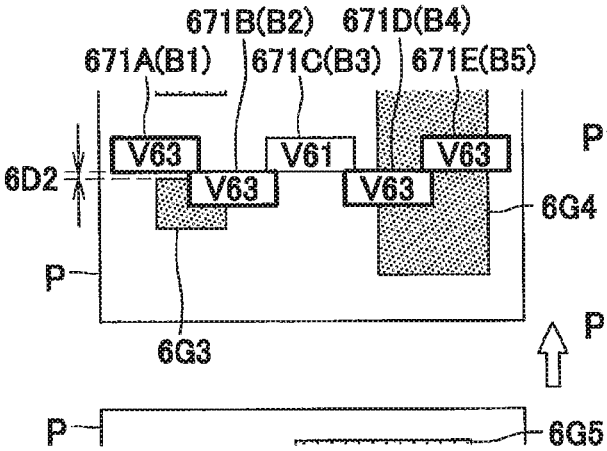

Thereafter, as illustrated in FIGS. 90B and 90C, at the timing when the distance between the third image 6G3 corresponding to both the fixing heads 671A and 671B and each of the fixing regions B1 and B2 becomes second distance 6D2, each voltage V applied to a corresponding one of the fixing heads 671A and 671B is switched from the second voltage V62 to the third voltage V63. As illustrated in FIG. 90D, when the third image 6G3 is moved past the second fixing region B2, the voltage V applied to the second fixing head 671B is switched from the third voltage V63 to the first voltage V61. That is, because there is no image corresponding to the second fixing region B2 on the subsequent paper 6P, the voltage V applied to the second fixing head 671B is switched from the third voltage V63 to the first voltage V61. Similarly, as illustrated in FIG. 90E, when the third image 6G3 is moved past the first fixing region B1, the voltage V applied to the first fixing head 671A is switched from the third voltage V63 to the first voltage V61.

Figure 90F:
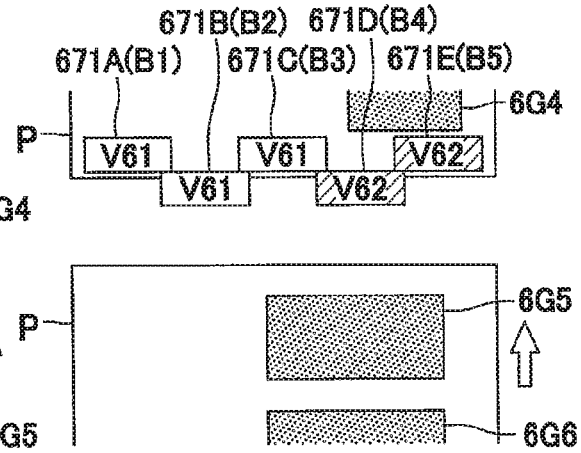

As illustrated in FIG. 90E, when the fourth image 6G4 corresponding to the fourth fixing head 671D is moved past the fourth fixing region B4, the voltage applied to the fourth fixing head 671D is switched from the third voltage V63 to the second voltage V62. Since the distance from the fourth image 6G4 to the leading end of the subsequent paper 6P is equal to or smaller than the fourth distance 6D4, the voltage applied to the fourth fixing head 671D is switched from the third voltage V63 to the second voltage V62. Similarly, as illustrated in FIG. 90F, when the fourth image 6G4 is moved past the fifth fixing region B5, the voltage applied to the fifth fixing head 671E is switched from the third voltage V63 to the second voltage V62.

The control for the fixing heads 671A-671E when the fifth paper 6P5 having the largest width is used has been described with reference to FIGS. 88 to 90. The control is performed in the same manner when the papers 6P1 to 6P4 having different widths are used. In this case, the voltage applied to a fixing head positioned outside the image formation region of the paper in the width direction (e.g., the fifth fixing head 671E when the fourth paper 6P4 is used) is maintained at the first voltage V61 during the print control.

Specifically, when the print control is performed using the fourth paper 6P4 for example, there is no target image corresponding to the fifth fixing head 671E positioned outside the image formation region of the fourth paper 6P4 in the conveyance direction. Thus, in the process illustrated in FIG. 85, "No" is determined in step S601 for the fifth fixing head 671E. Accordingly, the times t601-t604 for changing the voltage V are not set for the fifth fixing head 671E, with the result that the voltage applied to the fifth fixing head 671E is maintained at the first voltage V61 during the print control.

According to the seventh embodiment, the following effects can be obtained.

The voltage is controlled for each of the fixing heads 671A to 671E in accordance with the type (paper width) of the paper P or image data, so that spray of the fixing solution L from the fixing heads 671A to 671E can be individually stopped appropriately in the print control, whereby the fixing solution L can be prevented from being consumed wastefully.

The fixing heads 671A to 671E are arranged so as to correspond to the width of the papers 6P. Thus, when spraying is performed for the first paper 6P1 for example, the voltage need not be applied to the four fixing heads 671B to 671E that do not correspond to the width of the first paper 6P1, whereby the fixing solution can be prevented from being consumed wastefully.

When the fixing solution L is not sprayed from a prescribed fixing head, the valve 677B corresponding to the prescribed fixing head is closed. Accordingly, a current can be prevented from leaking from a fixing head that performs spraying to a fixing head that does not perform spraying by the insulating valve 677B. As a result, the fixing solution L can be prevented from being erroneously sprayed from a fixing head that does not perform spraying.

Because the voltage is increased from the first voltage V61 to the second voltage V62 before the leading end of the paper 6P reaches the fixing regions B1-B5, the droplet-like fixing solution L can be prevented from dropping from the nozzle 6N when switching the voltage from the first voltage V61 to the second voltage V62, and can prevent the fixing solution L from adhering to the paper 6P.

The voltage is once set to the second voltage V62 lower than the third voltage V63 before application of the third voltage V63, power consumption can be reduced as compared to a case where the voltage is changed to the third voltage V63 at one time from the first voltage V61 before the leading end of the paper 6P reaches the fixing regions B1-B5.

Because the voltage is reduced from the third voltage V63 to the second voltage V62 while the large gap between the images 6G2 and 6G3 is passing through the corresponding fixing region, power consumption can be reduced as compared to a case where the voltage is maintained at the third voltage V63 while the large gap is passing through the corresponding fixing region.

Because the voltage is maintained at the third voltage V63 while the small gap between the images 6G1 and 6G2 is passing through the corresponding fixing region, a state of spraying the fixing solution L for fixing the second image 6G2 following the first image 6G1 can be stabilized.

Because the voltage is reduced to the first voltage V61 after the most upstream third image 6G3 is moved past the first fixing region B1, unnecessary power consumption can be prevented gap between the first paper 6P and the subsequent paper 6P.

Because the voltage is reduced, not to the first voltage V61, but to the second voltage V62 after the most upstream fourth image 6G4 is moved past the fifth fixing region B5, dripping from the fifth fixing head 671E can be restricted between successive papers.

Because the second voltage V62 is determined on the basis of the relational expression calculated in the standby state, the second voltage V62 can be set to a proper value for the environment.

The width of the first fixing head 671A is made smaller than the width of the first paper 6P1, and the widths of the respective fixing heads 671B to 671E are made small such that the fixing heads 671B to 671E fall within the widths of their corresponding papers 6P2 to 6P5, respectively. Accordingly, the fixing heads 671A-671E can be reduced in size, which in turn can reduce the size of the fixing device 607.

The present invention is not limited to the above-described seventh embodiment, but may be variously modified as exemplified below. Hereinafter, like parts and components are designated with the same reference numerals as the seventh embodiment to avoid duplicating description.

Figure 91:
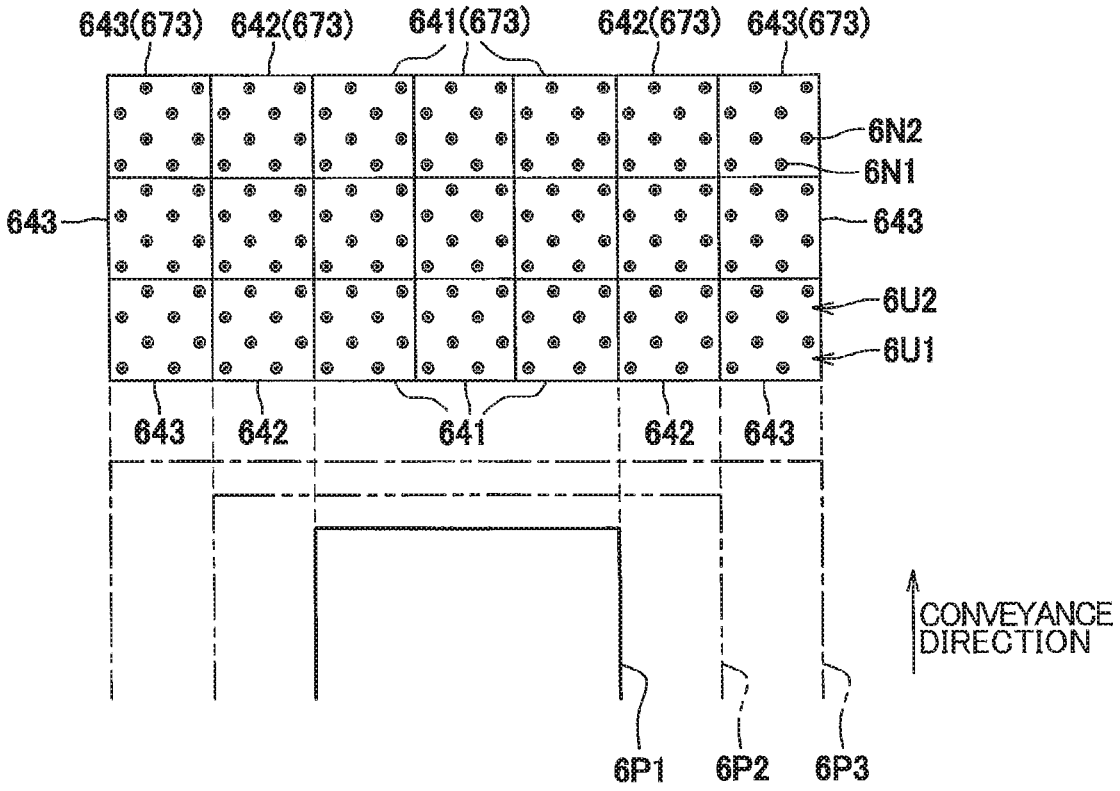
FIG. 91 is a view illustrating a fixing head as a first modification to the seventh embodiment.

In the above seventh embodiment, the plurality of container portions 673 is separately provided arranging in the width direction. However, the present invention is not limited to this, and, as illustrated in FIG. 91, the plurality of container portions 673 may be arranged in the conveyance direction. In other words, in the embodiment illustrated in FIG. 91, the plurality of rows is arranged in the conveyance direction while each row includes a plurality of container portions 673.

In this embodiment, end portions of each of the papers 6P1 to 6P3 having different widths are guided by a guide (not illustrated) capable of adjusting positions of the papers 6P1 to 6P3 in the width direction such that the center positions of the papers 6P1 to 6P3 are aligned to the same position.

Among the plurality of container portions 673 arranged in a row in the width direction, three first container portions 641 arranged at the center in the width direction is disposed so as to correspond to the width of the first paper 6P1. Similarly, in other rows, the three first container portions 641 at the center in the width direction are disposed so as to correspond to the width of the first paper 6P1.

In other words, the fixing regions of the respective nine first container portions 641 are not separated but overlap one another, and the both ends of the entire fixing region constituted by the nine first container portions 641 in the width direction coincide with or positioned outside both ends of the image formation region of the first paper 6P1.

Among the plurality of container portions 673 arranged in a row in the width direction, two second container portions 642 are provided adjacent to and outside of the three first container portions 641 in the width direction. The two second container portions 642 correspond to the width of the second paper 6P2 larger than the width of the first paper 6P1. Similarly, in other rows, the second container portions 642 correspond to the width of the second paper 6P2.

In other words, the fixing regions of the three second container portions 642 disposed to the left in FIG. 91 of the nine first container portions 641 are not separated but overlap one another. The outer end portion of the entire fixing region constituted by the above three second container portions 642 in the width direction coincide with or positioned outside the outer end portion of the image formation region of the second paper 6P2 in the width direction. The entire fixing region constituted by the three second container portions 642 disposed to the right in FIG. 91 of the nine first container portions 641 is disposed in a similar manner.

Among the plurality of container portions 673 arranged in a row in the width direction, two third container portions 643 is disposed outermost in the width direction. The two third container portions 643 correspond to the width of the third paper 6P3 larger than the width of the second paper 6P2. Similarly, in other rows, the third container portions 643 correspond to the width of the third paper 6P3.

In other words, the fixing regions of the three third container portions 643 disposed leftmost in FIG. 91 are not separated but overlap one another, and the outer end portion of the entire fixing region constituted by the above three third container portions 643 in the width direction coincide with or positioned outside the outer end portion of the image formation region of the third paper 6P3 in the width direction. The entire fixing region constituted by the three third container portions 643 disposed rightmost in FIG. 91 is disposed in a similar manner.

Figure 92:
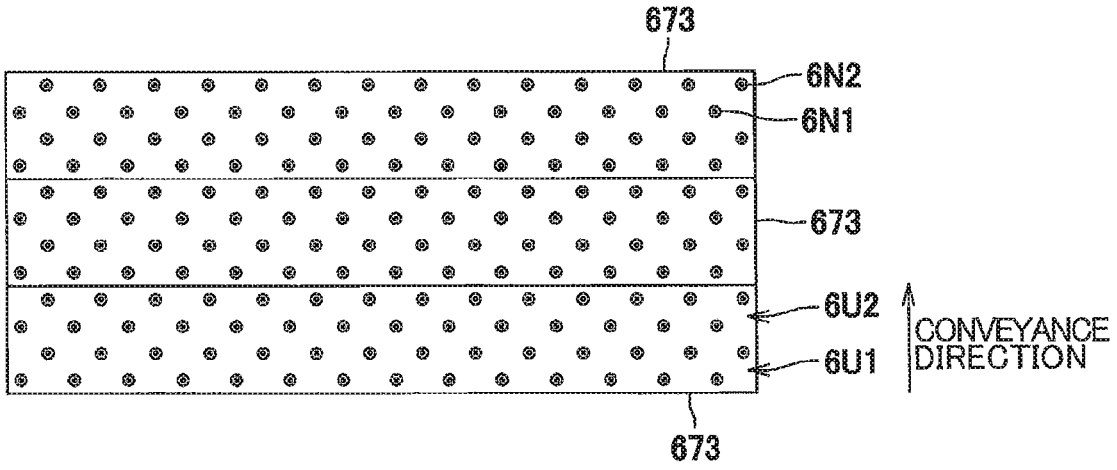
FIG. 92 is a view illustrating a fixing head as a second modification to the seventh embodiment.

Further, as illustrated in FIG. 92, a plurality of container portions 673 may be arranged in the conveyance direction. In this case, each container portion 673 may have a size corresponding to the paper P having a maximum width printable by the laser printer 601.

In the above seventh embodiment, the plurality of container portions 673 is formed separately. However, the container portions 673 in the seventh embodiment may be formed integrally. An example of an embodiment in which the plurality of container portions 673 is formed integrally will be described below with reference to FIG. 93.

Figure 93:
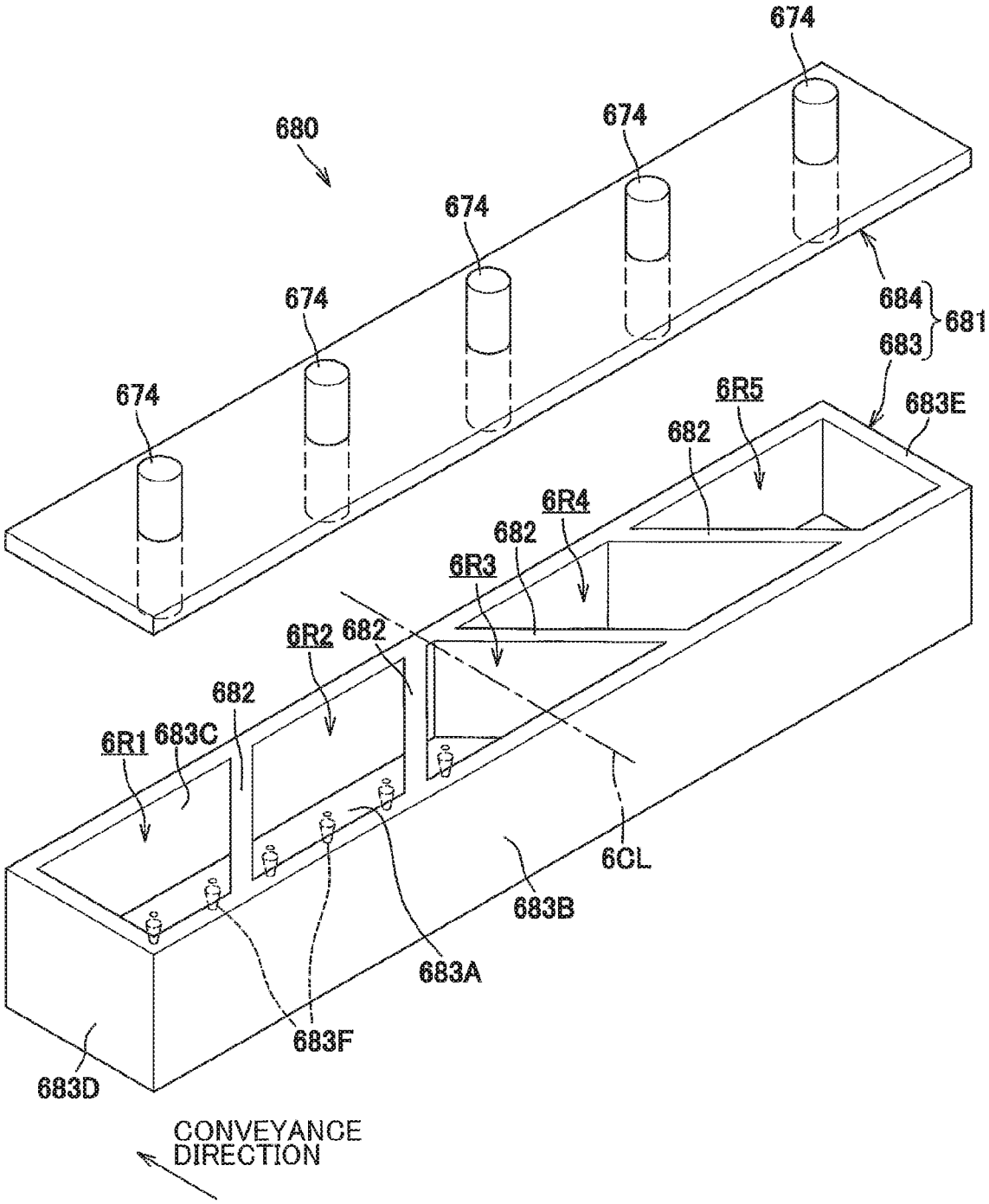
FIG. 93 is a perspective view of a fixing head as a third modification to the seventh embodiment as viewed from diagonally above.

A fixing head 680 illustrated in FIG. 93 has a container 681, a plurality of partitioning walls 682, and a plurality of first electrodes 674. The container 681 has a rectangular container main body 683 opened upward and a lid 684 that closes the opening part of the container main body 683.

The container main body 683 integrally has a bottom wall 683A, a front wall 683B, a rear wall 683C, a left wall 683D, and a right wall 683E. The bottom wall 683A is formed in a rectangular plate shape elongated in the width direction. A plurality of nozzles 683F is formed at appropriate positions of the bottom wall 683A. The plurality of nozzles 683F may be arranged in a similar manner to that of the plurality of nozzles 6N according to the above seventh embodiment.

The front wall 683B extends upward from the upstream end portion of the bottom wall 683A in the conveyance direction. The rear wall 683C extends upward from the downstream end portion of the bottom wall 683A in the conveyance direction.

The left wall 683D extends upward from one end portion (left side end portion) of the bottom wall 683A in the width direction. The left wall 683D is connected to one end portions of the bottom wall 683A, the front wall 683B, and the rear wall 683C with respect to the width direction. The right wall 683E extends upward from the other end portion (right side end portion) of the bottom wall 683A in the width direction. The right wall 683E is connected to the other end portions of the bottom wall 683A, the front wall 683B, and the rear wall 683C with respect to the width direction.

The partitioning walls 682 partition the inner space of the container 681 into a plurality of rooms 6R1 to 6R5. The partitioning walls 682 are formed integrally with the container main body 683 so as to extend upward from appropriate positions of the bottom wall 683A and to extend from the front wall 683B to the rear wall 683C. The partitioning walls 682 may be formed separately from the container main body 683.

The partitioning walls 682 are symmetrically formed with respect to a conveyance center 6CL of the paper P in the width direction. The conveyance center 6CL indicates a common center of the papers in the width direction in an embodiment wherein the papers having different widths are conveyed with their centers aligned to the same position with respect to the width direction, similarly to the embodiment shown in FIG. 91.

Each of the plurality of partitioning walls 682 is inclined with respect to the conveyance direction such that the downstream end portion thereof in the conveyance direction is closer to the conveyance center 6CL than the upstream side end portion thereof to the conveyance center 6CL in the conveyance direction. Further, the two partitioning walls 682 provided on one side of the conveyance center 6CL in the width direction extend parallel to each other, and the two partitioning walls 682 provided on the other side of the conveyance center 6CL in the width direction extend parallel to each other.

The lid 684 is formed in a rectangular plate shape elongated in the width direction. The lower surface of the lid 684 is in contact with and fixed to the upper surfaces of the front wall 683B, the rear wall 683C, the left wall 683D, the right wall 683E, and the partitioning walls 682. In a state where the lid 684 is fixed to the container main body 683, the inner space of the container 681 is partitioned by the partitioning walls 682. Accordingly, the plurality of rooms 6R1 to 6R5 is formed for storing the fixing solution L. In other words, in the seventh embodiment, the container portion storing the fixing solution L is constituted by a part of the container 681 and the partitioning wall(s) 682. As described above, in the seventh embodiment, five container portions are integrally formed.

The first electrodes 674 are provided so as to vertically penetrate the lid 684 at its appropriate positions, and the lower end portions thereof contact the fixing solution L in the respective rooms 6R1 to 6R5.

Figure 94A:
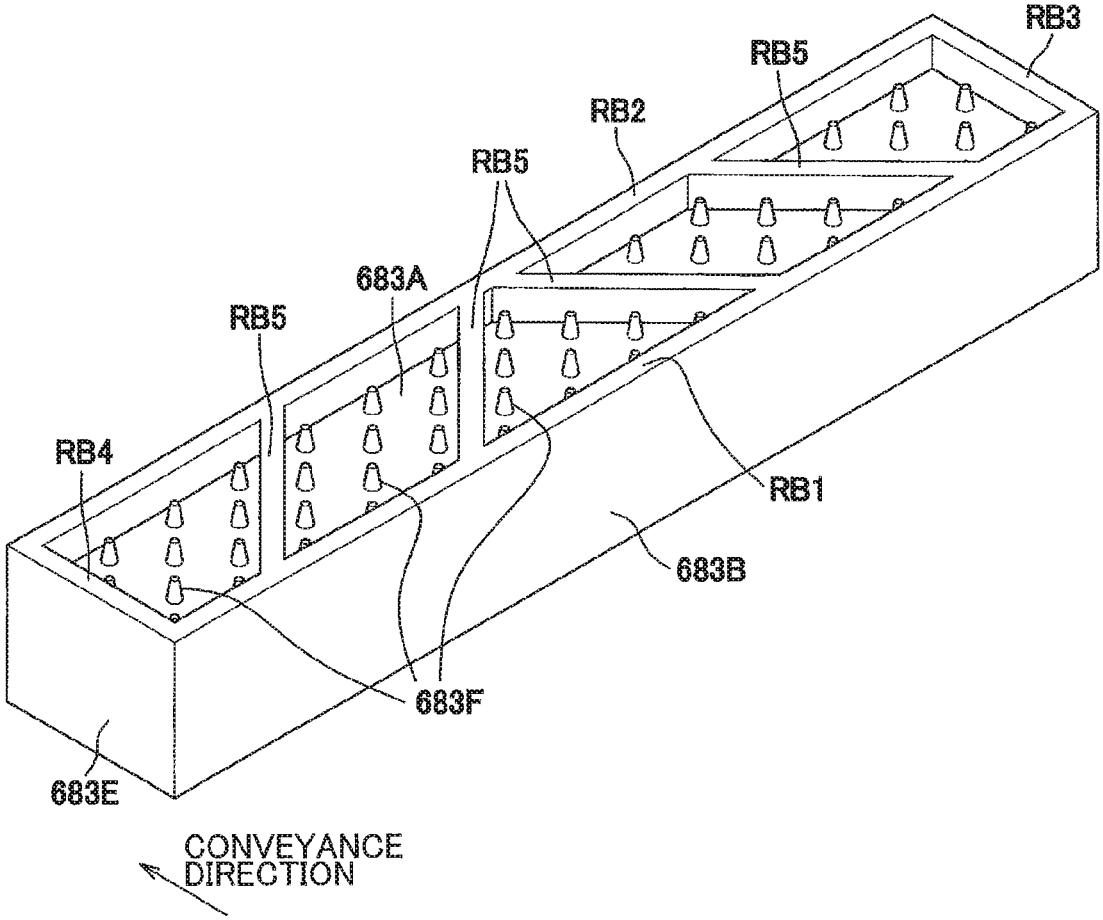
FIG. 94A is a perspective view of the fixing head as the third modification to the seventh embodiment as viewed from diagonally below.
Figure 94B:
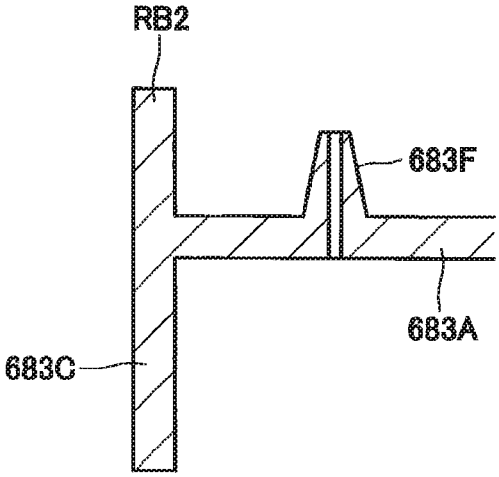
FIG. 94B is a cross-sectional view of the fixing head as the third modification.

As illustrated in FIGS. 94A and 94B, a plurality of ribs RB1 to RB5 is integrally formed with the bottom wall 683A so as to protrude downward from the lower surface of the bottom wall 683A. The ribs RB1 to RB5 are provided for protecting the tips of the respective nozzles 683F from the paper P. The ribs RB1 to RB5 protrude downward so that the lower ends of the ribs RB1-RB5 are lower than the tip ends of the nozzles 683F. The ribs RB1 to RB5 may be formed separately from the bottom wall 683A.

The plurality of ribs RB1 to RB5, the rib RB1 consists of a front rib RB1, a rear rib RB2, a left rib RB3, and a right rib RB4, and four oblique ribs RB5 extending from the front rib RB1 to the rear rib RB2. The front rib RB1, the rear rib RB2, the left rib RB3, and the right rib RB4 are provided along the four sides of the bottom wall 683A.

The oblique ribs RB5 are disposed at projected positions of the partitioning walls 682 when the partitioning walls 682 are projected in the longitudinal direction (protruding direction) of the nozzle 683F. Accordingly, the oblique ribs RB5 are also symmetrical with respect to the conveyance center 6CL in the width direction, so that the paper P guided by the oblique ribs RB5 can be prevented from moving obliquely with respect to the conveyance direction. Further, the oblique ribs RB5 are disposed so that the interval therebetween becomes gradually smaller toward the conveyance center 6CL as they approach the downstream side in the conveyance direction. Accordingly, when the paper P is curled such that the center of the paper P protrudes toward the nozzle 683F side in the cross section perpendicular to the conveyance direction for example, the protruding center of the paper P can be pushed toward the second electrode 672 side by the oblique ribs RB5, whereby the curl of the paper P can be straightened.

Figure 95:
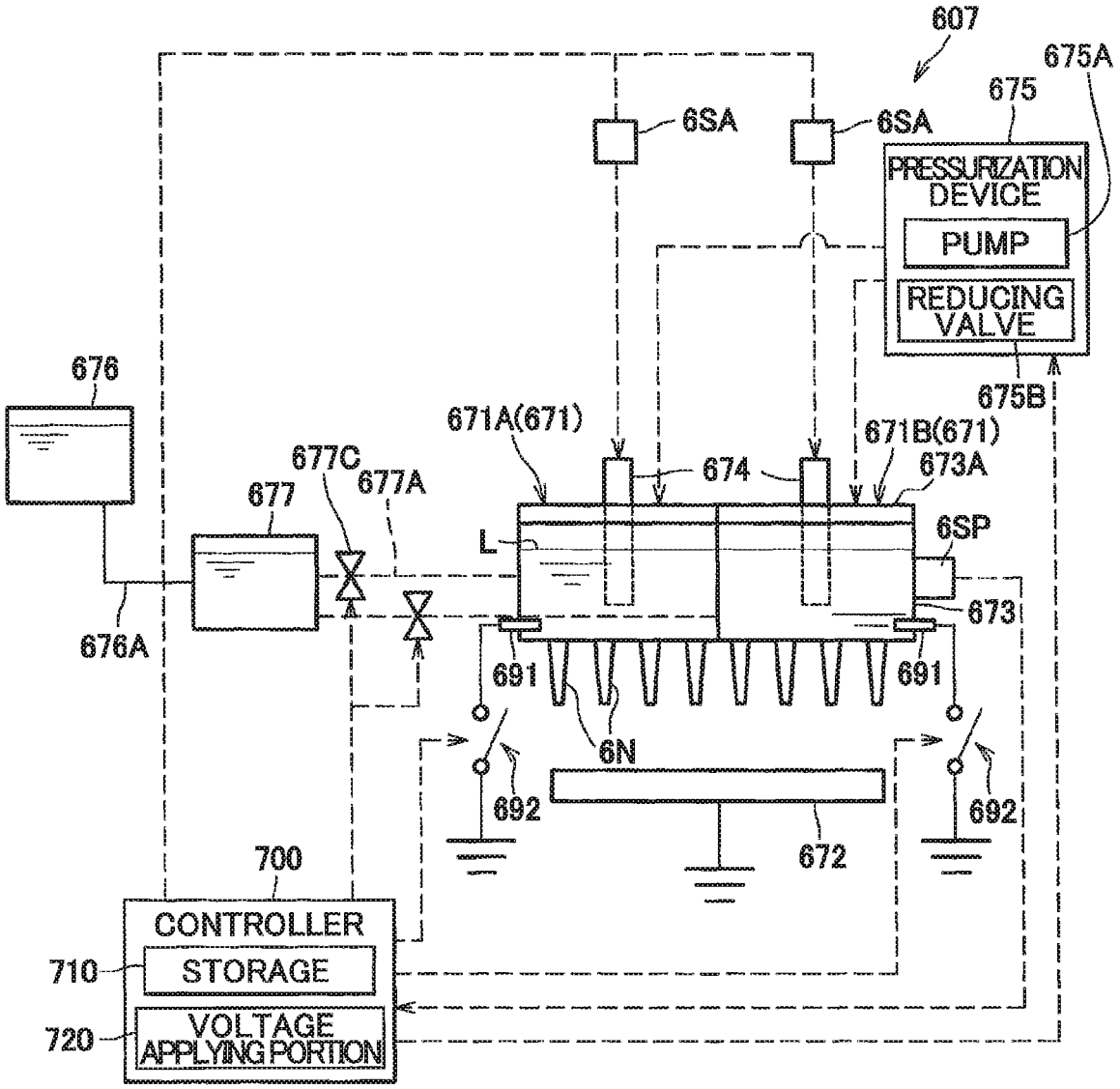
FIG. 95 is a view illustrating a configuration where a grounding portion is provided at each container portion.

In the above seventh embodiment, by providing the insulating valve 677B, a current can be prevented from leaking from a fixing head that performs spraying to a fixing head that does not perform spraying. However, the present invention is not limited to this, and the current leak may be prevented by providing a grounding portion in the fixing head or tank. For example, as illustrated in FIG. 95, a grounding portion 691 may be provided in each of the fixing heads 671A to 671E instead of making the valve 677C conductive on each pipe 677A provided between the tank 677 and each of the fixing heads 671A to 671E.

The grounding portion 691 is a conductive member for grounding the fixing solution L in the container portion 673. The grounding portion 691 is provided so as to penetrate the container portion 673 and contacts the fixing solution L in the container portion 673. The grounding portion 691 is grounded through a switch 692.

The switch 692 can switch between an ON state (first state) in which the fixing solution L in the container portion 673 is grounded and an OFF state (second state) in which the fixing solution L is not grounded. When spraying the fixing solution from a prescribed container portion 673, the controller 600 puts the switch 692 corresponding to the prescribed container portion 673 into the OFF state. On the other hand, when not spraying the fixing solution L from a prescribed container portion 673, the controller 600 puts the switch 692 corresponding to the prescribed container portion 673 into the ON state.

Specifically, when spraying is performed at the first fixing head 671A and not performed at the second fixing head 671B, the controller 600 puts the switch 692 corresponding to the first fixing head 671A that performs spraying into the OFF state, and puts the switch 692 corresponding to the second fixing head 671B that does not perform spraying into the ON state. Thus, even when the charge of the fixing solution L in the first fixing head 671A leaks to the fixing solution L in the second fixing head 671B through the fixing solution L in the pipes 677A or the tank 677, the charge flowing into the fixing solution L in the second fixing head 671B can be released to the ground by the grounding portion 691. As a result, the fixing solution L can be prevented from being erroneously sprayed from the second fixing head 671B that does not perform spraying.

Figure 96:
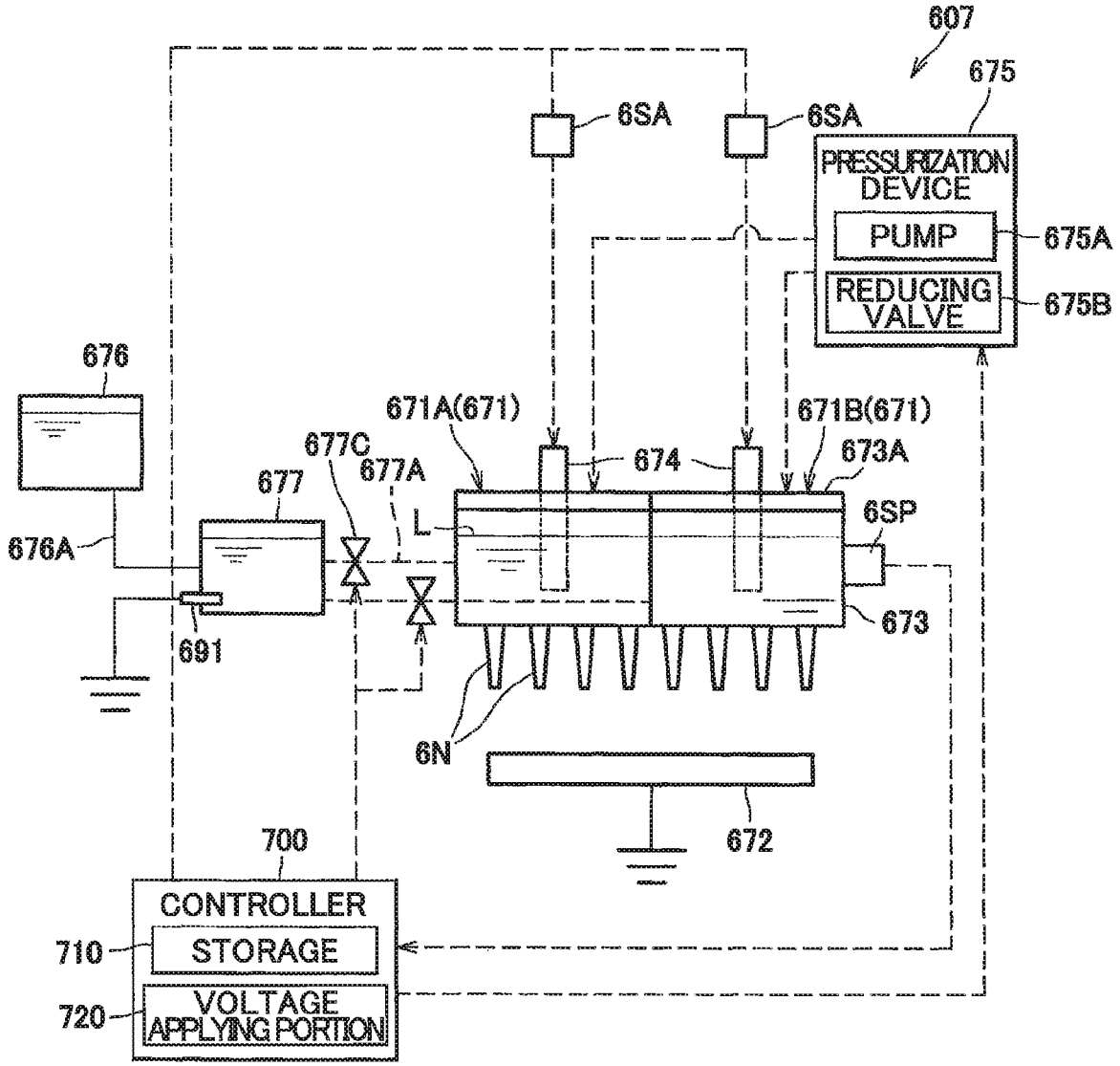
FIG. 96 is a view illustrating a configuration where a grounding portion is provided at a tank.

As illustrated in FIG. 96, the grounding portion 691 may be provided in the tank 677. Specifically, the grounding portion 691 is provided so as to penetrate the tank 677 and contacts the fixing solution L in the tank 677. The grounding portion 691 is directly grounded.

With this configuration, when spraying is performed at the first fixing head 671A and not performed at the second fixing head 671B, the charge of the fixing solution L in the first fixing head 671A can be released by the grounding portion 691 of the tank 677 provided on a flow channel from the first fixing head 671A to the second fixing head 671B. Accordingly, the charge of the fixing solution L in the first fixing head 671A is prevented from flowing into the fixing solution L in the second fixing head 671B through the fixing solution L in the pipes 677A and the tank 677.

In the embodiment illustrated in FIG. 95 or FIG. 96, the valve 677C is provided. However, the present invention is not limited to this, and the valve 677C may not be provided.

In the above seventh embodiment, the voltage applied to the fixing solution in each container portion 673 is controlled in accordance with both the type of the paper P and the image data. However, the present invention is not limited to this, but the voltage may be controlled in accordance with either one of the type of the paper P and the image data.

In the above described seventh embodiment, the voltage V is changed to the second voltage V62 (voltage value at which formation of Taylor cone starts) when the distance between two images is larger than the third distance 6D3. However, the present invention is not limited to this, and the voltage V may be changed to any value that is smaller than the third voltage V63 and larger than the first voltage V61.

In the above seventh embodiment, when the distance from the trailing end of the most upstream fourth image 6G4 to the leading end of the subsequent paper 6P is equal to or smaller than the fourth distance 6D4, the voltage V is set to the second voltage V62 after the most upstream fourth image 6G4 is moved past the fifth fixing region B5. However, the present invention is not limited to this, and the voltage V may be set to any value that is larger than the first voltage V61.

In the above seventh embodiment, in the print control, the voltage V is once increased to the second voltage V62 from the first voltage V1 set in the standby state and then increased to the third voltage V63 for fixing. However, the present invention is not limited to this, and the voltage V may be increased to the third voltage V63 at one time from the first voltage V61 before the leading end of the paper 6P reaches the fixing region, for example.

In the seventh embodiment, the first electrode 674 is disposed in the interior of the container portion 673. However, the present invention is not limited to this. For example, the nozzles and the container portions may be made of a conductive member such as a metal, and the nozzles or the container portion may be applied with a voltage. In this case, each nozzle or each container portion, which is applied with a voltage, functions as the first electrode. In this case, the plurality of conductive container portions may be provided so as to be separated from each other in order to block movement of electric charges between the container portions. Alternatively, insulating members may be provided between the plurality of conductive container portions in order to block movement of electric charges between the container portions. In another case, the container portion may be made of a non-conductive member such as a resin, the nozzles may be made of a conductive member such as a metal, and the nozzles may be applied with a voltage. In this case, each nozzle functions as the first electrode.

In the above seventh embodiment, the present invention is applied to the laser printer 601. However, the present invention is not limited to this, and may be applied to other types of image forming devices, such as a copying machine or a multifunction peripheral.

In the above seventh embodiment, the paper 6P such as a thick paper, a post card, or a thin paper is exemplified as a recording sheet. However, the present invention is not limited to this, and the recording sheet may be an OHP sheet for example.

In the above seventh embodiments, the pressurization device 675 having the pump and the reducing valve is exemplified as a pressure applying means. However, the present invention is not limited to this, and, for example, the pressure applying means may be a cylinder that pressurizes or depressurizes liquid in each head.

In the above seventh embodiment, determination in steps S602 and S606 is made based on the distance. However, the present invention is not limited to this, and the determination in steps S602 and S606 is made based on the time.

In the above seventh embodiment, a voltage is applied in the standby state. However, the present invention is not limited to this, and a voltage may not be applied in the standby state.

In the above seventh embodiment, each of the fixing regions B1-B5 is the same in shape, size, and position as a lower surface of the corresponding container portion 673 for descriptive convenience. However, the present invention is not limited to this, and the fixing region may be smaller or larger in size than the lower surface of the container portion. That is, the fixing region may be defined based on the front-rear width and left-right width of the fixing solution to be sprayed onto the paper.

The seventh object can be achieved by the seventh embodiment and any modification thereof described with reference to FIGS. 80 to 96. The above-described seventh embodiment is one example of the seventh invention, and the seventh invention is not limited to this.

A laser printer 701 of an eighth embodiment of the present invention will be described in detail with reference to FIGS. 97 to 106. In the eighth embodiment, like parts and components are designated with the same reference numerals as the first embodiment to avoid duplicating description.

Figure 97:
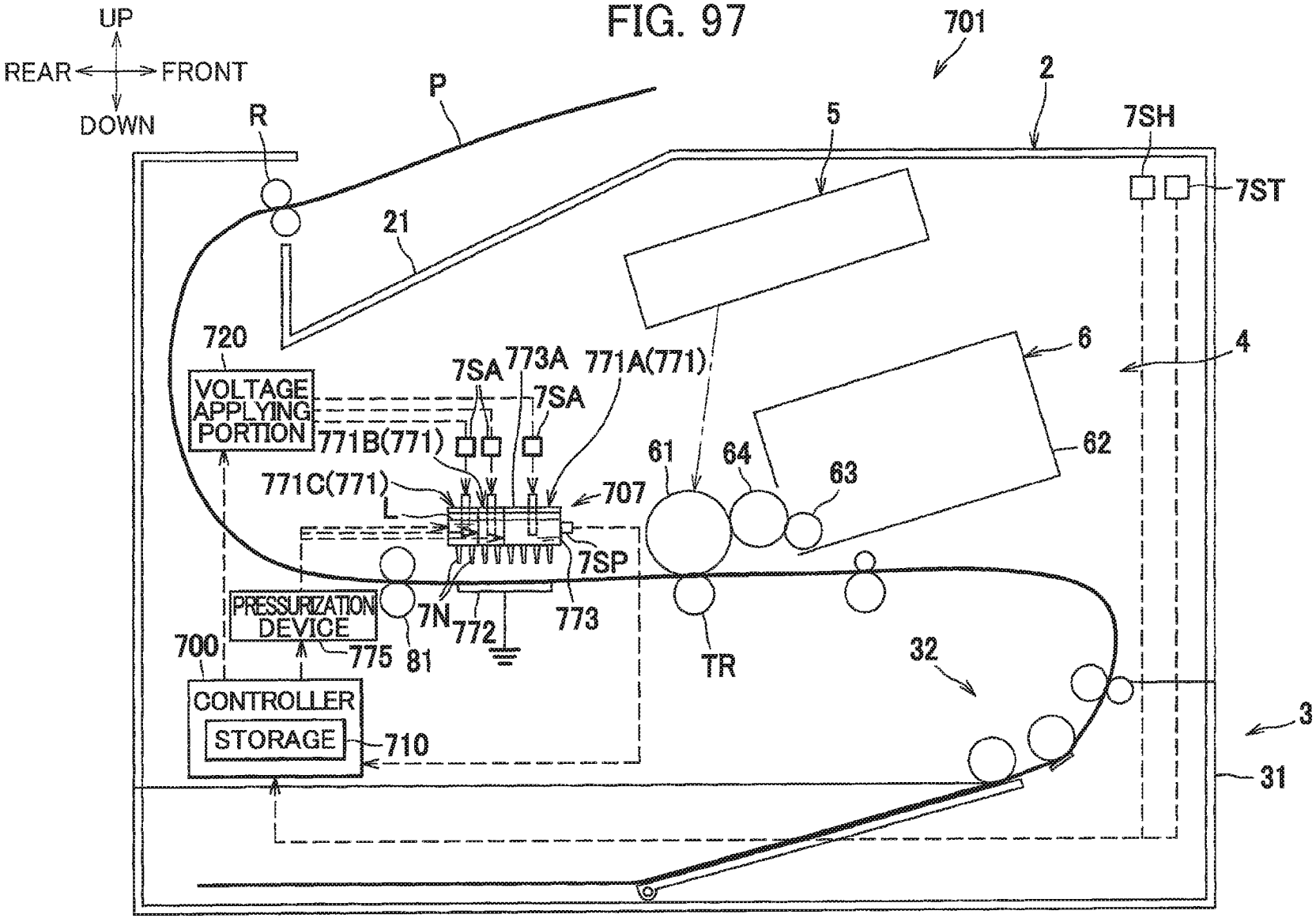
FIG. 97 is a view illustrating a laser printer provided with a fixing device according to an eighth embodiment of the present invention.

In the following description, directions are defined with respect to a position of a user using the laser printer. That is, the right side of FIG. 97 is defined as a front side, the left side of FIG. 97 is defined as a rear side, the far side of FIG. 97 is defined as a right side, and the near side of FIG. 97 is defined as a left side. The upward and downward directions of FIG. 97 are defined as an upward direction and a downward direction.

As illustrated in FIG. 97, the laser printer 701 further has a fixing device 707.

The fixing device 707 is configured to spray electrically charged fixing solution L as one example of a liquid toward the toner image on the paper P and fixes the toner image to the paper P under the electrostatic spraying method. A configuration of the fixing device 707 will be described in detail later.

A downstream side conveyance roller 81 is provided on the downstream side of the fixing device 707 in order to convey the paper P, which is discharged from the fixing device 7, to the downstream side with respect to the conveyance direction of the paper P.

Next, the configuration of the fixing device 7 will be described in detail.

The fixing device 707 has a fixing head 771 for spraying the fixing solution L and a second electrode 772 disposed below the fixing head 771 for supporting the paper P.

The fixing head 771 has a first head 771A, a second head 771B, and a third head 771C. The heads 771A to 771C are arranged in this order from the upstream side to the downstream side in the conveyance direction of the paper P.

The first head 771A has a container portion 773 that stores therein the fixing solution L, a plurality of nozzles 7N that communicates with the container portion 773 and is configured to spray the fixing solution L toward the toner image, and a first electrode 774 that is configured to apply a voltage to the fixing solution L in the container portion 773 and the nozzles 7N. The second and third heads 771B and 771C have substantially the same configurations as the first head 771A, so the same reference numerals as those given to the members constituting the first head 771A are given to the members constituting each of the second and third heads 771B and 771C, and description thereof will be omitted appropriately.

The first electrode 774 is provided so as to penetrate a top wall 773A of the container portion 773 from the top to bottom thereof. The lower end portion of the first electrode 774 is disposed in the fixing solution L in the container portion 773, and the upper end portion thereof is connected to a voltage applying portion 720 controlled by a controller 700. The voltage to be applied to the first electrode 774 is preferably in a range of 1 kV to 10 kV. A plurality of current sensors 7SA is provided so as to correspond to respective ones of the first electrodes 774A. Each current sensor 7SA is located between the corresponding first electrode 774 and the voltage applying portion 720. A current flowing in the first electrode 774 is detected by the corresponding current sensor 7SA. However, the current flowing in the first electrode may be detected by the voltage applying portion 720.

A pressurization device 775, which is an example of a pressure applying portion, is connected to the heads 771A to 771C. The pressurization device 775 is a device that applies pressure to the fixing solution L in the heads 771A to 771C. The pressurization device 775 has a pump that feeds the fixing solution L into the heads 771A to 771C for pressurization and a reducing valve that releases the fixing solution L from the heads 771A to 771C for depressurization. Further, a plurality of pressure sensors 7SP is provided for detecting pressures in respective ones of the heads 771A to 771C. In FIG. 97, only one pressure sensor 7SP is illustrated as a representative example. In the eighth embodiment, the pressure inside each of the heads 771A to 771C is adjusted by the pressurization device 775. However, the pressure inside each of the heads 771A to 771C may be adjusted by the water head difference of the fixing solution L inside the head.

The second electrode 772 is configured to be contact with the paper so as to generate a potential difference (electric field) between the fixing solution L contained in the nozzles 7N and the paper P. The second electrode 772 is disposed below each head 771A-771C so as to be separated from the tip ends of the nozzles 7N of each head 771A-771C by a predetermined distance. Here, the predetermined distance is larger than the thickness of the paper P, and determined through an experiment or a simulation so that the electrostatic spraying can be satisfactorily performed.

The second electrode 772 is grounded. The second electrode 772 need not necessarily be grounded, but a voltage lower than one applied to the first electrode 774 may be applied to the second electrode 772. The second electrode 772 forms an electric field between itself and the tips of the nozzles 7N.

When a voltage is applied to the first electrode 774, an electric field is formed in a space around the tip of each nozzle 7N. Specifically, the fixing solution L in the container portion 773 is applied with a pressure by the pressurization device 775. Accordingly, the fixing solution L is supplied toward the tip of each nozzle 7N, whereby an electric field is formed between the fixing solution L at the tip of each nozzle 7N and the second electrode 772. Then, at the tip of each nozzle 7N, the fixing solution L is attracted by the electric field to form so-called Taylor cone. The electric field is concentrated on the tip of the Taylor cone, with the result that the fixing solution L is torn off from the tip of the Taylor cone. Accordingly, a fine droplet is generated.

The current sensor 7SA is a sensor that detects a current flowing in the first electrode 774 to indirectly detect a current flowing in the fixing solution L. The current sensor 7SA detects a current flowing in the first electrode 774 when the fixing solution L is sprayed from the nozzle 7N to paper P, and outputs a detected value thereof to the controller 700. When the fixing solution L is not sprayed from the nozzle 7N, no current flows in the first electrode 774 even if a voltage is applied to the first electrode 774. A current flows in the first electrode 774 when the fixing solution L is sprayed from the nozzle 7N, that is, when the charged fixing solution L is moved from the nozzle 7N to the paper P.

The first electrode 774 and the second electrode 772, configured in such a manner, constitute a potential difference generating portion which generates a potential difference between the fixing solution L contained in the nozzles 7N and the paper P which is being conveyed and passing through a position separated from the nozzles 7N.

Further, a temperature sensor 7ST for detecting temperature and a humidity sensor 7SH for detecting humidity are provided in the casing 2. The temperature sensor 7ST and the humidity sensor 7SH output a detected temperature and a detected humidity to the controller 700, respectively. In the eighth embodiment, the temperature around the fixing device 707 is detected by the temperature sensor 7ST. However, the present invention is not limited to this, and the temperature of the fixing solution L may be detected by the temperature sensor.

Figure 98A:
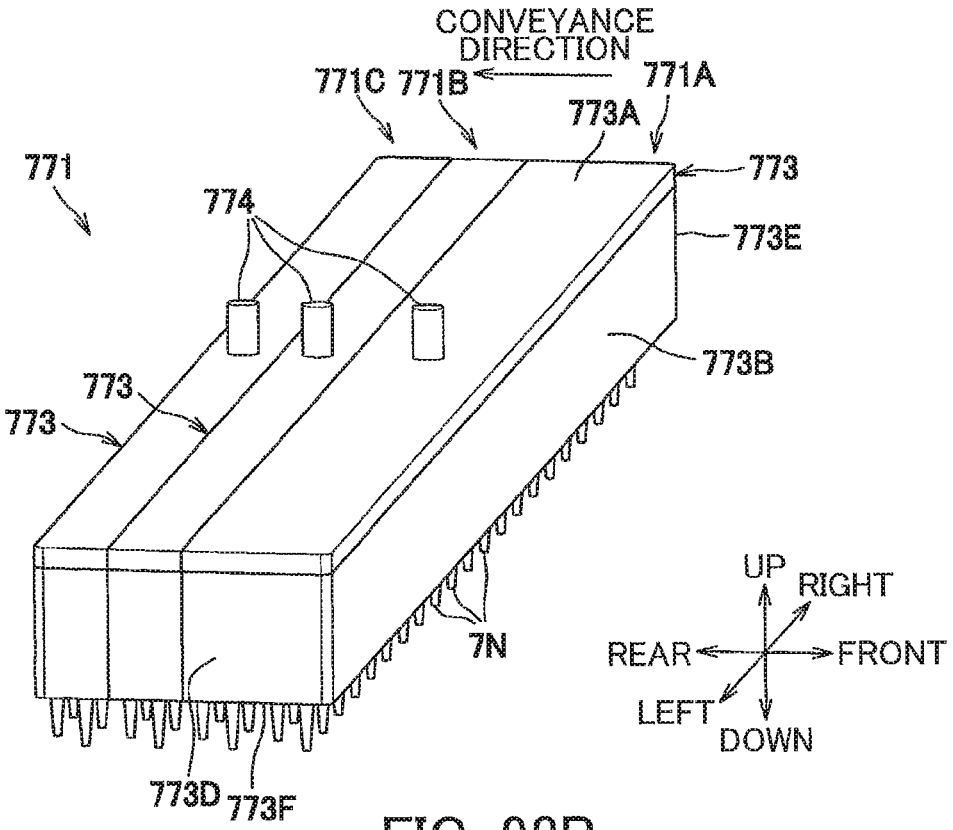
FIG. 98A is a perspective view of a fixing head as viewed from diagonally above.

As illustrated in FIG. 98A, the container portion 773 of the first head 771A is a container having a rectangular shape elongated in the left-right direction, i.e., in the width direction of the paper P and has a top wall 773A, a front wall 773B, a rear wall 773C, a left wall 773D, a right wall 773E, and a bottom wall 773F. The container portion 773 of the second head 771B has the same size as that of the container portion 773 of the first head 771A in the left-right direction and has a smaller size than that of the container portion 773 of the first head 771A in the conveyance direction. The container portion 773 of the third head 771C has the same size as that of the container portion 773 of the second head 771B.

Figure 98B:
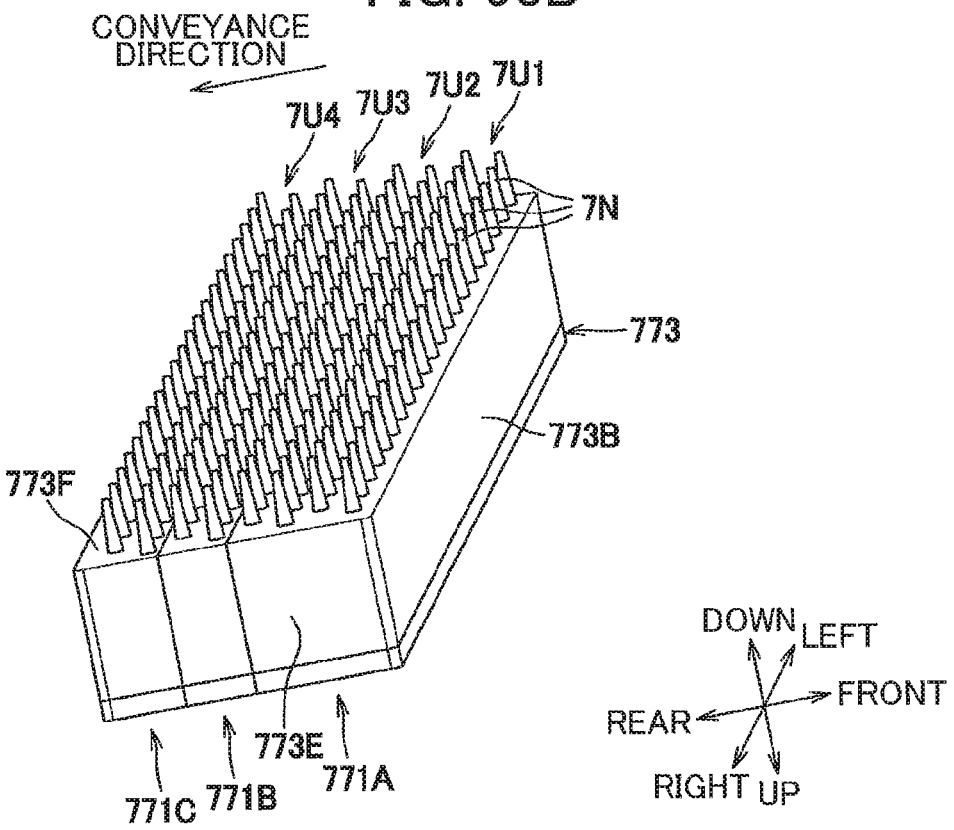
FIG. 98B is a perspective view of the fixing head as viewed from diagonally below.

As illustrated in FIG. 98B, the plurality of nozzles 7N in each of the heads 771A to 771C protrudes downward from the bottom wall 773F of the container portion 773. A diameter of each nozzle 7N reduces as it goes downward. The plurality of nozzles 7N is arranged both in the width direction of the paper P (left-right direction) and the conveyance direction of the paper P (front-rear direction). The inner diameter of each nozzle 7N is preferably in a range from 0.1 mm to 1.0 mm.

Specifically, the plurality of nozzles 7N in the first head 771A constitutes first and second staggered array groups 7U1 and 7U2 arranged in the conveyance direction. The plurality of nozzles 7N in the second head 771B constitutes a third staggered array group 7U3, and the plurality of nozzles 7N in the third head 771C constitutes a fourth staggered array group 7U4.

Figures 99A, 99B:
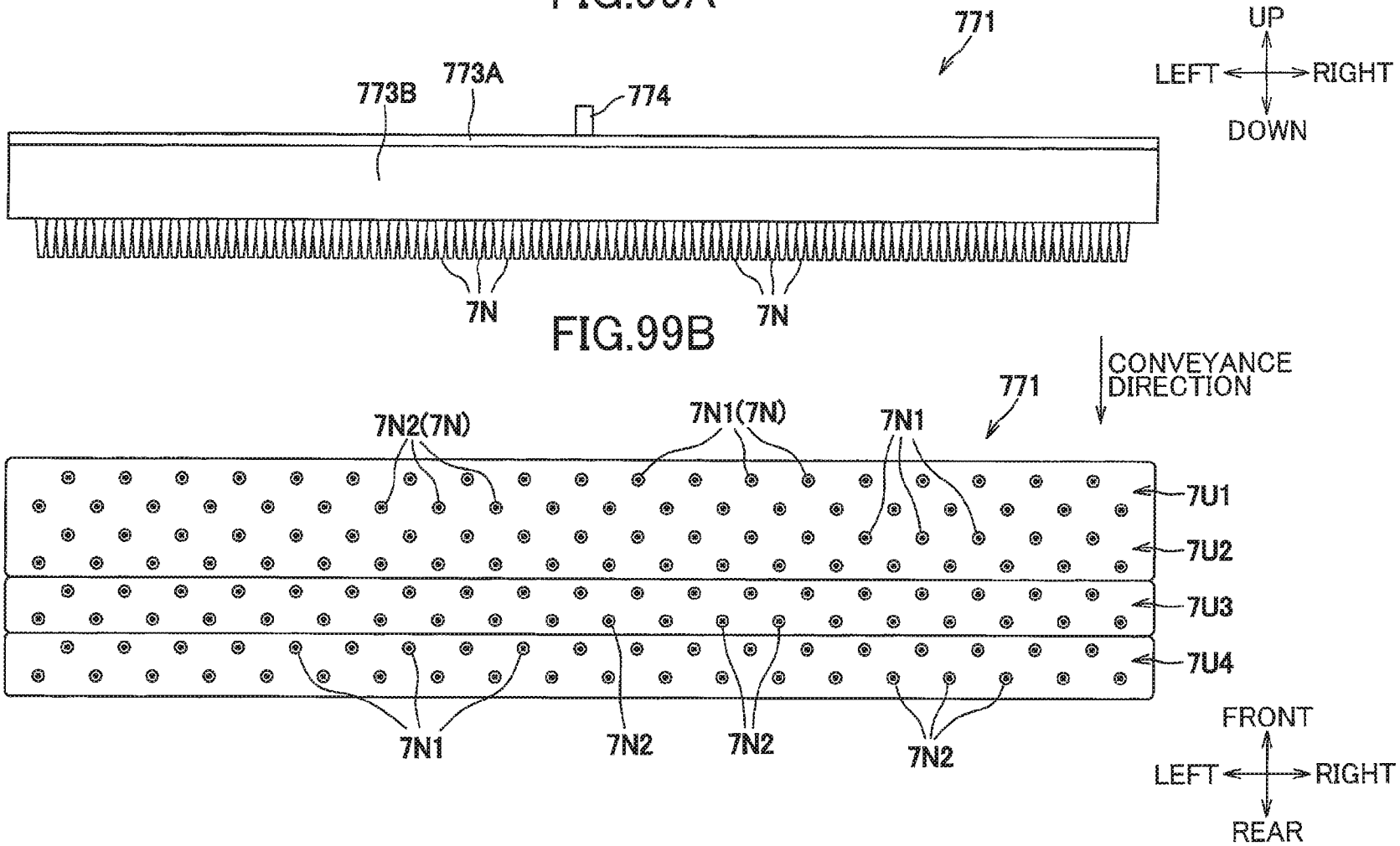
FIG. 99A is a front view of the fixing head.
FIG. 99B is a bottom view of the fixing head.
Figure 100A:
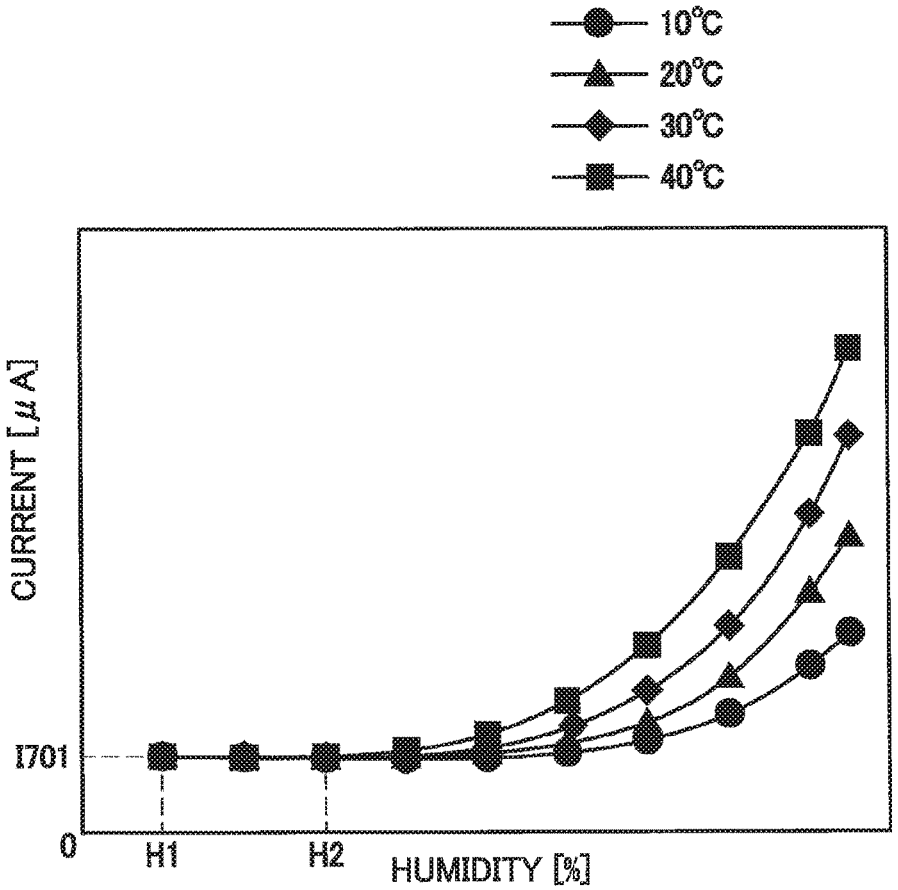
FIG. 100A is a view showing a first electrical current value table.
Figure 100B:
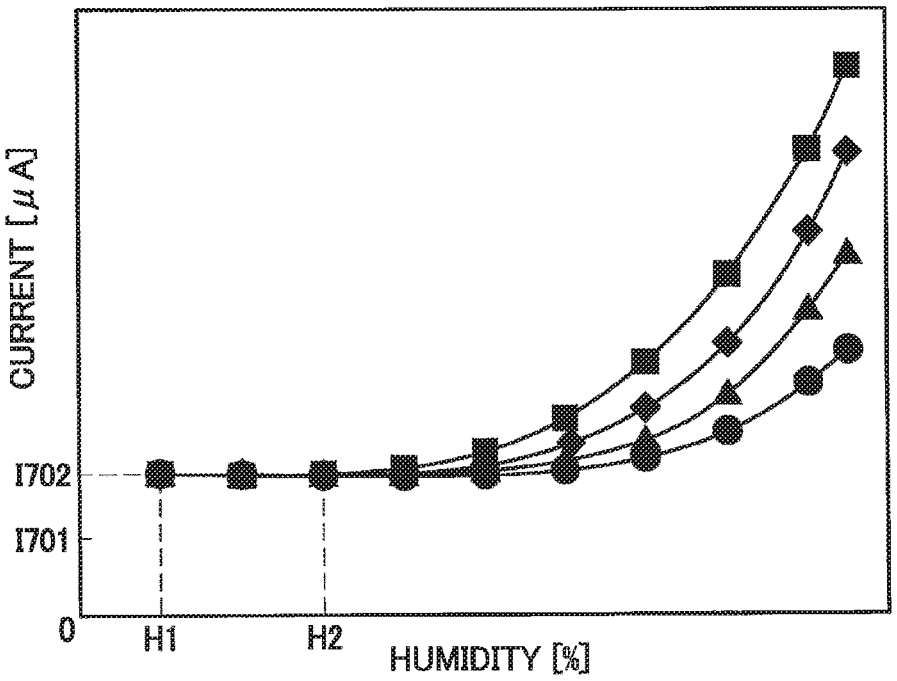
FIG. 100B is a view showing a second electrical current value table.

As illustrated in FIGS. 99A and 99B, the first staggered array group 7U1 includes a plurality of first nozzles 7N1 arranged at regular intervals in the width direction and a plurality of second nozzles 7N2 arranged at regular intervals in the width direction. The first nozzles 7N1 and the second nozzles 7N2 are alternately arranged in the width direction with the first nozzles 7N1 disposed in one side with respect to the conveyance direction and with the second nozzles 7N2 disposed in the other side with respect to the conveyance direction. The second nozzle 7N2 is disposed between two first nozzles 7N1 in the width direction. A shape formed by connecting two first nozzles 7N1 adjacent to each other in the width direction and the second nozzle 7N2 disposed between the two first nozzles 7N1 is a regular triangle or an isosceles triangle. Similarly, a shape formed by connecting two second nozzles 7N2 adjacent to each other in the width direction and the first nozzle 7N1 disposed between the two second nozzles 7N2 is a regular triangle or an isosceles triangle.

Each of the second staggered array group 7U2, the third staggered array group 7U3, and the fourth staggered array group 7U4 has the same structure as that of the first staggered array group 7U1. In the eighth embodiment, a nozzle pitch (shortest nozzle pitch) may be set in a range equal to or larger than 1 mm and equal to or smaller than 14 mm.

As illustrated in FIG. 97, the controller 700 has a storage 710 including a RAM, a ROM, and the like, a CPU, and an input/output circuit. The controller 700 has a function to control a voltage to be applied to the first electrode 774 and to control the pressurization device 775, on the basis of externally input image data and signals from the pressure sensors 7SP, the current sensors 7SA, the temperature sensor 7ST, and the humidity sensor 7SH.

Specifically, the controller 700 has a function to determine a target amount of spray based on image density of print data. Here, the target amount of spray is a target value of the fixing solution L to be sprayed per unit area of the paper P. More specifically, when the print data is text data, the controller 700 sets a prescribed first amount ρ1 of spray as the target amount of spray. On the other hand, when the print data is image data, that is, when the image density of the print data is higher than that of the text data, the controller 700 sets a second amount ρ2 of spray larger than the first amount ρ1 as the target amount of spray.

Further, the controller 700 has a function to determine a current value to be flowing in the fixing solution L based on the temperature detected by the temperature sensor 7ST and the humidity detected by the humidity sensor 7SH. Specifically, the storage 710 stores a first electric current value table illustrated in FIG. 100A and a second electric current value table illustrated in FIG. 100B. In the eighth embodiment, the electric current value tables are stored in the storage 710 as graphs (mathematical functions). However, the present invention is not limited to this, and each electric current value tables may be stored in the storage 710 in a tabular form.

When setting the target amount of spray to the first amount ρ1, the controller 700 selects the first electric current value table. When setting the target amount of spray to the second amount ρ2, the controller 700 selects the second electric current value table. The controller 700 determines a current value based on the selected electric current value table, temperature, and humidity.

The first electric current value table is a table that indicates the relationship among a current value corresponding to the first amount ρ1, the temperature, and the humidity (relative humidity) and is appropriately set by experiments or simulations. In the first electric current value table, when the humidity falls within a range from a first humidity H1 to a second humidity H2, the current value is set to substantially the same value (I701) irrespective of the temperature. When the humidity is higher than the second humidity H2, the current value is set to a larger value as the humidity becomes higher and as the temperature becomes higher.

The first electric current value table is set in consideration of a phenomenon in which the higher the temperature or humidity is, the more the current is discharged to the air. Further, the current value I701 is set to a current value required for spraying the first amount ρ1 in a state where a pressure (required pressure PRc to be described later) required for spraying the first amount ρ1 is applied to the fixing solution L. The second electric current value table and the current value I702 to be described later are respectively set in a similar way.

The second electric current value table is a table that indicates the relationship among a current value corresponding to the second amount ρ2, the temperature, and the humidity (relative humidity) and is appropriately set by experiments or simulations. In the second electric current value table, when the humidity falls within a range from a first humidity H1 to a second humidity H2, the current value is set to substantially the same value (I702) irrespective of the temperature. When the humidity is higher than the second humidity H2, the current value is set to a larger value as the humidity becomes higher and as the temperature becomes higher.

After determining the current value, the controller 700 further has a function to control the voltage such that the current value detected by the current sensor 7SA becomes the determined current value. Hereinafter, the determined current value is referred to also as "target current value".

The controller 700 further has a function to determine a pressure value to be applied to the fixing solution L based on the temperature detected by the temperature sensor 7ST. Specifically, the storage 710 stores a first pressure table illustrated in FIG. 101A and a second pressure table illustrated in FIG. 101B. In the eighth embodiment, the pressure tables are stored in the storage 710 as graphs (mathematical functions). However, the present invention is not limited to this, and each pressure table may be stored in the storage 710 in a tabular form.

When setting the target amount of spray to the first amount ρ1, the controller 700 selects the first pressure table. When setting the target amount of spray to the second amount ρ2, the controller 700 selects the second pressure table. The controller 700 determines a pressure value based on the selected pressure table and temperature. The pressure tables are appropriately set by experiments or simulations.

The first pressure table includes a first required pressure table Pn1, a first upper limit pressure table Pmax1, and a first lower limit pressure table Pmin1. The first required pressure table Pn1 is a table indicating the relationship between temperature and a pressure required for achieving the first amount ρ1. In this table, the pressure is set to a lower value as the temperature becomes higher. Specifically, in a low temperature region from 0° C. to a prescribed temperature T701, a pressure variation (a ratio of a decrease in the pressure relative to an increase in the temperature) becomes larger than that in a normal/high temperature region. Here, the normal/high temperature region is a region of the temperature higher than the prescribed temperature T701. This is because the viscosity of the fixing solution is changed depending on the temperature thereof. The fixing solution becomes higher in viscosity as the temperature becomes lower. So, when the temperature is low, it is necessary to increase the pressure to be applied to the fixing solution in order to achieve a desired amount of spray. Further, the fixing solution becomes lower in viscosity as the temperature becomes higher. So, when the temperature is high, it is necessary to reduce the pressure to be applied to the fixing solution in order to achieve a desired amount of spray. The first required pressure table Pn1 can be obtained by experiments.

The first upper limit pressure table Pmax1 is a table that indicates the relationship between temperature and the upper limit value of the pressure. Here, the upper limit value of the pressure is an upper limit of the pressure at which the fixing solution L can normally be sprayed in a state where a voltage corresponding to the first amount ρ1 is applied to the first electrode 774. In the table, the pressure is set to a smaller value as the temperature becomes higher. Specifically, in the low temperature region from 0° C. to the prescribed temperature T701, the pressure is set to a substantially constant value of PR704, and a pressure variation gradually becomes larger as the temperature is increased from the prescribed temperature T701. Then, when the temperature is increased to a certain high degree, the pressure variation gradually becomes smaller.

Specifically, the first upper limit pressure table Pmax1 indicates the upper limit value of the pressure to be applied to the container portion 773 for maintaining the Taylor cone at the tip of the nozzle 7N. In general, the Taylor cone is formed only in a specific range of flow rate of the solution (amount of the fixing solution to be supplied to the tip of the nozzle 7N) and in a specific range of electric field. When the electric field or the flow rate falls outside (above or below) the corresponding specific range for forming the Taylor cone, stable Taylor cone is not formed. Thus, it is necessary to adjust the pressure in the container portion 773 for controlling the amount of the fixing solution L to be supplied to the tip of the nozzle 7N.

In order to spray the fixing solution L from the nozzle N in a good condition in electrostatic spraying, the Taylor cone needs to be formed at the tip of the nozzle 7N. The Taylor cone is formed when the surface tension of the fixing solution L at the tip of the nozzle 7N is balanced with electrostatic force caused by the electric field. When electric field intensity is increased in this balanced state, the electrostatic force at the tip of the Taylor cone and the surface tension repulse each other, whereby a fine droplet is sprayed.

In order to supply the fixing solution L to the tip of the nozzle 7N, it is necessary to pressurize the fixing solution L inside the fixing head 771 using the pressurization device 775. However, when the pressure that the pressurization device 775 applies to the fixing solution L is excessively high, the balance between the surface tension and the electric field for maintaining the Taylor cone cannot be kept, with the result that the Taylor cone cannot be formed satisfactorily at the tip of the nozzle 7N. That is, assuming that the formed electric field and nozzle diameter are constant, the surface tension of the fixing solution L is dominant in the condition for maintaining the Taylor cone.

That is, the first upper limit pressure table Pmax1 can be experimentally obtained as a function of the surface tension of the fixing solution L. It is known that the surface tension of liquid is a decreasing function of temperature (upward-convex function in a low temperature, downward-convex function in a high temperature).

Thus, the controller 700 controls, on the basis of the first upper limit pressure table Pmax1 stored in the storage 710, the pressurization device 775 such that the pressure of the fixing solution L in the container portion 773 does not exceed the first upper limit pressure table Pmax1.

The first lower limit pressure table Pmin1 is a table that indicates the relationship between temperature and the lower limit value of the pressure. Here, the lower limit value of the pressure is a lower limit of the pressure at which the fixing solution L can normally be sprayed in a state where a voltage corresponding to the first amount ρ1 is applied to the first electrode 774. In the table, the pressure is set to a smaller value as the temperature becomes higher. Specifically, in the low temperature region from 0° C. to the prescribed temperature T701, the pressure is set to a substantially constant value of PR702 (PR702<PR704), and a pressure variation gradually becomes larger as the temperature is increased from the prescribed temperature T701. Then, when the temperature is increased to a certain high degree, the pressure variation gradually becomes smaller.

The first lower limit pressure table Pmin1 indicates the lower limit value of the pressure to be applied to the fixing solution L for forming the Taylor cone at the tip of the nozzle 7N. When the applied pressure is smaller than the first lower limit pressure table Pmin1, the shape of the fixing solution L is maintained by the surface tension thereof, and thus the Taylor cone is not formed. Thus, it is necessary to apply pressure to the fixing solution L in the container portion 773 for facilitating formation of the Taylor cone. At this time, the first lower limit pressure table Pmin1 is applied to the fixing solution L in the container portion 773 and, if the nozzle diameter is constant, the first lower limit pressure table Pmin1 can be experimentally obtained as a function of the surface tension of the fixing solution L.

The second pressure table includes a second required pressure table Pn2, a second upper limit pressure table Pmax2, and a second lower limit pressure table Pmin2 The second required pressure table Pn2 is a table indicating the relationship between temperature and a pressure required for achieving the second amount ρ2. In this table, the pressure is set to a lower value as the temperature becomes higher. Specifically, in the low temperature region from 0° C. to the prescribed temperature T701, a pressure variation becomes larger than that in the normal/high temperature region. Here, the normal/high temperature region is a region of the temperature higher than the prescribed temperature T701.

The second upper limit pressure table Pmax2 is a table that indicates the relationship between the upper limit value of the pressure and temperature. Here, the upper limit value of the pressure is an upper limit of the pressure at which the fixing solution L can normally be sprayed in a state where a voltage corresponding to the second amount ρ2 is applied to the first electrode 774. In this table, the pressure is set to a smaller value as the temperature becomes higher. Specifically, in the low temperature region from 0° C. to the prescribed temperature T701, the pressure is set to a substantially constant value of PR703 (PR702<PR703<PR704), and a pressure variation gradually becomes larger as the temperature is increased from the prescribed temperature T701. Then, when the temperature is increased to a certain high degree, the pressure variation gradually becomes smaller.

The second lower limit pressure table Pmin2 is a table that indicates the relationship between temperature and the lower limit value of the pressure. Here, the lower limit value of the pressure is a lower limit value of the pressure at which the fixing solution L can normally be sprayed in a state where a voltage corresponding to the second amount ρ2 is applied to the first electrode 774. In the table, the pressure is set to a smaller value as the temperature becomes higher. Specifically, in the low temperature region from 0° C. to the prescribed temperature T701, the pressure is set to a substantially constant value of PR701 (PR701<PR702), and a pressure variation gradually becomes larger as the temperature is increased from the prescribed temperature T701. Then, when the temperature is increased to a certain high degree, the pressure variation gradually becomes smaller.

In a case where the target amount of spray is the first amount ρ1 and where the temperature detected by the temperature sensor 7ST is a prescribed temperature, the controller 700 acquires a required pressure PRα, an upper limit PRβ, and a lower limit PRγ corresponding to the prescribed temperature from the first required pressure table Pn1, the first upper limit pressure table Pmax1, and the first lower limit pressure table Pmin1, respectively. Then, when the relationship among the PRα, PRβ, and PRγ is PRγ≤PRα≤PRβ, the controller 700 sets the required pressure PRα as a target pressure of the fixing solution L. When PRβ<PRα is satisfied, the controller 700 sets the upper limit PRβ as the target pressure. When PRα<PRγ is satisfied, the controller 700 sets the lower limit PRγ as the target pressure. Similarly, when the target amount of spray is the second amount ρ2, the controller 700 acquires the required pressure PRα, the upper limit PRβ, and the lower limit PRγ from the second required pressure table Pn2, the second upper limit pressure table Pmax2, and the second lower limit pressure table Pmin2, respectively, and sets the target pressure by comparing the above values.

Figure 102A:
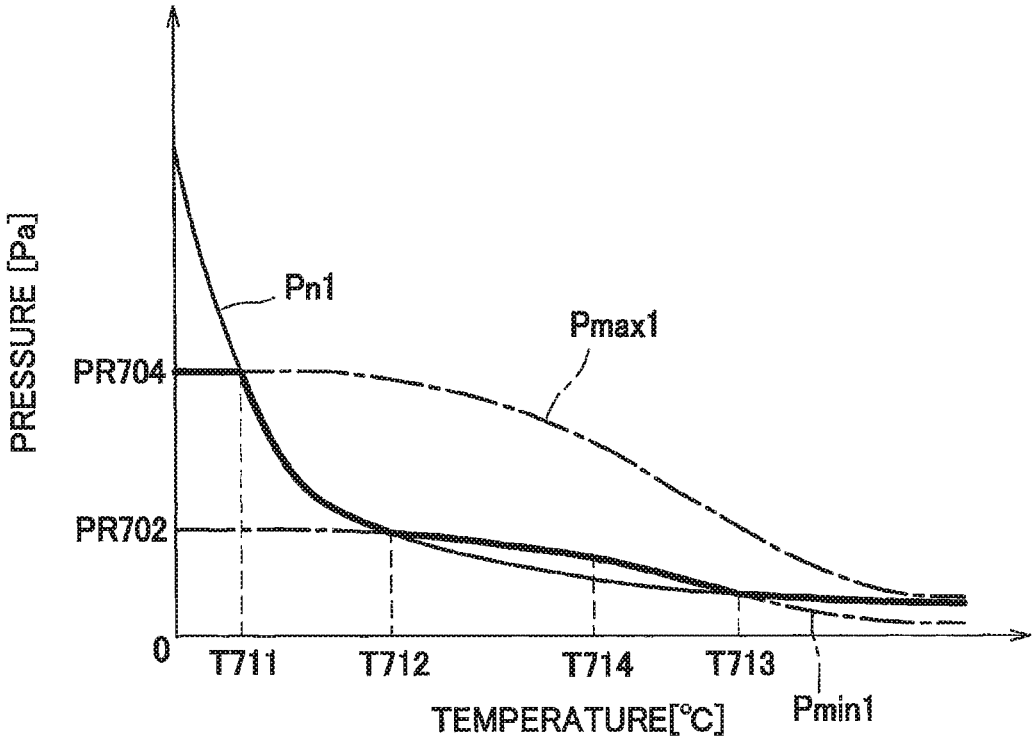
FIG. 102A is a view showing a selected pressure as a target pressure in the first pressure table.

That is, as illustrated in FIG. 102A, when the target amount of spray is the first amount ρ1, the controller 700 selects the upper limit PRβ in a temperature range from 0° C. to T711, selects the required pressure PRα in a temperature range from T711 to T712, selects the lower limit PRγ in a temperature range from T712 to T713, and selects the required pressure PRα when the temperature is higher than T713. When the temperature is in a range from T711 to T712 or the temperature is higher than T713, the required pressure PRα corresponds to a first pressure. When the temperature is in a range from 0° C. to T711, the upper limit PRβ corresponds to a second pressure. When the temperature is in a range from t712 to T713, the lower limit PRγ corresponds to a third pressure. The second pressure can be set to a value equal to the maximum pressure that can maintain the Taylor cone of the fixing solution L at the tip of each of the nozzles 7N. The third pressure can be set to a value equal to the minimum pressure that can form the Taylor cone of the fixing solution L at the tip of each of the nozzles 7N.

The above current value I701 is set to a current value required to achieve the first amount ρ1 when the required pressure PRα is applied to the fixing solution L in a case where the temperature is in a range from T711 to T712 or higher than T713.

Figure 102B:
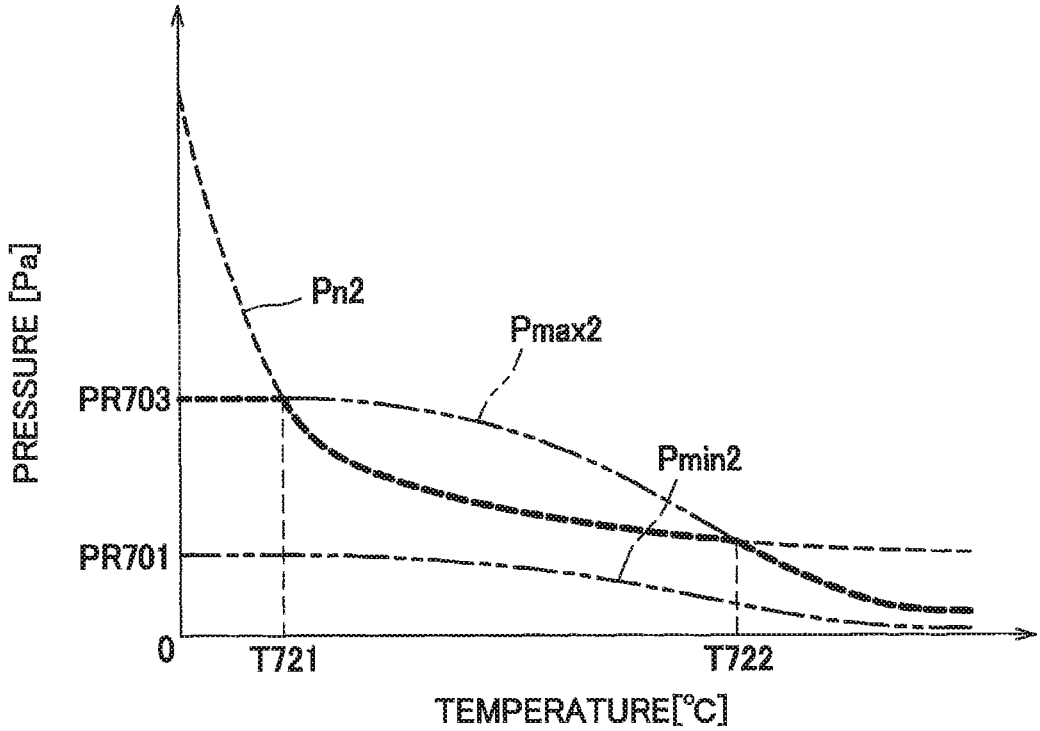
FIG. 102B is a view showing a selected pressure as a target pressure in the second pressure table.

On the other hand, as illustrated in FIG. 102B, when the target amount of spray is the second amount ρ2, the controller 700 selects the upper limit PRβ in a temperature range from 0° C. to T721, selects the required pressure PRα in a temperature range from T721 to T722, and selects the upper limit PRβ when the temperature is higher than T722. When the temperature is in a range from T721 to T722, the required pressure PRα corresponds to the first pressure. When the temperature is in a range from 0° C. to T721 or the temperature is higher than T722, the upper limit PRβ corresponds to the second pressure.

The above current value I702 is set to a current value required to achieve the first amount ρ1 when the required pressure PRα is applied to the fixing solution L in a case where the temperature is in a range from T721 to T722.

Figure 103:
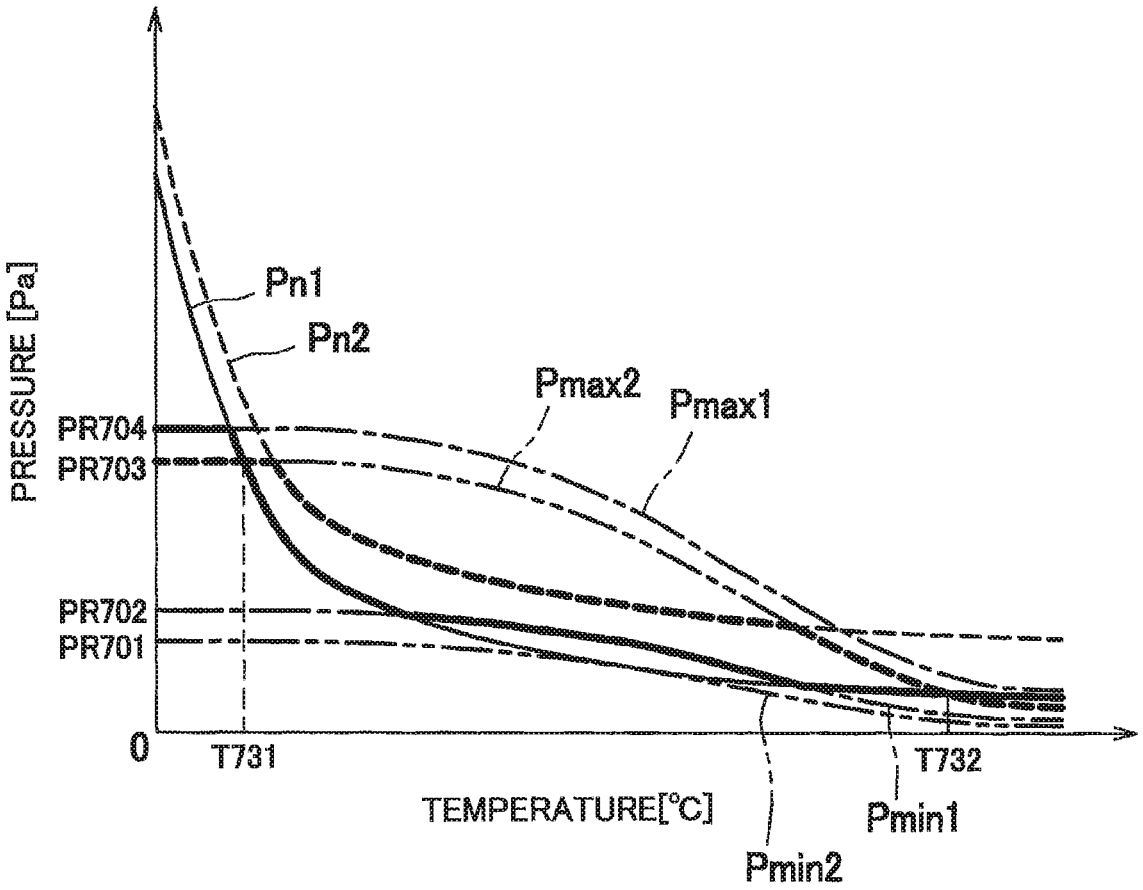
FIG. 103 is a view illustrating the first pressure table and the second pressure table superimposed with each other.

FIG. 103 is a view obtained by overlapping the first and second pressure tables. As illustrated in FIG. 103, in a case where the temperature falls within a prescribe range from T731 to T732, the pressure (denoted by the thick continuous line) selected when the target amount of spray is the first amount ρ1 is set to a smaller value than the pressure (denoted by the thick dashed line) selected when the target amount of spray is the second amount ρ2. In a case where the temperature falls outside the prescribe range, the pressure selected when the target amount of spray is the first amount ρ1 is set to a larger value than the pressure selected when the target amount of spray is the second amount ρ2.

The controller 700 has a function of changing the number of nozzles 7N to be operated depending on the set target pressure. Specifically, when setting the target pressure to the required pressure PRα, the controller 700 controls the voltages applied to the first electrodes 774 of the respective first to third heads 771A to 771C so that only the first head 771A and second head 771B are operated and the third head 771C is not operated. More specifically, the controller 700 applies voltage to the first electrodes 774 of the first and second heads 771A and 771B but does not apply voltage to the first electrode 774 of the third head 771C.

When setting the target pressure to the upper limit PRβ, the controller 700 controls the voltage applied to the first electrodes 774 of the first to third heads 771A to 771C so that all the three heads 771A to 771C are operated. When setting the target pressure to the lower limit PRγ, the controller 700 controls the voltages applied to the first electrodes 774 of the first to third heads 771A to 771C so that only the first head 771A is operated and neither the second nor third heads 771B and 771C is operated.

That is, when setting the target pressure to the required pressure PRα, the controller 700 sets the number of nozzles 7N to be operated to a first number of nozzles. When setting the target pressure to the upper limit PRβ, the controller 700 sets the number of nozzles 7N to be operated to a second number of nozzles larger than the first number of nozzles. When setting the target pressure to the lower limit PRγ, the controller 700 sets the number of nozzles 7N to be operated to a third number of nozzles smaller than the first number of nozzles.

The controller 700 temporarily determines the target pressure (hereinafter, referred to also as "provisional target pressure") before receiving a print instruction and applies a pressure to the fixing solution L in the container portions 773 of the heads 771A to 771C while controlling the pressurization device 775. In the eighth embodiment, the provisional target pressure is set by referring to the first pressure table. However, the present invention is not limited to this, and, for example, the provisional target pressure may be set by referring to the second pressure table. Alternatively, the provisional target pressure may be set using one of the first and second pressure tables that has a higher use frequency. Here, one of the first and second pressure tables having the higher user frequency is determined by comparing frequency of the first pressure table with the frequency of the second pressure table on the basis of a use history of a user.

The following describes in detail the operation of the controller 700.

Figure 104:
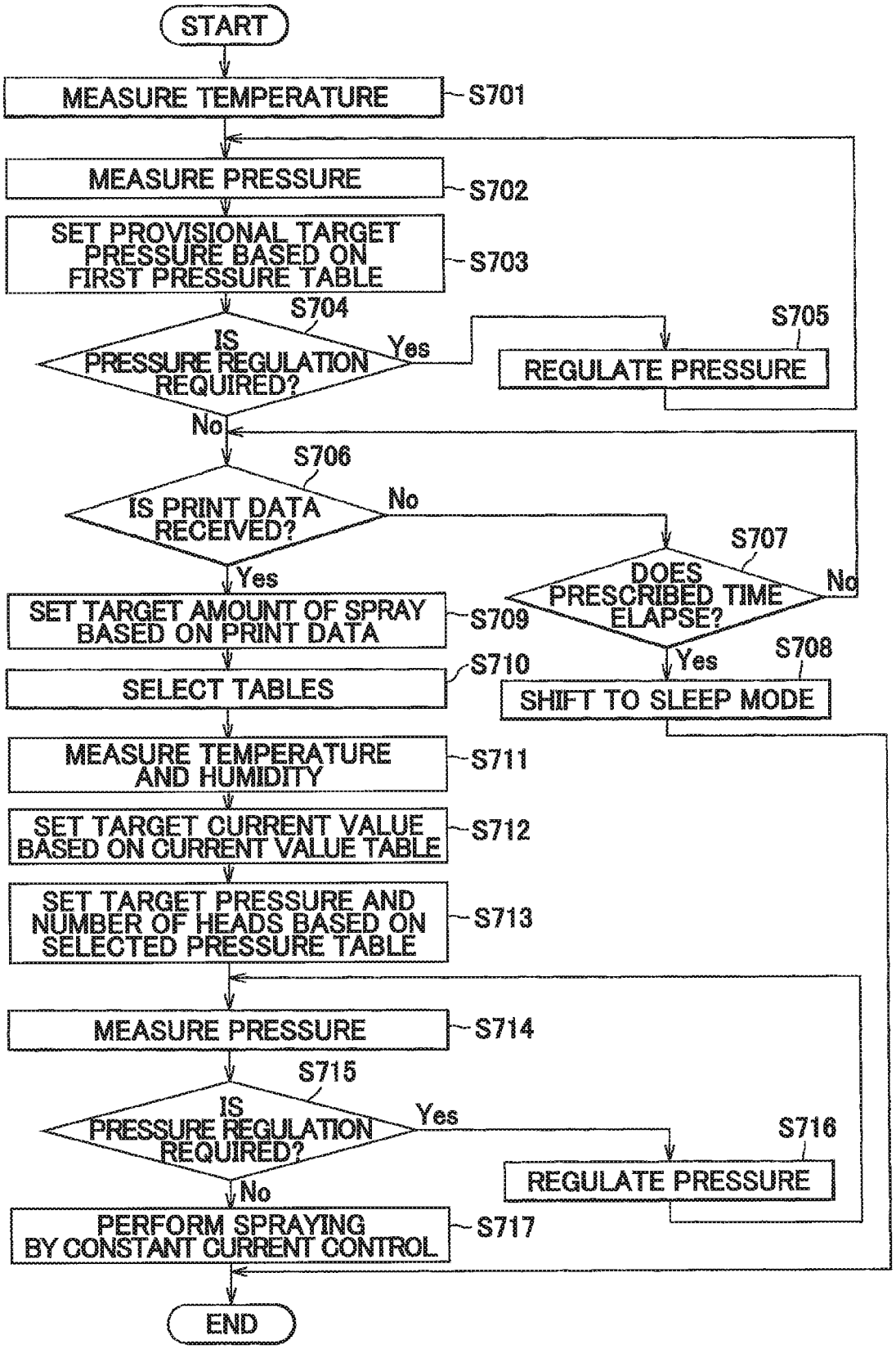
FIG. 104 is a flowchart illustrating operation in a controller.
Figure 105:
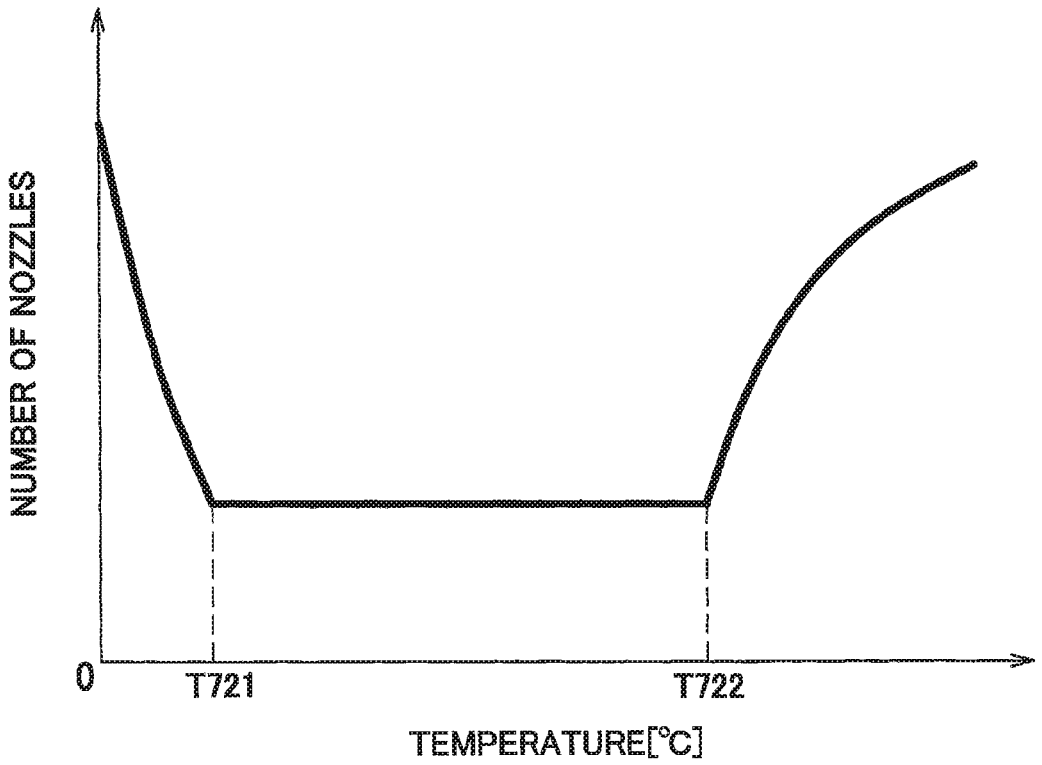
FIG. 105 is a table showing a relationship between numbers of nozzles and temperature, wherein the table is applied when performing pressure control on a basis of tables Pn2, Pmax2, and Pmin2.

As illustrated in FIG. 104, when the laser printer 701 is powered ON or restored from a sleep state (START), the controller 700 first measures temperature using the temperature sensor 7ST (S701). After executing step S701, the controller 700 measures pressure in each of the heads 771A to 771C using the corresponding pressure sensor 7SP (S702).

After executing step S702, the controller 700 sets the provisional target pressure based on the first pressure table and temperature (S703). After executing step S703, the controller 700 determines whether pressure regulation is required by determining whether the pressure measured using the pressure sensor 7SP is the provisional target pressure (S704). The determination of whether the measured pressure is the provisional target pressure may be made by determining whether the measured pressure coincides with the provisional target pressure or falls within a prescribed error range including the provisional target pressure.

When determining in step S704 that the measured pressure is not the provisional target pressure, that is, pressure regulation is required (Yes), the controller 700 drives the pump or reducing valve of the pressurization device 775 to pressurize or depressurize the fixing solution L in each of the heads 771A to 771C (S705) and returns to step S702. On the other hand, when determining in step S704 that the measured pressure is the provisional target pressure, that is, pressure regulation is not required (No), the controller 700 determines whether print data has been received (S706). Here, when determining that pressure regulation is not required, the controller 700 stops driving the pump or reducing valve of the pressurization device 775 to maintain the liquid pressure in each of the heads 771A to 771C at a provisional target pressure.

When determining in step S706 that print data has not been received (No), the controller 700 determines whether a prescribed time has elapsed from the time when it is determined that pressure regulation was not required (S707). When determining in step S707 that the predetermined time has not elapsed (No), the controller 700 returns to step S706.

When determining in step S707 that the prescribed time has elapsed (Yes), the controller 700 shifts to a sleep mode (S708) and ends this process. In the sleep mode, the pressure in each of the heads 771A to 771C may be returned to an initial state by releasing the reducing valve or may be maintained as it is.

When determining in step S706 that print data has been received (Yes), the controller 700 sets the target amount of spray based on the received print data (S709). Specifically, when the print data is text data, the controller 700 sets the target amount of spray to the first amount ρ1. On the other hand, when the print data is image data, the controller 700 sets the target amount of spray to the second amount ρ2.

After executing step S709, the controller 700 selects the electric current value table and the pressure table based on the set target amount of spray (S710). Specifically, when setting the target amount of spray to the first amount ρ1, the controller 700 selects the first electric current value table and the first pressure table. On the other hand, when setting the target amount of spray to the second amount ρ2, the controller 700 selects the second electric current value table and the second pressure table.

After executing step S710, the controller 700 measures temperature using the temperature sensor 7ST and measures humidity using the humidity sensor 7SH (S711). After executing step S711, the controller 700 sets the target current value based on the electric current value table selected in step S710 and the measured temperature and humidity (S712).

After executing step S712, the controller 700 sets the target pressure on the basis of the pressure table selected in step S710, and selects one or more heads to be operated from the first to third heads 771A to 771C on the basis of the set target pressure (S713). After executing step S713, the controller 700 measures pressure in each of the heads 771A to 771C using the pressure sensor 7SP (S714).

After executing step S714, the controller 700 determines whether pressure regulation is required by determining whether the pressure measured using the pressure sensor 7SP is the target pressure (S715). The determination of whether the measured pressure is the target pressure may be made by determining whether the measured pressure coincides with the target pressure or falls within a prescribed error range including the target pressure.

When determining in step S715 that the measured pressure is not the target pressure, that is, pressure regulation is required (Yes), the controller 700 drives the pump or reducing valve of the pressurization device 775 to pressurize or depressurize the fixing solution L in each of the heads 771A to 771C (S716) and returns to step S714. On the other hand, when determining in step S715 that the measured pressure is the target pressure, that is, pressure regulation is not required (No), the controller 700 stops driving the pump or reducing valve of the pressurization device 775, then performs electrostatic spraying under constant current control (S717), and ends this process. Specifically, the controller 700 applies a voltage only to the first electrode 774 of the head (or heads) selected in step S713 such that the current detected by the current sensor 7SA becomes the target current value. Further, in step S717, the controller 700 performs constant current control for a time from the start of printing for the number of papers designated in a print instruction till the end thereof. Thereafter, the controller 700 stops applying the voltage and ends this process.

According to the eighth embodiment, the following effects can be obtained.

The pressure value to be applied to the fixing solution L is determined on the basis of temperature, so that spraying can be adequately performed in accordance with temperature. Further, a heater used in conventional approaches need not be provided, so that power consumption can be reduced.

When the required pressure PRα is larger than the upper limit PRβ, the upper limit PRβ is set as the target pressure. Accordingly, a spraying state can be normally maintained. The amount of spray of the fixing solution L becomes larger as the current flowing in the fixing solution L becomes larger, and becomes larger as the pressure applied to the fixing solution L becomes higher. Thus, when the target pressure is set to the upper limit PRβ smaller than the required pressure PRα, the amount of spray may fall short of the target amount of spray. However, in this case, the number of nozzles is increased, specifically, the number of heads to be used is increased from two to three, and thus the amount of spray can be made close to the target amount of spray. Accordingly, fixing can be made satisfactorily.

When the required pressure PRα is smaller than the lower limit PRγ, the lower limit PRγ is set as the target pressure, so that a spraying state can be normally maintained. When the target pressure is set to the lower limit PRγ larger than the required pressure PRα, the amount of spray may exceed the target amount of spray. However, in this case, the number of nozzles is reduced, specifically, the number of heads to be used is decreased from two to one, and thus the amount of spray can be made close to the target amount of spray. Accordingly, fixing can be made satisfactorily.

As illustrated in FIG. 103, when the temperature falls within the prescribed range from T731 to T732, the pressure when the target amount of spray is set to the first amount ρ1 is set to a lower value than the pressure when the target amount of spray is set to the second amount ρ2, so that fixing can be made with an adequate amount of spray in a state where the temperature falls within the prescribed range from T731 to T732.

When the temperature falls outside the prescribed range, the pressure when the target amount of spray is set to the first amount ρ1 is set to a higher value than the pressure when the target amount of spray is set to the second amount ρ2, so that fixing can be made with an adequate amount of spray in a state where the temperature falls outside the prescribed range.

The provisional target pressure temporarily determined is applied to the fixing solution L before receiving print data (S705). Then, when receiving the print data (Yes in S706), the target pressure determined based on data type (text or image) designated in the print data and temperature will likely become substantially equal to the provisional pressure. In this case, the time required until the fixing device 7 is put into a sprayable state can be shorten, thereby increasing printing speed.

Because the current value is determined based on the temperature and humidity, spraying can be adequately performed in accordance with the temperature and humidity.

The voltage is controlled such that the current value detected by the current sensor 7SA becomes a determined target current value. Accordingly, the amount of spray can be made constant.

The electric current value table is selected based on the target amount of spray. Accordingly, a current value appropriate for the target amount of spray can be made to flow in the fixing solution L, allowing the fixing solution L to be adequately sprayed.

The present invention is not limited to the above-described eighth embodiment, and may be variously modified as exemplified below.

Figure 101A:
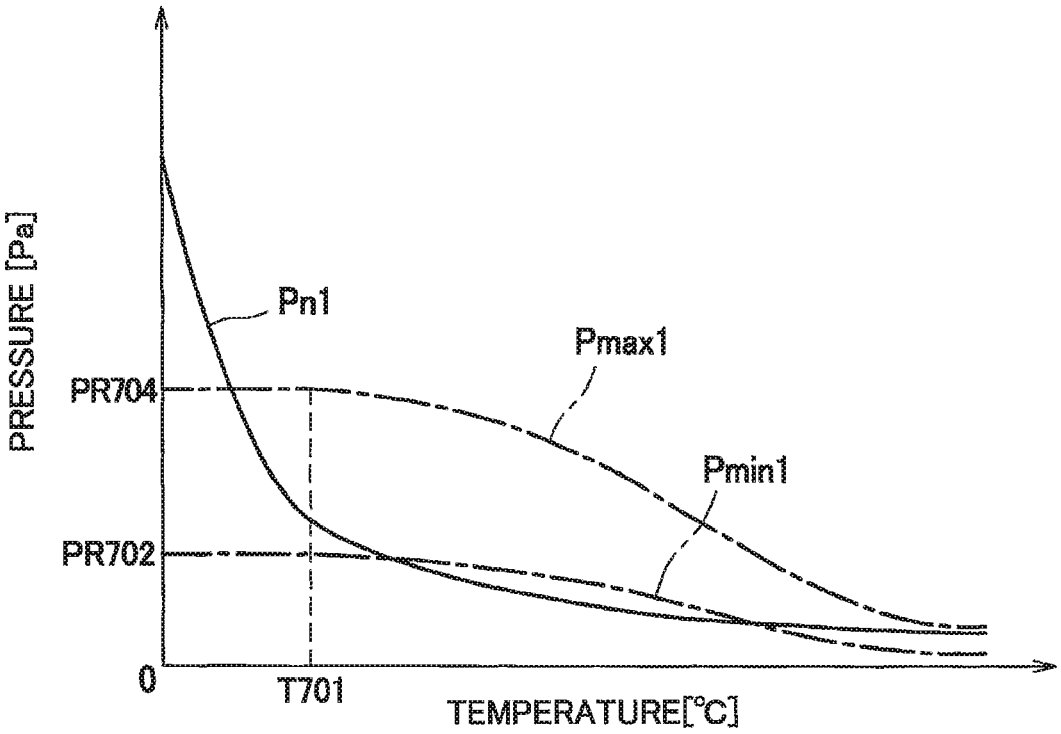
FIG. 101A is a view showing a first pressure table.
Figure 101B:
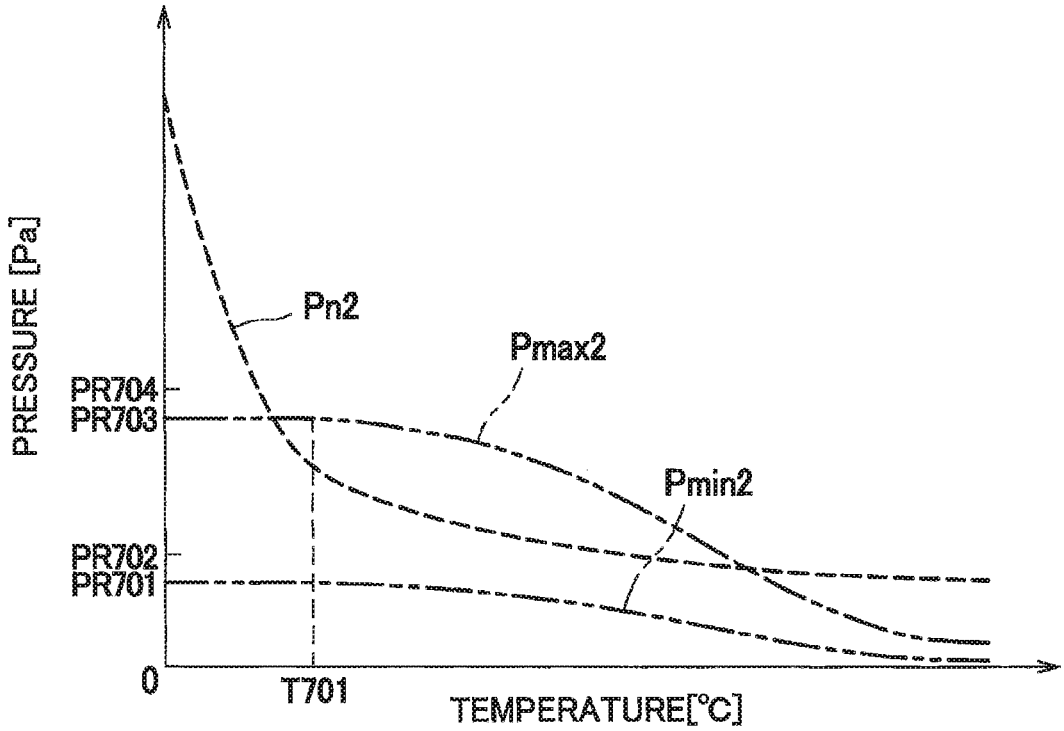
FIG. 101B is a view showing a second pressure table.

In the above eighth embodiment, the first pressure table includes the three tables Pn1, Pmax1, and Pmin1 as illustrated in FIG. 101A. However, the present invention is not limited to this, and, for example, the first pressure table may only include a table denoted by the thick continuous line of FIG. 102A. That is, only a table in which only the pressure values selected as the target pressure from those of the three tables Pn1, Pmax1, and Pmin1 are set may be stored in the storage. Similarly, the second pressure table may only include a table denoted by the thick dashed line of FIG. 102B.

The pressure table differs in tendency depending on the type of fixing solution to be used and may be appropriately determined depending on the type of fixing solution to be used through experiments and simulations. The current value (e.g., the current value I701 illustrated in FIG. 100A) used as a reference for the electric current value table may also be appropriately determined depending on the type of fixing solution to be used through experiments and simulations.

In the above eighth embodiment, when the required pressure PRα is larger than the upper limit PRβ, the target pressure is set to the upper limit PRβ. However, the present invention is not limited to this, and, for example, when the required pressure PRα exceeds the upper limit PRβ, the target pressure may be set to a pressure value falling within a range between the upper limit PRβ and the lower limit PRγ. Similarly, when the required pressure PRα is smaller than the lower limit PRγ, the target pressure may be set to a pressure value falling within a range between the upper limit PRβ and the lower limit PRγ.

In the above eighth embodiment, the pressurization device 775 having a pump and a reducing valve is exemplified as a pressure applying portion. However, the present invention is not limited to this, and, for example, a pressure applying portion may include a cylinder that pressurizes or depressurizes air in each head may be used.

In the above eighth embodiment, the first amount ρ1 corresponding to text data and the second amount ρ2 corresponding to image data are exemplified as the target amount of spray. However, the present invention is not limited to this, and, for example, three or more target amounts of spray according to image density (e.g., 0%, 20%, 40%, . . . ) may be set.

In the eighth embodiment, the present invention is applied to the laser printer 701. However, the present invention is not limited to this, and may be applied to other image forming devices, such as copying machines and multifunction peripherals.

In the eighth embodiment, the paper P, such as thick paper, postcard, or thin paper, is described as one example of recording sheet. However, the present invention is not limited to this, and the recording sheet may be a transparency film for example.

In the eighth embodiment, the first electrode 774 is disposed in the interior of the container portion 773. However, the present invention is not limited to this. For example, the nozzles and the container portions may be made of a conductive member such as a metal, and the nozzles or the container portions may be applied with voltage. In this case, the nozzles or the container portions, which are applied with a voltage, functions as the first electrode. In another case, the container portions may be made of a non-conductive member such as a resin, the nozzles may be made of a conductive member such as a metal, and the nozzles may be applied with a voltage. In this case, the nozzles function as the first electrode.

In addition, the second electrode 772 may not necessarily face the nozzles 7N, and may be shifted toward the upstream side or the downstream side in the conveyance direction, in which the paper is conveyed.

In the above eighth embodiment, the nozzles 7N are arranged in a staggered manner in each of the fixing heads 771A to 771C. However, the present invention is not limited to this, and a plurality of fixing heads may be provided in the conveyance direction. Here, each fixing head has only one nozzle line including a plurality of nozzles arranged in the left-right direction. In this case, ON/OFF control of spray may be performed independently for each nozzle line. In this case, for pressure control based on the tables Pn2, Pmax2, and Pmin2 illustrated in FIG. 102B, the storage may store a table (see FIG. 105) indicating the relationship between temperature and the number of nozzle lines, for example. In this table, the number of nozzle lines is gradually increased as the temperature becomes lower in the temperature range equal to or lower than T721. Similarly, for pressure control based on the tables Pn2, Pmax2, and Pmin2 illustrated in FIG. 102B, the storage may store a table (see FIG. 105) indicating the relationship between temperature and the number of nozzle lines. Here, in this table, the number of nozzle lines for spraying is gradually increased as the temperature becomes higher in the temperature range equal to or higher than T722. Similarly, in a case where ON/OFF control of spray can be performed independently for each nozzle (for example, a plurality of fixing heads each having only one nozzle is provided), the storage may store a table indicating the relationship between the temperature and the number of nozzles.

As described above, in the temperature range equal to or lower than T721, the viscosity of the fixing solution is increased as the temperature becomes lower, while the pressure is maintained constant, so that the amount of spray is reduced as the temperature becomes lower. However, by increasing the number of nozzles for spraying so as to compensate insufficiency of the amount of spray, the amount of spray can be controlled more accurately.

Figure 106:
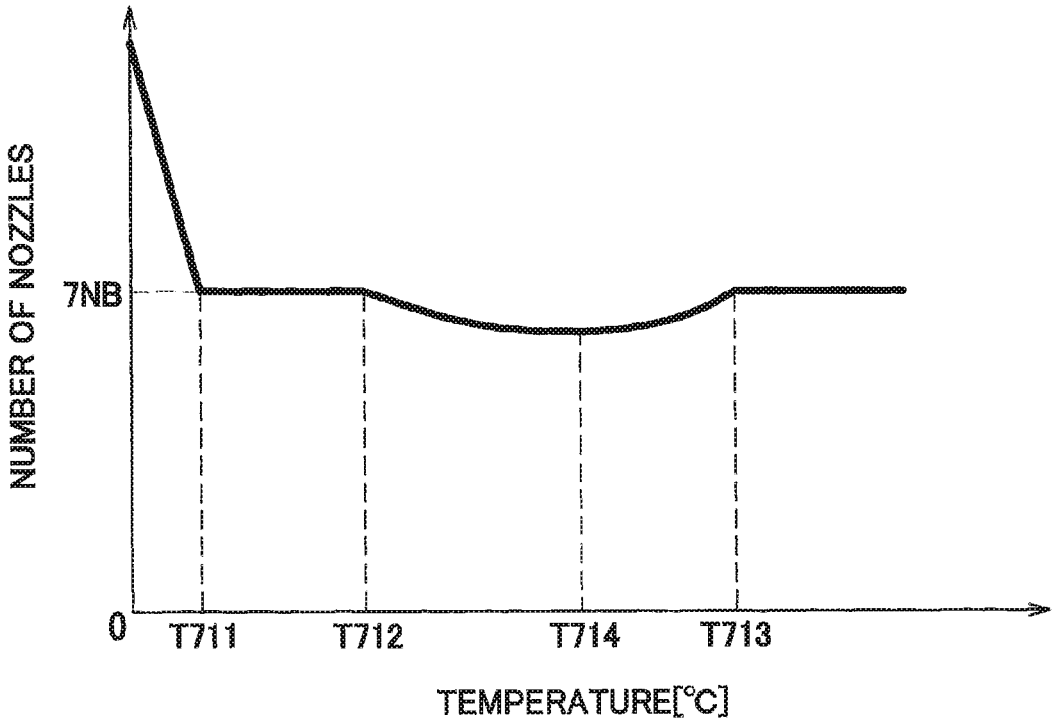
FIG. 106 is a table showing the relationship between numbers of nozzles and temperature, wherein the table is applied when performing pressure control on a basis of tables Pn1, Pmax1, and Pmin1.

Further, when pressure control is performed based on the tables Pn1, Pmax1, and Pmin1 illustrated in FIG. 102A, the controller may control each nozzle line so as to reduce an increase from a desired amount of spray based on a difference in pressure between the table Pn1 and the table Pmin1 in the temperature range from T712 to T713, for example. Specifically, as illustrated in FIG. 106, the controller gradually reduces the number of nozzle lines from a reference number 7NB of lines (the number of lines when pressure control is performed based on the table Pn) as the temperature becomes higher from T712. The reduction from the reference number 7NB becomes maximum at a temperature (e.g., T714, see FIG. 102A) at which a difference in pressure between the table Pn1 and the table Pmin1 becomes maximum. The controller gradually increases the number of nozzle lines toward the reference number NB as the temperature becomes higher in the temperature range from T714 to T713. The storage may store the table of FIG. 106 indicating the above-described relationship between the temperature and the number of nozzles. This allows control of the amount of spray with respect to the temperature to be performed more accurately.

In the table of FIG. 106, the number of nozzle lines for spraying is gradually increased as the temperature becomes lower in the temperature range equal to or lower than T711. The reason for this is the same as the reason that the number of nozzle lines is gradually increased as the temperature becomes lower in the temperature range equal to or lower than T721 in the table of FIG. 105.

As described above, the eighth object can be achieved by the eighth embodiment described with reference to FIGS. 97 to 106. The above eighth embodiment is an example of an embodiment according to the eighth invention, and the present invention is not limited to this.

A laser printer 801 of a ninth embodiment of the present invention will be explained with reference to FIGS. 107-114. In the ninth embodiment, like parts and components are designated with the same reference numerals as the first embodiment to avoid duplicating description.

Figure 107:
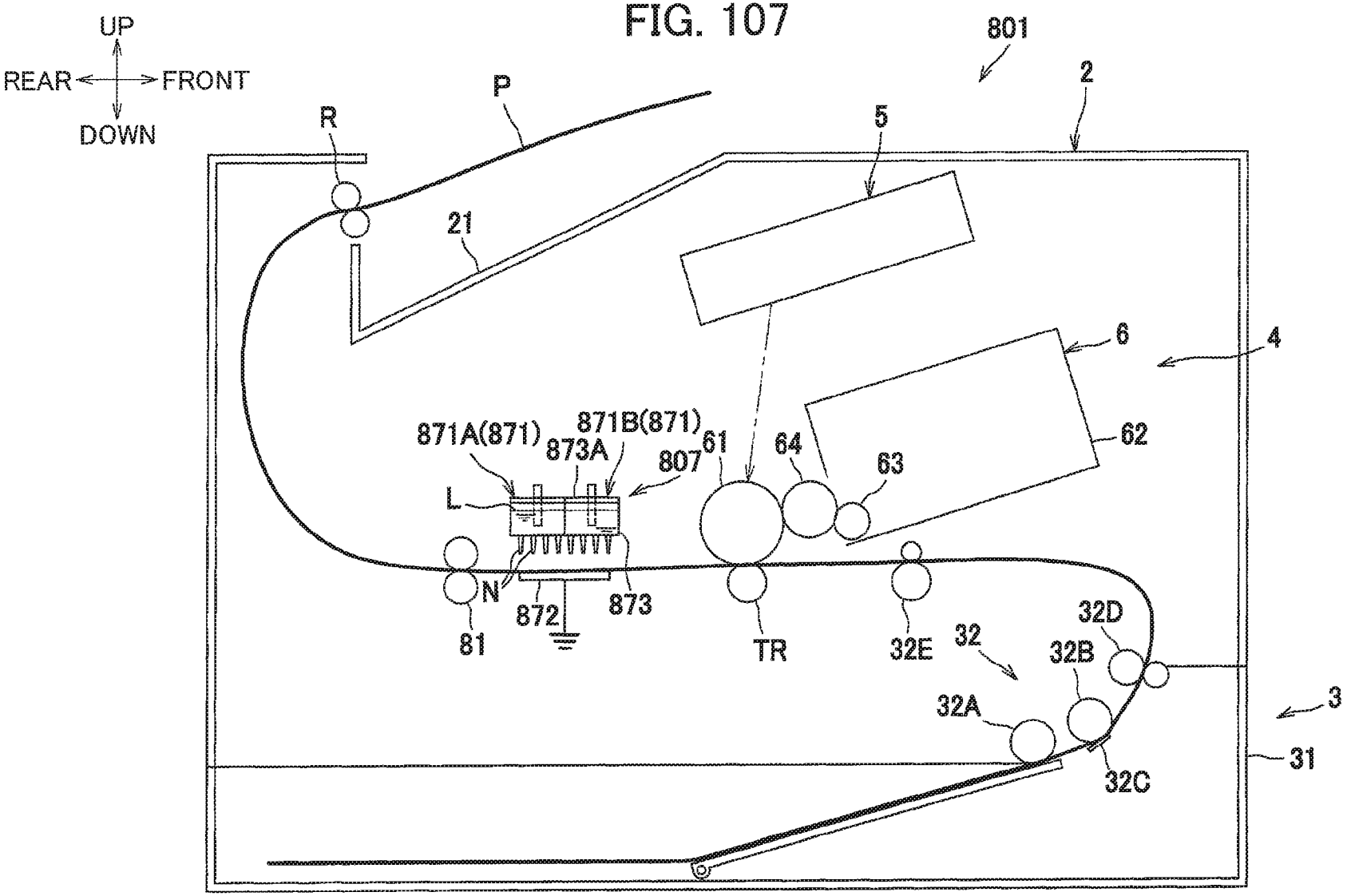
FIG. 107 is a view illustrating a laser printer provided with a fixing device according to a ninth embodiment of the present invention.
Figure 108:
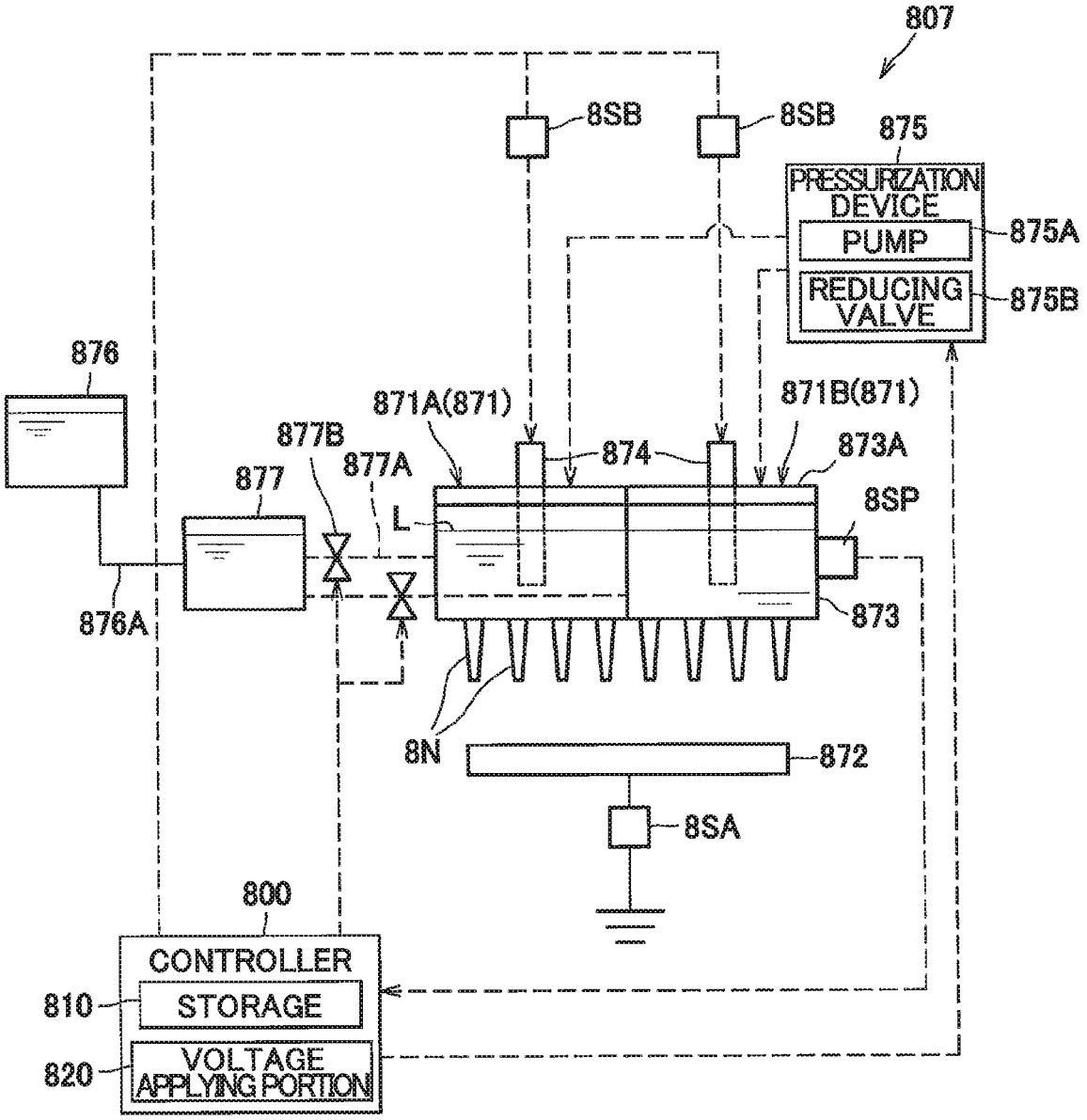
FIG. 108 is a view illustrating in detail the fixing device.

In the following description, directions are defined with respect to a position of a user using the laser printer. That is, the right side of FIG. 107 is defined as a front side, the left side of FIG. 107 is defined as a rear side, the far side of FIG. 107 defined as a right side, and the near side of FIG. 107 is defined as a left side. The upward and downward directions of FIG. 107 are defined as an upward direction and a downward direction.

As illustrated in FIG. 107, the laser printer 801 further has a fixing device 807.

The fixing device 807 is configured to supply a charged fixing solution L onto a toner image on the paper P by electrostatic spraying method to fix the toner image onto the paper P. The configuration of the fixing device 807 will be described later in detail.

A pair of downstream side conveyance rollers 81 is provided downstream of the fixing device 807. The pair of conveyance rollers 81 is configured to nip and convey the paper P discharged from the fixing device 807 to the downstream side.

Next, the configuration of the fixing device 807 will be described in detail.

As illustrated in FIG. 107, the fixing device 807 has a fixing head 871 for spraying the fixing solution L toward the toner image on the paper P, a second electrode 872 that is disposed below the fixing head 871 for supporting the paper P, a pressurization device 875 as an example of a pressure applying portion, a fixing-solution cartridge 876, a tank 877, and a controller 800.

Figure 109A:
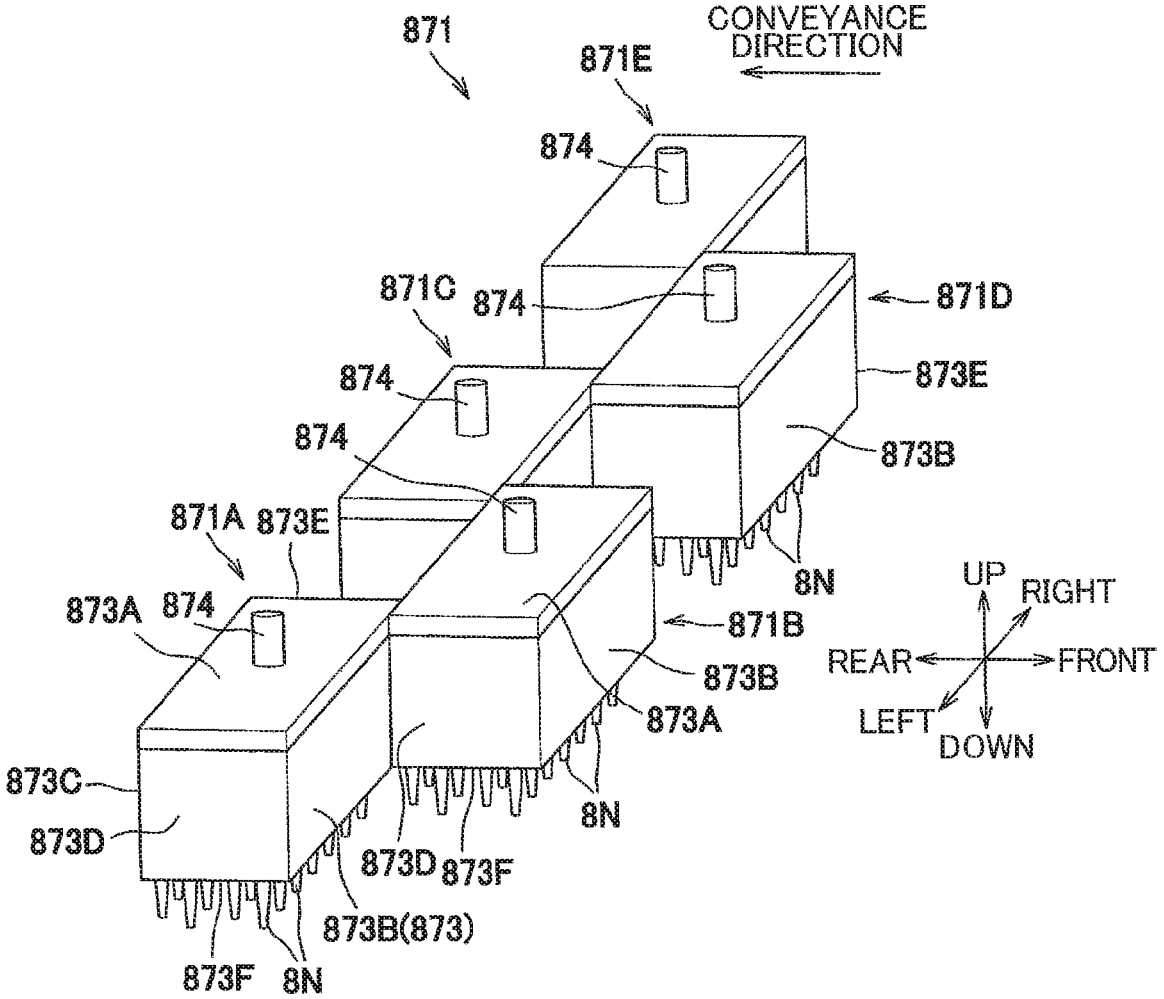
FIG. 109A is a perspective view of a fixing head as viewed from diagonally above.

As illustrated in FIG. 109A, the fixing head 871 has a first fixing head 871A, a second fixing head 871B, a third fixing head 871C, a fourth fixing head 871D, and a fifth fixing head 871E which are arranged in a staggered manner in the width direction of the paper P. The first fixing head 871A, the third fixing head 871C, and the fifth fixing head 871E are disposed at substantially the same position in the front-rear direction, i.e., in the conveyance direction of the paper P and disposed spaced apart from each other in the left-right direction, i.e., in the width direction of the paper P. The second fixing head 871B is disposed upstream of the first fixing head 871A and the third fixing head 871C in the conveyance direction such that the center of the second fixing head 871B in the width direction is located between the first fixing head 871A and the third fixing head 871C in the width direction. The fourth fixing head 871D is disposed upstream of the third fixing head 871C and the fifth fixing head 871E in the conveyance direction such that the center of the fourth fixing head 871E in the width direction is located between the third fixing head 871C and the fifth fixing head 871E in the width direction.

The first fixing head 871A has a container portion 873 that stores therein the fixing solution L, a plurality of nozzles 8N that communicates with the container portion 873 and is configured to spray the fixing solution L toward the toner image, and a first electrode 874 that is configured to apply a voltage to the fixing solution L in the container portion 873 and the nozzles 8N. The other fixing heads 871B to 871E have substantially the same configuration as the first fixing head 871A, so components of the other fixing heads 871B to 871E are designated with the same reference numerals as those of the first fixing head 871A, and description thereof is omitted. That is, the fixing heads 871A to 871E (container portions 873) have the same shape and are separately provided. The number and arrangement of the nozzles 8N are the same between all the container portions 873.

Figure 109B:
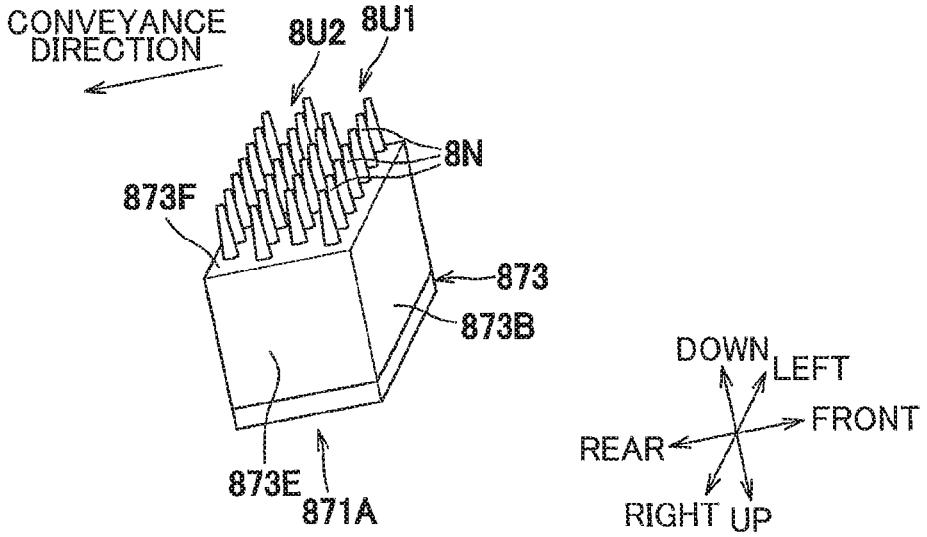
FIG. 109B is a perspective view of the first fixing head as viewed from diagonally below.

The container portion 873 is an insulating container having a rectangular shape elongated in the width direction and has a top wall 873A, a front wall 873B, a rear wall 873C, a left wall 873D, a right wall 873E, and a bottom wall 873F. As illustrated in FIG. 109B, the plurality of nozzles 8N in each of the fixing heads 871A-871E protrudes downward from the bottom wall 873F with their diameters gradually reduced as they extend downward. The plurality of nozzles 8N is arranged in both of the width and conveyance directions.

Figure 110:
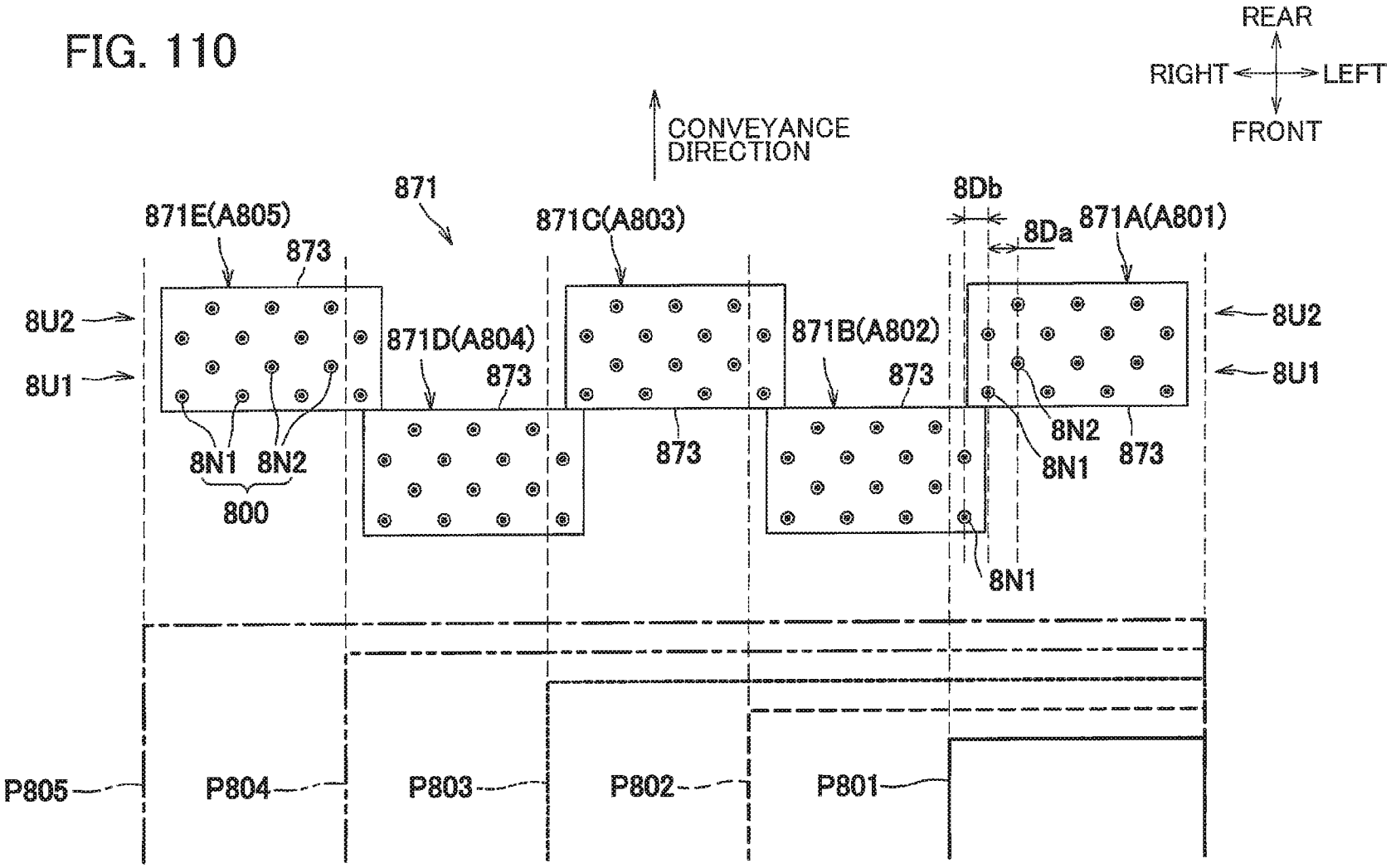
FIG. 110 is a bottom view of the fixing head.

Specifically, the plurality of nozzles 8N constitutes a first staggered array group 8U1 and a second staggered array group 8U2. The first staggered array group 8U1 and the second staggered array group 8U2 are arranged in the conveyance direction. As illustrated in FIG. 110, the first staggered array group 8U1 includes a plurality of first nozzles 8N1 arranged at regular intervals in the width direction and a plurality of second nozzles 8N2 arranged at regular intervals in the width direction. The first nozzles 8N1 and the second nozzles 8N2 are alternately arranged in the width direction with the first nozzles 8N1 disposed in one side with respect to the conveyance direction and with the second nozzles 8N2 disposed in the other side with respect to the conveyance direction.

Each second nozzle 8N2 is disposed between two first nozzles 8N1 in the width direction. A shape formed by connecting two first nozzles 8N1 adjacent to each other in the width direction and the second nozzle 8N2 disposed between the two first nozzles 8N1 is an equilateral triangle or an isosceles triangle. Similarly, a shape formed by connecting two second nozzles 8N2 adjacent to each other in the width direction and the first nozzle 8N1 disposed between the two second nozzles 8N2 is an equilateral triangle or an isosceles triangle.

The second staggered array group 8U2 has the same structure as that of the first staggered array group 8U1. In the ninth embodiment, a nozzle pitch (the shortest distance between the outer peripheries of the adjacent nozzles) may be set in a range equal to or larger than 1 mm and equal to or smaller than 14 mm.

Two fixing heads (e.g., first and second fixing heads 871A and 871B) adjacent to each other in the width direction are disposed such that the container portions 873 thereof overlap each other when viewed in the conveying direction. Specifically, the minimum pitch (e.g., pitch between the first nozzle 8N1 and the second nozzle 8N2) of the plurality of nozzles 8N in the width direction in a prescribed fixing head (e.g., the first fixing head 871A) is 8Da. On the other hand, a distance 8Db is smaller than the minimum pitch 8Da. Here, the distance 8Db is a distance from one nozzle 8N of a prescribed fixing head (e.g., the rightmost first nozzle 8N1 of the first fixing head 871A) to another nozzle 8N of another fixing head (e.g., the leftmost first nozzle 8N1 of the second fixing head 871B). Specifically, the width direction is a direction from one end side to the other end side, and the one nozzle 8N is an end nozzle disposed at the one end side in the width direction among nozzles 8N in the prescribed fixing head. The another fixing head is disposed adjacent to the prescribed fixing head at the one end side of the prescribed fixing head in the width direction. The another nozzle 8N is an end nozzle disposed at the other end side in the width direction among nozzles 8N in the another fixing head.

Fixing regions A801-A805 are set for respective fixing heads 871A-871E. Each of the fixing regions A801-A805 is a region to which the nozzles of the corresponding one of the fixing heads 871A-871E spray the fixing solution L toward the paper P. The fixing heads 871A-871E are disposed such that the fixing regions A801-A805 overlap one another when viewed in the conveyance direction. In the ninth embodiment, for descriptive convenience, it is assumed that the fixing regions A801-A805 of the respective fixing heads 871A-871E have the same in shape, size, and position as those of the lower surfaces of corresponding container portions 873.

More specifically, the first fixing region A801 overlaps the second fixing region A802 when viewed in the conveyance direction. Here, the fixing solution L is sprayed from the first fixing head 871A to the first fixing region A801 and the fixing solution L is sprayed from the second fixing head 871B to the second fixing region A802. Further, the fifth fixing region A805 overlaps the fourth fixing region A804 when viewed in the conveyance direction. Here, the fixing solution L is sprayed from the fifth fixing head 871E to the fifth fixing region A805 and the fixing solution L is sprayed from the fourth fixing head 871D to the fourth fixing region A804.

Further, the third fixing region A803 overlaps the second fixing region A802 and the fourth fixing region A804 when viewed in the conveyance direction. Here, the fixing solution L is sprayed from the third fixing head 871C to the third fixing region A803. The arrangement of the fixing heads 871A-871E described above can suppress occurrence of a region between any two of the fixing heads 871A-871E to which the fixing solution L is not sprayed.

The first fixing head 871A is a head for spraying the fixing solution L to a first paper P801 having the narrowest width among a plurality of types of the papers P on which the laser printer 801 can print images. The first fixing head 871A has a width smaller than the width of the first paper P801. The first fixing head 871A is disposed within a range between the left and right ends of the first paper P801 in the left-right direction. More specifically, the first fixing region A801 of the first fixing head 871A is formed so as to have a width equal to or larger than the width of an image formation region of the first paper P801 on which an image is to be formed. That is, the entire width of the image formation region falls within the width of the first fixing region A801.

In the ninth embodiment, as illustrated in FIG. 110, the papers P801 to P805 having different paper widths are conveyed with the left ends thereof set as a reference. Specifically, a guide member (not illustrated) is provided in the casing 2 and is configured to contact and guide the left end of each of the papers P801 to P805.

The second fixing head 871B is adjacent to the right side (one side in the width direction) of the first fixing head 871A and is disposed left side (the other side in the width direction) of the right end of the second paper P802 having a width larger than the width of the first paper P801. Specifically, the right end of the second fixing region A802 of the second fixing head 871B is disposed at the same position as or right side of the right end of the image formation region of the second paper P802. The left end of the image formation region of the second paper P802 substantially coincides with the left end of the image formation region of the first paper P801. With this arrangement, the combination of the first fixing head 871A and the second fixing head 871B can spray the fixing solution L to the image formation region of the second paper P802.

The third fixing head 871C is adjacent to the right side of the second fixing head 871B and is disposed left side of the right end of the third paper P803 having a width larger than the width of the second paper P802. Specifically, the right end of the third fixing region A803 of the third fixing head 871C is disposed at the same position as or right side of the right end of the image formation region of the third paper P803. The left end of the image formation region of the third paper P803 substantially coincides with the left end of the image formation region of the first paper P801. With this arrangement, the combination of the first fixing head 871A, the second fixing head 871B, and the third fixing head 871C can spray the fixing solution L to the image formation region of the third paper P803.

The fourth fixing head 871D is adjacent to the right side of the third fixing head 871C and is disposed left side of the right end of the fourth paper P804 having a width larger than the width of the third paper P803. Specifically, the right end of the fourth fixing region A804 of the fourth fixing head 871D is disposed at the same position as or right side of the right end of the image formation region of the fourth paper P804. The left end of the image formation region of the fourth paper P804 substantially coincides with the left end of the image formation region of the first paper P801. With this arrangement, the combination of the first to fourth fixing heads 871A to 871D can spray the fixing solution L to the image formation region of the fourth paper P804.

The fifth fixing head 871E is adjacent to the right side of the fourth fixing head 871D and is disposed left side of the right end of the fifth paper P805 having a width larger than the width of the fourth paper P804. Specifically, the right end of the fifth fixing region A805 of the fifth fixing head 871E is disposed at the same position as or right side of the right end of the image formation region of the fifth paper P805. The left end of the image formation region of the fifth paper P805 substantially coincides with the left end of the image formation region of the first paper P801. With this arrangement, the combination of the first to fifth fixing heads 871A-871E can spray the fixing solution L to the image formation region of the fifth paper P805.

Referring back to FIG. 108, the first electrode 874 is an electrode that applies a voltage to the fixing solution L in the container portion 873 to generate an electric field at the tip of each nozzle 8N. The first electrode 874 is provided so as to penetrate the top wall 873A of the container portion 873 from the top to the bottom of the top wall 873A. The lower end portion of the first electrode 874 is disposed in the fixing solution L in the container portion 873 and in contact with the fixing solution L, and the upper end portion thereof is connected to the controller 800 having a voltage applying portion 820. The voltage to be applied to the first electrode 874 is preferably in a range from 1 kV to 10 kV.

A pressurization device 875 is connected to the fixing heads 871A-871E. The pressurization device 875 is a device that applies a pressure to the fixing solution L in the fixing heads 871A-871E. The pressurization device 875 has a pump 875A that pressurizes the air in the fixing heads 871A-871E, and a reducing valve 875B that releases the air from the fixing heads 871A-871E so as to perform depressurization. Further, each of the fixing heads 871A-871E has a pressure sensor 8SP (in FIG. 108, only one pressure sensor 8SP is illustrated as a representative example) that detects the pressure of the fixing solution L therein.

The second electrode 872 is an electrode that is configured to contact the paper P to form a potential difference between the fixing solution L in the nozzle 8N and the paper P and is disposed below the fixing heads 871A-871E so as to be separated from the tips of the nozzles 8N of the fixing heads 871A-871E by a prescribed distance. The prescribed distance is determined by experiments or simulations. Specifically, the prescribed distance is set to a value larger than the thickness of the paper P so that electrostatic spraying can be performed suitably.

The second electrode 872 is grounded. The second electrode 872 need not necessarily be grounded, and a voltage lower than one applied to the first electrode 874 may be applied to the second electrode 872. The second electrode 872 forms an electric field between itself and the tips of the nozzles 8N.

An electric field is formed in a space around the tip of each nozzle 8N when a voltage is applied to the first electrode 874. Since the fixing solution L is supplied toward the tip of each nozzle 8N by the pressurization device 875, the second electrode 872 forms an electric field between the second electrode 872 and the fixing solution L in the tip of each nozzle 8N. Then, at the tip of each nozzle 8N, the fixing solution L is attracted by the electric field to form so-called Taylor cone. The fixing solution L is torn off from the tip of the Taylor cone, whereby a fine droplet is generated.

The droplet-like fixing solution L, sprayed by the nozzles 8N, is positively charged. In contrast, the paper P has a substantially zero potential. As a result, the droplet-like fixing solution L flies toward the paper P due to Coulomb force, and adheres to the paper P or the toner image.

A first current sensor 8SB is a sensor that detects a current flowing in the first electrode 874 to indirectly detect a current flowing in the fixing solution L and is provided corresponding to each first electrode 874. The first current sensor 8SB detects a current flowing in the first electrode 874 when the fixing solution L is sprayed from the corresponding nozzles 8N to the paper P and outputs a detected value thereof to the controller 800. When the fixing solution L is not sprayed from the nozzle 8N, no current flows in the first electrode 874 even if a voltage is applied to the first electrode 874. A current flows in the first electrode 874 when the fixing solution L is sprayed from the nozzles 8N, in other words, when the charged fixing solution L is moved from the nozzles 8N to the paper P.

A second current sensor 8SA is a sensor that is configured to detect a current flowing in the second electrode 872. The second current sensor 8SA detects a current flowing in the second electrode 872 when the fixing solution L is sprayed from the nozzles 8N to the paper P, and outputs a detected value of the current to the controller 800. When the fixing solution L is not sprayed from the nozzle 8N, no current flows in the second electrode 872 even if a voltage is applied to the first electrode 874. That is, a current flows in the second electrode 872 when the fixing solution L is sprayed from the nozzle 8N, in other words, when the charged fixing solution L is moved from the nozzle 8N to the paper P.

The first and second electrodes 874 and 872 having the above-configuration constitute a potential difference generating portion for generating a potential difference between the fixing solution L in the nozzles 8N and the paper P conveyed at a position separated from the nozzles 8N.

The fixing-solution cartridge 876 is a cartridge filled with the fixing solution L and is detachably attached to the casing 2. The fixing-solution cartridge 876 is connected to the tank 877 through a pipe 876A. The pipe 876A may be provided with a hydraulic pump for supplying the fixing solution L from the fixing-solution cartridge 876 to the tank 877 and a switching valve for switching between supply and stop of the fixing solution L.

The tank 877 is provided in the casing 2 and is connected to the container portions 873 of the fixing heads 871A to 871E through a plurality of pipes 877A. Each pipe 877A is provided with a hydraulic pump for supplying the fixing solution L from the tank 877 to a corresponding one of the fixing heads 871A to 871E, and a valve 877B for switching between supply and stop of the fixing solution L. The valve 877B is formed of an insulating member.

The controller 800 has a storage 810 including a RAM, a ROM, and the like, the voltage applying portion 820 that applies voltage to the first electrode 874, a CPU, and an input/output circuit. The controller 800 has a function to control the pressurization device 875 and to control a voltage to be applied to the first electrode 874, on the basis of externally input image data and signals from the sensors 8SP, 8SA, and 8SB. Specifically, the controller 800 is configured to control the voltages and pressures to be applied to the fixing solution L in the fixing heads 871A to 871E individually.

Specifically, when spraying the fixing solution L, the controller 800 is configured to set a pressure PR to be applied to the fixing solution L to a first pressure PR801 and control a voltage V to be applied to the first electrode 874 on the basis of a target amount ρ of spray. The target amount ρ is calculated on the basis of image data. The target amount ρ is a target value of the fixing solution L to be sprayed per unit area of the paper P and is set to a larger value as image density becomes higher. The first pressure PR801 is appropriately set by, e.g., experiments and simulations.

When stopping spraying the fixing solution L, the controller 800 is configured to start a pressure reduction process for reducing the pressure PR being applied to the fixing solution L, and then perform a voltage reduction process for reducing a voltage from a voltage applied at the start of the pressure reduction process. Specifically, in the voltage reduction process, the controller 800 stops voltage application to the first electrode 874 to thereby reduce the voltage to 0V. Further, the controller 800 determines to stop spray of the fixing solution L when a fixing spray process is completed (that is, when spray of the fixing solution L to a most upstream image on the last page in one print job is completed) or when any error occurs during the print control.

Here, the error includes a case where the paper P is jammed in a conveyance path inside the laser printer 801 and a case where a user erroneously opens a cover, which is provided for opening/closing an opening for exchanging the process cartridge 6, during the print control, for example. An error such as the jamming of the paper P may be determined on the basis of a signal from a paper sensor (not illustrated) disposed in a conveyance path. An error such as the opening of the cover during the print control may be determined based on a signal from an opening/closing detection sensor (not illustrated) for detecting opening/closing of the cover.

When determining to stop spraying the fixing solution L, the controller 800 sets the voltage V applied to the fixing solution L to a prescribed voltage V80*a*, and then starts the pressure reduction process. The prescribed voltage V80*a* is a value falling within a voltage range used in the fixing control and is appropriately determined by experiments and simulations. The controller 800 maintains the voltage V at the prescribed voltage V80*a* during a time period from a time when the controller 800 determines to stop spraying the fixing solution L to a time when the controller 800 starts the voltage reduction process.

In the pressure reduction process, the controller 800 changes the pressure PR applied to the fixing solution L from the first pressure PR801 to a second pressure PR802 lower than the pressure PR801. The second pressure PR802 is a value satisfying the following expression: $0 \leq PR802 < P801$. That is, the second pressure PR801 is appropriately determined by experiments and simulations so as to become equal to or less than a meniscus withstanding pressure.

The meniscus withstand pressure refers to the maximum pressure at which the fixing solution L can be retained in the nozzle 8N in a state where no voltage is applied to the fixing solution L and is represented by the following expression (1).

$$Pm=(4\cdot\sigma\cdot\cos\theta)/d \quad (1)$$

Pm: meniscus withstanding pressure
σ: surface tension of fixing solution L
θ: contact angle
d: inner diameter (diameter) of tip of nozzle 8N That is, when a pressure larger than the meniscus withstanding pressure is applied to the fixing solution L in a state where no voltage is applied to the fixing solution L, the fixing solution L leaks from the tip of the nozzle 8N. On the other hand, when a pressure equal to or smaller than the meniscus withstanding pressure is applied to the fixing solution L, the fixing solution L is retained in the nozzle 8N.

After starting the pressure reduction process, the controller 800 determines whether the spraying of the fixing solution L is stopped. Then, when determining that the spraying is stopped, the controller 800 starts performing the voltage reduction process. Specifically, the controller 800 determines whether the current I detected by the second current sensor 8SA becomes equal to or smaller than a prescribed value Ith. Then, when determining that the current I becomes equal to or smaller than a prescribed value Ith, the controller 800 determines that the spraying is stopped.

Figure 111:
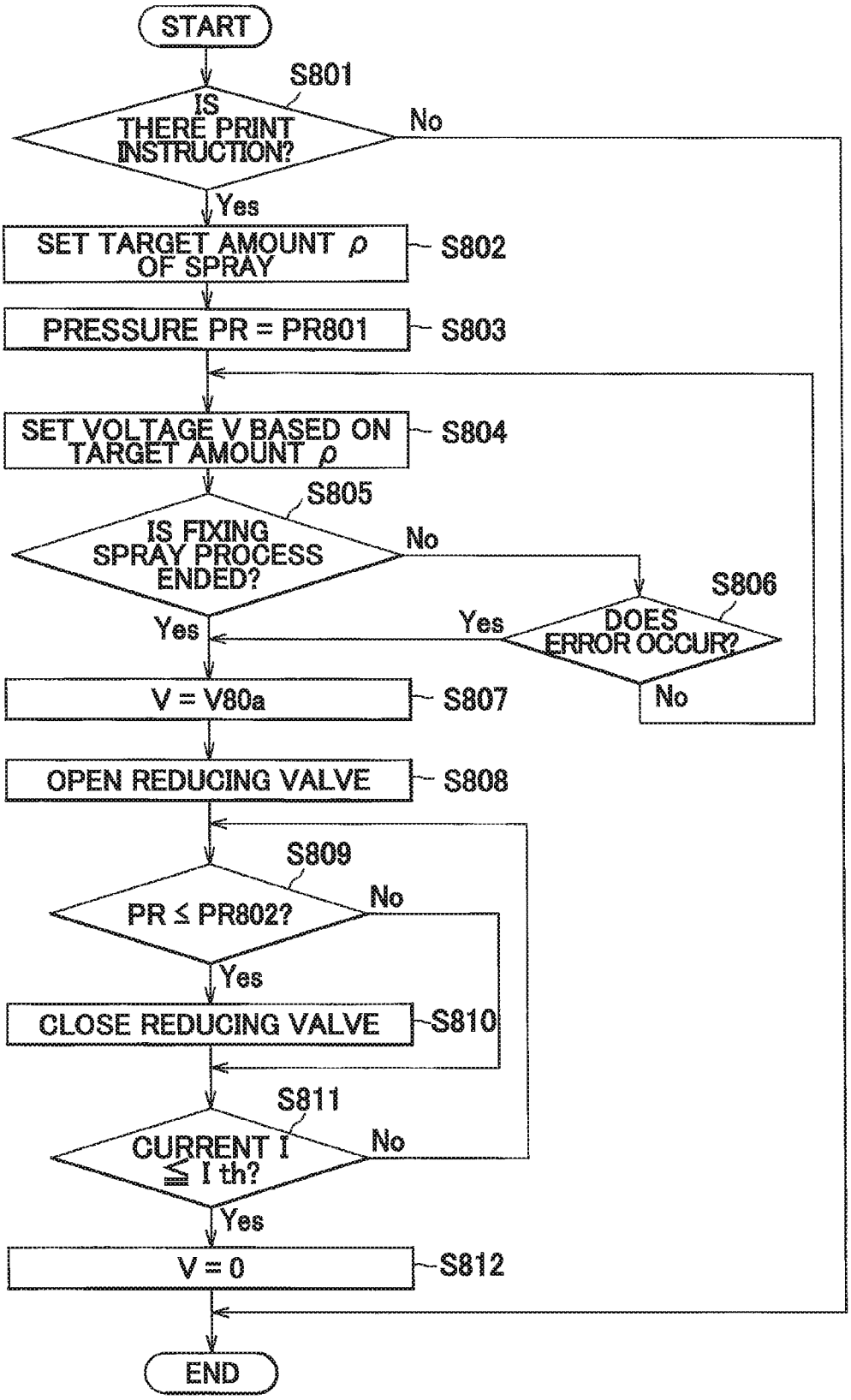
FIG. 111 is a flowchart illustrating operation in a controller.

The following describes in detail operation of the controller 800 with reference to FIG. 111. The controller 800 executes the process illustrated in FIG. 111 for each of the fixing heads 871A to 871E. Hereinafter, control for the first fixing head 871A will be described as a representative example.

As illustrated in FIG. 111, the controller 800 first determines whether there is a print instruction (S801). When determining in step S801 that there is no print instruction (No), the controller 800 ends the process.

When determining in step S801 that there is a print instruction (Yes), the controller 800 refers to print data in the print instruction and sets the target amount ρ of spray on the basis of an image corresponding to the first fixing head 871A (S802). After executing step S802, the controller 800 sets the pressure PR applied to the fixing solution L in the first fixing head 871A to the first pressure PR801 (S803).

After executing step S803, the controller 800 sets the voltage V to be applied to the first electrode 874 on the basis of the target amount ρ, and applies the set voltage V to the first electrode 874 to execute the fixing spray process for spraying the fixing solution L from the first fixing head 871A to an image on the paper P (S804). After executing step S804, the controller 800 determines whether the fixing spray process is ended (S805).

When determining in step S805 that the fixing spray process is not ended (No), the controller 800 determines whether any error has occurred (S806). When determining in step S806 that there occurs no error (No), the controller 800 returns to step S804.

When determining in step S805 that the fixing spray process is ended (Yes) or determining in step S806 that any error has occurred (Yes), the controller 800 determines to stop spraying the fixing solution L and sets the voltage V applied to the first electrode 874 to the prescribed voltage V80*a* (S807). After executing step S807, the controller 800 opens the reducing valve 875B of the pressurization device 875 (S808) to start the pressure reduction process.

After executing step S808, the controller 800 determines, on the basis of a signal from the pressure sensor 8SP, whether the pressure PR of the fixing solution L in the first fixing head 871A becomes equal to or lower than the second pressure PR802 (S809). When determining in step S809 that the pressure PR is higher than the second pressure PR802 (No), the controller 800 shifts to step S811. On the other hand, when determining in step S809 that the pressure PR is equal to or lower than the second pressure PR802 (Yes), the controller 800 closes the reducing valve 875B (S810) to end the pressure reduction process.

After executing step S810 or when determining "No" in step S809, the controller 800 determines whether the current I detected by the second current sensor 8SA is equal to or smaller than the prescribed value Ith (S811). When determining in step S811 that the current I is larger than the prescribed value Ith (No), the controller 800 returns to step S809. On the other hand, when determining that the current I is equal to or smaller than the prescribed value Ith (Yes), the controller 800 executes the voltage reduction process to reduce the voltage V to 0 (S812) and ends the process. When the reducing valve 875B is in an open state in step S812, the controller 800 closes the reducing valve 875B.

Figure 112A:
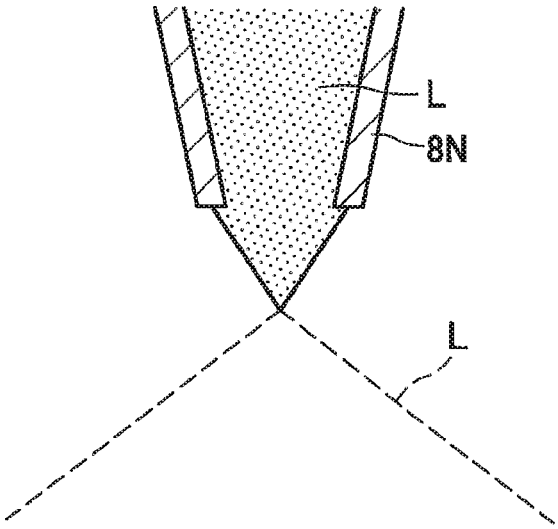
FIGS. 112A-112C are views illustrating states of fixing solution positioned adjacent to a tip end of a nozzle when spraying of the fixing solution is stopped.
Figure 112B:
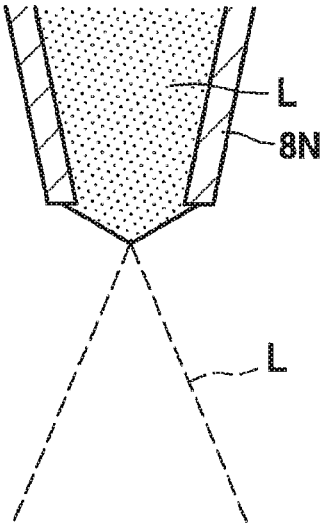
Figure 112C:
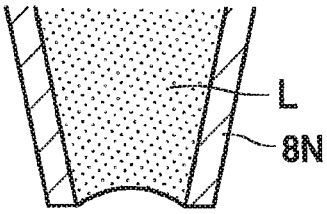

The following describes a state of the fixing solution L around the tip of the nozzle 8N when stopping spraying the fixing solution L with reference to FIGS. 112A to 112C.

As illustrated in FIG. 112A, in the fixing spray process, the cone-shaped fixing solution L, i.e., the Taylor cone is formed at the tip of the nozzle 8N, and the fixing solution L of the target amount ρ is sprayed from the tip of the Taylor cone. When the pressure reduction process is started after completion of the fixing spray process, the amount of the fixing solution L fed to the tip of the nozzle 8N is gradually reduced, with the result that the volume of the Taylor cone is gradually reduced as illustrated in FIG. 112B.

Thereafter, the spraying from the Taylor cone is stopped, and the controller 800 stops application of the voltage V to the fixing solution L. Then, as illustrated in FIG. 112C, the surface shape of the fixing solution L is changed from the Taylor cone-shape to a spherical shape. At this time, since the volume of the Taylor cone is reduced due to the spraying of the fixing solution during the time from the end of the fixing spray process to the stop of application of the voltage V, the amount of the fixing solution L remaining at the tip of the nozzle 8N (amount of the fixing solution L positioned below the tip of the nozzle N) is reduced. Accordingly, the fixing solution L remaining at the tip of the nozzle 8N is retained in the nozzle 8N without going around the outer peripheral surface of the nozzle 8N.

According to the ninth embodiment, the following effects can be obtained.

After completion of the fixing spray process, the pressure reduction process and the voltage reduction process are sequentially performed in this order, thereby preventing the fixing solution L from going around the outer peripheral surface of the nozzle 8N from the tip thereof, which in turn can prevent the fixing solution L from adhering to the outer peripheral surface of the nozzle 8N.

Even after the completion of the fixing spray process, voltage application (V=V80*a*) is continued until the spraying of the fixing solution L is stopped, so that the volume of the Taylor cone-shaped fixing solution L can be extremely reduced.

Since the spraying of the fixing solution L is determined to be stopped on the basis of the current I detected by the second current sensor 8SA, the stop of spraying can be properly determined.

The pressure reduction process and the voltage reduction process are executed even at occurrence of an error such as jamming of the paper P, so that the fixing solution L can be prevented from adhering to the outer peripheral surface of the nozzle 8N even at error occurrence.

The present invention can be used in various embodiments as described below as examples without limited to the ninth embodiment. In the following description, any member having substantially the same structure as that of the ninth embodiment will be given the same reference numeral, and the description thereof will be omitted.

In the above ninth embodiment, it is determined that the spraying of the fixing solution L is stopped on the basis of the current I detected by the second current sensor 8SA. However, the present invention is not limited to this, and determination of whether the spraying of the fixing solution L is stopped may be made on the basis of a voltage detected by a voltage sensor, for example. Specifically, a resistor and a voltage sensor for detecting a voltage applied to the resistor are provided in a wiring connected to the second electrode 872. It is determined whether a current value becomes equal to or smaller than a prescribed value (whether the spraying is stopped) by determining whether a voltage detected by the voltage sensor becomes equal to or smaller than a prescribed value.

Figure 113:
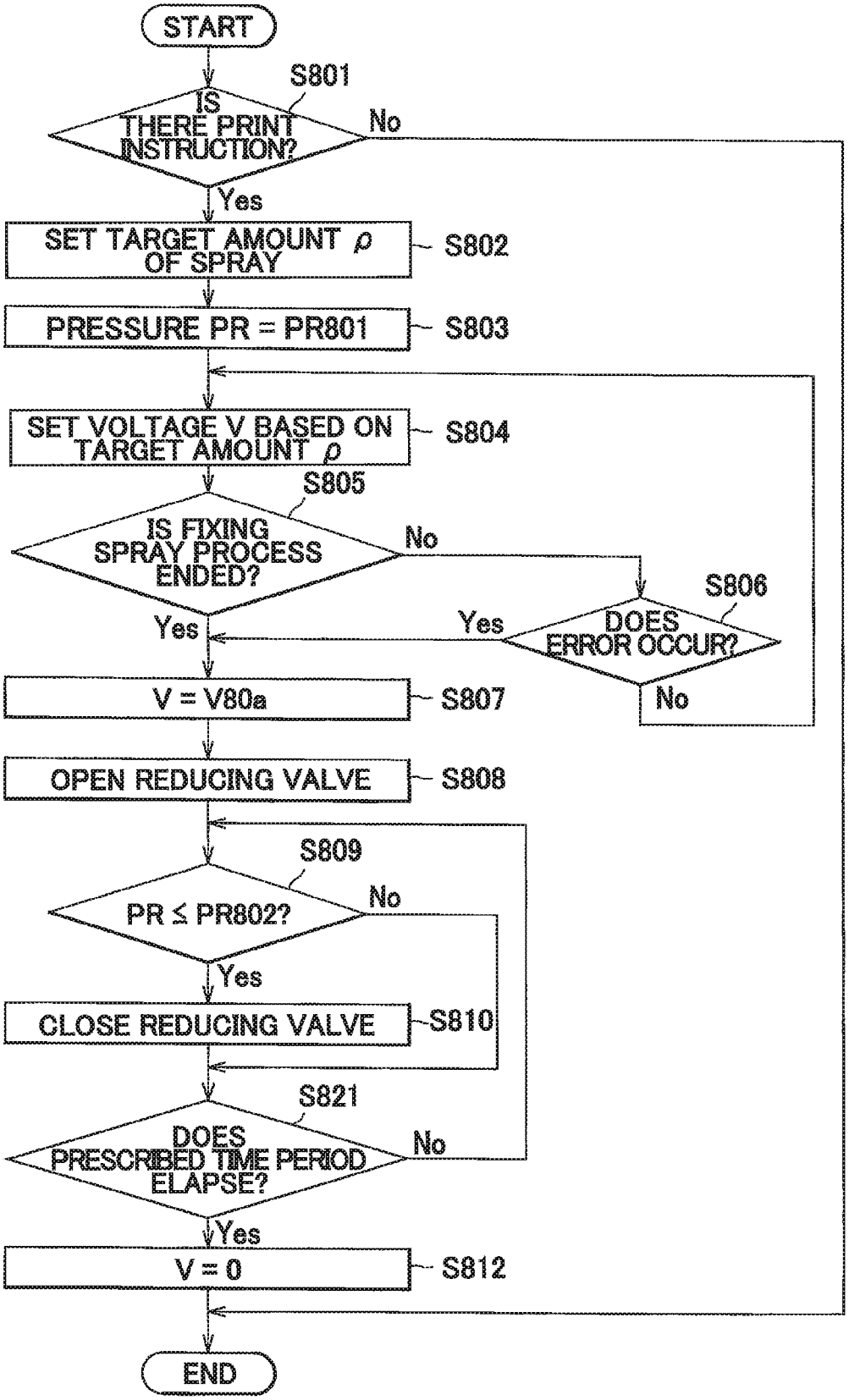
FIG. 113 is a flowchart illustrating operation in the controller according to a first modification.

Alternatively, determination of whether the spraying of the fixing solution L is stopped may be made on the basis of the time period elapsed from the start of the pressure reduction process. For example, step S821 illustrated in FIG. 113 is executed in place of step S811 illustrated in FIG. 111.

Specifically, in step S821, the controller 800 determines whether a prescribed time period has elapsed from the start of the pressure reduction process (start of execution of step S808). When determining in step S821 that the prescribed time period has not elapsed (No), the controller 800 returns to step S809. On the other hand, when determining that the prescribed time period has elapsed (Yes), the controller 800 determines that the spraying is stopped and shifts to step S812.

According to this embodiment, the stop of spraying is determined by the time period elapsed from the start of the pressure reduction process, so that control can be simplified as compared to the ninth embodiment.

In the above described ninth embodiment, the pressure reduction process is always executed after completion of the fixing spray process, that is, after the upstream end of an image on the last page in one print job is moved past the fixing regions A801 to A805 (spray regions) of the fixing solution L. However, the present invention is not limited to this, and, for example, the controller 800 may start the pressure reduction process before the upstream end of an image on the last page in one print job is moved past the fixing regions A801 to A805 of the fixing solution L.

Figure 114:
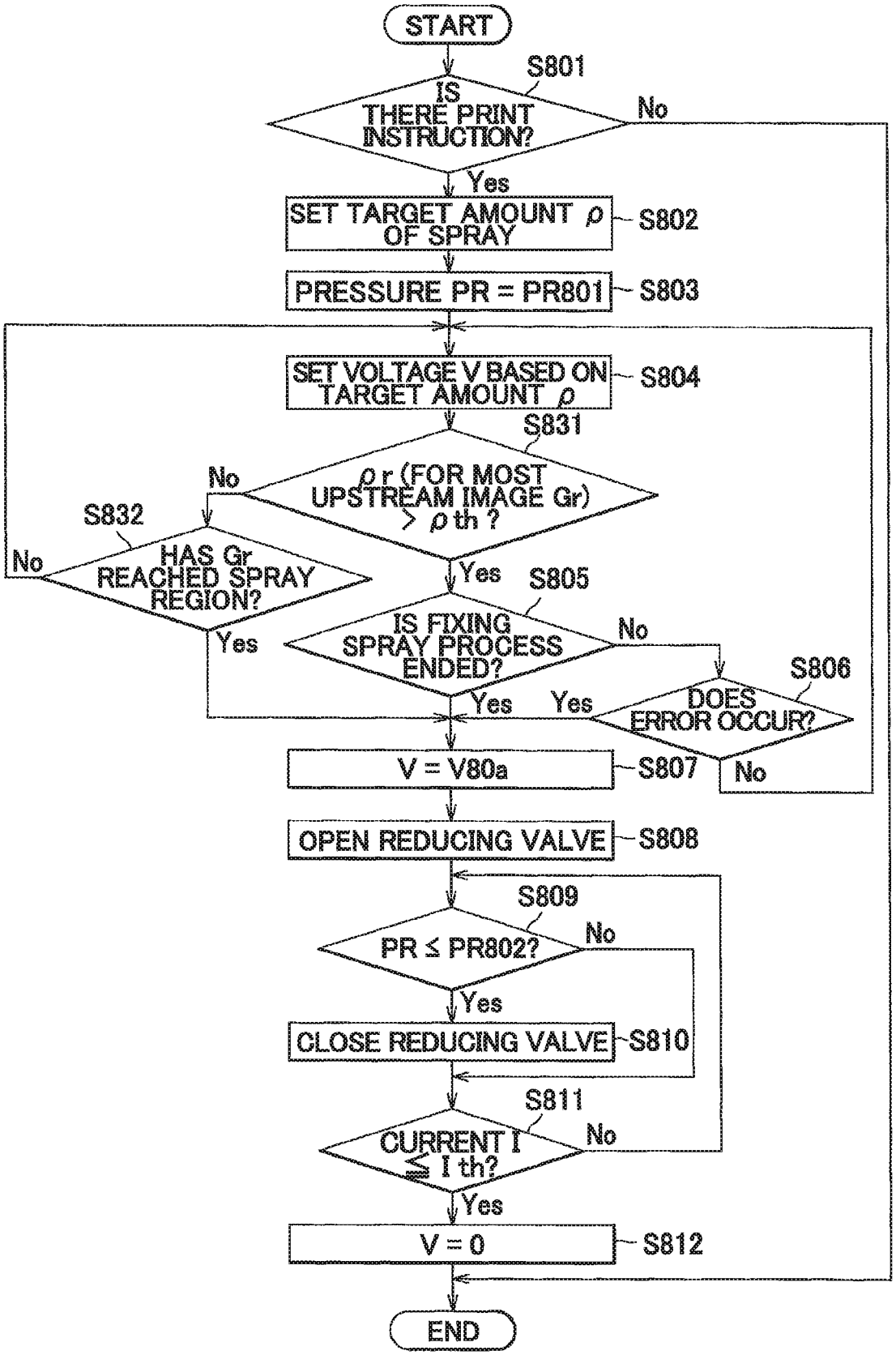
FIG. 114 is a flowchart illustrating operation in the controller according to a second modification.

For example, as illustrated in FIG. 114, steps S831 and S832 may be added to the process shown in the flowchart of FIG. 111. Step S831 is provided between step S804 and step S805.

In step S831, the controller 800 determines whether a target amount ρr of spray set for a most upstream image Gr (image having the same size as that of the fixing regions A801 to A805) disposed most upstream on the last page in one print job is larger than a prescribed threshold value pth. The threshold value pth is appropriately set by experiments and simulations as a value corresponding to the amount of the fixing solution L to be sprayed between steps S807 to S812.

When determining in step S831 that ρr is larger than pth (Yes), the controller 800 determines that the most upstream image Gr cannot be fixed satisfactorily with the amount of the fixing solution L to be sprayed between steps S807 to S812 and shifts to step S805. That is, when the image density of the most upstream image Gr is so high that a large amount of the fixing solution L is required for the fixing of the upstream image Gr (when the amount of the fixing solution L corresponding to the volume of the Taylor cone is insufficient for the fixing), the controller 800 shifts to step S805 and then to step S804, thus allowing the fixing solution L corresponding to the target amount ρr to be sprayed to the most upstream image Gr. Accordingly, the most upstream image Gr can be fixed satisfactorily.

When determining in step S831 that ρr is equal to or smaller than ρth (No), the controller 800 determines that the most upstream image Gr can be fixed satisfactorily with the amount of the fixing solution L to be sprayed between steps S807 to S812 and then determines whether the most upstream image Gr has reached the spray region (e.g., the fixing region A801) (S832). When determining in step S832 that the most upstream image Gr has not reached the spray region (No), the controller 800 returns to step 804.

When determining in step S832 that the most upstream image Gr has reached the spray region (Yes), the controller 800 shifts to step S807. As a result, step S807 and subsequent steps are executed before the most upstream image Gr is move past the spray region. This allows the fixing solution L to be sprayed between steps S807 and S812 to be used for fixing of the most upstream image Gr, whereby the fixing solution L can be effectively used.

In the ninth embodiment, the first electrode 874 is disposed in the interior of the container portion 873. However, the present invention is not limited to this. For example, the nozzles and the container portions may be made of a conductive member such as a metal, and the nozzles or the container portion may be applied with a voltage. In this case, each nozzle or each container portion, which is applied with a voltage, functions as the first electrode. In this case, the plurality of conductive container portions may be provided so as to be separated from each other in order to block movement of electric charges between the container portions. Alternatively, insulating members may be provided between the plurality of conductive container portions in order to block movement of electric charges between the container portions. In another case, the container portion may be made of a non-conductive member such as a resin, the nozzles may be made of a conductive member such as a metal, and the nozzles may be applied with a voltage. In this case, each nozzle functions as the first electrode.

In the above ninth embodiment, the present invention is applied to the laser printer 801. However, the present invention is not limited to this, and may be applied to other types of image forming devices, such as a copying machine or a multifunction peripheral.

In the above ninth embodiment, the paper P such as a thick paper, a post card, or a thin paper is exemplified as a recording sheet. However, the present invention is not limited to this, and the recording sheet may be, e.g., an OHP sheet.

In the above ninth embodiment, the pressurization device 875 having the pump 875A and the reducing valve 875B is exemplified as a pressure applying means for applying a pressure to the fixing solution in the container portion. However, the present invention is not limited to this, and, for example, the pressure applying means may be a device that pressurizes and depressurizes the liquid in each head utilizing the water head difference.

In the above ninth embodiment, it is assumed that the fixing regions A801 to A805 are the same in shape, size, and position as those of the lower surfaces of the respective container portions 873 for descriptive convenience. However, the present invention is not limited to this, and each fixing region may be smaller or larger in size than the lower surface of the container portion. That is, each fixing region may be defined on the basis of the front-rear width and the left-right width of the fixing solution to be sprayed onto the paper.

In the above ninth embodiment, the voltage is reduced to 0 in the voltage reduction process. However, the present invention is not limited to this, and, in the voltage reduction process, the voltage may be reduced to a value larger than 0 and smaller than the voltage applied at the start of the pressure reduction process. In other words, in the voltage reduction process, the voltage may be reduced to a value larger than 0 and smaller than the minimum value of a current range used in the fixing spray process.

The ninth object can be achieved by the ninth embodiment and any modification thereof described with reference to FIGS. 107 to 114. The above-described ninth embodiment is one example of the ninth invention, and the ninth invention is not limited to this.

A laser printer 901 of a tenth embodiment of the present invention will be explained with reference to FIGS. 115-121. In the tenth embodiment, like parts and components are designated with the same reference numerals as the first embodiment to avoid duplicating description.

Figure 115:
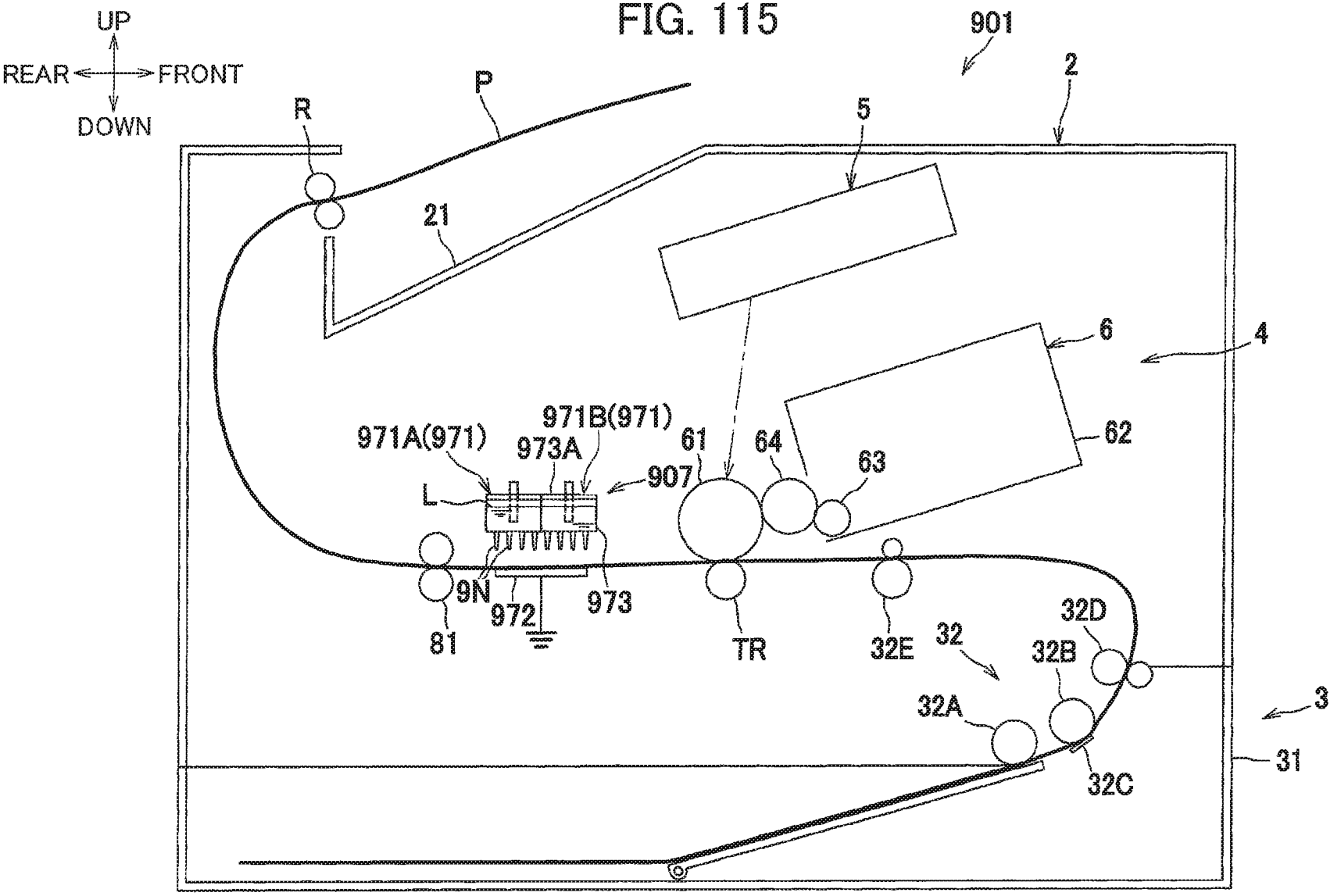
FIG. 115 is a view illustrating a laser printer provided with a fixing device according to a tenth embodiment of the present invention.

In the following description, directions are defined with respect to a position of a user using the laser printer. That is, the right side of FIG. 115 is defined as a front side, the left side of FIG. 115 is defined as a rear side, the far side of FIG. 115 defined as a right side, and the near side of FIG. 115 is defined as a left side. The upward and downward directions of FIG. 115 are defined as an upward direction and a downward direction.

As illustrated in FIG. 115, the laser printer 901 further has a fixing device 907.

The fixing device 907 is configured to supply a charged fixing solution L onto a toner image on the paper P by electrostatic spraying method to fix the toner image onto the paper P. The configuration of the fixing device 907 will be described later in detail.

A pair of downstream side conveyance rollers 81 is provided downstream of the fixing device 907. The pair of conveyance rollers 81 is configured to nip and convey the paper P discharged from the fixing device 907 to the downstream side.

Next, the configuration of the fixing device 907 will be described in detail.

Figure 116:
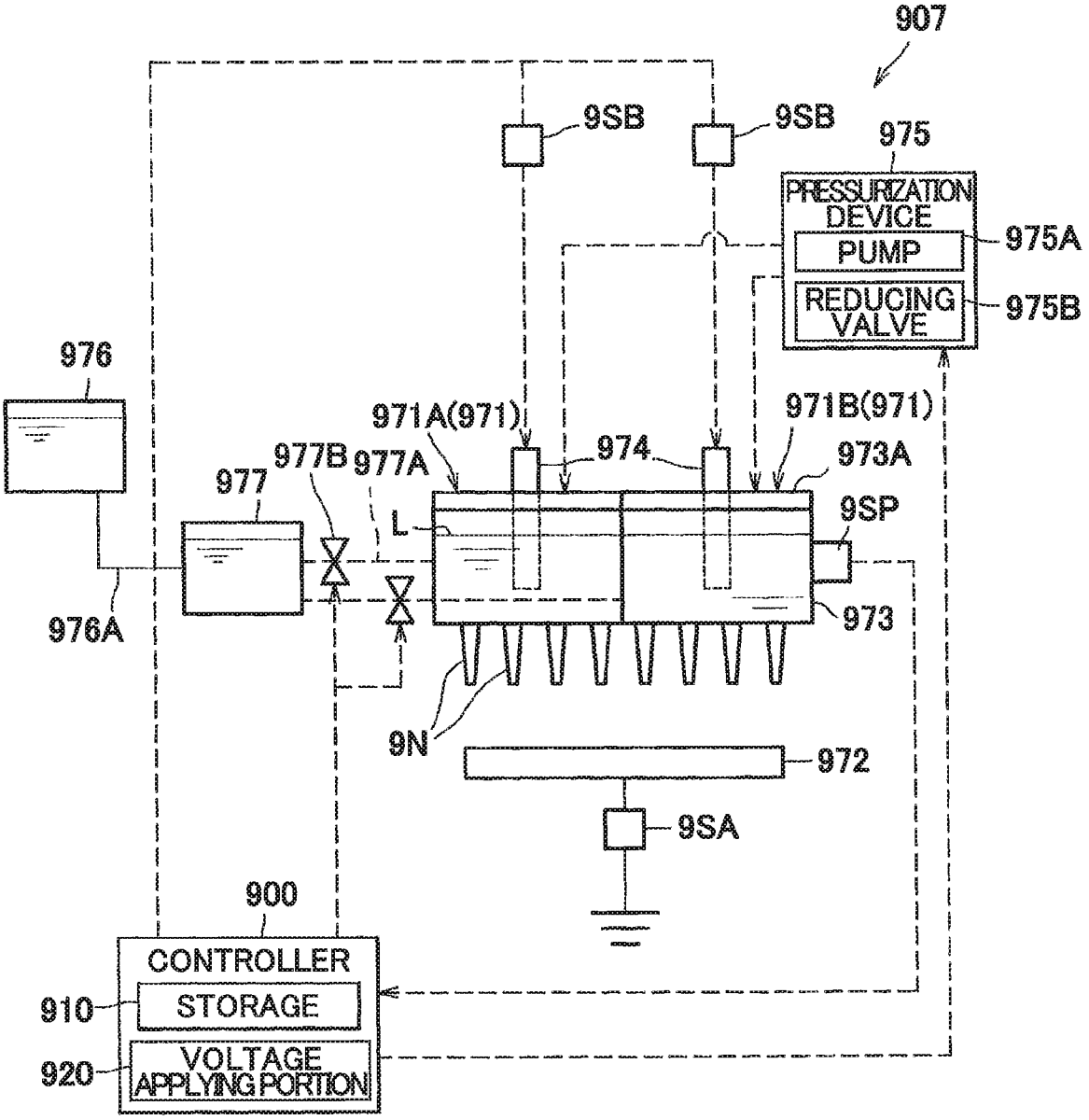
FIG. 116 is a view illustrating in detail the fixing device.

As illustrated in FIG. 116, the fixing device 907 has a fixing head 971 for spraying the fixing solution L toward the toner image on the paper P, a second electrode 972 that is disposed below the fixing head 971 for supporting the paper P, a pressurization device 975 as an example of a pressure applying portion, a fixing-solution cartridge 976, a tank 977, and a controller 900.

Figure 117A:
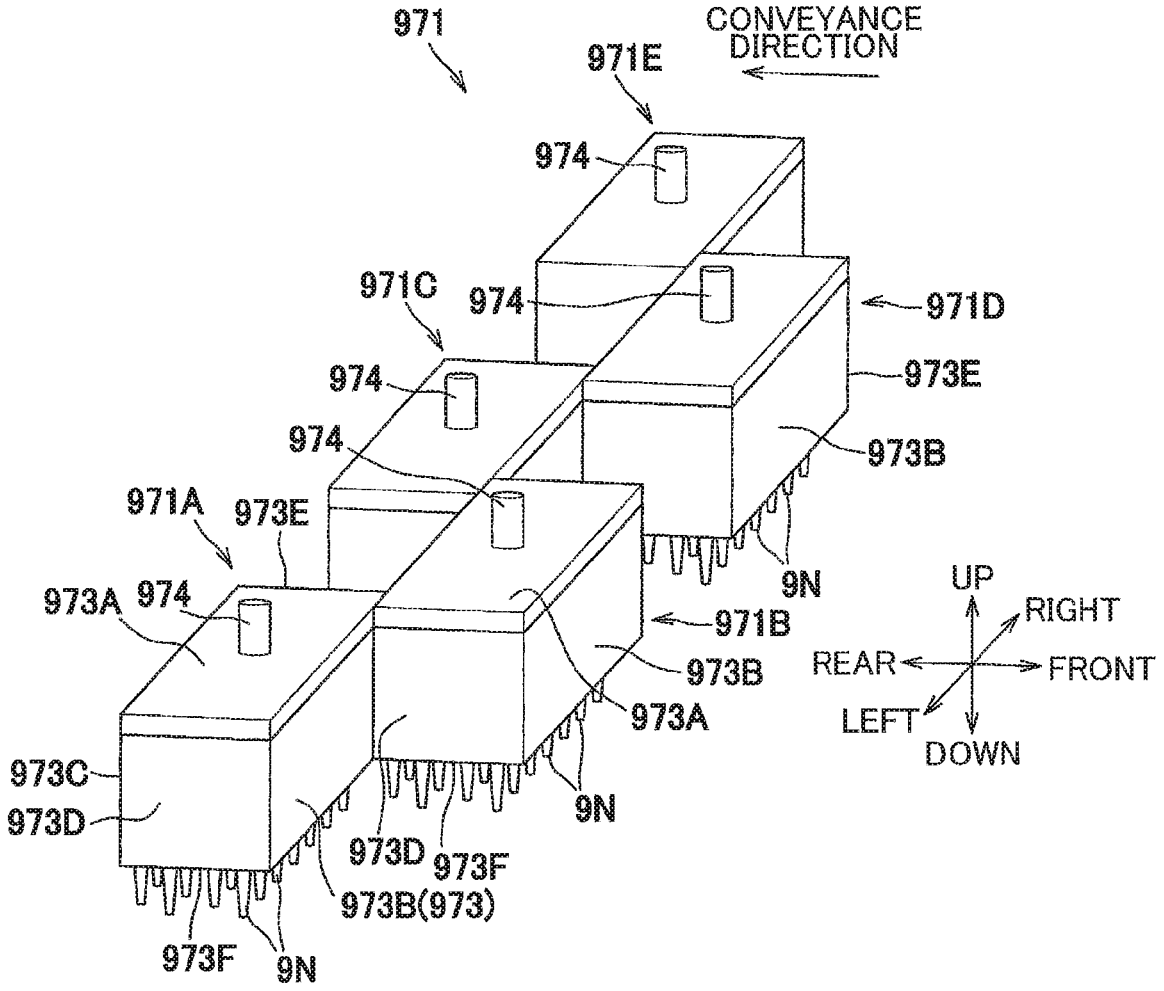
FIG. 117A is a perspective view of a fixing head as viewed from diagonally above.

As illustrated in FIG. 117A, the fixing head 971 has a first fixing head 971A, a second fixing head 971B, a third fixing head 971C, a fourth fixing head 971D, and a fifth fixing head 971E which are arranged in a staggered manner in the width direction of the paper P. The first fixing head 971A, the third fixing head 971C, and the fifth fixing head 971E are disposed at substantially the same position in the front-rear direction, i.e., in the conveyance direction of the paper P and disposed spaced apart from each other in the left-right direction, i.e., in the width direction of the paper P. The second fixing head 971B is disposed upstream of the first fixing head 971A and the third fixing head 971C in the conveyance direction such that the center of the second fixing head 971B in the width direction is located between the first fixing head 971A and the third fixing head 971C in the width direction. The fourth fixing head 971D is disposed upstream of the third fixing head 971C and the fifth fixing head 971E in the conveyance direction such that the center of the fourth fixing head 971E in the width direction is located between the third fixing head 971C and the fifth fixing head 971E in the width direction.

The first fixing head 971A has a container portion 973 that stores therein the fixing solution L, a plurality of nozzles 9N that communicates with the container portion 973 and is configured to spray the fixing solution L toward the toner image, and a first electrode 974 that is configured to apply a voltage to the fixing solution L in the container portion 973 and the nozzles 9N. The other fixing heads 971B to 971E have substantially the same configuration as the first fixing head 971A, so components of the other fixing heads 971B to 971E are designated with the same reference numerals as those of the first fixing head 971A, and description thereof is omitted. That is, the fixing heads 971A to 971E (container portions 973) have the same shape and are separately provided. The number and arrangement of the nozzles 9N are the same between all the container portions 973.

Figure 117B:
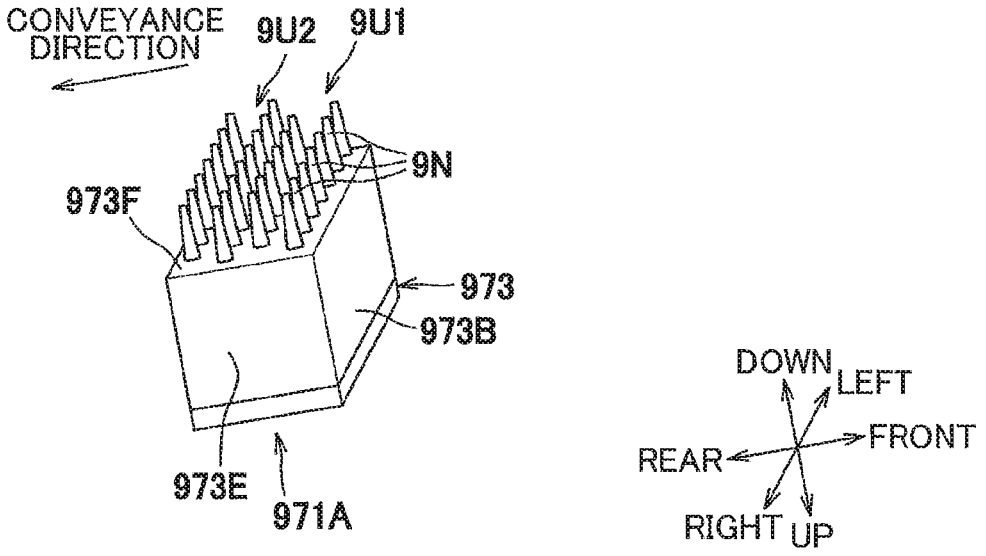
FIG. 117B is a perspective view of the first fixing head as viewed from diagonally below.

The container portion 973 is an insulating container having a rectangular shape elongated in the width direction and has a top wall 973A, a front wall 973B, a rear wall 973C, a left wall 973D, a right wall 973E, and a bottom wall 973F. As illustrated in FIG. 117B, the plurality of nozzles 9N in each of the fixing heads 971A-971E protrudes downward from the bottom wall 973F with their diameters gradually reduced as they extend downward. The plurality of nozzles 9N is arranged in both of the width and conveyance directions.

Figure 118:
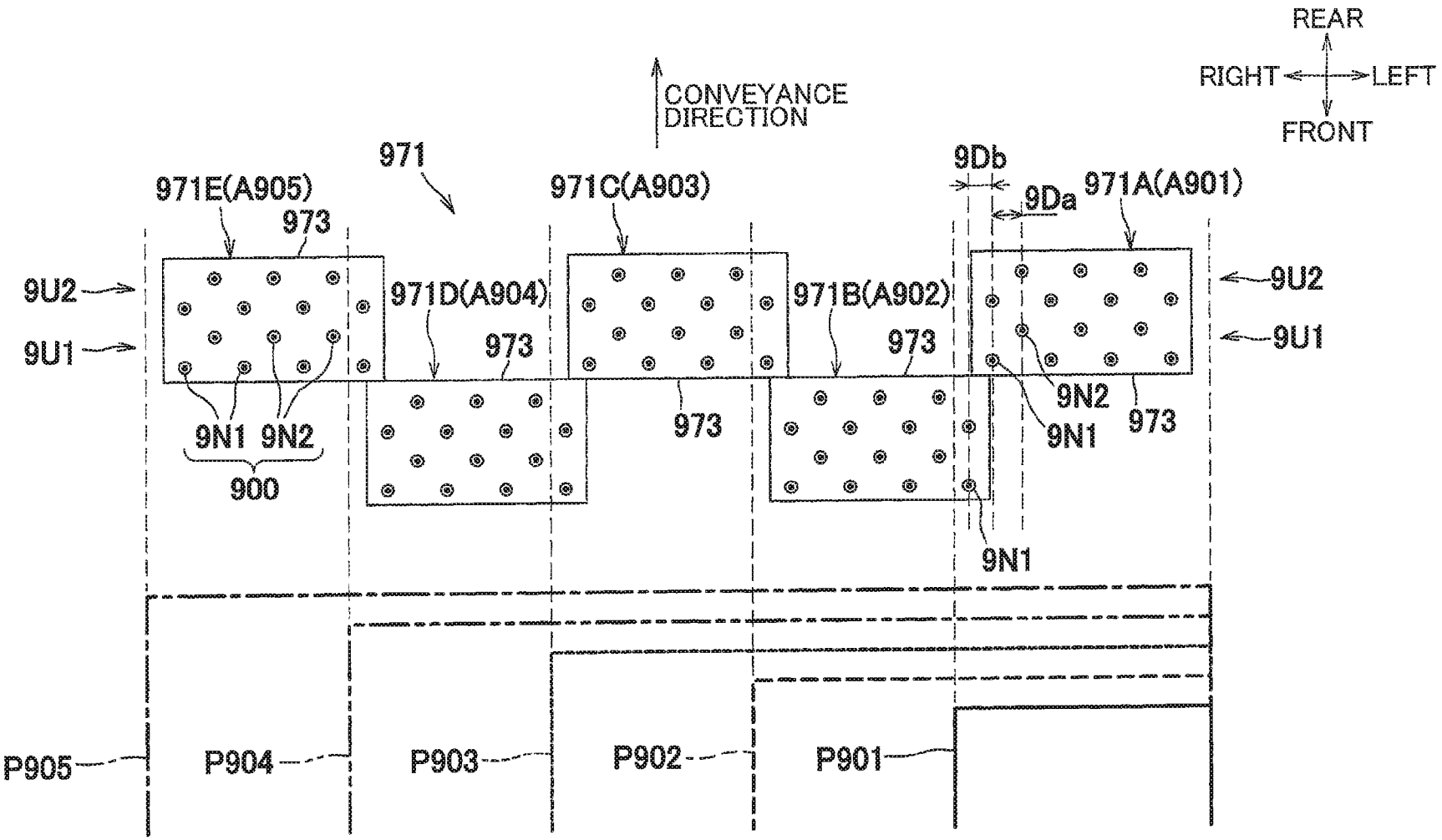
FIG. 118 is a bottom view of the fixing head.

Specifically, the plurality of nozzles 9N constitutes a first staggered array group 9U1 and a second staggered array group 9U2. The first staggered array group 9U1 and the second staggered array group 9U2 are arranged in the conveyance direction. As illustrated in FIG. 118, the first staggered array group 9U1 includes a plurality of first nozzles 9N1 arranged at regular intervals in the width direction and a plurality of second nozzles 9N2 arranged at regular intervals in the width direction. The first nozzles 9N1 and the second nozzles 9N2 are alternately arranged in the width direction with the first nozzles 9N1 disposed in one side with respect to the conveyance direction and with the second nozzles 9N2 disposed in the other side with respect to the conveyance direction.

Each second nozzle 9N2 is disposed between two first nozzles 9N1 in the width direction. A shape formed by connecting two first nozzles 9N1 adjacent to each other in the width direction and the second nozzle 9N2 disposed between the two first nozzles 9N1 is an equilateral triangle or an isosceles triangle. Similarly, a shape formed by connecting two second nozzles 9N2 adjacent to each other in the width direction and the first nozzle 9N1 disposed between the two second nozzles 9N2 is an equilateral triangle or an isosceles triangle.

The second staggered array group 9U2 has the same structure as that of the first staggered array group 9U1. In the tenth embodiment, a nozzle pitch (the shortest distance between the outer peripheries of the adjacent nozzles) may be set in a range equal to or larger than 1 mm and equal to or smaller than 14 mm.

Two fixing heads (e.g., first and second fixing heads 971A and 971B) adjacent to each other in the width direction are disposed such that the container portions 973 thereof overlap each other when viewed in the conveying direction. Specifically, the minimum pitch (e.g., pitch between the first nozzle 9N1 and the second nozzle 9N2) of the plurality of nozzles 9N in the width direction in a prescribed fixing head (e.g., the first fixing head 971A) is 9Da. On the other hand, a distance 9Db is smaller than the minimum pitch 9Da. Here, the distance 9Db is a distance from one nozzle 9N of a prescribed fixing head (e.g., the rightmost first nozzle 9N1 of the first fixing head 971A) to another nozzle 9N of another fixing head (e.g., the leftmost first nozzle 9N1 of the second fixing head 971B). Specifically, the width direction is a direction from one end side to the other end side, and the one nozzle 9N is an end nozzle disposed at the one end side in the width direction among nozzles 9N in the prescribed fixing head. The another fixing head is disposed adjacent to the prescribed fixing head at the one end side of the prescribed fixing head in the width direction. The another nozzle 9N is an end nozzle disposed at the other end side in the width direction among nozzles 9N in the another fixing head.

Fixing regions A901-A905 are set for respective fixing heads 971A-971E. Each of the fixing regions A901-A905 is a region to which the nozzles of the corresponding one of the fixing heads 971A-971E spray the fixing solution L toward the paper P. The fixing heads 971A-971E are disposed such that the fixing regions A901-A905 overlap one another when viewed in the conveyance direction. In the tenth embodiment, for descriptive convenience, it is assumed that the fixing regions A901-A905 of the respective fixing heads 971A-971E have the same in shape, size, and position as those of the lower surfaces of corresponding container portions 973.

More specifically, the first fixing region A901 overlaps the second fixing region A902 when viewed in the conveyance direction. Here, the fixing solution L is sprayed from the first fixing head 971A to the first fixing region A901 and the fixing solution L is sprayed from the second fixing head 971B to the second fixing region A902. Further, the fifth fixing region A905 overlaps the fourth fixing region A904 when viewed in the conveyance direction. Here, the fixing solution L is sprayed from the fifth fixing head 971E to the fifth fixing region A905 and the fixing solution L is sprayed from the fourth fixing head 971D to the fourth fixing region A904.

Further, the third fixing region A903 overlaps the second fixing region A902 and the fourth fixing region A904 when viewed in the conveyance direction. Here, the fixing solution L is sprayed from the third fixing head 971C to the third fixing region A903. The arrangement of the fixing heads 971A-971E described above can suppress occurrence of a region between any two of the fixing heads 971A-971E to which the fixing solution L is not sprayed.

The first fixing head 971A is a head for spraying the fixing solution L to a first paper P901 having the narrowest width among a plurality of types of the papers P on which the laser printer 901 can print images. The first fixing head 971A has a width smaller than the width of the first paper P901. The first fixing head 971A is disposed within a range between the left and right ends of the first paper P901 in the left-right direction. More specifically, the first fixing region A901 of the first fixing head 971A is formed so as to have a width equal to or larger than the width of an image formation region of the first paper P901 on which an image is to be formed. That is, the entire width of the image formation region falls within the width of the first fixing region A901.

In the tenth embodiment, as illustrated in FIG. 118, the papers P901 to P905 having different paper widths are conveyed with the left ends thereof set as a reference. Specifically, a guide member (not illustrated) is provided in the casing 2 and is configured to contact and guide the left end of each of the papers P901 to P905.

The second fixing head 971B is adjacent to the right side (one side in the width direction) of the first fixing head 971A and is disposed left side (the other side in the width direction) of the right end of the second paper P902 having a width larger than the width of the first paper P901. Specifically, the right end of the second fixing region A902 of the second fixing head 971B is disposed at the same position as or right side of the right end of the image formation region of the second paper P902. The left end of the image formation region of the second paper P902 substantially coincides with the left end of the image formation region of the first paper P901. With this arrangement, the combination of the first fixing head 971A and the second fixing head 971B can spray the fixing solution L to the image formation region of the second paper P902.

The third fixing head 971C is adjacent to the right side of the second fixing head 971B and is disposed left side of the right end of the third paper P903 having a width larger than the width of the second paper P902. Specifically, the right end of the third fixing region A903 of the third fixing head 971C is disposed at the same position as or right side of the right end of the image formation region of the third paper P903. The left end of the image formation region of the third paper P903 substantially coincides with the left end of the image formation region of the first paper P901. With this arrangement, the combination of the first fixing head 971A, the second fixing head 971B, and the third fixing head 971C can spray the fixing solution L to the image formation region of the third paper P903.

The fourth fixing head 971D is adjacent to the right side of the third fixing head 971C and is disposed left side of the right end of the fourth paper P904 having a width larger than the width of the third paper P903. Specifically, the right end of the fourth fixing region A904 of the fourth fixing head 971D is disposed at the same position as or right side of the right end of the image formation region of the fourth paper P904. The left end of the image formation region of the fourth paper P904 substantially coincides with the left end of the image formation region of the first paper P901. With this arrangement, the combination of the first to fourth fixing heads 971A to 971D can spray the fixing solution L to the image formation region of the fourth paper P904.

The fifth fixing head 971E is adjacent to the right side of the fourth fixing head 971D and is disposed left side of the right end of the fifth paper P905 having a width larger than the width of the fourth paper P904. Specifically, the right end of the fifth fixing region A905 of the fifth fixing head 971E is disposed at the same position as or right side of the right end of the image formation region of the fifth paper P905. The left end of the image formation region of the fifth paper P905 substantially coincides with the left end of the image formation region of the first paper P901. With this arrangement, the combination of the first to fifth fixing heads 971A-971E can spray the fixing solution L to the image formation region of the fifth paper P905.

Referring back to FIG. 116, the first electrode 974 is an electrode that applies a voltage to the fixing solution L in the container portion 973 to generate an electric field at the tip of each nozzle 9N. The first electrode 974 is provided so as to penetrate the top wall 973A of the container portion 973 from the top to the bottom of the top wall 973A. The lower end portion of the first electrode 974 is disposed in the fixing solution L in the container portion 973 and in contact with the fixing solution L, and the upper end portion thereof is connected to the controller 900 having a voltage applying portion 920. The voltage to be applied to the first electrode 974 is preferably in a range from 1 kV to 10 kV.

A pressurization device 975 is connected to the fixing heads 971A-971E. The pressurization device 975 is a device that applies a pressure to the fixing solution L in the fixing heads 971A-971E. The pressurization device 975 has a pump 975A that pressurizes the air in the fixing heads 971A-971E, and a reducing valve 975B that releases the air from the fixing heads 971A-971E so as to perform depressurization. Further, each of the fixing heads 971A-971E has a pressure sensor 9SP (in FIG. 116, only one pressure sensor 9SP is illustrated as a representative example) that detects the pressure of the fixing solution L therein.

The second electrode 972 is an electrode that is configured to contact the paper P to form a potential difference between the fixing solution L in the nozzle 9N and the paper P and is disposed below the fixing heads 971A-971E so as to be separated from the tips of the nozzles 9N of the fixing heads 971A-971E by a prescribed distance. The prescribed distance is determined by experiments or simulations. Specifically, the prescribed distance is set to a value larger than the thickness of the paper P so that electrostatic spraying can be performed suitably.

The second electrode 972 is grounded. The second electrode 972 need not necessarily be grounded, and a voltage lower than one applied to the first electrode 974 may be applied to the second electrode 972. The second electrode 972 forms an electric field between itself and the tips of the nozzles 9N.

An electric field is formed in a space around the tip of each nozzle 9N when a voltage is applied to the first electrode 974. Since the fixing solution L is supplied toward the tip of each nozzle 9N by the pressurization device 975, the second electrode 972 forms an electric field between the second electrode 972 and the fixing solution L in the tip of each nozzle 9N. Then, at the tip of each nozzle 9N, the fixing solution L is attracted by the electric field to form so-called Taylor cone. The fixing solution L is torn off from the tip of the Taylor cone, whereby a fine droplet is generated.

The droplet-like fixing solution L, sprayed by the nozzles 9N, is positively charged. In contrast, the paper P has a substantially zero potential. As a result, the droplet-like fixing solution L flies toward the paper P due to Coulomb force, and adheres to the paper P or the toner image.

A first current sensor 9SB is a sensor that detects a current flowing in the first electrode 974 to indirectly detect a current flowing in the fixing solution L and is provided corresponding to each first electrode 974. The first current sensor 9SB detects a current flowing in the first electrode 974 when the fixing solution L is sprayed from the corresponding nozzles 9N to the paper P and outputs a detected value thereof to the controller 900. When the fixing solution L is not sprayed from the nozzle 9N, no current flows in the first electrode 974 even if a voltage is applied to the first electrode 974. A current flows in the first electrode 974 when the fixing solution L is sprayed from the nozzles 9N, in other words, when the charged fixing solution L is moved from the nozzles 9N to the paper P.

A second current sensor 9SA is a sensor that is configured to detect a current flowing in the second electrode 972. The second current sensor 9SA detects a current flowing in the second electrode 972 when the fixing solution L is sprayed from the nozzles 9N to the paper P, and outputs a detected value of the current to the controller 900. When the fixing solution L is not sprayed from the nozzle 9N, no current flows in the second electrode 972 even if a voltage is applied to the first electrode 974. That is, a current flows in the second electrode 972 when the fixing solution L is sprayed from the nozzle 9N, in other words, when the charged fixing solution L is moved from the nozzle 9N to the paper P.

The first and second electrodes 974 and 972 having the above-configuration constitute a potential difference generating portion for generating a potential difference between the fixing solution L in the nozzles 9N and the paper P conveyed at a position separated from the nozzles 9N.

The fixing-solution cartridge 976 is a cartridge filled with the fixing solution L and is detachably attached to the casing 2. The fixing-solution cartridge 976 is connected to the tank 977 through a pipe 976A. The pipe 976A may be provided with a hydraulic pump for supplying the fixing solution L from the fixing-solution cartridge 976 to the tank 977 and a switching valve for switching between supply and stop of the fixing solution L.

The tank 977 is provided in the casing 2 and is connected to the container portions 973 of the fixing heads 971A to 971E through a plurality of pipes 977A. Each pipe 977A is provided with a hydraulic pump for supplying the fixing solution L from the tank 977 to a corresponding one of the fixing heads 971A to 971E, and a valve 977B for switching between supply and stop of the fixing solution L. The valve 977B is formed of an insulating member.

The controller 900 has a storage 910 including a RAM, a ROM, and the like, the voltage applying portion 920 that applies voltage to the first electrode 974, a CPU, and an input/output circuit. The controller 900 has a function to control the pressurization device 975 and to control a voltage to be applied to the first electrode 974, on the basis of externally input image data and signals from the sensors 9SP, 9SA, and 9SB. Specifically, the controller 900 is configured to control the voltages and pressures to be applied to the fixing solution L in the fixing heads 971A to 971E individually.

Specifically, the controller 900 has a function to perform a fixing spray process and a droplet removal process. The fixing spray process is a process for spraying the fixing solution L from the fixing heads 971A to 971E toward the paper P to fix a toner image on the paper P. The droplet removal process is a process for removing droplets adhering to the outer peripheral surface of the nozzle 9N. When performing the fixing spray process, the controller 900 is configured to set a pressure PR to be applied to the fixing solution L to a first pressure PR901 and control a voltage V to be applied to the first electrode 974 on the basis of a target amount ρ of spray. The target amount ρ is calculated on the basis of image data. The target amount ρ is a target value of the fixing solution L to be sprayed per unit area of the paper P and is set to a larger value as image density becomes higher. The first pressure PR901 is appropriately set by, e.g., experiments and simulations.

The controller 900 executes the droplet removal process before the fixing spray process. The controller 900 executes the droplet removal process during the time period from a time when a print job is input and to a time when the fixing spray process is started.

In the droplet removal process, the controller 900 sets the pressure PR applied to the fixing solution L to a second pressure PR902 lower than the first pressure PR901 and sets the voltage V applied to the fixing solution L to a prescribed voltage V90*a*. The prescribed voltage V90*a* is a value falling within a voltage range within which the voltage is controlled in the fixing spray process. The prescribed voltage V90*a* is appropriately determined by experiments and simulations. The higher the prescribed voltage V90*a* is, the more fixing solution L adhering to the outer peripheral surface of the nozzle 9N can be scattered. So, the prescribed voltage V90*a* may be set to the maximum voltage value of the voltage range for the fixing spray process. The second pressure PR902 is a value in the range equal to or larger than P902 and smaller than P901 and is appropriately determined by experiments and simulations so as to be equal to or less than a meniscus withstanding pressure.

The meniscus withstand pressure refers to the maximum pressure at which the fixing solution L can be retained in the nozzle 9N in a state where no voltage is applied to the fixing solution L and is represented by the following expression (1).

$$Pm=(4\cdot\sigma\cdot\cos\theta)/d \quad (1)$$

Pm: meniscus withstanding pressure

σ: surface tension of fixing solution L

θ: contact angle d: inner diameter (diameter) of tip of nozzle 9N

That is, when a pressure larger than the meniscus withstanding pressure is applied to the fixing solution L in a state where no voltage is applied to the fixing solution L, the fixing solution L leaks from the tip of the nozzle 9N. On the other hand, when a pressure equal to or smaller than the meniscus withstanding pressure is applied to the fixing solution L, the fixing solution L is retained in the nozzle 9N.

The controller 900 applies the voltage V (prescribed voltage V90*a*) to the first electrode 974 for a first time period T901 in the droplet removal process and then changes the pressure PR from the second pressure PR902 to first pressure PR901 so as to start the fixing spray process. The first time period T901 refers to a time required for removal of the fixing solution L adhering to the outer peripheral surface of the nozzle 9N due to application of the prescribed voltage V90*a*. The first time period T901 is appropriately set by experiments and simulations.

When a print job is received, the controller 900 determines whether a third time period T903 or more has elapsed from the completion of the previous fixing spray process. When determining that the third time period T903 or more has elapsed, the controller 900 does not execute the droplet removal process. The third time period T903 refers to a sufficiently long time for naturally evaporating the fixing solution L adhering to the outer peripheral surface of the nozzle 9N. The third time period T903 is appropriately set by experiments and simulations.

The third time period T903 may be appropriately changed depending on temperature and humidity. For example, the third time period T903 may be set to a smaller value as temperature becomes higher and as humidity becomes lower.

The controller 900 has a function to execute a purge process for discharging outside the fixing solution L clogging in the tip of the nozzle 9N by pressure when moisture of the fixing solution L in the tip of the nozzle 9N is evaporated to increase the viscosity of the fixing solution L (for example, when the fixing operation is not performed for a certain period of time or over). In the purge process, the controller 900 pressurizes the fixing solution L in the fixing heads 971A to 971E by driving the pump 975A to discharge the fixing solution L from the tip of the nozzle 9N without applying a voltage to the fixing solution L.

It is likely that the fixing solution L adheres to the outer peripheral surface of the nozzle 9N through such a purge process. Thus, in the tenth embodiment, the controller 900 executes the droplet removal process also when the purge process is executed.

Figure 119:
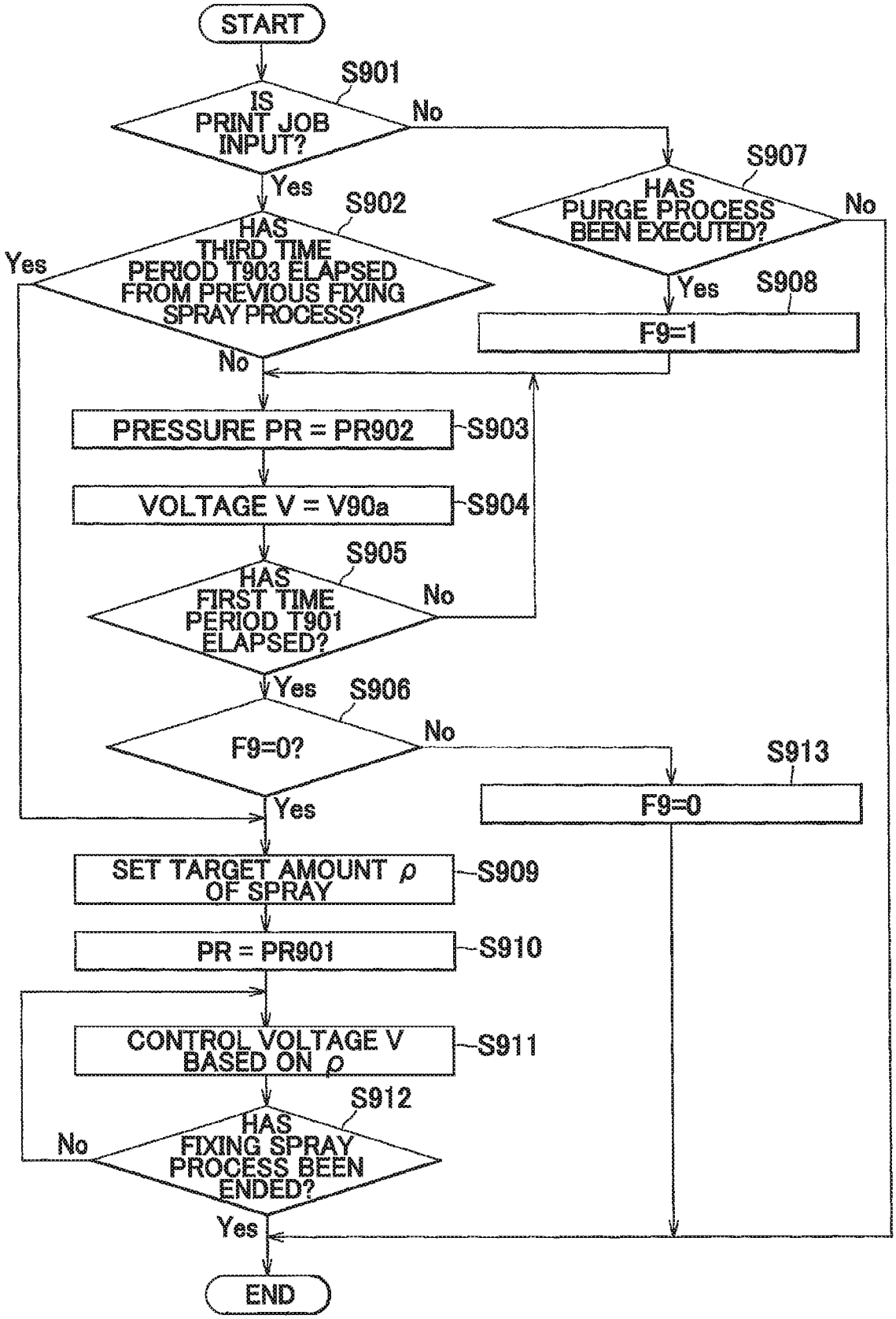

The following describes in detail the operation of the controller 900 with reference to FIG. 119. The controller 900 executes the process illustrated in FIG. 119 for each of the fixing heads 971A to 971E. Hereinafter, control for the first fixing head 971A will be described as a representative example.

As illustrated in FIG. 119, the controller 900 first determines whether a print job is input (S901). When determining in step S901 that a print job is input (Yes), the controller 900 determines whether the third time period T903 has elapsed from a previous fixing spray process (S902).

When determining in step S902 that the third time period T903 has not elapsed (No), the controller 900 sets the pressure PR applied to the fixing solution L to the second pressure PR902 which is a lower pressure (S903). Specifically, when the current pressure PR is equal to the second pressure PR902 in step S903, the controller 900 maintains the pressure PR at the second pressure PR902 without controlling the pressurization device 975. When the current pressure PR is lower than the second pressure PR902 in step S903, the controller 900 activates the pump 975A to increase the pressure PR to the second pressure PR902. When the current pressure PR is higher than the second pressure PR902 in step S903, the controller 900 opens the reducing valve 975B to reduce the pressure PR to the second pressure PR902 and then closes the reducing valve 975B.

After executing step S903, the controller 900 applies the prescribed voltage V90*a* to the fixing solution L (S904). As a result, the droplet removal process is started.

After executing step S904, the controller 900 determines whether the first time period T901 has elapsed from when the prescribed voltage V90*a* was applied to the fixing solution L to thereby determine whether the fixing solution adhering to the outer peripheral surface of the nozzles 9N has been removed (S905). When determining in step S905 that the first time period T901 has not elapsed (No), the controller 900 returns to step S903 and continues the droplet removal process. On the other hand, when determining in step S905 that the first time period T901 has elapsed (Yes), the controller 900 shifts to step S906.

When determining in step S901 that a print job is not input (No), the controller 900 determines whether the purge process has been executed (S907). When determining in step S907 that the purge process has not been executed (No), the controller 900 ends this process.

When determining in step S907 that the purge process has been executed (Yes), the controller 900 sets a flag F9 indicating the purge process having been executed to 1 (S908) and then executes the droplet removal process (S903, S904). In step S906, the controller 900 determines whether the flag F9 is 0 to thereby determine whether the droplet removal process has been started with input of a print job as a trigger.

When determining in step S906 that the flag F9 is 0 (Yes), that is, when a print job is input, the controller 900 shifts to the fixing spray process (S909 to S911). On the other hand, when determining that the flag F9 is 1 (No), when no print job is input, the controller 900 does not shift to the fixing spray process (S909 to S911), and sets the flag F9 back to 0 (S913) and ends this process.

When setting the flag F9 back to 0, the controller 900 stops voltage application so as to end the droplet removal process. The pressure PR after completion of the droplet removal process, i.e., the pressure PR at standby state may be maintained at the second pressure PR902 which was set at the droplet removal process or may be set to a pressure value different from the second pressure PR902.

When determining in step S902 that the third time period T903 has elapsed (Yes), that is, when the fixing solution L adhering to the outer peripheral surface of the nozzle 9N is evaporated due to the elapse of a sufficiently long time from the previous fixing spray process, the controller 900 does not perform the droplet removal process (S903, S904) and shifts to the fixing spray process (S909 to S911).

In step S909, the controller 900 sets the target amount ρ of spray based on an image corresponding to the first fixing head 971A. Here, the image is based on the print data. After executing step S909, the controller 900 changes the pressure PR applied to the fixing solution L in the first fixing head 971A from the second pressure PR902 to the first pressure PR901 (S910). Specifically, in step S910, the controller 900 activates the pump 975A to increase the pressure PR from the second pressure PR902 to the first pressure PR901.

After executing S910, the controller 900 sets the voltage V applied to the first electrode 974 based on the target amount ρ and applies the set voltage V to the first electrode 974 to execute the fixing spray process to spray the fixing solution L to an image on the paper P from the first fixing head 971A (S911). After executing step S911, the controller 900 determines whether the fixing spray process has been ended (S912).

When determining in step S912 that the fixing spray process is not ended (No), the controller 900 returns to step S911 and continues the fixing spray process. On the other hand, when determining in step S912 that the fixing spray process is ended (Yes), the controller 900 stops voltage application and ends this process. The pressure PR after completion of the fixing spray process may be reduced to the second pressure PR902 which is set at the droplet removal process or reduced to a pressure value different from the second pressure PR902.

Figure 120A:
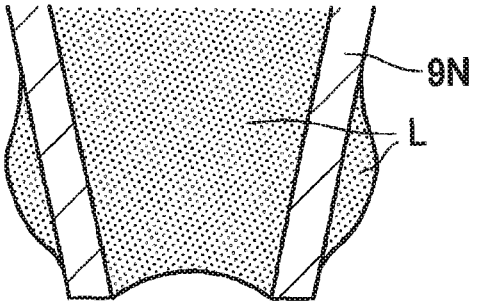
Figure 120B:
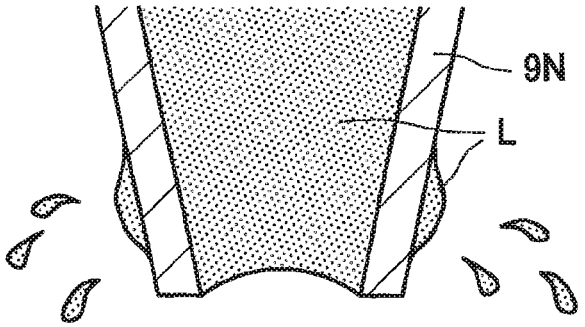
Figure 120C:
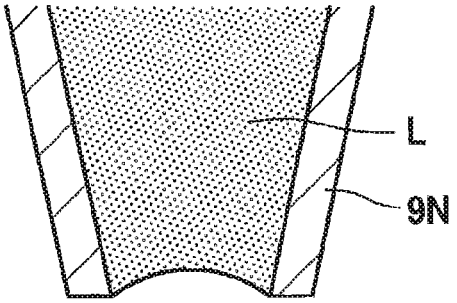

The following describes a state where the fixing solution L adhering to the outer peripheral surface of the nozzle 9N is removed with reference to FIGS. 120A to 120C.

As illustrated in FIG. 120A, the droplet-like fixing solution L may adhere to the outer peripheral surface of the tip of the nozzle 9N after completion of the fixing spray process or purge process. In this case, when the droplet removal process is executed, an electric field is generated around the fixing solution L adhering to the outer peripheral surface of the tip of the nozzle 9N by voltage application to the first electrode 974. The fixing solution L is scattered as illustrated in FIG. 120B due to the generated electric field. As a result, as illustrated in FIG. 120C, the fixing solution L adhering to the outer peripheral surface of the tip of the nozzle 9N can be removed satisfactorily.

In the droplet removal process, the pressure PR applied to the fixing solution L is set to the second pressure PR902 lower than the first pressure PR901 which is set at the fixing spray process. Accordingly, the amount of the fixing solution L to be fed to the tip of the nozzle 9N is reduced. As a result, during the droplet removal process, the fixing solution L can be prevented from being pushed outside from the opening of the nozzle 9N and going around the outer peripheral surface thereof. The fixing solution L can be removed satisfactorily from the outer peripheral surface of the nozzle 9N while preventing the amount of the fixing solution L on the outer peripheral surface of the nozzle 9N from being increased.

According to the tenth embodiment, the following effects can be obtained.

Even when the fixing solution L adheres to the outer peripheral surface of the nozzle 9N, the fixing solution L adhering to the outer peripheral surface of the nozzle 9N can be removed by execution of the droplet removal process. As a result, a stable spray state can be quickly achieved before the start of the fixing spray process.

When the third time period T903 or more has elapsed from the completion of the previous fixing spray process, the droplet removal process is not executed. Accordingly, power consumption can be reduced.

The droplet removal process is executed after the purge process, so that the solution L adhering to the outer peripheral surface of the nozzle 9N in the purge process can be removed satisfactorily.

The present invention can be used in various embodiments as described below as examples without limited to the tenth embodiment. In the following description, any member having substantially the same structure as that of the tenth embodiment will be given the same reference numeral, and the description thereof will be omitted.

Figure 121:
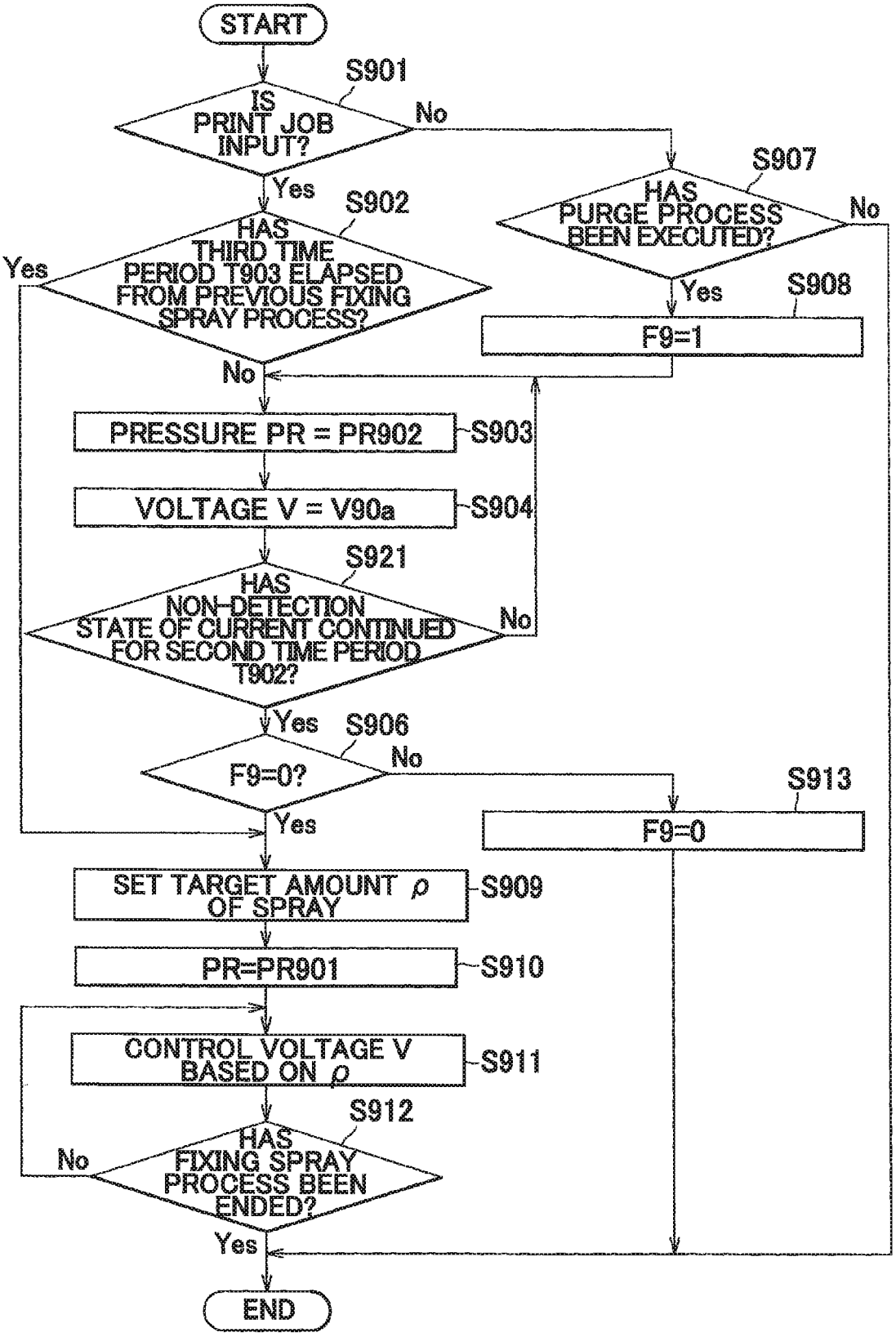

In the above 10th embodiment, determination of whether the fixing solution L adhering to the outer peripheral surface of the nozzle 9N has been removed is made by determining whether the first time period T901 has elapsed. However, the present invention is not limited to this, and the removal of the fixing solution L may be determined by determining whether a state where no current flows in the first electrode 974 has continued for a second time period T902 or more. Specifically, as illustrated in FIG. 121, step S921 may be provided in place of step S905 in the flowchart of FIG. 119.

In step S921, the controller 900 determines whether a state where a detection value is not output from the second current sensor 9SA has continued for the second time period T902 or more. Specifically, the controller 900 starts counting using a counter when the voltage V is set to the prescribed voltage V90*a* in step S904. When acquiring a detection value from the second current sensor 9SA before the count number of the counter reaches a value corresponding to the second time period T902, the controller 900 resets the counter to 0 and thereafter starts counting again. Then, when the count number of the counter becomes equal to or larger than a value corresponding to the second time period T902, the controller 900 determines Yes in step S921.

Thus, by determining whether a state where no current flows in the first electrode 974 has continued for the second time period T902 or more, determination of whether scattering of the fixing solution L on the outer peripheral surface of the nozzle 9N has been ended can be made with accuracy. The second time period T902 may appropriately be set by experiments and simulations.

In the above tenth embodiment, the timing at which the droplet removal process is executed is set between when a print job is input and when the fixing spray process is started and also set after the purge process is completed. However, the present invention is not limited to this, and the droplet removal process may be executed at any timing as long as the timing is within a period in which the fixing spray process is not executed. For example, the droplet removal process may be executed after completion of the fixing spray process.

In the above tenth embodiment, the voltage V is maintained at the prescribed voltage V90*a* in the droplet removal process. However, the present invention is not limited to this, and the voltage value may be varied in the droplet removal process.

In the tenth embodiment, the first electrode 974 is disposed in the interior of the container portion 973. However, the present invention is not limited to this. For example, the nozzles and the container portions may be made of a conductive member such as a metal, and the nozzles or the container portion may be applied with a voltage. In this case, each nozzle or each container portion, which is applied with a voltage, functions as the first electrode. In this case, the plurality of conductive container portions may be provided so as to be separated from each other in order to block movement of electric charges between the container portions. Alternatively, insulating members may be provided between the plurality of conductive container portions in order to block movement of electric charges between the container portions. In another case, the container portion may be made of a non-conductive member such as a resin, the nozzles may be made of a conductive member such as a metal, and the nozzles may be applied with a voltage. In this case, each nozzle functions as the first electrode.

In the above tenth embodiment, the present invention is applied to the laser printer 901. However, the present invention is not limited to this, and may be applied to other types of image forming devices, such as a copying machine or a multifunction peripheral.

In the above tenth embodiment, the paper P such as a thick paper, a post card, or a thin paper is exemplified as a recording sheet. However, the present invention is not limited to this, and the recording sheet may be, e.g., an OHP sheet.

In the above tenth embodiment, the pressurization device 975 having the pump 975A and the reducing valve 975B is exemplified as a pressure applying means for applying a pressure to the fixing solution in the container portion. However, the present invention is not limited to this, and, for example, the pressure applying means may be a device that pressurizes and depressurizes the liquid in each head utilizing the water head difference.

In the above tenth embodiment, it is assumed that the fixing regions A901 to A905 are the same in shape, size, and position as those of the lower surfaces of the respective container portions 973 for descriptive convenience. However, the present invention is not limited to this, and each fixing region may be smaller or larger in size than the lower surface of the container portion. That is, each fixing region may be defined on the basis of the front-rear width and the left-right width of the fixing solution to be sprayed onto the paper.

The tenth object can be achieved by the tenth embodiment and any modification thereof described with reference to FIGS. 115 to 121. The above-described tenth embodiment is one example of the ninth invention, and the ninth invention is not limited to this.

Any configurations and processes in the above first to tenth embodiments and their modifications may be combined.

The present specification contains the followings aspects. According to an aspect 1, a fixing device for fixing a developing agent image to a recording sheet by electrostatically spraying a charged fixing solution toward the developing agent image on the sheet. The fixing device includes a container portion, a plurality of nozzles, and a potential difference generating portion. The container portion is configured to store therein the fixing solution. The plurality of nozzles is in communication with the container portion and configured to spray the fixing solution toward the developing agent image. The potential difference generating portion is configured to generate a potential difference between the fixing solution stored in the plurality of nozzles and the recording sheet conveyed at a position separated from the plurality of nozzles.

According to an aspect 2 depending from the aspect 1, the plurality of nozzles is arrayed in a perpendicular direction perpendicular to a conveyance direction of the recording sheet.

According to an aspect 3 depending from the aspect 2, the plurality of nozzles is arrayed in the conveyance direction of the recording sheet.

According to an aspect 4 depending from the aspect 3, neighboring nozzles in the plurality of nozzles are separated from each other by a first interval not more than an interval where a fixing solution sprayed from one of the neighboring nozzles and a fixing solution sprayed from remaining one of the neighboring nozzles are electrically repel each other.

According to an aspect 5 depending from the aspect 4, natural numbers St of the plurality of nozzles is set satisfying the following inequality:

$$St \geq \alpha/[(1-1/\exp(x/B))\times A],$$

where;

A [g/s]: an amount of spray from a nozzle assuming that the nozzle is a single nozzle;

y15 [g/s]: an actual measured value of an amount of spray per nozzle where a nozzle pitch between two nozzles is 15 mm;

α [g/s]: a minimum amount of spray required for fixing a developing agent image on the recording sheet;

x [mm]: a nozzle pitch between two nozzles separated from each other by the first interval;

B: a value satisfying an equation of $y15=(1-1)/\exp(15/B))\times A$.

According to an aspect 6 depending from the aspect 4, the first interval is not less than 1 mm.

According to an aspect 7 depending from the aspect 4, the plurality of nozzles includes a plurality of first nozzles arrayed in the perpendicular direction at regular second intervals, and a plurality of second nozzles arrayed in the perpendicular direction at regular third intervals. The plurality of first nozzles and the plurality of second nozzles are alternately arrayed in the perpendicular direction with the plurality of first nozzles disposed in one side with respect to the conveyance direction and the plurality of second nozzles disposed in the other side with respect to the conveyance direction so that the plurality of nozzles has a plurality of staggered nozzle array groups.

According to an aspect 8 depending from the aspect 7, lines connecting two first nozzles and one second nozzle form an isosceles triangle. The two first nozzles are arrayed adjacent to each other in the perpendicular direction and the one second nozzle is positioned between the two adjacent first nozzles in the perpendicular direction.

According to an aspect 9 depending from the aspect 8, the plurality of staggered nozzle array groups are at positions identical to each other in the perpendicular direction. The second interval and the third interval are identical with each other. An angle of an imaginary line relative to the conveyance direction is in a range from 30 to 60 degrees, the imaginary line connecting one of the plurality of first nozzles and one of the plurality of second nozzles neighboring to the one first nozzle.

According to an aspect 10 depending from the aspect 9, lines connecting two first nozzles and one first nozzle form an equilateral triangle. The two first nozzles are arrayed adjacent to each other in the perpendicular direction. The one second nozzle is positioned between the two adjacent nozzles in the perpendicular direction.

According to an aspect 11 depending from the aspect 7, the plurality of staggered nozzle array groups includes a predetermined first staggered nozzle array group and a second staggered nozzle array group positioned downstream of the first staggered nozzle array group in the conveyance direction. The second staggered nozzle array group is shifted from the first staggered nozzle array group in the perpendicular direction by a distance smaller than a half of the second interval.

According to an aspect 12 depending from the aspect 4, the plurality of nozzles includes a first nozzle line and a second nozzle line. The first nozzle line includes a plurality of first nozzles arrayed in the perpendicular direction at regular fourth intervals. The second nozzle line is positioned downstream of the first nozzle line in the conveyance direction and includes a plurality of second nozzles arrayed in the perpendicular direction at regular fifth intervals. The second nozzle line is shifted from the first nozzle line in the perpendicular direction by a distance smaller than a half of the fourth interval.

According to an aspect 13 depending from the aspect 7, an amount of spray ρ [g/s] per one staggered nozzle array group is set to satisfy the following inequality:

$$\rho \leq \beta-\alpha,$$

where;

α [g/s]: a minimum required amount of spray for fixing a developing agent image on the recording sheet;

β [g/s]: a maximum amount of spray capable of drying the developing agent image before the developing agent image on the recording sheet is brought into contact with a component positioned downstream of the plurality of staggered nozzle array groups.

Numbers k of the plurality of staggered nozzle array groups is set to satisfy the following inequality:

$k \geq n+1$, where n is a minimum natural number satisfying $n \geq \alpha/\rho$.

According to an aspect 14 depending from the aspect 13, number k of the plurality of staggered nozzle array groups is set to satisfy $k \geq m$ where m is a maximum natural number satisfying $m \geq \beta/\rho$.

According to an aspect 15 depending from the aspect 13, amount ρ of spray per one staggered nozzle array group is smaller than a maximum amount ρmax of spray corresponding to maximum capacity of the one staggered nozzle array group.

According to an aspect 16 depending from the aspect 1, the potential difference generating portion comprises a first electrode configured to apply voltage to the fixing solution in the nozzle, and a second electrode configured to generate potential difference between the fixing solution in the nozzle and the recording sheet.

According to an aspect 17 depending from the aspect 16, the fixing device further includes a conveyance member and a voltage applying portion. The conveyance member is positioned between the first electrode and the second electrode and having a plurality of conveyance surfaces separated from each other. The voltage applying portion is configured to form a first potential difference between the first electrode and the conveyance surfaces, and to form a second potential difference between the first electrode and the second electrode. The second potential difference is greater than the first potential difference.

According to an aspect 18 depending from the aspect 17, the conveyance surface is shifted from the nozzles as viewed in a direction perpendicular to the conveyance surfaces.

According to an aspect 19 depending from the aspect 18, the conveyance member is formed with a plurality of opening portions penetrating in a direction from the conveyance surfaces to the second electrode, the opening portions being at positions corresponding to the nozzles.

According to an aspect 20 depending from the aspect 19, the opening portion is greater than an outer periphery of the nozzle.

According to an aspect 21 depending from the aspect 17, a pitch of the nozzles is set in a range from 2 mm to 15 mm.

According to an aspect 22 depending from claim 17, the plurality of nozzles includes a plurality of first nozzles arrayed in a widthwise direction of the recording sheet at regular intervals, and a plurality of second nozzles arrayed in the widthwise direction at regular intervals. The plurality of first nozzles and the plurality of second nozzles are alternately arrayed in the widthwise direction with the plurality of first nozzles disposed in one side with respect to the conveyance direction and the plurality of second nozzles disposed in the other side with respect to the conveyance direction so that the plurality of nozzles has a plurality of staggered nozzle array groups conveyance direction.

According to an aspect 23 depending from the aspect 22, the conveyance surface is slanted with respect to the conveyance direction so that the conveyance surface pass through a space between neighboring first nozzles and a space between neighboring second nozzles when viewed in a direction perpendicular to the conveyance surfaces.

According to an aspect 24 depending from the aspect 17, the fixing device further includes a storage portion configured to accumulate the fixing solution sprayed from the nozzles. The second electrode is configured to guide the fixing solution toward the storage portion.

According to an aspect 25 depending from the aspect 24, the second electrode is formed with a guide groove configured to guide the fixing solution toward the storage portion.

According to an aspect 26 depending from the aspect 17, the conveyance member contains electrically conductive resin.

According to an aspect 27 depending from the aspect 17, the conveyance member contains metal.

According to an aspect 28 depending from the aspect 17, the conveyance surfaces have a most upstream end in the conveyance direction of the recording sheet, the most upstream end being positioned upstream of a most upstream nozzle in the conveyance direction among the nozzles.

According to an aspect 29 depending from the aspect 17, the conveyance surfaces have a most downstream end in the conveyance direction of the recording sheet, the most downstream end being positioned downstream of a most downstream nozzle in the conveyance direction among the nozzles.

According to an aspect 30 depending from the aspect 17, the fixing device further includes a pressurization device configured to pressurize the fixing solution.

According to an aspect 31 depending from the aspect 17, the fixing device further includes a controller configured to control the voltage applying portion. The controller is configured to: control the voltage applying portion to start application of voltage before a first recording sheet reaches the conveyance surfaces and after printing control is started; and as a result of determination that the first recording sheet reaches the conveyance surfaces, control the voltage applying portion to reduce the voltage applied to the conveyance surface at a level lower than the voltage applied prior to the determination.

According to an aspect 32 depending from the aspect 17, the conveyance member incudes a frame and a connecting portion. The frame has a rectangular shape and includes a first portion and a second portion. The first portion extends in a longitudinal direction of the container portion. The second portion is positioned separated from the first portion in the conveyance direction of the recording sheet and extending in the longitudinal direction. The connecting portion extends in the conveyance direction and connecting the first portion to the second portion. The conveyance surfaces are surfaces of the connecting portion which face the container portion.

According to an aspect 33 depending from the aspect 32, the connecting portion is a rib.

According to an aspect 34 depending from the aspect 17, the first electrode is positioned in an interior of the container portion.

According to an aspect 35 depending from the aspect 16, the fixing device further includes a rib configured to protect the plurality of nozzles against the recording sheet. The plurality of nozzles and the rib extend toward the second electrode. A distance between the second electrode and the plurality of nozzles is greater than a distance between the second electrode and the rib.

According to an aspect 36 depending from the aspect 35, the rib extends from the container portion toward the second electrode.

According to an aspect 37 depending from the aspect 35 or 36, the rib is disposed between two nozzles.

According to an aspect 38 depending from any one of the aspects 35 to 37, the plurality of nozzles comprises a plurality of lateral nozzle arrays, each of the plurality of lateral nozzle arrays including a plurality of nozzles arrayed in a perpendicular direction perpendicular to a conveyance direction of the recording sheet. The rib includes a first portion disposed upstream of a most upstream lateral nozzle array among the plurality of lateral nozzle arrays in the conveyance direction.

According to an aspect 39 depending from the aspect 38, the rib further includes a second portion disposed downstream of a most downstream lateral nozzle array among the plurality of lateral nozzle arrays in the conveyance direction.

According to an aspect 40 depending from the aspect 39, the rib further includes a third portion extending continuously from the first portion to the second portion and connected to the first portion and the second portion.

According to an aspect 41 depending from the aspect 40, the rib is inclined with respect to the conveyance direction.

According to an aspect 42 depending from the aspect 41, the rib includes a plurality of ribs spaced away from each other in the perpendicular direction. The plurality of ribs includes two ribs neighboring to each other in the perpendicular direction, the two ribs includes one rib and another rib, the first portion of the one rib and the second portion of the another rib being overlapped with each other as viewed in the conveyance direction.

According to an aspect 43 depending from the aspect 41, the rib includes: a plurality of first ribs, each first rib including the first portion and the second portion, the second portion of the each first rib being disposed in one side of the first portion of the each first rib with respect to the perpendicular direction; and a plurality of second ribs, each second rib including the first portion and the second portion, the second portion of the each second rib being disposed in another side of the first portion of the each second rib with respect to the perpendicular direction. The plurality of first ribs and the plurality of second ribs are alternately arrayed in the perpendicular direction.

According to an aspect 44 depending from the aspect 43, the plurality of first ribs includes one first rib, and the plurality of second ribs includes one second rib neighboring to the another side of the one first rib and another second rib neighboring to the one side of the one first rib. The first portion of the one first rib is connected to the first portion of one second rib of the plurality of second ribs, and the second portion of the one first rib is connected to the second portion of the another second rib.

According to an aspect 45 depending from the aspect 41, the rib includes: a plurality of first ribs, each first rib including the first portion and the second portion, the second portion of the each first rib being disposed in one side of the first portion of the each first rib with respect to the perpendicular direction; and a plurality of second ribs, each second rib including the first portion and the second portion, the second portion of the each second rib being disposed in another side of the first portion of the each second rib with respect to the perpendicular direction. The plurality of first ribs is disposed in the one side of a center in the perpendicular direction of each of the plurality of lateral nozzle arrays. The plurality of second ribs is disposed in the another side of the center in the perpendicular direction of the each of the plurality of lateral nozzle arrays.

According to an aspect 46 depending from the aspect 45, the plurality of first ribs includes a most adjacent first rib most adjacent to the center in the perpendicular direction of the each of the plurality of lateral nozzle arrays, and the plurality of second ribs includes a most adjacent second rib most adjacent to the center in the perpendicular direction of the each of the plurality of lateral nozzle arrays. The first portion of the most adjacent first rib and the first portion of the most adjacent second rib are connected together.

According to an aspect 47 depending from the aspect 41, the rib includes: a plurality of first ribs, each first rib including the first portion and the second portion, the second portion of the each first rib being disposed in one side of the first portion of the each first rib with respect to the perpendicular direction; and a plurality of second ribs, each second rib including the first portion and the second portion, the second portion of the each second rib being disposed in another side of the first portion of the each second rib with respect to the perpendicular direction. The plurality of first ribs is disposed in the another side of a center in the perpendicular direction of each of the plurality of lateral nozzle arrays. The plurality of second ribs is disposed in the one side of the center in the perpendicular direction of the each of the plurality of lateral nozzle arrays.

According to an aspect 48 depending from the aspect 47, the plurality of first ribs includes a most adjacent first rib most adjacent to the center in the perpendicular direction of the each of the plurality of lateral nozzle arrays, and the plurality of second ribs includes a most adjacent second rib most adjacent to the center in the perpendicular direction of the each of the plurality of lateral nozzle arrays. The second portion of the most adjacent first rib and the second portion of the most adjacent second rib are connected together.

According to an aspect 49 depending from the aspect 35 or 36, the plurality of nozzles includes two first nozzles neighboring to each other in a perpendicular direction perpendicular to a conveyance direction of the recording sheet. The rib is positioned at a position shifted from the two first nozzles in the conveyance direction. The rib has a first end portion positioned close to the two first nozzles. The first end portion is positioned at a position between each center of each of the two first nozzles in the perpendicular direction.

According to an aspect 50 depending from the aspect 49, the plurality of nozzles includes two second nozzles neighboring to each other in the perpendicular direction. The rib is positioned at a position between the two first nozzles and the two second nozzles in the conveyance direction. The rib has a second end portion positioned close to the two second nozzles. The second end portion is positioned at a position between each center of each of the two second nozzles in the perpendicular direction.

According to an aspect 51 depending from the aspect 49 or 50, a minimum distance between the first end portion and each of the two first nozzles is equal to a minimum distance between the two first nozzles.

According to an aspect 52 depending from any one of the aspects 35 to 51, the plurality of nozzles is configured to provide a substantially same amount of spray per unit area at each position on the recording sheet in a perpendicular direction perpendicular to the conveyance direction of the recording sheet.

According to an aspect 53 depending from the aspect 52, the plurality of nozzles includes a plurality of nozzle arrays arrayed with each other in the perpendicular direction, each of the plurality of nozzle arrays including nozzles arrayed in the conveyance direction. The plurality of nozzle arrays has numbers of the nozzles equal to each other.

According to an aspect 54 depending from any one of the aspects 35 to 53, in the plurality of nozzles, two neighboring nozzles provide a nozzle pitch not less than 2 mm and less than 10 mm.

According to an aspect 55 depending from any one of the aspects 35 to 54, the container portion, the plurality of nozzles, and the rib are integrally formed with a resin.

According to an aspect 56 depending from the aspect 1, the fixing device further includes a controller configured to perform controlling a voltage applied to the potential difference generating portion.

According to an aspect 57 depending from the aspect 56, the controller is configured to further perform a first process of estimating, on the basis of a value of a current flowing through the potential difference generating portion by application of the voltage to the potential difference generating portion, a spraying amount of the fixing solution sprayed from the plurality of nozzles per unit time.

According to an aspect 58 depending from the aspect 57, the controller is configured to further perform a second process of determining whether the spraying of the fixing solution from the plurality of nozzles has become stable, and the first process is performed when the controller determines that the spraying has become stable.

According to an aspect 59 depending from the aspect 58, the controller is configured to further perform estimating a spraying amount of the fixing solution during a time period from a start of the spraying to a time when the spraying becomes stable to be zero.

According to an aspect 60 depending from the aspect 58, the controller is configured to further perform estimating, in a different way from that in the first process, a spraying amount of the fixing solution during a time period from a start of the spraying to a time when the spraying becomes stable.

According to an aspect 61 depending from any one of the aspects 58 to 60, the controlling controls the voltage so that the current flowing through the potential difference generating portion can have a target current value.

According to an aspect 62 depending from the aspect 61, the determining whether the spraying of the fixing solution has become stable is performed by determining whether a difference between the value of the current flowing through the potential difference generating portion and the target current value has become equal to or smaller than a prescribed value.

According to an aspect 63 depending from any one of the aspects 57 to 62, the controller is configured to further perform estimating a ratio of charge to mass on the basis of a temperature or humidity, and the estimating in the first process sets the spraying amount of the fixing solution from the plurality of nozzles per unit time to a value obtained by dividing a measured value of the current by the ratio of charge to mass.

According to an aspect 64 depending from any one of the aspects 57 to 62, the controller is configured to further perform estimating a ratio of charge to mass on the basis of a temperature or humidity, and the estimating in the first process sets the spraying amount of the fixing solution from the plurality of nozzles per unit time to a value obtained by dividing an average value of a present value and a previous value of measured values of the current by the ratio of charge to mass.

According to an aspect 65 depending from any one of the aspects 57 to 64, the controller is configured to further perform calculating a residual amount of the fixing solution by subtracting the spraying amount from a previous value of the residual amount.

According to an aspect 66 depending from the aspect 61, the controller is configured to further perform: a third process of setting, on the basis of image data, a target spraying amount which is a target value of the spraying amount of the fixing solution from the plurality of nozzles per unit time; and setting, on the basis of the target spraying amount set in the third process, the target current value.

According to an aspect 67 depending from the aspect 66, the setting in the third process sets the target spraying amount in accordance with a type of the recording sheet.

According to an aspect 68 depending from the aspect 56, the controller is configured to further perform: a setting process of setting, on the basis of image data, a target spraying amount which is a target value of a spraying amount of the fixing solution sprayed from the plurality of nozzles per unit time; a determination process of determining whether the spraying of the fixing solution from the plurality of nozzles has become stable; when the controller determines that the spraying has become stable, an estimation process of estimating, from the target spraying amount, the spraying amount of the fixing solution sprayed from the plurality of nozzles per unit time; and a calculation process of calculating a residual amount of the fixing solution by subtracting the spraying amount from a previous value of the residual amount.

According to an aspect 69 depending from the aspect 68, the determining whether the spraying has become stable is performed by determining whether an elapsed time period from a start of application of the voltage to the potential difference generating portion has reached a prescribed time period.

According to an aspect 70 depending from the aspect 68 or 69, the controller is configured to further perform setting a spraying amount of the fixing solution during a time period from a start of the spraying to a time when the spraying becomes stable to a value smaller than the target spraying amount.

According to an aspect 71 depending from the aspect 56, the controller is configured to apply voltage to the potential difference generating portion such that the fixing solution is sprayed from the nozzle before a leading end of the recording sheet reaches a fixing region.

According to an aspect 72 depending from the aspect 71, the controller is configured to apply voltage to the potential difference generating portion such that the fixing solution is sprayed from the nozzle after a leading end of the recording sheet is moved past a portion between a photosensitive member and a transfer member.

According to an aspect 73 depending from the aspect 71, the controller is configured to: set the voltage to a first voltage with which the fixing solution is not sprayed from the nozzles in a standby state; and set the voltage to a second voltage higher than the first voltage at a prescribed timing before the leading end of the recording sheet reaches the fixing region in print control.

According to an aspect 74 depending from the aspect 73, the controller is configured to set the voltage to a third voltage before the developing agent image on the recording sheet reaches the fixing region, the third voltage enabling to fix the developing agent and being higher than the second voltage.

According to an aspect 75 depending from the aspect 74, the controller is configured to set a fourth voltage lower than the third voltage and higher than the first voltage in a case where a plurality of developing agent images on a prescribed recording sheet is positioned separated from each other in a conveyance direction of the recording sheet and where a time period from a time when a preceding developing agent image on the prescribed recording sheet moves past the fixing region to a time when a subsequent developing agent image on the prescribed recording sheet reaches the fixing region is not less than a first threshold value.

According to an aspect 76 depending from the aspect 75, the fourth voltage is equal to the second voltage.

According to an aspect 77 depending from the aspect 75 the controller is configured to maintain the third voltage in a case where the time period from the time when the precedent developing agent image on the prescribed recording sheet moves past the fixing region to the time when the subsequent developing agent image on the prescribed recording sheet reaches the fixing region is less than the first threshold value.

According to an aspect 78 depending from the aspect 73, the controller is configured to set the voltage to the first voltage after a most upstream developing agent image on the recording sheet in the conveyance direction moves past the fixing region.

According to an aspect 79 depending from the aspect 78, the controller is configured to set the voltage to a value higher than the first voltage after the most upstream developing agent image moves past the fixing region in a case where a time period from a time when the most upstream developing agent image moves past the fixing region to a time when a leading end of a subsequent recording sheet reaches the fixing region is not more than a second threshold value.

According to an aspect 80 depending from the aspect 73, the controller is configured to: calculate a relational expression between electrical current flowing in the potential difference generating portion in the standby state and a voltage applied to the potential difference generating portion in the standby state; and determine the second voltage on a basis of the relational expression.

According to an aspect 81 depending from the aspect 71, the fixing device further includes a pressurizing unit configured to apply pressure to the fixing solution. The controller is configured to maintain the pressure applied to the fixing solution at a constant level during print control.

According to an aspect 82 depending from the aspect 71, the fixing device further includes a fixing head provided with the plurality of nozzles. The fixing head includes a plurality of fixing heads arrayed in a widthwise direction of the recording sheet. The controller is configured to individually control voltages to be applied to the plurality of fixing head.

According to an aspect 83 depending from the aspect 82, the fixing region is set for each of the plurality of fixing heads.

According to an aspect 84 depending from the aspect 83, in a case where it is determined that there is no developing agent image in a prescribed region on a prescribed recording sheet, the controller is configured to maintain the voltage to be applied to the fixing solution in the prescribed fixing head corresponding to the prescribed region to the first voltage while the prescribed recording sheet is passing through the prescribed fixing region.

According to an aspect 85 depending from the aspect 82, the plurality of fixing heads includes: a first fixing head configured to spray the fixing solution to a first recording sheet; a second fixing head positioned adjacent to one side of the first fixing head in the widthwise direction; and a third fixing head positioned adjacent to one side of the second fixing head in the widthwise direction. The combination of the first fixing head and the second fixing head are capable of spraying the fixing solution to a second recording sheet whose width is greater than the width of the first recording sheet. The combination the first fixing head, the second fixing head, and the third fixing head are capable of spraying the fixing solution to a third recording sheet whose width is greater than the width of the second recording sheet.

According to an aspect 86 depending from the aspect 85, the first fixing head has a width smaller than that of the first recording sheet. The second recording sheet has one end and another end in the widthwise direction, the second fixing head being positioned shifted from the one end of the second recording sheet toward the another side of the second recording sheet. The third recording sheet has one end and another end in the widthwise direction, the third fixing head being positioned shifted from the one end of the third recording sheet toward the another end of the third recording sheet.

According to an aspect 87 depending from the aspect 73, the second voltage enables to fix the developing agent image.

According to an aspect 88 depending from the aspect 71, the potential difference generating portion includes: a first electrode in contact with the fixing solution and configured to apply voltage to the fixing solution; and a second electrode facing the nozzle.

According to an aspect 89 depending from the aspect 56, the fixing device further includes a storage. The controller is configured to perform a state grasping control in which the controller stores one of a first voltage and a first electrical current value in the storage. The first voltage is a voltage applied to the potential difference generating portion when a current flowing in the potential difference generating portion has a prescribed first electrical current value. The first electrical current value is a value of a current flowing in the potential difference generating portion when a voltage applied to the potential difference generating portion becomes a prescribed first voltage. The controller is configured further to perform a spray control to spray the fixing solution to a developing agent image on a basis of one of the stored first voltage and the stored first electrical current value.

According to an aspect 90 depending from the aspect 89, the controller is configured to store the first voltage in the storage when the electrical current flowing in the potential difference generating portion has the prescribed first electrical current value in the state grasping control. The controller is configured to perform the spray control on a basis of the first voltage stored in the storage.

According to an aspect 91 depending from the aspect 90, the first electrical current value is in a range of a current to be used in the spray control.

According to an aspect 92 depending from the aspect 90, in the state grasping control, the controller is configured to: control the voltage such that the electrical current flowing in the potential difference generating portion has a second electrical current value different from the first electrical current value, and store a second voltage when the electrical current has the second electrical current value; obtain a first function indicating a relationship between the voltage and the electrical current on a basis of the first voltage and the second voltage; and specify a voltage to be applied to the potential difference generating portion in the spray control on a basis of the first function and a target electrical current value.

According to an aspect 93 depending from the aspect 92, the first function is a linear function.

According to an aspect 94 depending from the aspect 92, the controller is configured to set a third voltage to be applied to the potential difference generating portion in a standby state or a preparation state, the third voltage being not less than a value of the voltage obtained from the first function with the current value thereof set to zero, the third voltage being larger than or equal to zero.

According to an aspect 95 depending from the aspect 92, the fixing device further includes a pressure applying portion configured to apply pressure to the fixing solution. The controller is configured to: obtain a first voltage when pressure applied to the fixing solution is at a first pressure; obtain a first voltage when pressure is applied to the fixing solution is at a second pressure different from the first pressure; calculate a third function indicative of a relationship between pressure and voltage on a basis of the first pressure, the first voltage obtained when the pressure is at the first pressure, the second pressure, and the first voltage obtained when the pressure is at the second pressure; and determine a pressure at the standby state or at the preparation state on a basis of the third function.

According to an aspect 96 depending from the aspect 95, the controller is configured to: calculate the first function on a basis of the first voltage and the second voltage which are obtained when the pressure applied to the fixing solution is at the first pressure; calculate the second function indicative of the relationship between voltage and electrical current on a basis of the first voltage and the second voltage which are obtained when the pressure applied to the fixing solution is at the second pressure different from the first pressure; and obtain the third function on a basis of the first pressure, a fourth voltage, the second pressure, and a fifth voltage, wherein the fourth voltage is a voltage obtained from the first function with the electric current thereof set to zero, and wherein the fifth voltage is a voltage obtained from the second function with the electric current thereof set to zero.

According to an aspect 97 depending from the aspect 96, the controller is configured to determine a fourth function to determine the voltage at the spray control on a basis of: one of the first function and the second function; and the third function. The fourth function is such that a sixth voltage is a voltage when the electrical current is zero, and, the sixth voltage is greater than or equal to a target voltage, the target voltage being larger than or equal to zero.

According to an aspect 98 depending from the aspect 97, the sixth voltage is set greater than the target voltage. The controller is configured to apply a seventh voltage to the potential difference generating portion in the standby state or the preparation state, the seventh voltage corresponding to a difference between the sixth voltage and the target voltage.

According to an aspect 99 depending from the aspect 89, the fixing device further includes a fixing head provided with the plurality of nozzles. The fixing head includes a plurality of fixing heads. The controller is configured to perform the state grasping control and the spray control for each of the plurality of fixing heads individually.

According to an aspect 100 depending from the aspect 99, the plurality of fixing heads are arrayed with each other in the widthwise direction of the recording sheet.

According to an aspect 101 depending from the aspect 99, the plurality of fixing heads are arrayed with each other in the conveyance direction of the recording sheet.

According to an aspect 102 depending from the aspect 89, the controller is configured to perform the state grasping control after elapse of a predetermined time period from a previously executed state grasping control.

According to an aspect 103 depending from the aspect 89, the controller is configured to perform the state grasping control in a case where a prescribed temperature difference from a temperature obtained in a previously executed state grasping control.

According to an aspect 104 depending from the aspect 89, the fixing device further includes a fixing solution cartridge accommodating therein the fixing solution to be supplied to the nozzle. The controller is configured to perform the state grasping control in a case where the fixing solution cartridge is replaced by a new fixing solution cartridge.

According to an aspect 105 depending from the aspect 92, in a case where a specified voltage determined on a basis of the first function and the target electrical current value is not less than an upper limit, the controller is configured to prohibit the spray control.

According to an aspect 106 depending from the aspect 92, in a case where a specified voltage determined on a basis of the first function and the target electrical current value is not less than the upper limit, the controller is configured to set the specified voltage to a value less than an upper limit and to decrease a conveyance speed of the recording sheet.

According to an aspect 107 depending from the aspect 89, the potential difference generating portion includes: a first electrode in contact with the fixing solution and applied with a voltage; and a second electrode positioned away from the nozzle.

According to an aspect 108 depending from the aspect 94, the standby state is one of a state where a prescribed standby period elapses from a start-up timing of an image forming apparatus or a termination timing of the printing control, and a state by the time a print job is received during the standby period.

According to an aspect 109 depending from the aspect 94, the preparation state is a state after the printing control starts and before the spray control starts.

According to an aspect 110 depending from the aspect 56, the container portion comprises a plurality of container portions. The controller is configured to control voltage to be applied to each fixing solution stored in a corresponding one of the container portions according to a type of the recording sheet or image data.

According to an aspect 111 depending from the aspect 110, the plurality of the container portions is arrayed with each other in the widthwise direction of the recording sheet.

According to an aspect 112 depending from the aspect 111, the fixing device further includes a container, and a partitioning wall partitioning an interior of the container into a plurality of rooms. Each container portion is constructed by a part of the container and the partitioning wall.

According to an aspect 113 depending from the aspect 112, the partitioning wall is integrally formed with the container.

According to an aspect 114 depending from the aspect 112, the container is provided with a rib for protecting a tip end of the nozzles. The rib is positioned at a projected position of the partitioning wall when the partitioning wall is projected in a longitudinal direction of the nozzle.

According to an aspect 115 depending from the aspect 114, the rib is integrally formed with the container.

According to an aspect 116 depending from the aspect 111, the plurality of container portions is separately provided from each other.

According to an aspect 117 depending from the aspect 111, the plurality of container portions comprises: a first container portion positioned in correspondence with a width of a first recording sheet; a second container portion positioned in correspondence with a width of a second recording sheet, the width of the second recording sheet being greater than that of the first recording sheet; and a third container portion positioned in correspondence with a width of a third recording sheet, the width of the third recording sheet being greater than that of the second recording sheet.

According to an aspect 118 depending from the aspect 110, the plurality of the container portions is arrayed with each other in the conveyance direction of the recording sheet.

According to an aspect 119 depending from the aspect 110, the fixing device further includes a plurality of grounding portions corresponding to respective ones of the container portions, each of the plurality of grounding portions being configured to ground fixing solution in the corresponding container portions.

According to an aspect 120 device depending from the aspect 119, the fixing device further includes a plurality of switches provided for respective ones of the plurality of the grounding portions, each of the plurality of switches being configured to be switched between a first state where the fixing solution in the corresponding container portion is grounded and a second state where the fixing solution in the corresponding container portion is not grounded. In a case where the fixing solution of a prescribed container portion is to be sprayed, the controller is configured to control the switch corresponding to the prescribed container portion to the second state. In a case where the fixing solution of the prescribed container portion is not to be sprayed, the controller is configured to control the switch corresponding to the prescribed container portion to the first state.

According to an aspect 121 depending from the aspect 110, the fixing device further includes: a fixing solution cartridge configured to accommodate therein the fixing solution; a tank configured to receive the fixing solution from the fixing solution cartridge and to supply the fixing solution to the plurality of container portions; and a grounding portion configured to ground the fixing solution in the tank.

According to an aspect 122 depending from the aspect 110, the fixing device further comprises: a fixing solution cartridge configured to accommodate therein the fixing solution; a tank configured to receive the fixing solution from the fixing solution cartridge and to supply the fixing solution to the plurality of container portions; a plurality of pipes connecting the tank to respective ones of the plurality of container portions; and a plurality of electrically insulating valves provided for respective ones of the plurality of pipes. In a case where the fixing solution in a prescribed container portion is not to be sprayed, the controller is configured to close the valve corresponding to the prescribed container portion.

According to an aspect 123 depending from the aspect 110, numbers of nozzles provided for respective ones of the container portions are identical to each other.

According to an aspect 124 depending from the aspect 110, the container portions have shapes identical to each other.

According to an aspect 125 depending from the aspect 110, a nozzle pitch of the plurality of nozzles is within a range from 1 mm to 14 mm.

According to an aspect 126 depending from the aspect 1, the fixing device further includes: a pressure applying portion configured to apply pressure to the fixing solution in the container portion; a temperature sensor configured to detect a temperature; and a controller configured to determine a value of a pressure to be applied to the fixing solution on a basis of the temperature detected by the temperature sensor.

According to an aspect 127 depending from the aspect 126, the fixing device further includes a storage configured to store a pressure table in which pressure corresponding to temperature is set. The controller is configured to determine the value of the pressure on a basis of the pressure table.

According to an aspect 128 depending from the aspect 127, the pressure in the pressure table is set corresponding to the temperature and a target amount of spray of the fixing solution.

According to an aspect 129 device depending from the aspect 128, the pressure in the pressure table is set so that the pressure to be applied to the container portion increases as the temperature decreases.

According to an aspect 130 depending from the aspect 129, the pressure in the pressure table includes: a first pressure required for spraying the target amount and within a pressure range enabling a state of spray to be normal; and a second pressure lower than a pressure required for spraying the target amount and within the pressure range enabling a state of spray to be normal.

According to an aspect 131 depending from the aspect 130, the second pressure is equal to a maximum pressure capable of maintaining Tayler cones of the fixing solution at tip ends of the plurality of nozzles.

According to an aspect 132 depending from the aspect 130, the pressure in the pressure table includes: a first pressure being required for spraying the target amount and within the pressure range enabling a state of spray to be normal; and a third pressure being higher than a pressure required for spraying the target amount and within the pressure range enabling a state of spray to be normal.

According to an aspect 133 depending from the aspect 132, the third pressure is equal to a minimum pressure capable of maintaining Tayler cones of the fixing solution at tip ends of the plurality of nozzles.

According to an aspect 134 depending from the aspect 130, the controller is configured to: set a first number of nozzles to be operated in a case where the first pressure is set as the pressure; and set a second number of nozzles to be operated in a case where the second pressure is set as the pressure, the second number being greater than the first number.

According to an aspect 135 depending from the aspect 132, the controller is configured to: set a first number of nozzles to be operated in a case where the first pressure is set as the pressure; and set a third number of nozzles to be operated in a case where the third pressure is set as the pressure, the third number being smaller than the first number.

According to an aspect 136 depending from the aspect 132, in the pressure table, a pressure for the target amount set to a first amount is lower than a pressure for the target amount set to a second amount in a case where a temperature is within a prescribed range, the second amount being greater than the first amount.

According to an aspect 137 depending from the aspect 136, in the pressure table, the pressure used for the target amount set to the first amount is higher than the pressure for the target amount set to the second amount in a case where a temperature is outside of the prescribed range, the second amount being greater than the first amount.

According to an aspect 138 depending from the aspect 128, prior to reception of print instruction, the controller is configured to determine a pressure value and to control the pressure applying portion to apply pressure to have the pressure value to the fixing solution in the container portion.

According to an aspect 139 depending from the aspect 126, the fixing device further includes a humidity sensor configured to detect a humidity. The controller is configured to determine an electric current value to be flowing in the fixing solution on a basis of the temperature detected by the temperature sensor and the humidity detected by the humidity sensor.

According to an aspect 140, depending from the aspect 139, further the fixing device includes a storage configured to store an electric current value table in which an electric current value is set corresponding to temperature and humidity. The controller is configured to determine the electric current value on a basis of the electric current value table.

According to an aspect 141 depending from the aspect 140, the fixing device further includes an electric current sensor configured to detect an electric current flowing in the fixing solution. The controller is configured to control voltage such that the electric current value detected by the electric current sensor becomes the determined electric current value.

According to an aspect 142, depending from the aspect 140, the storage is further configured to store a plurality of electric current value tables in correspondence with respective ones of target amounts of the fixing solution. The controller is configured to select the electric current value table on a basis of the target amount.

According to an aspect 143 depending from the aspect 142, the controller is configured to determine the target amount in accordance with a density of an image.

According to an aspect 144 depending from the aspect 126, the temperature sensor is capable of detecting temperature around the fixing device.

According to an aspect 145 depending from the aspect 126, the temperature sensor is capable of detecting a temperature of the fixing solution.

According to an aspect 146 depending from the aspect 126, the potential difference generating portion includes: a first electrode in contact with the fixing solution in the container portion and configured to apply voltage to the fixing solution; and a second electrode spaced away from the nozzle, and configured to generate an electric field between the second electrode and a tip end of the nozzle.

According to an aspect 147 depending from the aspect 1, the fixing device further includes a pressure applying portion configured to apply pressure to the fixing solution to supply the fixing solution to a tip end of the nozzle; and a controller configured to control voltage to be applied to the potential difference generating portion and control pressure to be applied to the fixing solution. In a case where spraying the fixing solution is stopped, the controller is configured to perform a voltage reduction process after starting a pressure reduction process. In the pressure reduction process, the controller controls the pressure applying portion to reduce application of the pressure to the fixing solution. In the voltage reduction process, the controller controls the potential difference generating portion to reduce a voltage to be applied to the fixing solution from a voltage applied to the fixing portion at a time of start of the pressure reduction process.

According to an aspect 148 depending from the aspect 147, the controller is configured further to determine whether the spraying the fixing solution is stopped after starting the pressure reduction process. The controller performs the voltage reduction process in a case where it is determined that the spraying the fixing solution is stopped.

According to an aspect 149 depending from the aspect 148, the controller is configured further to determine whether the electric current flowing in the potential difference generating portion is smaller than or equal to a prescribed value, and to determine the stop of the spraying in a case where it is determined that the electric current flowing in the potential difference generating portion is smaller than or equal to the prescribed value.

According to an aspect 150 depending from the aspect 148, the controller is configured to determine whether a prescribed time period has elapsed after performing the pressure reduction process, and to determine the stop of the spraying in a case where it is determined that the prescribed time period has elapsed.

According to an aspect 151 depending from the aspect 147, the controller is configured to control the pressure to be smaller than a meniscus withstanding pressure in the pressure reduction process.

According to an aspect 152 depending from the aspect 147, the controller is configured to start the pressure reduction process before an upstream end of an image on a last page in a print job is moved past the spraying region of the fixing solution.

According to an aspect 153 depending from the aspect 147, the controller is configured to perform the pressure reduction process after an upstream end of an image on a last page in a print job is moved past the spraying region of the fixing solution.

According to an aspect 154 depending from the aspect 147, the controller is configured to start the pressure reduction process and then to perform the voltage reduction process in a case where sheet jamming occurs.

According to an aspect 155 depending from the aspect 147, the pressure applying portion includes a pump configured to apply pressure to a gas contained in the fixing head.

According to an aspect 156 depending from the aspect 147, the controller is configured to maintain the voltage at a constant voltage during a period from starting the pressure reduction process to starting the voltage reduction process.

According to an aspect 157 depending from the aspect 147, the potential difference generating portion includes: a first electrode in contact with the fixing solution in the container portion; and a second electrode positioned spaced away from the nozzle.

According to an aspect 158 depending from the aspect 1, further includes: a pressure applying portion configured to apply pressure to the fixing solution; and a controller configured to control voltage to be applied to the potential difference portion, and control pressure to be applied to the fixing solution. The controller is configured to perform: a fixing spray process in which the pressure applying portion applies a first pressure to the fixing solution and voltage is applied to the potential difference generating portion to spray the fixing solution from the nozzle toward the recording sheet; and a droplet removal process in which voltage is applied to the potential difference generating portion while the pressure applying portion applies a second pressure lower than the first pressure to the fixing solution in a case where the fixing spray process is not performed.

According to an aspect 159 depending from the aspect 158, the controller is configured to perform the droplet removal process prior to the fixing spray process.

According to an aspect 160 depending from the aspect 159, the second pressure is not more than a meniscus withstanding pressure.

According to an aspect 161 device depending from the aspect 159, the controller is configured to perform voltage application for a first time period in the droplet removal process.

According to an aspect 162 depending from the aspect 159, the controller is configured to start the fixing spray process by altering the pressure from the second pressure to the first pressure after the voltage application for the first time period is performed in the droplet removal process.

According to an aspect 163 depending from the aspect 159, the controller is configured to start the fixing spray process by altering the pressure from the second pressure to the first pressure in a case where a non-flowing state continues for a second time period in the droplet removal process, the non-flowing state being a state where electrical current does not flow in the potential difference generating portion.

According to an aspect 164 depending from the aspect 159, the controller is configured to perform the droplet removal process on a basis of an input of a print job.

According to an aspect 165 depending from the aspect 159, the controller is configured not to perform the droplet removal process in a case where a third time period elapses from a termination of a previous fixing spray process.

According to an aspect 166 depending from the aspect 158, a voltage applied to the potential difference generating portion in the droplet removal process is within a range of voltage applied in the fixing spray process.

According to an aspect 167 depending from the aspect 158, the controller is configured further to perform the droplet removal process after a purging process is performed, wherein in the purging process, the fixing solution is discharged outside from the nozzle by application of pressure.

According to an aspect 168 depending from the aspect 158, the pressure applying portion comprises a pump configured to apply pressure to a gas contained in the fixing head.

According to an aspect 169 depending from the aspect 158, the potential difference generating portion comprises a first electrode in contact with the fixing solution, and a second electrode facing the nozzle.

What is claimed is:

1. A fixing device for fixing a developing agent image on a sheet, the fixing device comprising:

a fixing head configured to spray fixing solution;

a first electrode; and a second electrode, wherein the fixing head includes:

a casing having a surface and a container, the surface opposing the second electrode, the container being formed with interior space of the casing, the container being configured to contain the fixing solution; and a plurality of nozzles in communication with the container, the plurality of nozzles configured to spray the fixing solution toward the developing agent image on the sheet, each of the plurality of nozzles extending from the surface toward the second electrode and protruding to outside of the casing, wherein the second electrode is spaced away from the plurality of nozzles, and wherein the first electrode is configured to apply a voltage to the fixing solution contained in the container which is in communication with each of the plurality of nozzles, and a first portion of the first electrode is positioned in the container.

2. The fixing device according to claim 1, wherein the first portion of the first electrode is positioned in the fixing solution contained in the container.

3. The fixing device according to claim 1, wherein the first electrode penetrates the container.

4. The fixing device according to claim 3, wherein the first electrode penetrates a top wall of the container.

5. The fixing device according to claim 1, wherein the second electrode is configured to generate an electric field between the second electrode and the plurality of nozzles.

6. The fixing device according to claim 5, wherein the second electrode is configured to generate an electric field between the second electrode and a tip end of the plurality of nozzles.

7. The fixing device according to claim 1, wherein the second electrode is positioned below the plurality of nozzles.

8. The fixing device according to claim 1, wherein the plurality of nozzles is positioned between the first electrode and the second electrode.

9. The fixing device according to claim 1, further comprising:

a pressure applying portion configured to apply pressure to the fixing solution in the container.

10. The fixing device according to claim 1, further comprising:

a storage portion configured to accumulate the fixing solution sprayed from the plurality of nozzles.

11. The fixing device according to claim 10, wherein the storage portion is positioned below the plurality of nozzles.

12. The fixing device according to claim 10, wherein the storage portion has an opening allowing entry of the fixing solution sprayed from the plurality of nozzles.

13. The fixing device according to claim 12, wherein a length of the opening of the storage portion is greater than a length of the second electrode.

14. The fixing device according to claim 10, wherein the second electrode is fixed to a portion of the storage portion.

15. The fixing device according to claim 14, further comprising a support portion being positioned in the storage portion, and wherein the second electrode is fixed to the portion of the storage portion via the support portion.

16. An image forming apparatus comprising:

a fixing device for fixing a developing agent image on a sheet, the fixing device comprising:

a fixing head configured to spray fixing solution;

a first electrode; and a second electrode, wherein the fixing head includes:

a casing having a surface and a container, the surface opposing the second electrode, the container being formed with interior space of the casing, the container being configured to contain the fixing solution; and a plurality of nozzles in communication with the container, the plurality of nozzles configured to spray the fixing solution toward the developing agent image on the sheet, each of the plurality of nozzles extending from the surface toward the second electrode and protruding to outside of the casing, wherein the second electrode is spaced away from the plurality of nozzles, and wherein the first electrode is configured to apply a voltage to the fixing solution contained in the container which is in communication with each of the plurality of nozzles, and a first portion of the first electrode positioned in the container.

17. The image forming apparatus according to claim 16, further comprising a controller including a voltage applying portion, wherein a second portion of the first electrode connects to the controller, and wherein the second portion is positioned outside the container.

18. The image forming apparatus according to claim 16, further comprising a controller including a voltage applying portion, wherein the controller is configured to determine a spraying amount of the fixing solution sprayed from the plurality of nozzles per unit time based on a value of a current flowing through the first electrode.

19. An image forming apparatus comprising:

a fixing device for fixing a developing agent image on a sheet, the fixing device comprising:

a container configured to contain fixing solution;

a plurality of nozzles in communication with the container, the nozzle configured to spray the fixing solution toward the developing agent image on the sheet;

a first electrode configured to apply a voltage to the fixing solution contained in the container; and a second electrode spaced away from the nozzle; and a pressure applying portion configured to apply pressure to the fixing solution in the container; and a controller configured to control voltage to be applied to the first electrode and control pressure to be applied to the fixing solution by using the pressure applying portion, wherein a first portion of the first electrode is positioned in the container, wherein in a case where spraying the fixing solution is stopped, the controller is configured to perform a voltage reduction process after starting a pressure reduction process, wherein in the pressure reduction process, the controller controls the pressure applying portion to reduce application of pressure to the fixing solution, and wherein in the voltage reduction process, the controller controls the first electrode to reduce a voltage to be applied to the fixing solution from a voltage applied to the fixing solution at a time of start of the pressure reduction process.

* * * * *